US012584316B2

(12) United States Patent
van Lierop et al.

(10) Patent No.: US 12,584,316 B2
(45) Date of Patent: Mar. 24, 2026

(54) CANTILEVER UMBRELLA

(71) Applicant: ZHEJIANG ZHENGTE CO., LTD., Linhai (CN)

(72) Inventors: Patrick van Lierop, Linhai (CN); Younghui Chen, Linhai (CN)

(73) Assignee: ZHEJIANG ZHENGTE CO., LTD., Linhai (CN)

( * ) Notice: Subject to any disclaimer, the term of this patent is extended or adjusted under 35 U.S.C. 154(b) by 223 days.

(21) Appl. No.: 18/424,539

(22) Filed: Jan. 26, 2024

(65) Prior Publication Data

US 2024/0306779 A1 Sep. 19, 2024

Related U.S. Application Data

(60) Provisional application No. 63/441,741, filed on Jan. 27, 2023.

(51) Int. Cl.
*A45B 23/00* (2006.01)
*A45B 25/06* (2006.01)
(Continued)

(52) U.S. Cl.
CPC ..... *A45B 23/00* (2013.01); *A45B 25/06* (2013.01); *A45B 25/08* (2013.01);
(Continued)

(58) Field of Classification Search
CPC ..... A45B 25/06; A45B 25/08; A45B 25/14; A45B 2023/0031; A45B 2023/0043
(Continued)

(56) References Cited

U.S. PATENT DOCUMENTS 6,113,054 A 9/2000 Ma
6,173,721 B1 1/2001 Mery
(Continued)

FOREIGN PATENT DOCUMENTS

CN 201076108 Y 6/2008
CN 201282795 Y 8/2009
(Continued)

OTHER PUBLICATIONS

WO, PCT/CN2024/074158 ISR and Written Opinion, May 8, 2024.

*Primary Examiner* — Robert Canfield
(74) *Attorney, Agent, or Firm* — ONE LLP

(57) ABSTRACT

Disclosed are example embodiments of a 5-device-in-one component box including a plurality of cranking-arm-wrench storage clips respectively molded onto said under-surface of a multi-function loss-preventing storing-and-or-ganizing lid-tray. The box includes a multi-link crank control arm wrench snap, a plurality of ground-securing-and-leveling-screws storage cavities, a plurality of Allen-wrench storage cavities; a plurality of Allen wrenches; a plurality of screws respectively stacked inside a second base-plate cover; a compartmentalized loss-preventing stor-ing-and-organizing inner-tray, a plurality of louver end-caps, a plurality of crank-handle-coupler storage-stem molded onto said compartmentalized loss-preventing storing-and-organizing inner-tray, a crank-handle coupler snap-locked onto said crank-handle-coupler storage-stem, a plurality of compression-locking-plates storage compartments, a plural-ity of compression-locking plates respectively inserted and secured to said compression-locking-plates storage compart-ments; a plurality of drill-bit clips respectively molded onto said compartmentalized loss-preventing storing-and-orga-nizing inner-tray; a drill bit snap-locked between said drill-
(Continued)

bit clips; and fourth base-plate cover stacked right side up on said third base-plate cover.

20 Claims, 310 Drawing Sheets

(51) Int. Cl.
*A45B 25/08* (2006.01)
*A45B 25/14* (2006.01)

(52) U.S. Cl.
CPC ..... *A45B 2023/0012* (2013.01); *A45B 2023/0018* (2013.01); *A45B 2023/0037* (2013.01)

(58) Field of Classification Search
USPC ..... 135/20.1, 20.3, 39
See application file for complete search history.

(56) References Cited

U.S. PATENT DOCUMENTS 6,367,494 B1 4/2002 Tung
6,374,840 B1 4/2002 Ma
6,446,650 B1 9/2002 Ma
6,478,037 B2 11/2002 Tung
6,591,848 B2 7/2003 Ma
6,810,892 B2 11/2004 Lai
6,827,321 B1 12/2004 Murren et al.
6,983,921 B1 1/2006 Rahmer
7,017,598 B2 3/2006 Nipke
7,156,114 B2 1/2007 Lo
7,188,633 B2 3/2007 Zerillo
7,207,343 B2 4/2007 Earnshaw et al.
7,290,742 B2 11/2007 Wang
7,334,590 B2 2/2008 Chang
7,406,976 B1 8/2008 Chan et al.
7,556,051 B2 7/2009 Lai
7,614,600 B1 11/2009 Smith et al.
7,641,165 B2 1/2010 Li
7,784,761 B2 8/2010 Ma
7,836,908 B2 11/2010 Sy-Facunda
7,886,755 B2 2/2011 Tung
7,891,633 B2 2/2011 Ying
D638,622 S 5/2011 He
7,958,901 B2 6/2011 Lai
7,980,261 B2 * 7/2011 Glatz ..... A45B 19/04 135/21
8,066,021 B2 11/2011 Ma
8,069,868 B2 12/2011 Kuelbs
8,087,420 B1 1/2012 Lukacsy
8,104,492 B2 1/2012 Dan
8,291,923 B2 10/2012 Young et al.
8,522,804 B1 9/2013 Tung
8,632,045 B2 1/2014 Ma
8,636,020 B2 1/2014 Li
8,657,246 B2 2/2014 Ma
8,807,513 B2 8/2014 Violin
8,875,350 B2 11/2014 Bukovitz
8,919,361 B2 12/2014 Ma
8,919,722 B2 12/2014 Ma
8,985,129 B2 3/2015 Li et al.
9,200,655 B2 12/2015 Pan
9,220,325 B2 12/2015 Ma
9,237,785 B2 1/2016 Ma
9,271,550 B2 3/2016 Xiong
9,289,038 B2 * 3/2016 Ma ..... A45B 25/08
9,358,995 B2 6/2016 Allos et al.
9,540,840 B2 1/2017 Ma
9,565,907 B2 2/2017 Ma
9,585,447 B1 3/2017 Rudder et al.
9,655,416 B1 5/2017 Clarke
9,930,942 B2 * 4/2018 Ma ..... A45B 23/00
10,017,955 B2 7/2018 Ye
10,100,969 B1 10/2018 Zhu et al.
10,136,709 B2 11/2018 Ma
10,292,467 B2 5/2019 Akin et al.
10,376,027 B1 8/2019 Kuelbs
10,426,234 B1 10/2019 Violin
10,508,465 B2 12/2019 Pan et al.
10,537,161 B1 1/2020 Violin
10,711,481 B2 7/2020 Zhu et al.
10,758,016 B1 9/2020 Wang
10,765,185 B1 9/2020 Wengerd
10,813,425 B2 10/2020 Shen et al.
10,874,183 B1 * 12/2020 Wang ..... A45B 9/02
D971,707 S 12/2022 Van Lierop et al.
11,523,664 B2 * 12/2022 Fisher ..... A45B 25/14
12,408,740 B2 * 9/2025 Browne ..... A45B 25/08
2006/0054206 A1 3/2006 Bilotti
2006/0081277 A1 4/2006 Liu
2007/0080277 A1 4/2007 Chen
2010/0095991 A1 * 4/2010 Glatz ..... A45B 19/04 135/20.1
2013/0146739 A1 6/2013 Zhao
2015/0068566 A1 * 3/2015 Ma ..... A45B 23/00 135/20.1
2015/0068567 A1 * 3/2015 Ma ..... A45B 23/00 135/20.1
2015/0075574 A1 * 3/2015 Ma ..... A45B 25/08 135/20.1
2015/0305453 A1 10/2015 Gatto-Weising
2015/0351505 A1 12/2015 Ostrander
2020/0063462 A1 2/2020 Kong
2020/0397103 A1 * 12/2020 Glatz ..... A45B 25/14
2021/0079956 A1 3/2021 Xie
2021/0161262 A1 6/2021 Jin
2021/0251352 A1 8/2021 Fisher
2021/0386166 A1 12/2021 Luo
2022/0195749 A1 6/2022 Luo
2023/0346090 A1 * 11/2023 Volin ..... A45B 25/00

FOREIGN PATENT DOCUMENTS

CN 203435821 U 2/2014
CN 307439580 S 7/2022
EP 2845509 A1 * 3/2015 ..... A45B 23/00
EP 2850962 A1 * 3/2015 ..... A45B 23/00
WO WO 2016/109598 A1 7/2016
WO WO 2021/034346 A1 2/2021

* cited by examiner

CANTILEVER UMBRELLA

CROSS REFERENCE TO RELATED APPLICATIONS

The present application claims priority to U.S. Patent Application No. 63/441,741, filed Jan. 27, 2023, which is incorporated herein by reference in its entirety.

TECHNICAL FIELD

The disclosure relates generally to the field of patio equipment, and specifically and not by way of limitation, some embodiments are related to a cantilever umbrella or cantilever umbrella components.

BACKGROUND

A number of umbrellas have been introduced in the past. Some examples are provided below.

U.S. Pat. No. 6,113,054, issued 2000 Sep. 5, to Oliver Joen-an Ma describes a patio umbrella base has a base housing that has a central opening, and an interior wall configured to define an interior space, with a shaft extending from the central opening. A first weight is secured to the interior wall of the base housing and retained inside the interior space, and a second weight is removably secured to the base housing and retained inside the interior space.

U.S. Pat. No. 6,173,721, issued 2001 Jan. 16, to Jhoni Mery describes a patio umbrella with a pole that has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

U.S. Pat. No. 6,367,494, issued 2002 Apr. 9, to Benson Tung describes a sunshade base comprising a base adapted to engage with a support tube of a sunshade and two wheel assemblies each having a mounting plate and at least one wheel. The mounting plate is pivotally mounted to the base. The wheel is rotatably mounted to the mounting plate. The mounting plate is pivotable between a storage position in which the wheel does not contact the ground and an operative position in which the wheel is located on the ground and thus raises the base above the ground.

U.S. Pat. No. 6,374,840, issued 2002 Apr. 23, to Oliver Joen-An Ma describes a patio umbrella which has a pole, a plurality of primary ribs extending from the pole, a hub slidably supported on the pole, and a plurality of secondary ribs, each secondary rib having a first end pivotally coupled to the hub and a second end pivotally coupled to one of the primary ribs. The patio umbrella has a ledge positioned on the pole, and a spring slidably supported on the pole between the hub and the ledge. The patio umbrella can also have at least one stretcher having a first end pivotally coupled to one of the secondary ribs, and a second end pivotally coupled to the ledge.

U.S. Pat. No. 6,446,650, issued 2002 Sep. 10, to Oliver Joen-An Ma describes a tilt device for a patio umbrella which has a collar that is provided for slidable movement around the exterior surface of a first pole section of the patio umbrella, and a vertical spring positioned inside the first pole section and having an upper end provided in a fixed position. The tilt device further includes a coupling leg coupled to the collar and positioned inside the first pole section, with the coupling leg having a top edge that abuts the lower end of the vertical spring. The tilt device also has a guide track positioned inside a second pole section of the patio umbrella, with a bottom edge of the coupling leg positioned inside the guide track for reciprocating movement therein.

U.S. Pat. No. 6,478,037, issued 2002 Nov. 12, to Pai Tung describes a sunshade including a supporting rod, a canopy support frame, and a canopy. An adjusting sleeve is slidably mounted around the supporting rod. A holding sleeve is pivotally connected to an upper end of the supporting rod. An arcuate tube is slidably extended through the holding sleeve. An elbow is mounted to a first end of the arcuate tube and a reel is mounted to a second end of the arcuate tube. A connecting rod is connected between the second end of the arcuate tube and the adjusting sleeve. An anchor is provided to be releasably engaged in an anchor room in the elbow to reliably retain the canopy support frame in a desired tilting angle relative to the supporting rod. The arcuate tube and the supporting rod can be folded to further reduce the overall volume of the sunshade.

U.S. Pat. No. 6,591,848, issued 2003 Jul. 15, to Mark Joen Shen Ma describes a parasol control device including a shaft rotatably received in aligned holes defined in a central rod of the parasol. A handle is coupled to a first end of the shaft for manually rotating the shaft. A rope is fastened to the shaft whereby when the shaft is rotated, the rope is wound to/unwound from the shaft for opening/closing the parasol. A ratchet wheel defines a central bore tightly fit over the shaft whereby a friction is present between the ratchet wheel and the shaft. A block is attached to the rod and defines a bore for rotatably supporting the shaft. A blind hole is defined in the block with a spring biased pin received in the blind hole. A free end of the pin engages with the teeth of the ratchet for generating consecutive impact sounds when the shaft is rotated in a first direction to open the parasol. When the shaft is rotated in an opposite second direction to close the parasol, the ratchet wheel is prevented from rotation by the pin. With a sufficient large torque applied to the shaft, the friction is overcome, and the shaft is rotated in the second direction to release the rope for closing the parasol.

U.S. Pat. No. 6,810,892, issued 2004 Nov. 2, to Jin Sheng Lai describes a self-tilting connector mechanism of an umbrella. The mechanism comprises a seat, a tilting head seat, a pulling shaft, a steel cable and a linking shaft. The seat and the tilting head seat are each provided with a pulley. Using a locking means to position the linking shaft between the tilting head seat and the pulling shaft, such that the pulling shaft is inserted into the through hole of the small tubular section of the seat, and a restoration spring is provided between the pulling shaft and the tubular section, and a steel cable is wound at the pulleys of the seat and the tilting head seat, and the steel cable is mounted to the handle rotating shaft of the main shaft of the umbrella, by rotating adjustment of the hand, the opening, tilting, reverse-tilting and closing of umbrella can be obtained.

U.S. Pat. No. 6,827,321, issued 2004 Dec. 7, to Andrew J. Murren describes a wheeled tree stand apparatus for allowing the moving of a tree such as a Christmas tree to facilitate the decorating thereof. The wheeled tree stand apparatus includes a cone-shaped base member having top, bottom and side walls, and also having an opening being disposed in the top wall thereof, and further having a tree trunk-receiving bore being disposed therein through the opening; and also includes a wheel assembly being retractably disposed in the cone-shaped base member and including wheel support members, and also including bracket members being attached to the wheel support members, and further including wheel members being pivotally mounted to the bracket members; and further includes a wheel locking assembly including latches being engageable to the wheel support members for locking the wheel members in ground-engagement positions; and also includes a fastening assembly being attached to the cone-shaped base member for fastening about a portion of a tree being supported upon the cone-shaped base member.

U.S. Pat. No. 6,983,921, issued 2006 Jan. 10, to Paul G. Rahmer describes a Christmas tree stand with integral, adjustable, and lockable rolling casters. A series of thumb operated bolts hold the tree and a central reservoir to hold water to help the tree remain green. A series of four or five casters are provided around the bottom perimeter of the stand. Each caster is adjustable in height, which allows the user to set the tree straight or plumb.

U.S. Pat. No. 7,017,598, issued 2006 Mar. 28, to Mike Nipke describes a powered patio pole umbrella. The powered patio pole umbrella receives power from an external outlet and provides power to a plurality of power hubs including electrical outlets positioned vertically within the central pole of the umbrella. Consumers may plug electrical devices into the electrical outlets in the power hubs. The power hubs are sealed for moisture and a ground fault circuit interrupter is provided for additional safety.

U.S. Pat. No. 7,156,114, issued 2007 Jan. 2, to Chong-Yi Lo describes an angle adjusting device for the canopy of a hang umbrella, which includes a cantilever divided into a left-sectional cantilever and a right-sectional cantilever, with a connecting plug inserted in between the interiors of the left-sectional and the right-sectional cantilever. The left-sectional cantilever is secured with one end of the connecting plug and the right-sectional cantilever fitted around the other end of the connecting plug by a tightening bolt. By so designing, the outer portion of the cantilever, which is connected with the canopy, can be rotated and adjusted in different angles. Thus, the canopy of the hang umbrella can be adjusted and turned forward and backward as well as leftward and rightward.

U.S. Pat. No. 7,188,633, issued 2007 Mar. 13, to Michael Anthony Zerillo describes an electric opening and closing device that retrofits to new and existing patio and market umbrellas. Such umbrellas are commonly used to provide shade outdoors, and are usually installed through a hole in the center of a table or mounted freestanding in a support base. The invention consists of a low voltage reversible electric motor that attaches to the upper end of the umbrella mast, a cable reel driven by the motor, a length of cable with one end affixed to the cable reel and the opposite end affixed to the umbrella yoke, electric control switch, remote control means, and electric supply means.

U.S. Pat. No. 7,207,343, issued 2007 Apr. 24, to John Michael Earnshaw describes an umbrella frame including an upper shaft part 2 and a lower shaft part 1, the two parts being connected by a tilting joint to enable the upper part to tilt with respect to the lower, a runner 4 sliding on the lower shaft part 1, for spreading a cover on the umbrella frame into its unfurled configuration when slid upwardly, and an actuator connected to the upper shaft part 2 and passing down the shaft, through or past the runner 4 when in its upper position with the umbrella open, to an operating location on the lower shaft part 1, the actuator being accessible at its lower end to allow an operator to tilt the upper shaft part 2.

U.S. Pat. No. 7,290,742, issued 2007 Nov. 6, to Dennis H. Wang describes an adjustable support tool for either vertical or horizontal mounting. The adjustable support tool comprises a rod slidably received by a tube. The rod has depressions formed thereon. A threaded portion is coupled to the tube and a hand grip tightener is turnable engaged to the threaded portion for adjusting their overall length. A ratchet housing is resiliently engaged to the hand grip tightener. The ratchet housing has a ratchet for securerly engaging to one of the depressions, a wheel spring for rollably engaging to another one of the depressions, a safety lock pivotally engaged to the ratchet housing for prevent access to the ratchet when locked. When the rod is slided, the wheel spring pushes up the ratchet from its underside to loosen its engagement. The loosened ratchet allows the rod to slide more smoothly, while protecting the painted surface on the rod. Both the ratchet and threaded portion provide adjustment to the overall length of the support tool.

U.S. Pat. No. 7,334,590, issued 2008 Feb. 26, to Wei-Chen Chang describes an anti-slip opening and closing device for an umbrella, which comprises a rope reeled on a roller positioned on a pole of the umbrella. The roller is screwed with a reel having a friction disc. The friction disc is set inside a notch of a ratchet wheel. An elastic accessory is positioned between the roller and the ratchet wheel for pushing the friction disc to lean against the ratchet wheel. A block part is disposed to resist the ratchet wheel reversing. A bearing positioned at a side of the reel leans against beads of a cap positioned on the pole. When the reel is rotated clockwise, the roller and the reel are screwed together, and the rope is reeled by the roller. Hence, the umbrella is opened due to the pull of the rope, and the roller is not reversed by the obstruction of the block part. On the other hand, the reel is backed from the roller by rotating counter-clockwise and leans against the beads. The friction between the friction disc and the ratchet wheel becomes minor if the reel keeps rotating. Then, the rope is released, and the umbrella is folded gradually. If the reel stops rotating, the roller also stops rotating because of the friction produced between the friction disc and the ratchet wheel.

U.S. Pat. No. 7,406,976, issued 2008 Aug. 5, to Ping Chiu Chan describes a winch for opening and closing an umbrella including a winch drum mounted within an elongate support tube of the umbrella, to rotate about a longitudinal axis thereof. A threaded shaft is coaxial and rotationally fast with the drum. A line is fixed at one end to the drum and at other end to a sleeve, to which struts are pivotally connected, each strut being associated with a canopy-supporting rib. A travelling nut is engaged with the threaded shaft and blocked for rotation relative to the tube. A guide is fixed to the nut for guiding the line onto the drum, and a motor is also enclosed in the support tube and drivingly connected to the winch drum.

U.S. Pat. No. 7,556,051, issued 2009 Jul. 7, to Jin-Sheng Lai describes a suspension umbrella including an upright support post, a sliding seat, a control shaft, an umbrella frame, and a drive cord. The umbrella frame includes a shank, a plurality of ribs, a plurality of spreaders and a runner. Thus, the umbrella frame is expanded when the control shaft is movable toward the umbrella frame and is folded when the control shaft is movable outwardly relative to the umbrella frame, so that the umbrella frame is expanded and folded easily and conveniently. In addition, the user only needs to operate the control handle to move the control shaft so as to expand or fold the umbrella frame easily and quickly, thereby greatly facilitating the user operating the suspension umbrella.

U.S. Pat. No. 7,614,600, issued 2009 Nov. 10, to James C. Smith describes an umbrella base comprised of a body portion containing a power source for powering umbrella lights or electrical devices or appliances used around the umbrella or other furniture accessory held by the base. A power console is provided for use on or above the base to provide connectivity to the power supply.

U.S. Pat. No. 7,641,165, issued 2010 Jan. 5, to Wanda Ying Li describes an adjustable rotation base including a base housing and a transportation arrangement. The base housing has a bottom side, an upper side for coupling with the supporting post to support the outer umbrella in an upright manner, and a receiving cavity indently formed on the bottom side of the base housing, wherein the base housing includes a stationary unit provided at the bottom side for sitting on the ground surface in a stationary manner, and a plurality of transferring wheels rotatably supported at the bottom side of the base housing. The transportation arrangement is provided at the base housing to operate the base housing between an idle mode and a transportation mode in which the stationary unit is upwardly lifted to allow the transferring wheels being sitting on the ground surface, such that the base housing is adapted to be transported on the ground surface via the transferring wheels.

U.S. Pat. No. 7,784,761, issued 2010 Aug. 31, to Oliver Joen-an Ma describes a base assembly that includes a base and a coupler. The coupler includes a sleeve for receiving an umbrella pole, a lower portion comprising a side surface, and a locking member coupled with the side surface. The locking member is configured to move toward or away from a longitudinal axis of the sleeve such that the locking member engages the base to prevent rotation of the coupler relative to the base.

U.S. Pat. No. 7,891,633, issued 2011 Feb. 22, to Wanda Ying Li describes an adjustable rotation base including a base housing and a transportation arrangement. The base housing has a bottom side, an upper side for coupling with the supporting post to support the outer umbrella in an upright manner, and a receiving cavity indently formed on the bottom side of the base housing, wherein the base housing includes a stationary unit provided at the bottom side for sitting on the ground surface in a stationary manner, and a plurality of transferring wheels rotatably supported at the bottom side of the base housing. The transportation arrangement is provided at the base housing to operate the base housing between an idle mode and a transportation mode in which the stationary unit is upwardly lifted to allow the transferring wheels being sitting on the ground surface, such that the base housing is adapted to be transported on the ground surface via the transferring wheels.

U.S. Pat. No. 7,836,908, issued 2010 Nov. 23, to Ron Sy-Facunda describes a canopy with an automatic roof structure having improved structural stability. The canopy comprises a plurality of vertical support posts connected by trusses. A plurality of roof support rods extend from the vertical support posts to a central hub. At least one of the roof support rods has a cantilever support extending from the associated slide or thereabouts to a pivot on the roof support rod. The canopy also comprises central truss supports and stubs extending from the connection of the lateral trusses to the central hub. The canopy has an expanded, open configuration and a collapsed, closed configuration.

U.S. Pat. No. 7,886,755, issued 2011 Feb. 15, to Benson Tung describes a side-supporting sunshade including a mast and an adjusting sleeve slideably mounted on the mast in a vertical direction. A lower end of a supporting arm is pivotably connected to the adjusting sleeve. A linking rod includes an end pivotably connected to an upper end of the mast. The other end of the linking rod is pivotably connected to an intermediate portion of the supporting arm. A canopy support frame is coupled to an upper end of the supporting arm and supports a canopy. A cable includes a first end fixed to an axle rotatably mounted in the adjusting sleeve and a second end fixed to the canopy support frame. The cable is movable in a winding direction to fold the canopy when the axle rotates in a direction. The cable is movable in a releasing direction to unfold the canopy when the axle rotates in a reverse direction.

U.S. Pat. No. 7,958,901, issued 2011 Jun. 14, to Jin-Sheng Lai describes an umbrella including an upright post, a swing mechanism pivotally mounted on the upright post, a frame mounted on the swing mechanism to pivot in concert with the swing mechanism relative to the upright post, and a driving mechanism mounted on the upright post and connected with the swing mechanism to drive the swing mechanism to pivot relative to the upright post. Thus, the frame is rolled relative to the upright post to tilt leftward or rightward to adjust the inclined angle of the skeleton of the frame so as to provide a better shading effect.

U.S. Pat. No. 7,980,261, issued 2011 Jul. 19, to Adolf Gustav Glatz describes an invention originating with a mast on the upper end of which a locking and tiltable jib support is arranged. A jib is guided in the jib support such that said jib can be slid and fastened and carries a roof construction on the outer end thereof, wherein said roof construction can be extended like a canopy, fan, or frame. To make the extension and retraction of the jib easier, it is proposed that the jib support be designed with at least four guide and locking rollers, of which at least two engage in a left-handed track and two in a right-handed track of the jib.

U.S. Pat. No. 8,066,021, issued 2011 Nov. 29, to Oliver Joen-An Ma describes an umbrella assembly which comprises a canopy assembly and support rods connected by a hinge assembly. The hinge assembly allows the canopy assembly to alternate between both deployed and folded positions, as well as opened and closed, by a single tension member that can be controlled by an actuation device such as a crank. The hinge assembly can also interlock, stabilizing the canopy assembly.

U.S. Pat. No. 8,069,868, issued 2011 Dec. 2, to Gregory G. Kuelbs describes a lawn or patio umbrella with an integral lighting system that utilizes cold cathode ray tubes, light emitting diodes (LED's), or florescent lights, to provide relatively bright outdoor light for reading and other activities that require relatively high light intensities is provided. In one embodiment, a modular, electrically powered lawn or patio umbrella in which lighting systems, such as those utilizing cold cathode tubes, LED's, or florescent lights; cooling systems, such as those utilizing electric fans or misting systems; and motorized retraction systems; can be selectively interchanged is provided.

U.S. Pat. No. 8,087,420, issued 2012 Jan. 3, to Steven A. Lukacsy describes teachings generally directed to gravity-powered, and self-opening umbrella systems that can also be wind-resistant. As evidenced from the teachings provided herein, the systems can be designed in a variety of configurations. The umbrella system can include a counterweight and system of pulleys, where the system of pulleys includes class 1 and class 2 pulleys configured with the counterweight to gain a mechanical advantage in the normal operation of the umbrella. The umbrella can be, for example, a patio umbrella in which the mechanical advantage provides a self-opening of an umbrella canopy and ease-of-retracting of the canopy for a user. And, the system can also be dynamic, such that it's also resistant to external forces, such as the wind.

U.S. Pat. No. 8,104,492, issued 2012 Jan. 31, to Wu Wei Dan describes an adjustable offset umbrella which has a generally vertical main pole and a sliding member slidably mounted to the main pole. The sliding member includes a locking mechanism for securing it at a desired location along the main pole. One end of an arm is associated with the sliding member, and the other end supports an umbrella canopy. A winding mechanism is associated with the sliding member and moves with it. A line extends from the winding mechanism to the umbrella canopy. Operating the winding mechanism opens and closes the umbrella canopy, and moving the sliding member up or down the main pole adjusts the angle of the canopy with respect to the main pole.

U.S. Pat. No. 8,291,923, issued 2012 Oct. 23, to David Young describes an Apparatus and methods for holding and tilting an umbrella. The apparatus comprises at least one spring connected to an umbrella pole so that the spring(s) is extended or retracted when the pole angle of the umbrella is adjusted. The apparatus also comprises a pivot between an umbrella holder and a bracket that allows angular motion of the umbrella pole. The apparatus also comprises a rotary bearing capable of rotating around an axis of the umbrella pole. The spring(s) and the pivot can be connected to the rotary bearing. The present apparatus can also include a shade umbrella. Methods for tilting an umbrella are also provided.

U.S. Pat. No. 8,522,804, issued 2013 Sep. 3, to Benson Tung describes a sunshade (12) including a pole (111) rotatably receiving a screw rod (295) that can be rotated by operating a handle (213) to cause movement of a follower (277) in the pole (111) between a folded position, an unfolded position, and a tilted position. A runner (297) is mounted around the pole (111) and fixed to the follower (277) to move therewith. A pivotable member (383) is pivotably connected to a fixing member (363) fixed on an upper end (113) of the pole (111). Ribs (451) are pivotably mounted to a hub (439) fixed on the pivotable member (383). Stretchers (313) are pivotably mounted between the ribs (451) and the runner (297). The hub (439) and the ribs (451) are tilted when the pivotable member (383) is pivoted due to movement of the follower (277) from the unfolded position to the tilted position.

U.S. Pat. No. 8,632,045, issued 2014 Jan. 21, to Oliver Joen-an Ma describes a ratchet assembly including an elongated shaft, a gear housing, a ratcheting member, and an arm. The elongated shaft can have a gear and be supported by the gear housing to allow rotation about a primary axis of the shaft. The ratcheting member can mount in the housing and be biased toward the gear to engage with the gear hindering relative rotation about the shaft axis in a first direction and allowing rotation about the shaft axis in a second direction opposite the first direction. The ratcheting member can rotatably mount within the housing about a second axis. The arm can couple to the gear housing in a first configuration to provide torque to rotate the housing about the shaft axis in the first direction when the arm is pressed downward. The arm can also be coupled to the gear housing in a second configuration to rotate the housing about the shaft axis in a second direction opposite the first direction when the arm is pressed downward.

U.S. Pat. No. 8,636,020, issued 2014 Jan. 28, to Wanda Ying Li describes an outdoor umbrella including an awning frame, a supporting shaft and an adjustable rotation base including a base housing and a transportation arrangement. The base housing is arranged to couple with the supporting shaft to support the awning frame in an upright manner, and includes a plurality of transferring wheels. The transportation arrangement is provided at the base housing to operate the base housing between an idle mode and a transportation mode, wherein in the idle mode, the transferring wheels are suspendly lifted up to position above the bottom edge of the base housing such the base housing is sat on the ground surface in a stationary manner, wherein in the transportation mode, the base housing is lifted up by air pressure for allowing the transferring wheels to move out of the receiving cavity at a position below the bottom edge of the base housing.

U.S. Pat. No. 8,657,246, issued 2014 Feb. 25, to Oliver Joen-an Ma describes in a further embodiment, a method of controlling a base assembly. An actuation member can be pumped to deploy one or more wheels to lift a base assembly on said wheels. Further, a pin can be received in a holding portion on a semi-planar contoured surface in response to the pumping of the actuation member. The wheels can be held in a deployed position via the pin being held in the holding portion. Further pumping of the actuation member can separate the pin from the holding portion and retract the wheels from the deployed position.

U.S. Pat. No. 8,807,513, issued 2014 Aug. 19, to Dee Volin describes a multi-adjustable, rotating, and opposite-double-locking umbrella-stanchion system which is operated with one finger for oppositely double-locking and-unlocking the umbrella-supporting post of a crank-arm-operated umbrella to secure it in different positions. The system comprises a canopy system, a supporting post, a stanchion base, a U-shaped rotational lever, an actuator arm, a push rod, two opposite L-shaped locking arms, two opposite locking cleats, radial teeth, and two opposite tension springs for pushing the opposite locking cleats downward to oppositely double-lock the post and the canopy system, in place. The radial teeth are molded to the stanchion base. To operate the system, lift the U-shaped rotational lever with one finger to lift the opposite locking cleats to oppositely double-unlock them. Next, rotate the supporting post to a desired position. Then, release the U-shaped rotational lever to oppositely double-lock the opposite locking cleats between the radial teeth.

U.S. Pat. No. 8,875,350, issued 2014 Nov. 4, to Richard K. Bukovitz describes a reversible tip assembly for selectively connecting an extension pole/handle extension to tool handles having either compatible quick release lock mechanisms or conventional internally threaded sockets. The tip assembly comprises a body having oppositely extending rod-like tips at opposite ends of the body. One of the tips has a plurality of circumferentially spaced axially extending external thread segments. The other tip has an end portion that is compatible with quick release lock mechanisms.

U.S. Pat. No. 8,919,361, issued 2014 Dec. 30, to Oliver Joen-an Ma describes a ratcheting assembly which can include a housing, a ratcheting gear, a first ratchet pawl, a motion translation member, and a ratcheting actuation member. The ratcheting gear can rotatably mount within the housing and include a plurality of ratchet teeth and an eccentric opening. The eccentric opening can include a rotational center of the ratcheting gear. The first ratchet pawl can mount to the housing adjacent to the ratcheting gear to allow rotation in a first direction and to hinder rotation in a second direction opposite the first direction. The motion translation member can mount within the opening such that rotation of the ratcheting gear can cause a movement of the motion translation member via rotation of the eccentric opening. The ratcheting actuation member can mount to the housing and include a second ratchet pawl. The second ratchet pawl can mount to the ratcheting actuation member adjacent to the ratcheting gear such that actuation of the ratcheting actuation member in the first direction can cause a rotation of the ratcheting gear and actuation of the ratcheting actuation member in the second direction opposite the first direction does not cause a rotation of the ratcheting gear.

U.S. Pat. No. 8,919,722, issued 2014 Dec. 30, to Oliver Joen-an Ma describes a ratchet assembly including an elongated shaft, a gear housing, a ratcheting member, and an arm. The elongated shaft can have a gear and be supported by the gear housing to allow rotation about a primary axis of the shaft. The ratcheting member can mount in the housing and be biased toward the gear to engage with the gear hindering relative rotation about the shaft axis in a first direction and allowing rotation about the shaft axis in a second direction opposite the first direction. The ratcheting member can rotatably mount within the housing about a second axis. The arm can couple to the gear housing in a first configuration to provide torque to rotate the housing about the shaft axis in the first direction when the arm is pressed downward. The arm can also be coupled to the gear housing in a second configuration to rotate the housing about the shaft axis in a second direction opposite the first direction when the arm is pressed downward.

U.S. Pat. No. 8,985,129, issued 2015 Mar. 24, to Ren Li describes a sunshade umbrella capable of adjusting the umbrella surface angle, including an upright rod and an upright rod handle which moves up and down along the upright rod, wherein one end of the upright rod is connected with umbrella base, the other end of the upright rod is hinged with the connecting rod, the other end of the connecting rod is hinged with a circumferential fixed hanger rod, the hanger rod is hinged with the upright rod handle, an umbrella surface angle adjusting device is mounted on one end of the hanger rod, an executing device that takes the circumferential movement around the hanger rod is mounted on the other end of the hanger rod, and the executing device is connected with an upper umbrella plate. This umbrella has the following advantages: increased overall firmness of the sunshade umbrella, simple structure, and is convenient to operate.

U.S. Pat. No. 9,200,655, issued 2015 Dec. 1, to Lianzhang Pan describes a pole securement sleeve. The pole securement sleeve includes a tubular housing member having a sidewall defining an internal passageway configured to receive a pole therein; a clamping member, a portion of the clamping member disposed in the internal passageway of the tubular housing member, the clamping member configured to apply a compressive force about a portion of an outer periphery of the pole; and a clamping member adjustment means operatively coupled to the clamping member, the clamping member adjustment means together with the clamping member circumscribing an area configured to be intersected by the pole. When a moment or torque is applied to the clamping member adjustment means, a size of the area circumscribed by the clamping member adjustment means and the clamping member is adjusted. A pole securement system and an umbrella base assembly, each including the pole securement sleeve, are also disclosed herein.

U.S. Pat. No. 9,220,325, issued 2015 Dec. 29, to Oliver Joen-an Ma describes an umbrella that has a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is pivotally coupled with the second support member. The umbrella also has an enclosure disposed at the first end of the second support member. A canopy control mechanism is disposed in the enclosure to alter the configuration of the canopy.

U.S. Pat. No. 9,237,785, issued 2016 Jan. 19, to Oliver Joen-An Ma describes Umbrella assemblies configured to retract and extend, tilt side to side, and open and close. In some embodiments, the umbrella assembly can include a cantilevered beam. The umbrella assembly can further include a tilt mechanism operable to rotate the canopy frame. The umbrella assembly can include a clutch mechanism fixed to the cantilevered beam.

U.S. Pat. No. 9,271,550, issued 2016 Mar. 1, to Luo Xiong describes an adjustable umbrella, which includes: an umbrella base, a stand column, a sliding sleeve, a cross rod, an umbrella cover adjustment mechanism, a drawing rod, and an umbrella frame, wherein a top of the umbrella frame is rotatably attached to a top end of the cross rod through a rotating mechanism, a bottom joint of the cross rod is rotatably connected to the sliding sleeve, the umbrella frame has an elongated umbrella rib with a bottom end, the bottom end of the elongated umbrella rib is connected to the umbrella cover adjustment mechanism, the umbrella frame is rotatable by adjusting the umbrella cover adjustment mechanism. The sunshade is novel in appearance, and has strong practical performance and reasonable and practical structure.

U.S. Pat. No. 9,289,038, issued 2016 Mar. 22, to Oliver Joen-An Ma describes an umbrella that has a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is coupled with the second support member. The umbrella also has an enclosure disposed at the first end of the second support member. A canopy control mechanism is at least partially disposed in the enclosure to alter the configuration of the canopy.

U.S. Pat. No. 9,358,995, issued 2016 Jun. 7, to Khalid Mike Allos describes systems and methods providing a specialized dolly that works with a hydraulic floor jack and together the assembly performs the lifting and moving of vehicles with ease and efficiency. The configuration and design of the dolly enables a standard hydraulic floor jack to be positioned within a frame of the dolly in a stationary position. A handle of a hydraulic floor jack can then be used to maneuver the combination dolly/floor jack assembly with ease on the floor of the repair shop. The combination dolly/floor jack assembly can then be positioned under the undercarriage of a disabled vehicle and used to move the vehicle to a desired location with greatly-reduced rolling resistance. The dolly may be designed an d configured to have stationary low resistance front rear wheel assemblies, both of which provide for convenient maneuvering and steering. The dolly's wheel tracks (distance between front wheels) and its wheelbase length (distance between front and rear wheels) allows the dolly to be stable and significantly maneuverable, especially over or around potholes, slopes, and ramps, and at the same time provides greater safety for the operating technician.

U.S. Pat. No. 9,540,840, issued 2017 Jan. 10, to Oliver Joen-an Ma describes a foldable umbrella base which may include a cross-piece having a ground engaging portion and an upright receptacle configured to receive an umbrella pole. The foldable umbrella base may also include a foldable container comprising a ballast retaining space configured to receive and retain a ballast material. The foldable umbrella base may also include a foldable cover configured to be disposed over the foldable container to enclose the foldable container and cross-piece while permitting the umbrella pole to extend therethrough. A first plurality of retainers may be coupled to a side surface of the foldable container may be configured to receive and hold a corresponding first plurality of rigid members such that the first plurality of retainers can provide structural support to the foldable container, whereby the foldable container can retain a shape upon receiving the ballast.

U.S. Pat. No. 9,565,907, issued 2017 Feb. 14, to Mark J. S. Ma describes an umbrella having a support arm, a canopy having a support hub defining a first axis, and a pivot joint coupling the support hub to the support structure. The pivot joint is rotatable with respect to the support structure, about a second axis at a fixed angle with respect to the support structure. The pivot joint has a rotatable joint axle rotatably coupled to the support structure, and a tilt joint axle having a first end rotatably coupled to the rotatable joint axle along an interface plane at an angle, and a second end coupled to the support hub, wherein the tilt joint axle defines a longitudinal third axis. The orientation of the canopy can be changed with respect to the support structure by rotating the rotatable joint axle about the second axis.

U.S. Pat. No. 9,585,447, issued 2017 Mar. 7, to Keeon Rudder describes a reversible umbrella which has a pole, a first handle affixed to a first end of the pole, a second handle affixed to a second end of the pole, and a plurality of ribs extending outwardly of the pole. A canopy is affixed to the ribs. The canopy has a first side facing one direction and a second side facing an opposite direction. The ribs are movable from a first position, wherein the first side of the canopy is in a generally concave configuration with respect to the first handle, to a second position, wherein the first side of the canopy is in a generally convex position with respect to the first handle. The opposing sides of the canopy preferably have different appearances or textures, such that the user can select between two designs to be exposed on the exterior of the umbrella.

U.S. Pat. No. 9,655,416, issued 2017 May 23, to Dougan H. Clarke describes a crank handle positioning assembly structured to selectively position a mast mounted canopy of an umbrella into and between open and closed orientations. A gear housing is disposed within the interior of the mast in at least partially enclosing relation to a gear assembly and in driving relation to at least one elongated drive gear. A crank handle is disposed on an exterior of the mast and extends there-through into rotationally driving relation to the gear assembly. A rider member is interconnected in driving relation to the canopy assembly and is reciprocally movable along the length of the drive gear upon rotational, driving engagement of the crank handle with the gear assembly. Concurrent, cooperative directions of linear movement of the rider member and a rotational movement of the crank handle is determinative of the positioning of the canopy assembly in either the open or closed orientations.

U.S. Pat. No. 9,930,942, issued 2018 Apr. 3, to Oliver Joen-an Ma describes a Umbrella assemblies described herein are configured to retract and extend, tilt side to side, and open and close. In some embodiments, the umbrella assembly can include a cantilevered beam. The umbrella assembly can further include a tilt mechanism operable to rotate the canopy frame. The umbrella assembly can include a clutch mechanism fixed to the cantilevered beam. The umbrella assembly can also include an integrated mechanism to both open and close the canopy frame and raise and lower the cantilevered beam.

U.S. Pat. No. 10,017,955, issued 2018 Jul. 10, to Lianghui Ye describes a mobile base having a telescopic foot pedal. The mobile base comprises a base frame, a counterweight block, and a base cover; wherein the base frame is cooperatively provided with a lifting primary arm, one end of the lifting primary arm rotatably mating with a guiding rod, a lower end of the guiding rod mating with a track locking member fixed on the base frame, the other end of the lifting primary arm rotatably mating with a U-shaped support on the base frame, an end portion on the lifting primary arm proximate the guiding rod is cooperatively provided with a telescopic foot pedal, the other end of the lifting primary arm being connected to a group of lifting secondary arms, the lifting secondary arms respectively rotatably mating with the base frame, bottoms of the lifting secondary arms being fixedly provided with universal wheels.

U.S. Pat. No. 10,100,969, issued 2018 Oct. 16, to Shilin Zhu describes a movable sunshade base. The base comprises a base frame, a base cover, a roller component, a rotary assembly, a transmission component, a first drive rod, a second drive rod and a pull rod. Through swinging a pull rod, the second drive rod drives the transmission shaft, thereby driving the first drive rod. Driven by the first drive rod, a wheel bracket achieves power transmission using the leverage theorem, thereby controlling the roller to move to the outside of the base frame. When the movement is completed, the pull rod is swung to the opposite direction so that the roller can shrink into the base frame. The disclosure has the advantages of simple operation, convenient appearance, strong practicability and low cost, and can effectively solve the problem of moving difficulty and can be applied to various types of sunshade base.

U.S. Pat. No. 10,136,709, issued 2018 Nov. 27, to Oliver Joen-an Ma describes a cantilever umbrella assembly that includes an upright pole, a runner, a transverse pole, and a canopy. The upright pole includes an upright guide surface. The runner is coupled with the upright pole and has a bearing coupled with the guide surface for guiding the runner along the upright pole. The cantilever umbrella assembly includes a deployable tension member with a first end disposed in the transverse pole and a second end coupled with the canopy.

U.S. Pat. No. 10,292,467, issued 2019 May 21, to Sarah Akin describes a solar-powered umbrella which has a cap structure that is connected by hinges to struts. The struts are relatively rigid and positioned above the umbrella shade and house solar panels. When the umbrella is opened and closed, the struts rotate via the hinges from an open to closed position. When the solar panels are exposed to the sun, light is converted to electrical energy to charge a rechargeable battery. The battery supplies power to one or more USB ports. A user can recharge an electronic device (e.g., smartphone or tablet computer) by connecting to a port of the umbrella using a cable.

U.S. Pat. No. 10,376,027, issued 2019 Aug. 13, to Gregory G. Kuelbs describes an umbrella apparatus having a canopy portion hingedly coupled to a pole portion. The umbrellas apparatus includes a rechargeable electrical power system that provides electrical power to an electromechanical opening and closing system and a light assembly and an entertainment system. A solar energy system is conductively coupled to the rechargeable electrical power system and is utilized to collect and convert solar energy to electrical energy for recharging the electrical power system. The entertainment system features a USB port and allows users to stream music and control the color of the light assembly.

U.S. Pat. No. 10,426,234, issued 2019 Oct. 1, to Dee Volin describes a multi-angle multi-function umbrella which comprises: a first foot, a second foot, a mounting plate bolted to the first and second feet, a lower post attached to the mounting plate, an upper post, a middle post, a first inner core inserted into the lower and middle posts, a second inner core inserted into the middle and upper posts, a central tube, a spool, a crank rotatably attached to the spool, a rope threaded through the central tube, central ribs, central arms pivotably attached to the central ribs, an adjustable central canopy attached to the central ribs to adjust to different heights, an intersector slidably attached to the central tube, first ribs pivotably connected to the intersector and central arms, second ribs, third ribs, first coil caps pivotably connected to the first and second ribs, second coil caps pivotably connected to the second and third ribs, raising arms foldably attached to the intersector, an adjustable ring canopy attached to the first and second ribs, and adjusting flaps sewn to the adjustable ring canopy to adjust it to multiple different sizes.

U.S. Pat. No. 10,508,465, issued 2019 Dec. 17, to Jiangbo Pan describes a detachable base including a pedestal, a counterweight box mounted on the pedestal, and a shell detachably covered on the counterweight box and the pedestal. The shell includes an edge, a corner having a smooth transition camber surface, and a cover. The edge is detachably connected to the cover. A side edge vertical to the corner is provided with a first fitting portion of a fastening part. A vertical side edge of the edge corresponding to the corner is provided with a second fitting portion of a fastened part. The first fitting portion fits with the second fitting portion through socketing. The counterweight box, the detachable shell and the pedestal of the invention allow the whole detachable base to be disassembled into small-sized parts easy to take and pack, or to be assembled, as spare parts, together with other accessories of the sunshade.

U.S. Pat. No. 10,537,161, issued 2020 Jan. 21, to Dee Volin describes a wind-lift-eliminating self-adjusting self-stabilizing arthritic-aiding umbrella, which comprises: a flow-directing chapeau attached to a chapeau crown, an upper cone rotatably attached to a cable conduit for preventing the umbrella from radially twisting clockwise and counterclockwise out of shape, a lower tube for centering the upper cone, a stanchion, an intersector bolted to the stanchion, a supporting-arm intersector, a top-hub, a canopy-height-and-tilt-adjusting arthritic-hand-aiding handle slidably connected to the stanchion, a height-adjusting arthritic-hand-aiding trigger springably and pivotably attached to the handle for providing aid to arthritic hands to operate the handle without discomfort and for providing means to slidably lower and raise the handle to adjust the umbrella, a supporting arm pivotably attached to the lifting-arm intersector and the supporting-arm intersector, a lifting arm pivotably attached to the handle and the top-hub intersector, the supporting-arm intersector pivotably attached to the lifting arm, a deploying cable, a cable spool molded into the handle and attached to the cable, an arthritic-hand-aiding crank, an arthritic-hand-aiding-crank paddle rotatably connected to the crank for providing aid to arthritic hands to operate the crank providing means to deploy and retract the umbrella without discomfort, a reversible wind-pressure-releasing and cooling-funnel canopy for providing a cover to protect users from weather elements and for releasing air pressure below the umbrella, an opening is cut into the canopy, a top-hub-ring, the cable conduit rotatably attached to the top-hub-ring, the top-hub intersector pivotably attached to the top-hub-ring, a bottom-shuttle-hub-ring, the lower cone rotatably attached to the bottom-shuttle-hub-ring, the cable connected to the bottom hub-ring, upper-ribs, wind-lift-eliminating self-adjusting funnel-and-canopy-tension-adjusting springs for adjustably tensioning the canopy and for customizingly relieving air pressure below the umbrella to stabilize and to eliminate lift and vibration from wind gusts, adjustable-tension-canopy-spring brackets springably securing the wind-lift-eliminating self-adjusting funnel-and-canopy-tension-adjusting springs to the upper-ribs, lower-ribs pivotably screwed to the bottom-shuttle-hub-ring and the upper-ribs, a stanchion base-mounting plate attached to the stanchion, and base-stabilizing feet bolted to the base-mounting-plate.

U.S. Pat. No. 10,711,481, issued 2020 Jul. 14, to Lei Zhu describes a removable sunshade base and a sunshade including the removable sunshade base. The removable sunshade base includes a sunshade base body and a pull rod. A bottom of the sunshade base body has a sliding groove and first sliding wheels. One end of the pull rod has a second sliding wheel, and the pull rod is movably connected with the sliding groove of the sunshade base body such that the pull rod is accommodated in the sliding groove or is pulled out from the sliding groove. When the pull rod is pulled out from the sliding groove, both the first sliding wheels and the second sliding wheel contact one supporting plane to move the sunshade base body.

U.S. Pat. No. 10,758,016, issued 2020 Sep. 1, to Weigang Wang describes an adjustable umbrella canopy shade with mounting post. The mounting post has a mounting post front side and a mounting post rear side. A cantilever support is mounted to the mounting post at a lower post hinge. A tension member is mounted to the mounting post at an upper post hinge. The tension member is mounted to the cantilever support at a cantilever support middle joint. A canopy is mounted to the cantilever support. A retainer system is mounted to the mounting post and coupled to the lower post hinge so that the retainer system moves with the lower post hinge. The lower post hinge is translationally mounted on the mounting post. A handle is formed on the retainer system, and the handle is mounted to a threaded handle shaft.

U.S. Pat. No. 10,765,185, issued 2020 Sep. 8, to Tim Wengerd describes an umbrella mounting device including a clamp assembly configured to be removably clamped to an elongated support member and an umbrella holder coupled to the clamp assembly so that the umbrella holder is rotatable about a longitudinal rotation axis that is generally perpendicular to the clamp assembly axis. A longitudinal rotation locking mechanism includes a threaded handwheel to secure the umbrella holder in the longitudinal rotation axis at an angular position that is selectable from a plurality of angular positions about the longitudinal rotation axis. The umbrella holder also is rotatable to one of a plurality of selectable positions about a transverse rotation axis. A transverse locking mechanism secures the umbrella holder into one of the plurality of selectable positions about the transverse rotation axis. The clamping assembly includes a quick locking and quick release lever.

U.S. Pat. No. 10,813,425, issued 2020 Oct. 27, to Honghua Shen describes a sunshade and a sunshade base thereof. The sunshade base, configured to be connected with a sunshade rod to support a sunshade top, the sunshade includes: a support, an upper side of the support is provided with a connection member for being connected with the sunshade rod; a moving assembly, rolling or sliding to drive the support to move; and a counterweight, the support has a counterweight area for supporting the counterweight. When the sunshade needs to be moved, it only needs to drive the moving assembly to roll or slide, thereby driving the support and the whole sunshade to move. Compared with the prior art in which several people is required to work together to move the sunshade, this invention greatly reduces the labor intensity of moving the sunshade, thereby making the moving of the sunshade more time-saving and labor-saving.

U.S. Publication No. 2006/0054206, issued 2006 Mar. 16, to Alfred J. Bilotti, describes an umbrella base for use with a patio umbrella. The umbrella base has a base shell, a shaft coupled to the base shell for receiving the pole of the patio umbrella, and at least one wheel assembly coupled to the base shell.

U.S. Publication No. 2006/0081277, issued 2006 Apr. 20, to Lausan Chung-Hsin Liu describes a side-supporting umbrella. A collar is installed on a mast, and able to slide along the mast in a continuously variable manner, and pivotally connected to a supporting arm of a canopy. A movement of the collar sequentially actuates another movement of the pivotally interlinked supporting arm to adjust the tilt of the canopy, and the collar can be fixed at any position of the mast by a locking element. Thus, the canopy can be adjusted to any tilt attitude in response to the solar radiation coming from any direction. Besides, a controlling line of the present is inside-installed in order to prevent the line from exposure to the environment and avoid wear or damage of the line and then prolong the life of the umbrella and promote the operating safety.

U.S. Publication No. 2007/0080277, issued 2007 Apr. 12, to Nengsen Chen, describes the utility model of a large-sized sunshade umbrella which is used at fixed site outdoor. The interior of the base is divided into several independent portions, a protection case which is mated with the base is brought to cover the base, and the devices of caster wheel which can be stretched-out and drawn-back are provided in the holes at the corners of the base. Sand or water as the counterweight in the base can be added or reduced freely. When the base needs to fix, the caster wheels are drawn-back into the base through manual regulation to make the base rest on the ground to increase the attaching force; when the umbrella needs to move, the four caster wheels are stretched-out from the base to contact with the ground, so that a man or woman can push the umbrella smoothly to the site where he or she intends to place it.

U.S. Publication No. 2013/0146739 A1, issued 2013 Jun. 13, to Lifeng Zhao, describes an umbrella base comprising one or more identical sector-shaped base boxes that can be filled with heavy filling material (e.g., sand), the identical sector-shaped base boxes are attached to each other and placed on a formation of elongated base members of an umbrella to hold the umbrella in an upright position. When the umbrella base is not in use, the base boxes can be emptied and separated, and the identical sector-shaped boxes may be disassembled and stacked on top of one another. The overall dimension of the sector-shaped boxes when stacked is compact which allows the umbrella and the umbrella base together to fit inside the umbrella package.

U.S. Publication No. 2015/0305453, issued 2015 Oct. 29, to Gina M Gatto-Weising relates to holders and clamps, such as umbrella holders. In certain embodiments, an item holder and one or more clamps may be combined to form an umbrella holder. Further, a clamp may include two jaw members that can be tightened to engage a ball joint member of a holder. There may also be an attachment mechanism that also has a ball joint that can be engaged by an end of the clamp opposite the holder. Such a clamp may also be adapted for other uses, such as to engage other items connected to a ball joint.

U.S. Publication No. 2015/0351505, issued 2015 Dec. 10, to Christopher Jon Ostrander describes a cantilevered umbrella including a base, a mast, a cantilevered arm, a canopy, and an air shock system. The mast has a first end and a second end. The first end of the mast is connected to the base. The cantilevered arm has a first end and a second end. The first end of the cantilevered arm is pivotally connected to the second end of the mast. The canopy is connected to the cantilevered arm and has a covering and a frame. The frame is moveable between an inflated position and a deflated position. The air shock system has at least two gas springs and is at least partially deposed within the frame of the canopy. The gas springs assist with moving the frame of the canopy between the inflated and deflated position.

U.S. Publication No. 2020/0063462, issued 2020 Feb. 27, to Chengxi Kong describes a cantilever umbrella including a frame having an upper tray and a lower tray. Two first crossed rods, a transverse rod and a first long rib are articulated to the upper tray. Two second crossed rods and two first short ribs are articulated to the lower tray. One of the two first short ribs is articulated to a middle portion of the transverse rod and the other one is articulated to a middle portion of the first long rib. A middle portion of each second crossed rod is articulated to a middle portion of the first crossed rod on a same side. An end of each first crossed rod is articulated with a short-rib tray which is articulated to a short rib, and an end of each second crossed rod is articulated with a long-rib tray which is articulated to a long rib. The short ribs each has one end articulated to the short-rib tray and another end articulated to a middle portion of one of the long ribs. The upper tray and the two long-rib trays are each disposed with a cap thereon, and a canopy fabric is covered on the long ribs to form three canopies.

U.S. Publication No. 2021/0079956, issued 2021 Mar. 18, to Jianqiang Xie, describes a device to adjust the angle of rotation of a canopy of a sunshade and comprises an upper clutch sleeve sleeved at a lower end of an upper tube of the sunshade, a lower clutch sleeve sleeved at an upper end of a lower tube, a rotary handle sleeve and a rotary shaft sleeved outside the upper tube and the lower tube, a rotary shaft rotationally inserted within one of the upper tube and the lower tube and fixedly connected with the other, a retaining ring disposed between the upper end of the rotary handle sleeve and the upper tube and elastically connected with the upper clutch sleeve or the upper tube, and a set of fitting parts.

U.S. Publication No. 2021/0161262, issued 2021 Jun. 3, to Ji Jin, describes a conveniently opening and closing sun umbrella, which includes a vertical pole, a connecting rod, an inclined rod, an umbrella frame and an umbrella opening mechanism. The two ends of the connecting rod are respectively hinged on the vertical pole and the inclined rod. The umbrella opening mechanism includes a first pull rope, a movable pulley, a second pull rope and a slide locking piece which is slidably mounted on the vertical pole. One end of the inclined rod is hinged on the slide locking piece, and the other end is hinged on a fixed umbrella disk. One end of the first pull rope is fixed on the movable pulley, and the other end is fixed on the movable umbrella disk. One end of the second pull rope is fixed on the vertical pole, and the other end is fixed on the slide locking piece.

U.S. Publication No. 2021/0386166, issued 2021 Dec. 16, to Xiong Luo, describes a sunshade umbrella capable of rotating left and right which includes a base, a vertical column, a transverse rod, a drawing rod, an umbrella frame, a rotating mechanism for controlling the umbrella frame to rotate left and right, and an adjustment handle for driving the rotating mechanism to rotate. The umbrella frame has a lengthened rib, and a bottom end of the lengthened rib is connected to the rotating mechanism. The rotating mechanism includes an upper clutch tooth mechanism and a lower clutch tooth mechanism. The adjustment handle is disposed on the lower clutch tooth mechanism. The upper clutch tooth mechanism and the lower clutch tooth mechanism are respectively disposed at the top end and the bottom end of the transverse rod, and are connected with each other through a connecting rod.

U.S. Publication No. 2022/0195749, issued 2022 Jun. 23, to Xiong Luo, describes a movable umbrella base comprising a housing (1), a wheel frame (2) disposed under the bottom of the housing (1), at least three wheels (3) connected at intervals to the wheel frame (2) and located partially under the wheel frame (2), a plurality of air bags (4) located inside a space defined by the wheel frame (2) and the housing (1), and a plurality of elastic members (6) limit displacement of the wheel frame (2) and the wheels (3) from the housing (1); when the air bags (4) are inflated, the housing (1) is lifted up relative to the wheel frame (2) and the wheels (3) from the ground; when the air bags (4) are deflated, the housing (1) is lowered relative to the wheel frame (2) and the wheels (3) and contacts the ground. The umbrella base can be moved by the air bags (4), the whole operation process is easier, and it saves more time and effort.

SUMMARY

Disclosed are example embodiments of a device having one or more of a five-device-in-one arthritic-assisting anti-vibration anti-friction anti-pinching portable elevators, twisting jaws, and uneven base, which may be economical to produce, may be arthritic-friendly, and can be quickly and easily assembled and disassembled. Particularly, the present invention relates to five-device-in-one arthritic-assisting anti-vibration anti-friction anti-pinching portable elevators, twisting jaws, and uneven base (for being adapted to umbrella post, hand rail, sail pole, awning arm, and pergola column, and for being capable of functioning as uneven-step supporter, uneven-surface supporter, patio bolt-locker, platform stabilizer, and weight base), which may include: Arthritic-assisting anti-vibration anti-friction anti-pinching track system, Arthritic-assisting anti-vibration anti-friction anti-pinching portable-elevator system, 5-device-in-one anti-slipping anti-cracking opposite-twisting-jaw system, Multi-elevation twistable-tube system, Anti-crack reinforcing twistable-rib system, Multi-application pivoting-connector system, Opposite-twisting-jaw-housing tunnel system, Production-increasing cost-saving identical-half-base-top system, Production-increasing cost-saving identical-half-base-bottom system, Adjustable-hidable angle-operated caster system; and Deployable-hidable crank-and-bolt-lock system.

The features and advantages described in the specification are not all-inclusive. In particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the disclosed subject matter.

BRIEF DESCRIPTION OF THE DRAWINGS

The foregoing summary, as well as the following detailed description, is better understood when read in conjunction with the accompanying drawings. The accompanying drawings, which are incorporated herein and form part of the specification, illustrate a plurality of embodiments and, together with the description, further serve to explain the principles involved and to enable a person skilled in the relevant art(s) to make and use the disclosed technologies.

The figures and the following description describe certain embodiments by way of illustration only. One skilled in the art will readily recognize from the following description that alternative embodiments of the structures and methods illustrated herein may be employed without departing from the principles described herein. Reference will now be made in detail to several embodiments, examples of which are illustrated in the accompanying figures. It is noted that wherever practicable similar or like reference numbers may be used in the figures to indicate similar or like functionality.

DETAILED DESCRIPTION

The detailed description set forth below in connection with the appended drawings is intended as a description of configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Disadvantages of the Prior Art

Figure 10:
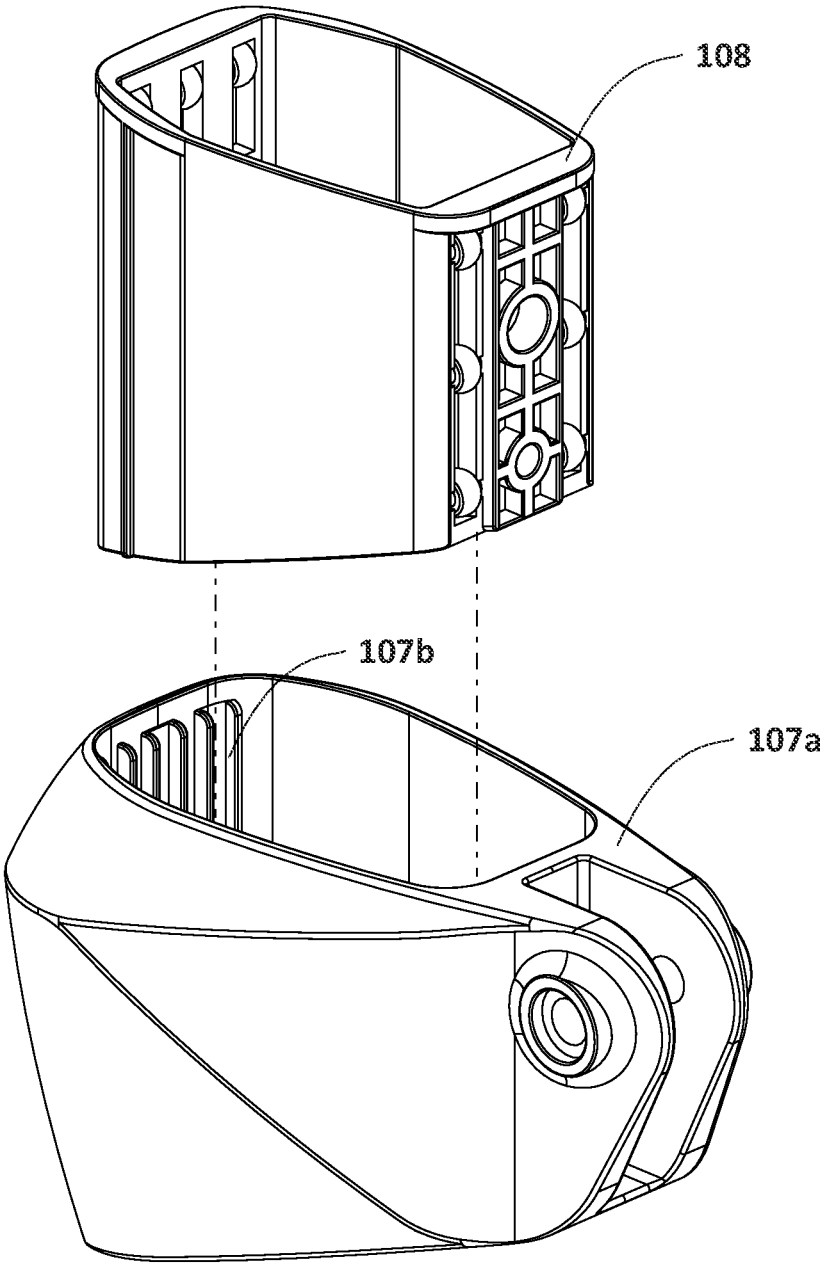
Figure 51:
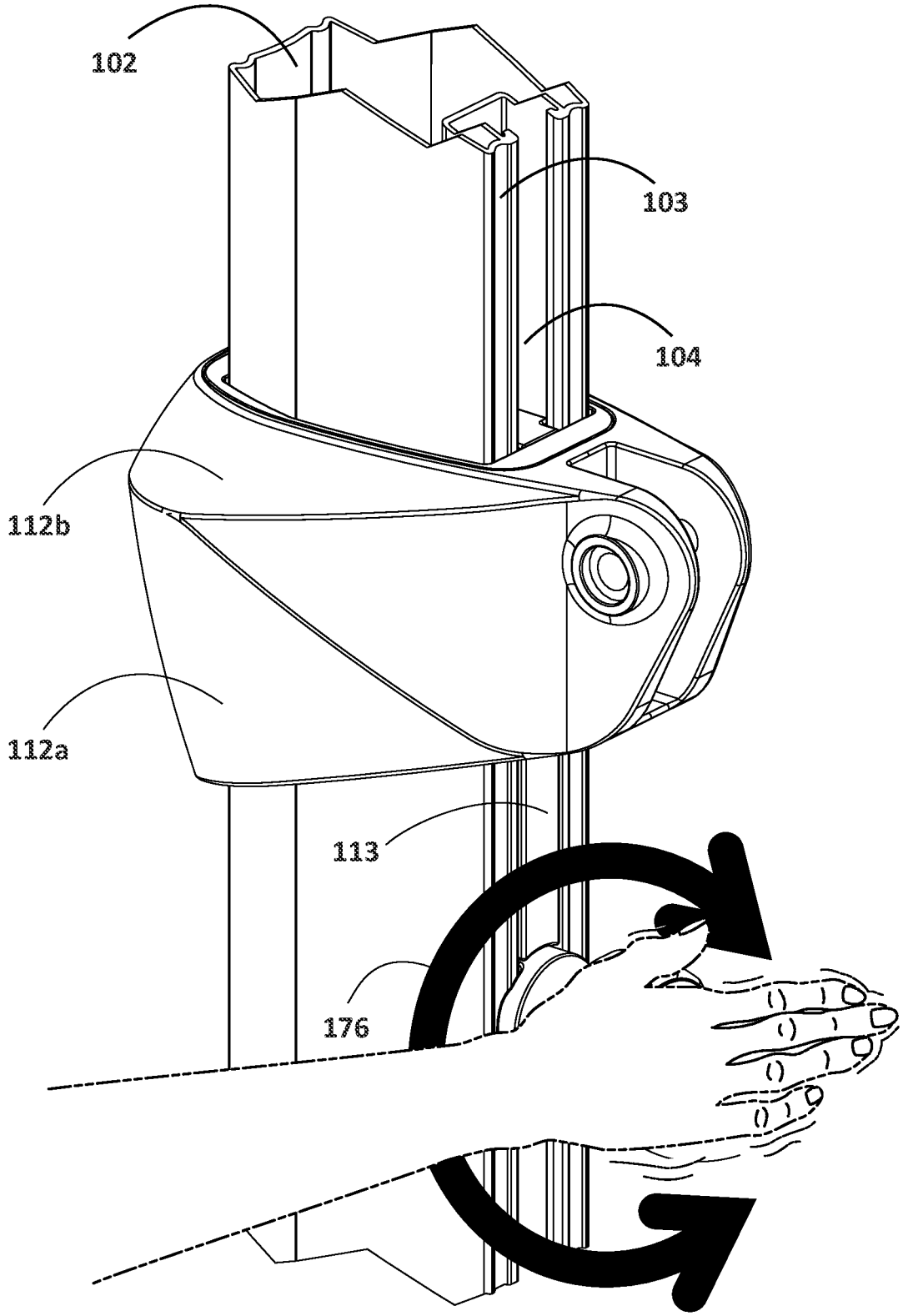
FIG. 51-FIG. 57 are diagrams illustrating perspective views demonstrating how an arthritic could raise and lower arthritic-assisting anti-vibration anti-friction anti-pinching portable-elevator system 106 without the need to bend the fingers.
Figure 52:
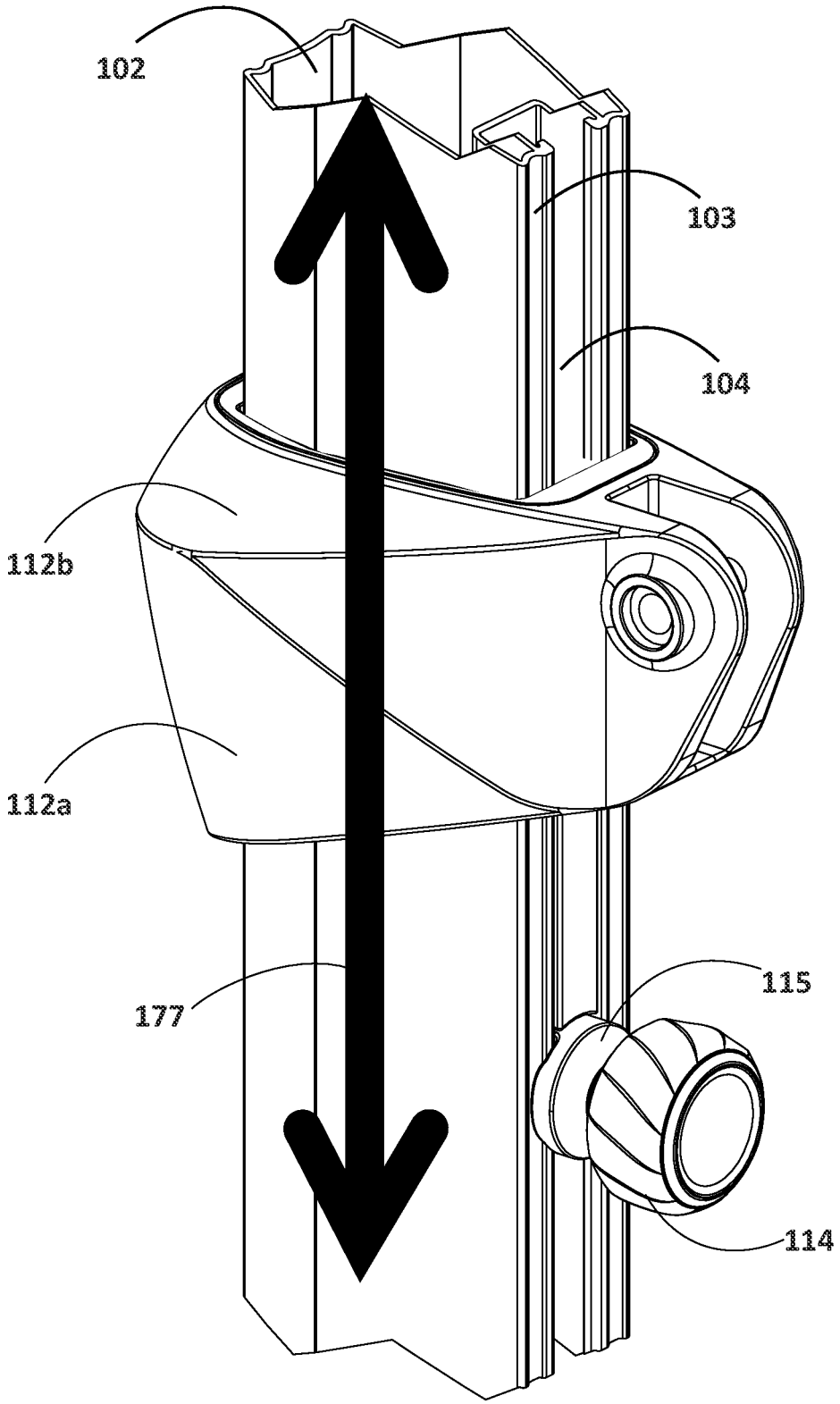
Figure 53:
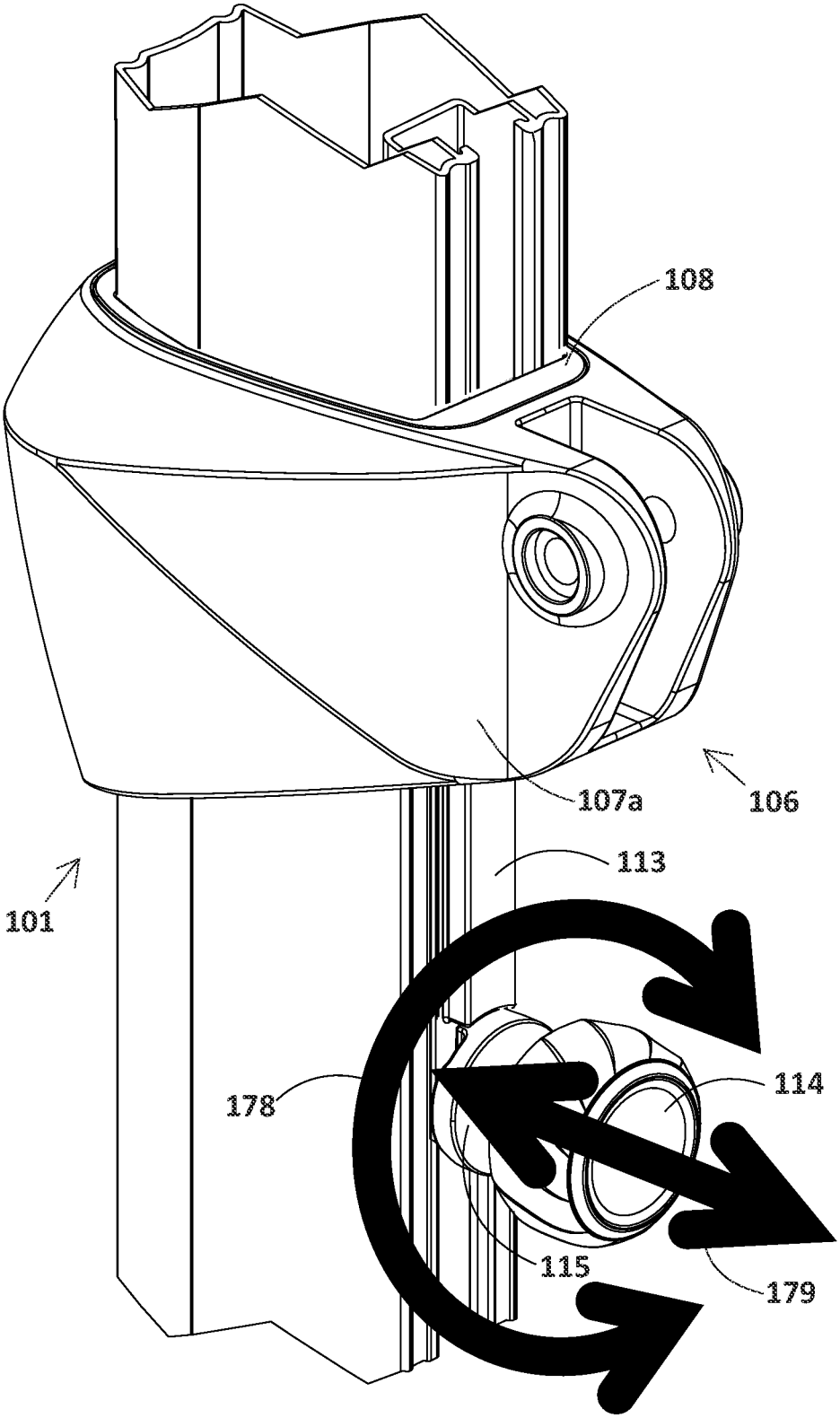
Figure 54:
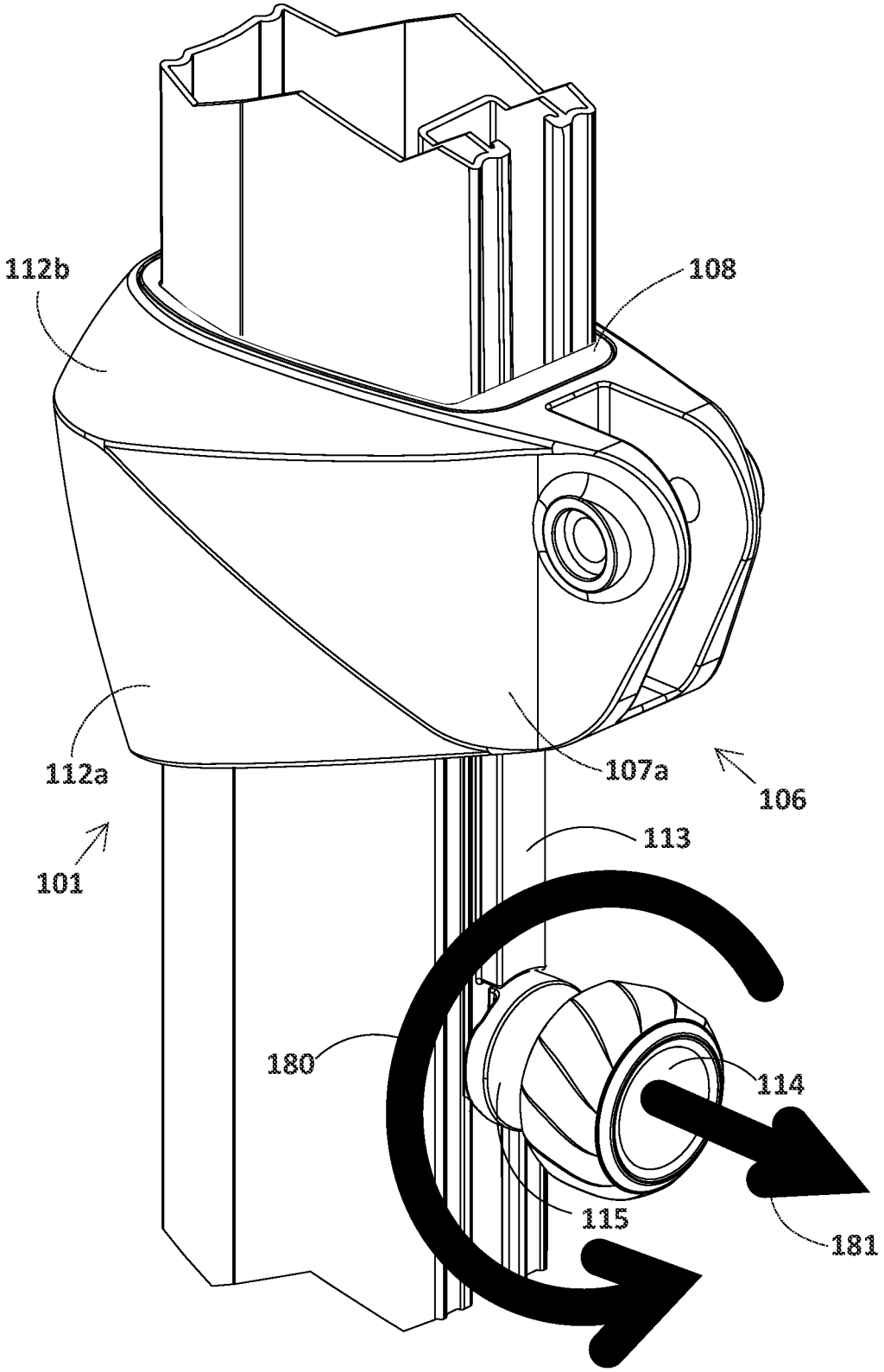
Figure 55:
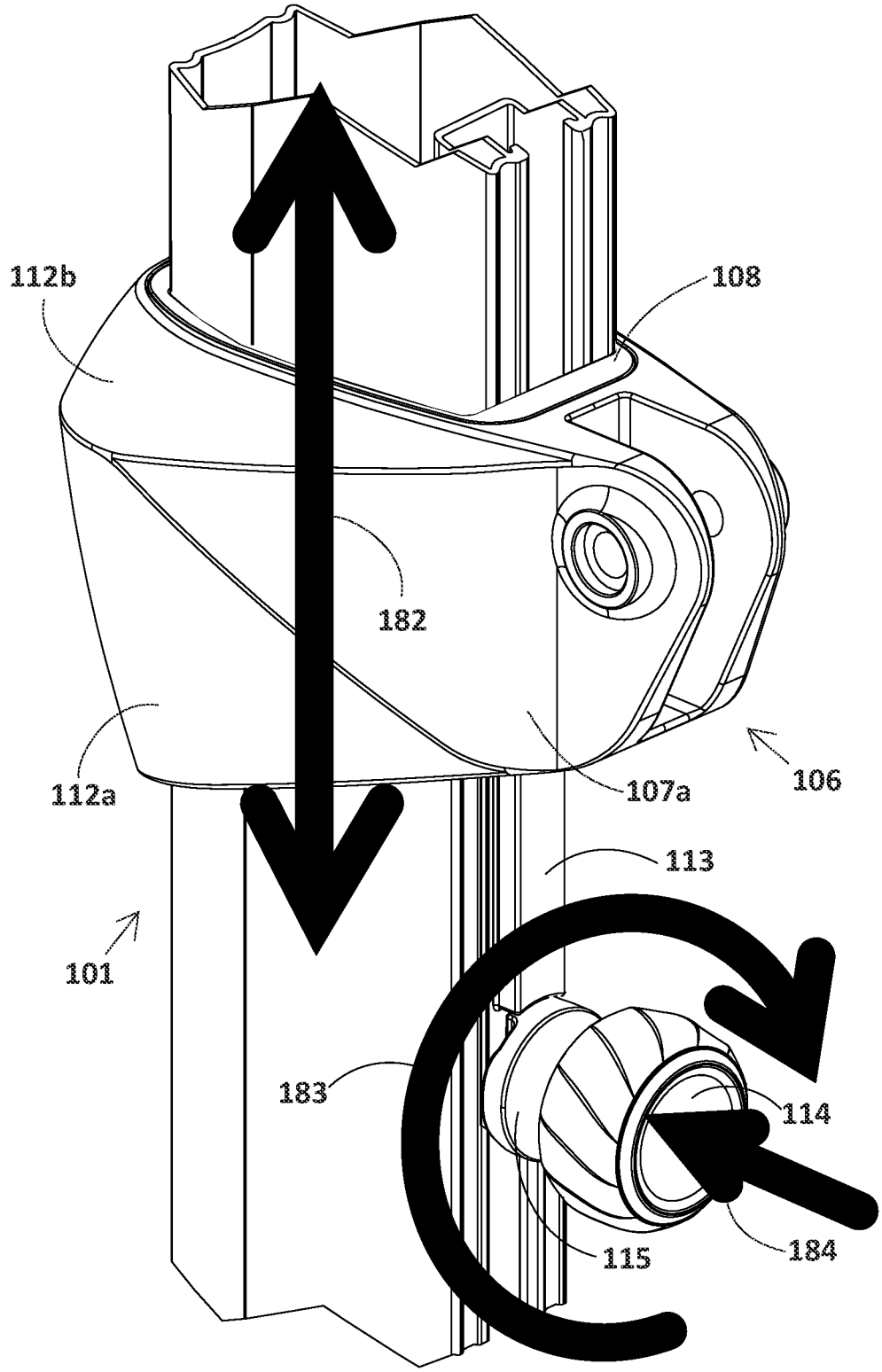
Figure 56:
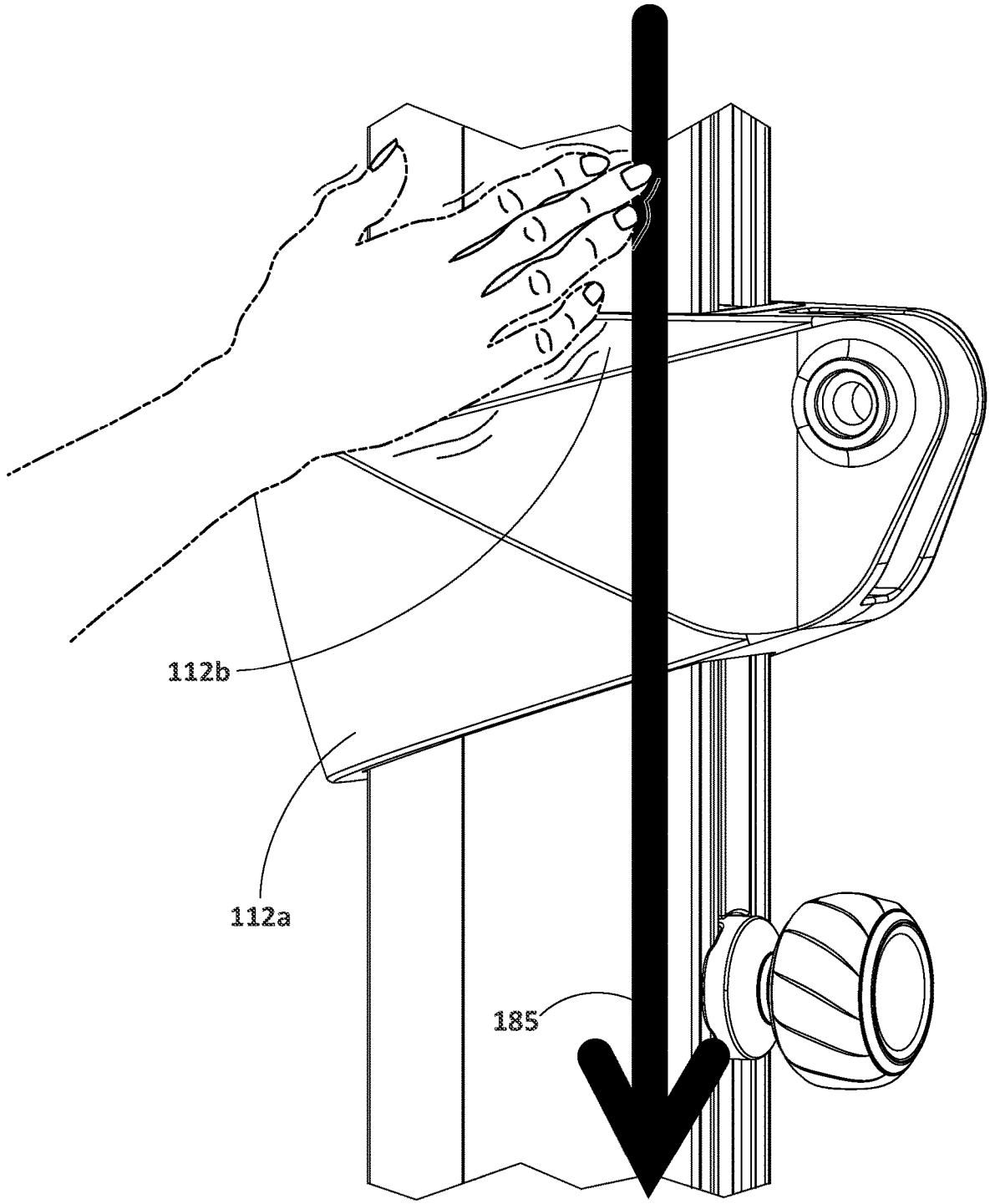
Figure 57:
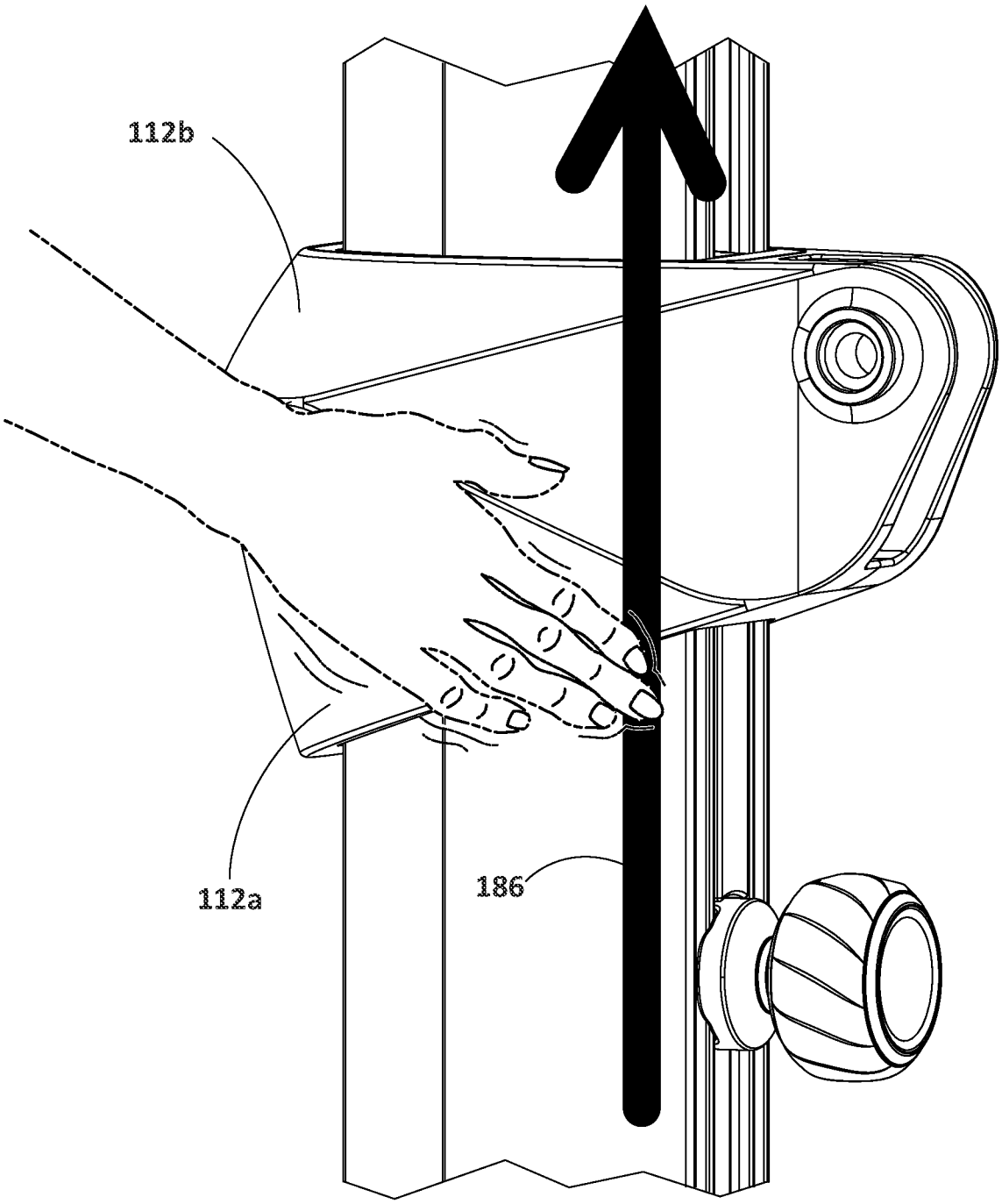
Figure 58:
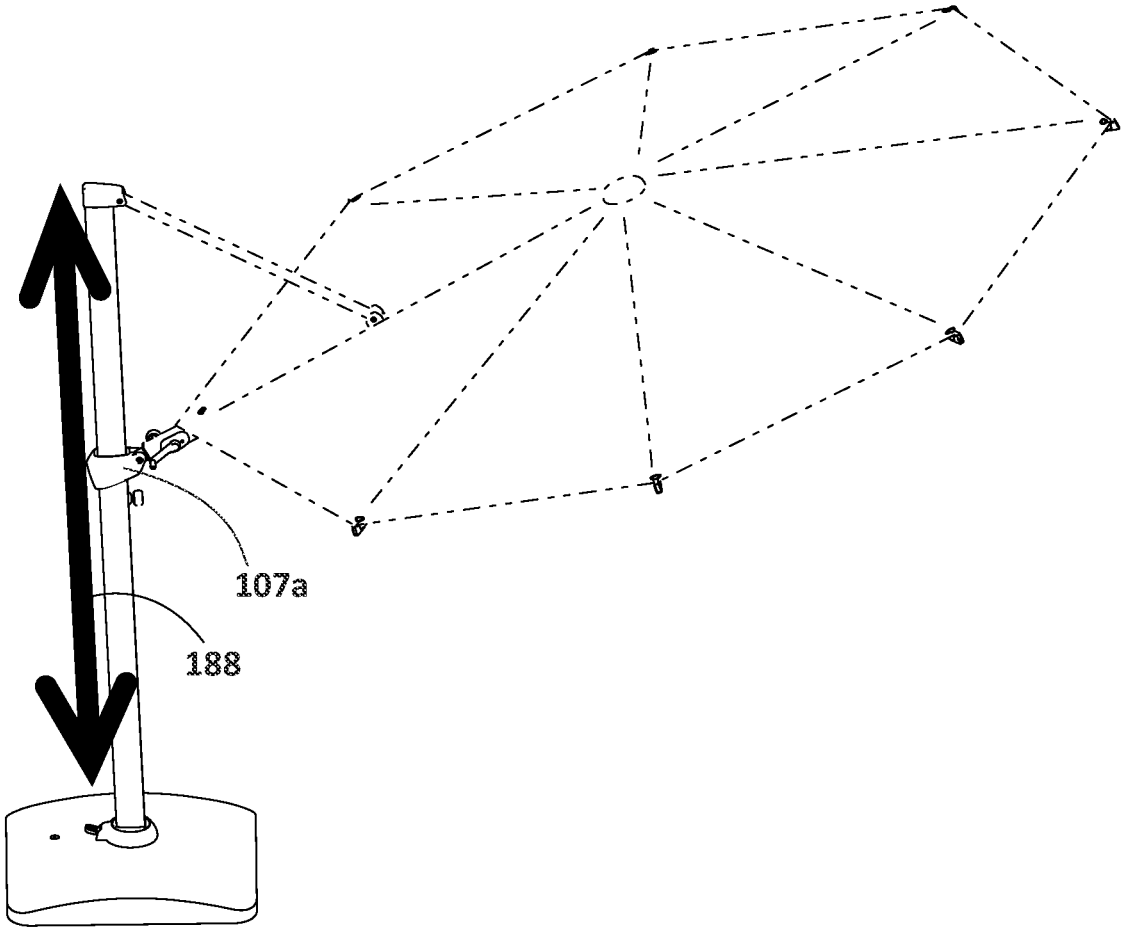
FIG. 58-FIG. 62 are diagrams illustrating perspective views demonstrating how the five-device-in-one arthritic-assisting anti-vibration anti-friction anti-pinching portable elevators (being used on an umbrella post, handrail, sail pole, awning arm, and pergola column).
Figure 59:
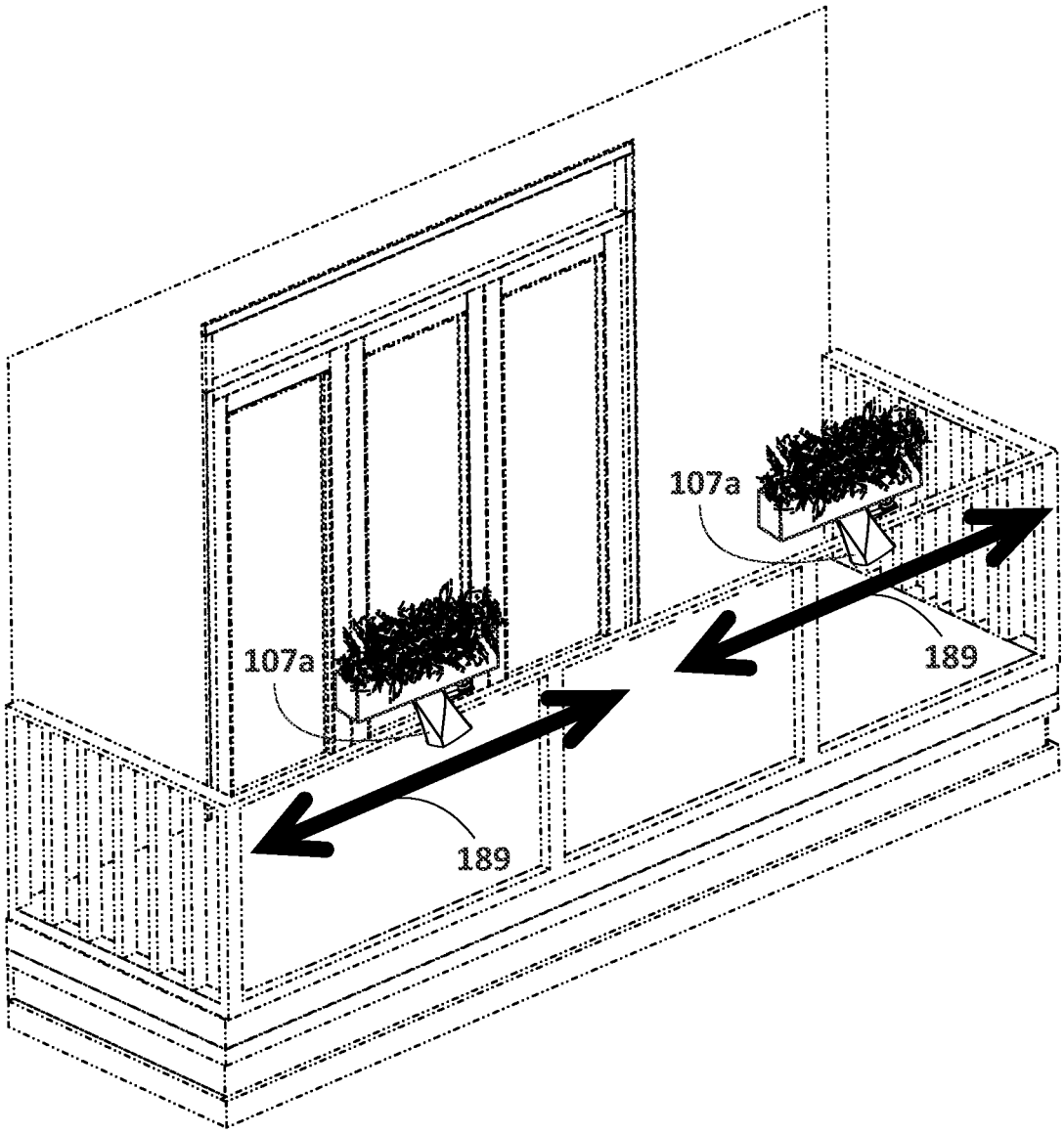
Figure 60:
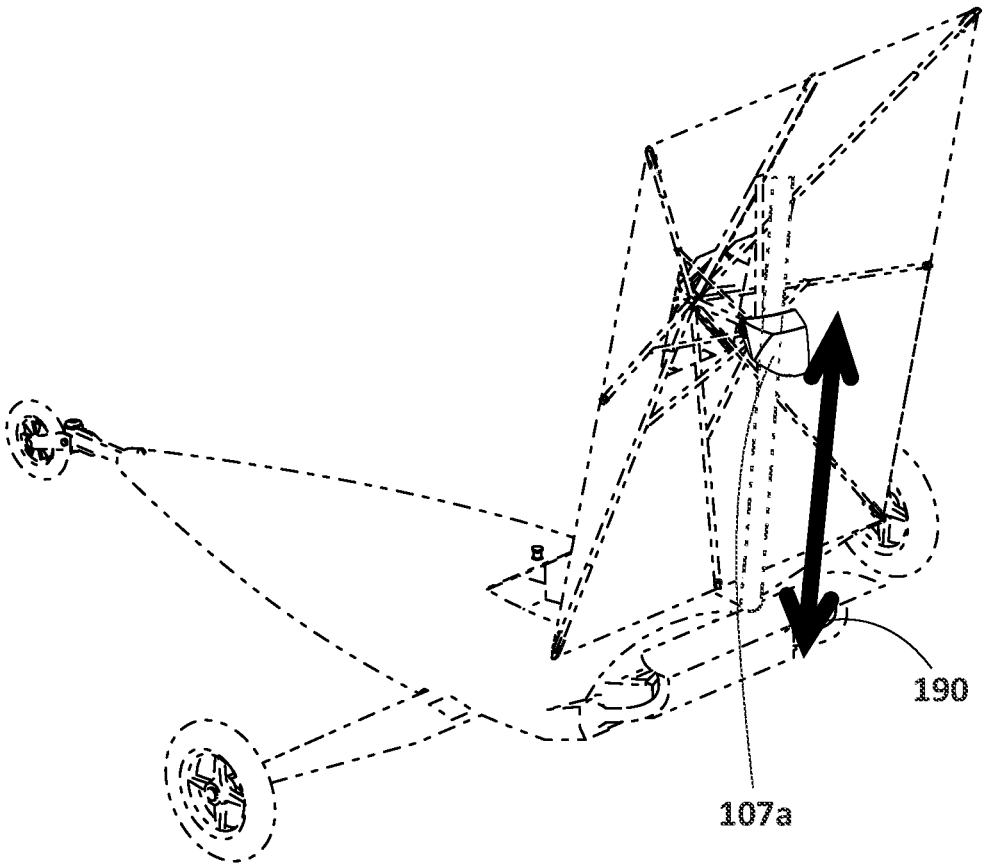
Figure 61:
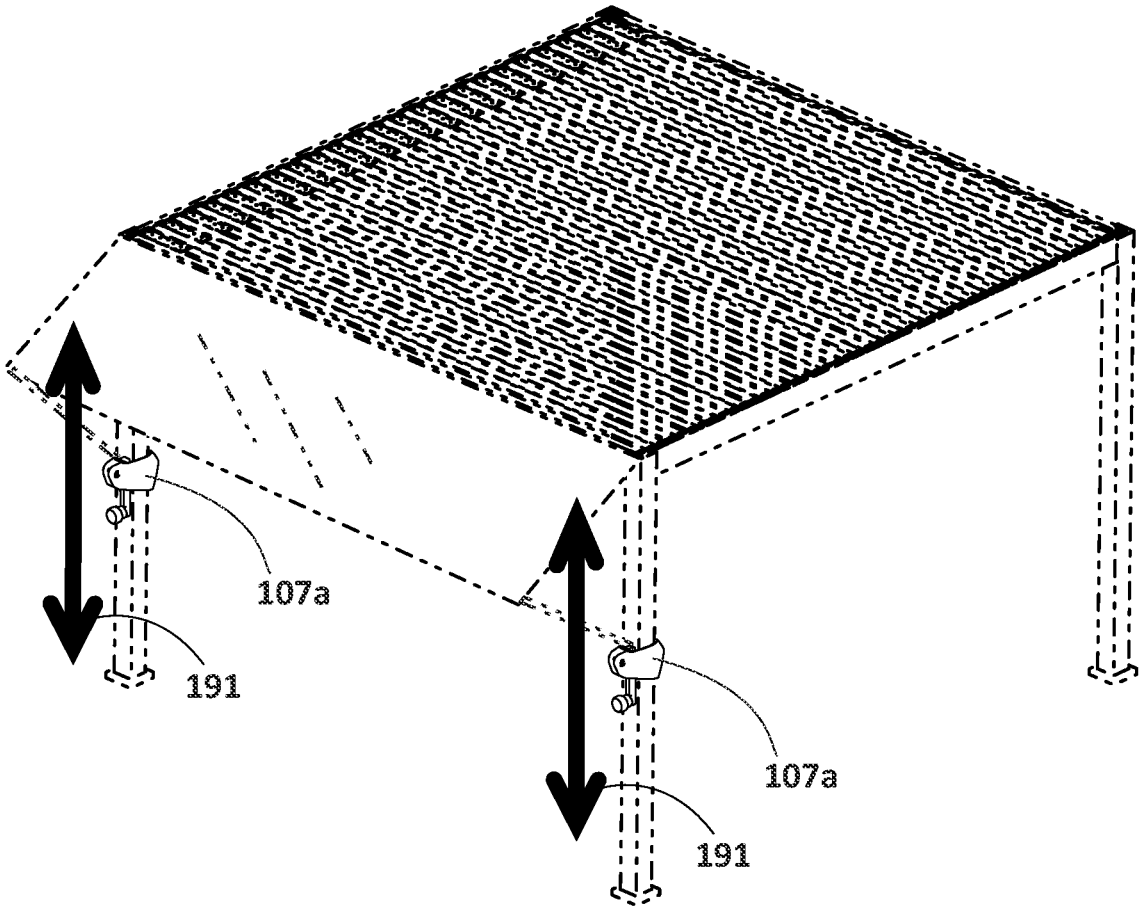
Figure 62:
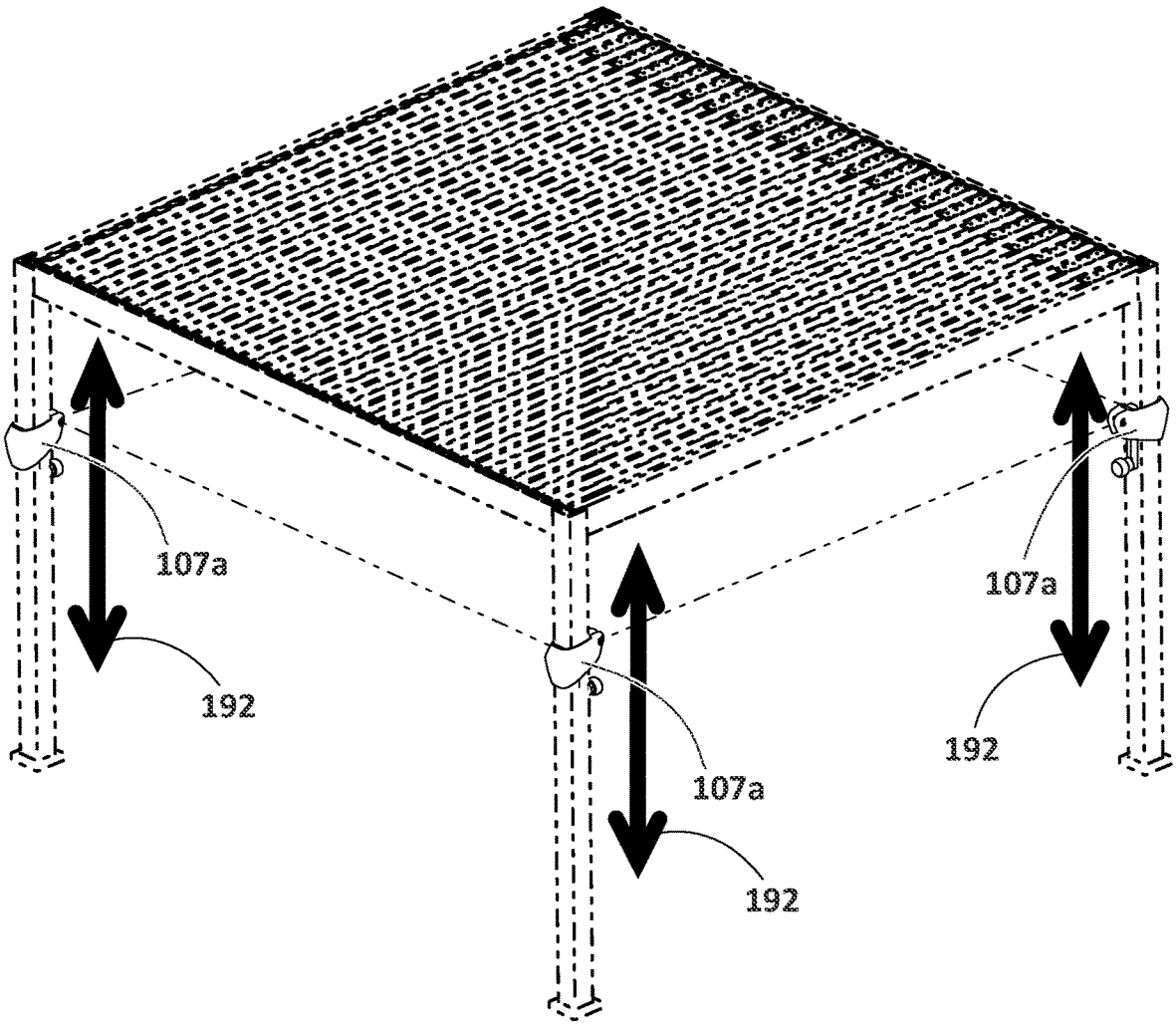
Figure 63:
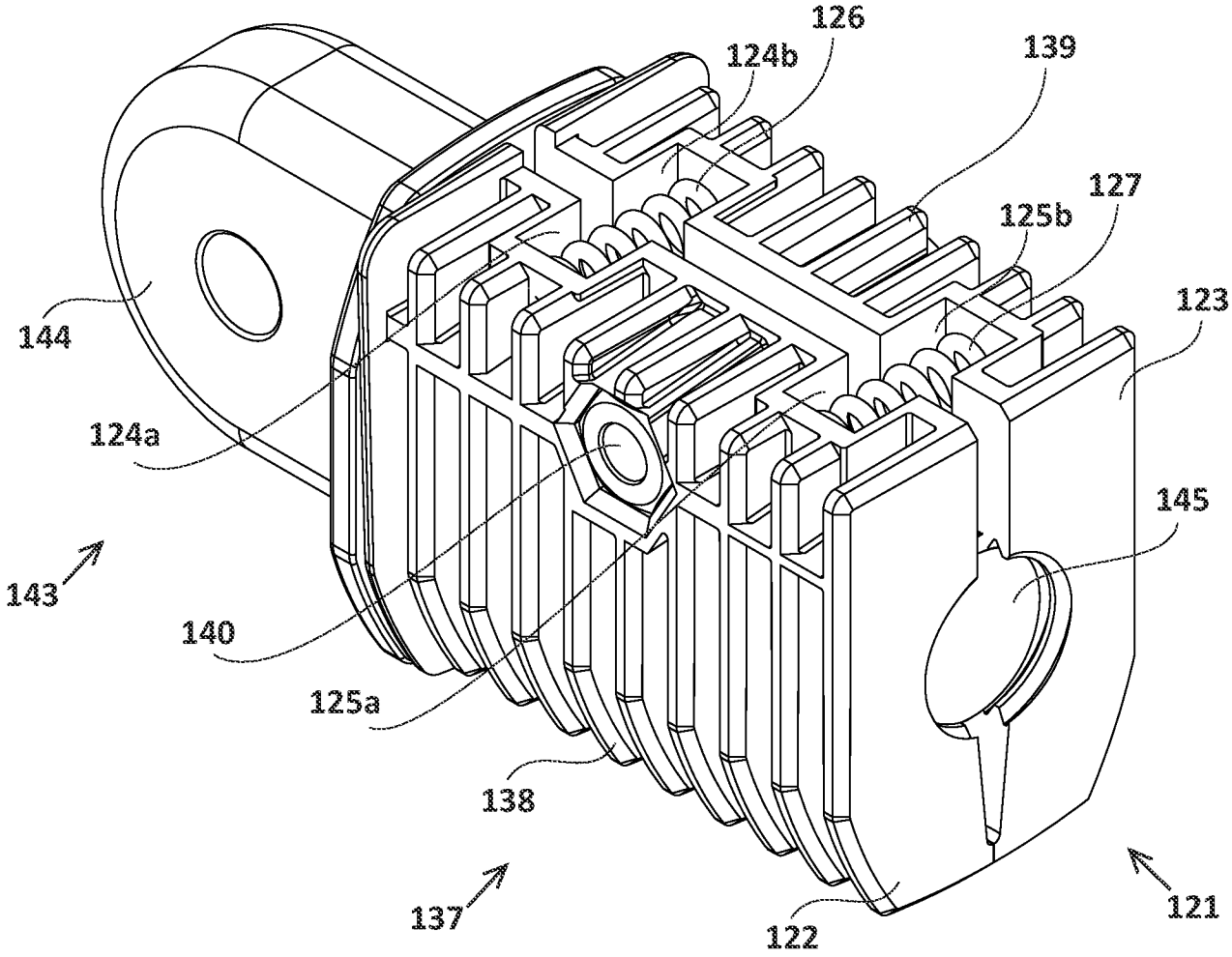
FIG. 63 are diagrams illustrating a perspective view demonstrating components and the assembly of 5-device-in-one anti-slipping anti-cracking opposite-twisting-jaw system 121.
Figure 64:
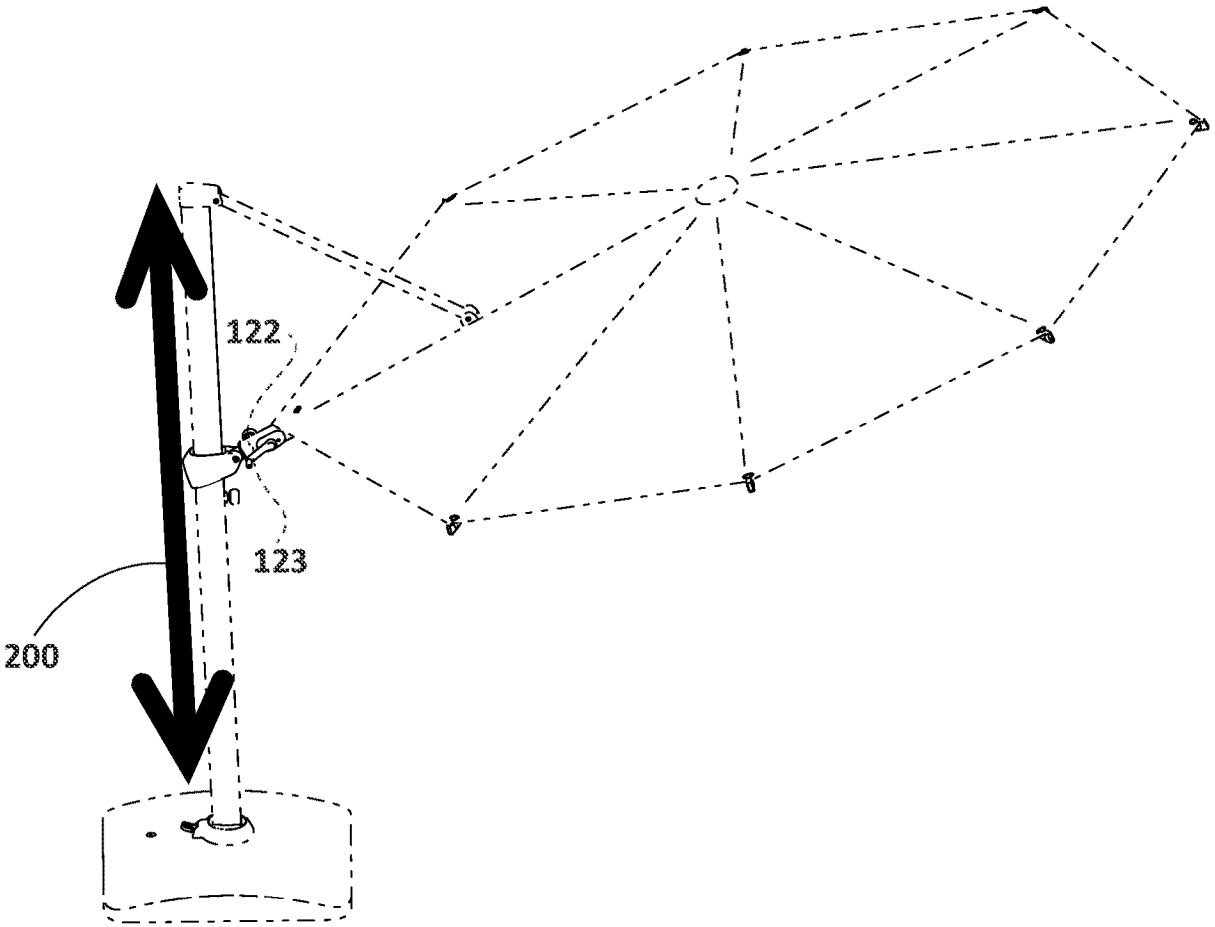
FIG. 64-FIG. 68 are diagrams illustrating perspective views demonstrating additional applications of the five-device-in-one arthritic-assisting anti-slipping anti-cracking production-increasing opposite-twisting jaws.
Figure 65:
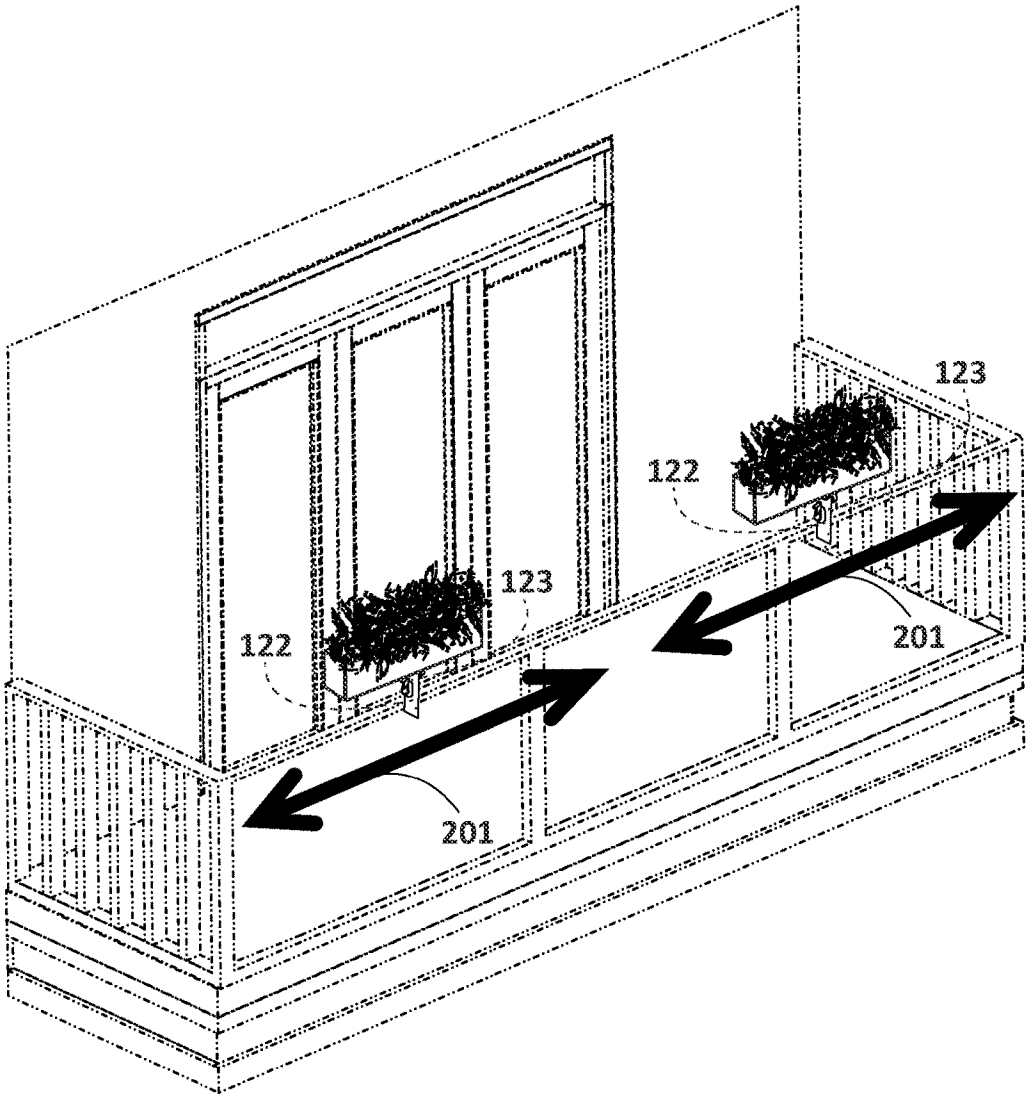
Figure 66:
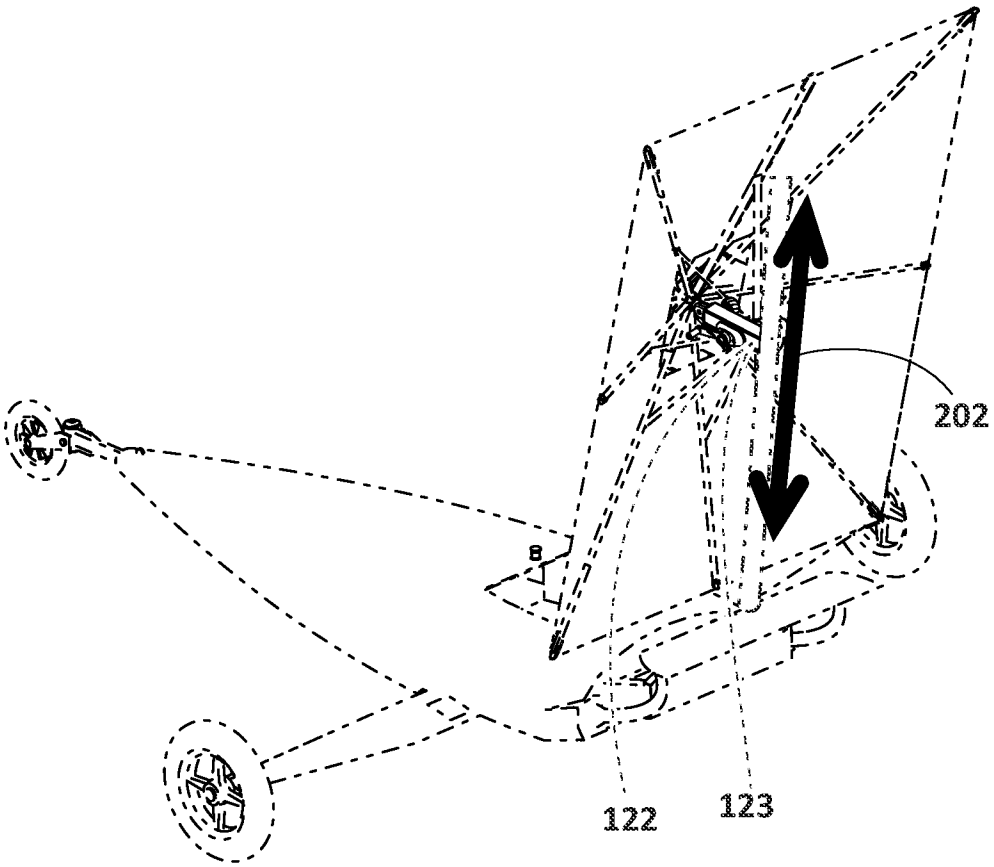
Figure 67:
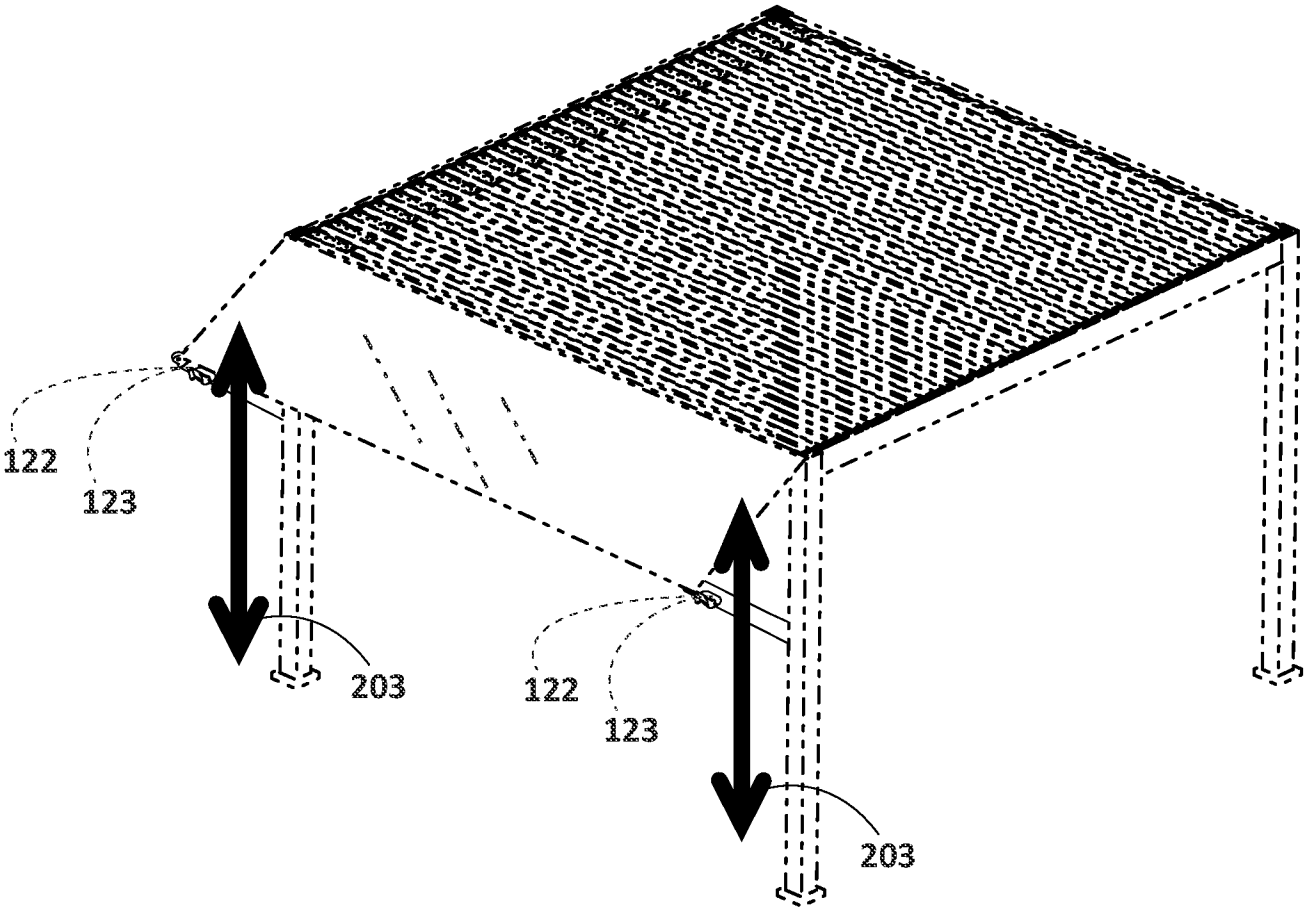
Figure 68:
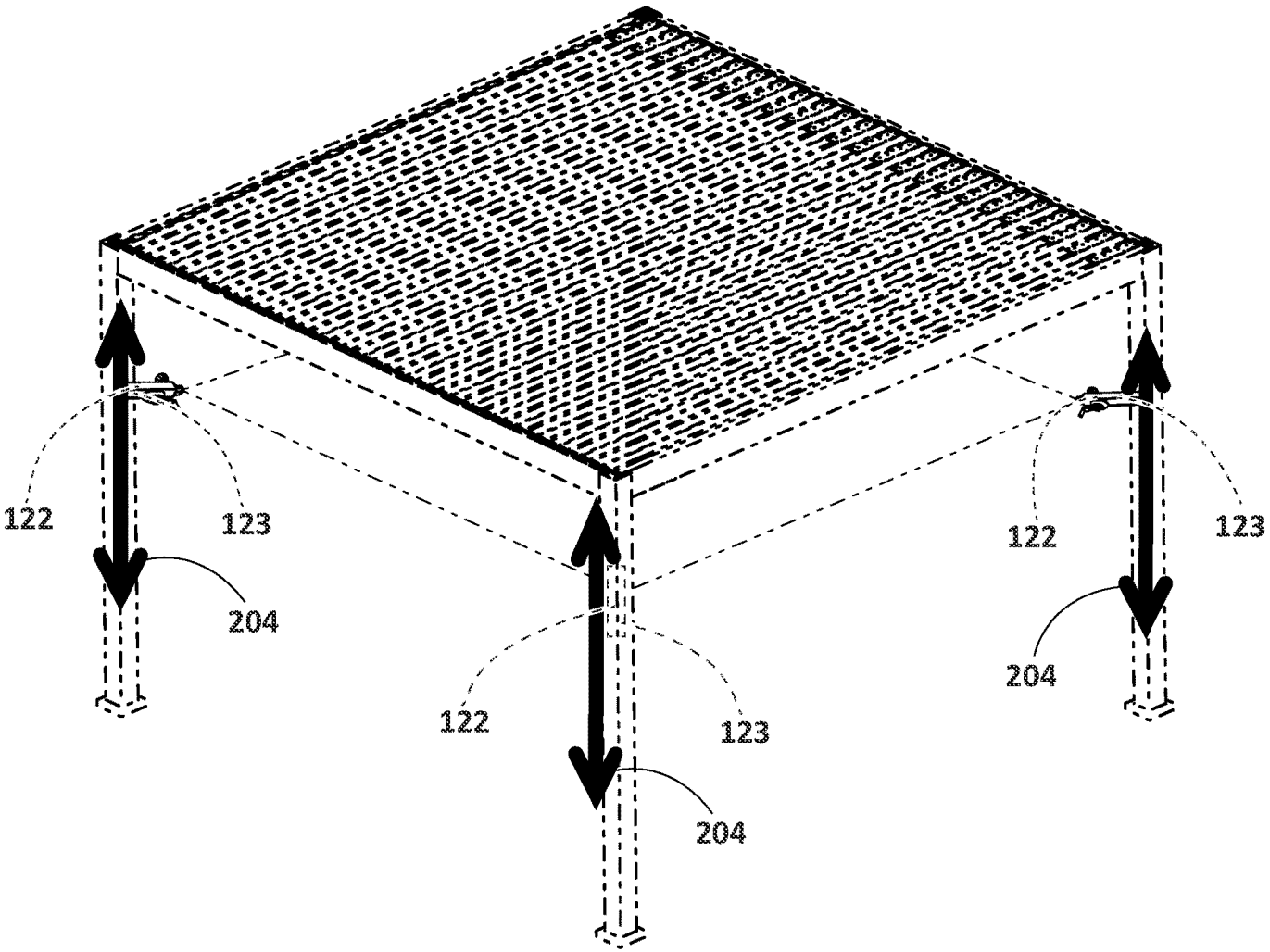
Figure 69:
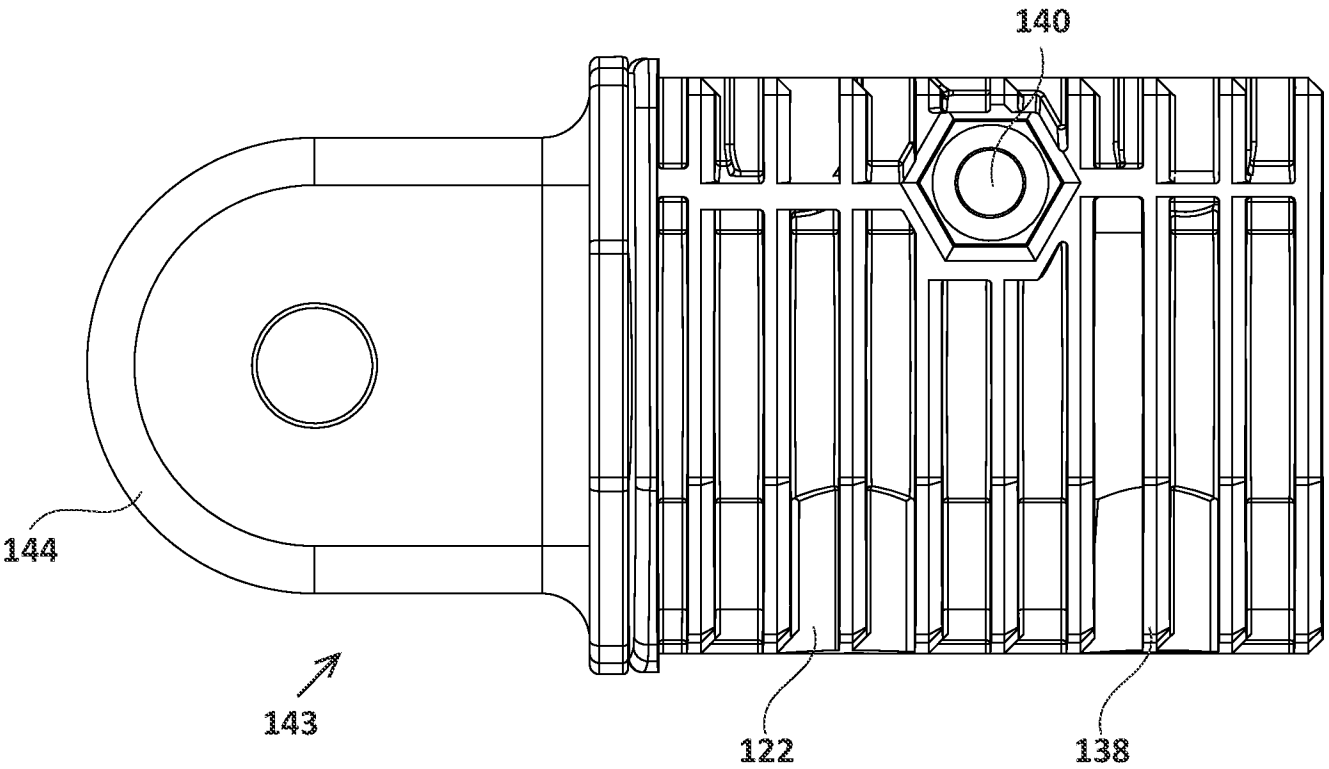
FIG. 69-FIG. 74 are diagrams illustrating side and top views demonstrating various components and functions of 5-device-in-one anti-slipping anti-cracking opposite-twisting-jaw system 121.
Figure 70:
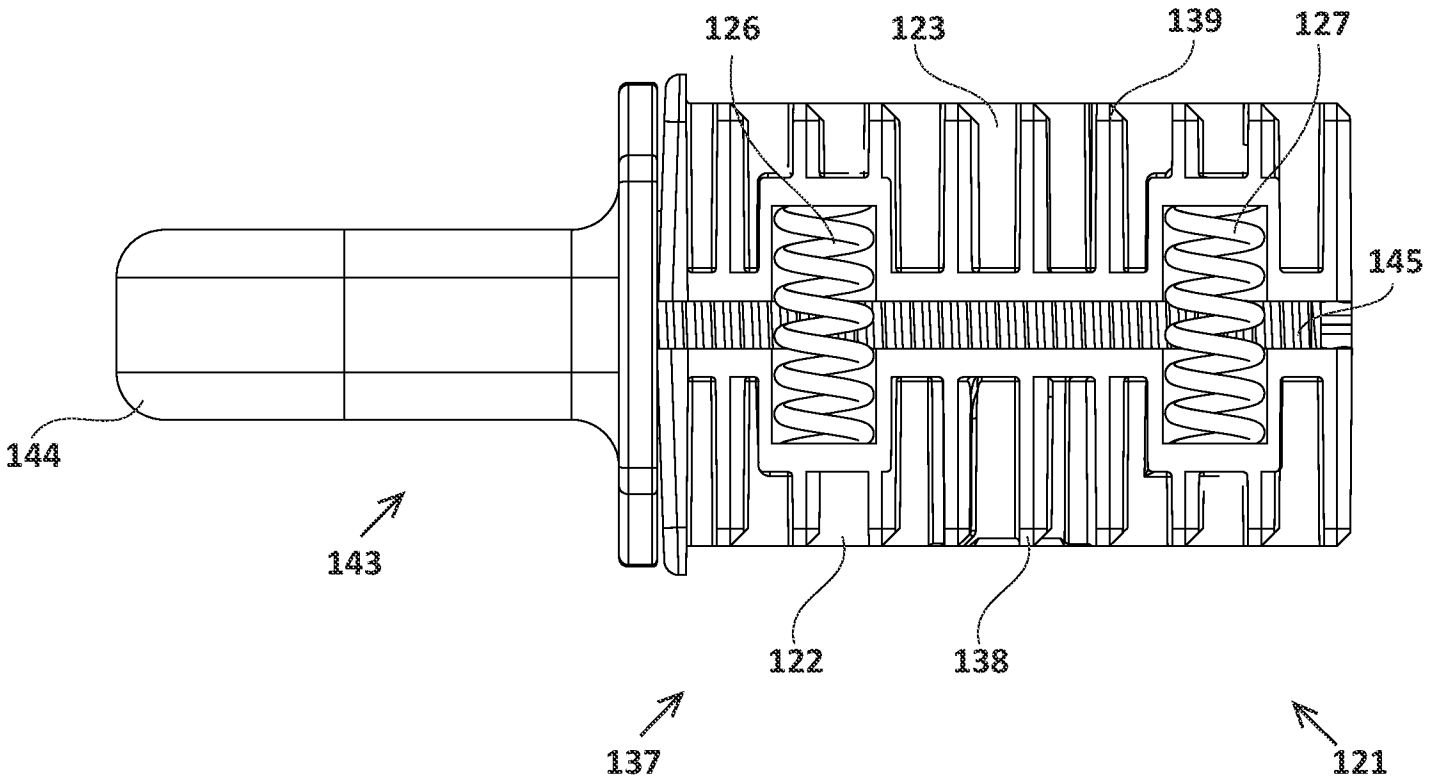
Figure 71:
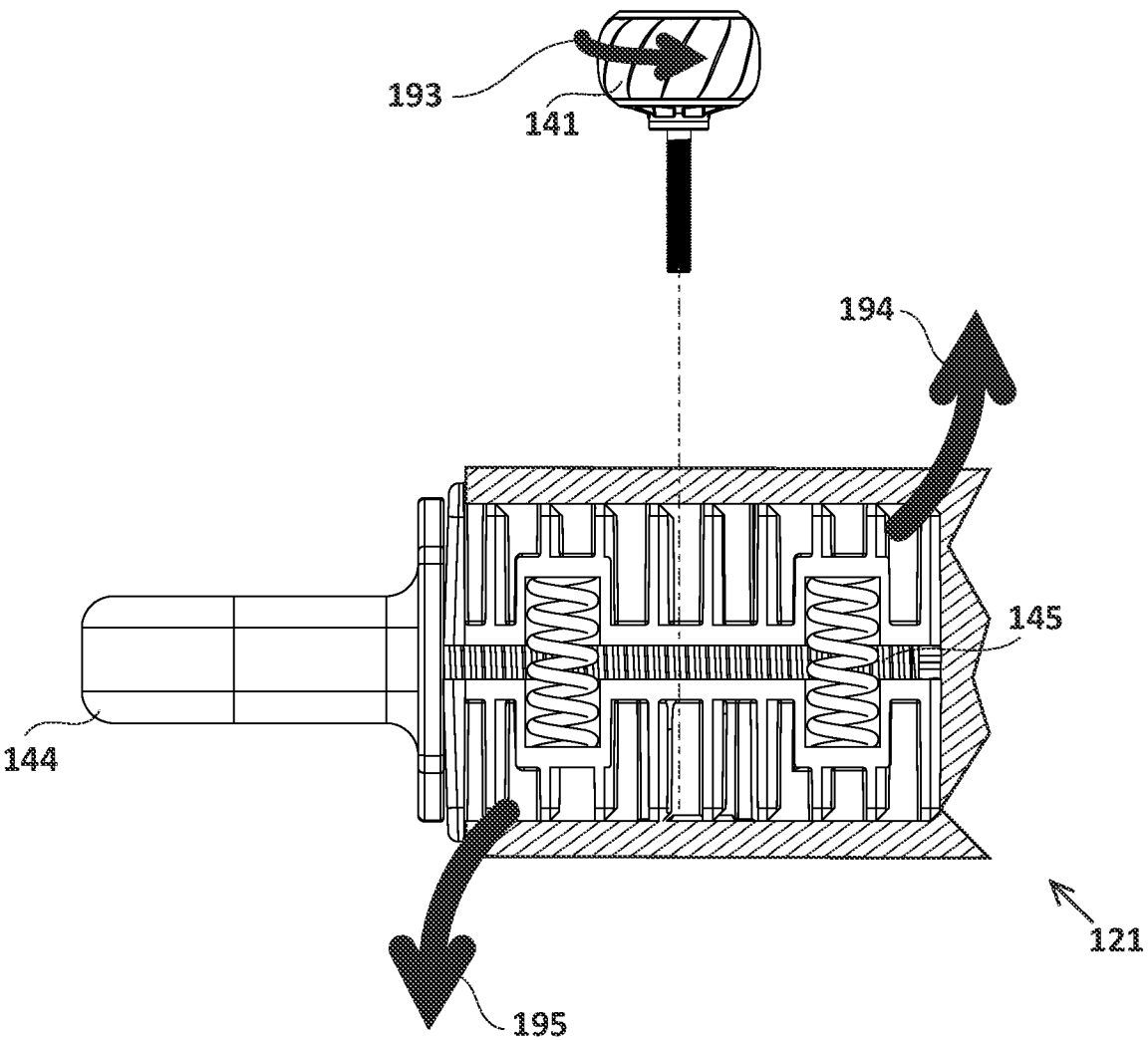
Figure 72:
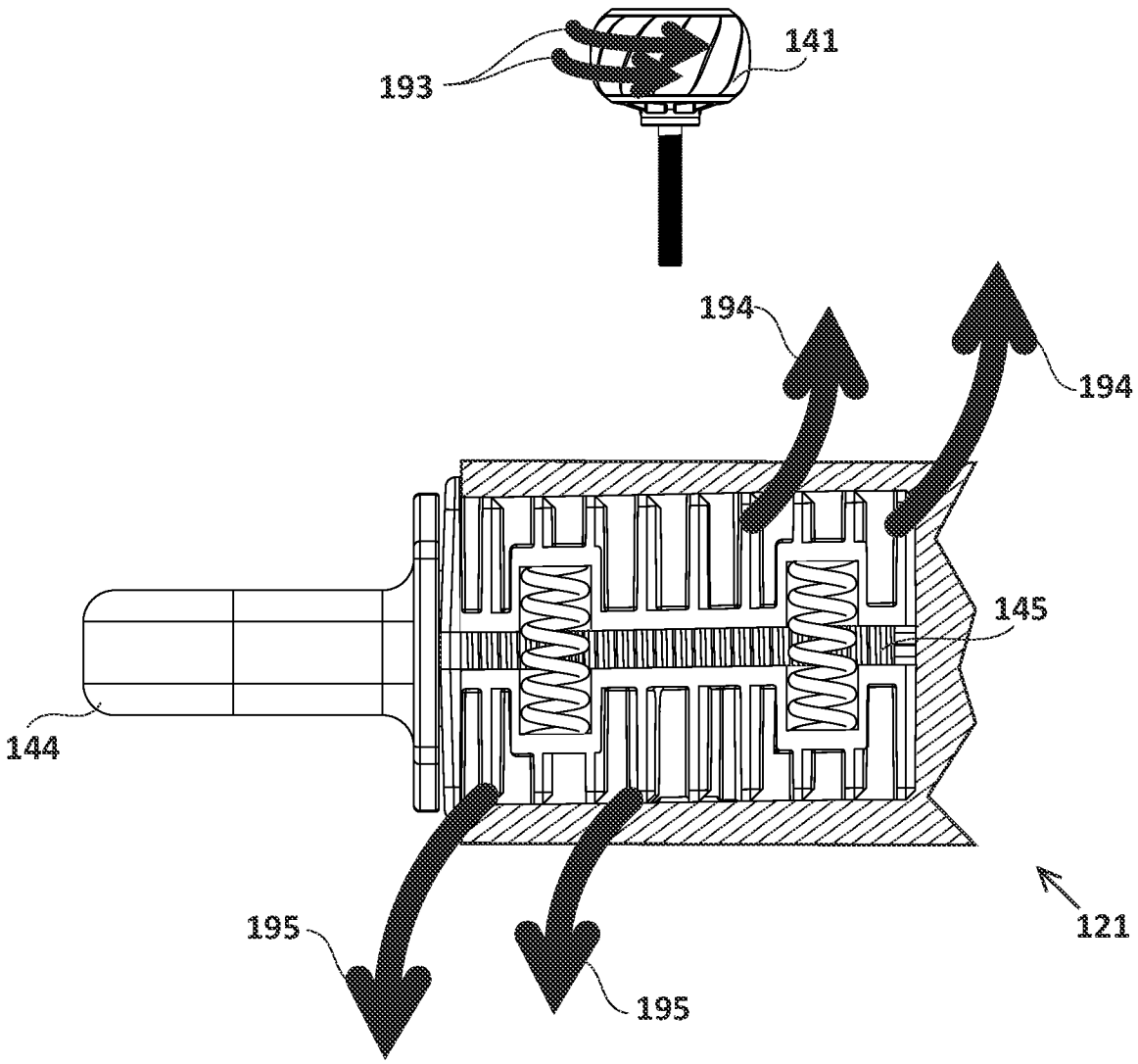
Figure 73:
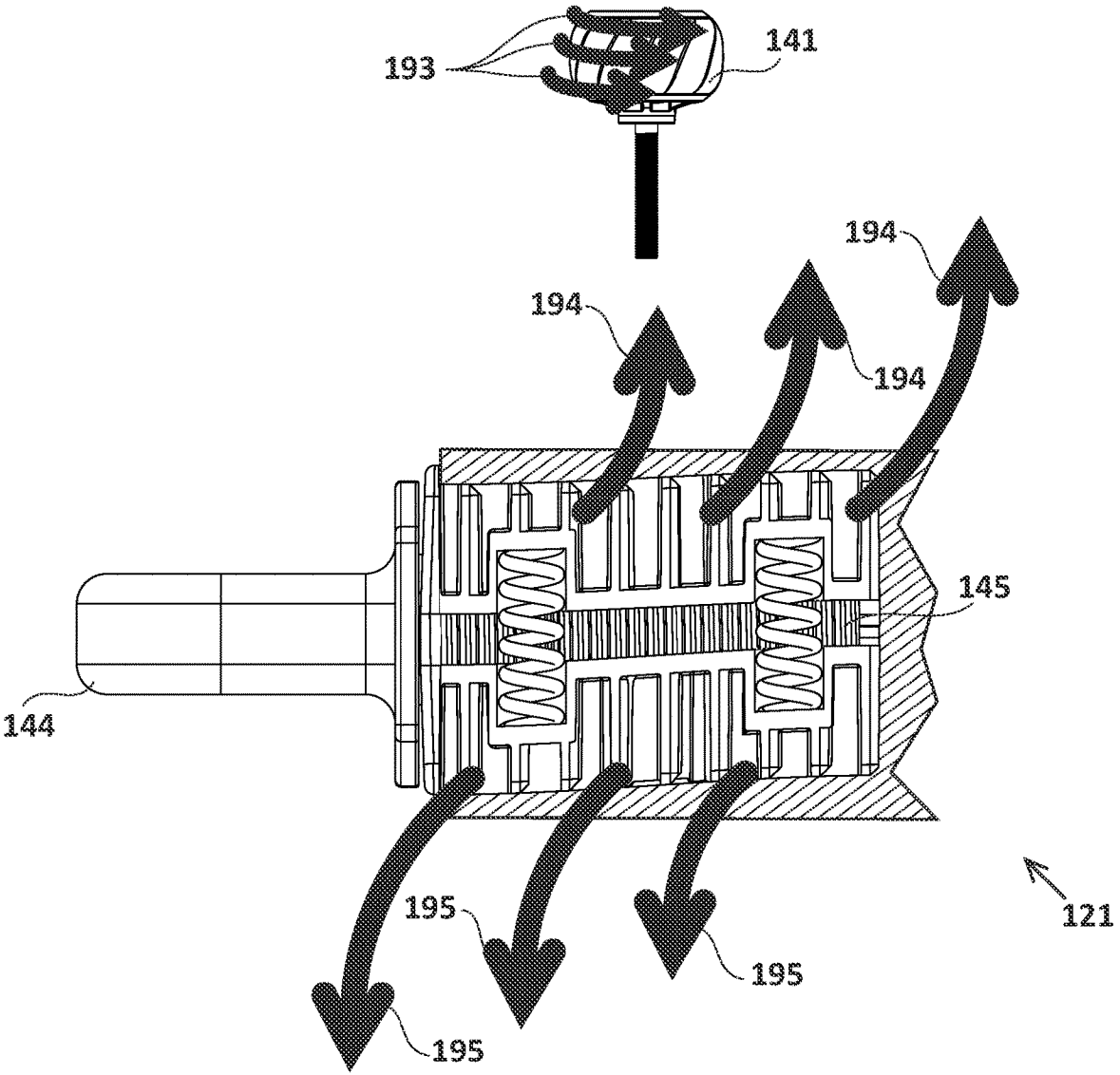
Figure 74:
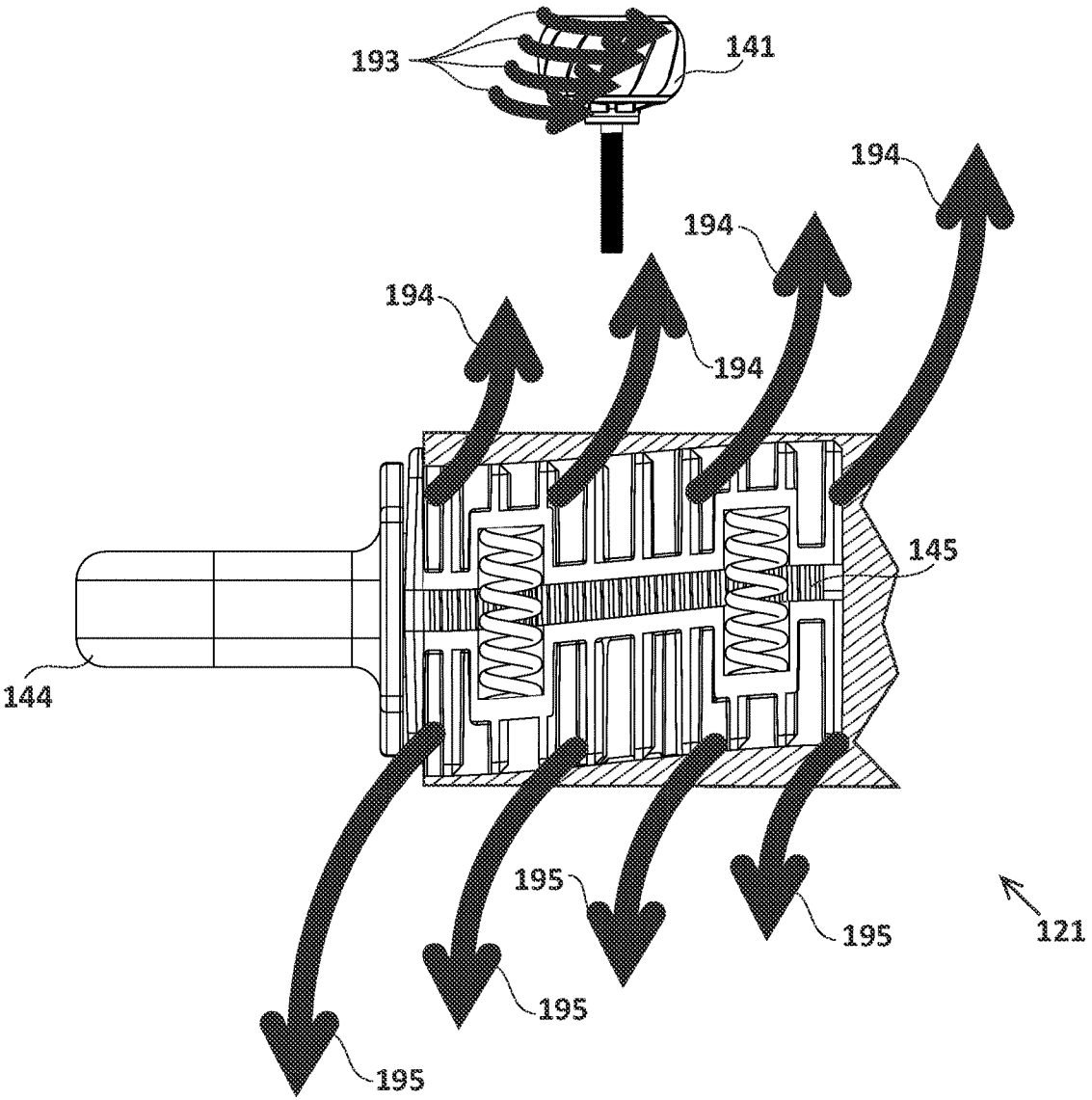
Figure 75:
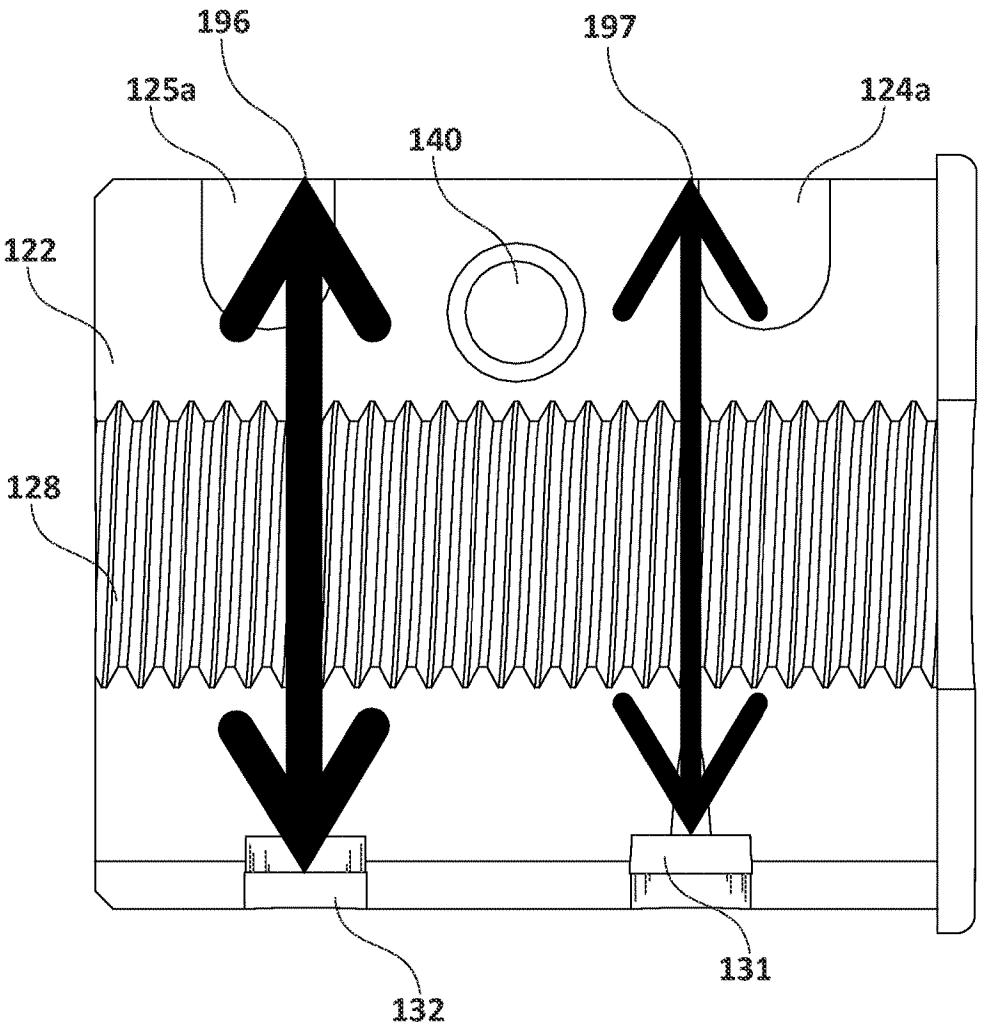
FIG. 75-FIG. 83 are diagrams illustrating side and perspective views demonstrating components and assembly of multi-elevation twistable-tube system 130.
Figure 76:
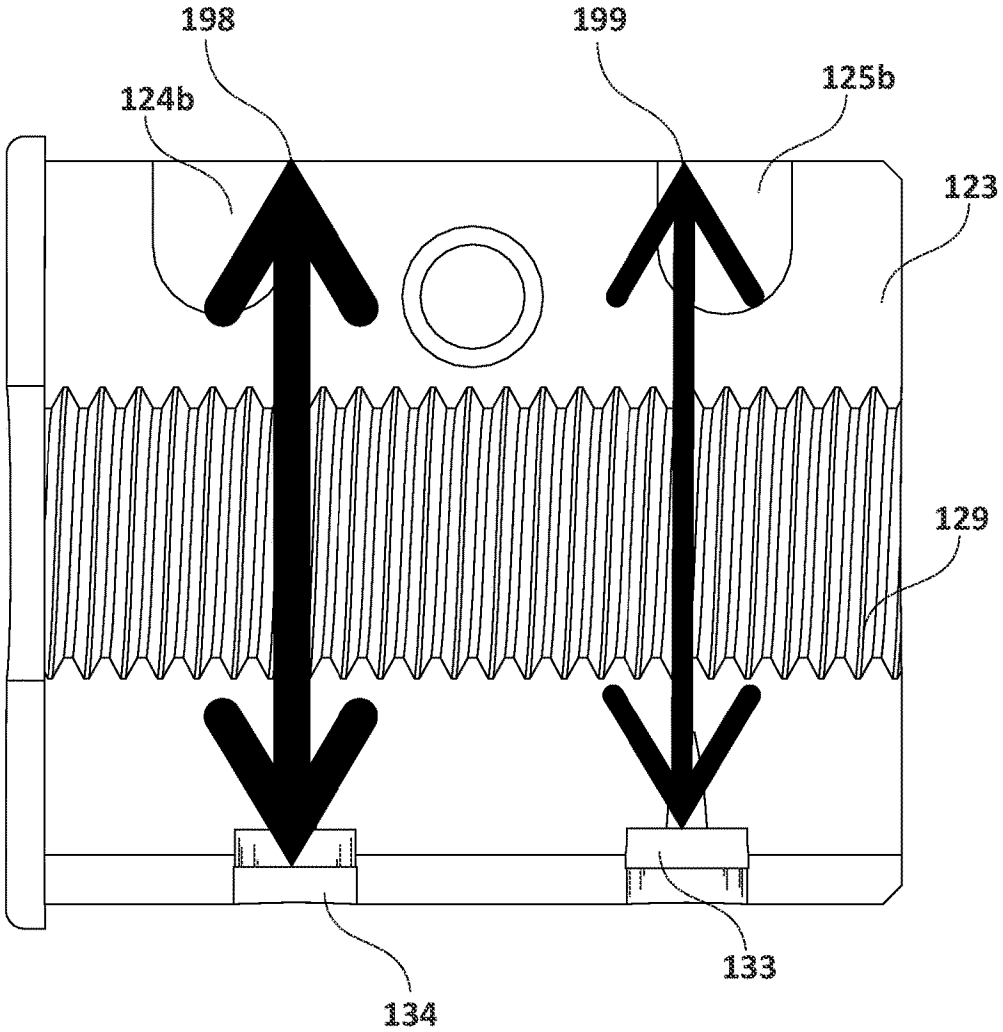
Figure 77:
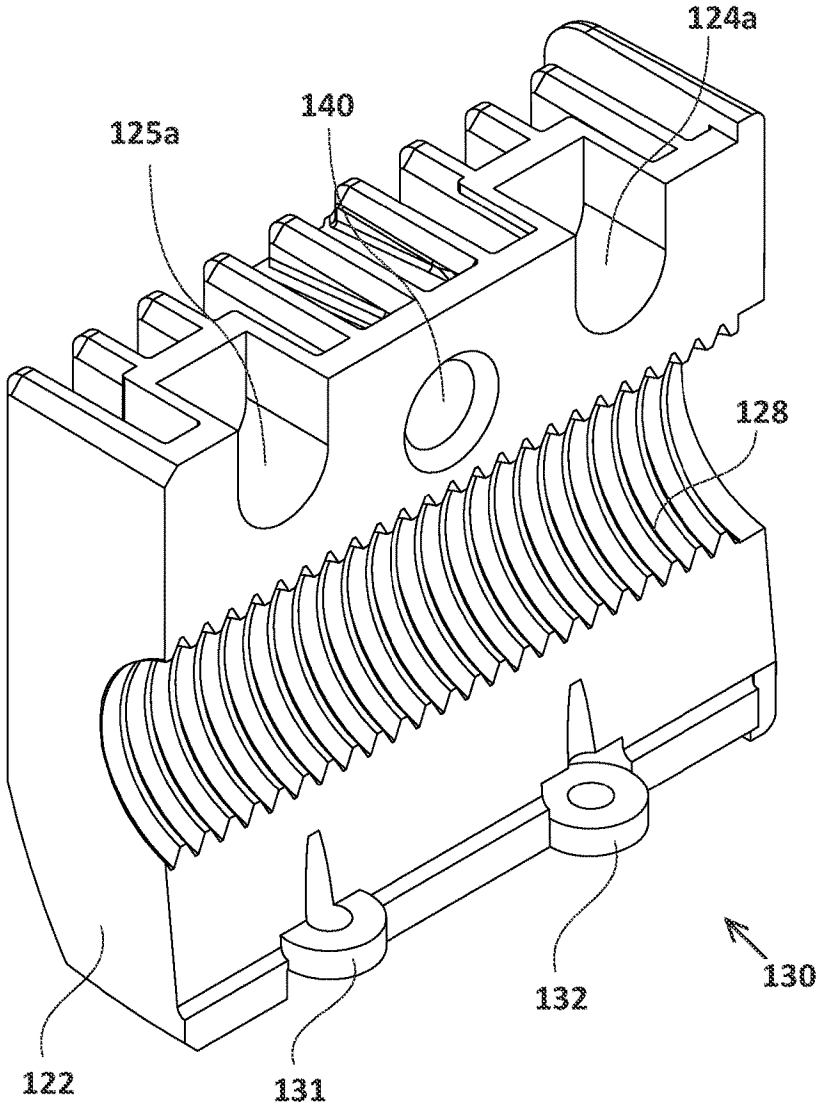
Figure 78:
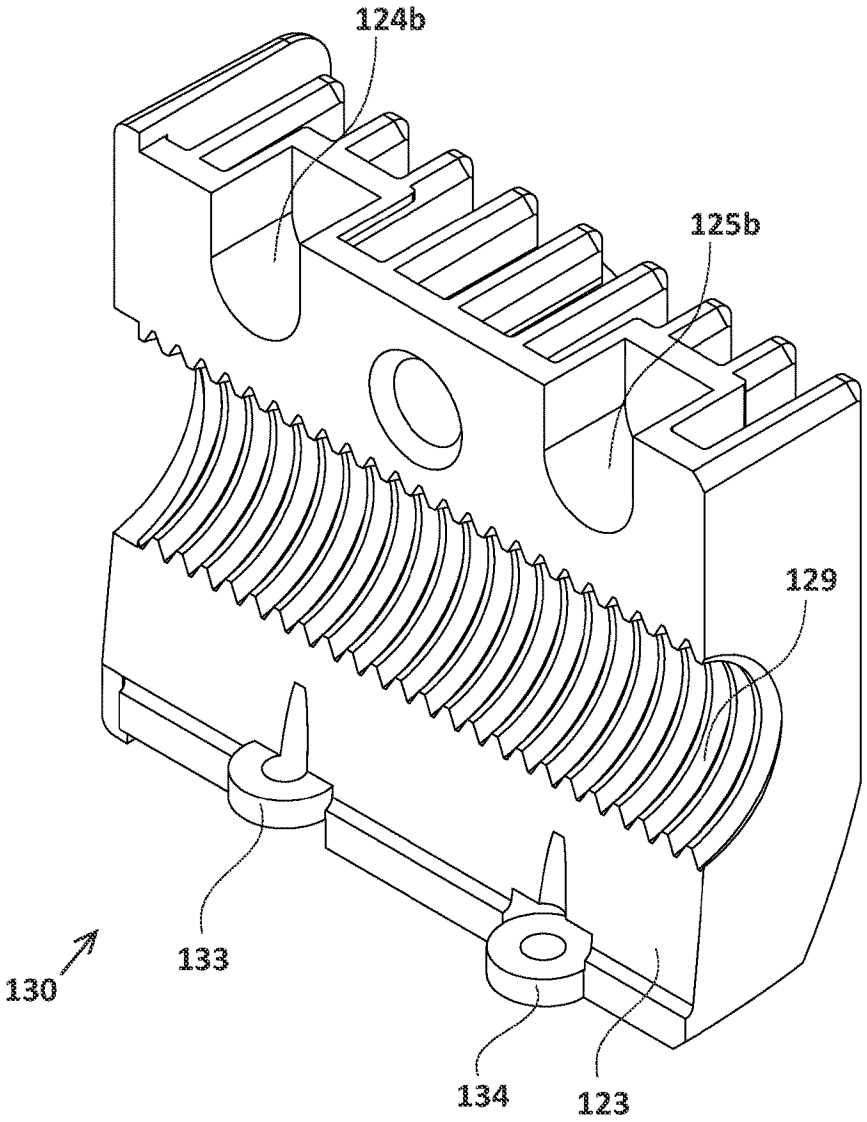
Figure 79:
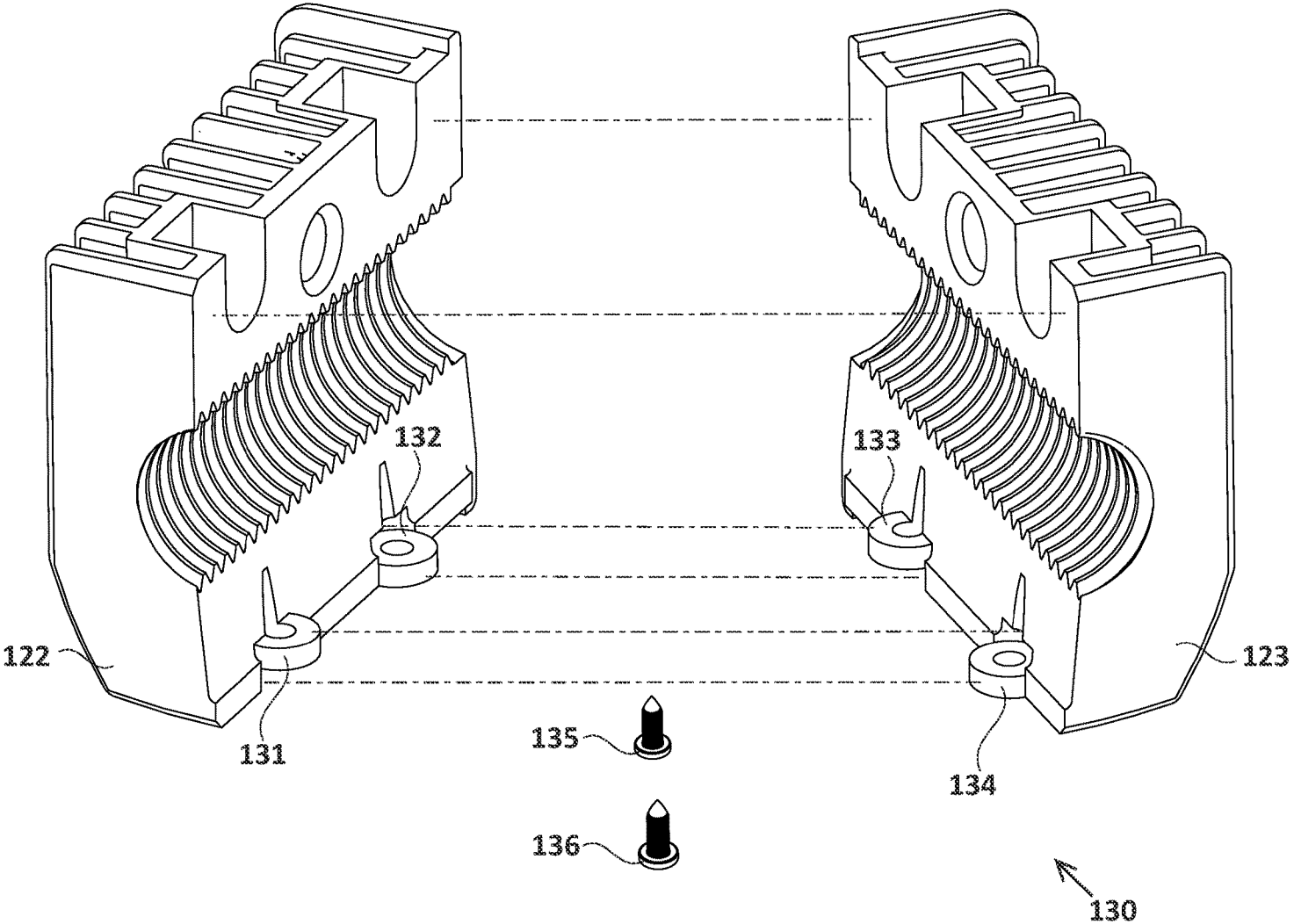
Figure 80:
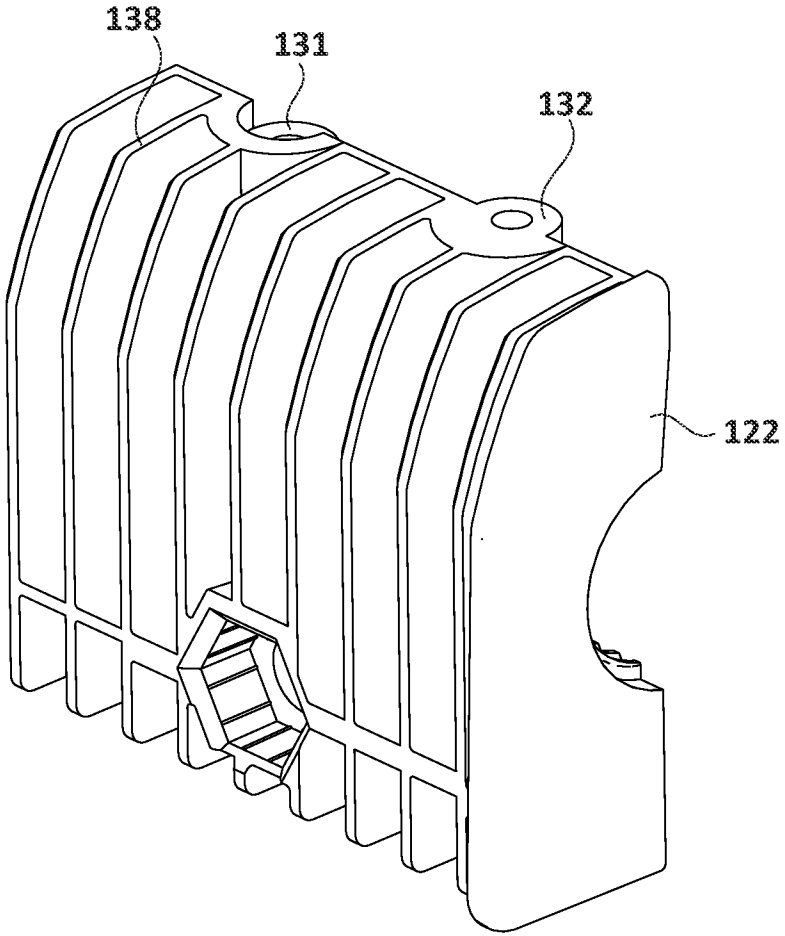
Figure 81:
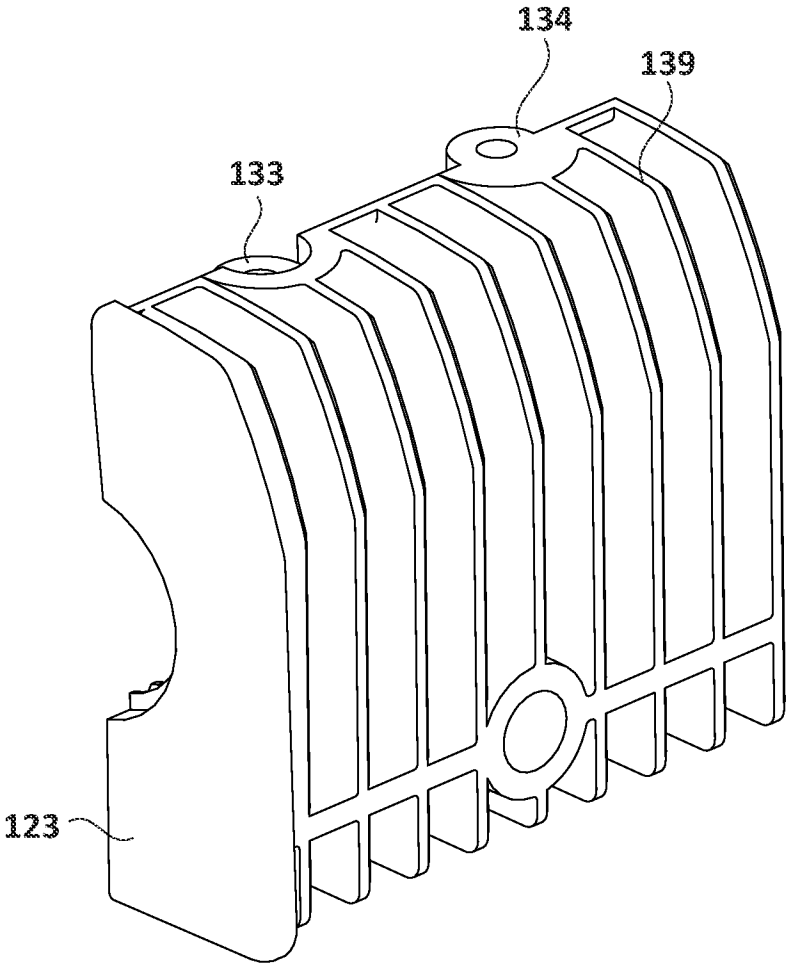
Figure 82:
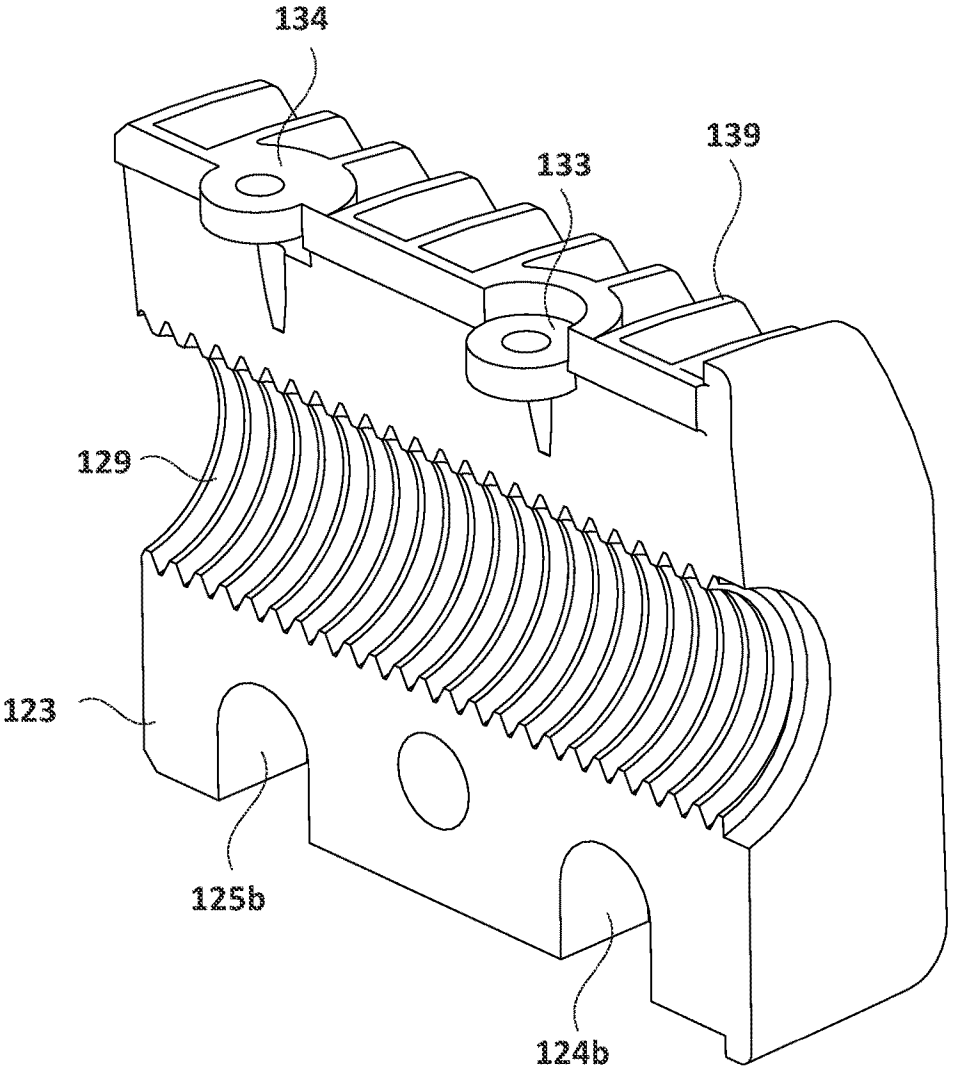
Figure 83:
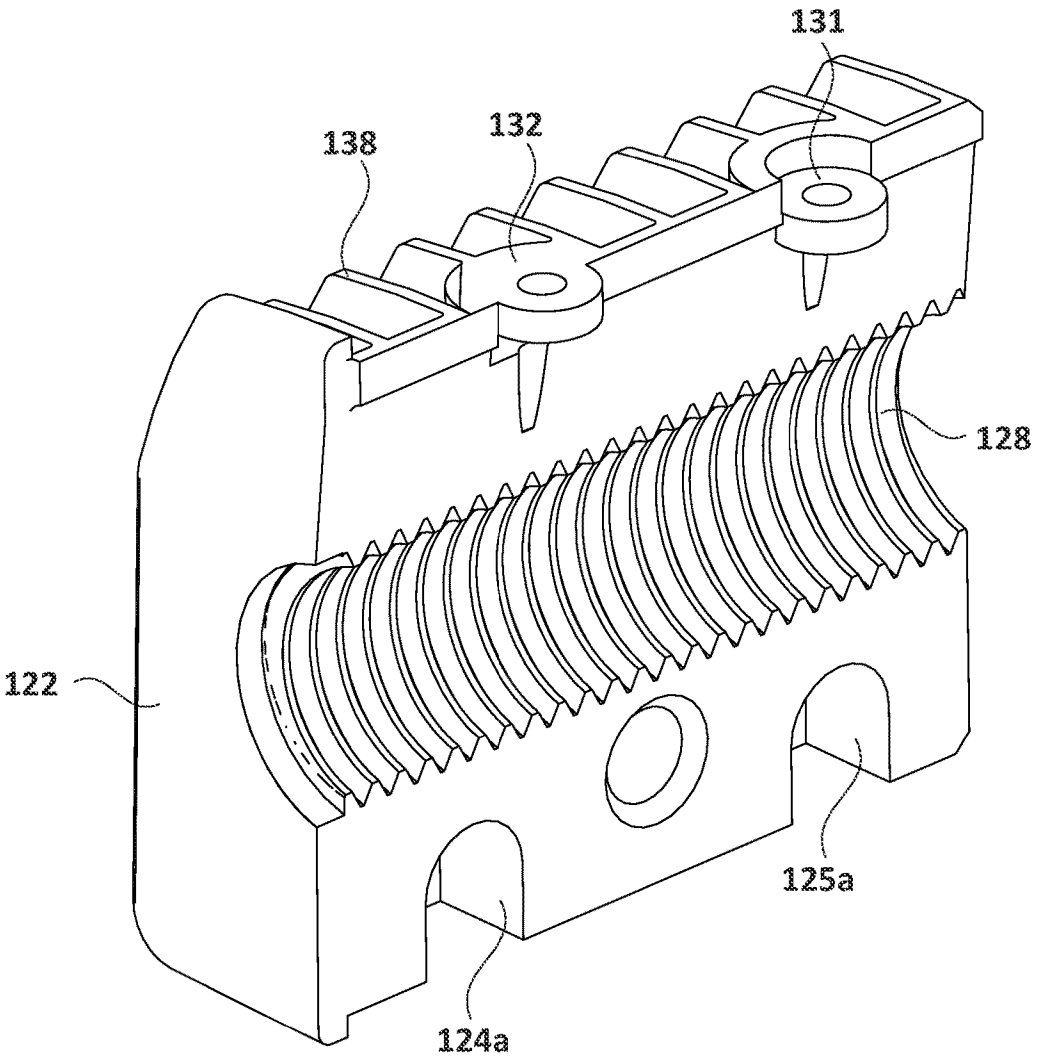
Figure 84:
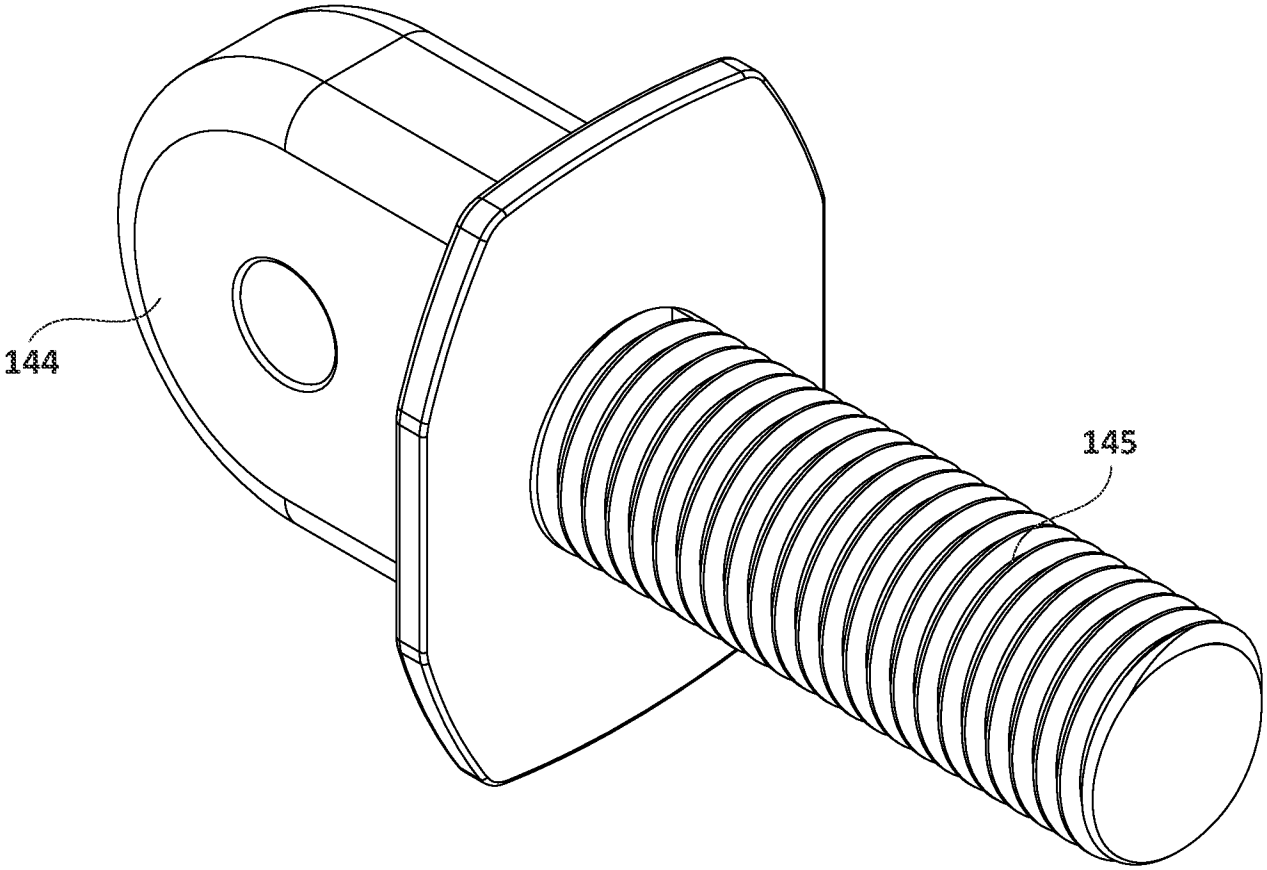
FIG. 84 are diagrams illustrating a perspective view demonstrating multi-application pivoting-connector system 143.
Figure 85:
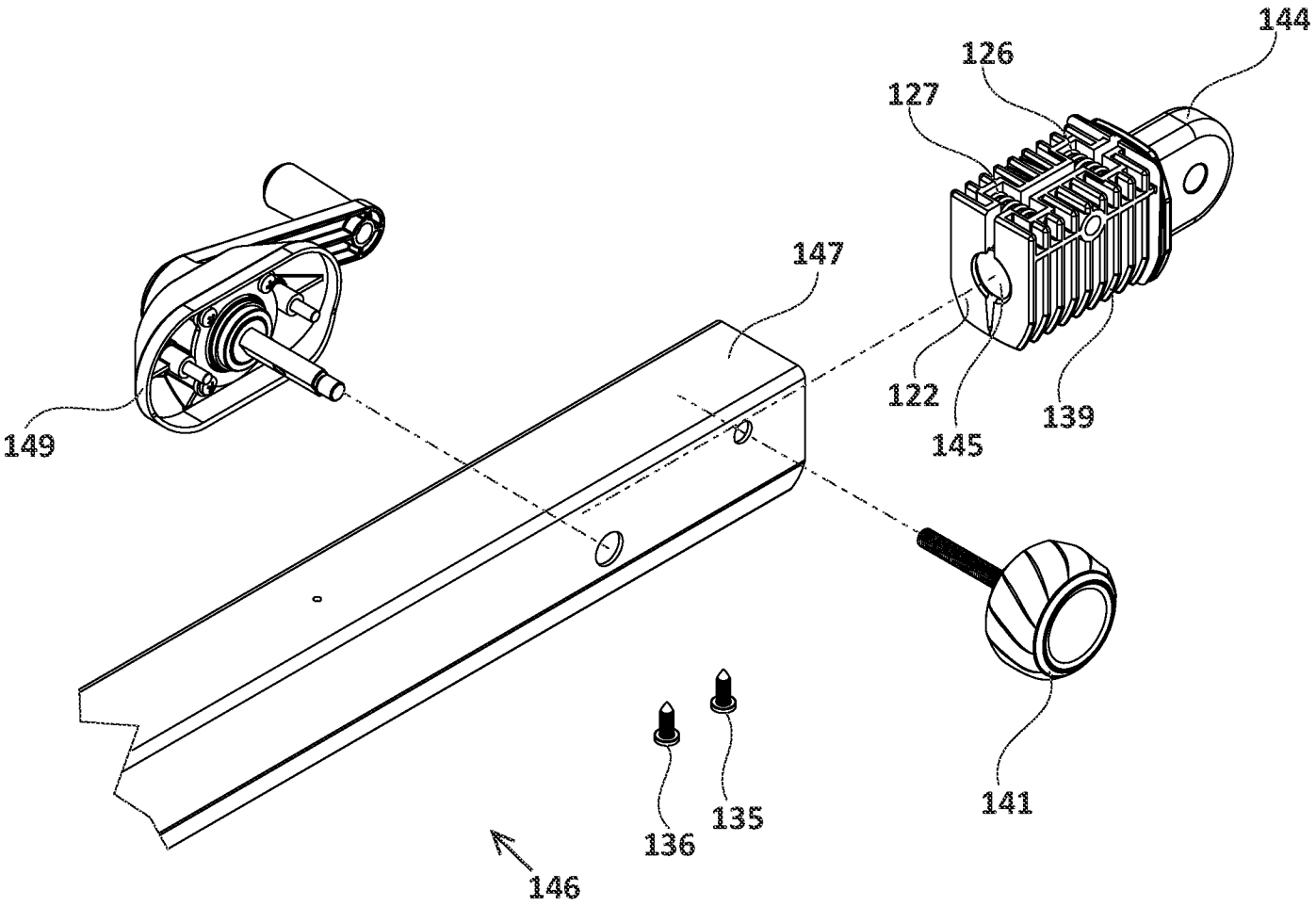
FIG. 85-FIG. 108 are diagrams illustrating perspective, front, side, and top views demonstrating components, assemblies, and function of opposite-twisting-jaw-housing tunnel system 146.
Figure 86:
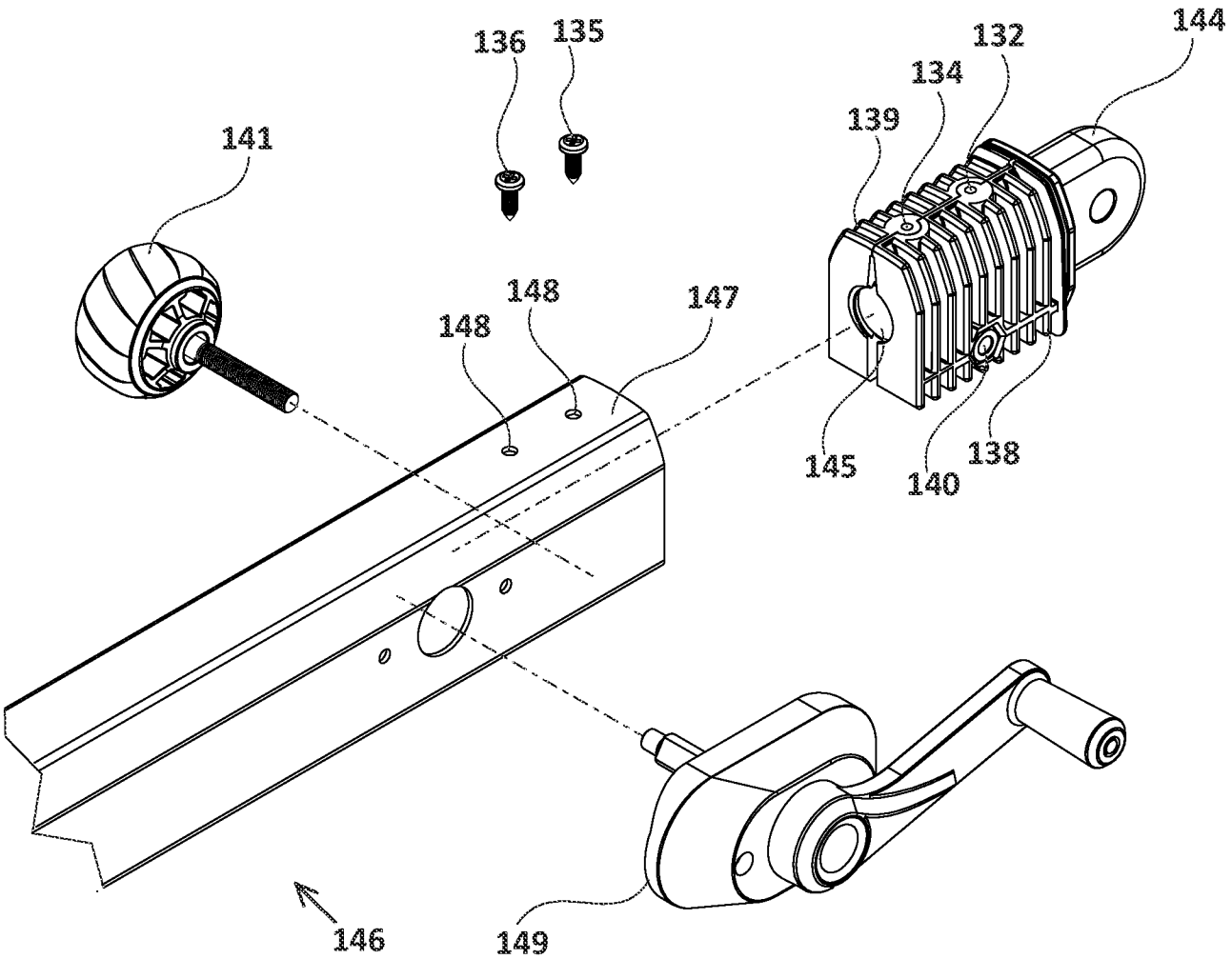
Figure 87:
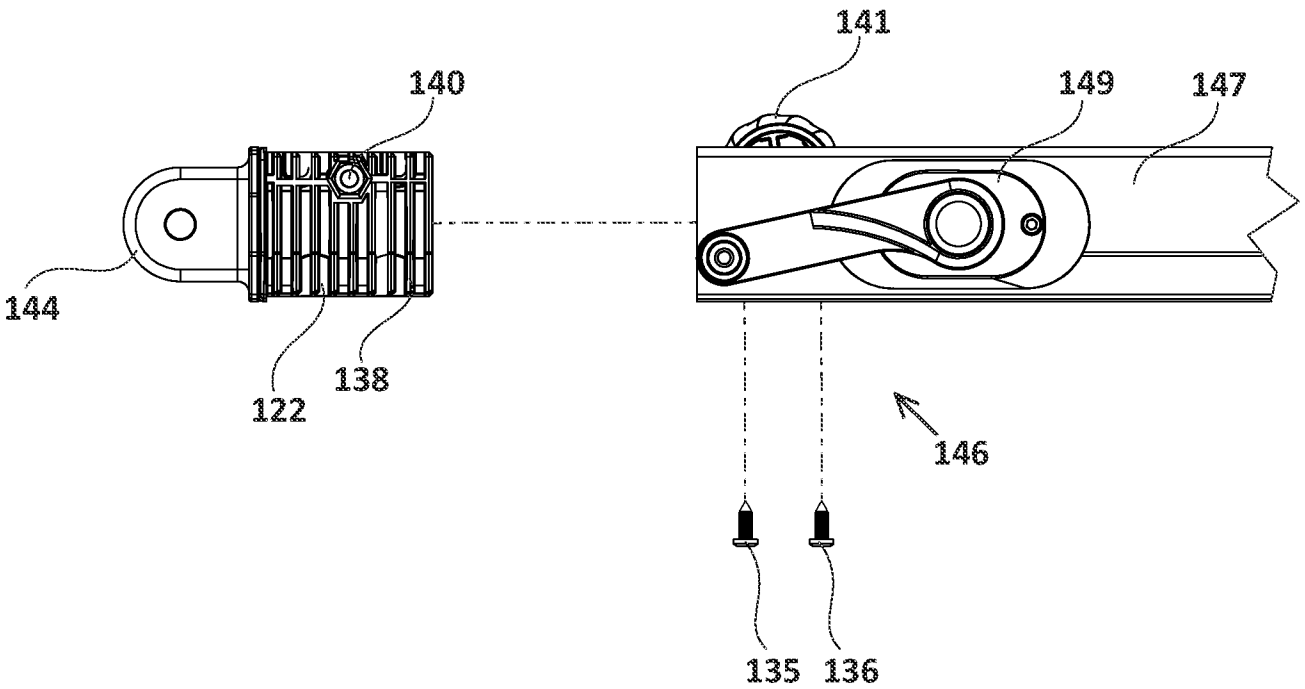
Figure 88:
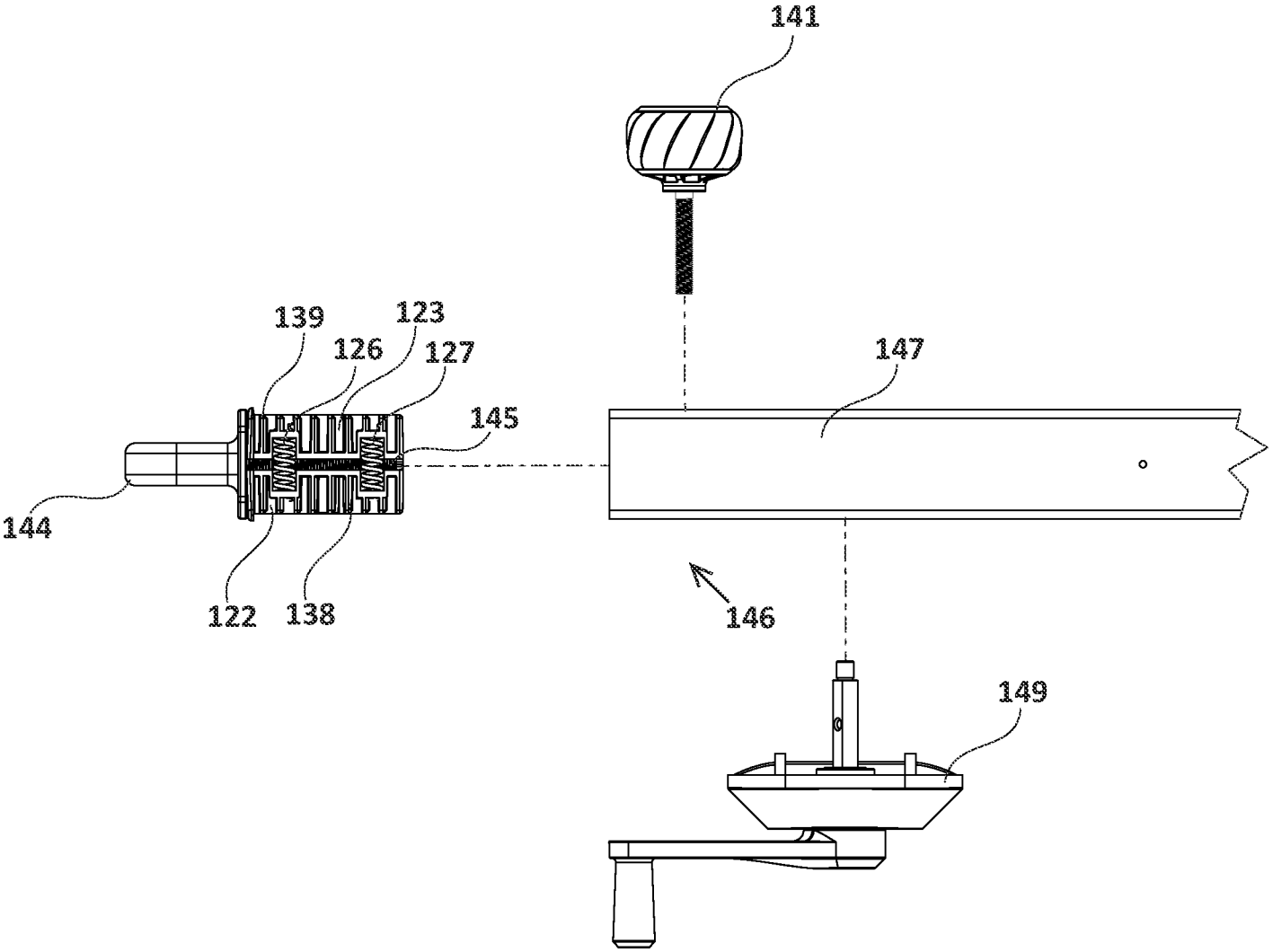

The prior art has failed to solve many problems associated with such umbrella, as follows:

1) No prior art mention or disclose any umbrella, having arthritic-assisting anti-vibration anti-friction portable handle-elevator 107*a*. Therefore, the prior art of umbrella are not capable of eliminating the needs for an arthritic to fold and unfold his fingers to raise and lower arthritic-assisting anti-vibration anti-friction anti-pinching portable-elevator system 106 (see FIG. 51, FIG. 56, and FIG. 57); Not capable of securing and enclosing arthritic-assisting anti-vibration anti-friction portable roller-elevator 108 (see FIG. 10); Not capable of being used on umbrella post, hand rail, sail pole, awning arm, and pergola column (see FIG. 58-FIG. 62); and not capable of preventing an arthritic's hand from being pinched by multi-elevator stabilizer 113, arthritic-assisting anti-vibration anti-friction portable rollers 111, and roller axles 110 (see FIG. 51, FIG. 56, and FIG. 57).

Figure 3:
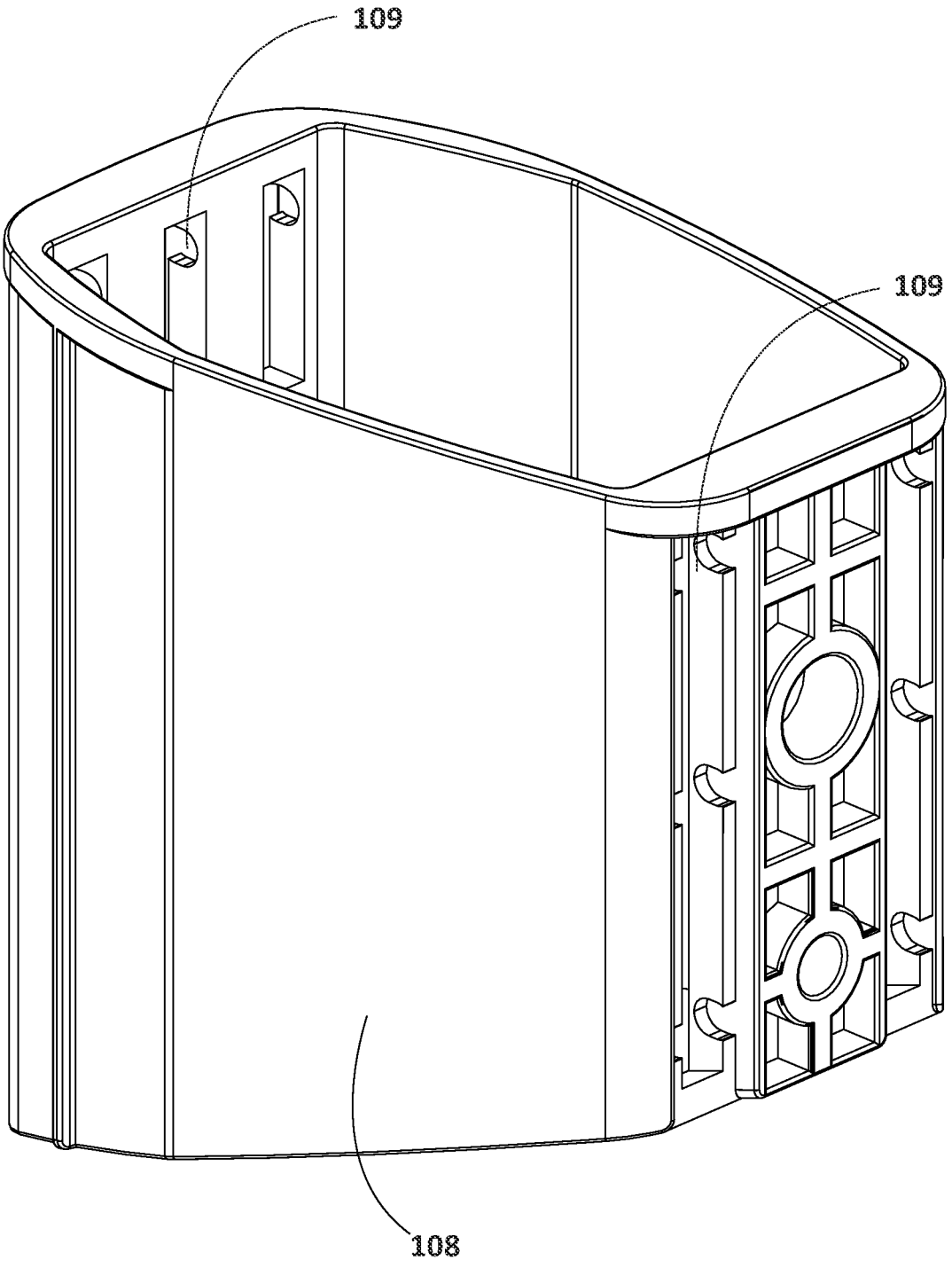
Figure 4:
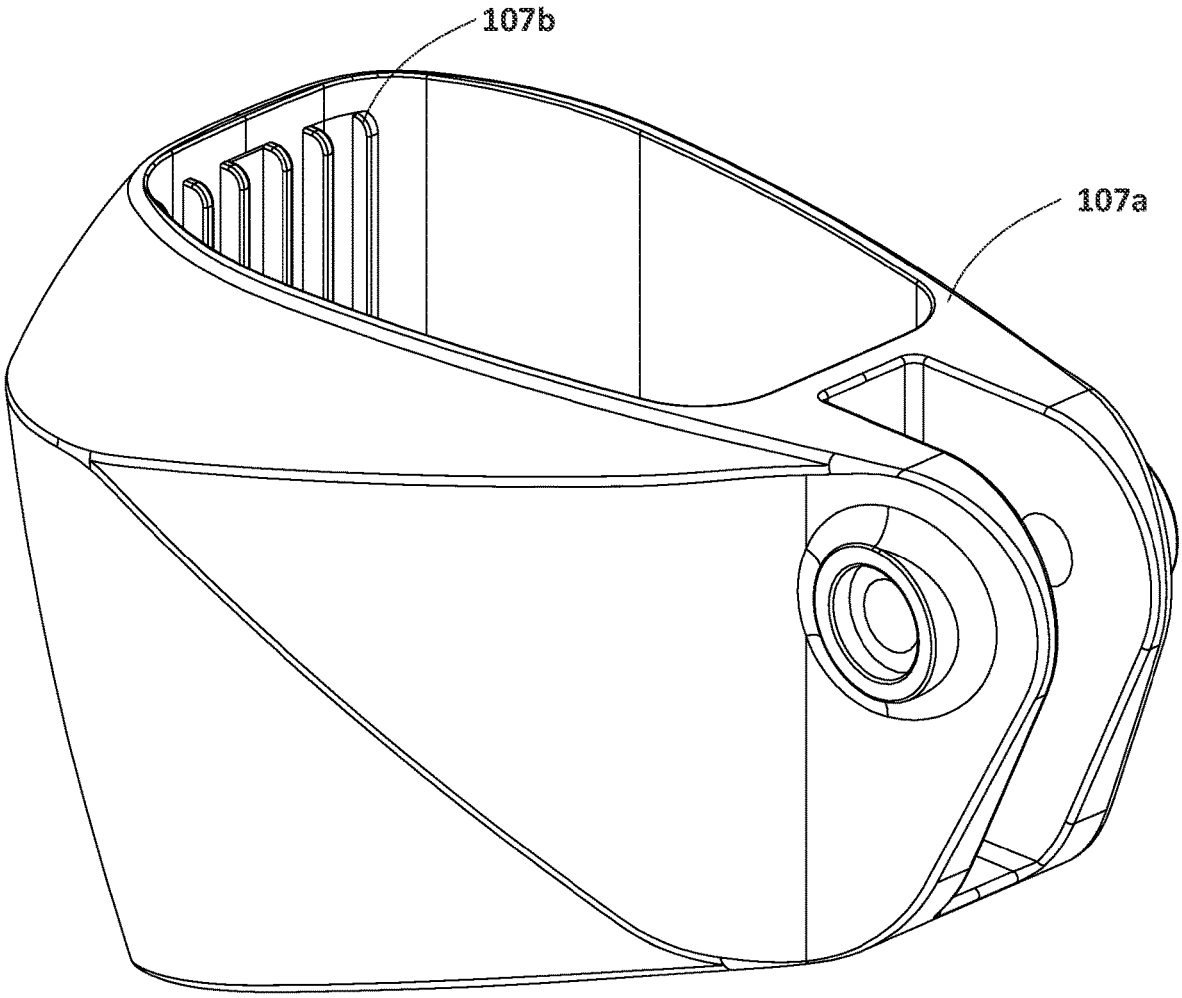
Figure 5:
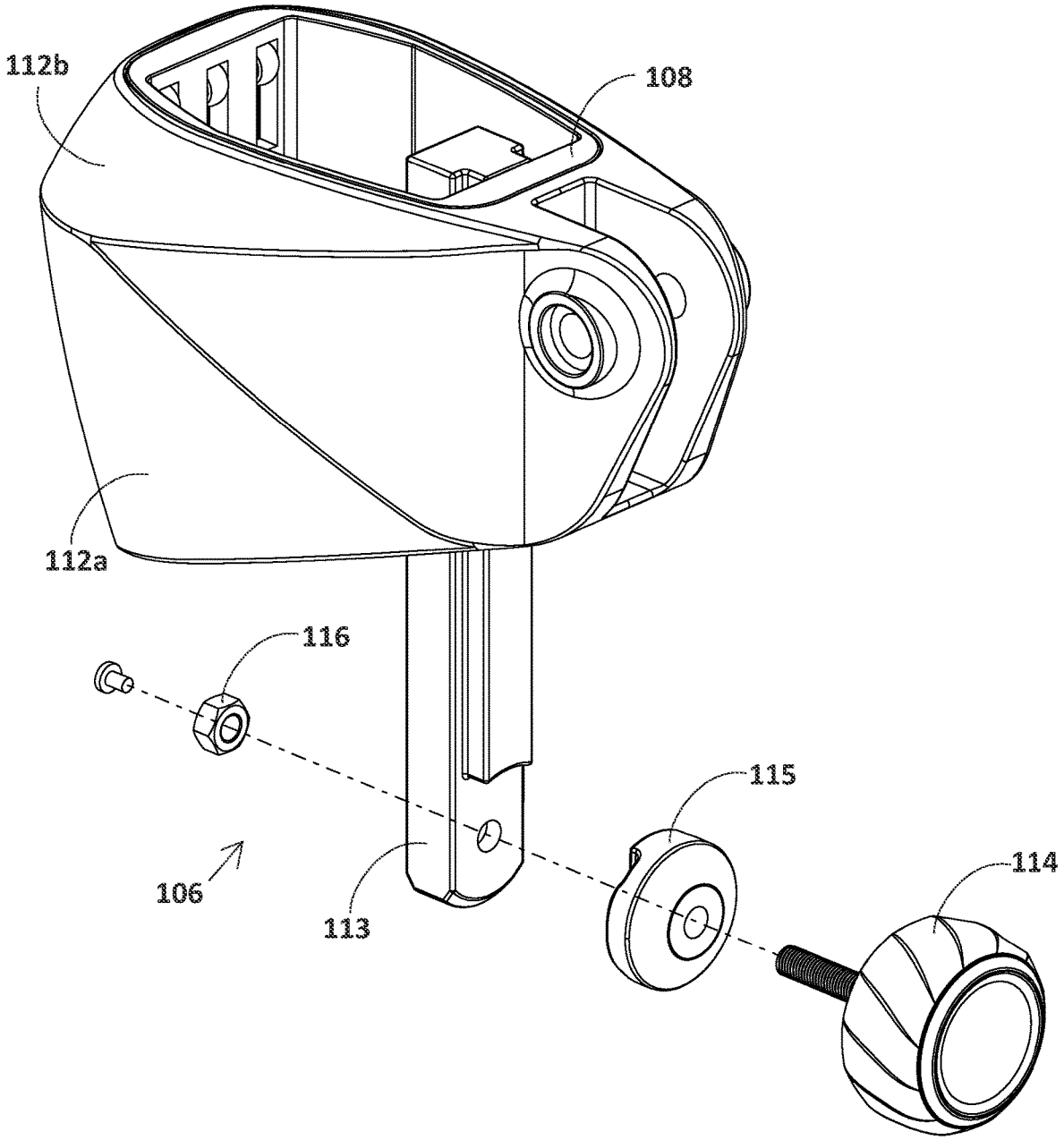
Figure 6:
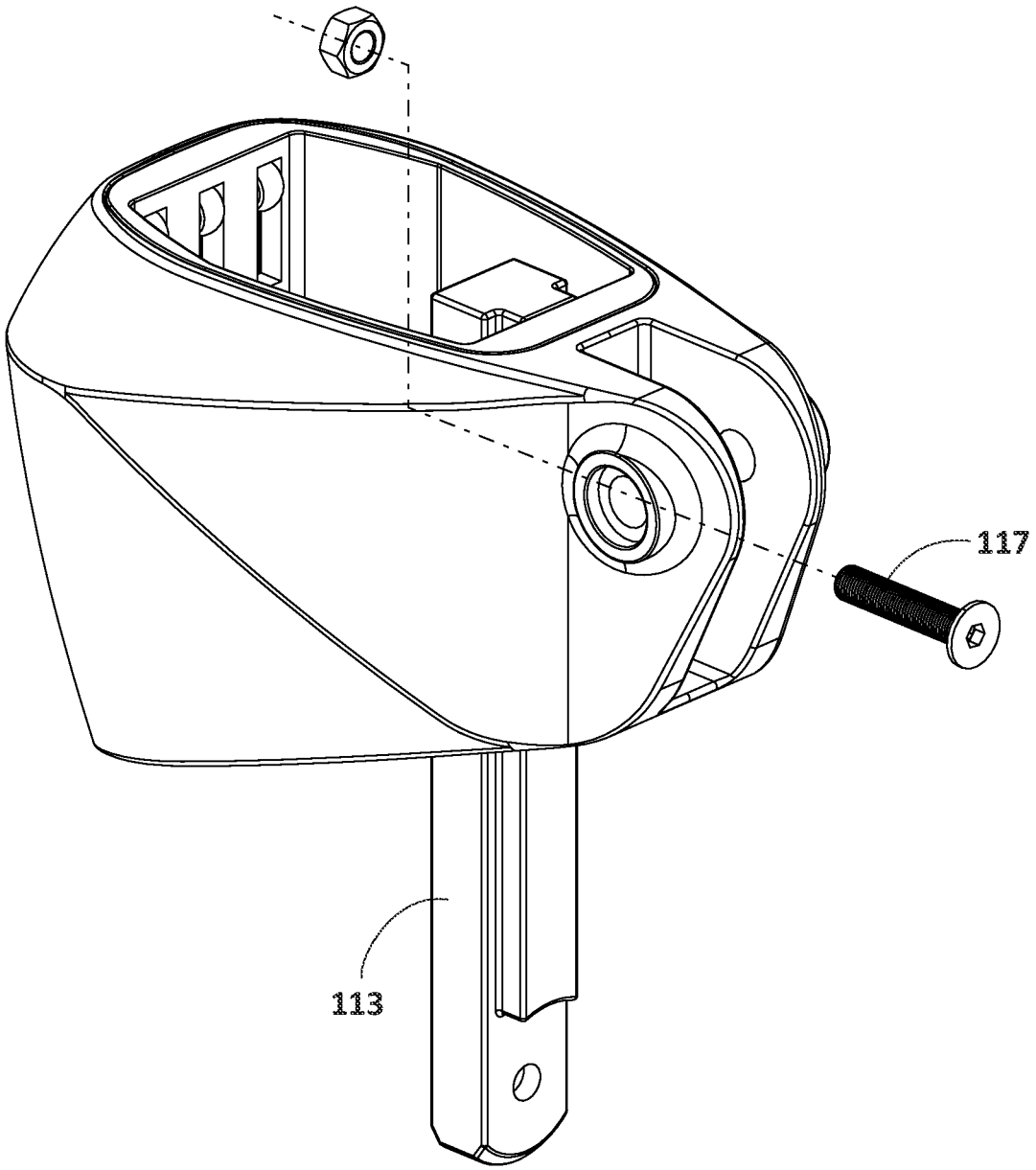
Figure 7:
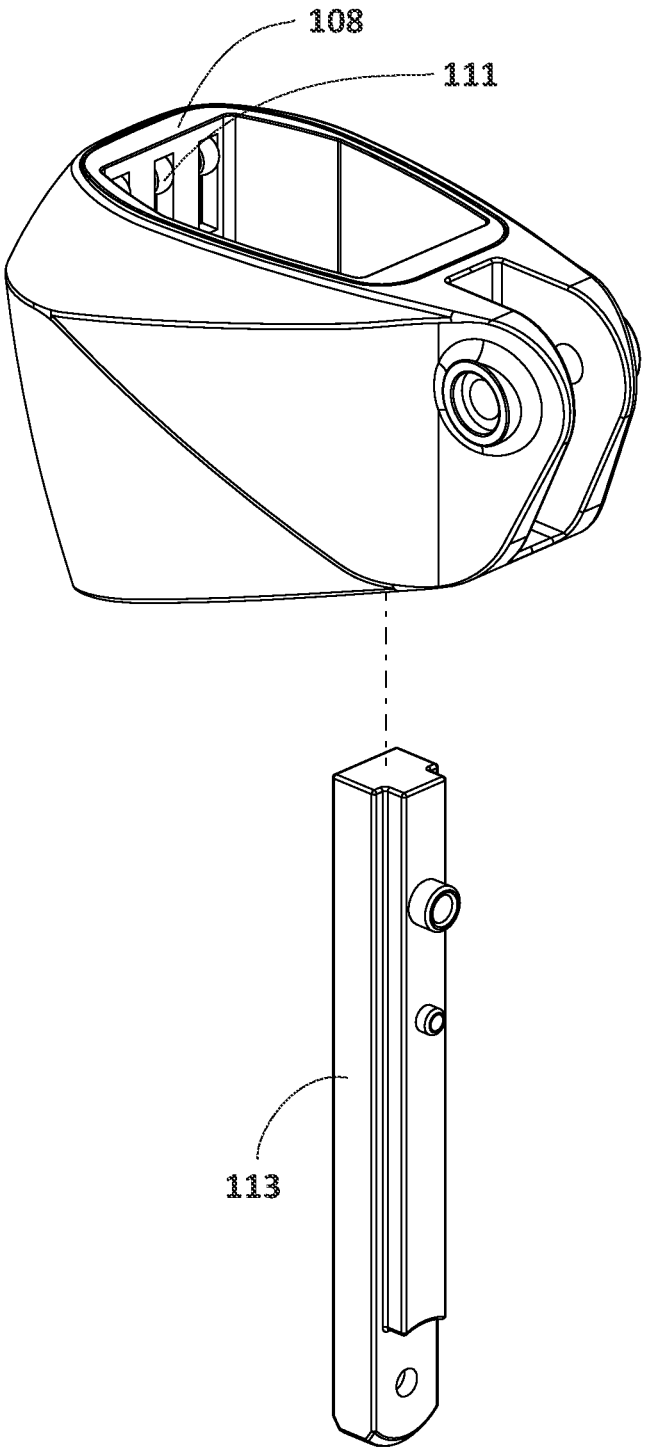
Figure 8:
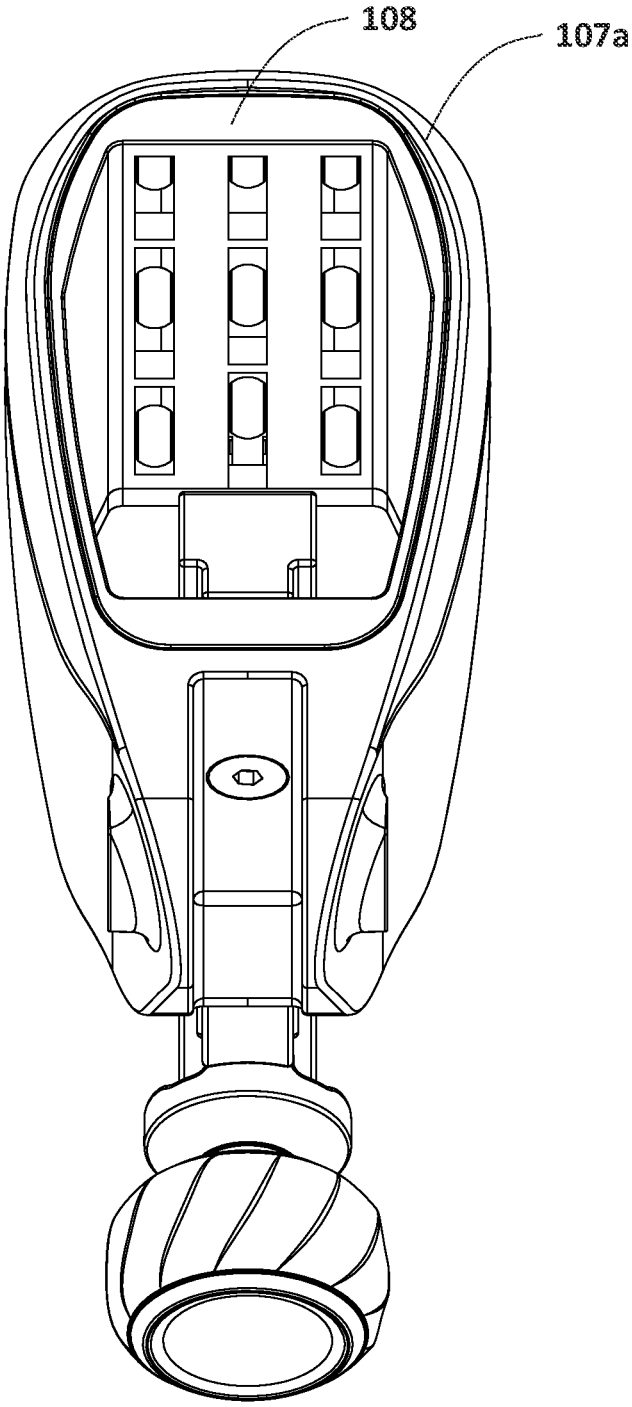
Figure 9:
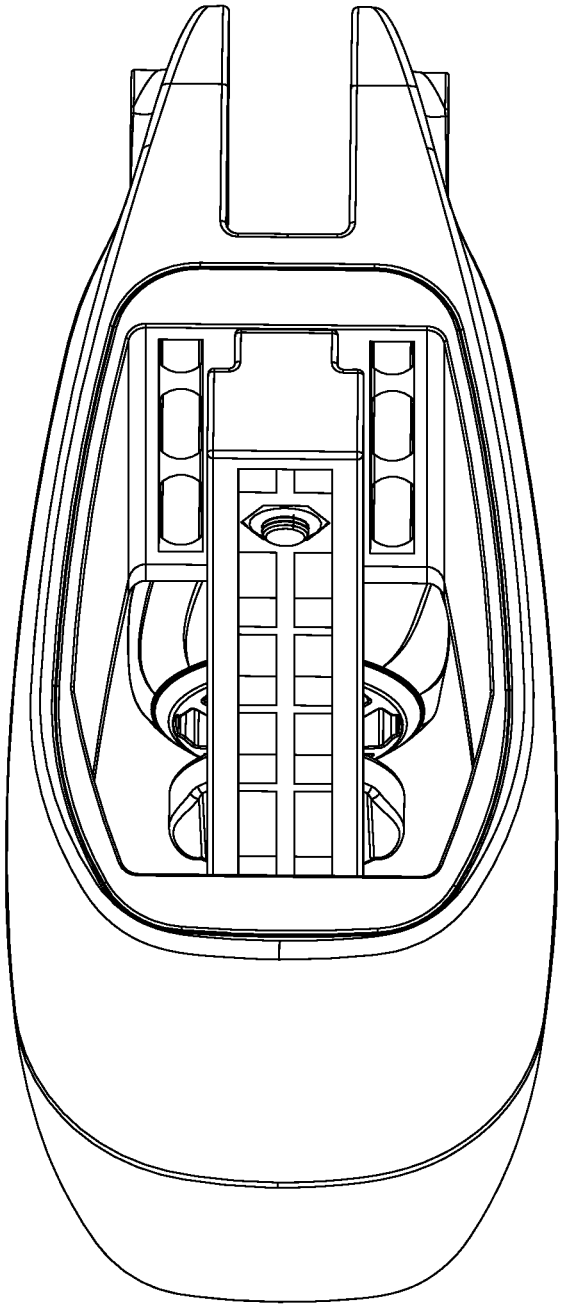

2) No prior art mention or disclose any umbrella, having arthritic-assisting anti-vibration anti-friction handle-elevator-track 107*b*. Therefore, the prior art of umbrella are: not capable of sealing arthritic-assisting anti-vibration anti-friction portable rollers 111 to protect a user's hand or an arthritic's hand; and not capable of guiding arthritic-assisting anti-vibration anti-friction portable rollers 111 (see FIG. 3).

Figure 2:
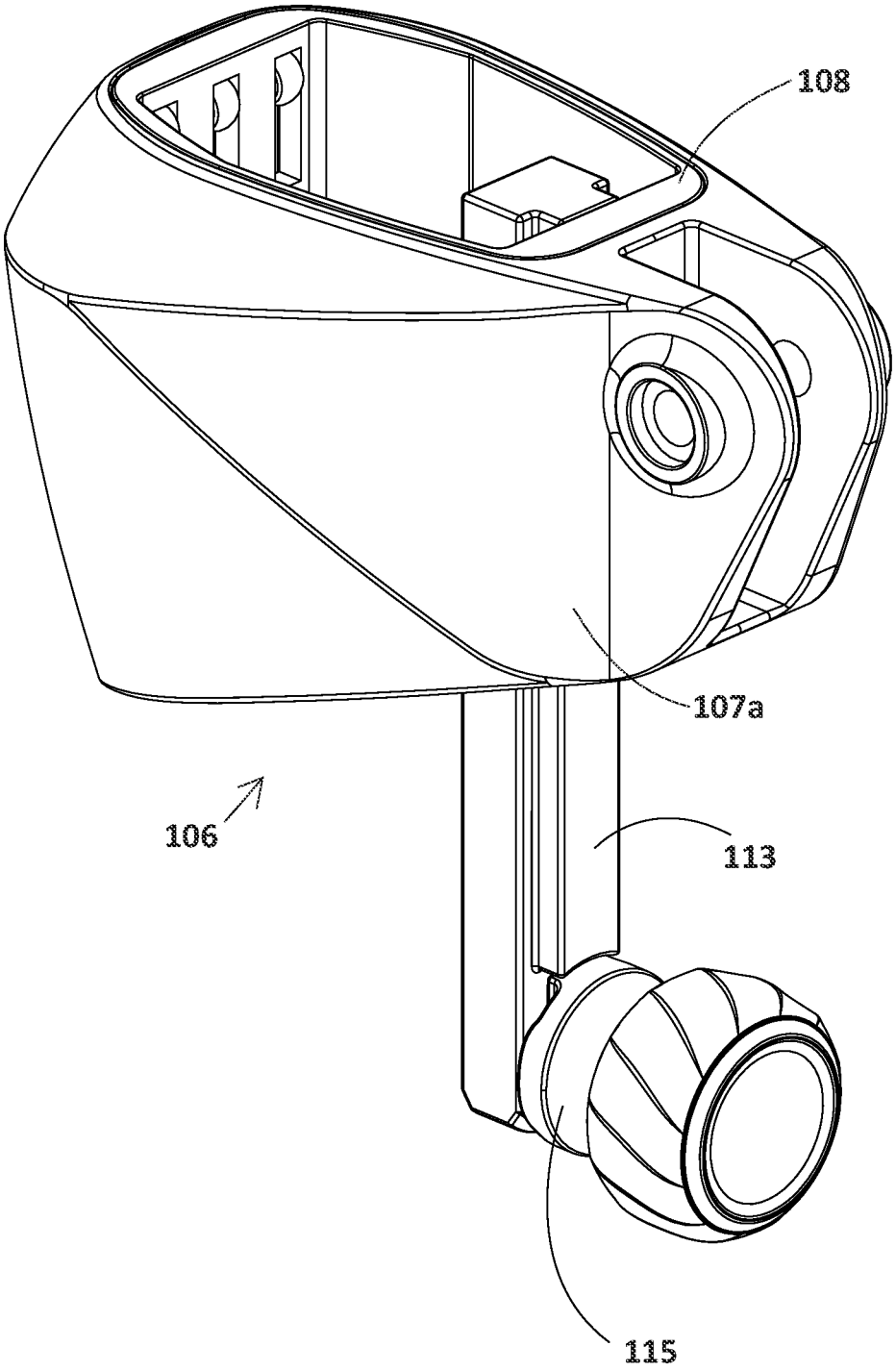
Figure 11:
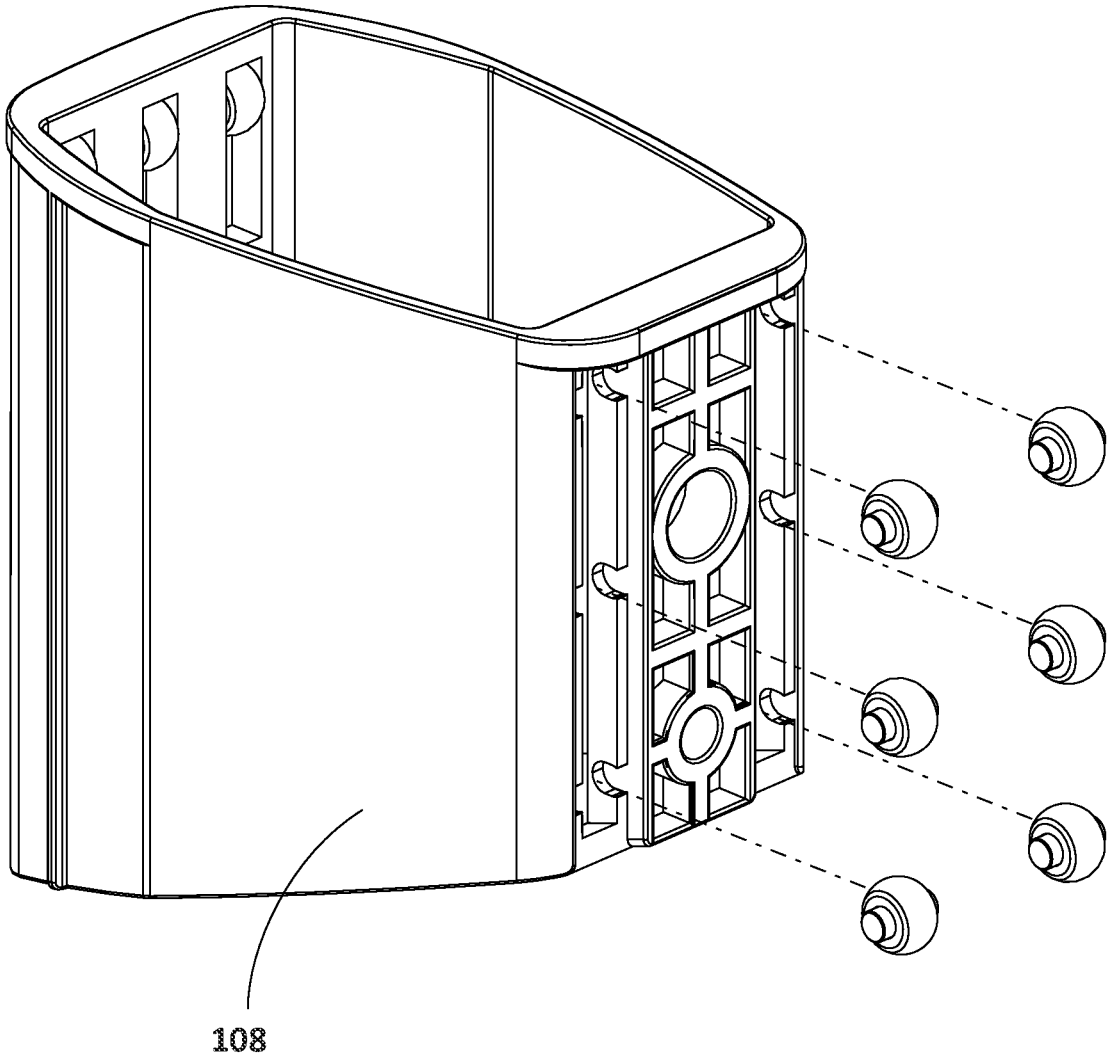
Figure 12:
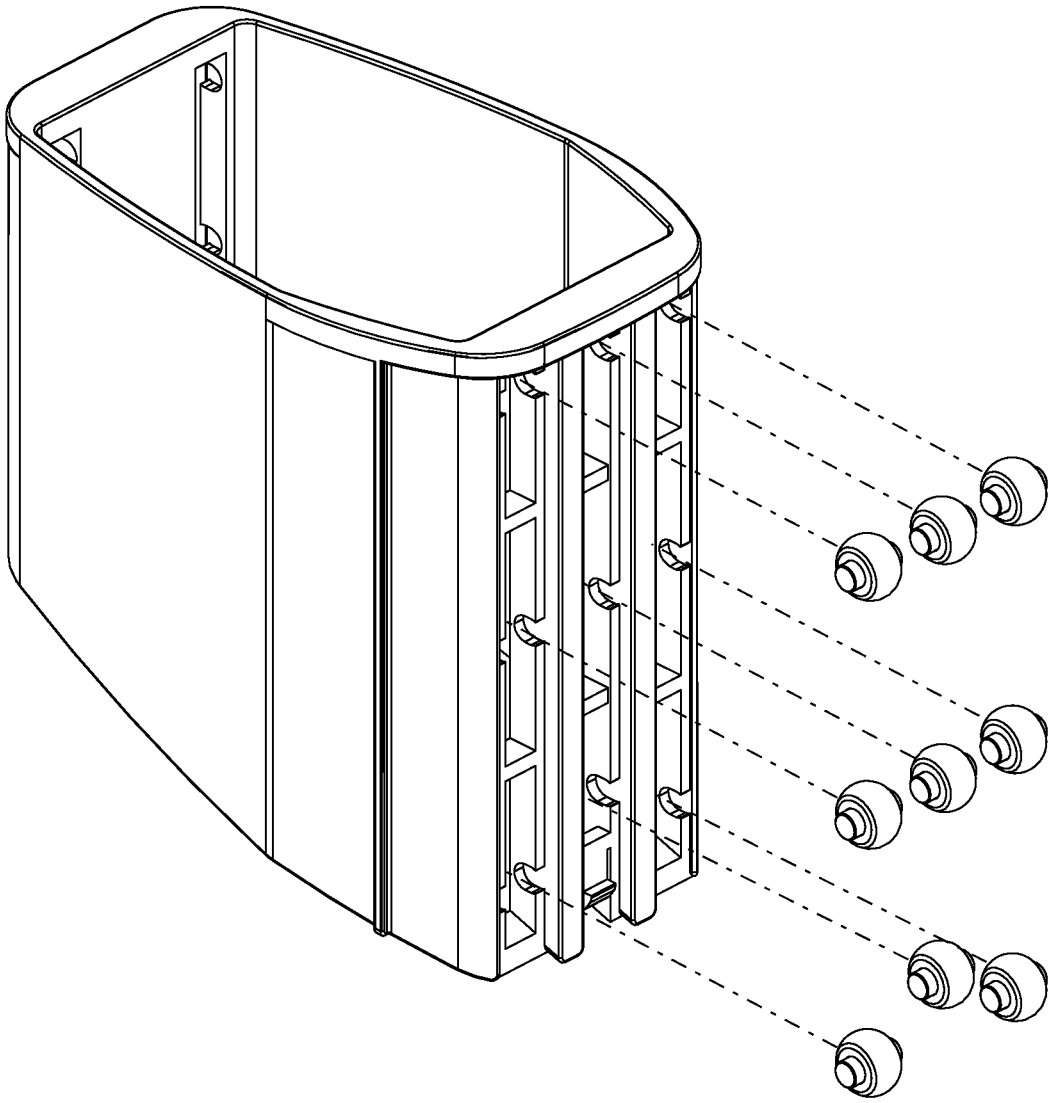
Figure 13:
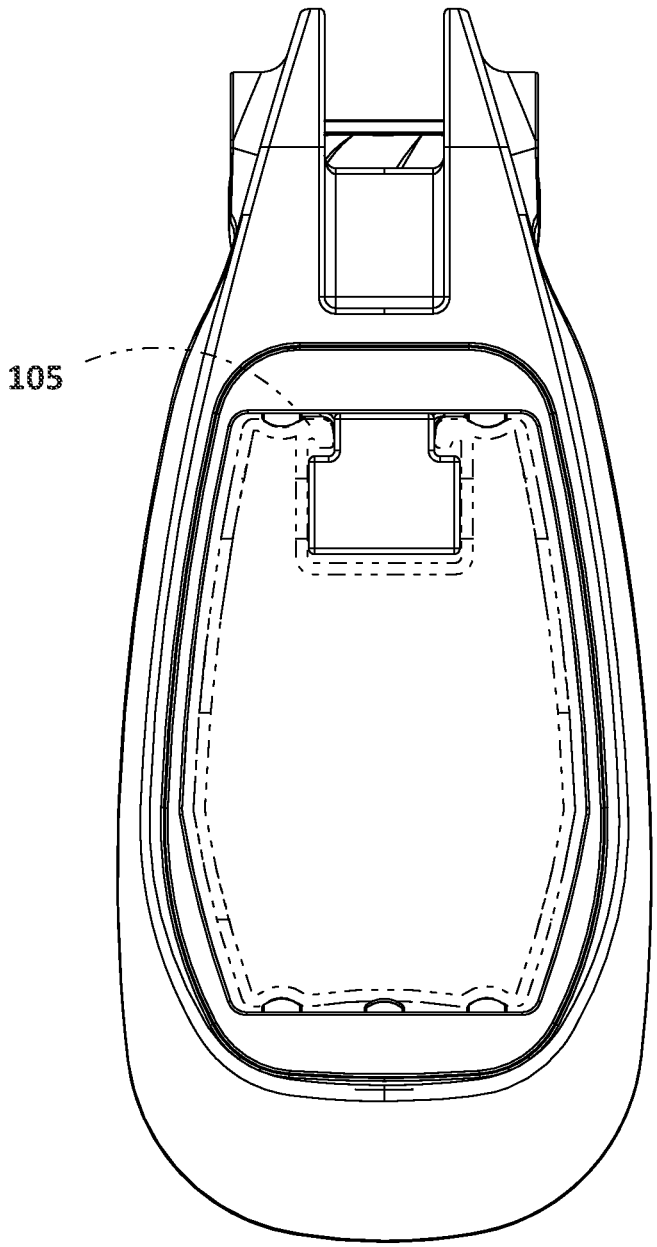
Figure 14:
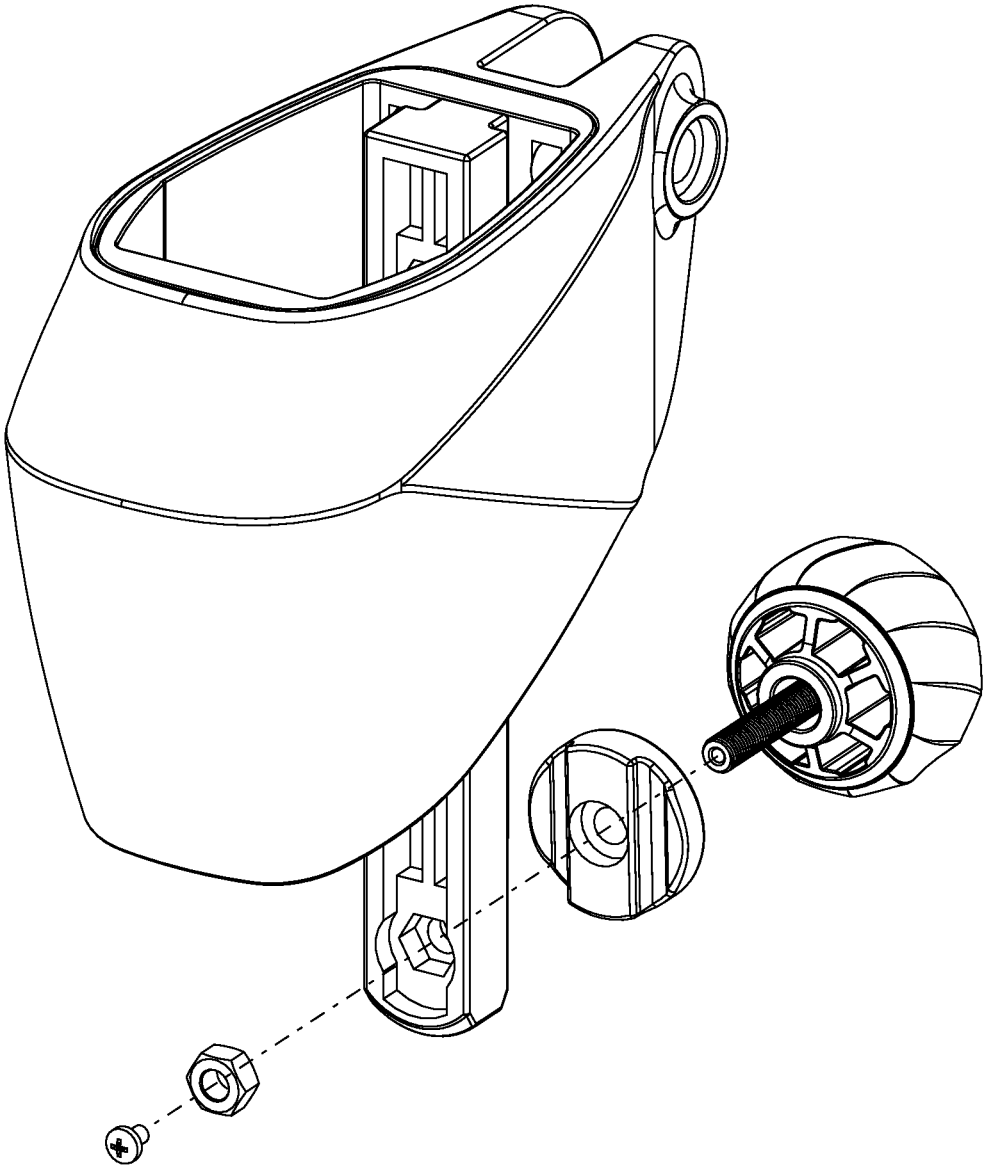
Figure 15:
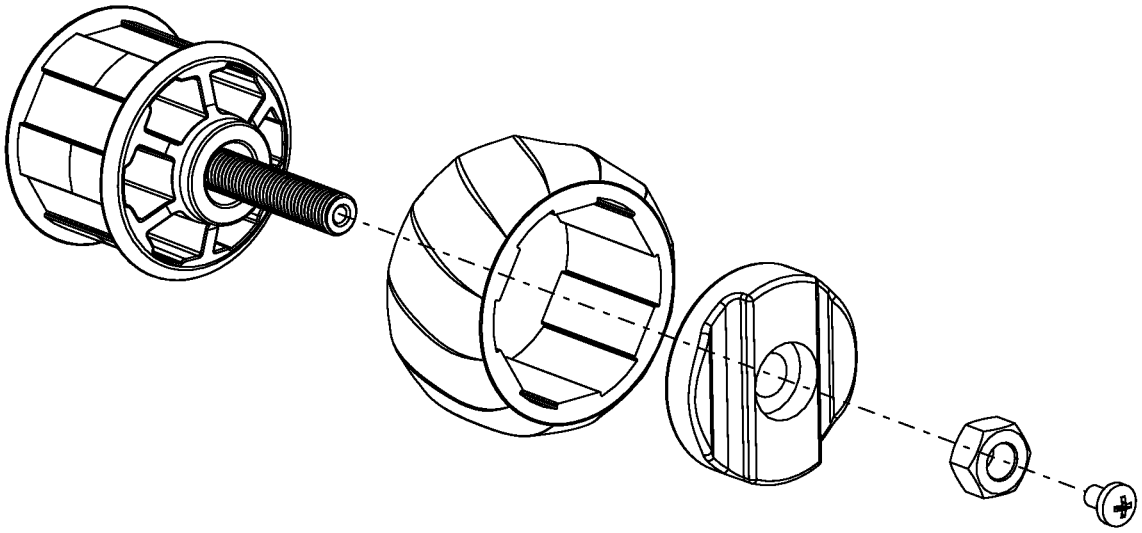
Figure 16:
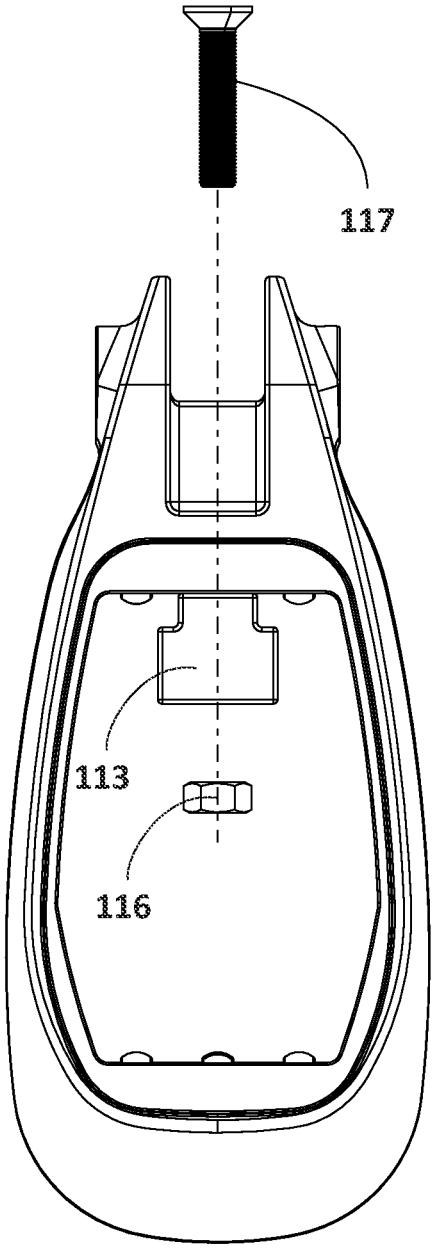
Figure 17:
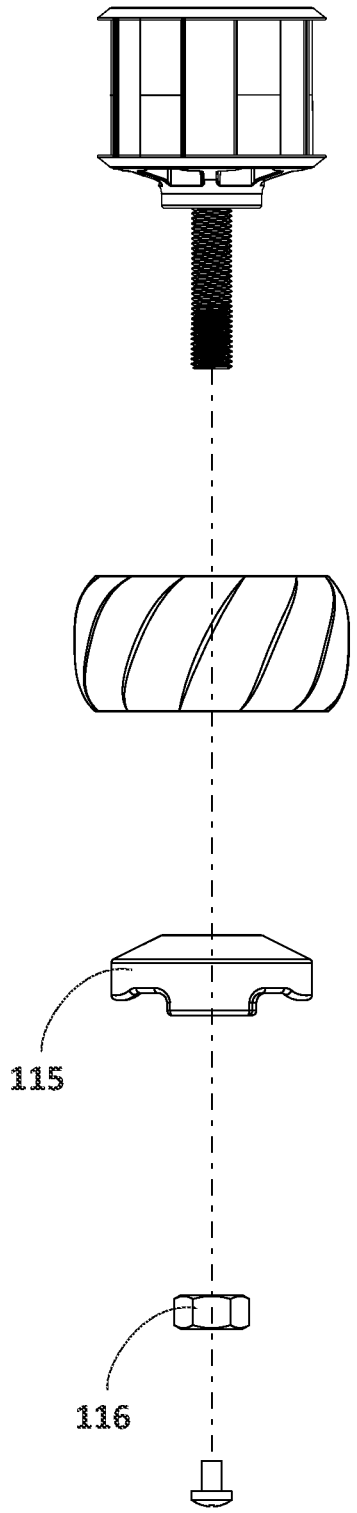
Figure 18:
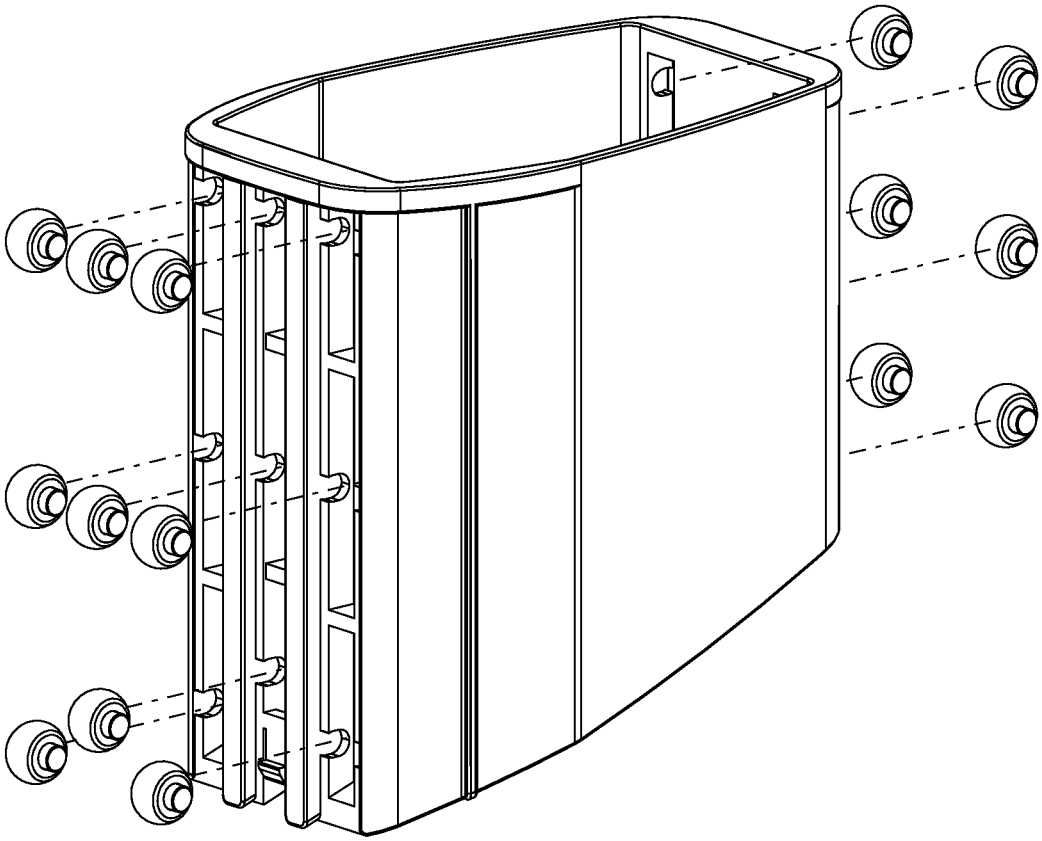
Figure 19:
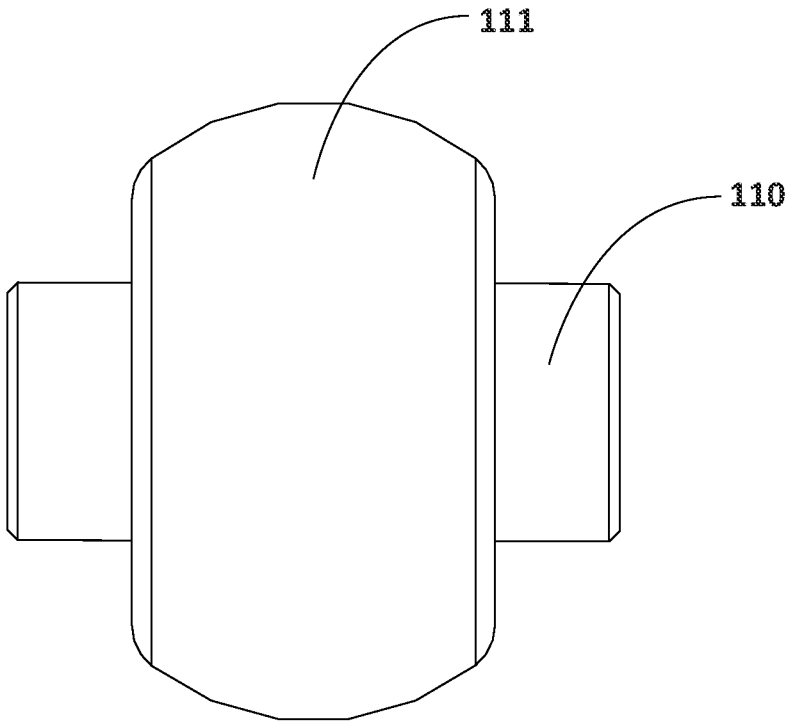
Figure 20:
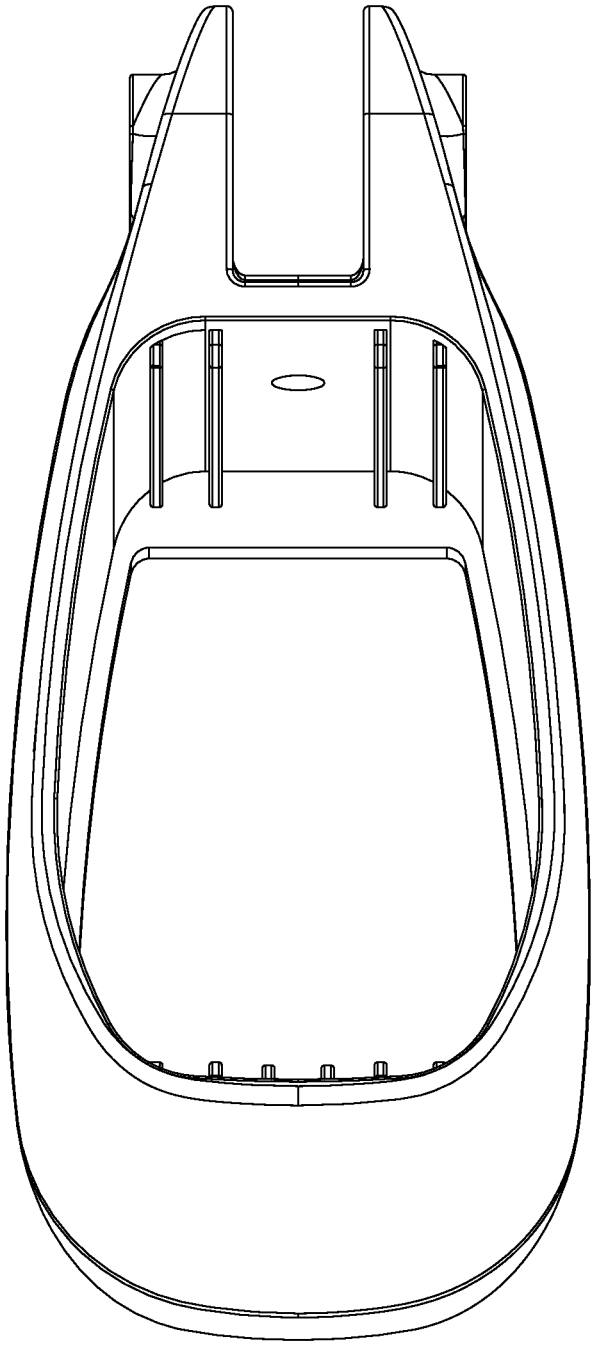
Figure 21:
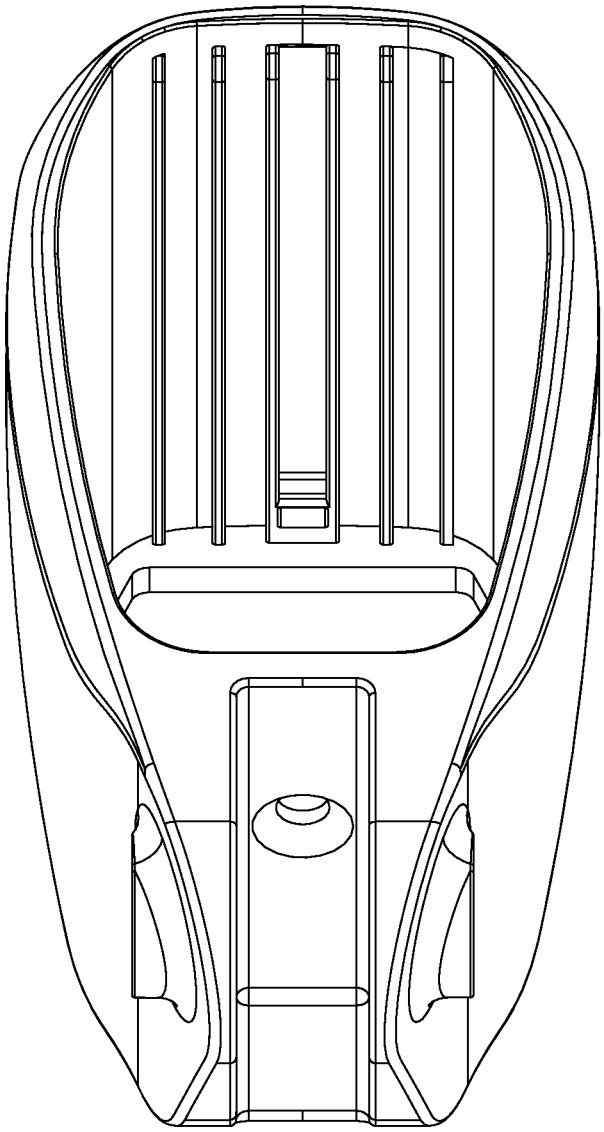
Figure 22:
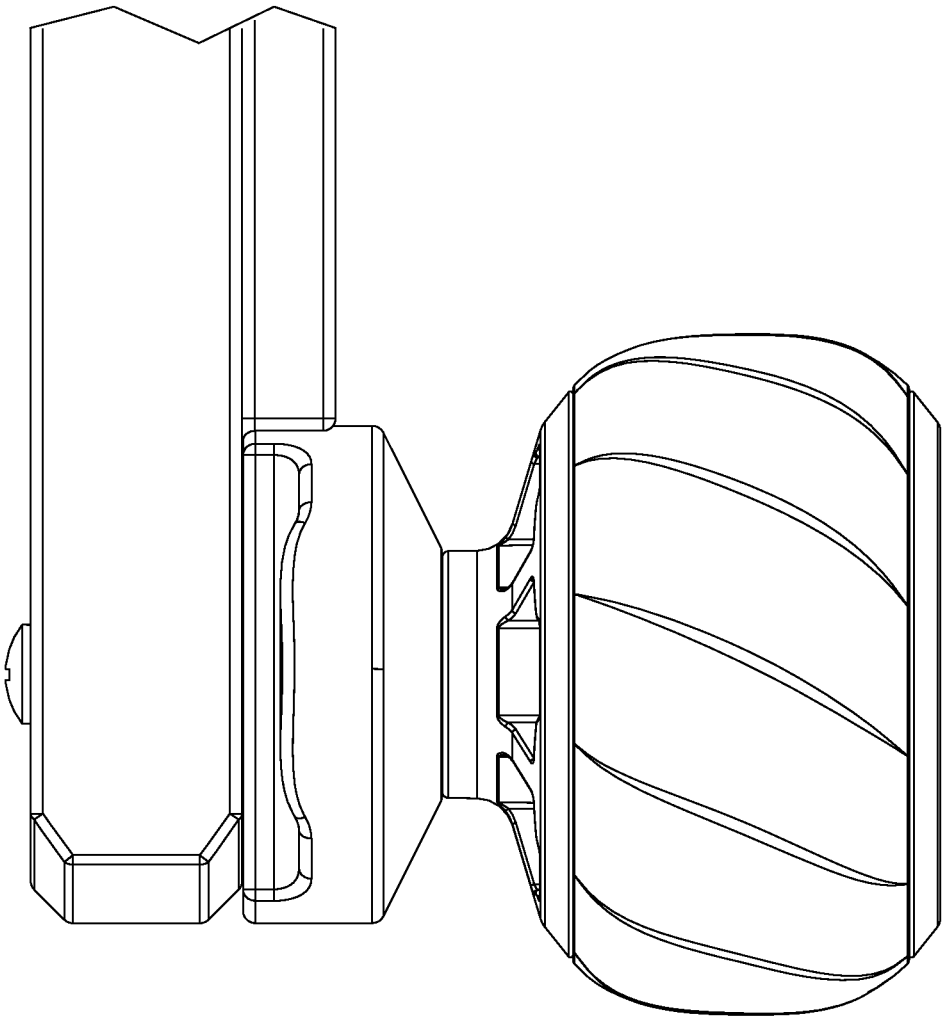
Figure 23:
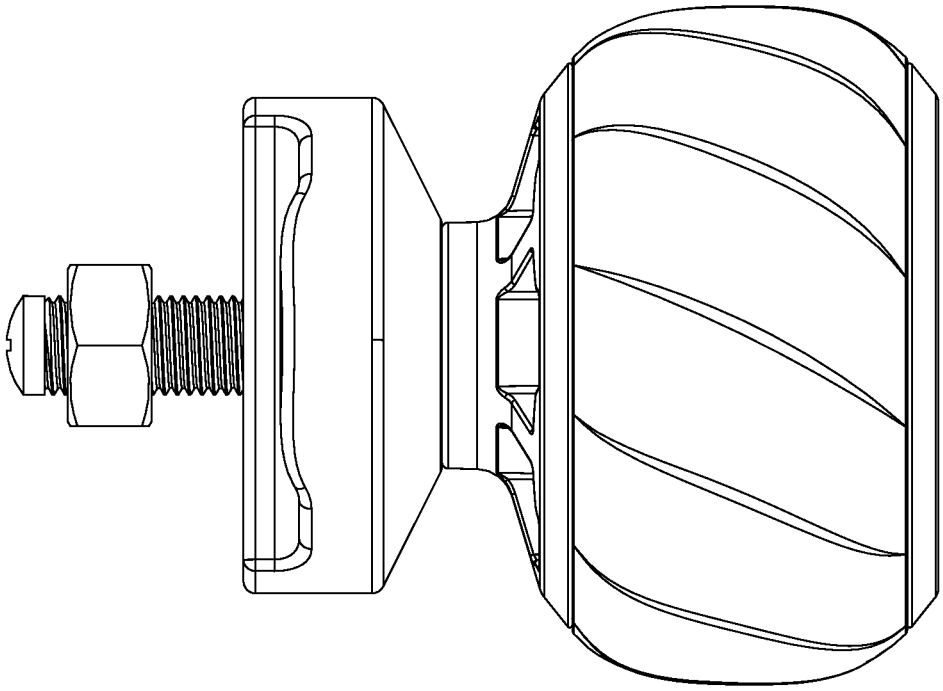
Figure 24:
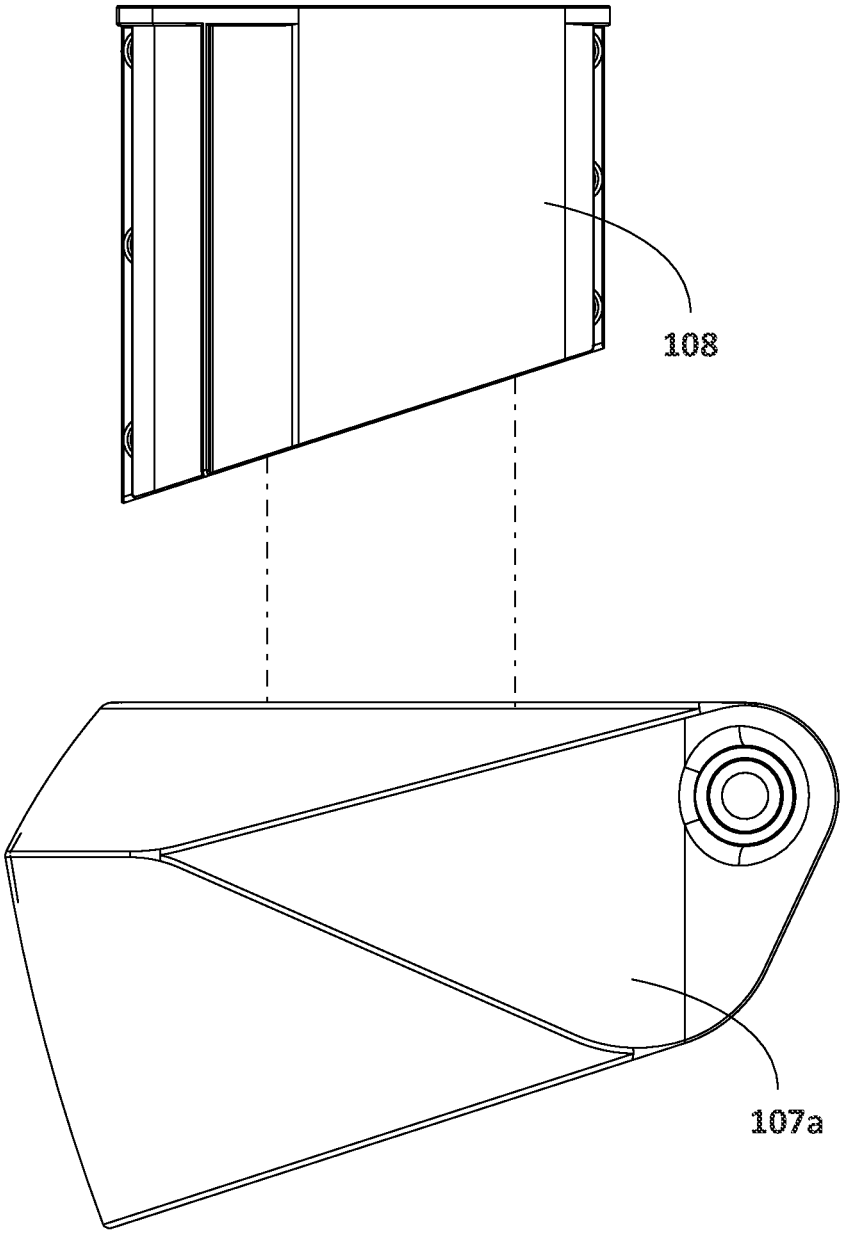
Figure 25:
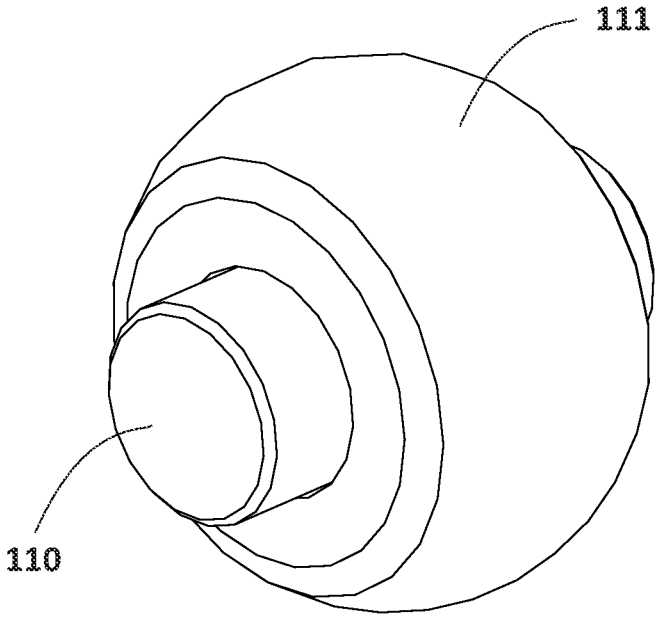
Figure 26:
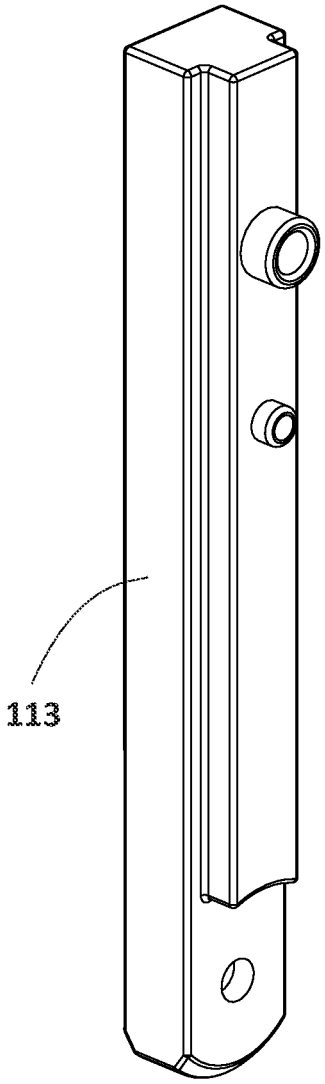

3) No prior art mention or disclose any umbrella, having arthritic-assisting anti-vibration anti-friction portable roller-elevator 108. Therefore, the prior art of umbrella are: not capable of being used on umbrella post, hand rail, sail pole, awning arm, and pergola column (see FIG. 58-FIG. 62); Not capable of hiding arthritic-assisting anti-vibration anti-friction portable roller-elevator 108 (see FIG. 2); and Not capable of securing and organizing arthritic-assisting anti-vibration anti-friction portable rollers 111 (see FIG. 11, FIG. 12, and FIG. 18).

Figure 49:
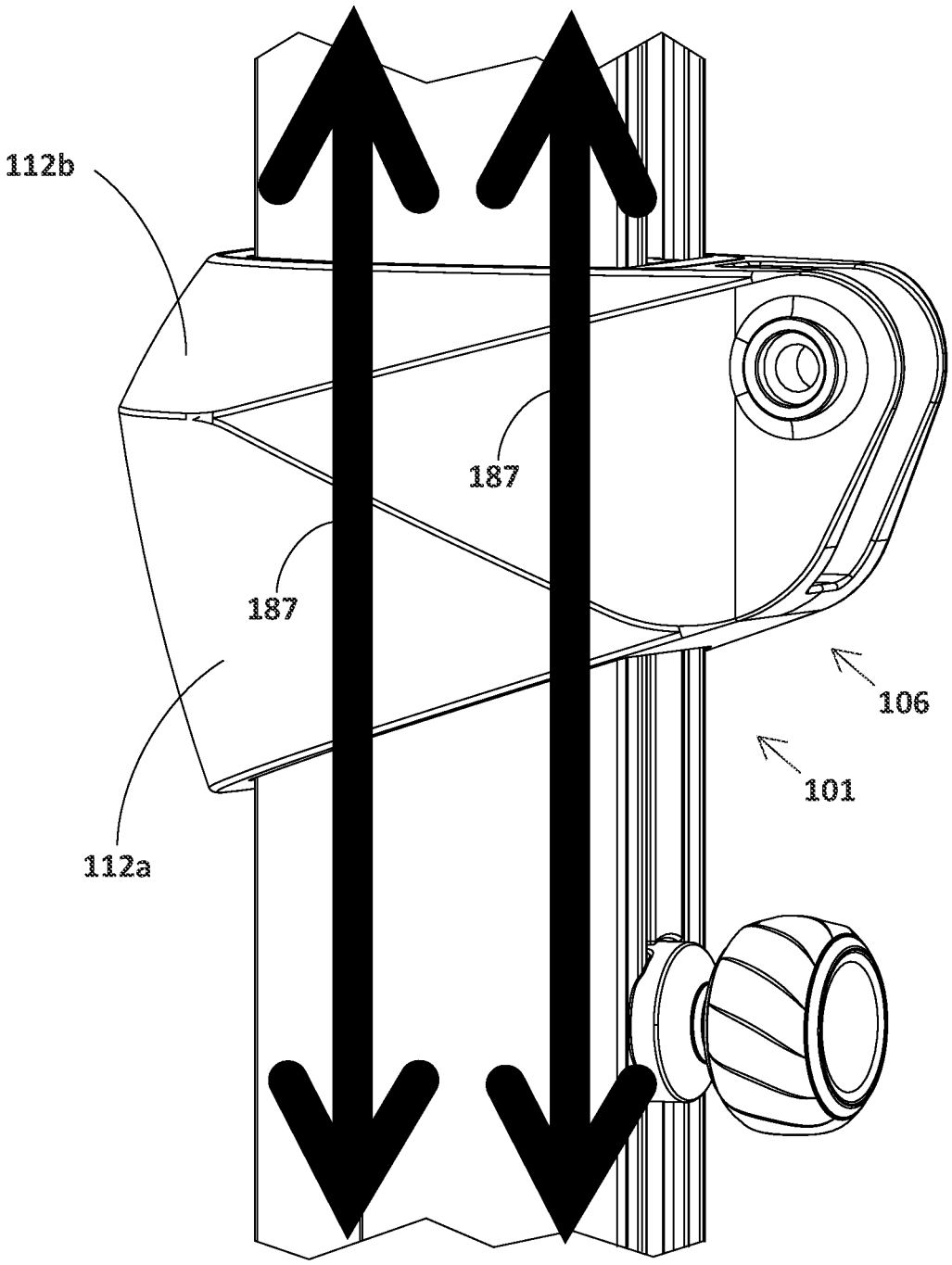
FIG. 49 and FIG. 50 are diagrams illustrating perspective views demonstrating the raising and lowering of Arthritic-assisting anti-vibration anti-friction anti-pinching portable-elevator system 106.
Figure 50:
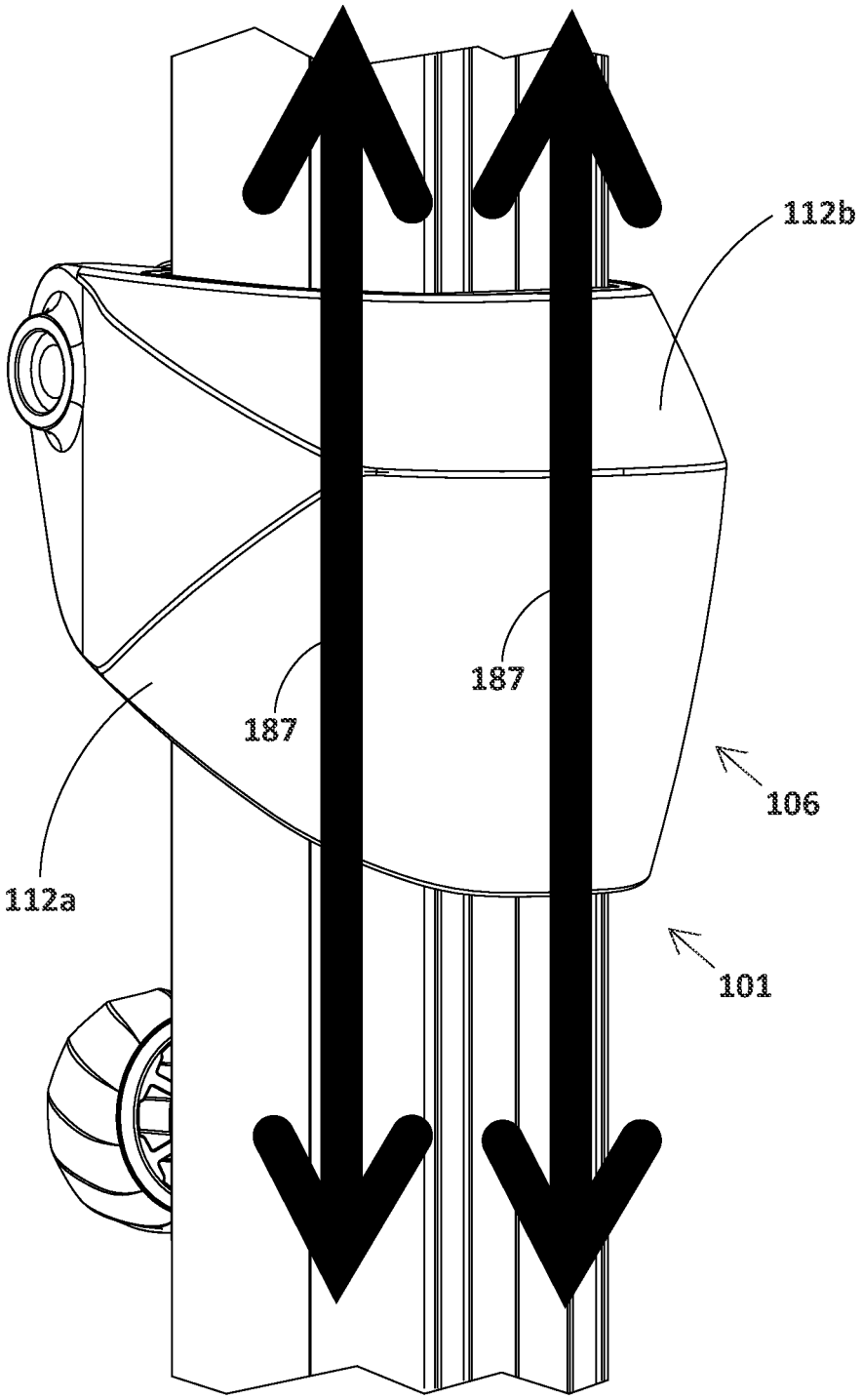

4) No prior art mention or disclose any umbrella, having arthritic-assisting anti-vibration anti-friction portable rollers 111. Therefore, the prior art of umbrella are: not capable of assisting an arthritic in operating arthritic-assisting anti-vibration anti-friction anti-pinching portable-elevator system 106 in the directions of arrows 176-186 (see FIG. 51-FIG. 57); and Not capable of eliminating vibration and friction during operation of arthritic-assisting anti-vibration anti-friction anti-pinching portable-elevator system 106 in the direction of arrow 187 (see FIG. 49 and FIG. 50).

5) No prior art mention or disclose any umbrella, having arthritic-assisting anti-vibration anti-friction back roller-tracks 102 and arthritic-assisting anti-vibration anti-friction front roller-tracks 103. Therefore, the prior art of umbrella are not capable of guiding arthritic-assisting anti-vibration anti-friction portable rollers 111 to assist an arthritic during operation of arthritic-assisting anti-vibration anti-friction anti-pinching portable-elevator system 106 in the directions of arrows 176-186 (see FIG. 51-FIG. 57); and not capable of eliminating vibration and friction during operation of arthritic-assisting anti-vibration anti-friction anti-pinching portable-elevator system 106 in the direction of arrow 187 (see FIG. 49 and FIG. 50); and 6) No prior art mention or disclose any umbrella, having arthritic-assisting raising angle-handle 112*a*. Therefore, the prior art of umbrella are: not capable of assisting an arthritic to eliminate the needs for folding an arthritic's fingers when raising arthritic-assisting anti-vibration anti-friction anti-pinching portable-elevator system 106 in the directions of arrows 176-186 (see FIG. 51-FIG. 57); and Not capable of reducing impact against an arthritic's fingers during operation of arthritic-assisting anti-vibration anti-friction anti-pinching portable-elevator system 106 in the directions of arrows 176-186 (see FIG. 51-FIG. 57).

7) No prior art mention or disclose any umbrella, having arthritic-assisting lowering angle-handle 112*b*. Therefore, the prior art of umbrella are not capable of assisting an arthritic to eliminate the needs for folding an arthritic's fingers when lowering arthritic-assisting anti-vibration anti-friction anti-pinching portable-elevator system in the directions of arrows 176-186 (see FIG. 51-FIG. 57); and not capable of reducing impact against an arthritic's fingers during operation of arthritic-assisting anti-vibration anti-friction anti-pinching portable-elevator system 106 in the directions of arrows 176-186 (see FIG. 51-FIG. 57).

8) No prior art mention or disclose any umbrella, having first production-increasing anti-slipping anti-cracking opposite-twisting jaw 122 and second production-increasing anti-slipping anti-cracking opposite-twisting jaw 123. Therefore, the prior art of umbrella are not Capable of mutually working with first upper-elevation twistable tube 131, first lower-elevation twistable tube 132, second upper-elevation twistable tube 133, and second lower-elevation twistable tube 134 to twistingly unclamp and to twistingly clamp threaded connector core 145 when turning arthritic-assisting twist-clamping-jaw hand-knob 141 in the directions of arrows 193, 194, and 195 (see FIG. 71-FIG. 74); and not capable of twisting while being twistingly spread by first twist-spreading spring 126 and second twist-spreading spring 127 to twistingly unclamp threaded connector core 145 to allow opposite-twisting-jaw-housing tunnel system 146 to be rotatably adjusted without slipping in the directions of arrows 193, 194, and 195 (see FIG. 71-FIG. 74).

Figure 89:
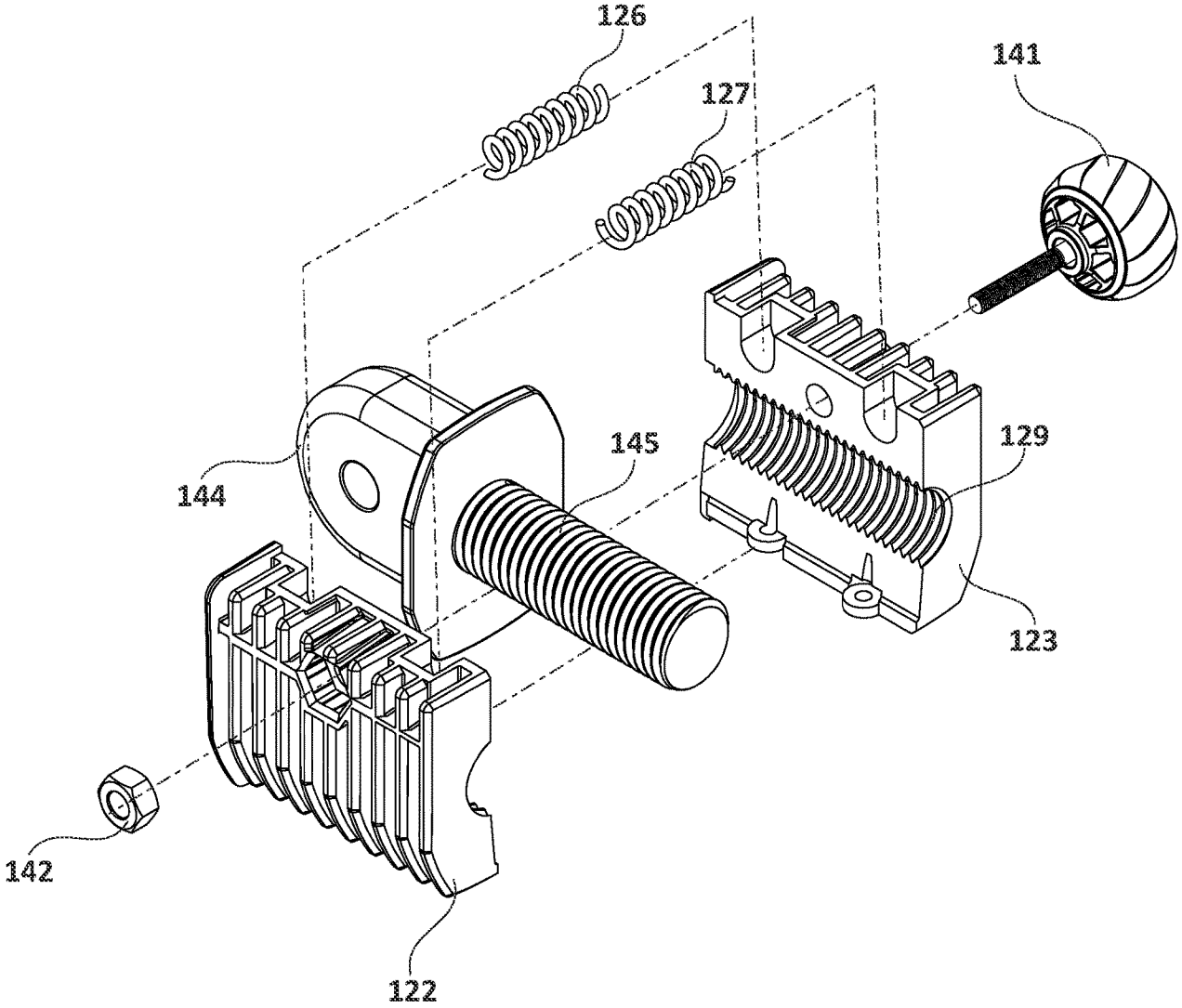
Figure 90:
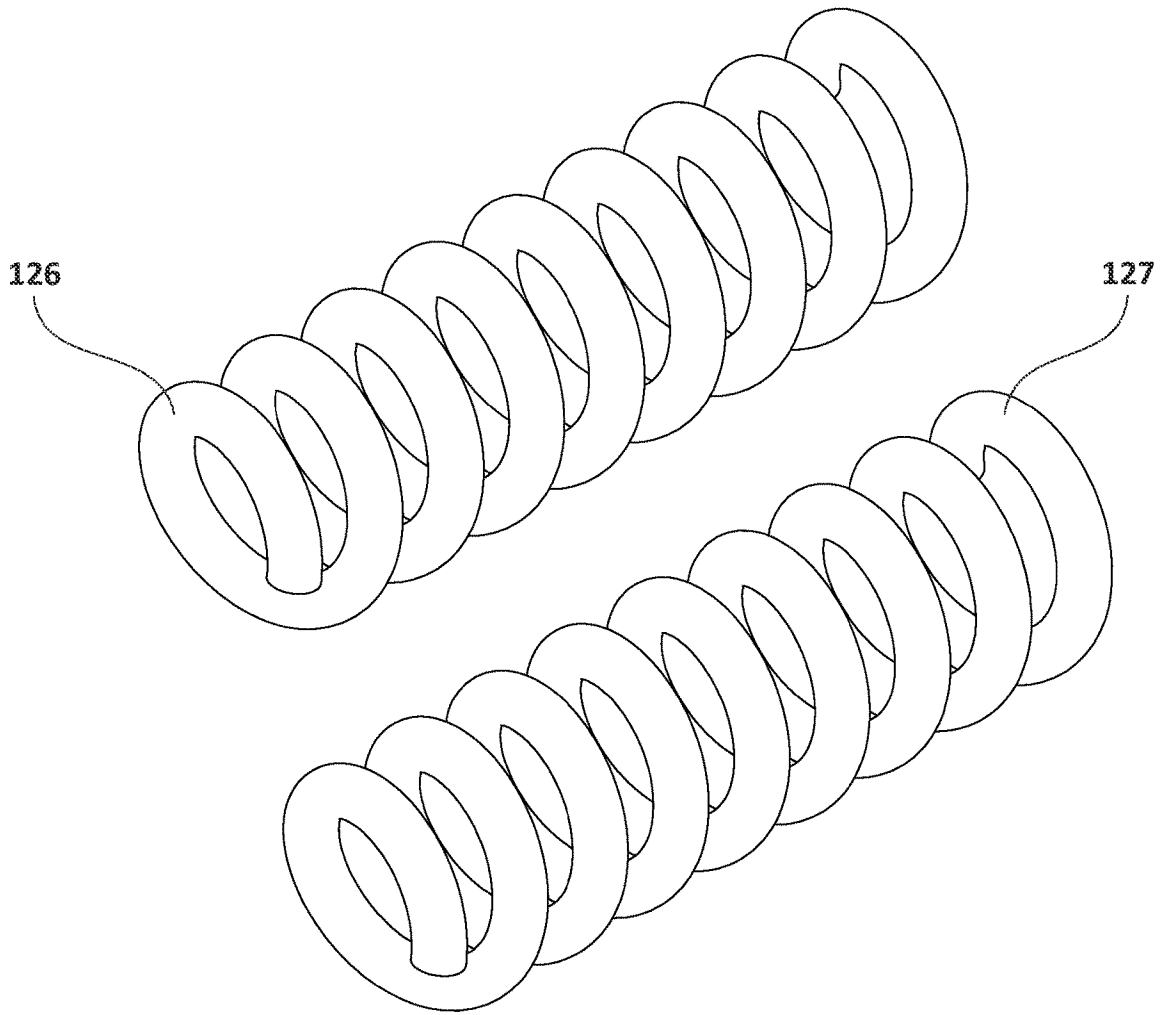
Figure 91:
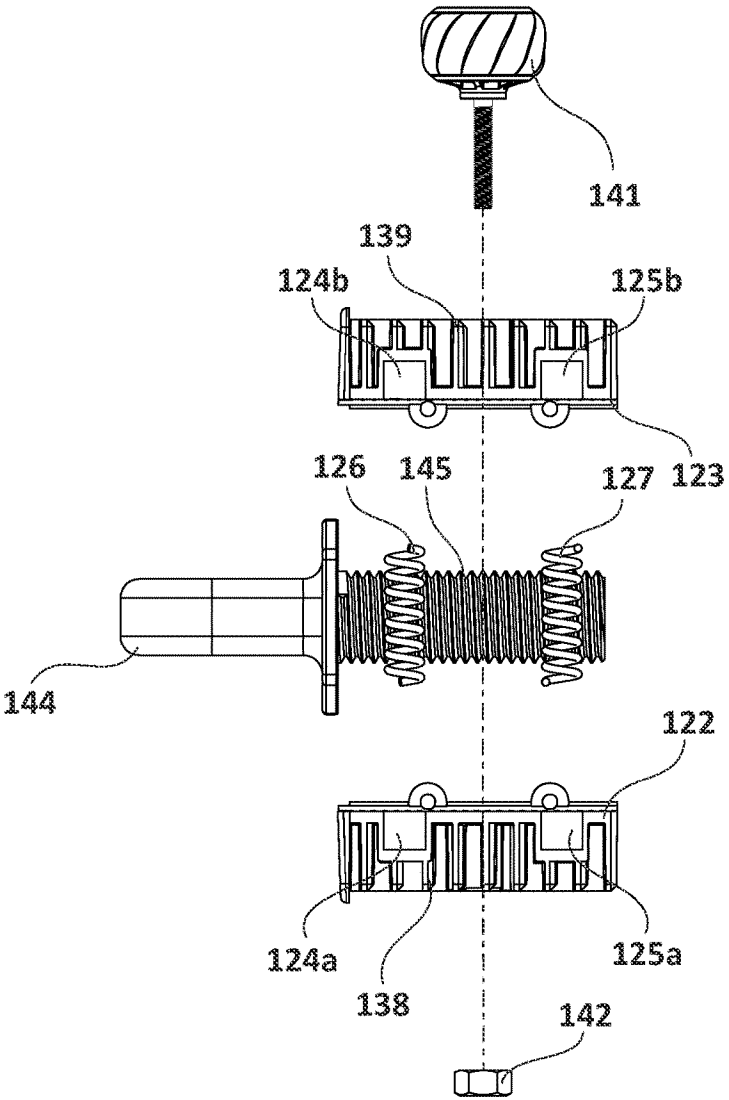
Figure 92:
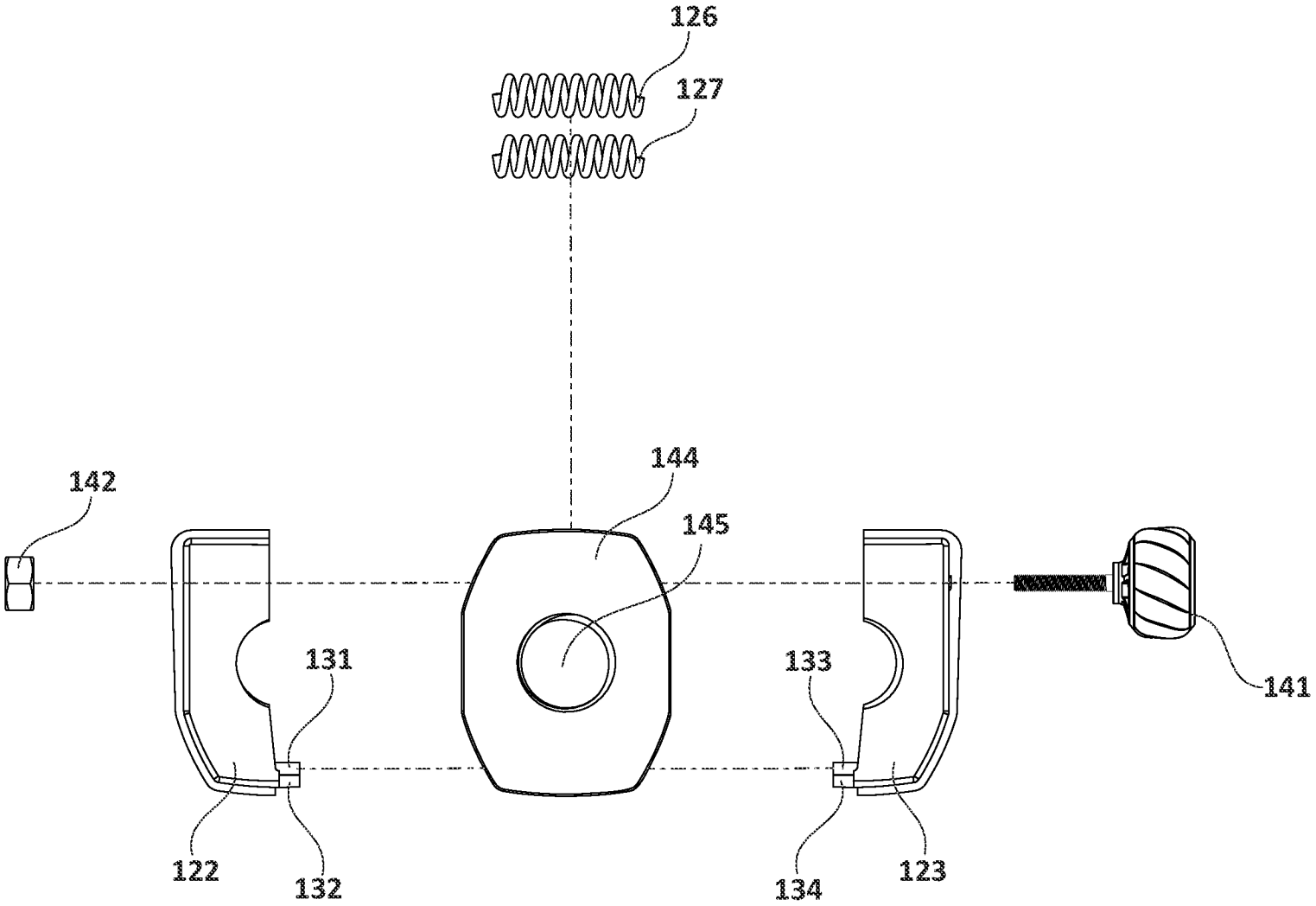
Figure 93:
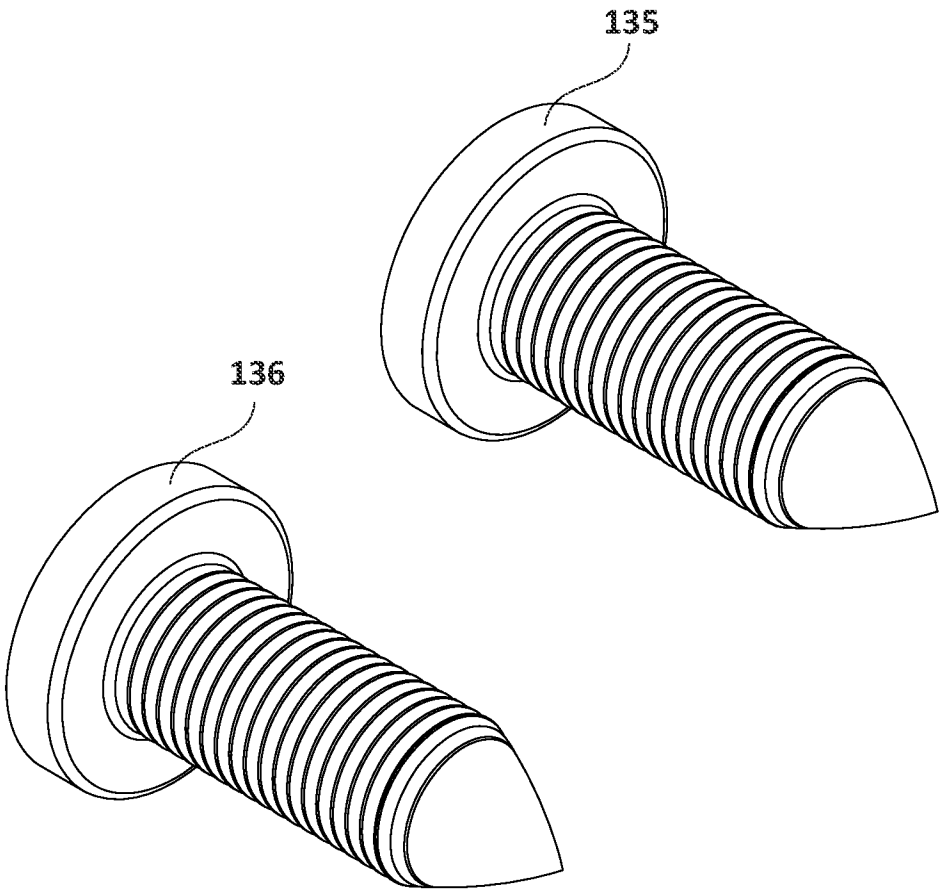
Figure 94:
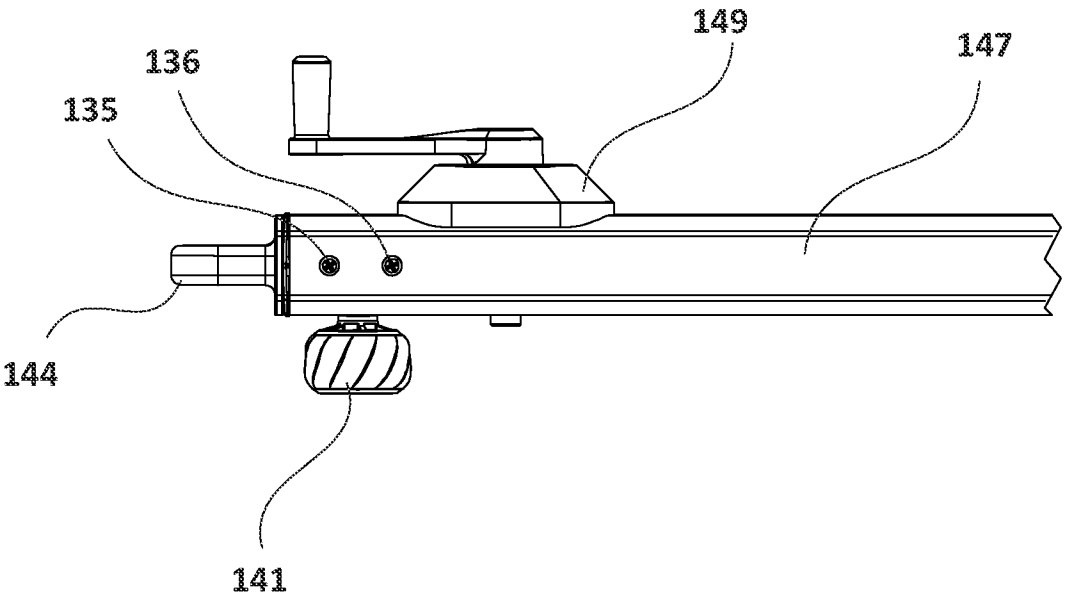
Figure 95:
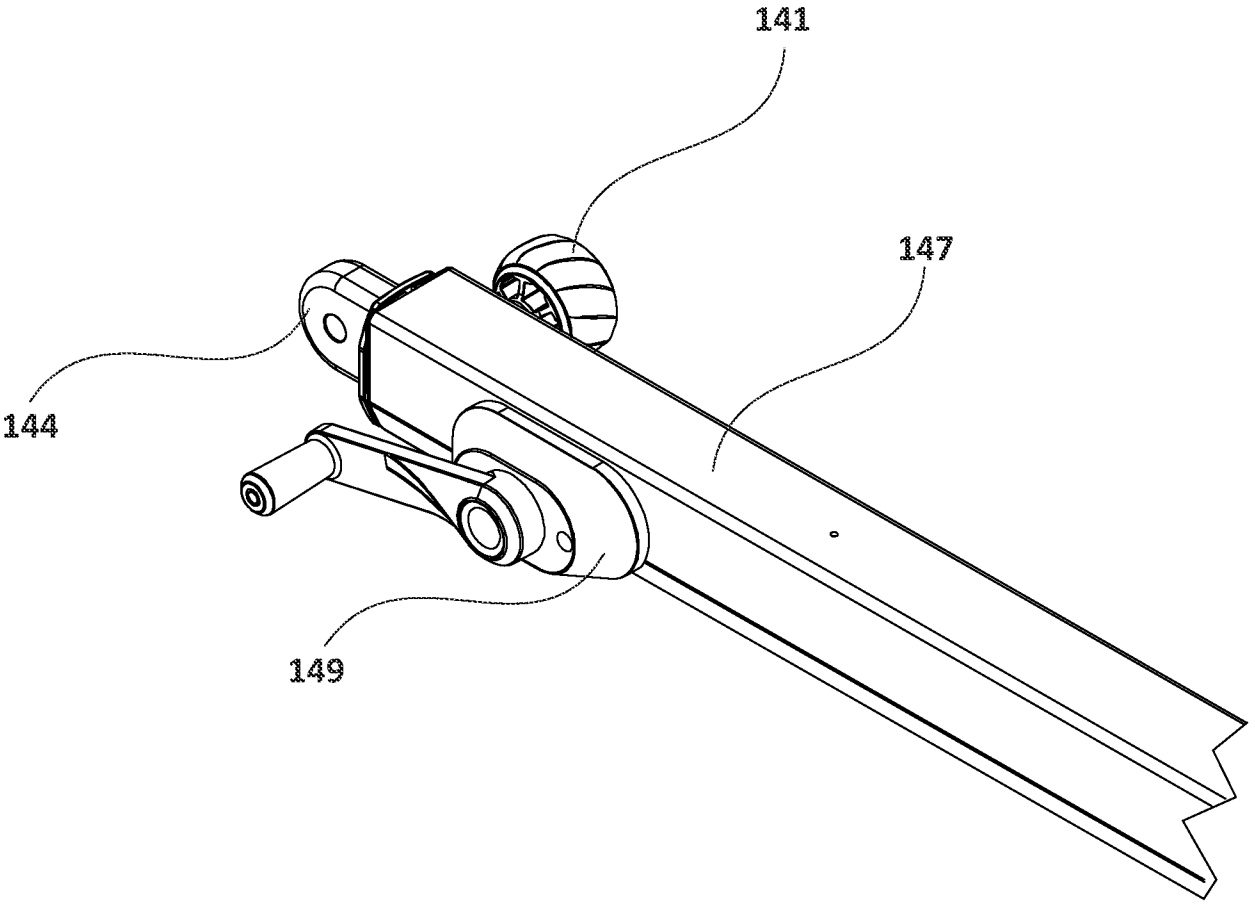
Figure 96:
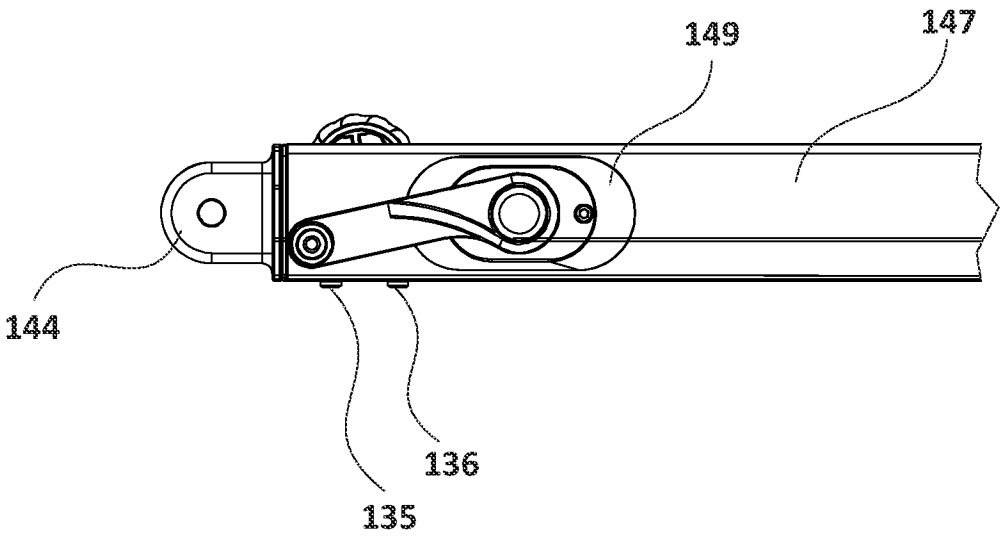
Figure 97:
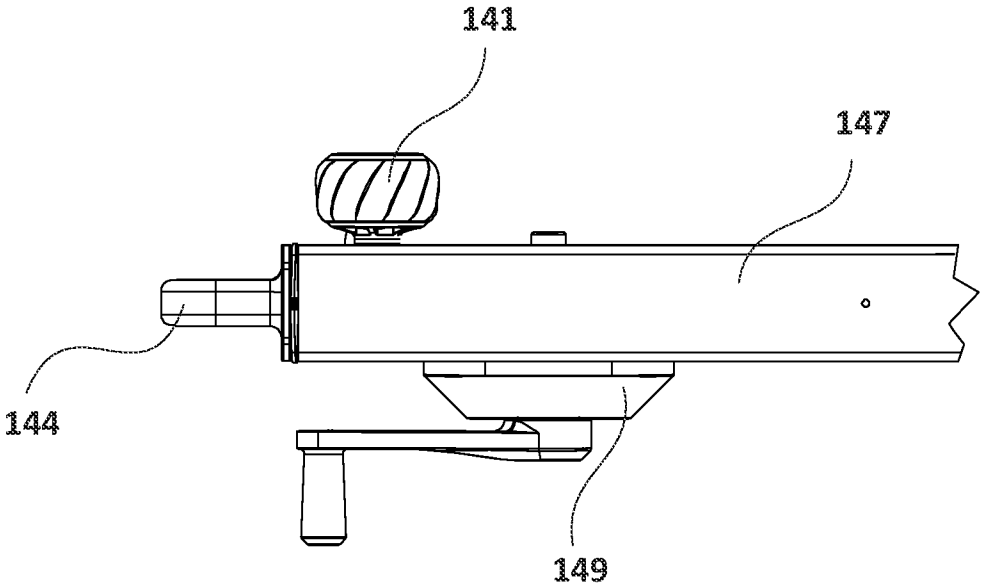
Figure 98:
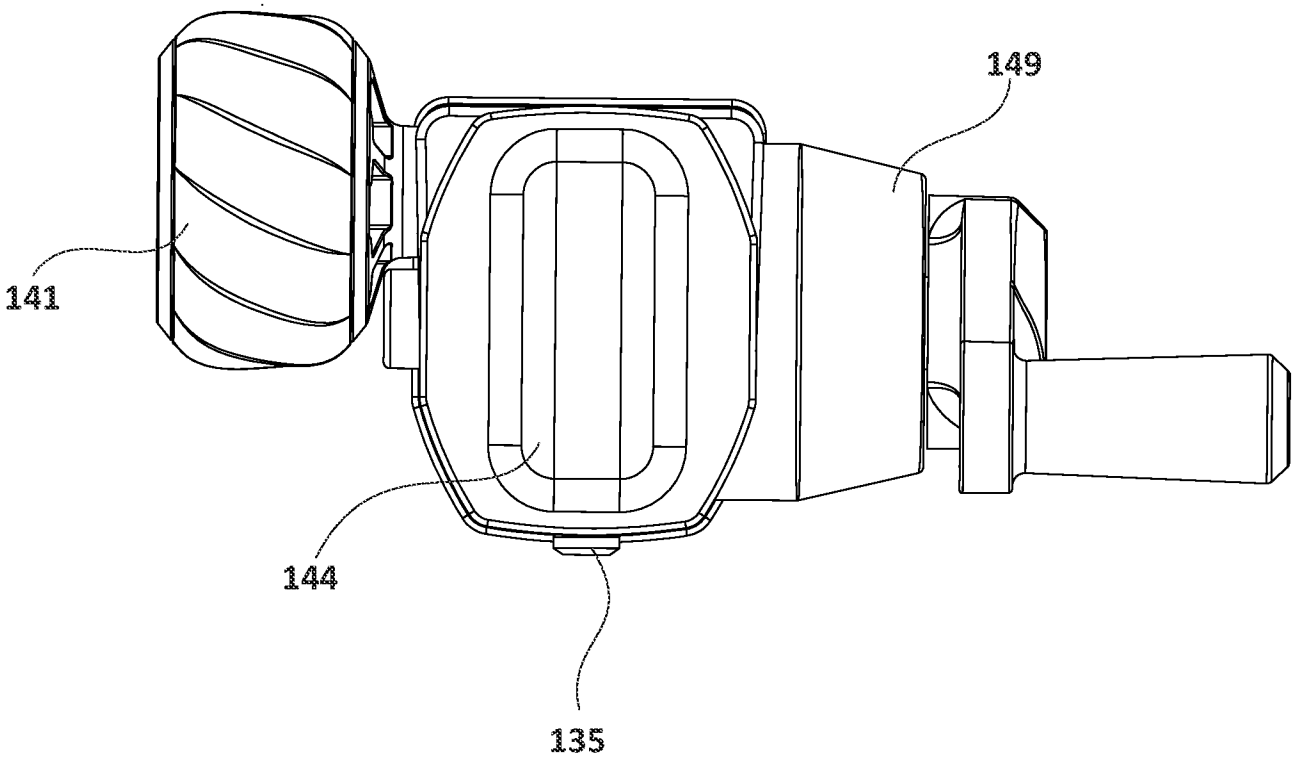

9) No prior art mention or disclose any umbrella, having first anti-slipping core-twist-clamping threads 128 and second anti-slipping core-twist-clamping threads 129. Therefore, the prior art of umbrella are not capable of mutually working with first upper-elevation twistable tube 131, first lower-elevation twistable tube 132, second upper-elevation twistable tube 133, and second lower-elevation twistable tube 134 to twistingly unclamp threaded connector core 145 when twistingly spread by first and second twist-spreading springs 126 and 127 to allow opposite-twisting-jaw-housing tunnel system 146 to be rotatably adjusted without slipping in the directions of arrows 193, 194, and 195 (see FIG. 71-FIG. 74); and not capable of mutually working with first upper-elevation twistable tube 131, first lower-elevation twistable tube 132, second upper-elevation twistable tube 133, and second lower-elevation twistable tube 134 to twistingly clamp threaded connector core 145 when squeezed by arthritic-assisting twist-clamping-jaw hand-knob 141 and hand-knob nut 142 (see FIG. 89).

10) No prior art mention or disclose any umbrella, having first upper-elevation twistable tube 131 and first lower-elevation twistable tube 132. Therefore, the prior art of umbrella are not capable of being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 75-FIG. 78); and b) Not capable of being on 2 different elevations to allow first production-increasing anti-slipping anti-cracking opposite-twisting jaw 122 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

11) No prior art mention or disclose any umbrella, having second upper-elevation twistable tube 133 and second lower-elevation twistable tube 134. Therefore, the prior art of umbrella are not capable of being on 2 different elevations to allow second production-increasing anti-slipping anti-cracking opposite-twisting jaw 123 to twistingly unclamp threaded connector core 145 when twistingly spread by first and second twist spreading springs 126 and 127 on different elevations of arrows 196, 197, 198, and 199 (see FIG. 75-FIG. 78); and not capable of being on 2 different elevations to allow second production-increasing anti-slipping anti-cracking opposite-twisting jaw 123 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

12) No prior art mention or disclose any umbrella, having first reinforcing twistable ribs 138 and second reinforcing twistable ribs 139. Therefore, the prior art of umbrella are not capable of mutually working with first upper-elevation twistable tube 131, first lower-elevation twistable tube 132, second upper-elevation twistable tube 133, and second lower-elevation twistable tube 134 to allow 1st production-increasing anti-slipping anti-cracking opposite-twisting jaw 122 and 2nd production-increasing anti-slipping anti-cracking opposite-twisting jaw 123 to twistingly unclamp and to twistingly clamp threaded connector core 145 in the directions of arrows 193, 194, and 195 (see FIG. 71-FIG. 74); and not capable of reinforcing 1 st production-increasing anti-slipping anti-cracking opposite-twisting jaw 122 and 2nd production-increasing anti-slipping anti-cracking opposite-twisting jaw 123 to prevent them from cracking, and to securely unclamp and to securely clamp threaded connector core 145 in the directions of arrows 193, 194, and 195 (see FIG. 71-FIG. 74).

Figure 113:
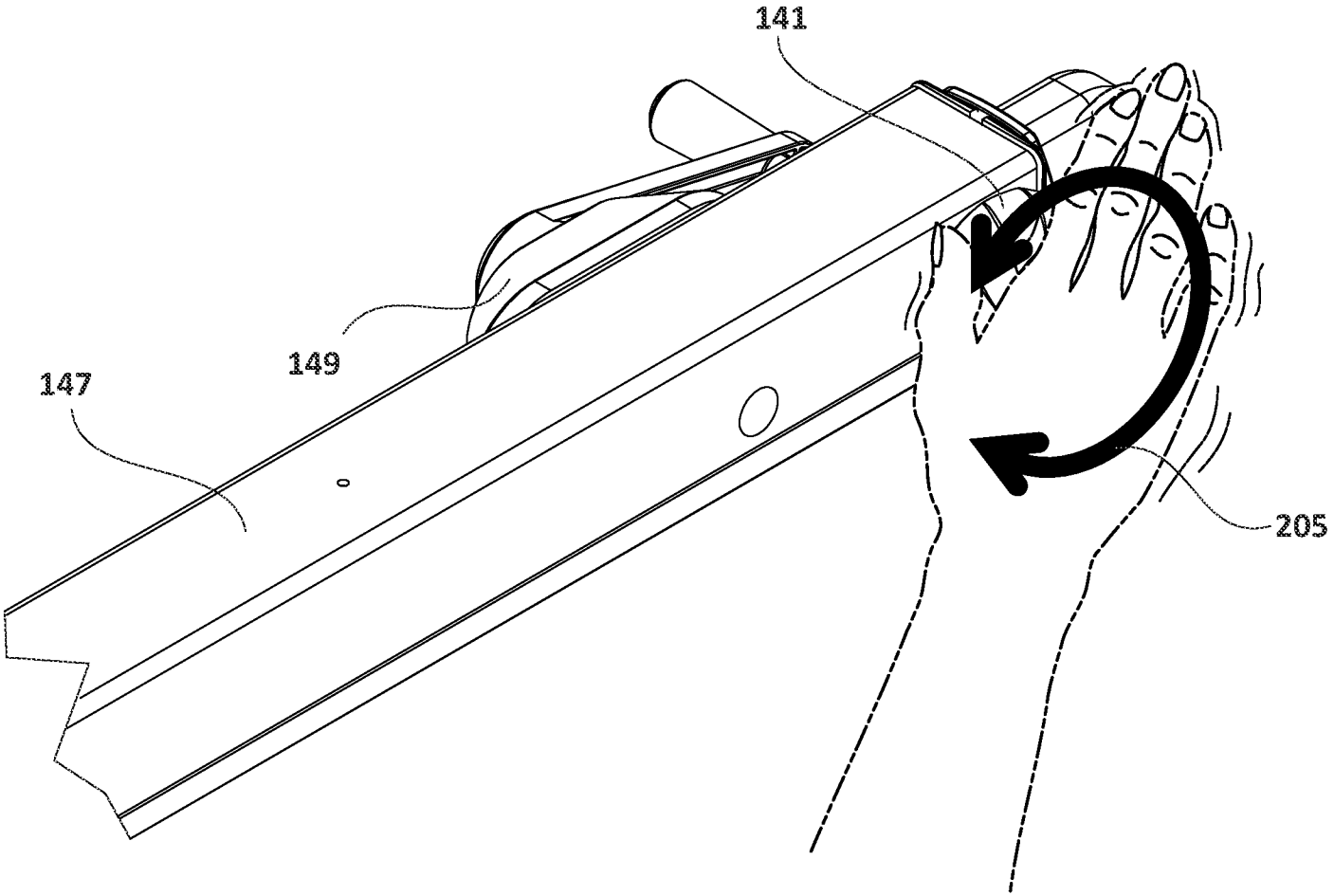
Figure 114:
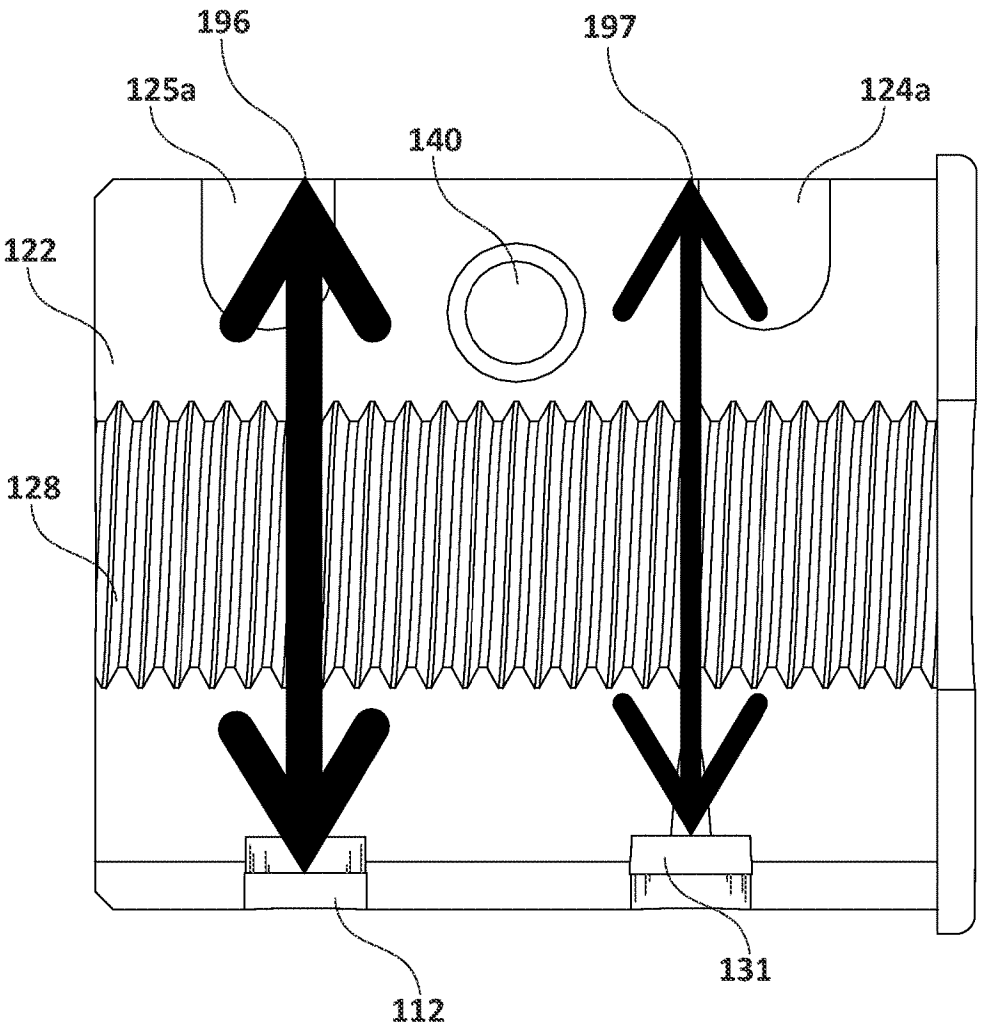
Figure 115:
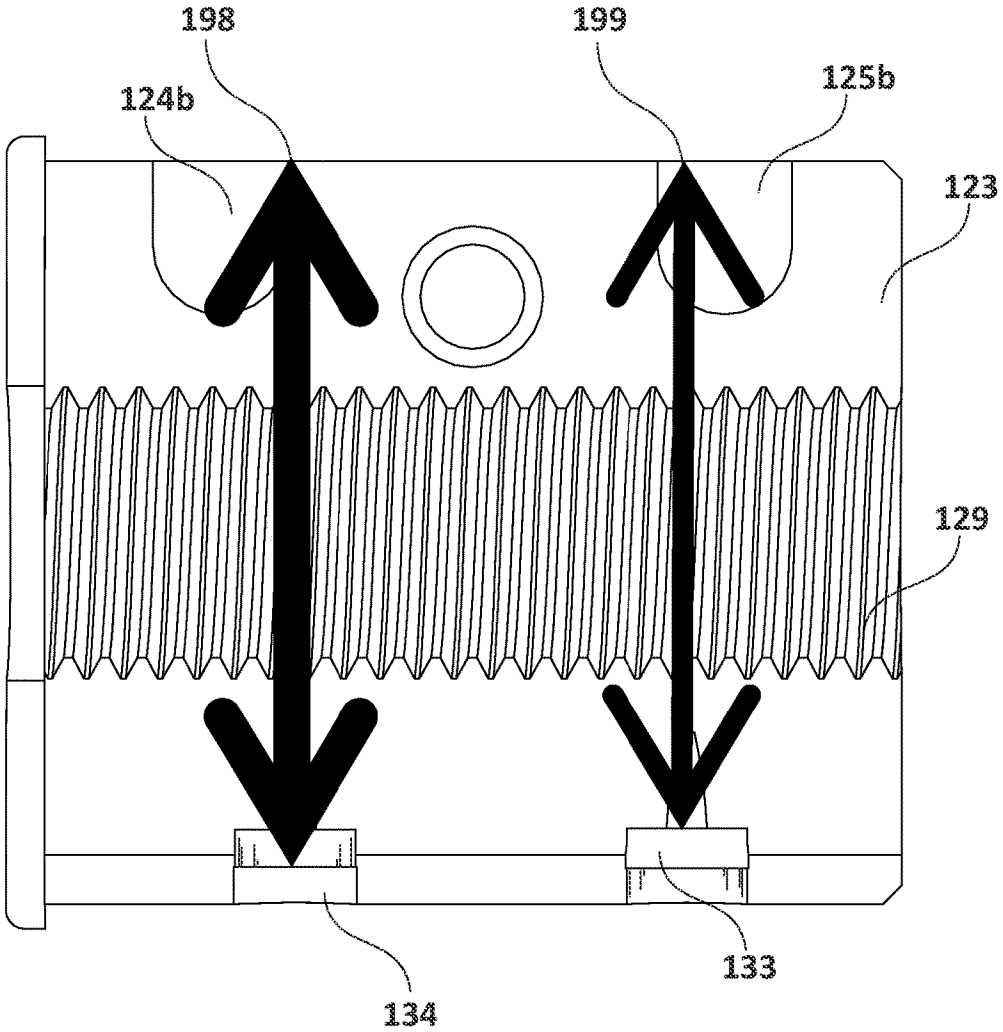
Figure 116:
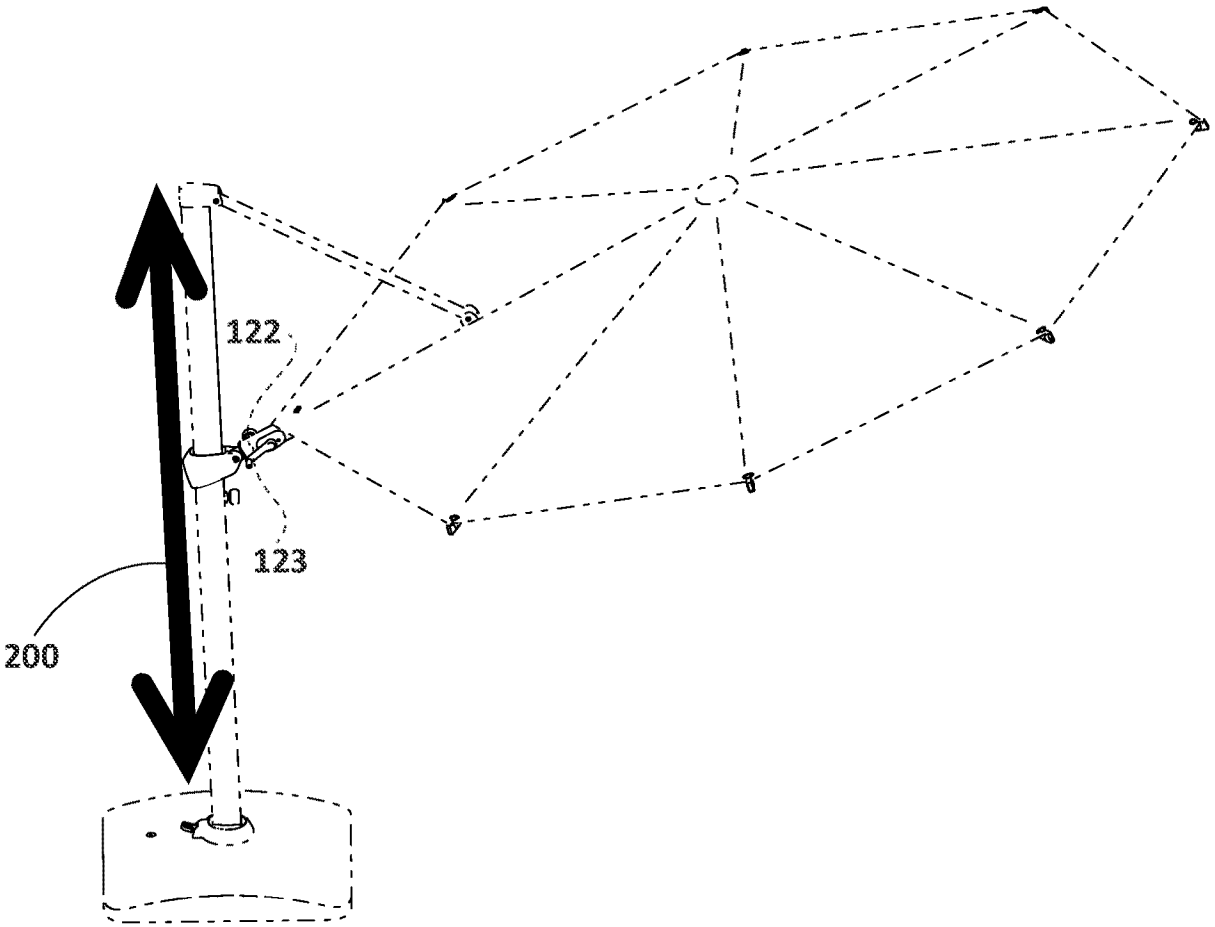
Figure 117:
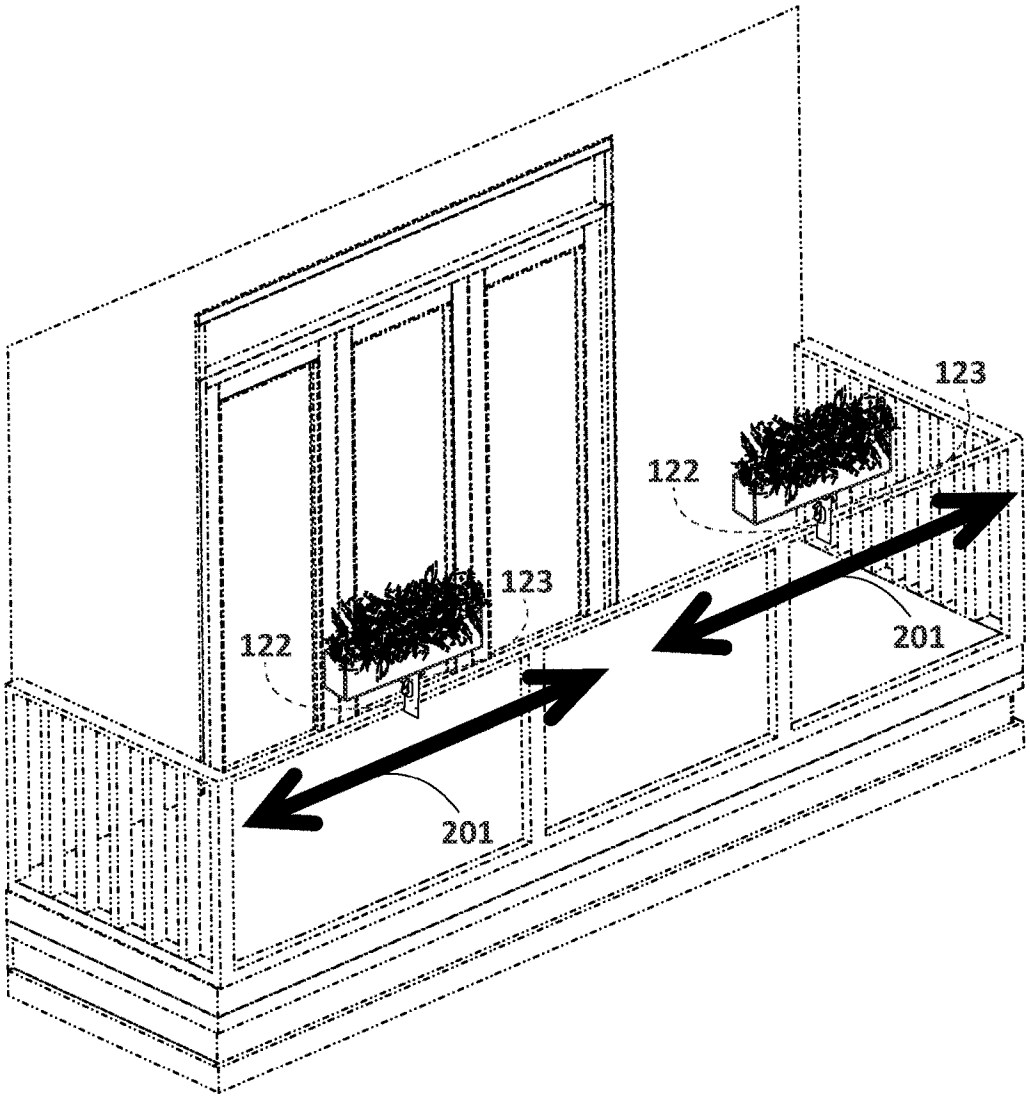
Figure 118:
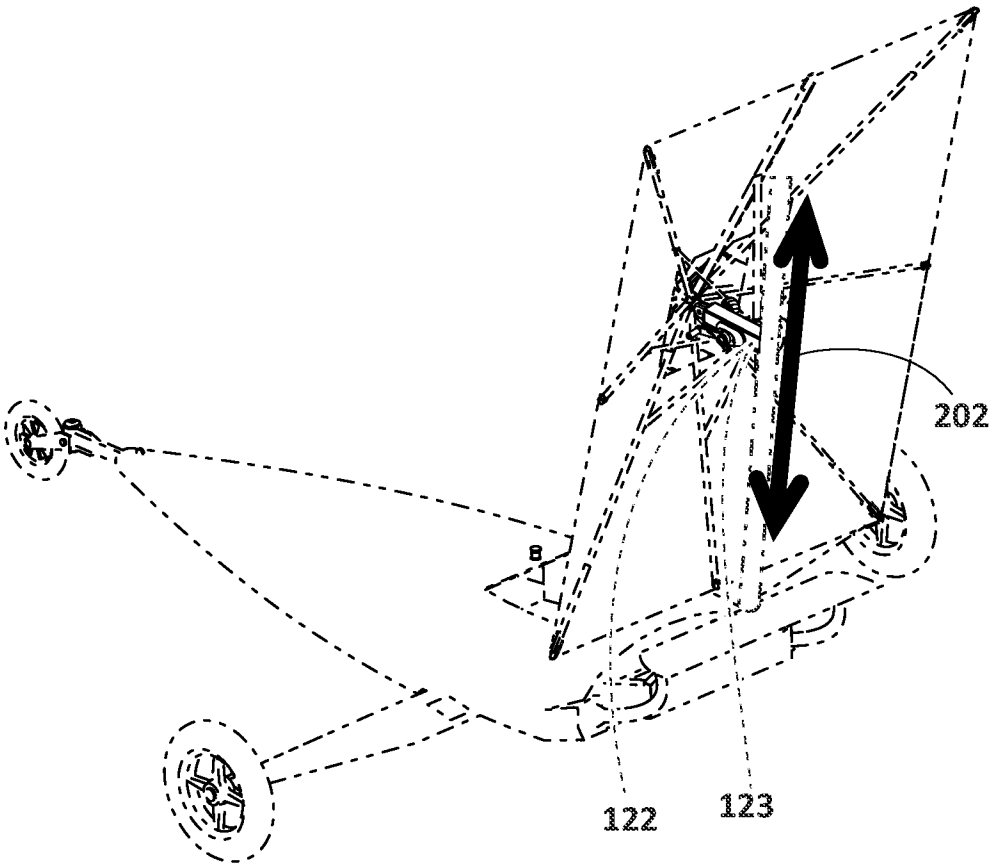
Figure 119:
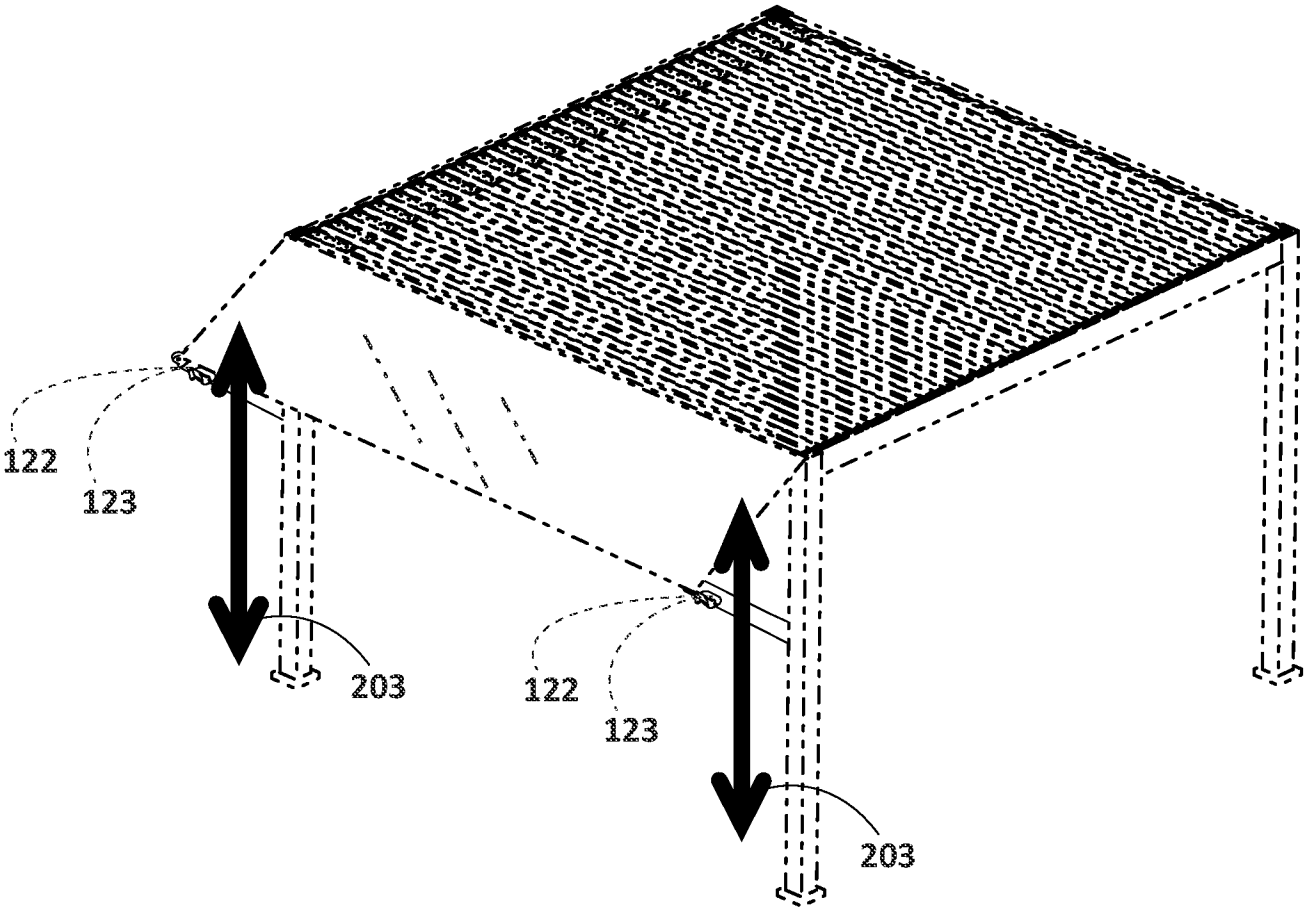
Figure 120:
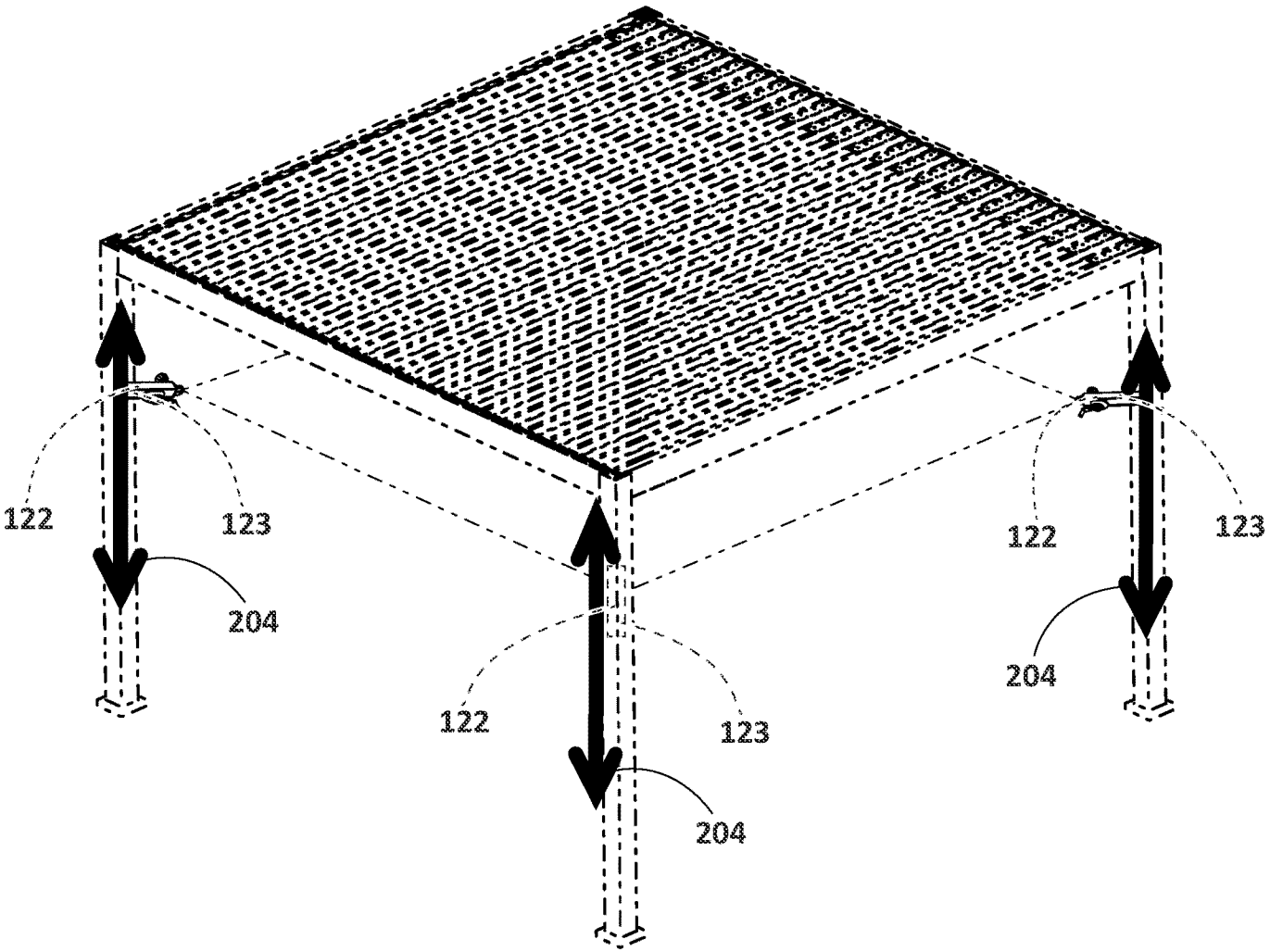
Figure 121:
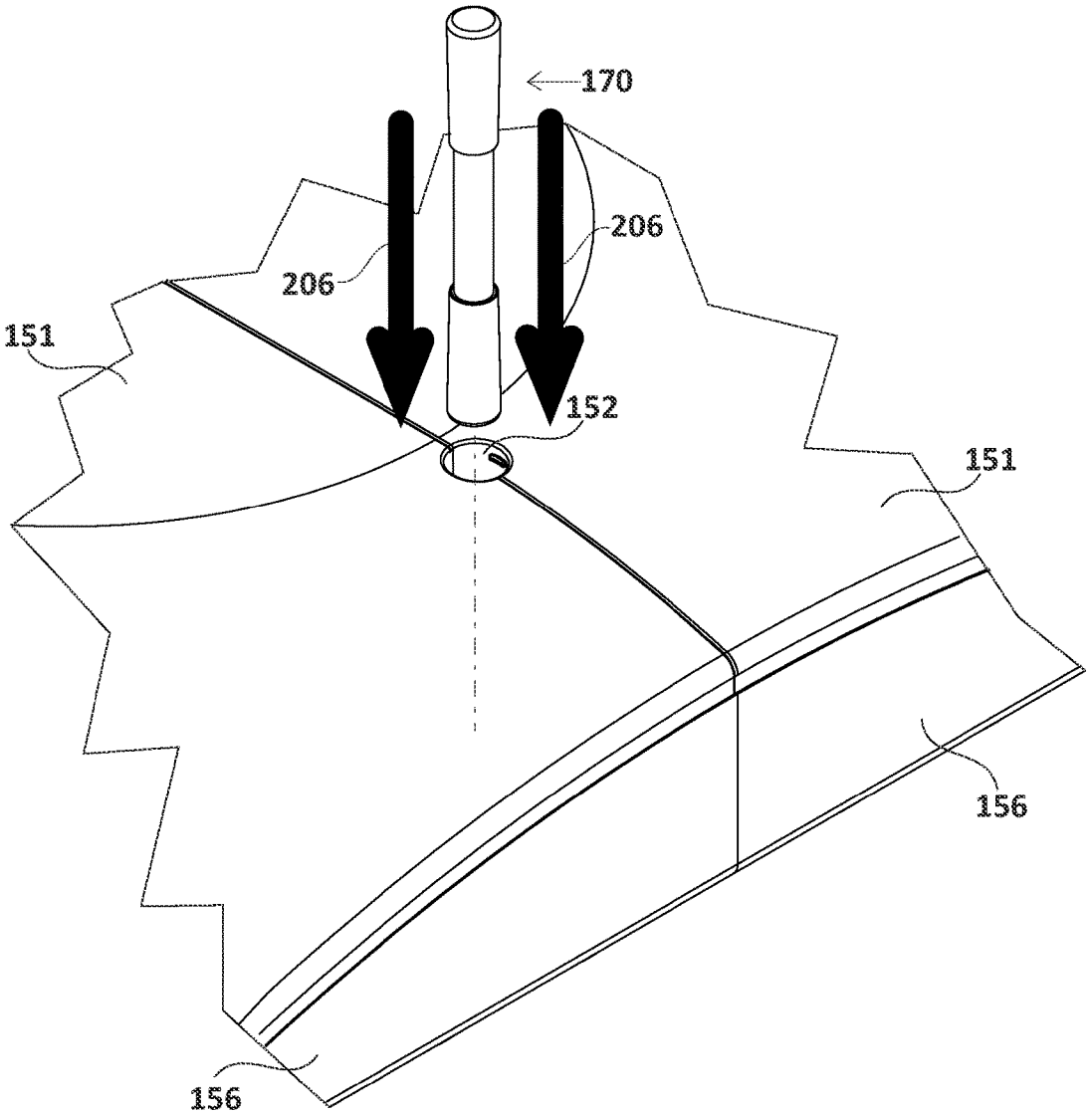
FIG. 121-FIG. 124 are diagrams illustrating perspective and side views demonstrating deployable-hidable crank-and-bolt-lock system 170 for locking production-increasing cost-saving identical-half-base-bottom system 155 to a patio or platform.
Figure 122:
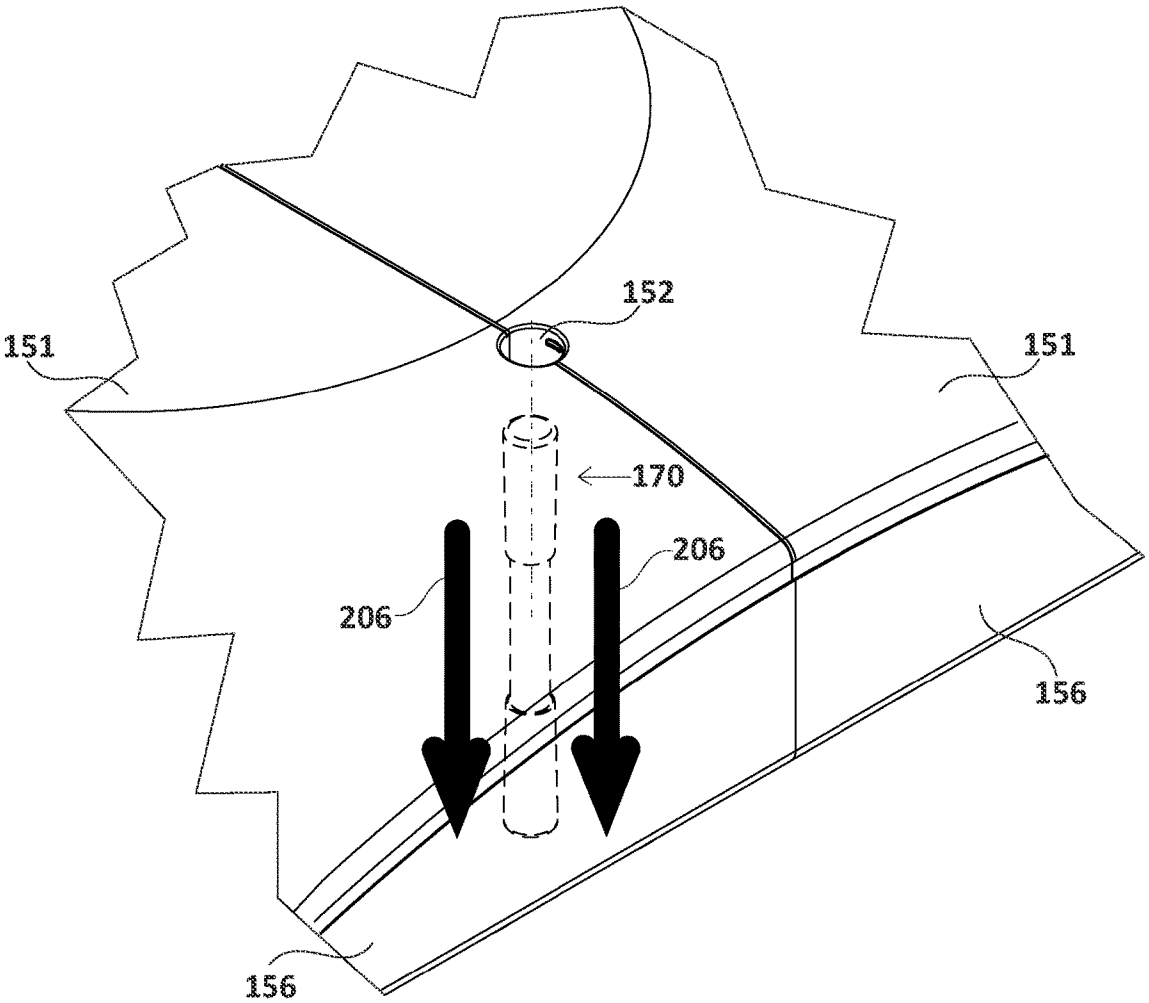
Figure 123:
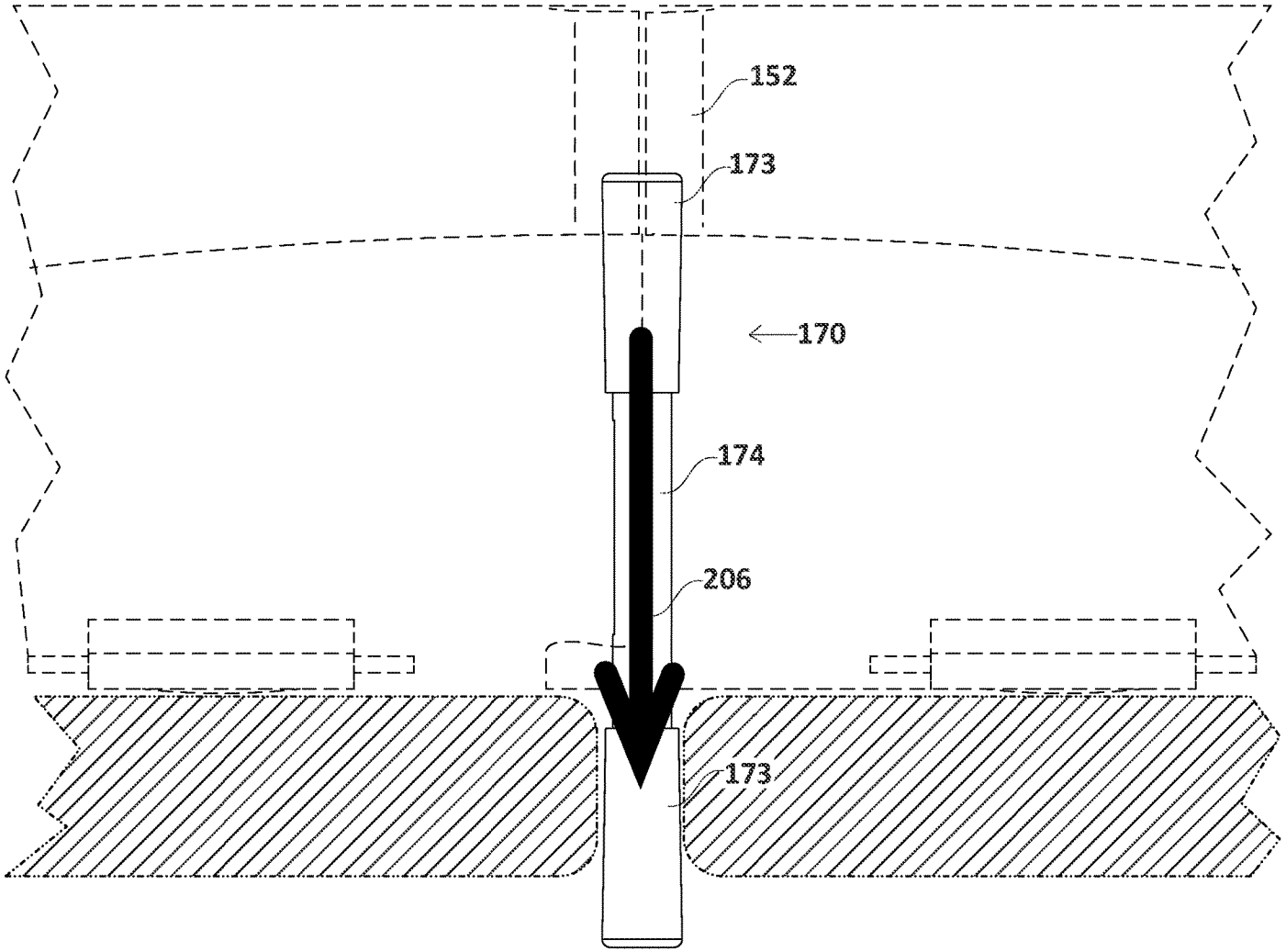
Figure 124:
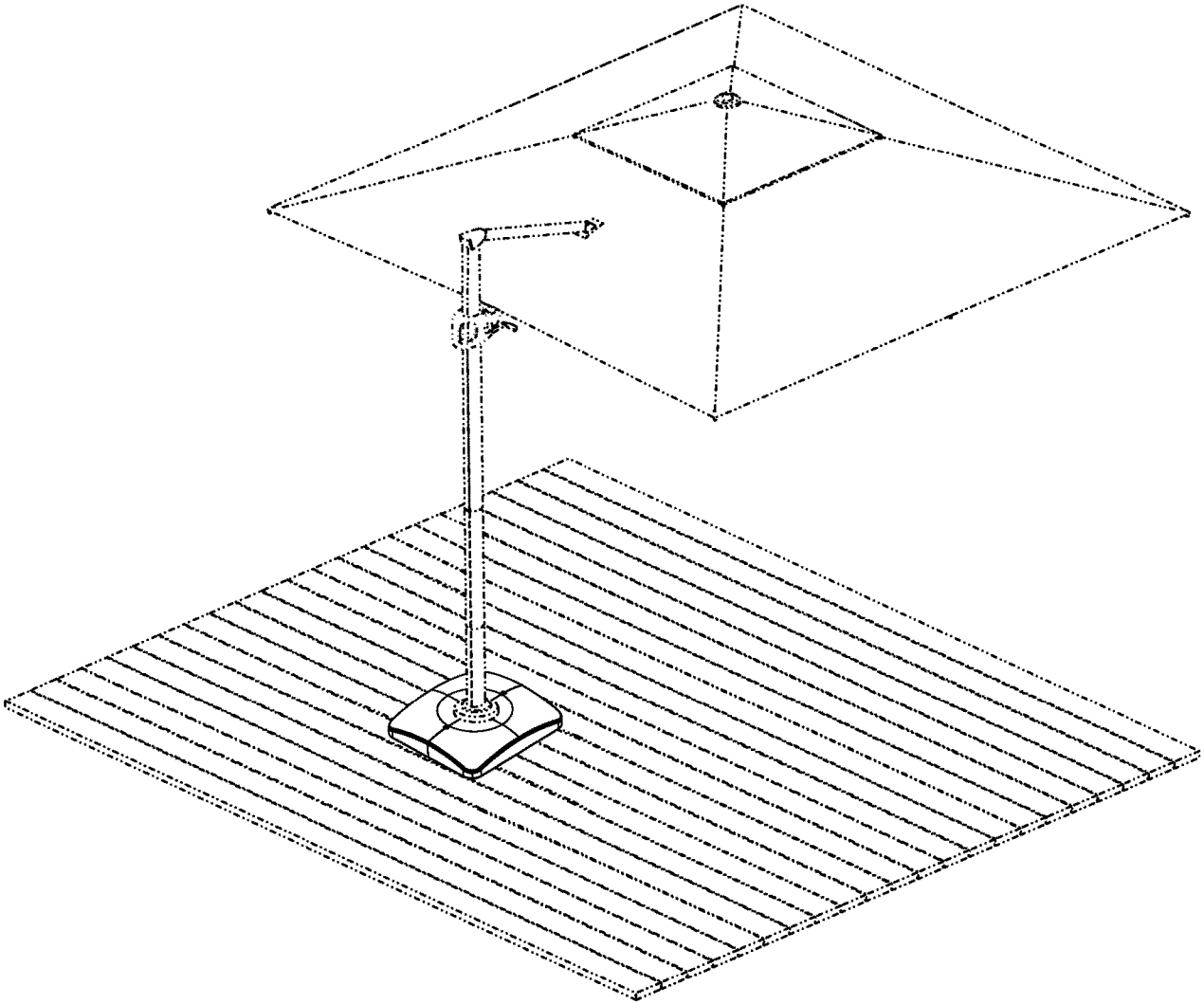
Figure 125:
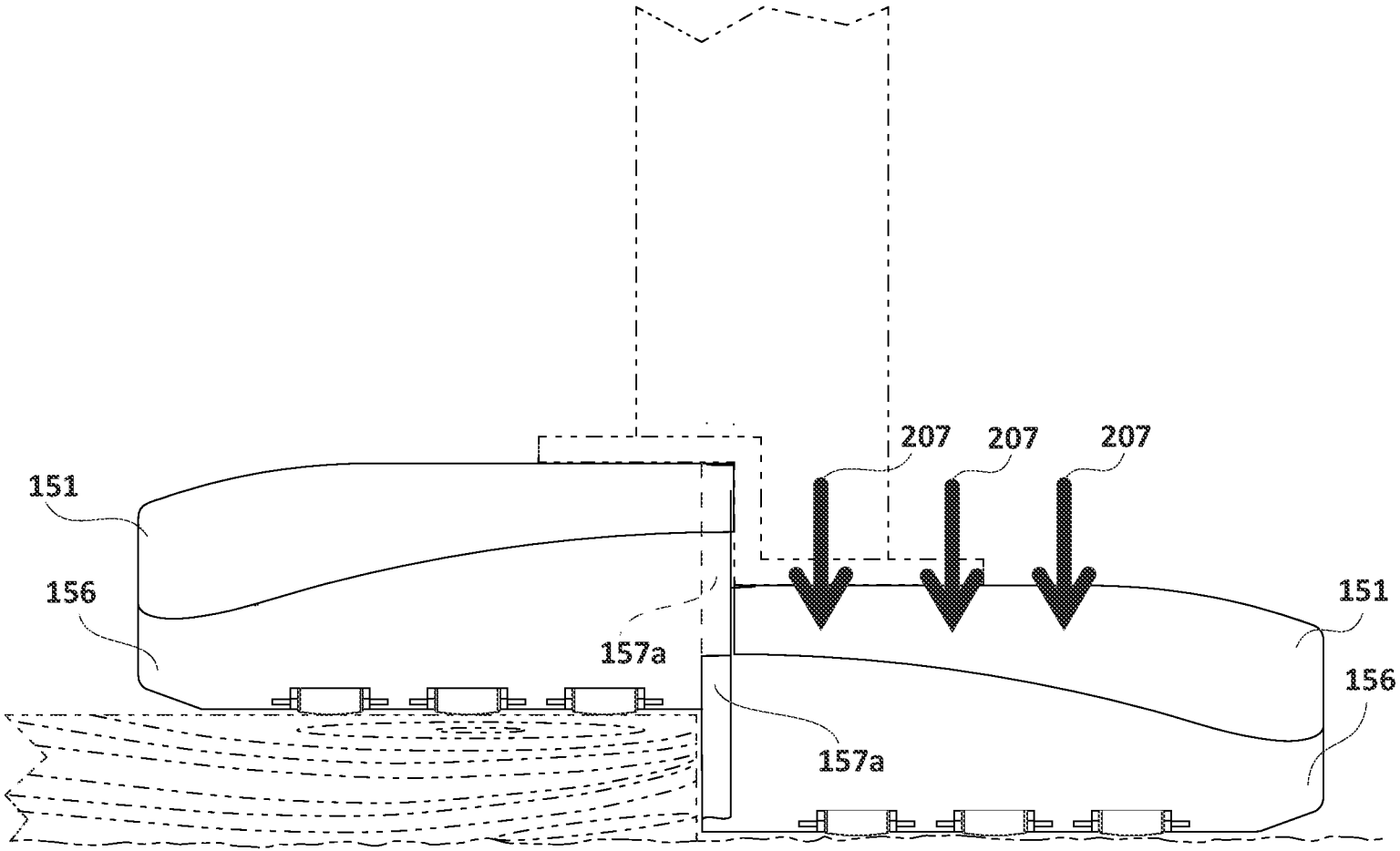
FIG. 125-FIG. 130 are diagrams illustrating side, top, and perspective views demonstrating how production-increasing cost-saving identical-half-base-bottom system 155 can sit on two different elevations at the same time.
Figure 126:
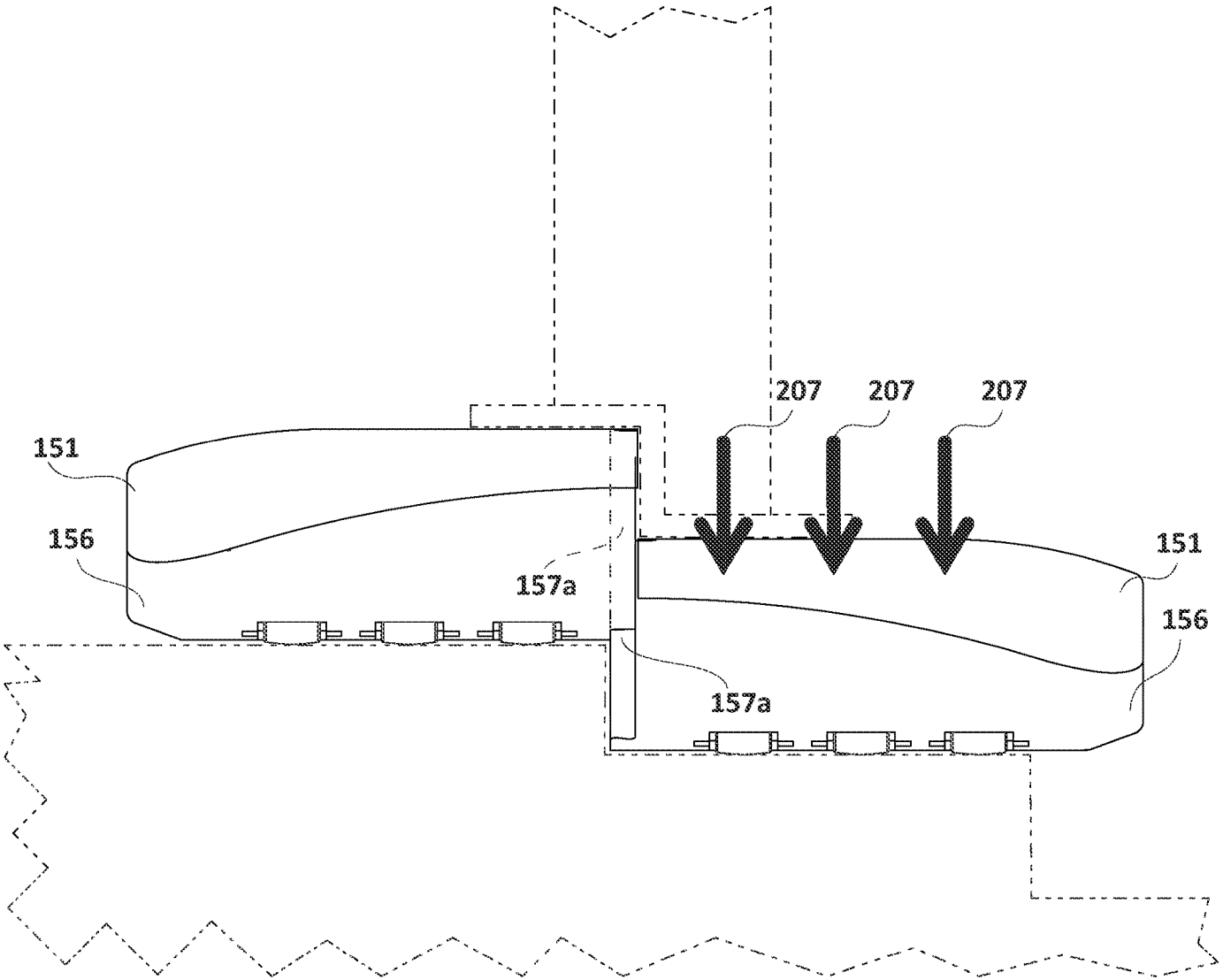
Figure 127:
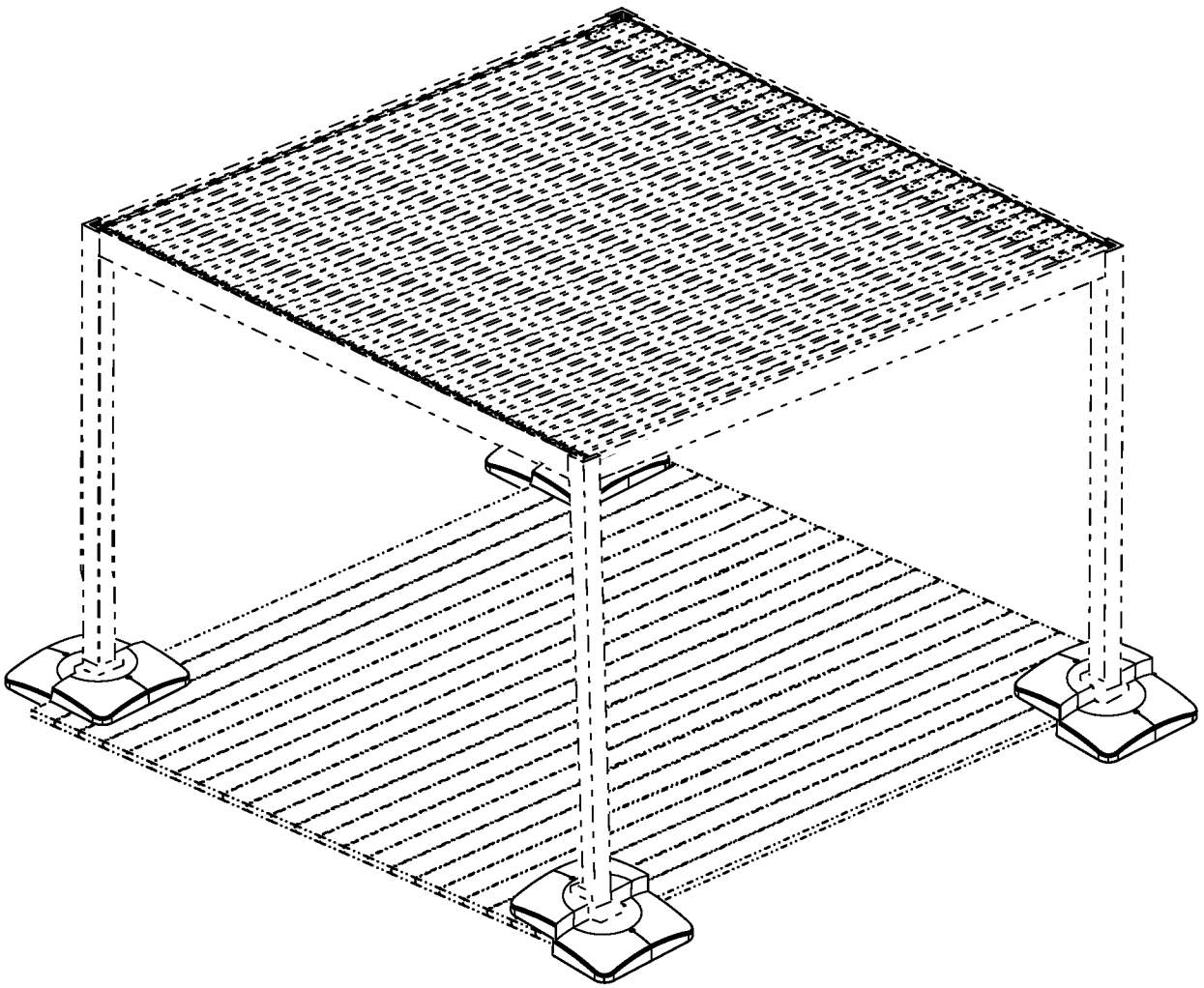
Figure 128:
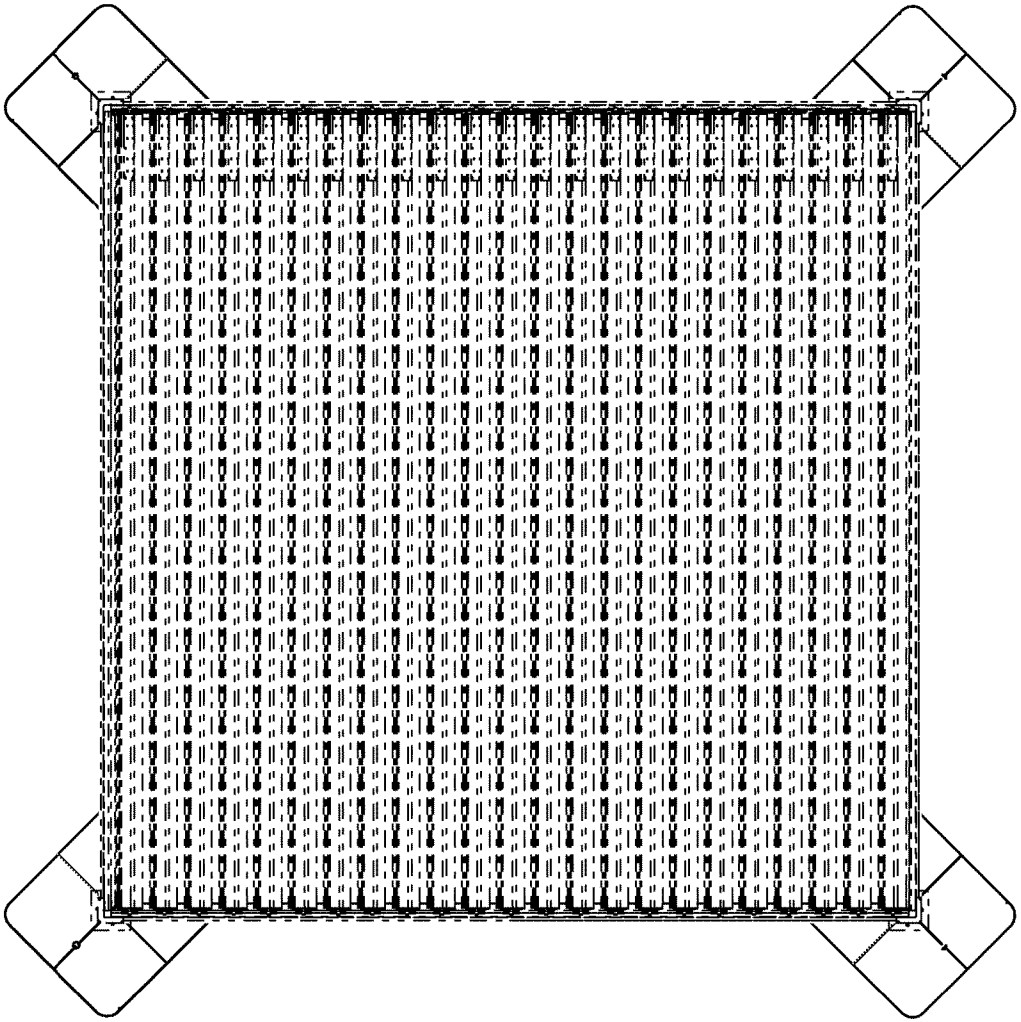
Figure 129:
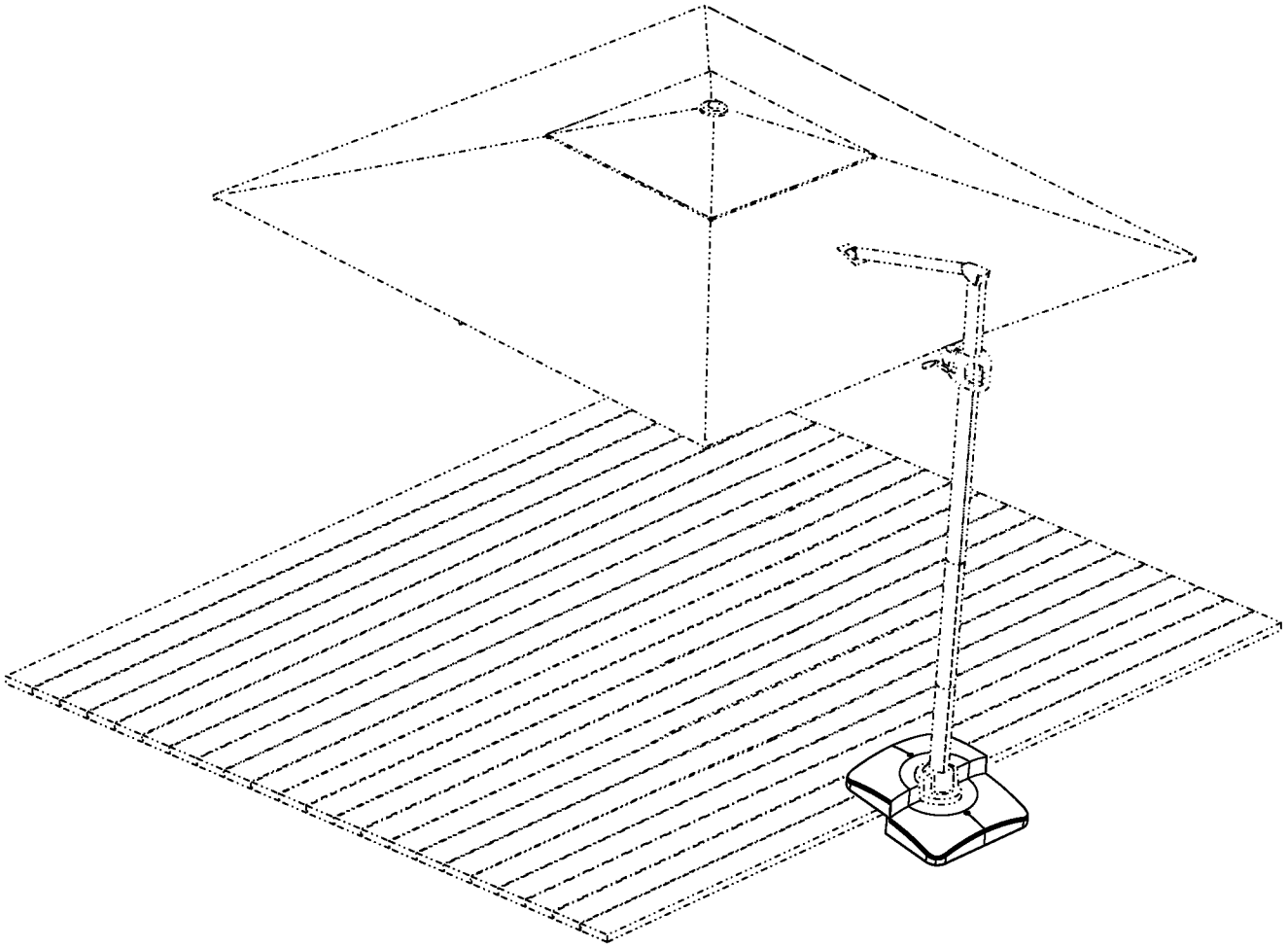
Figure 130:
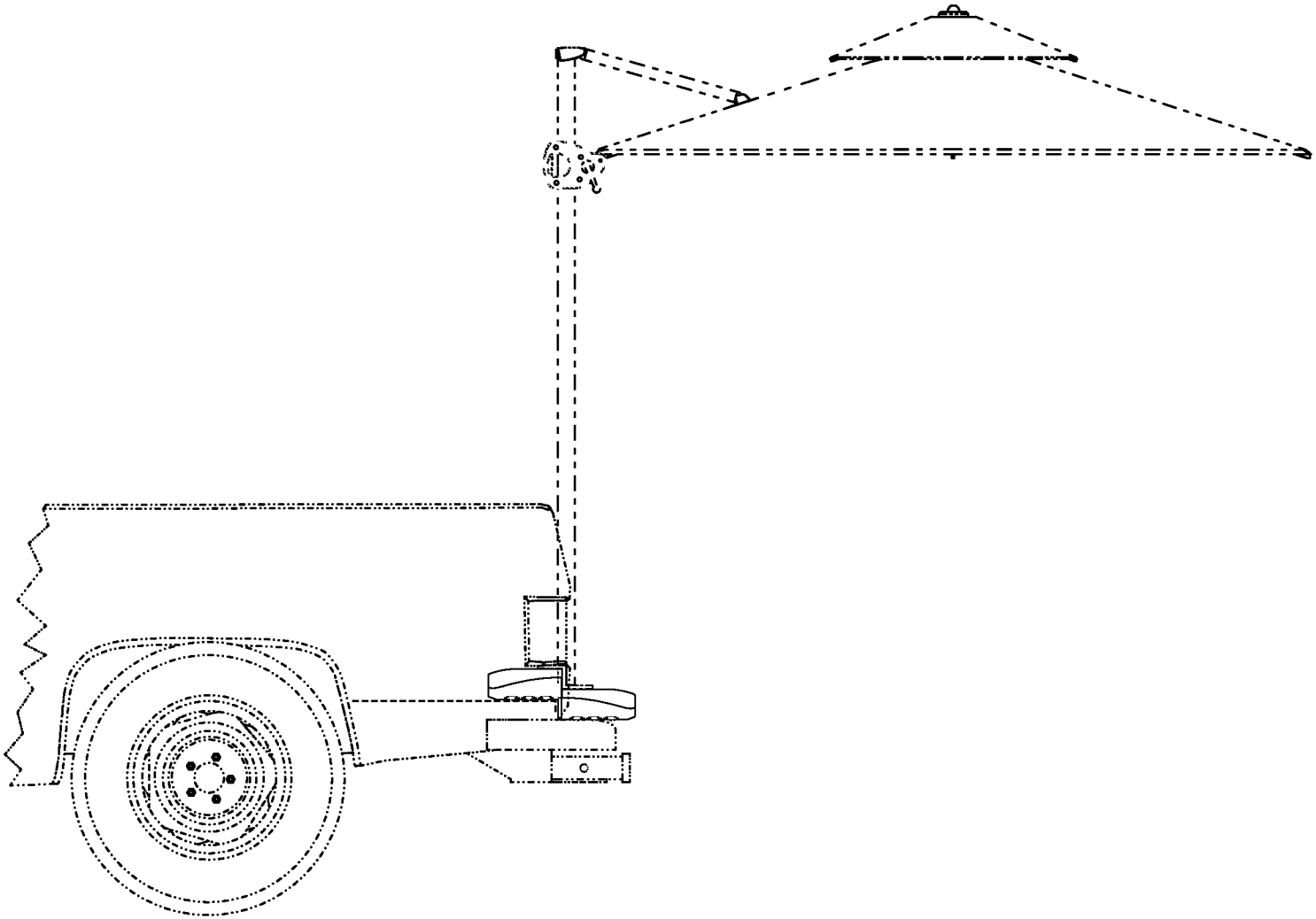
Figure 131:
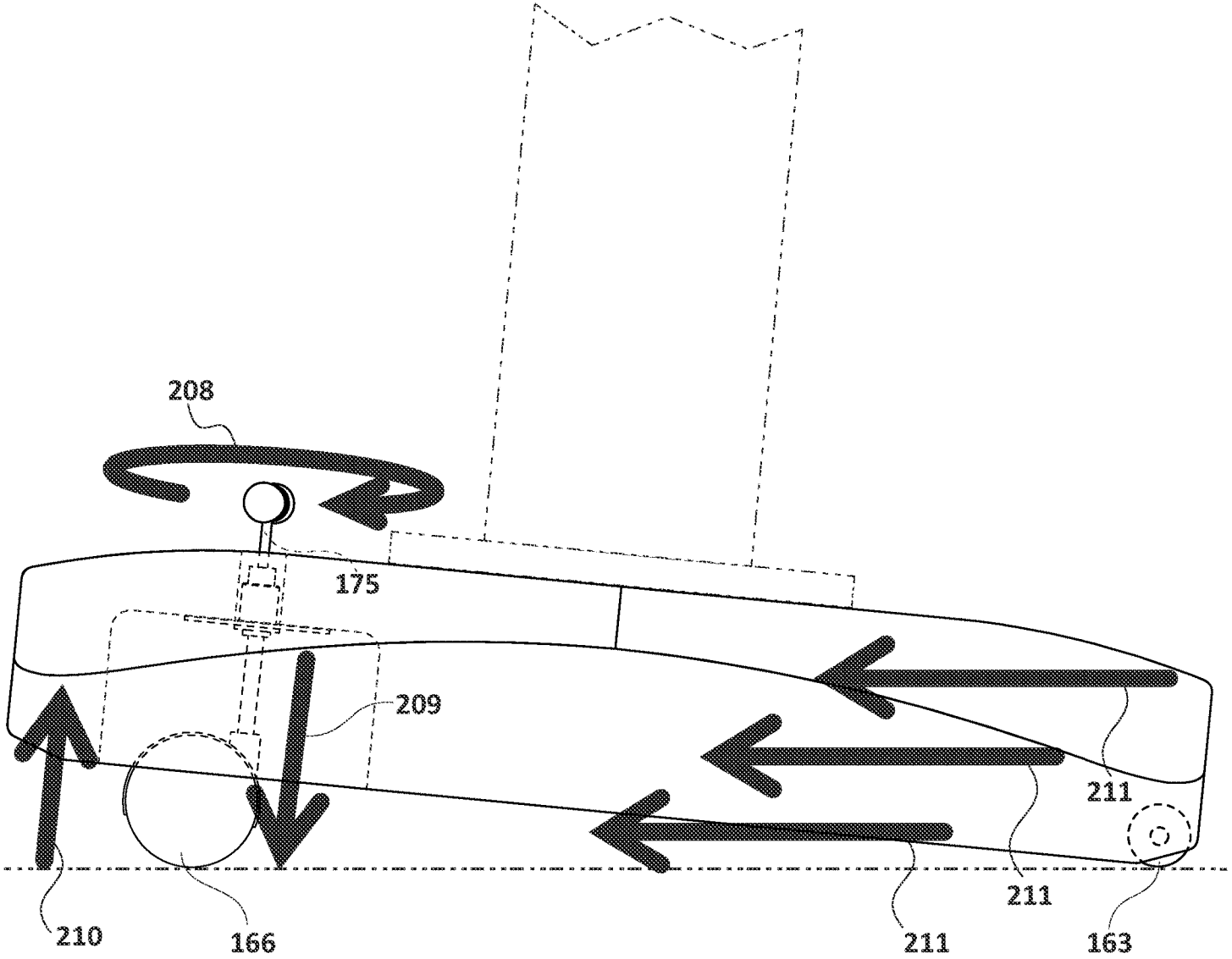
FIG. 131 and FIG. 132 are diagrams illustrating side views demonstrating adjustable-hidable angle-operated caster system 164 being able to be adjusted to different tilted heights to work together with 6 angle-operated edge rollers 163 to elevate the 5-device-in-one base off the ground for moving.
Figure 132:
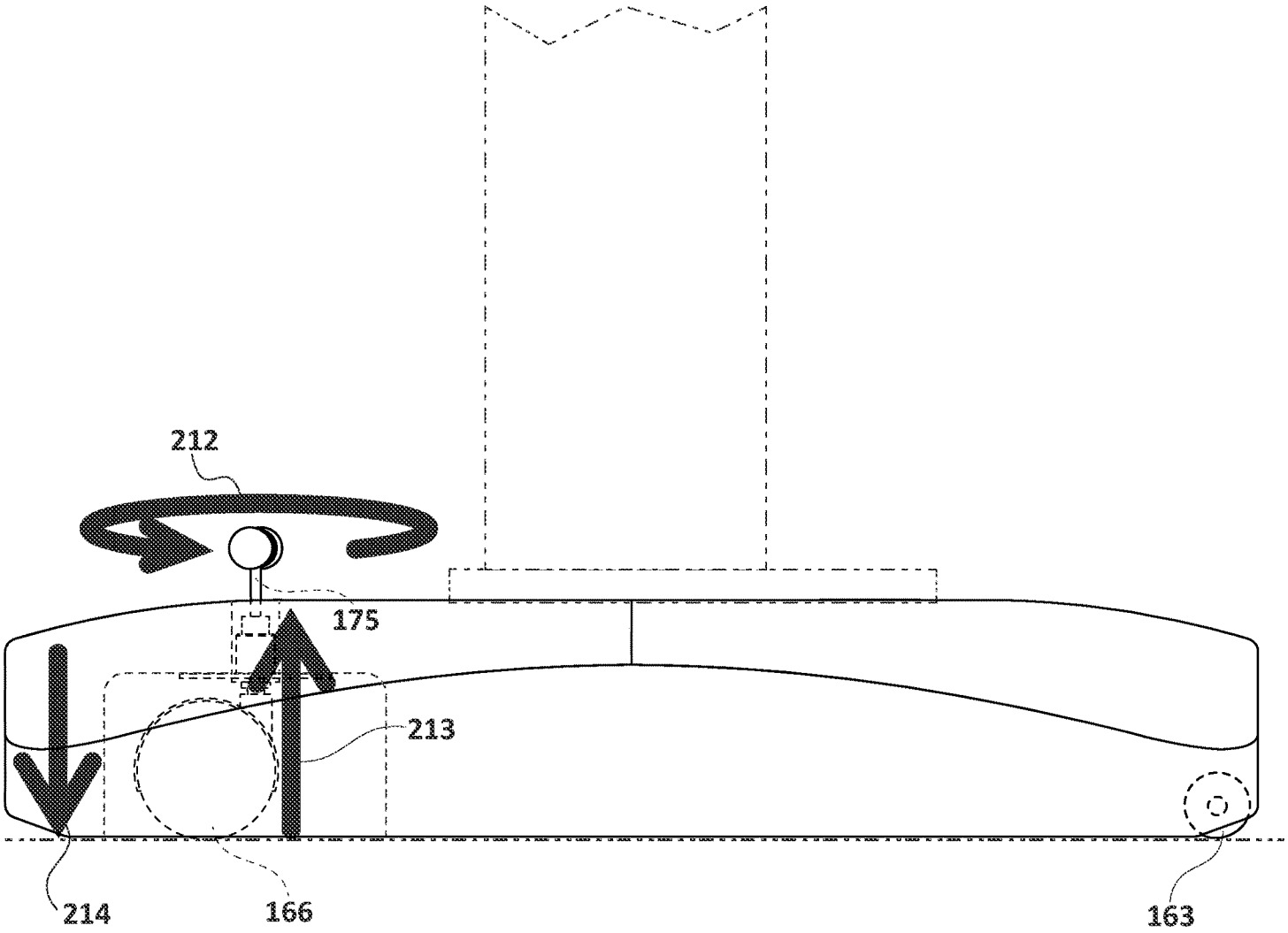
Figure 133:
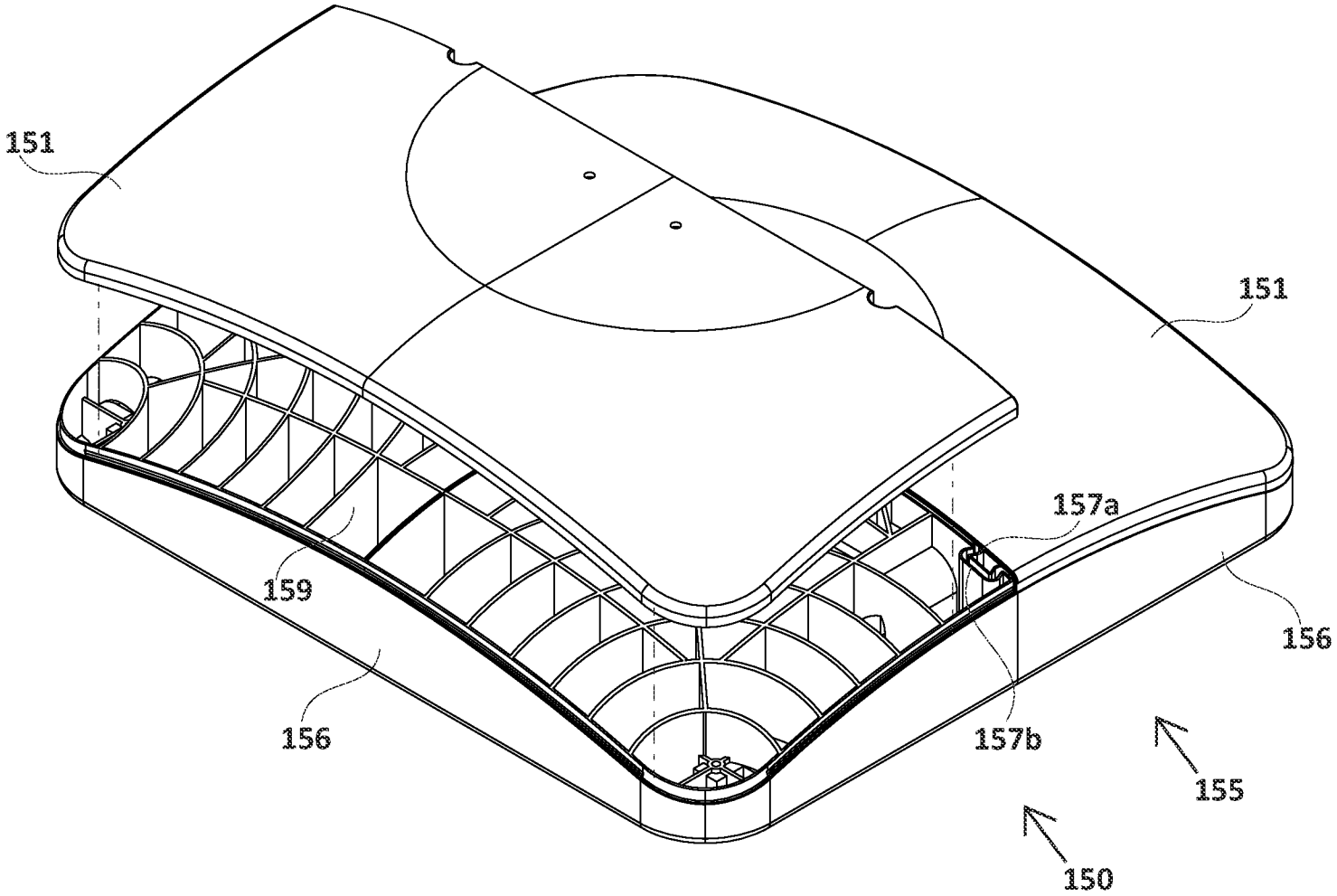
FIG. 133-FIG. 172 are diagrams illustrating perspective, top, and side views demonstrating the components of production-increasing cost-saving identical-half-base-top system 150 and production-increasing cost-saving identical-half-base-bottom system 155.
Figure 134:
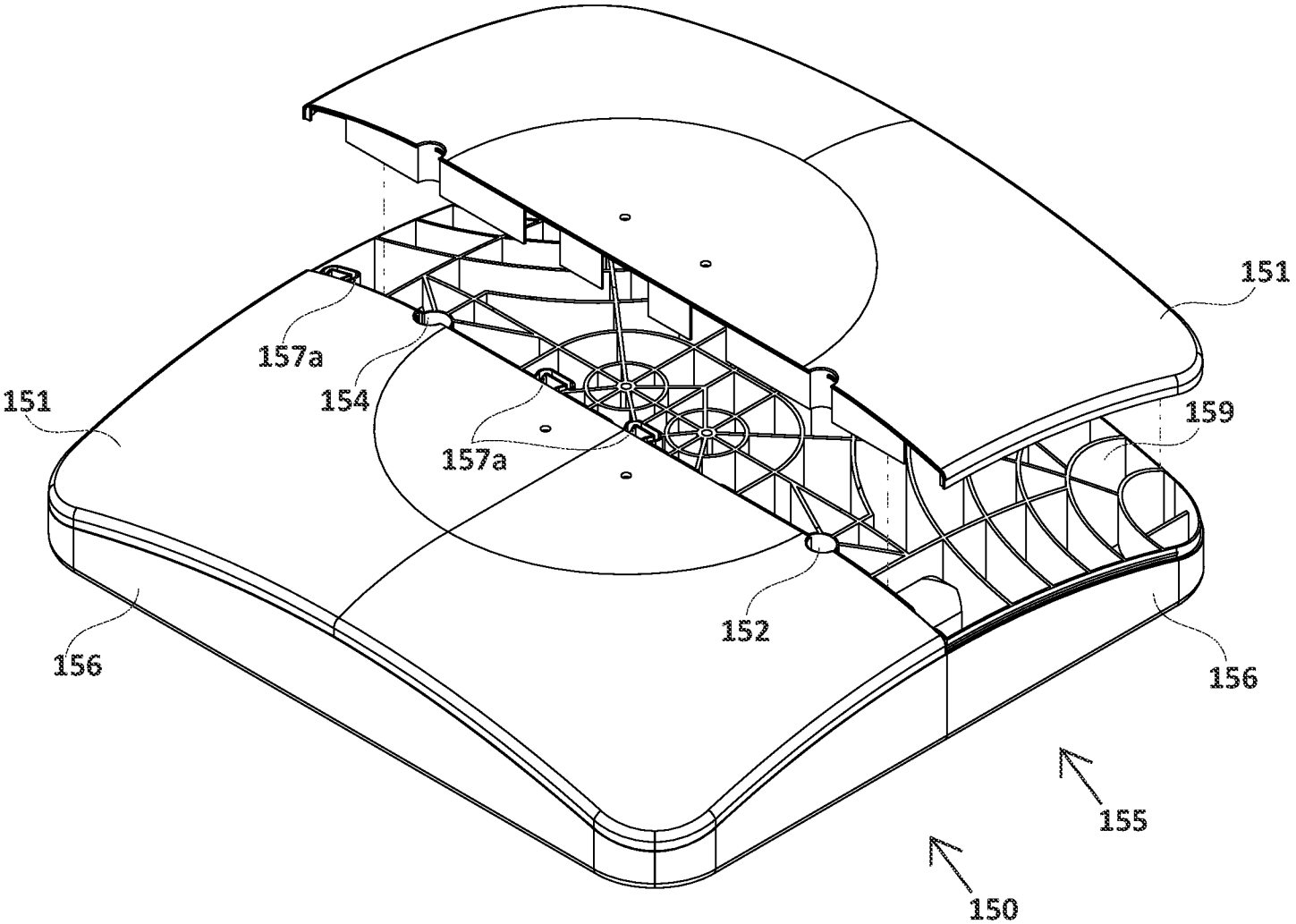
Figure 135:
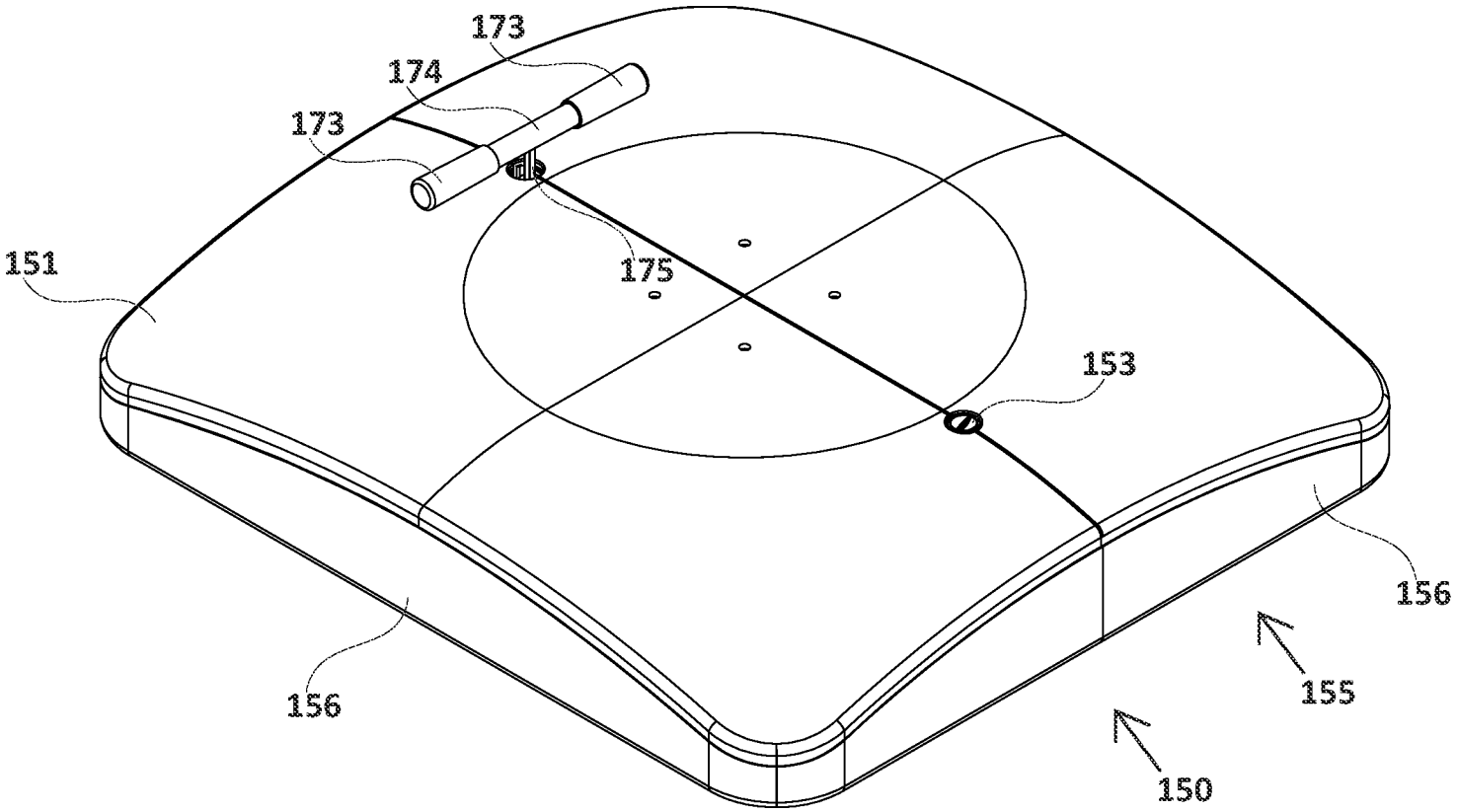
Figure 136:
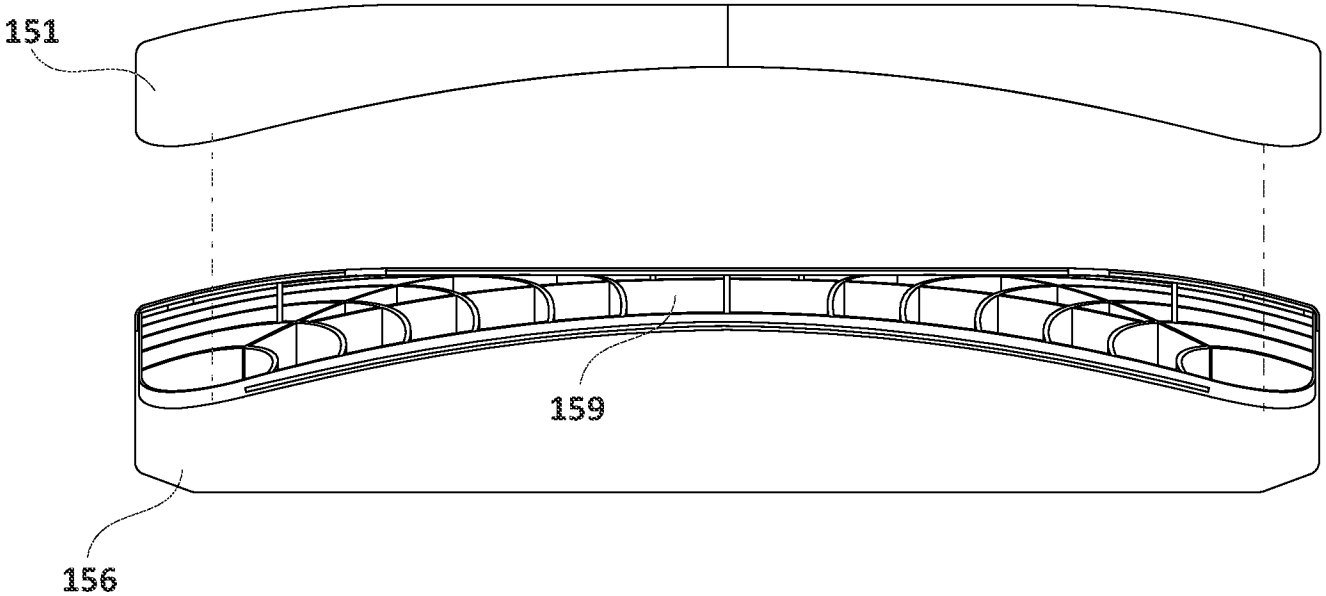
Figure 137:
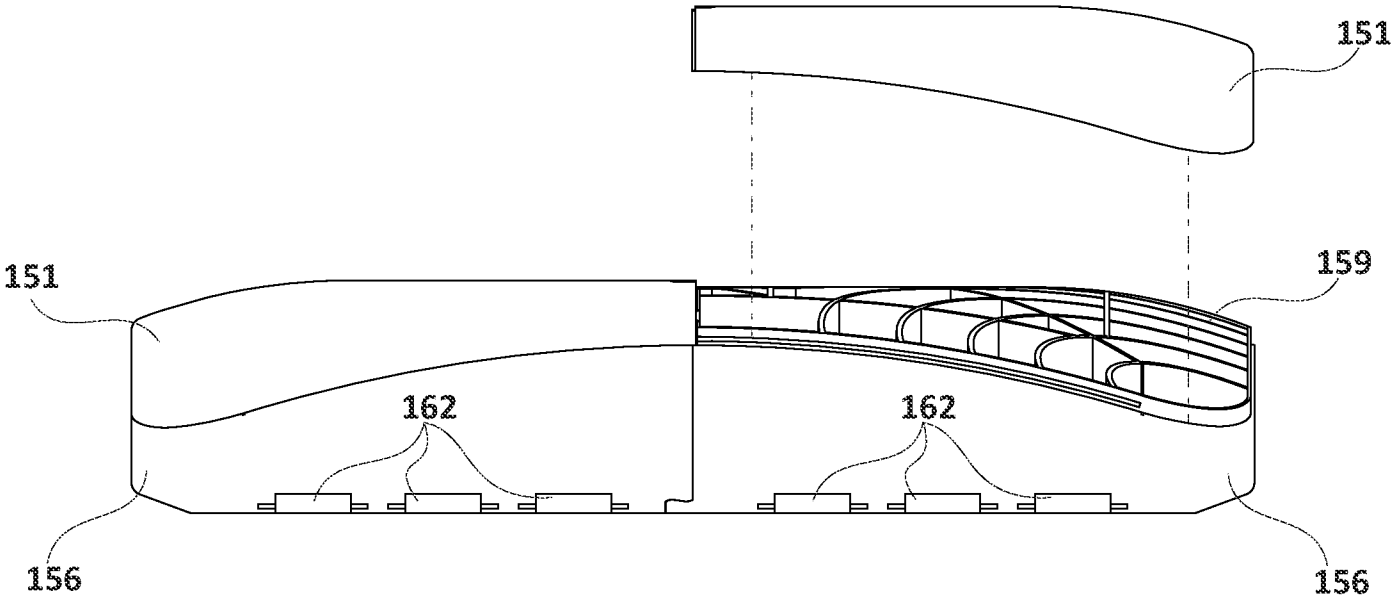
Figure 138:
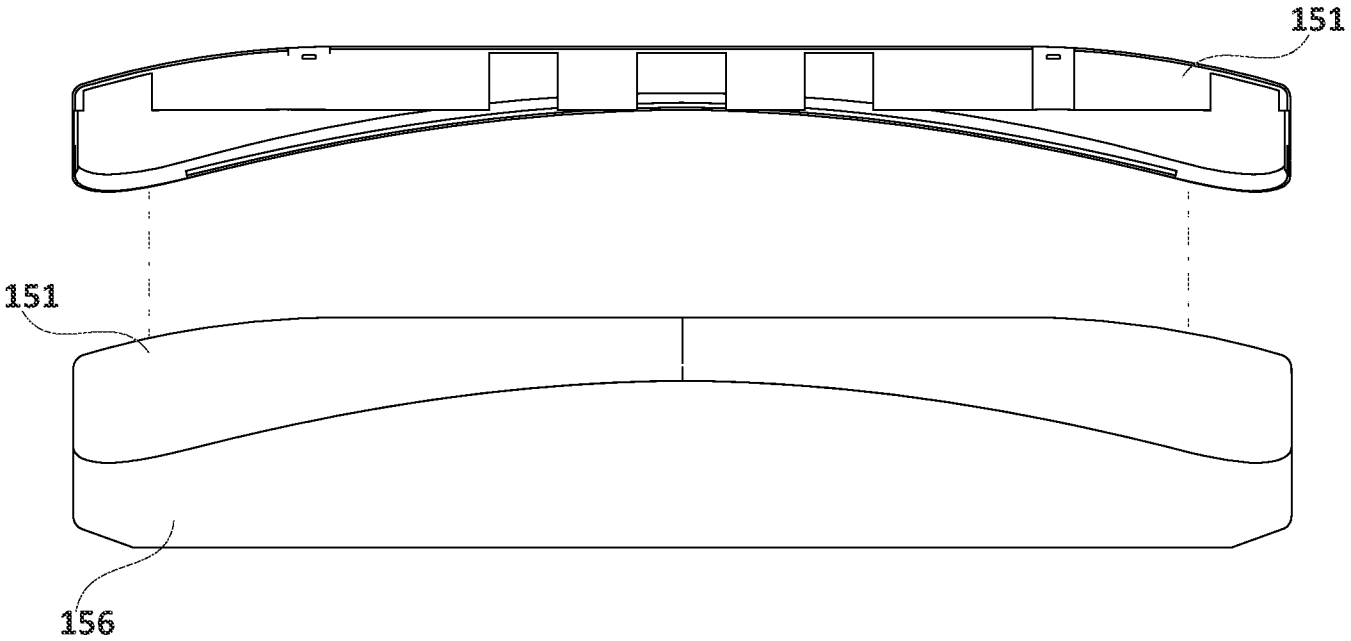
Figure 139:
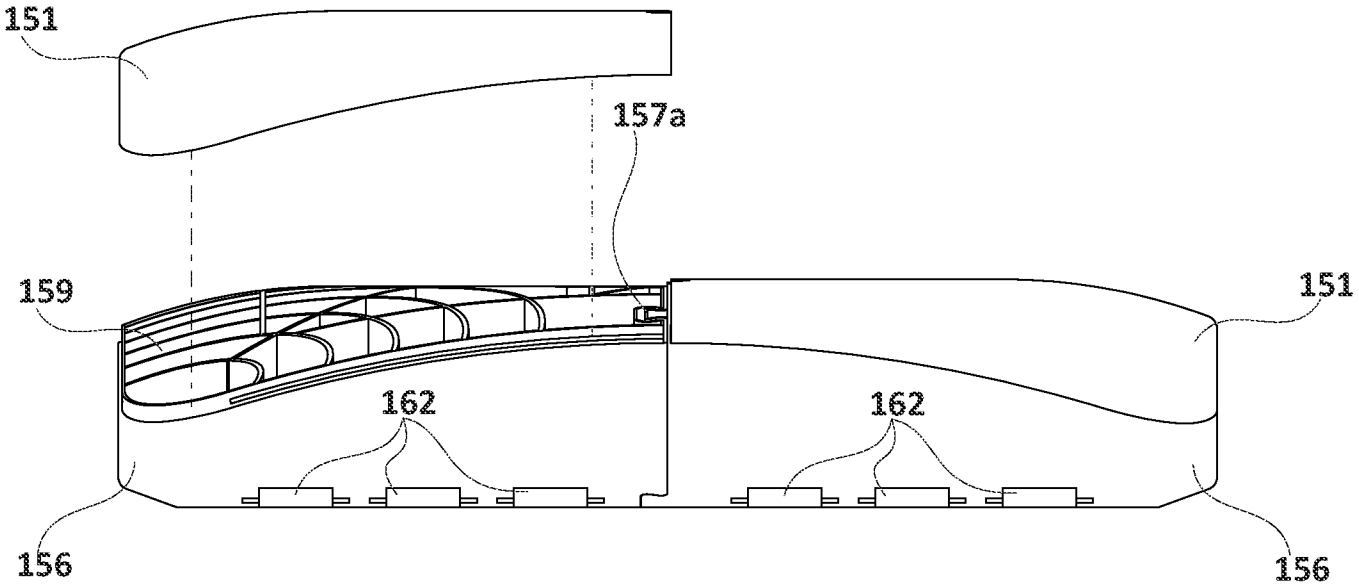
Figure 140:
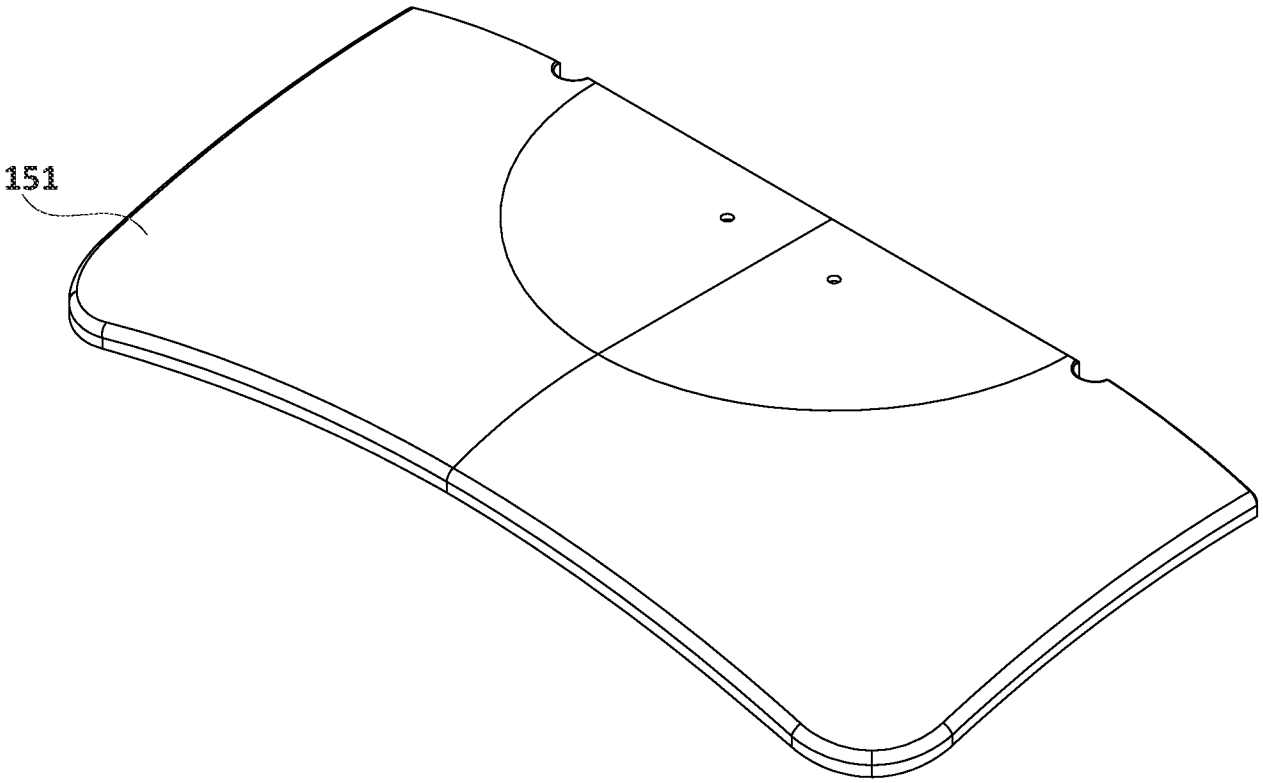
Figure 141:
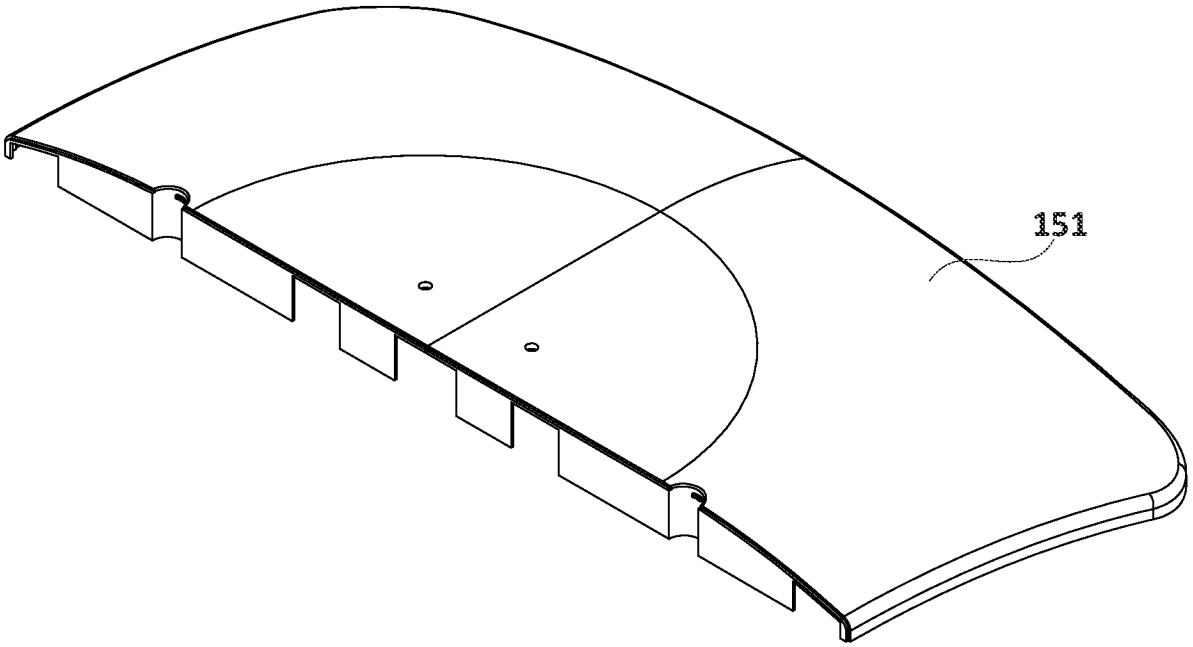
Figure 142:
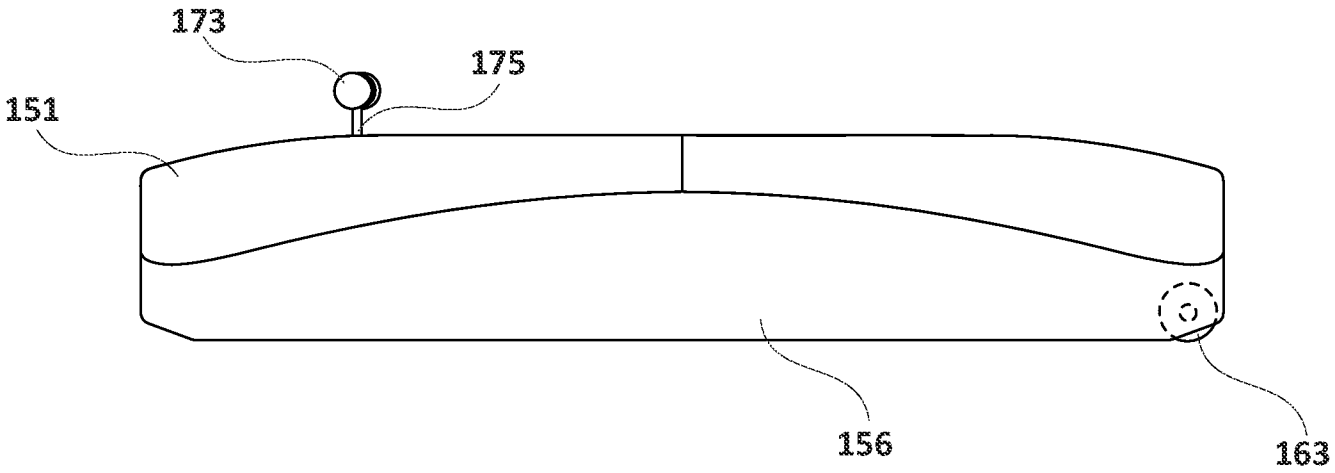
Figure 143:
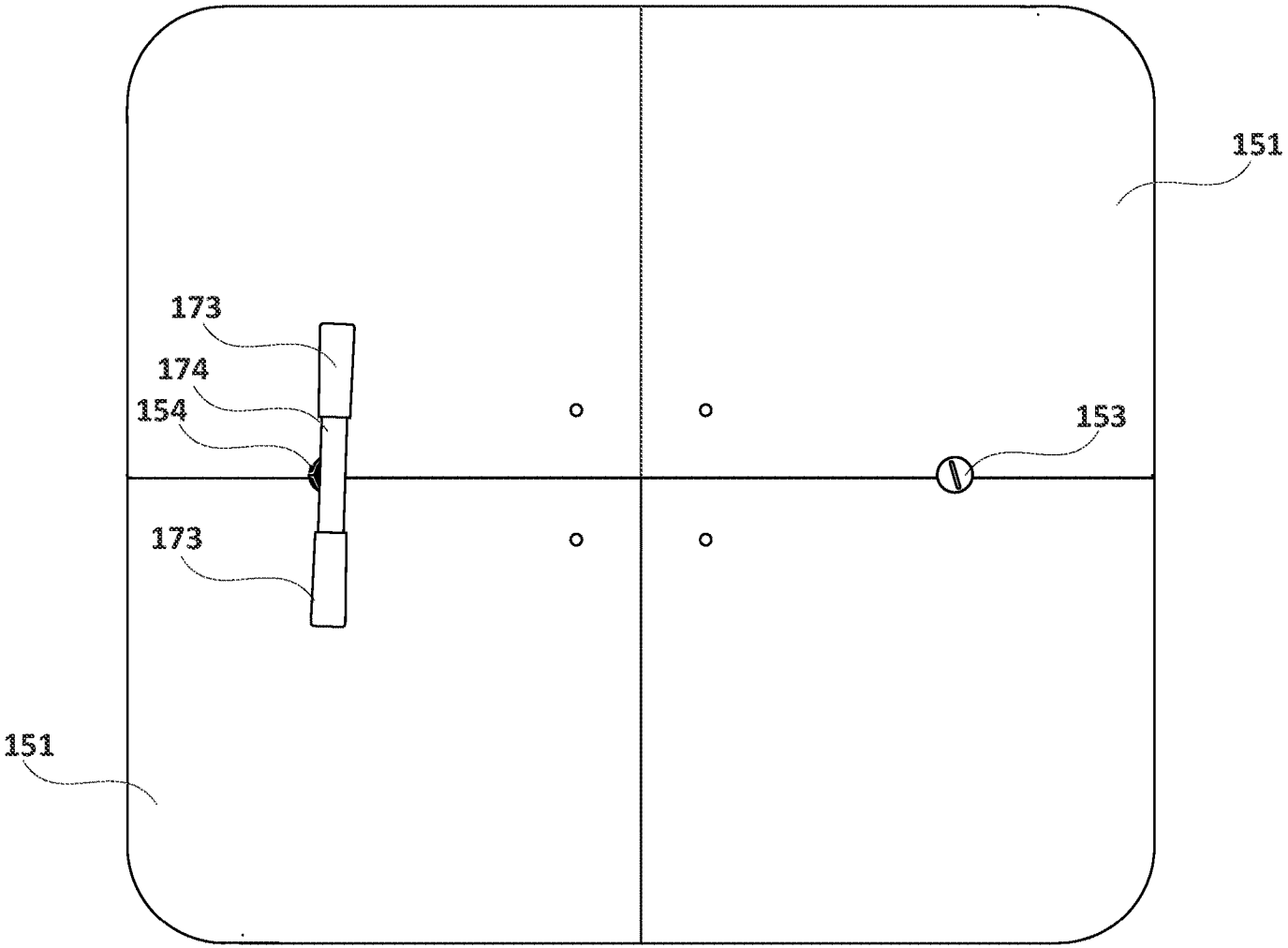
Figure 144:
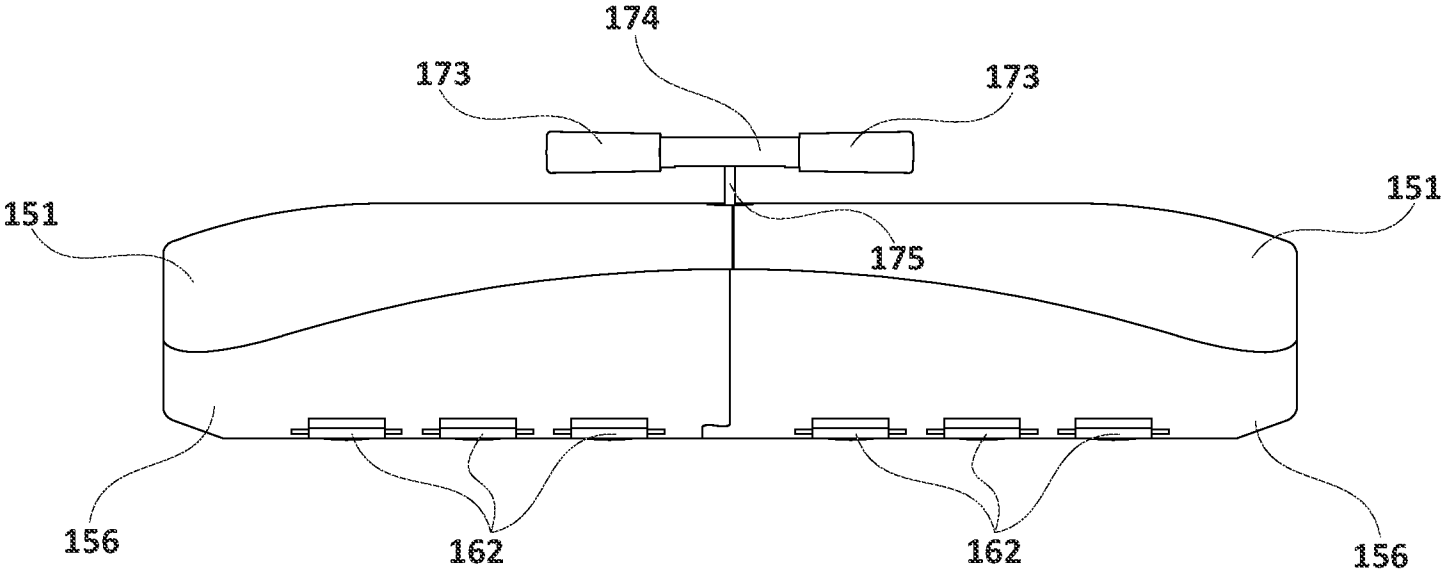
Figure 145:
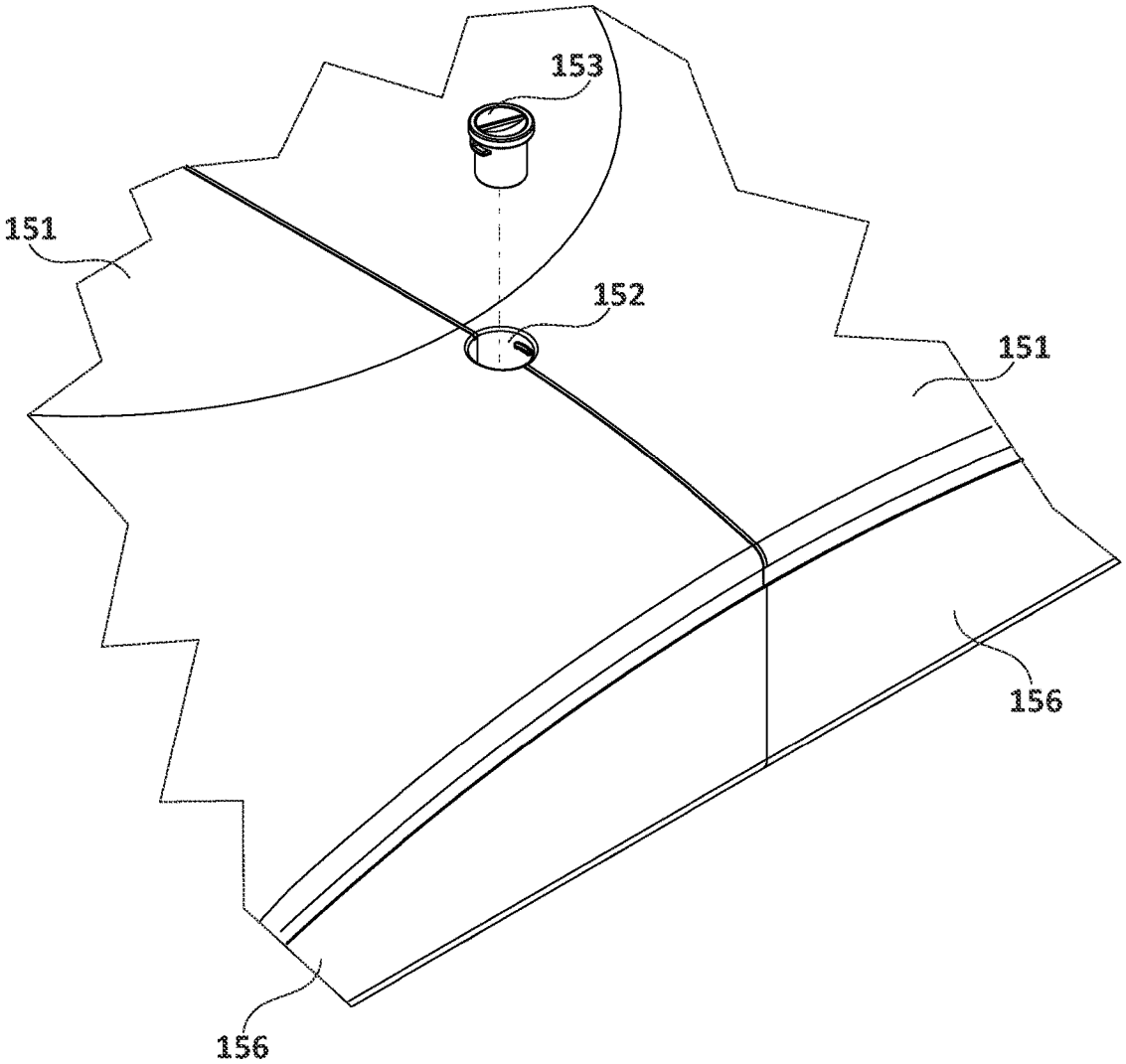
Figure 146:
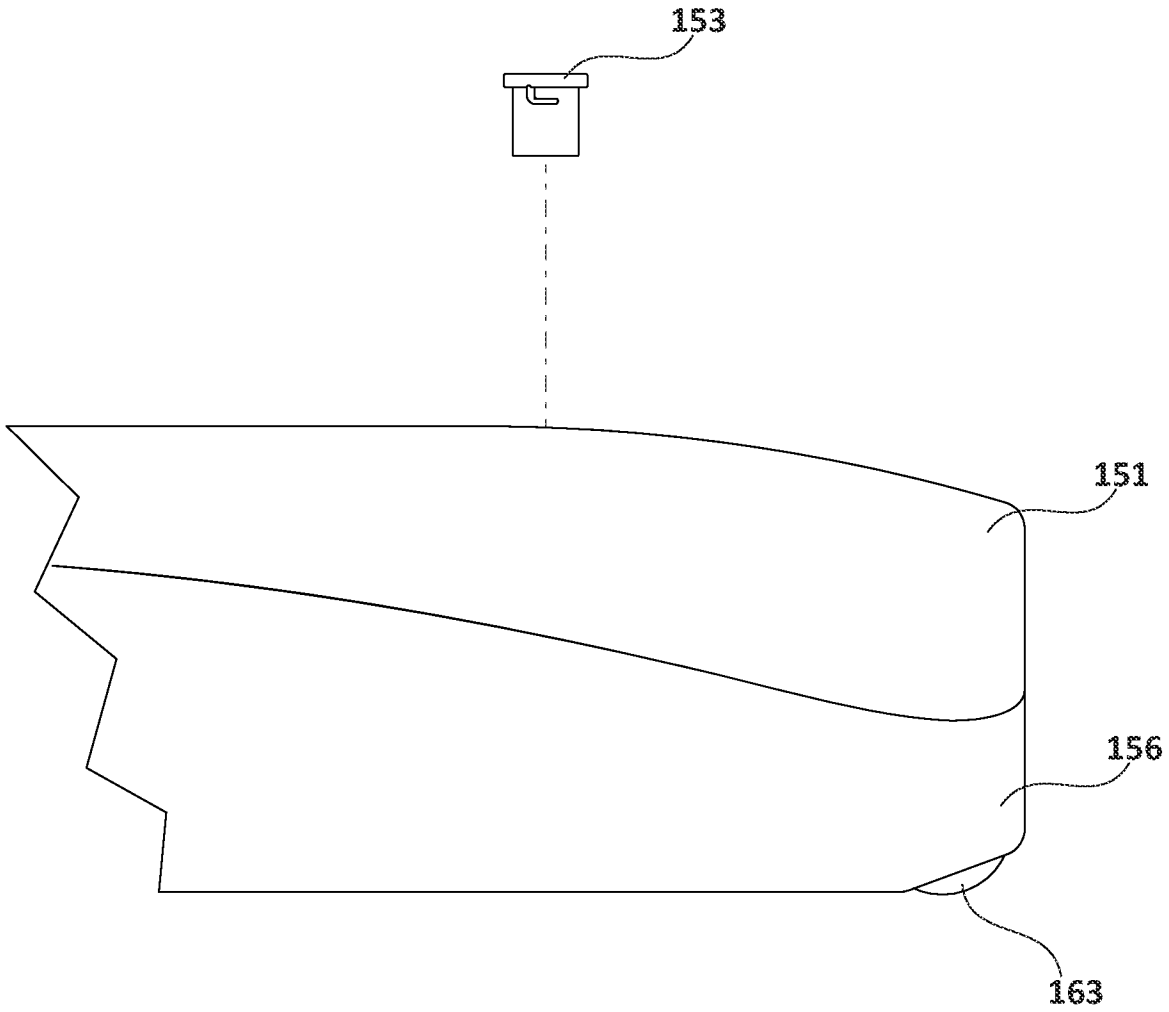
Figure 147:
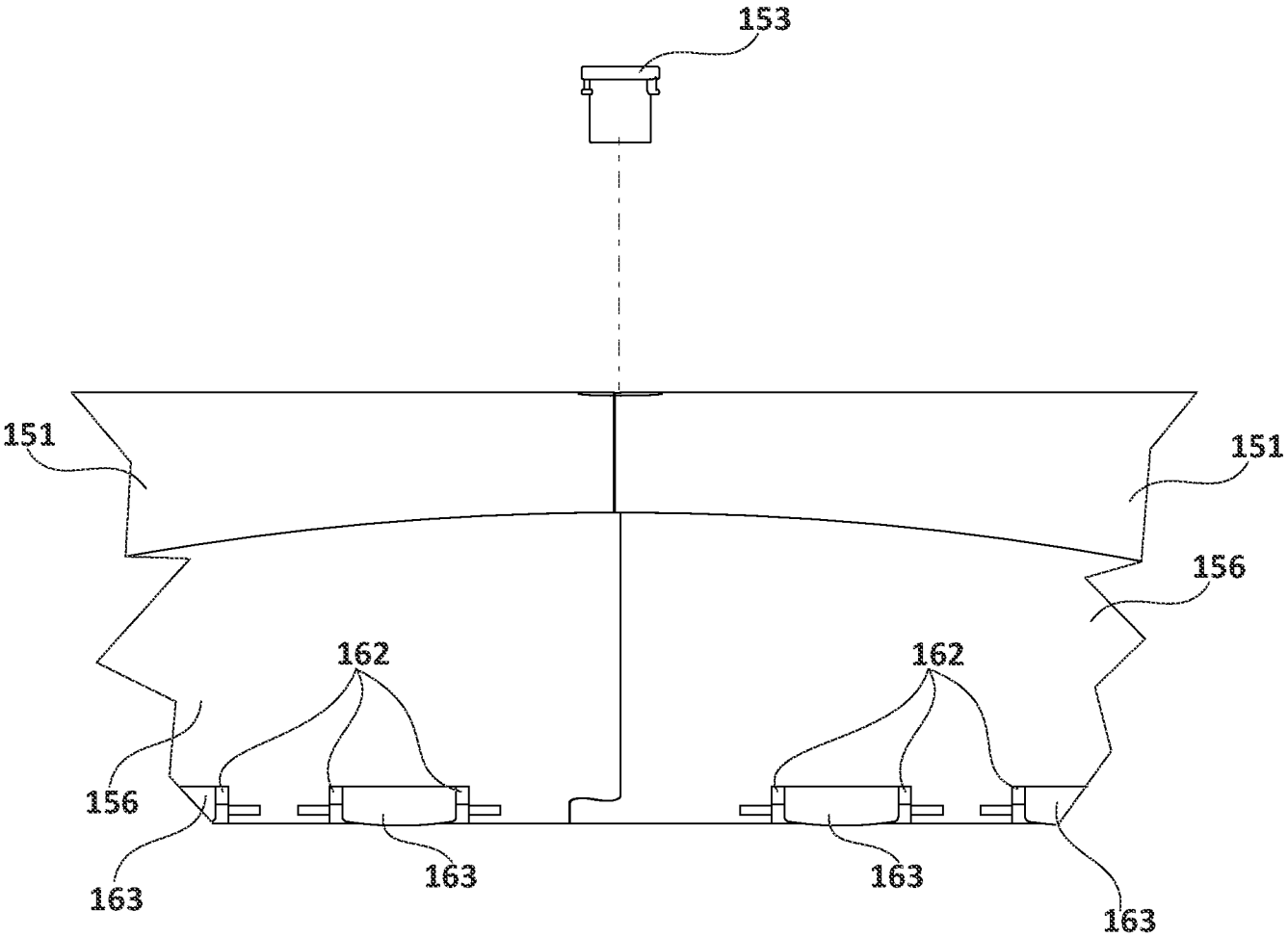
Figure 148:
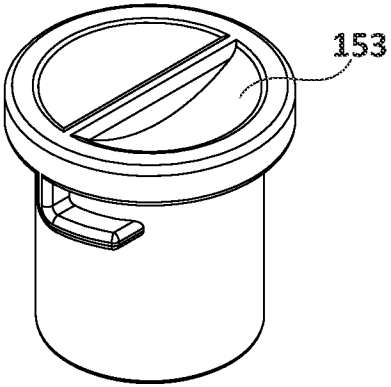
Figure 149:
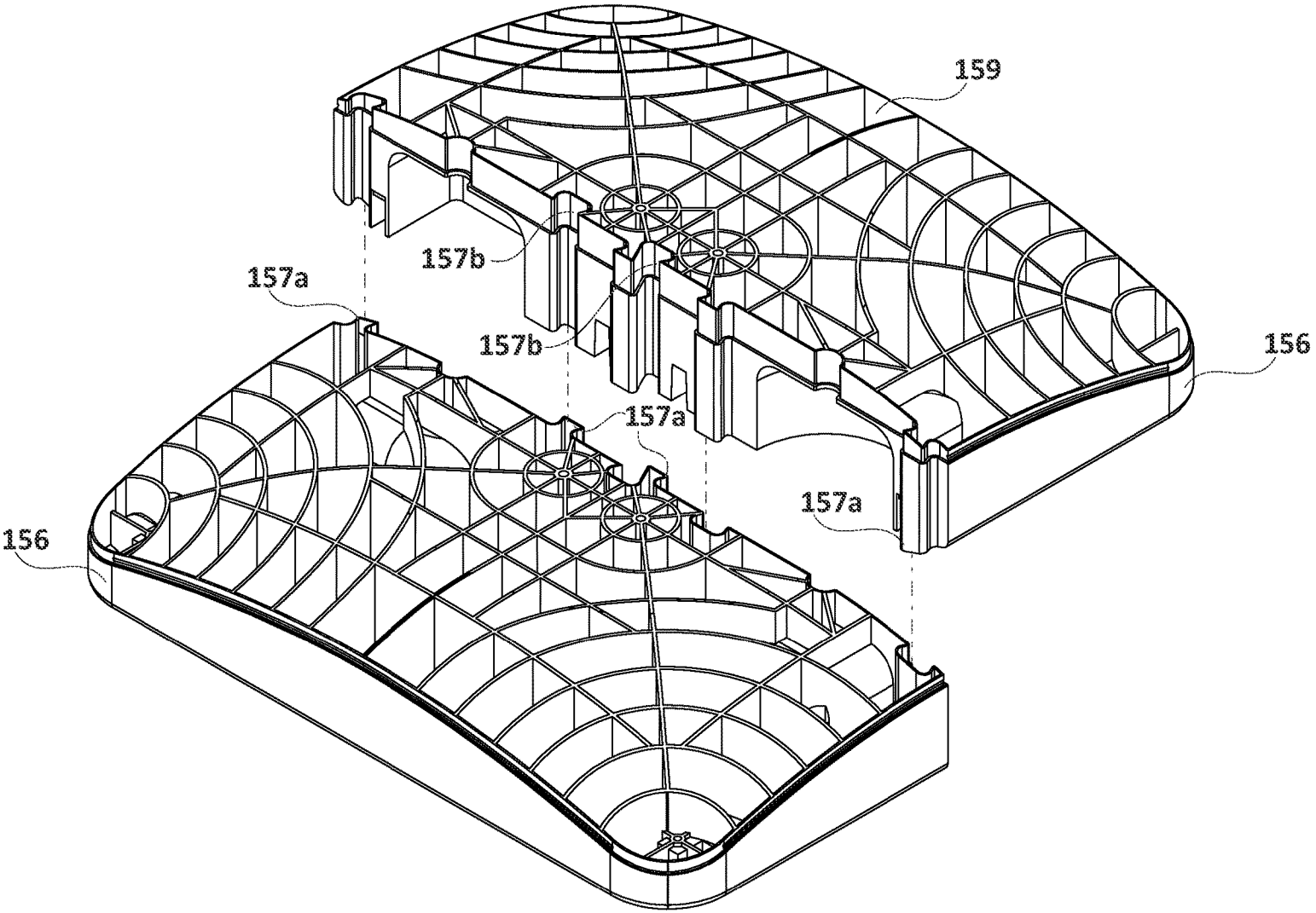
Figure 150:
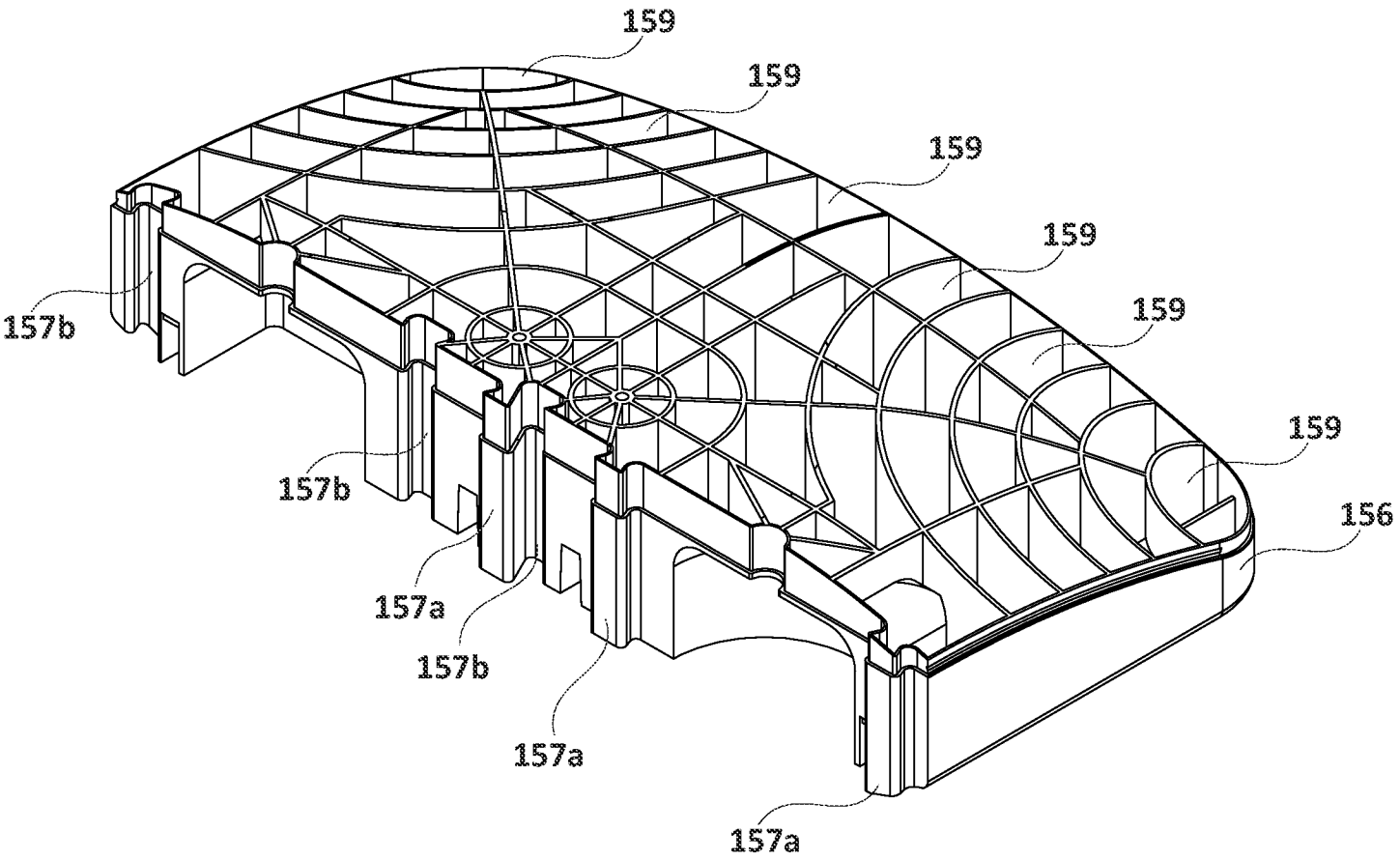
Figure 151:
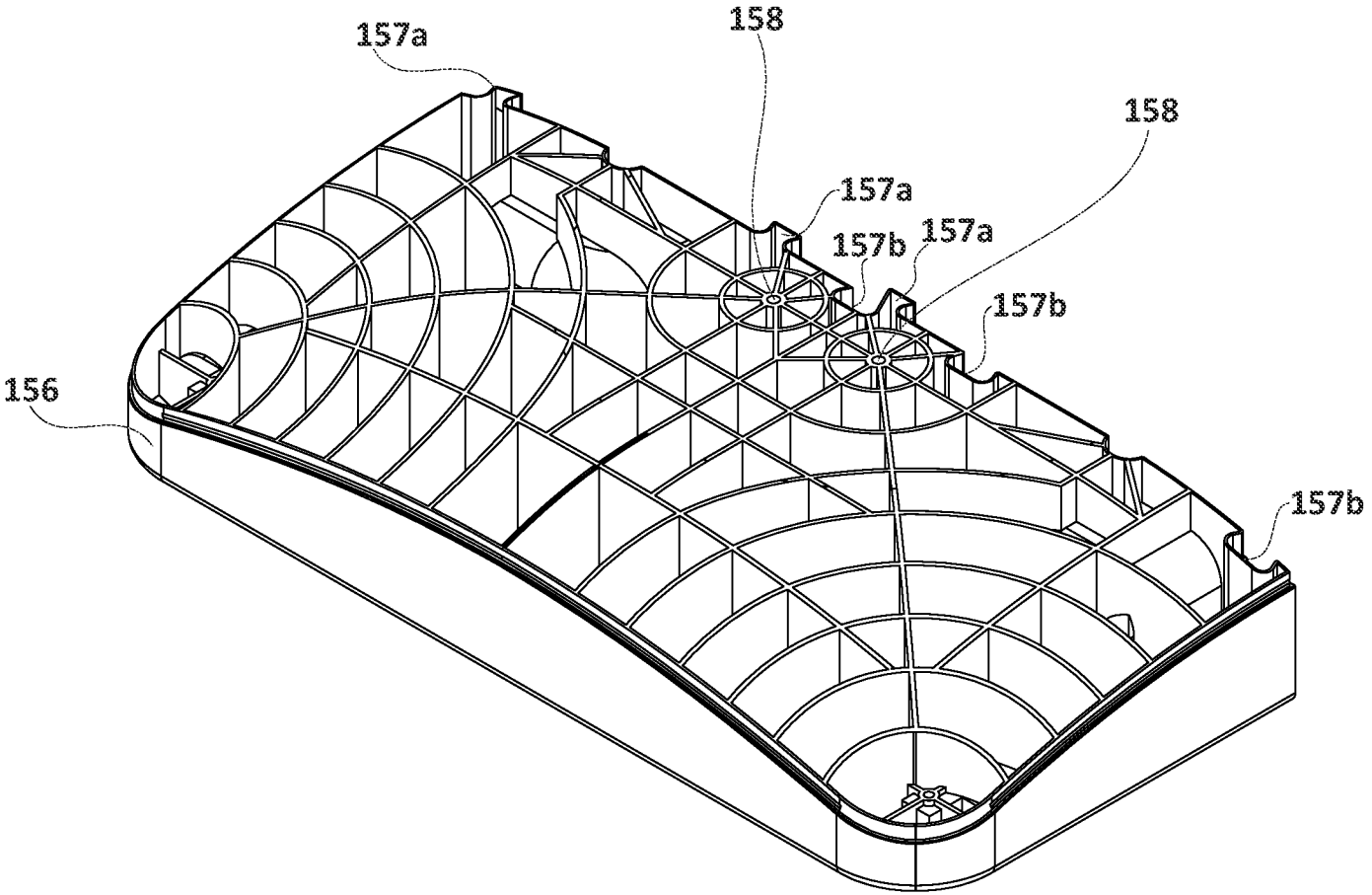
Figure 152:
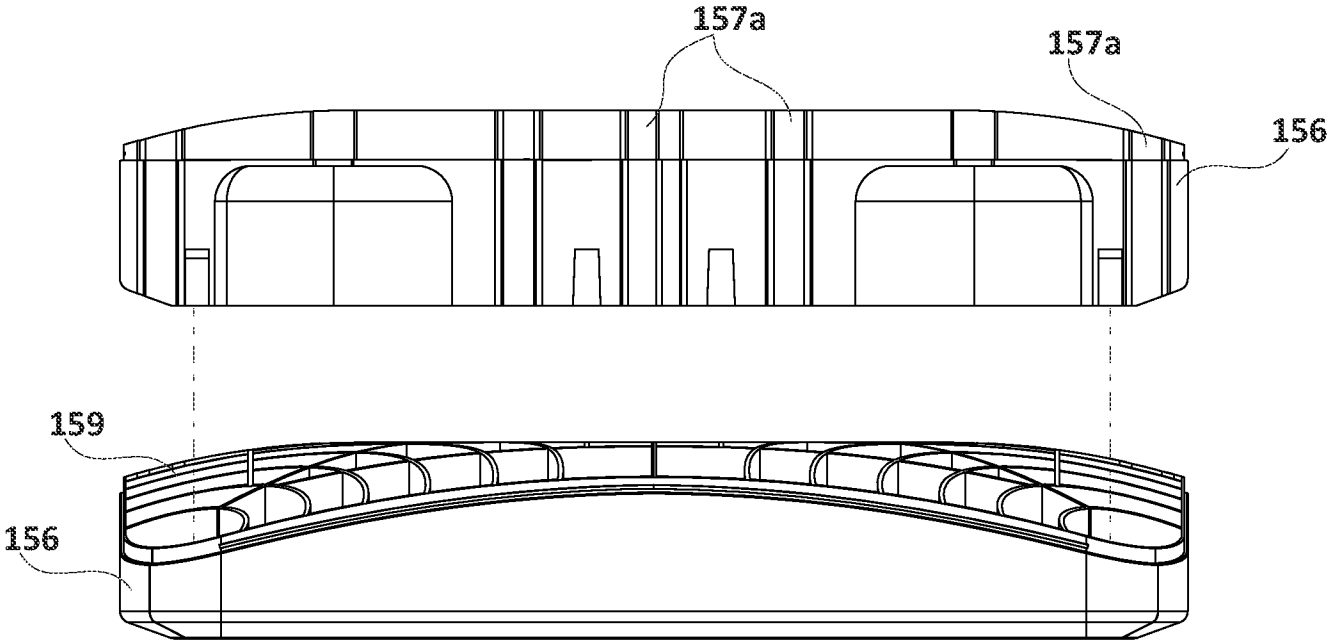
Figure 153:
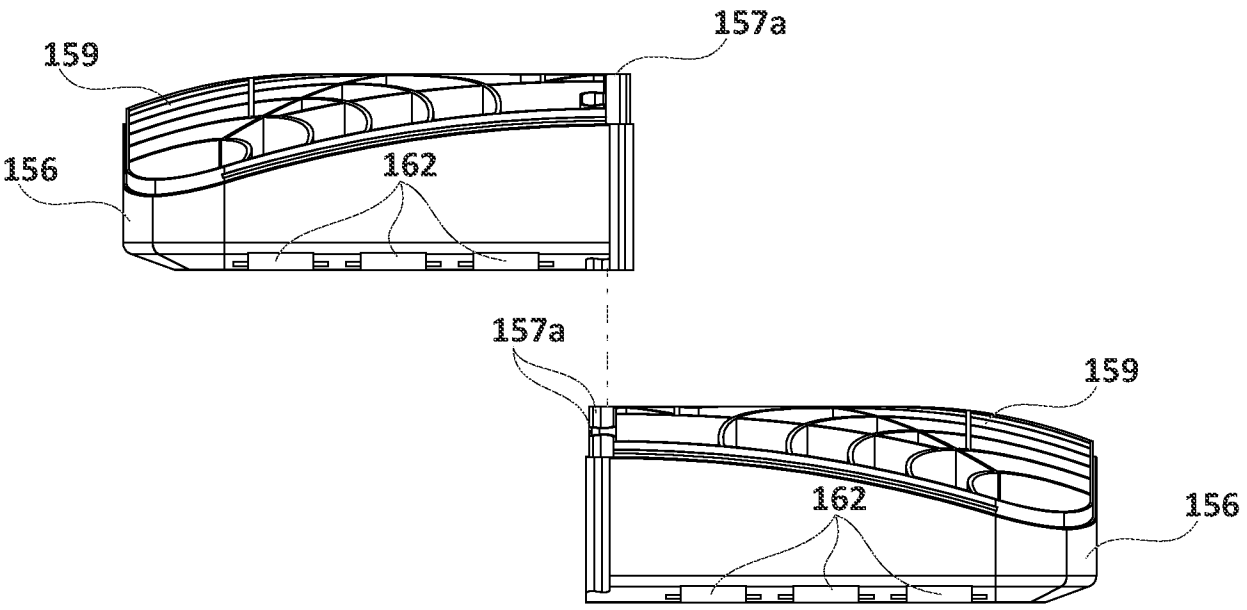
Figure 154:
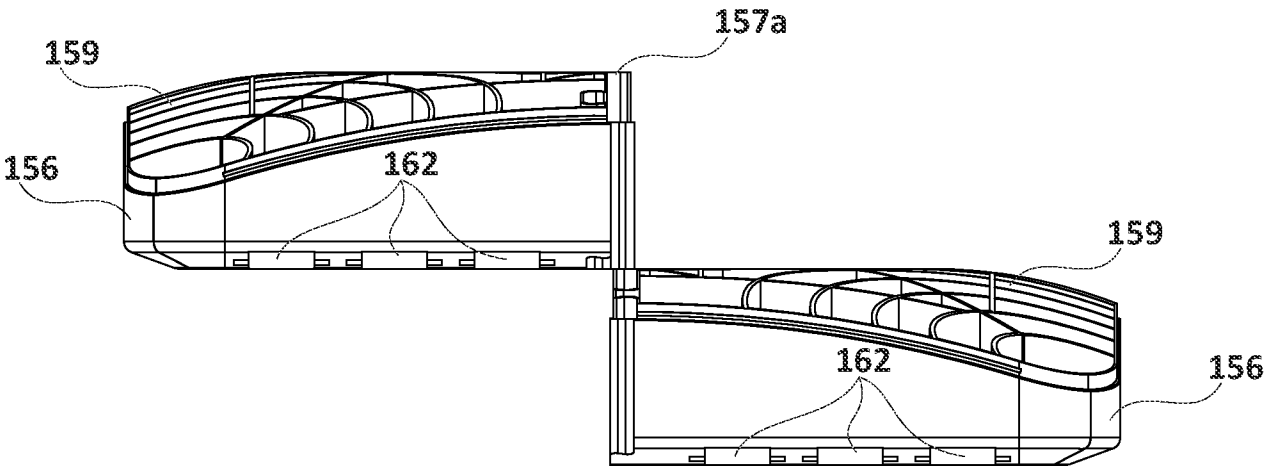
Figure 155:
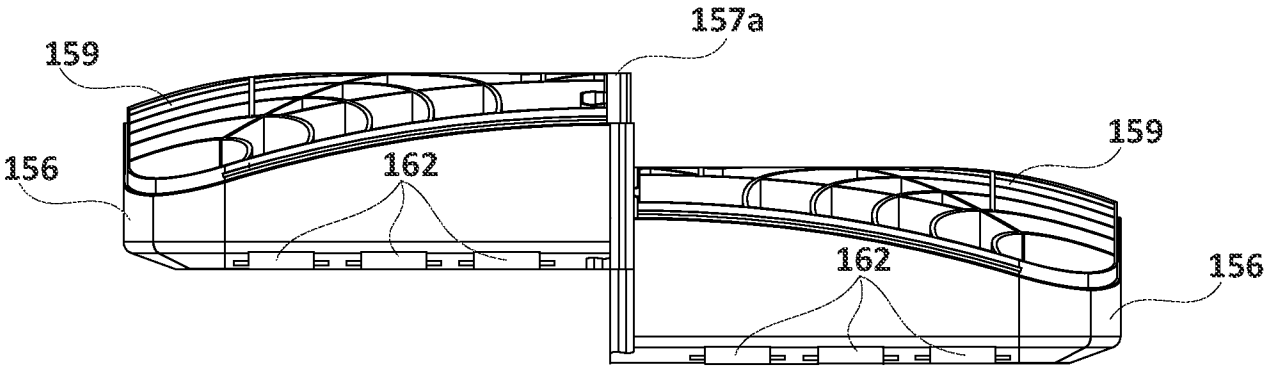
Figure 156:
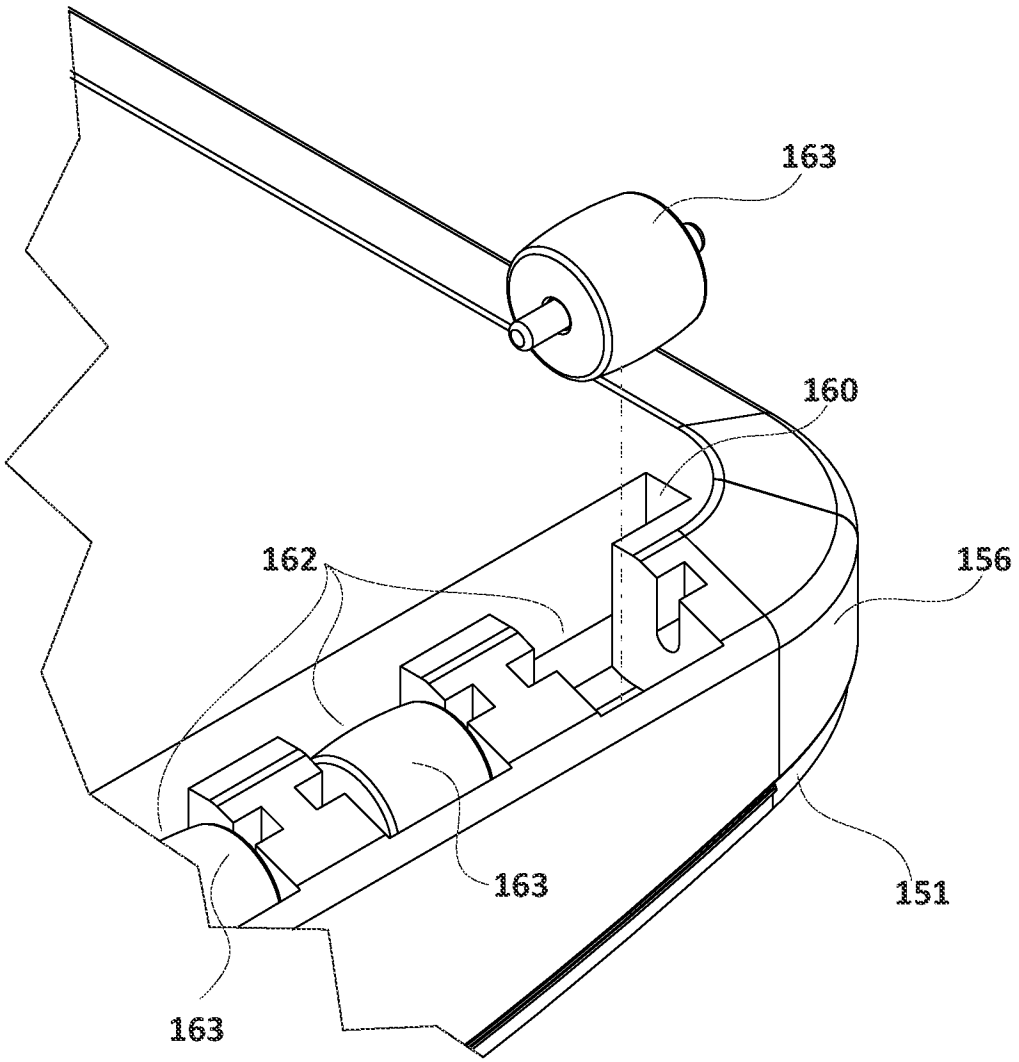
Figure 157:
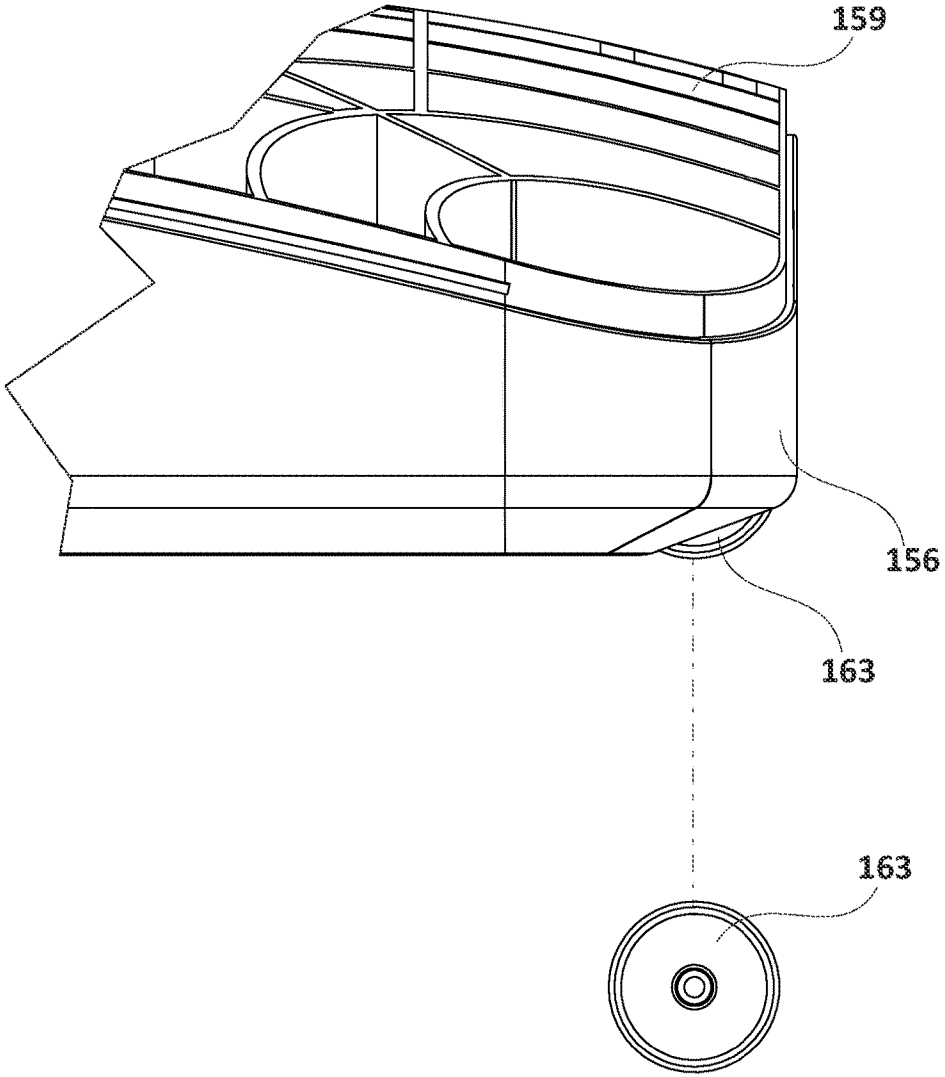
Figure 158:
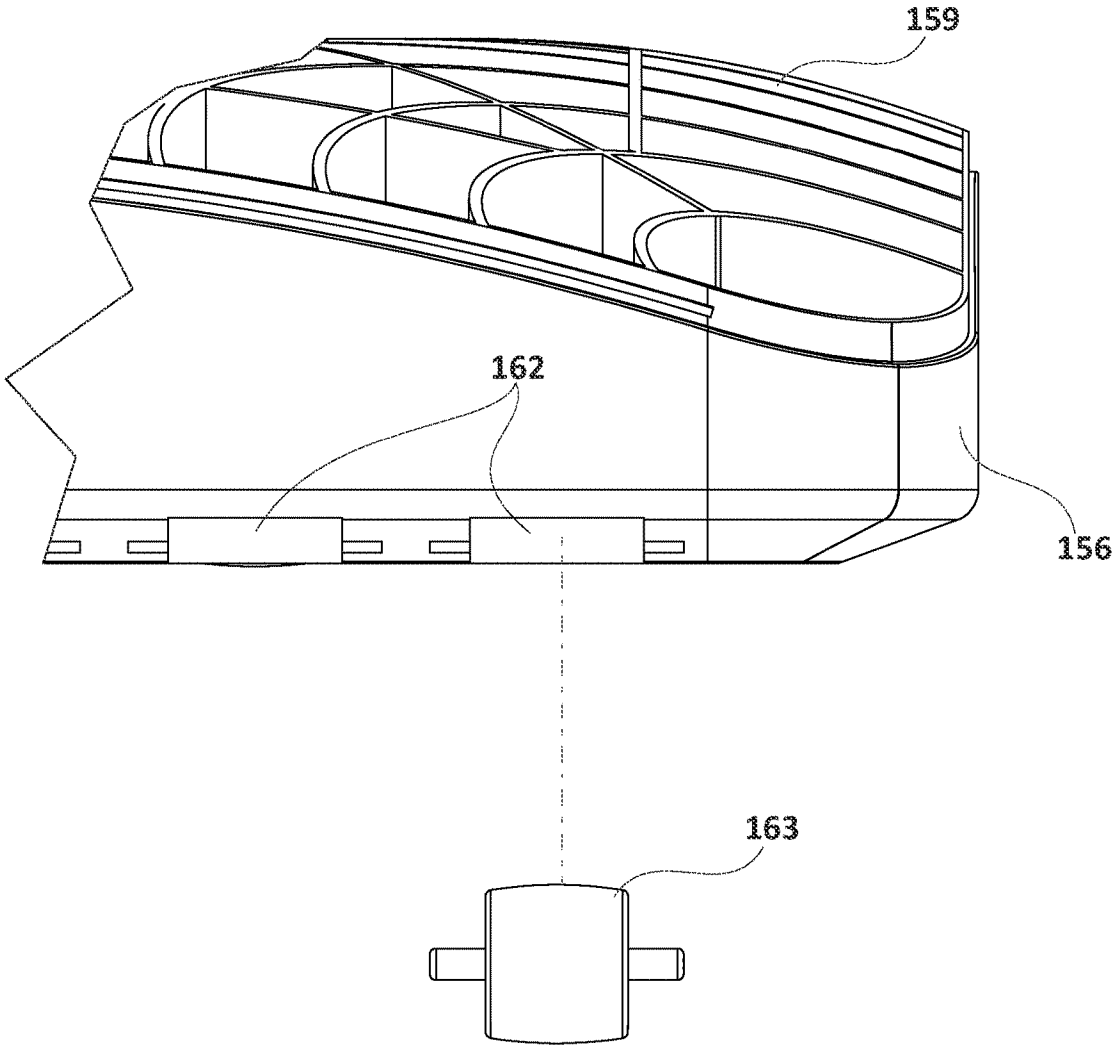
Figure 159:
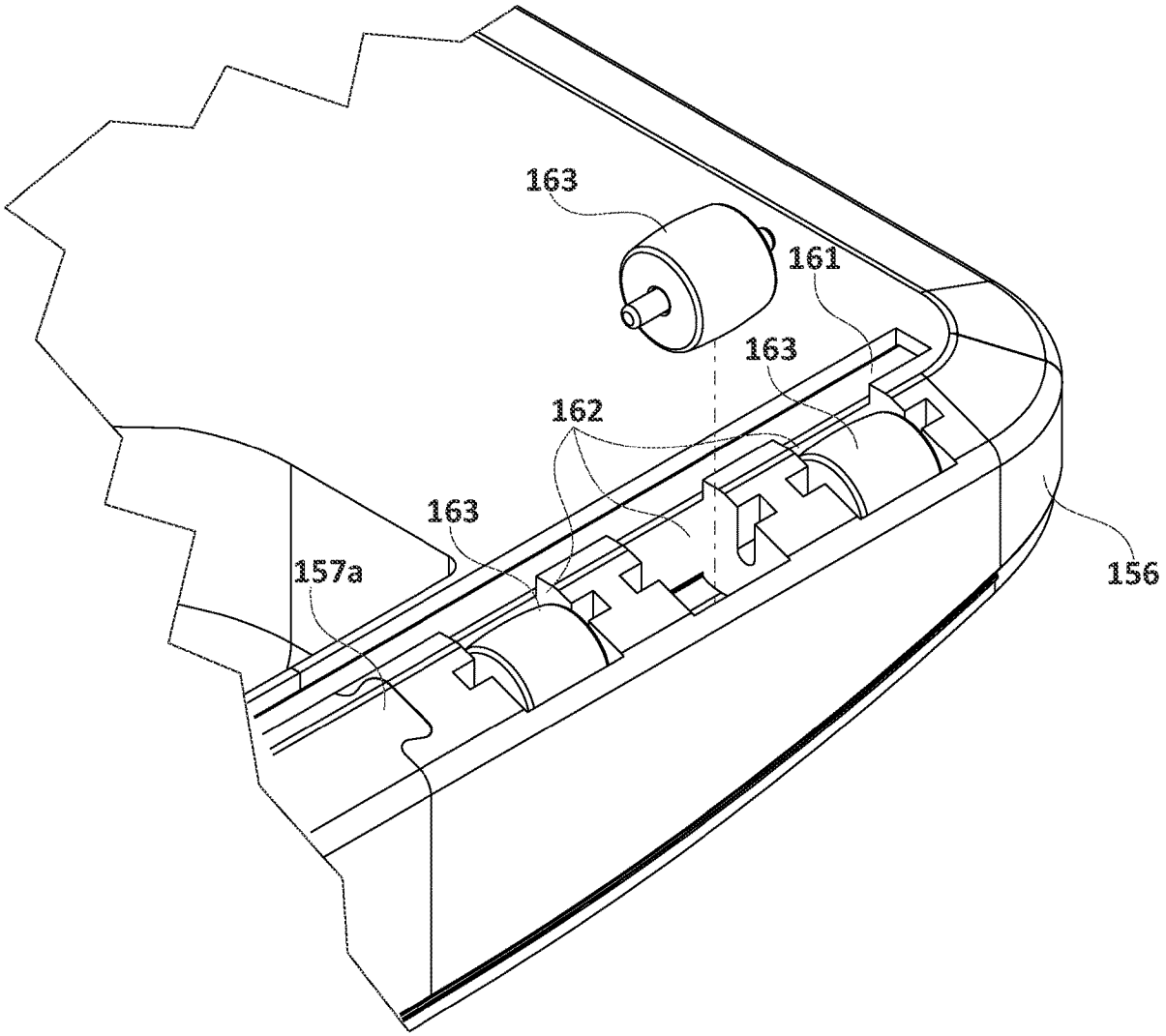
Figure 160:
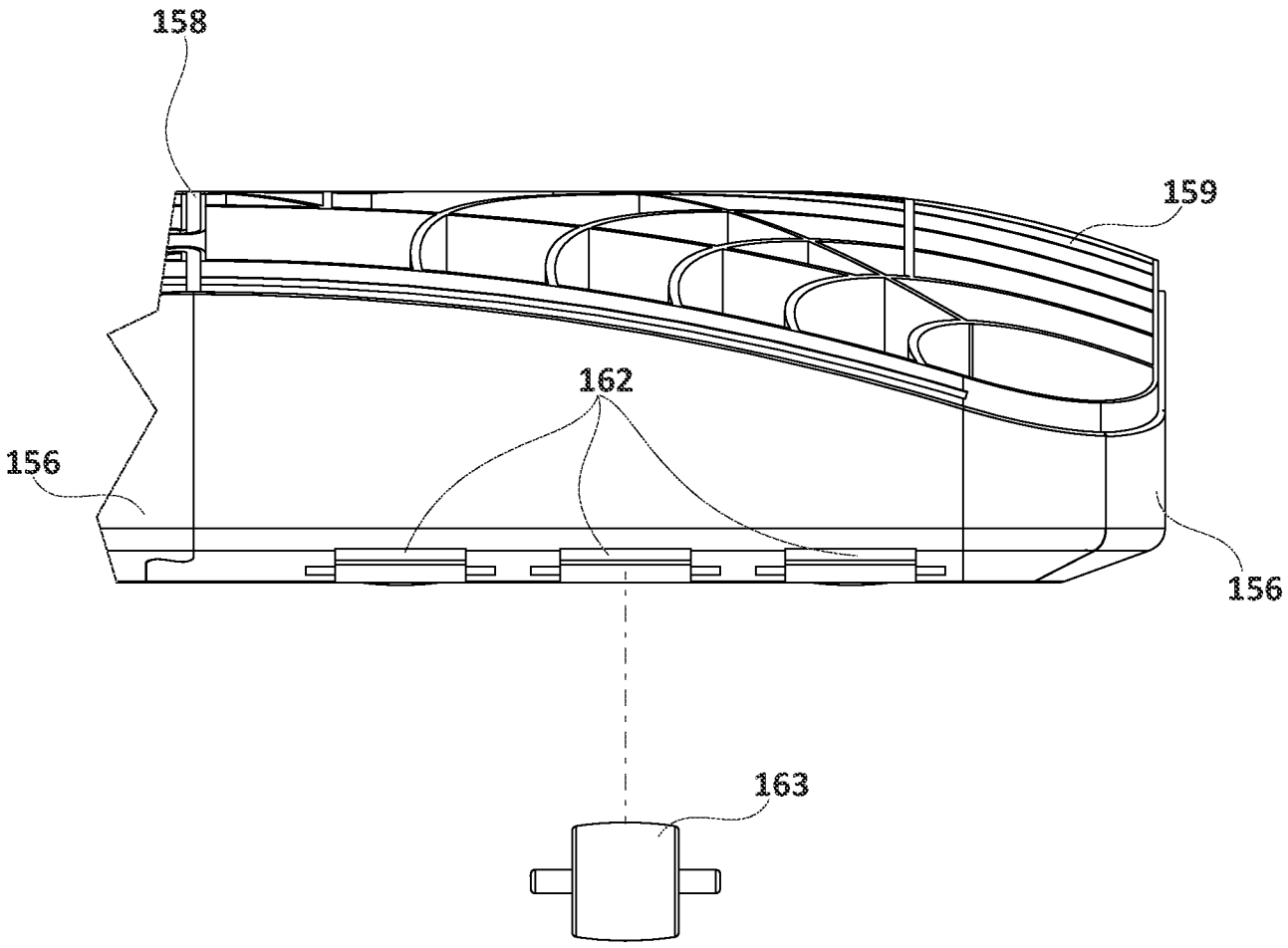
Figure 161:
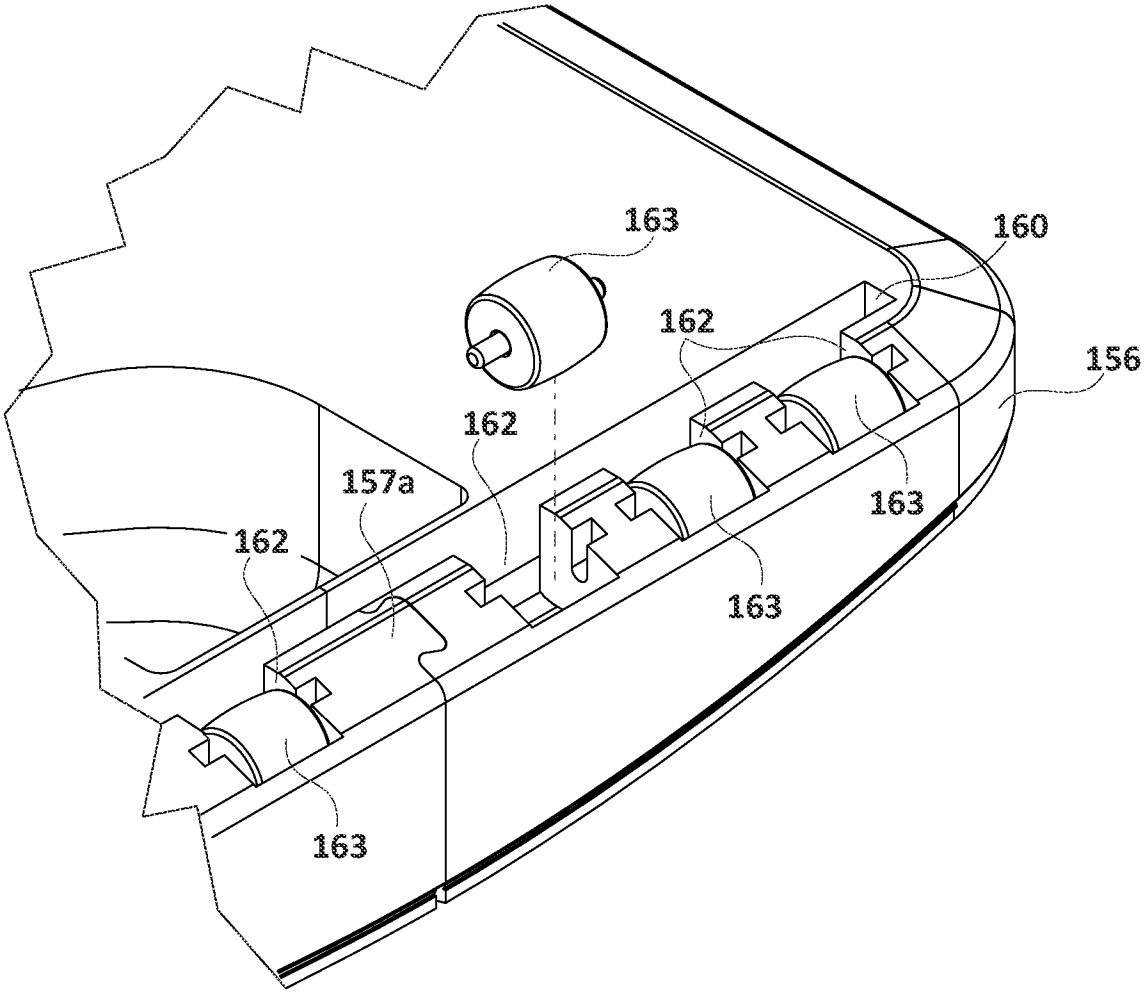
Figure 162:
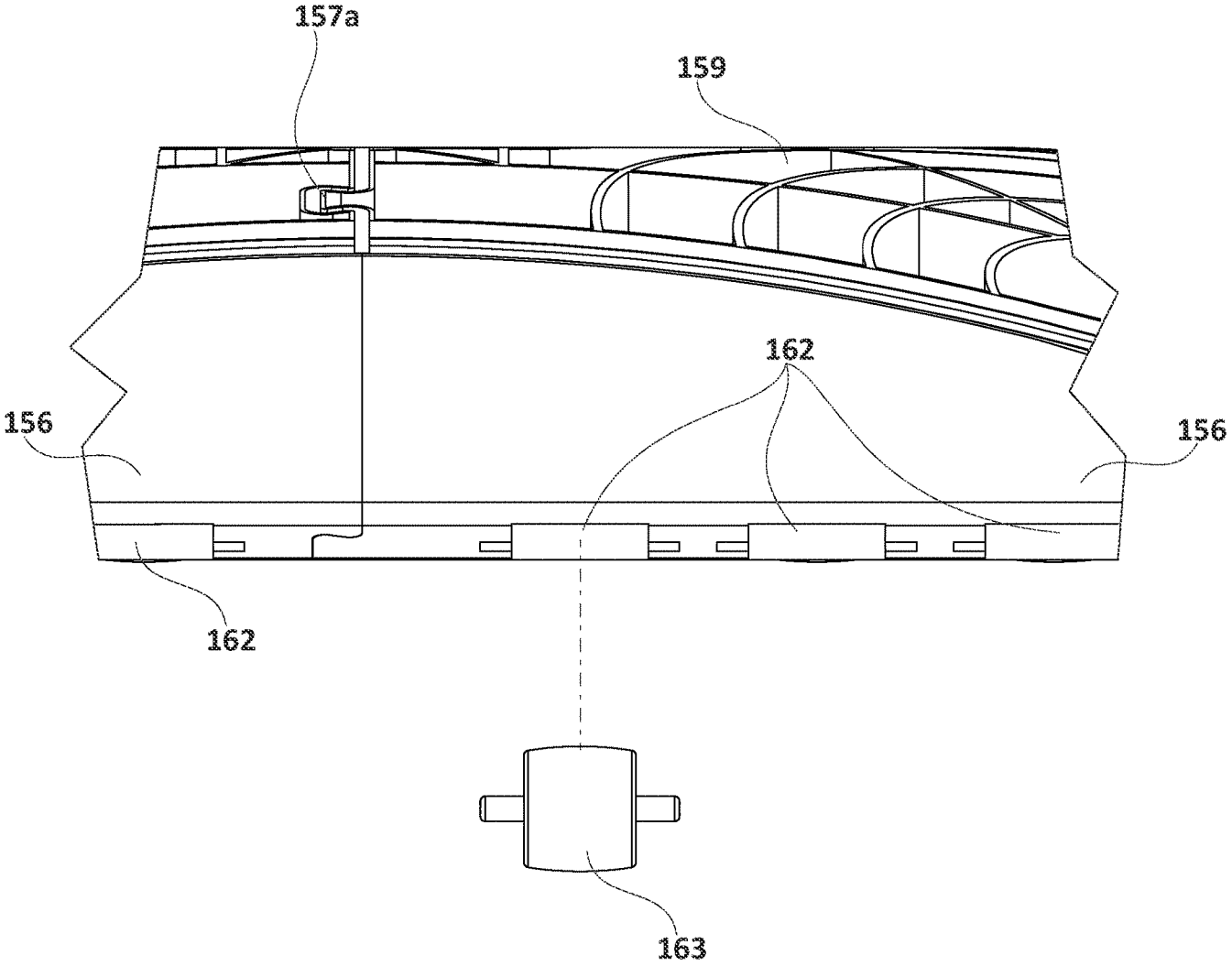
Figure 163:
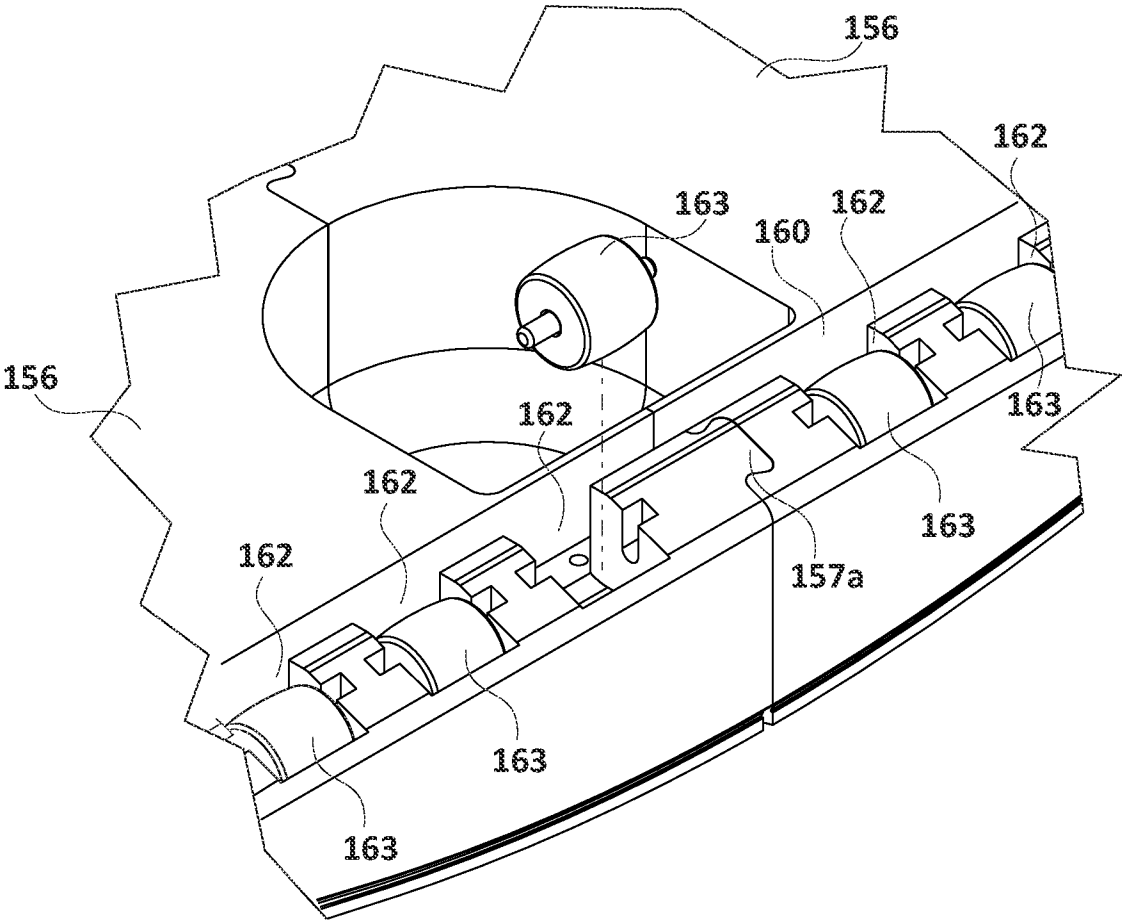
Figure 164:
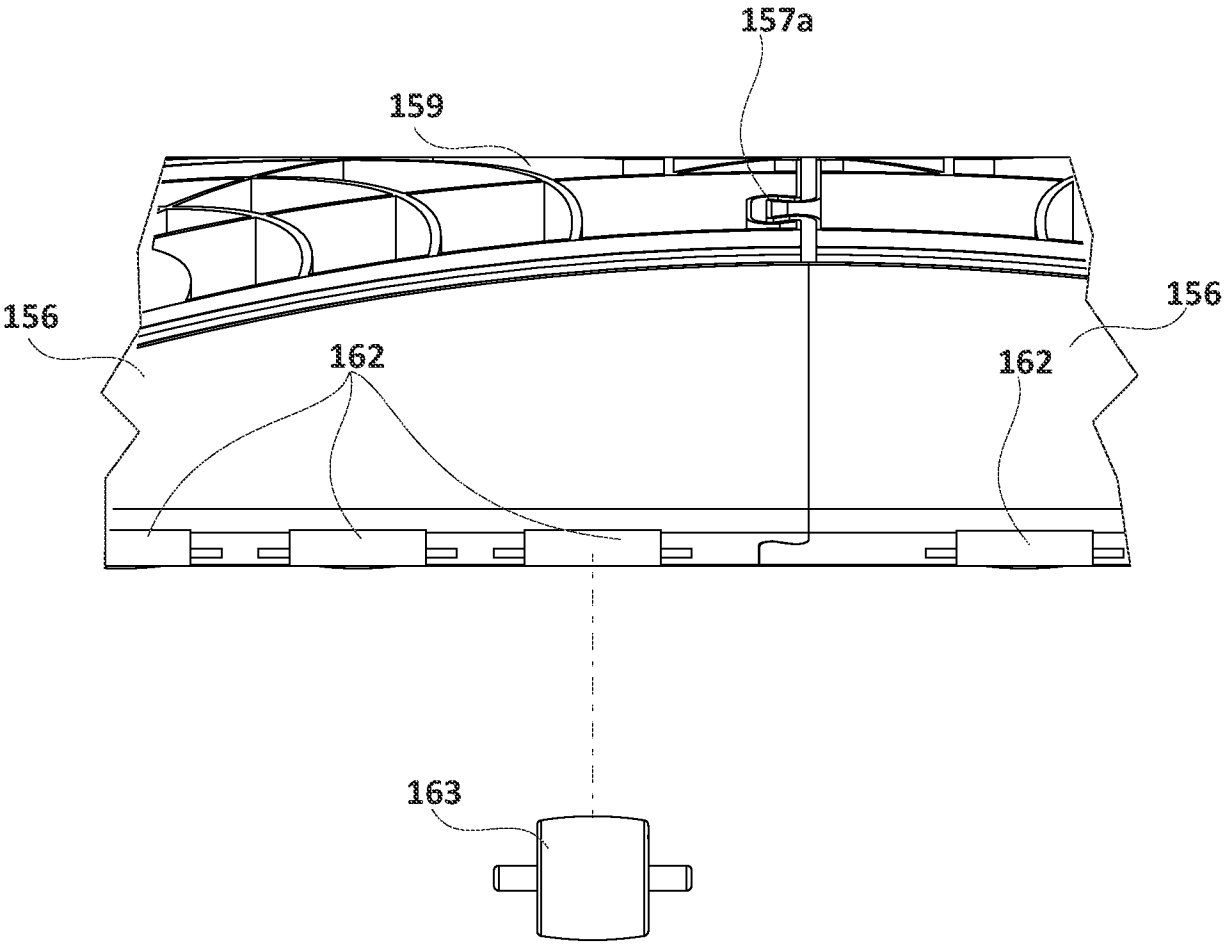
Figure 165:
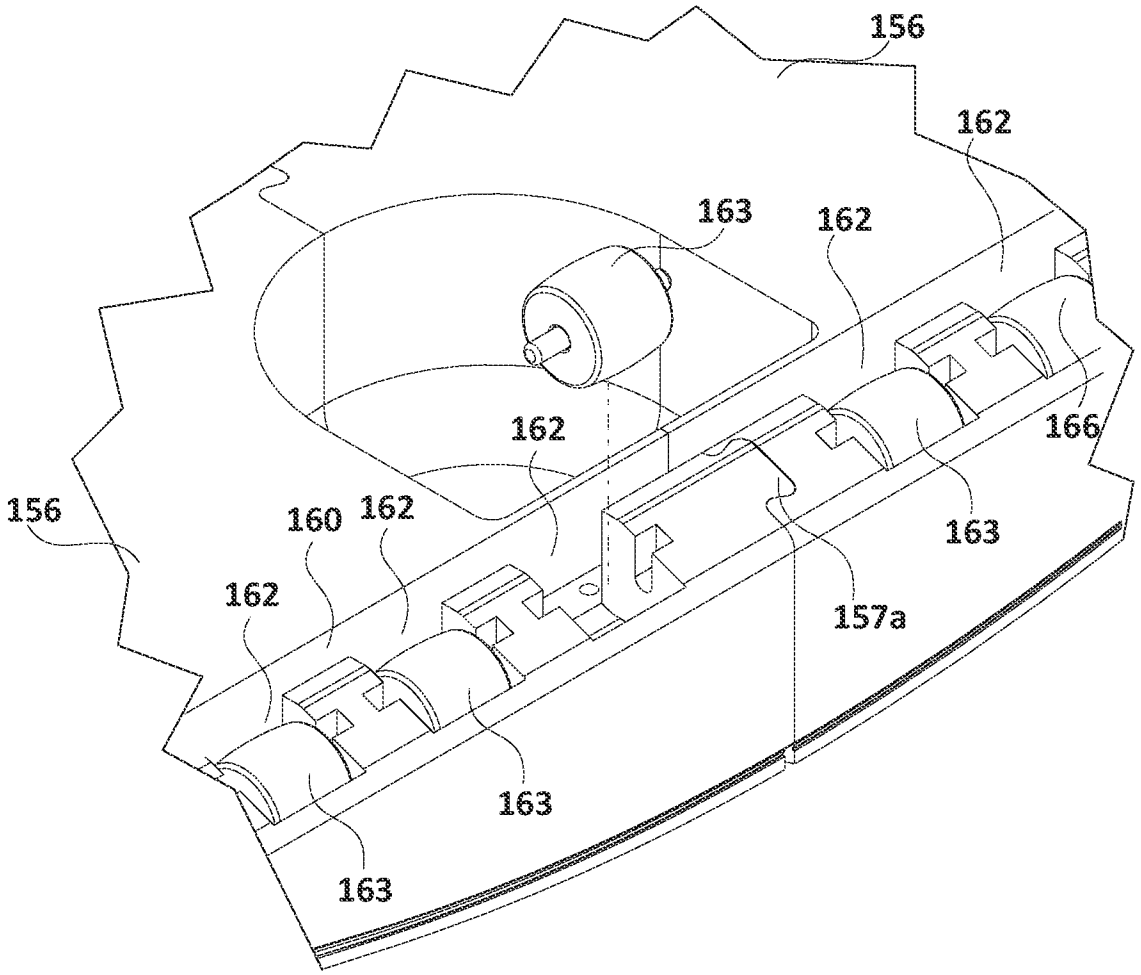
Figure 166:
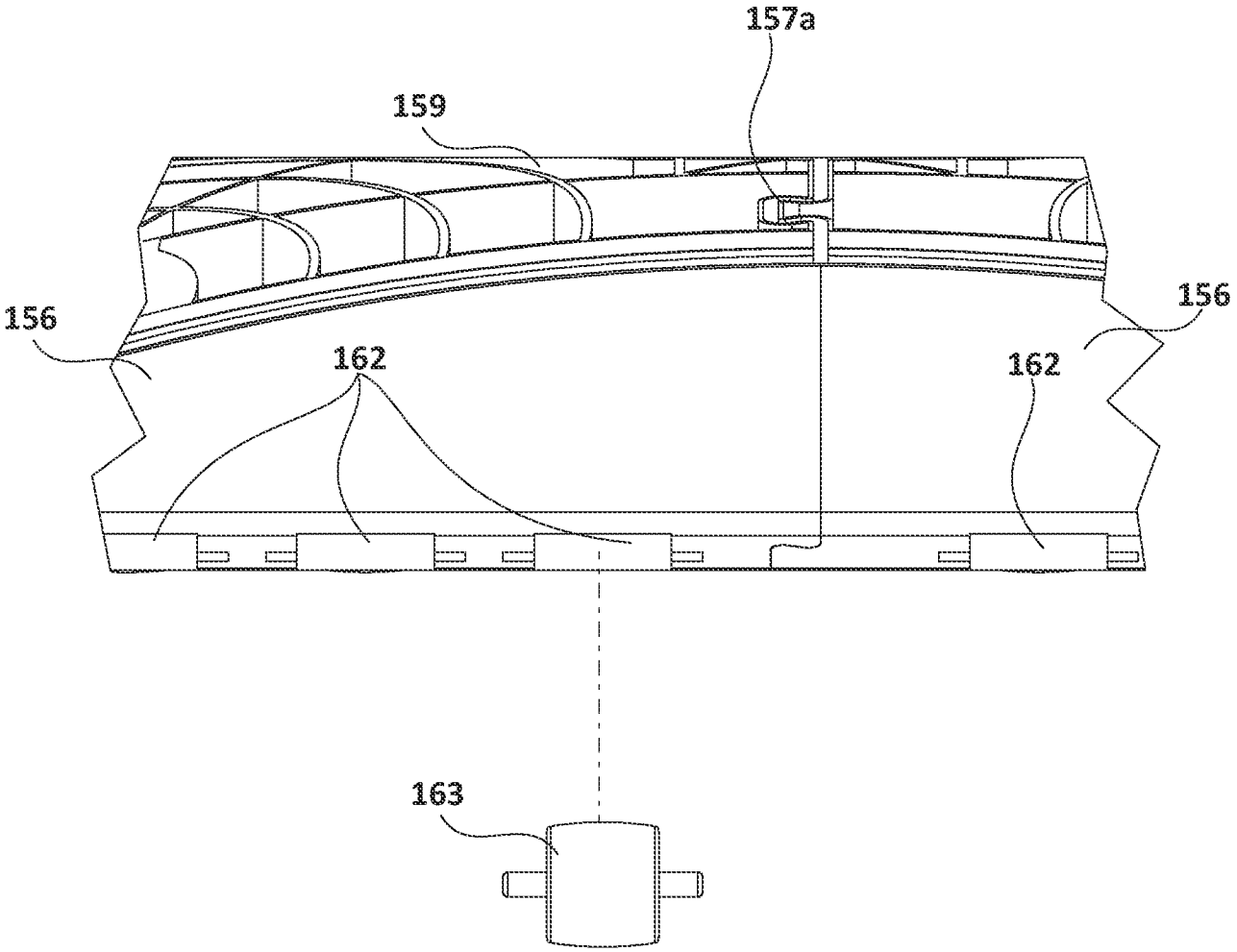
Figure 167:
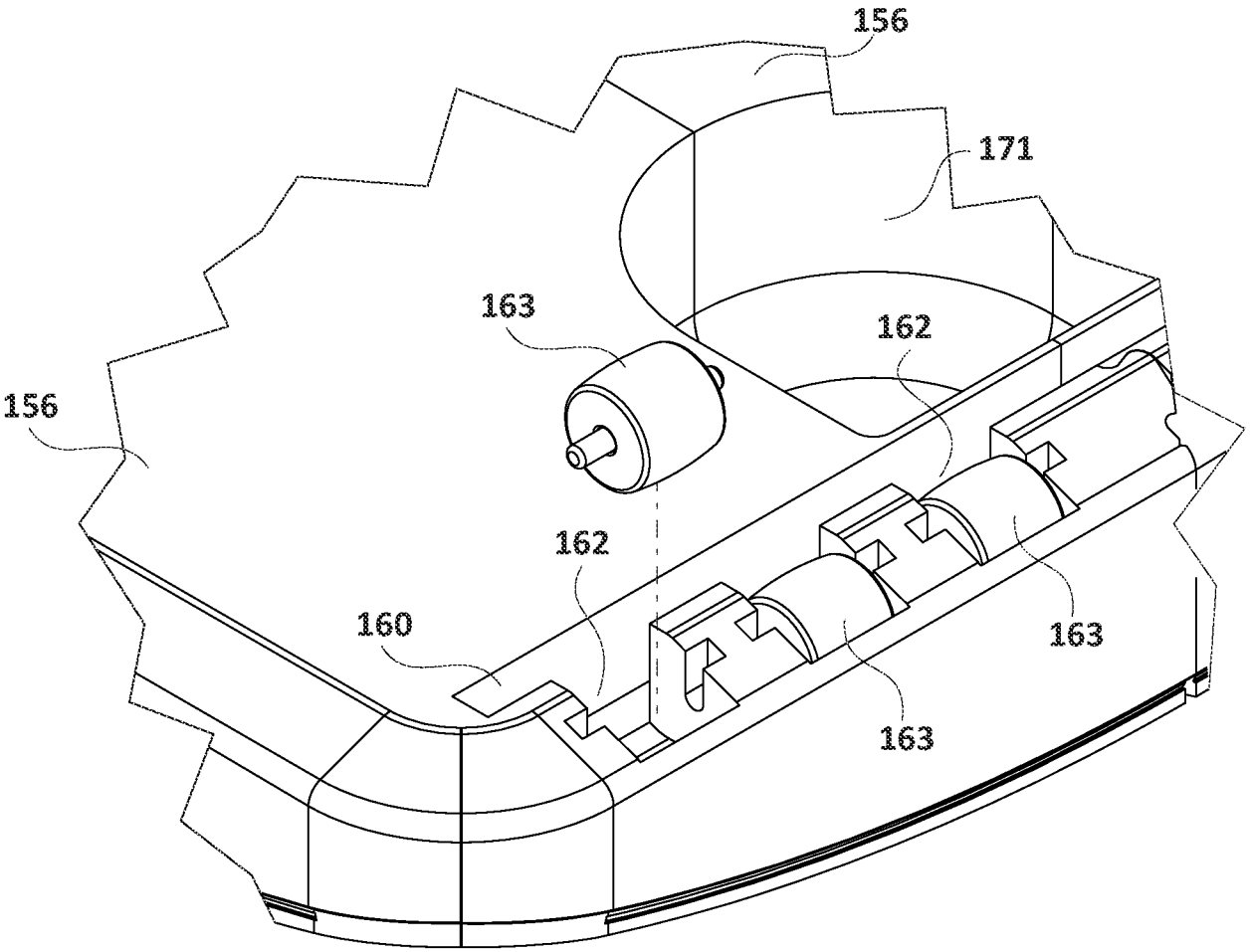
Figure 168:
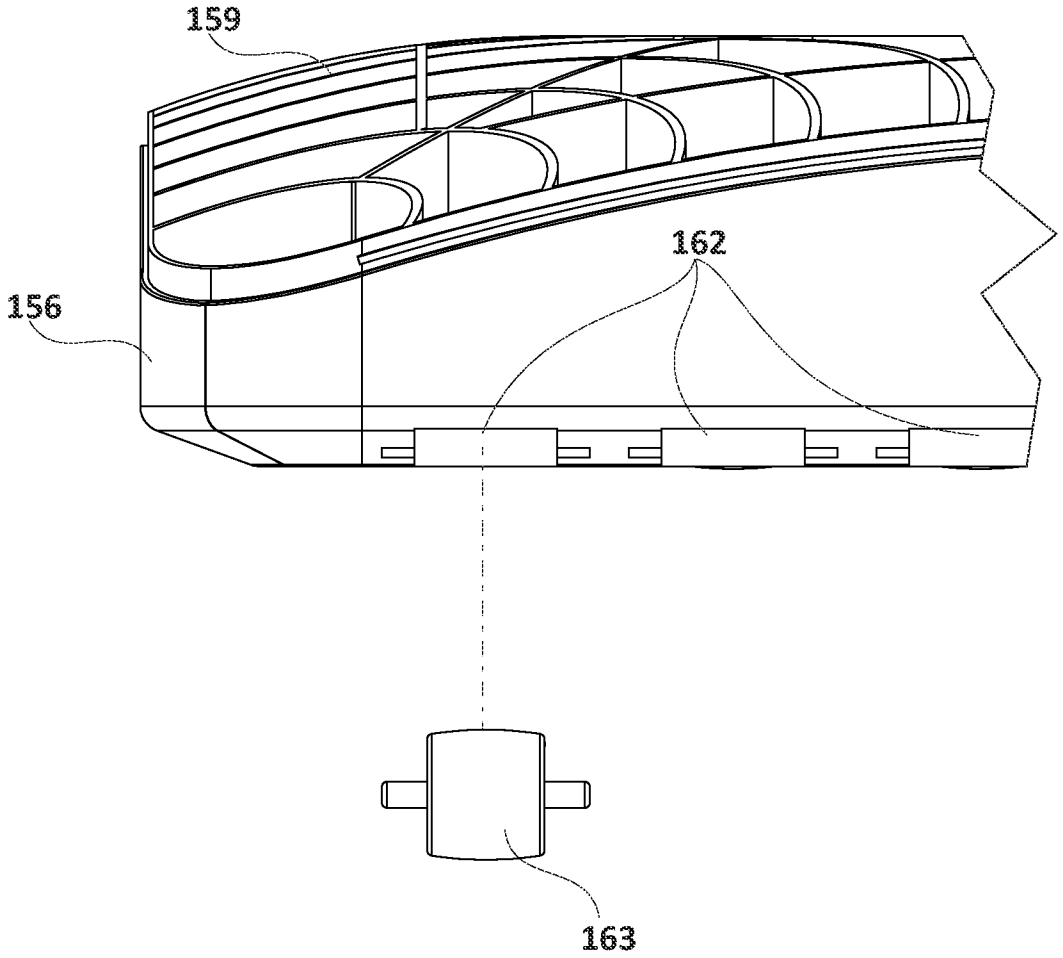
Figure 169:
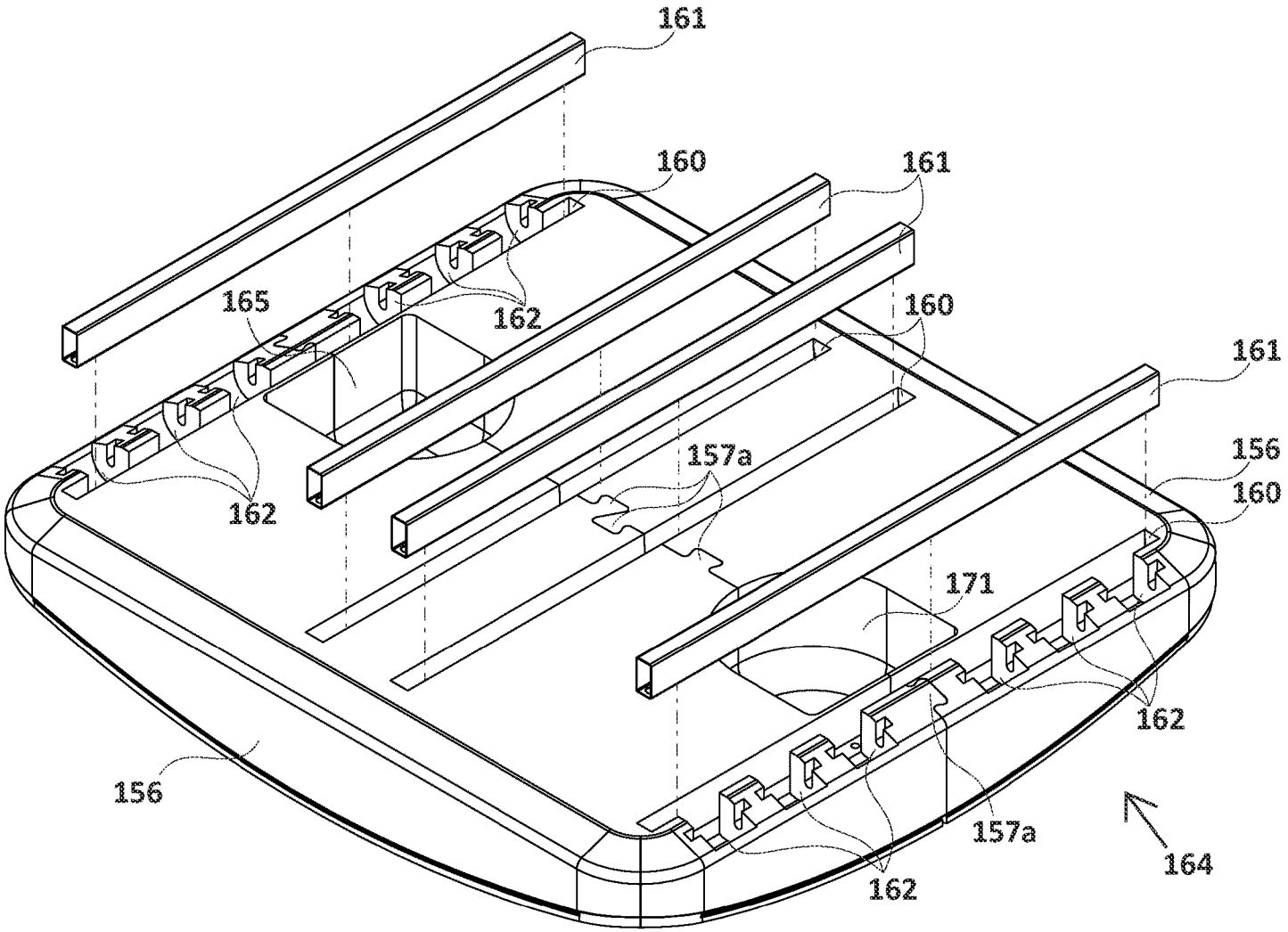
Figure 170:
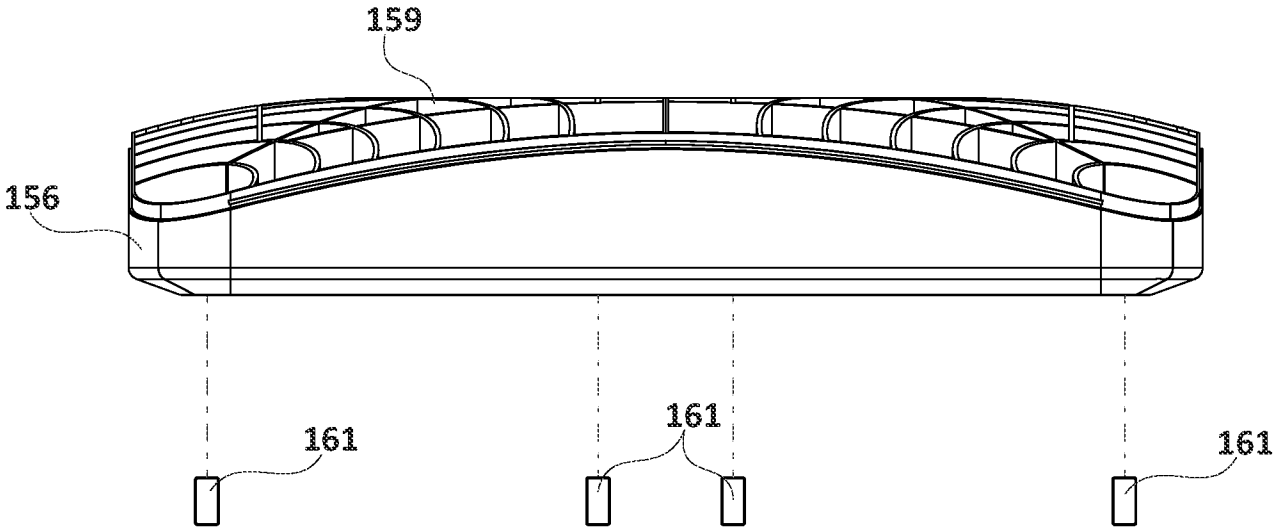
Figure 171:
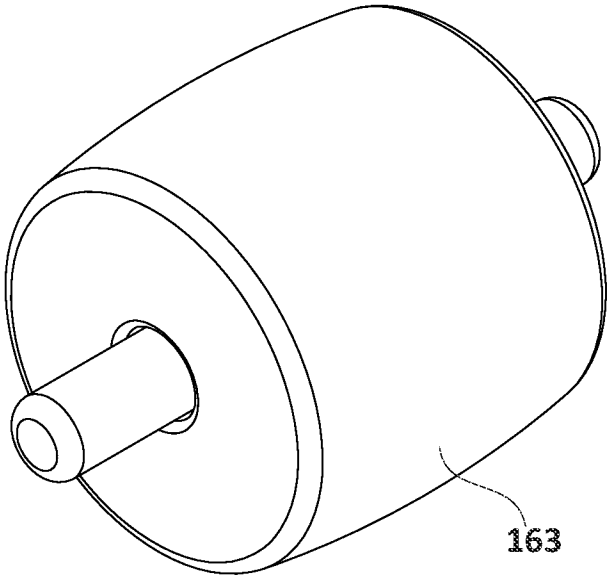
Figure 172:
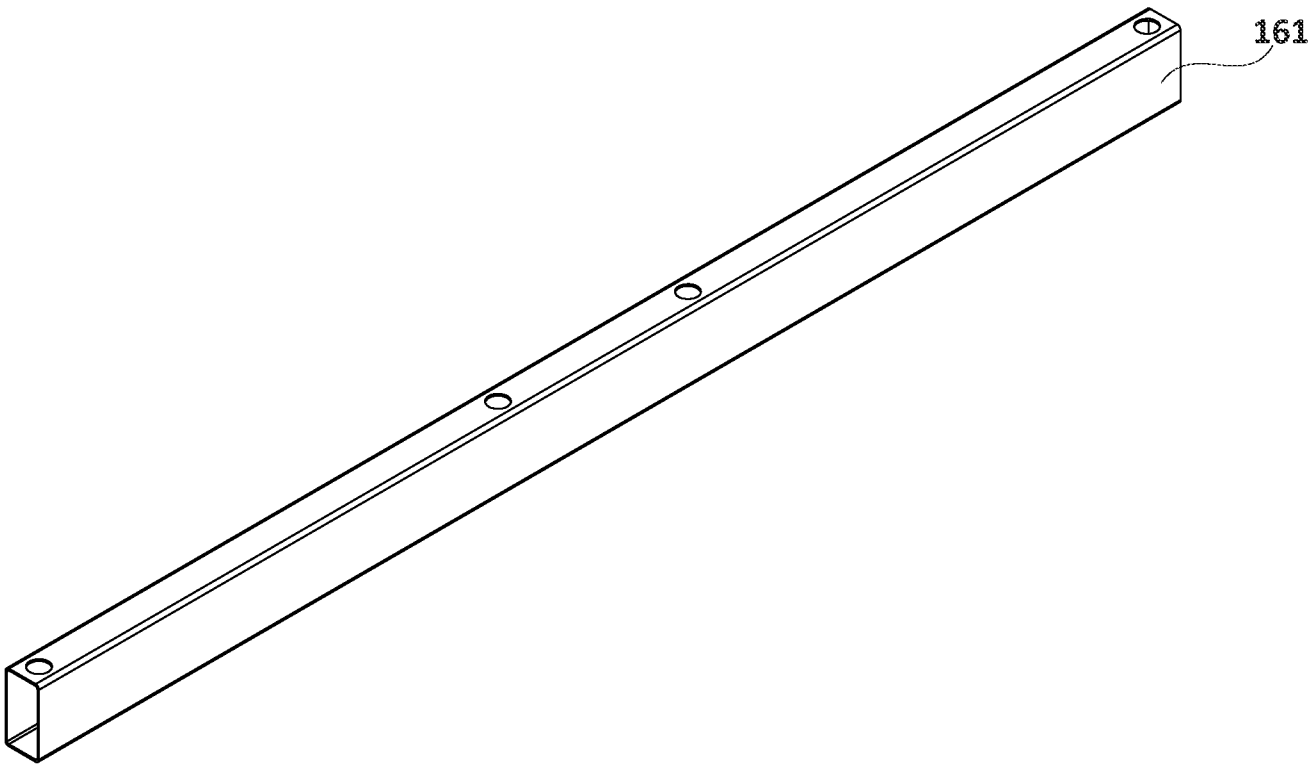
Figure 173:
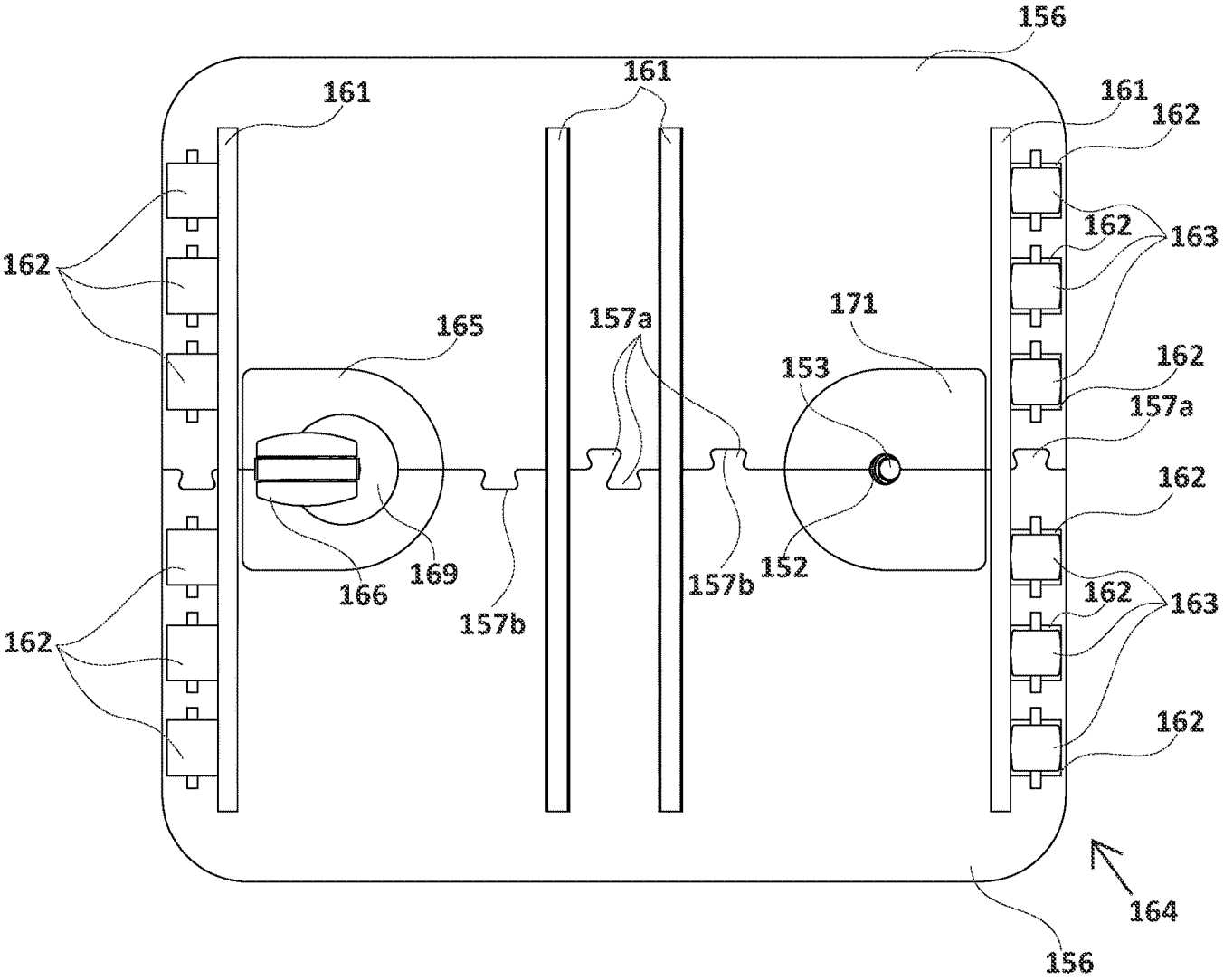
FIG. 173-FIG. 184 are diagrams illustrating perspective, bottom, and side views demonstrating the components of adjustable-hidable angle-operated caster system 164.
Figure 174:
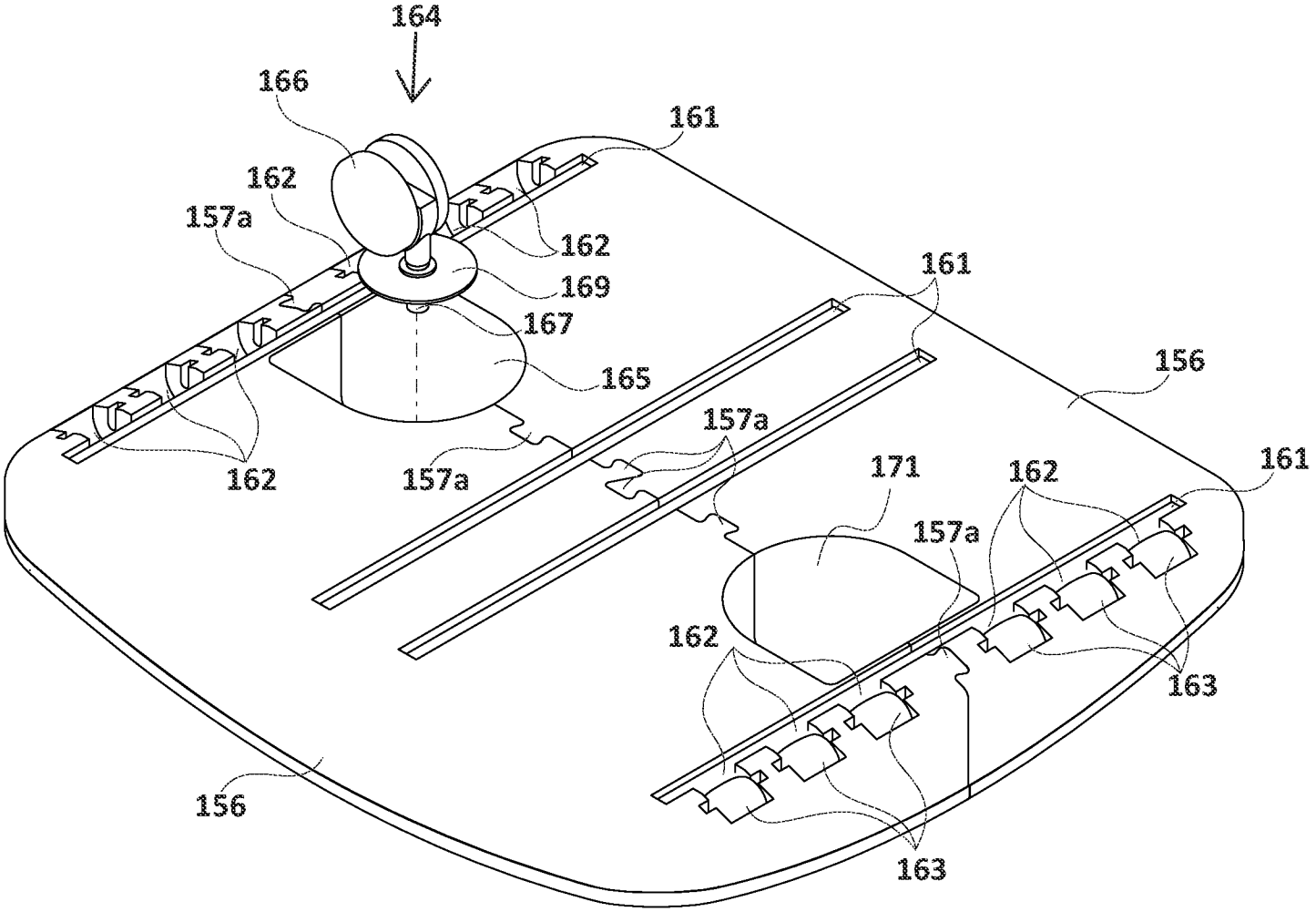
Figure 175:
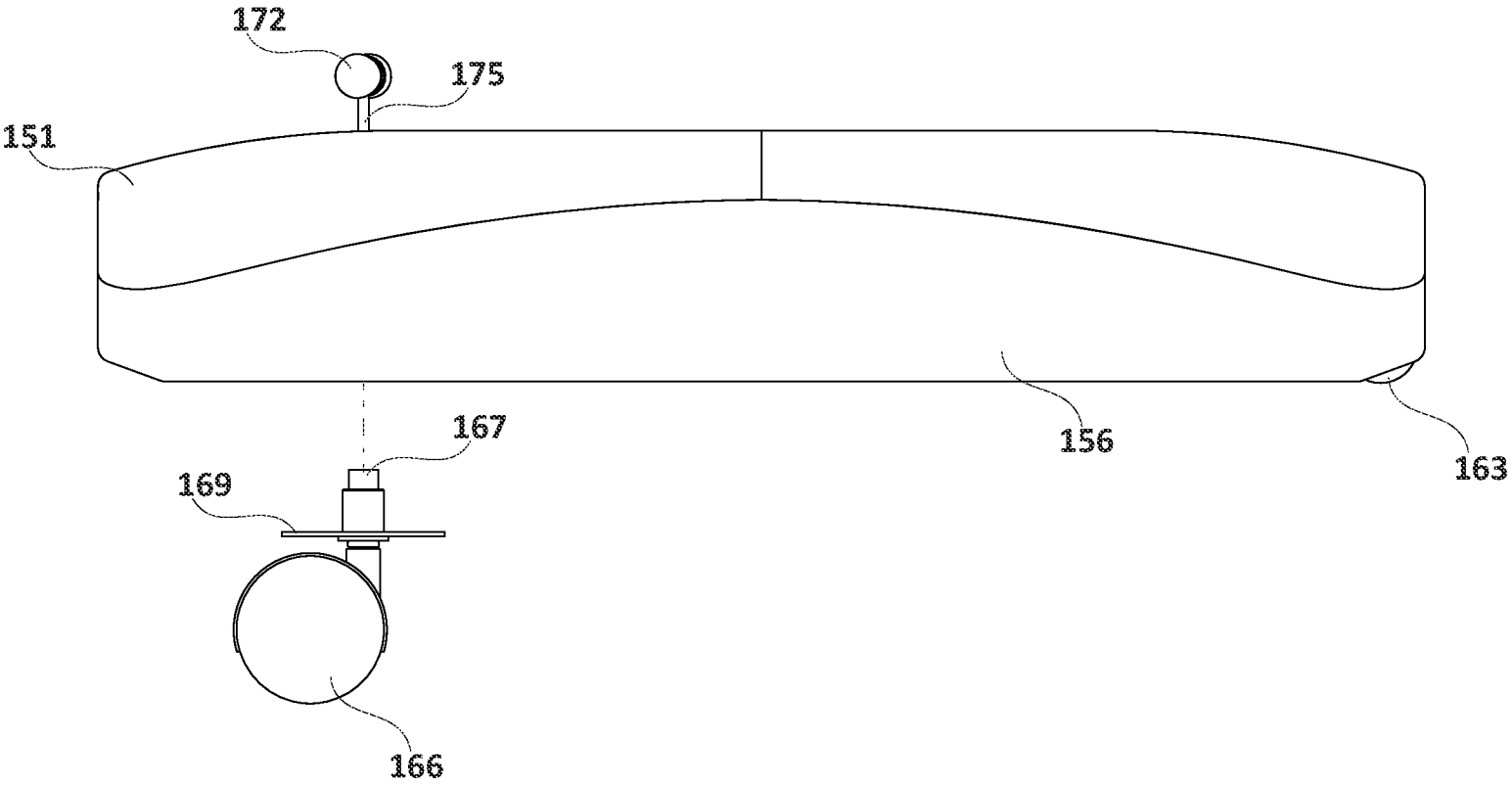
Figure 176:
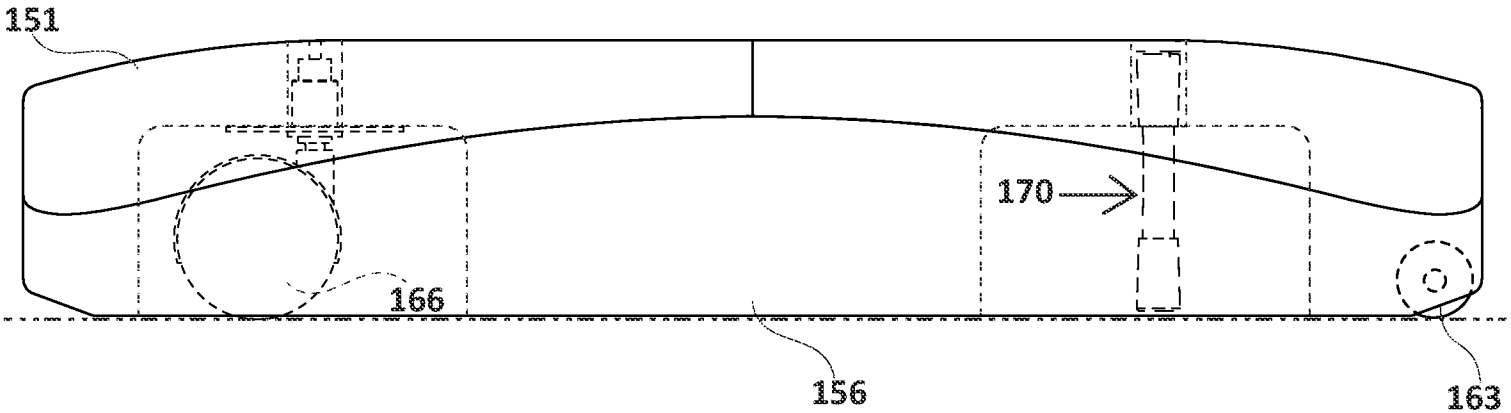
Figure 177:
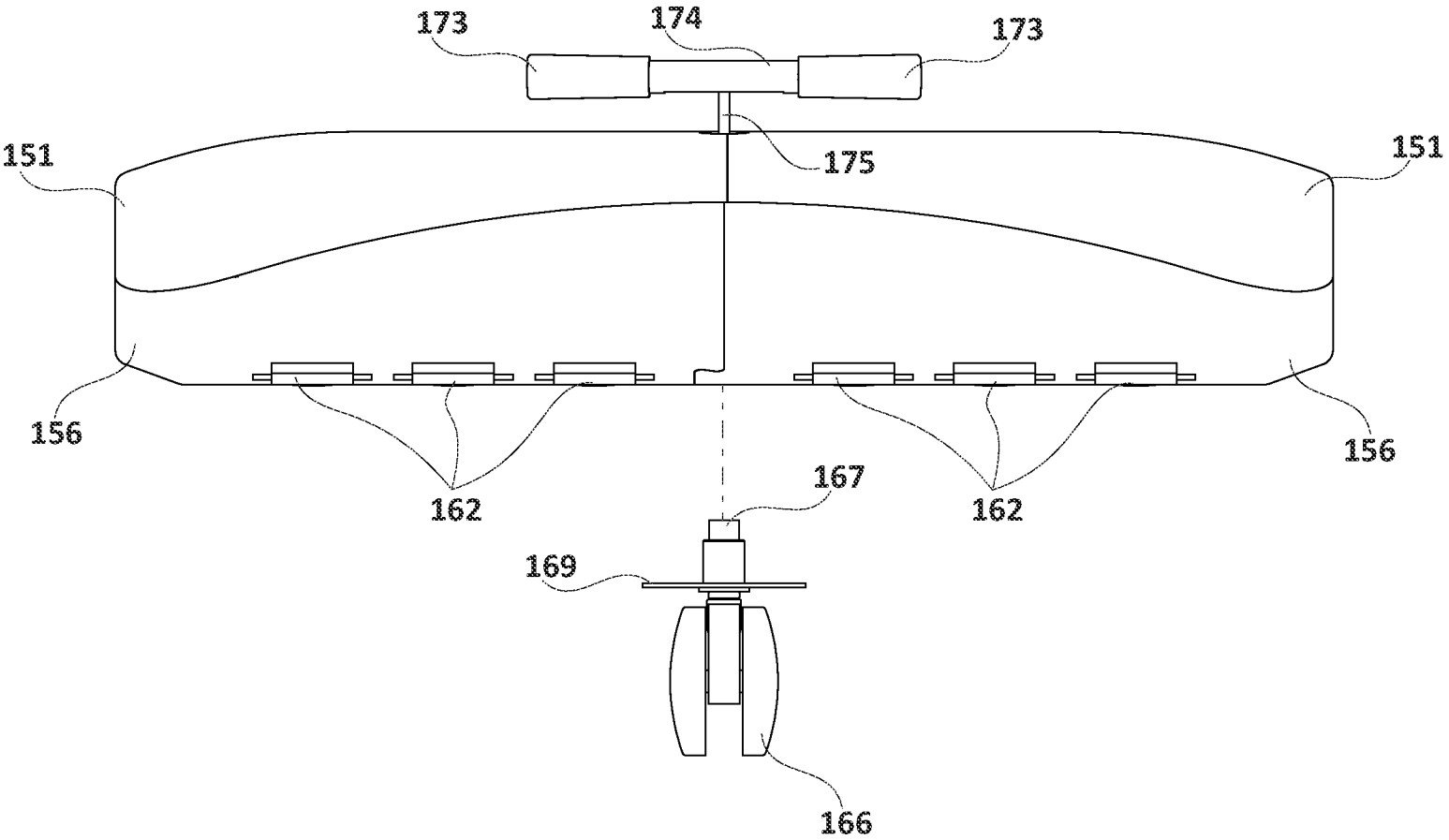
Figure 178:
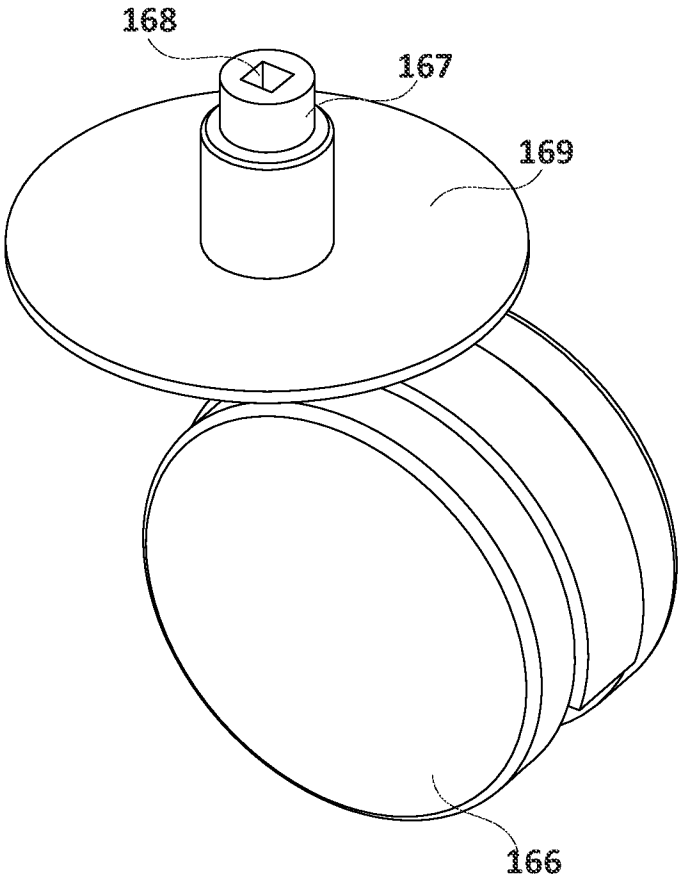
Figure 179:
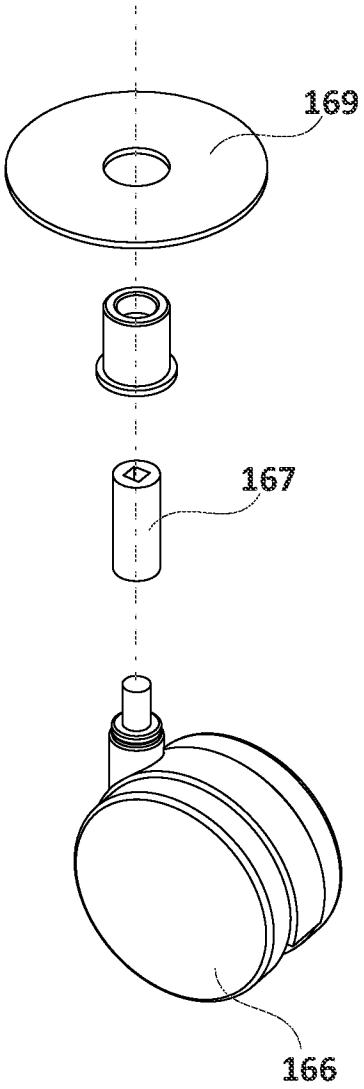
Figure 180:
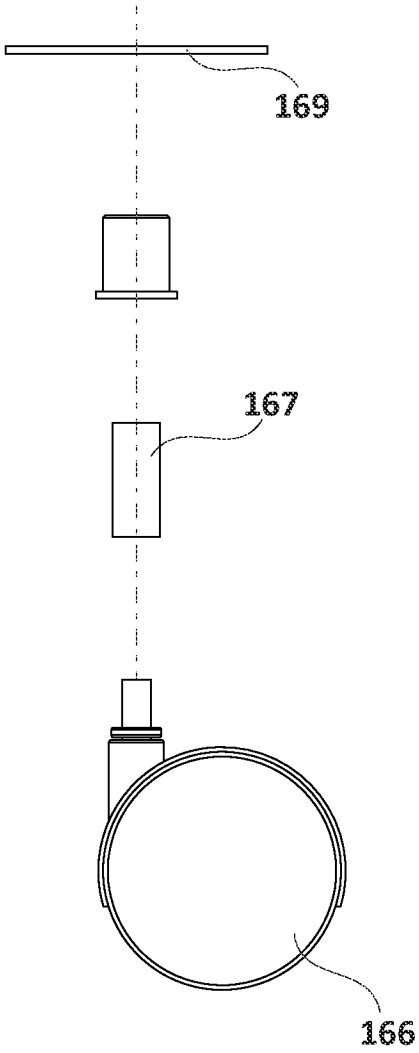
Figure 181:
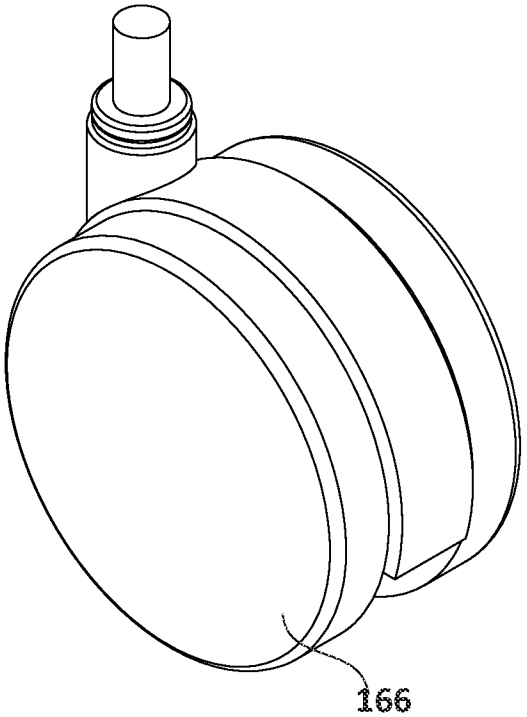
Figure 182:
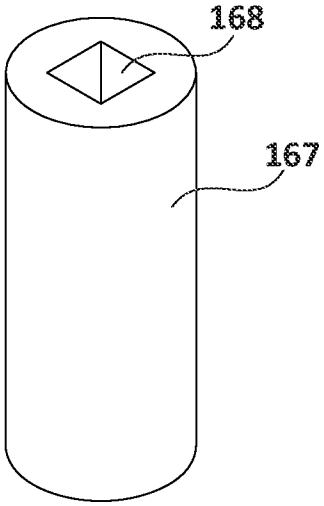
Figure 183:
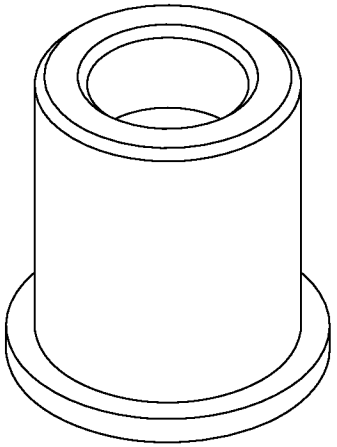
Figure 184:
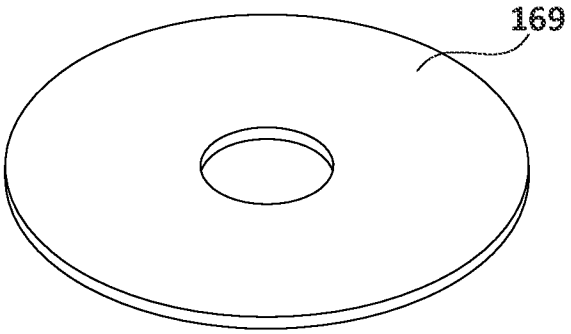
Figure 185:
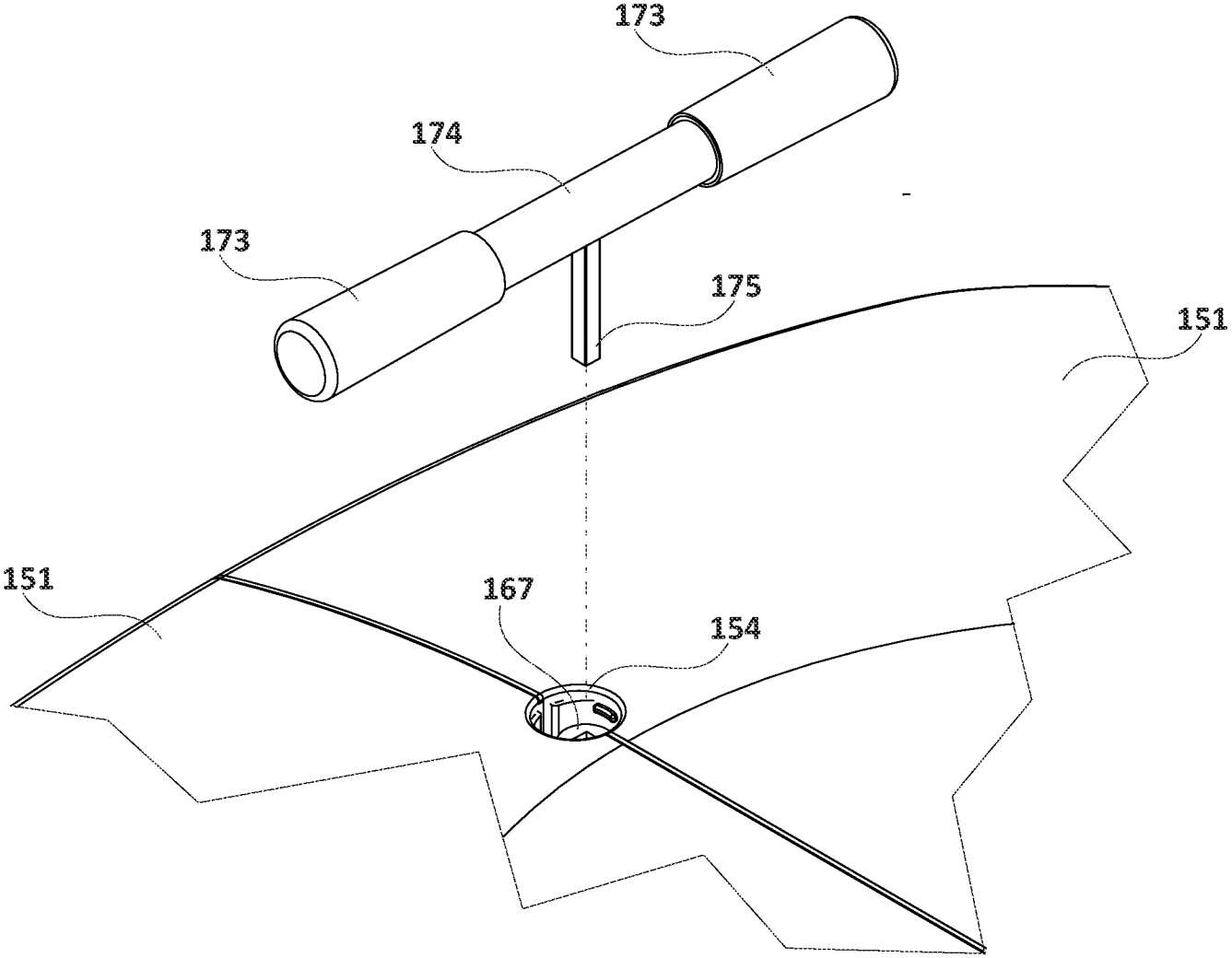
FIG. 185-FIG. 195 are diagrams illustrating perspective and side views demonstrating the components of deployable-hidable crank-and-bolt-lock system 170.
Figure 186:
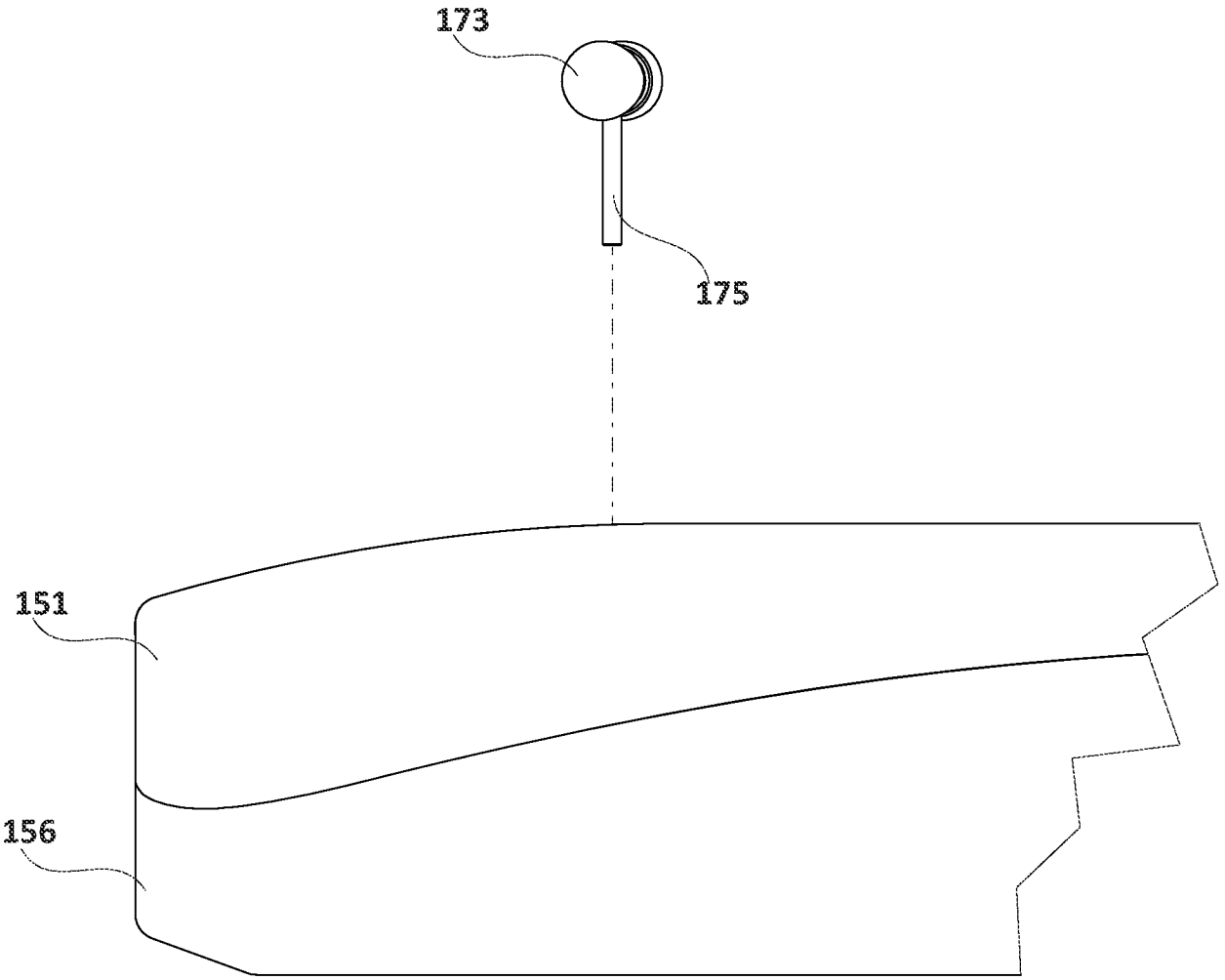
Figure 187:
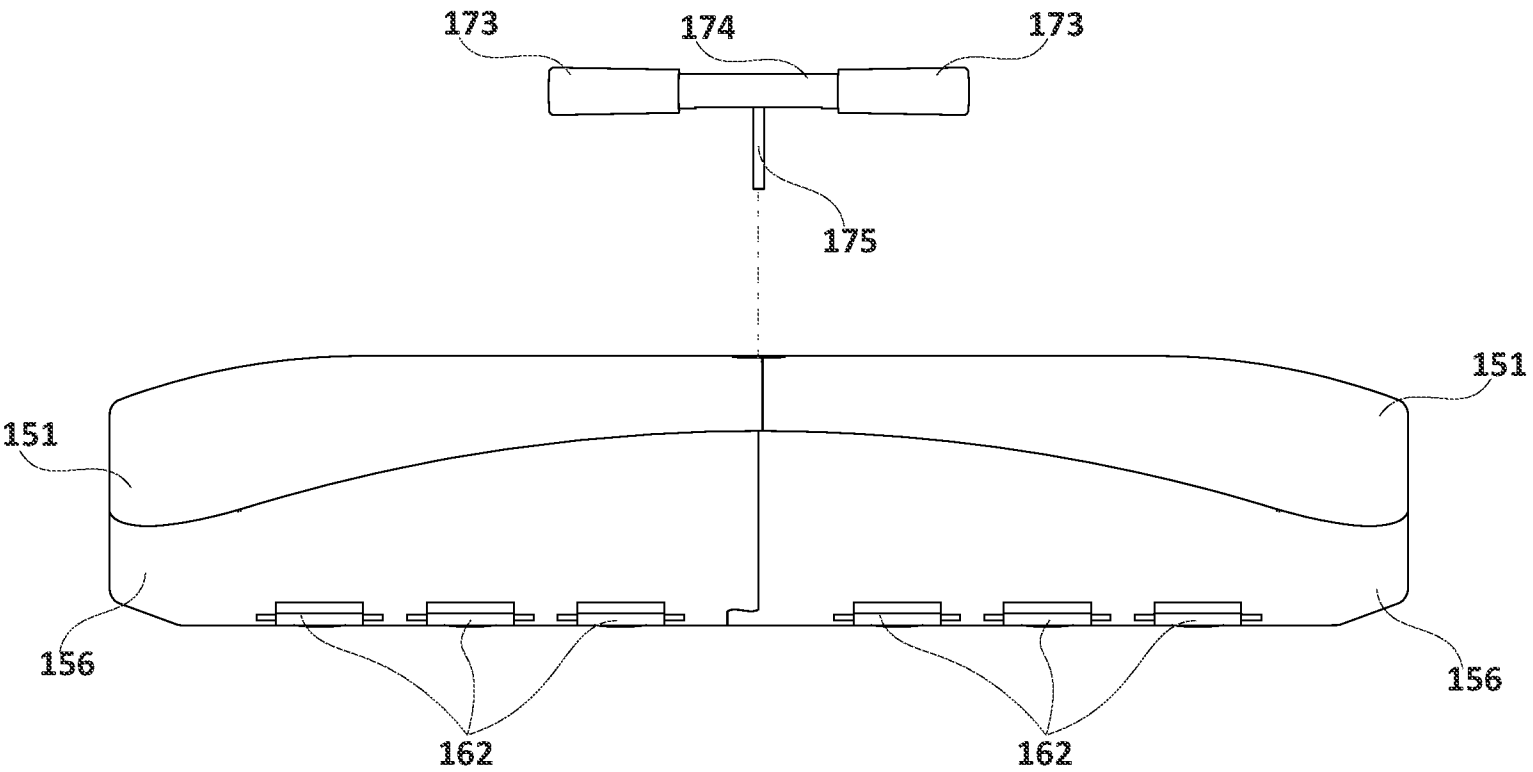
Figure 188:
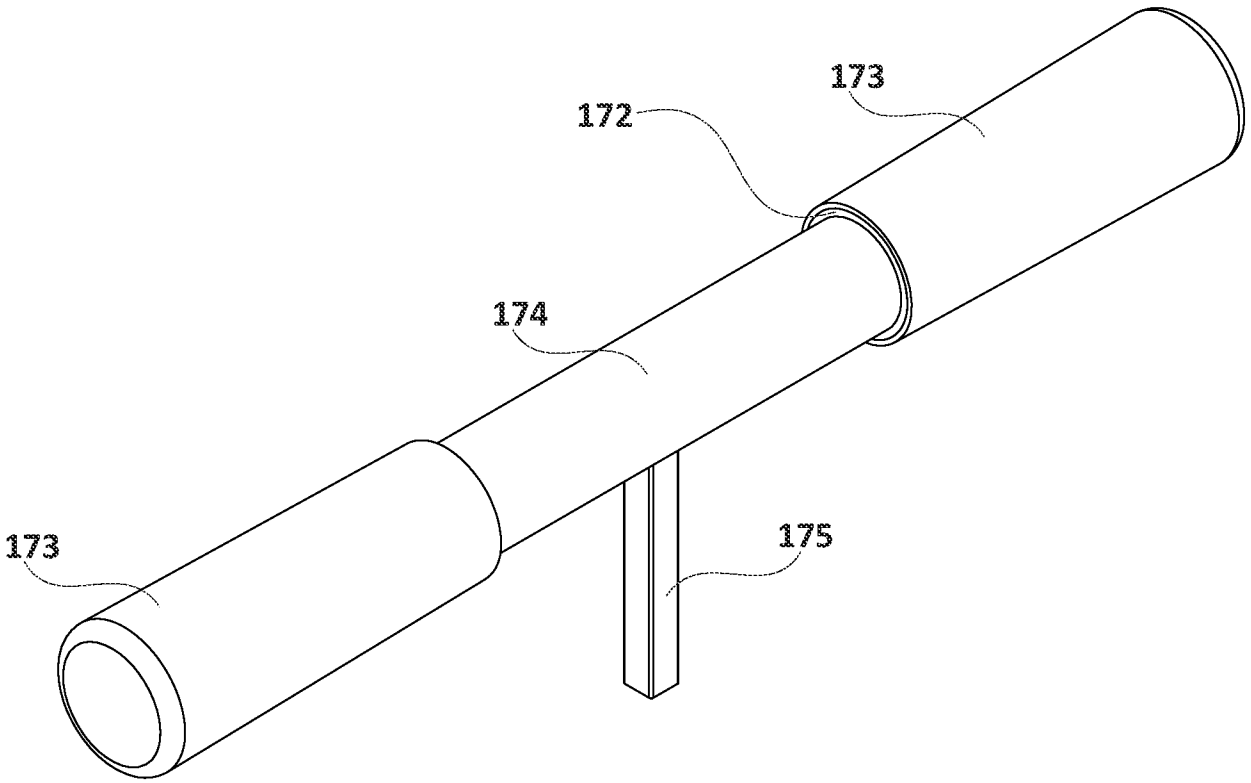
Figure 189:
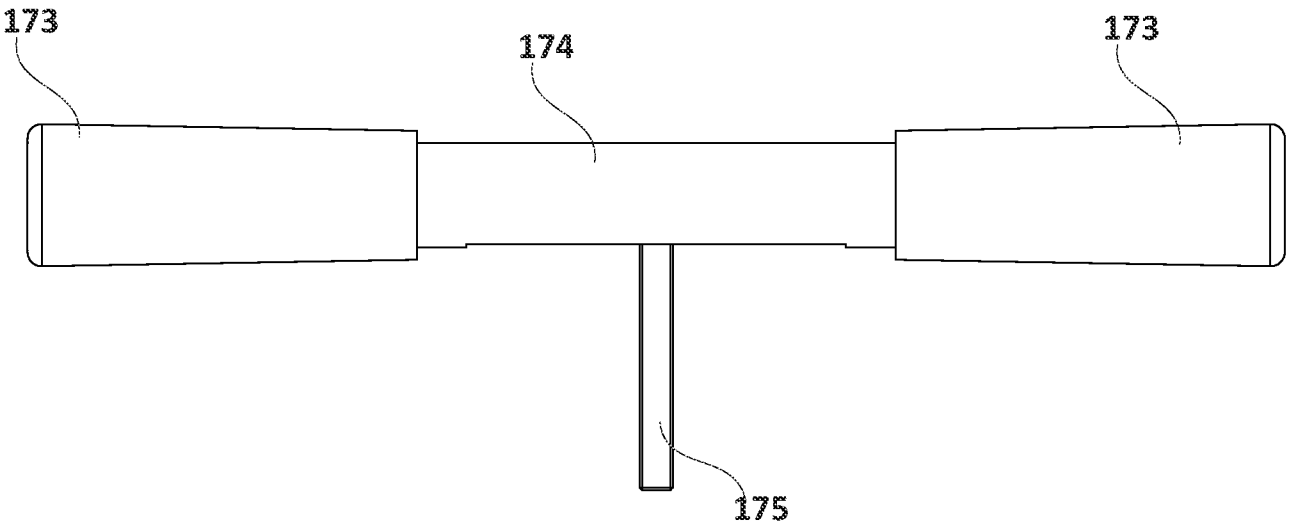
Figure 190:
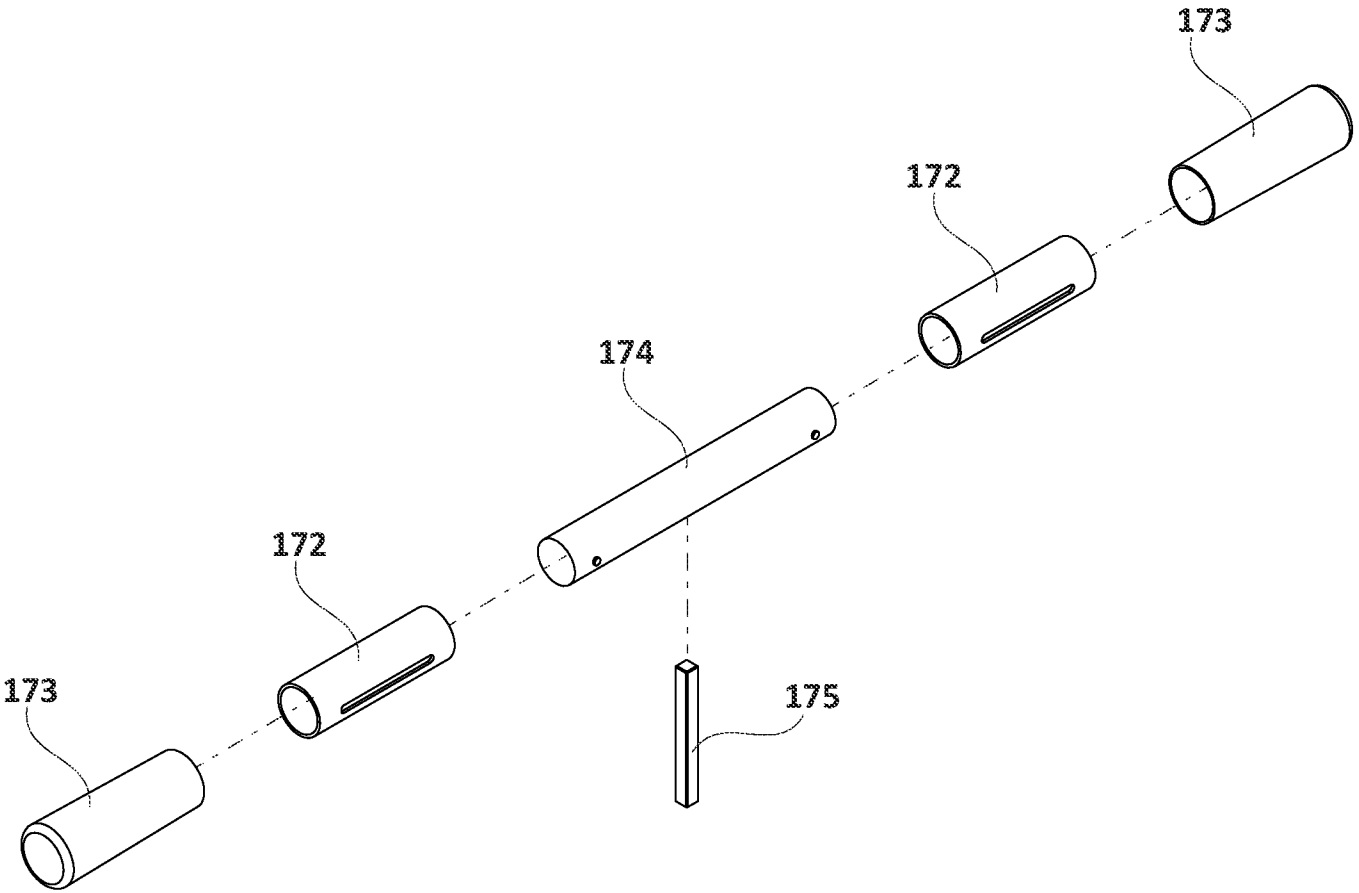
Figure 191:
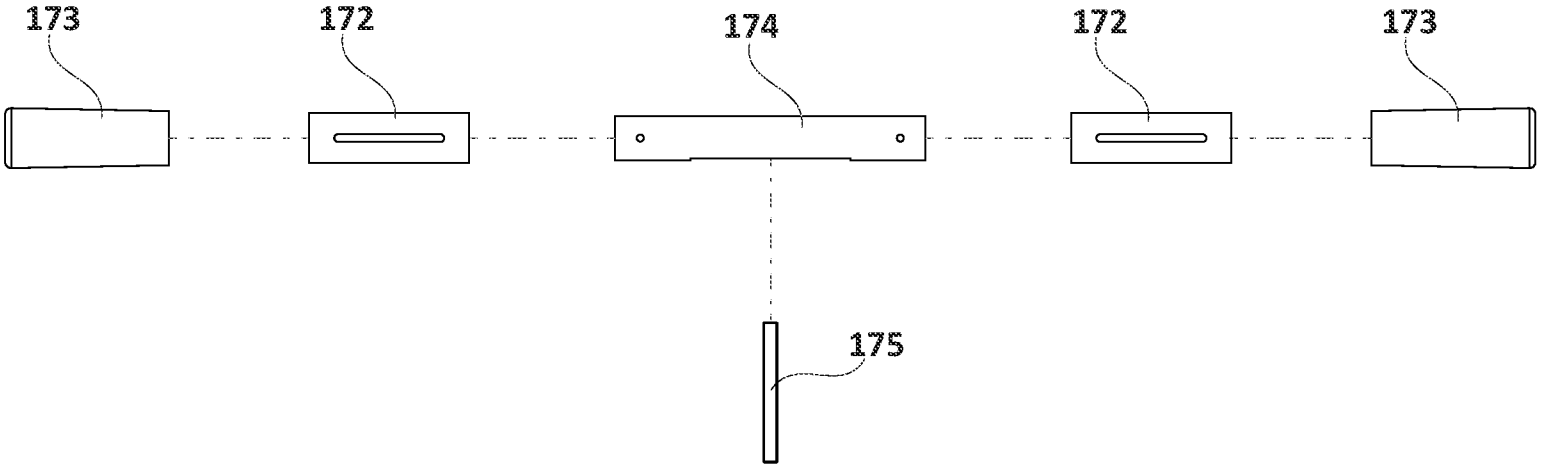
Figure 192:
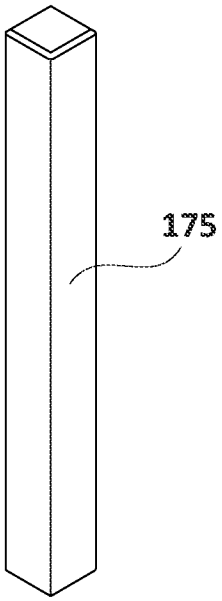
Figure 193:
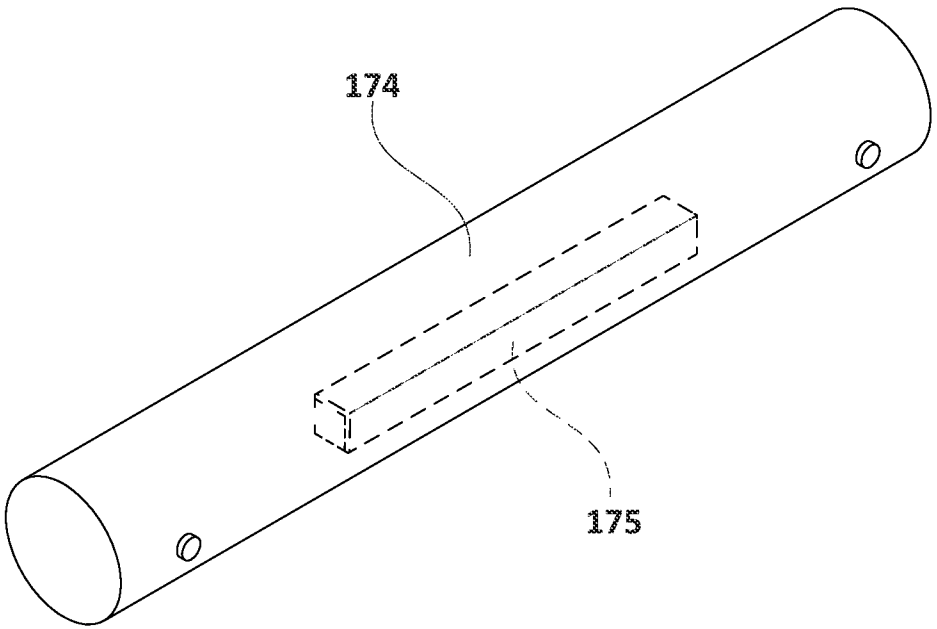
Figure 194:
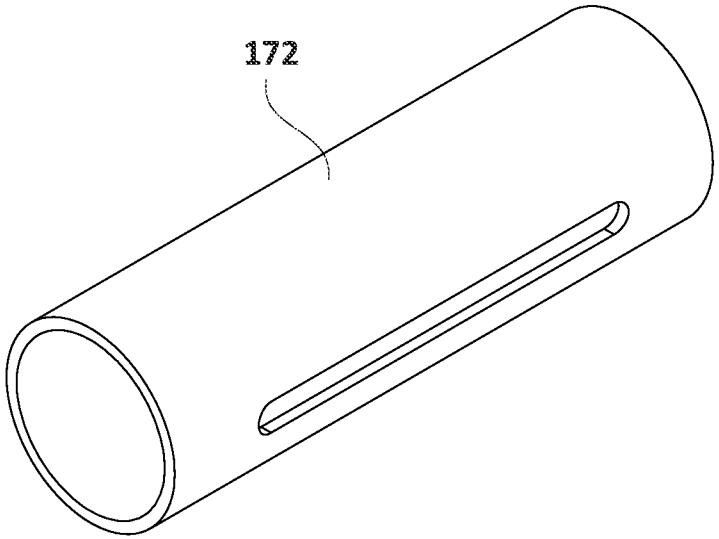
Figure 195:
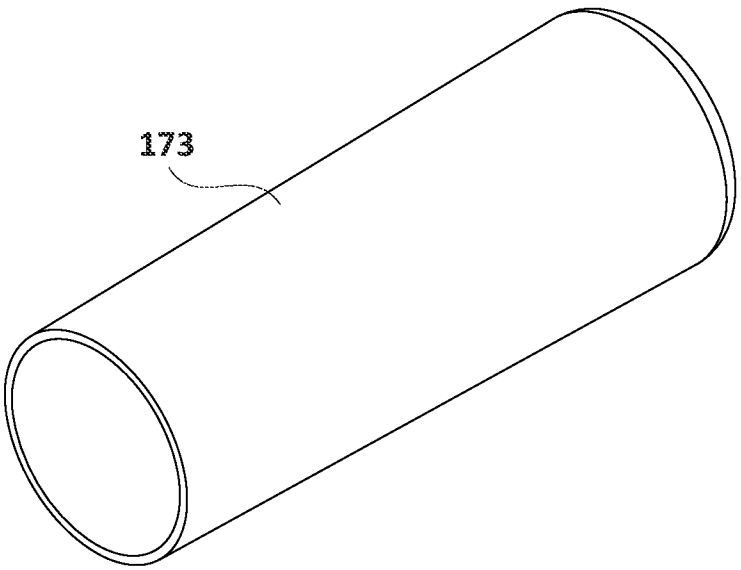
Figure 196:
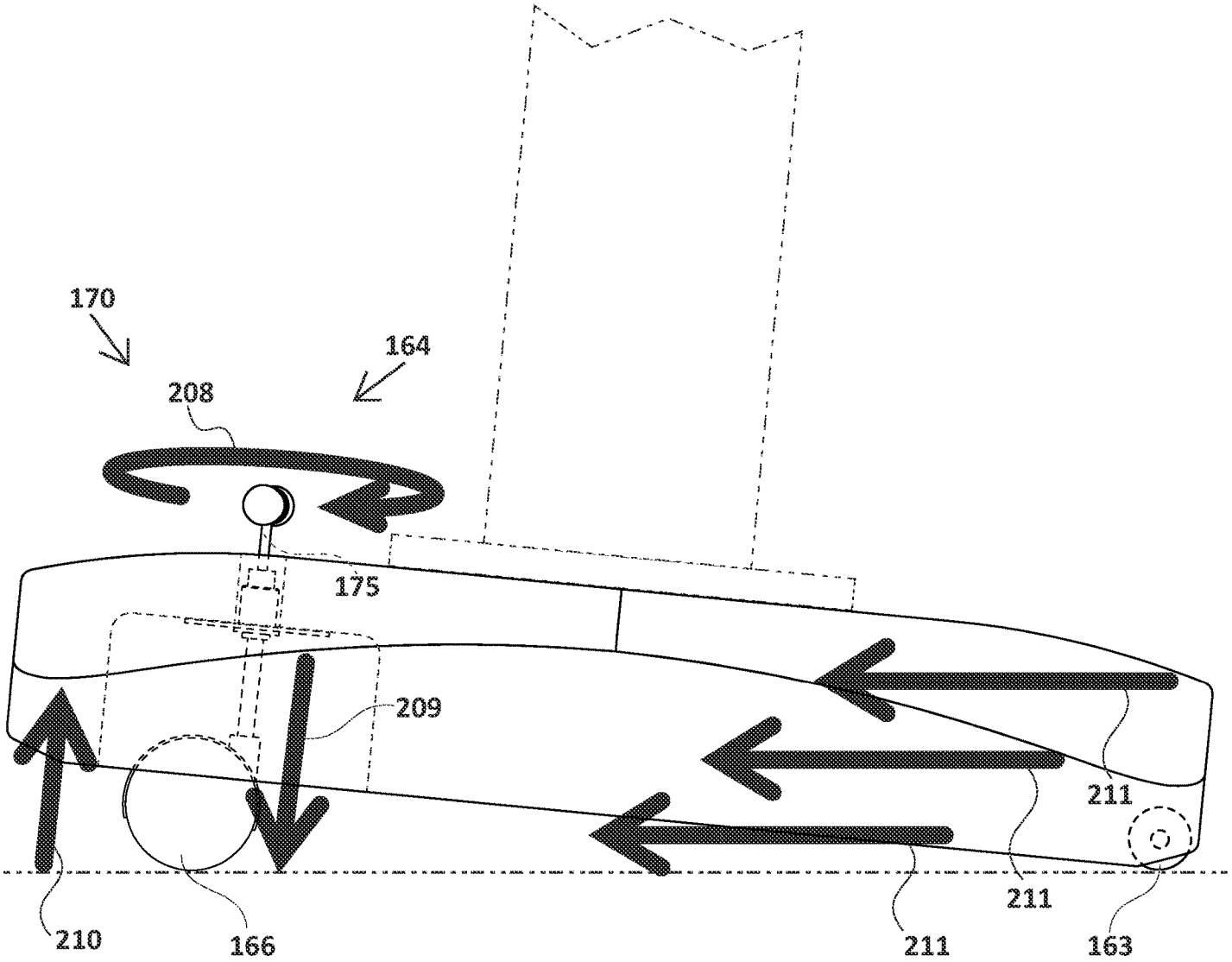
FIG. 196-FIG. 197 are diagrams illustrating side views demonstrating adjustable-hidable angle-operated caster system 164 being able to be adjusted to different tilted heights to work together with 6 angle-operated edge rollers 163 to elevate the 5-device-in-one base off the ground for moving.
Figure 197:
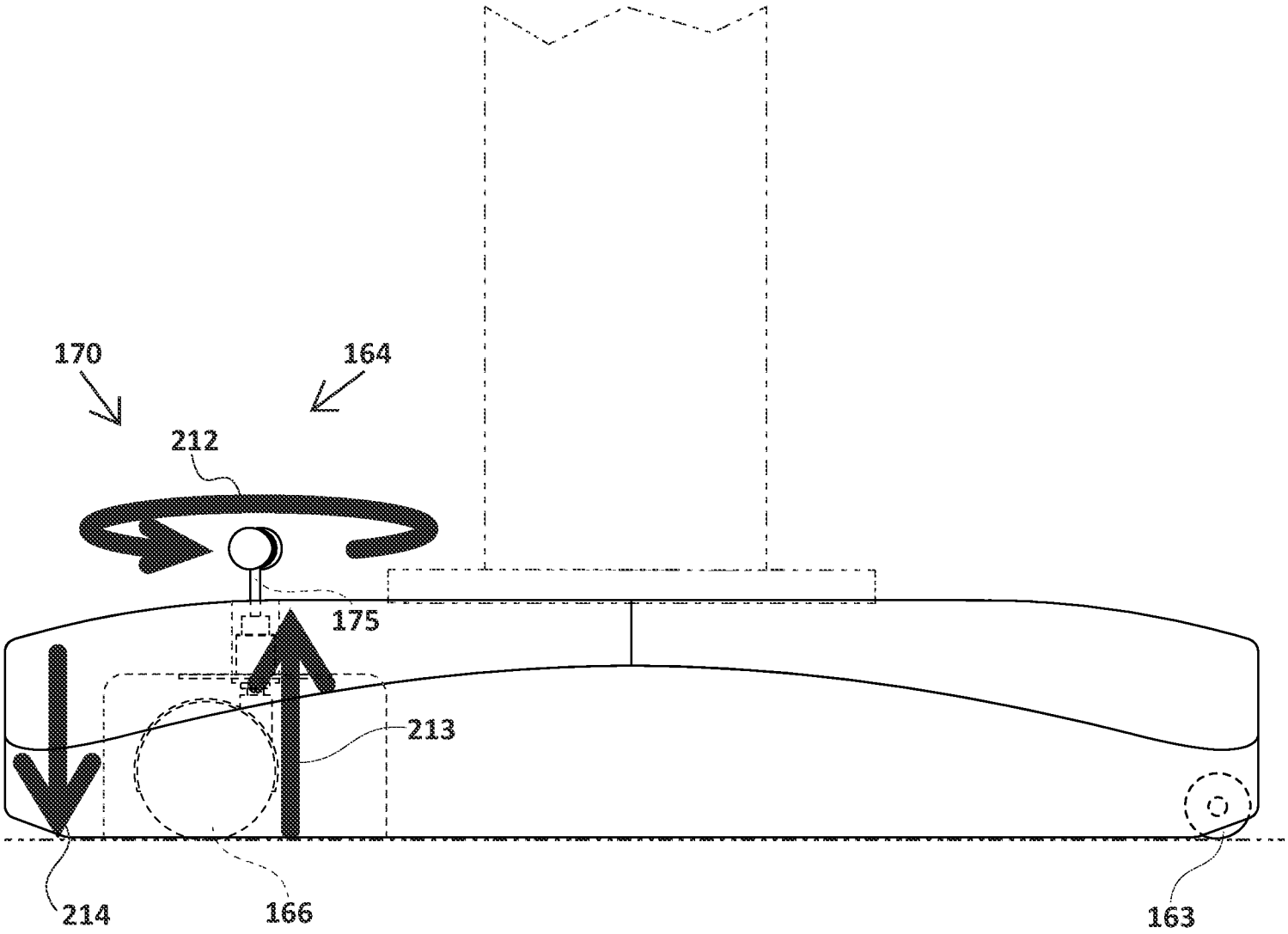
Figure 198:
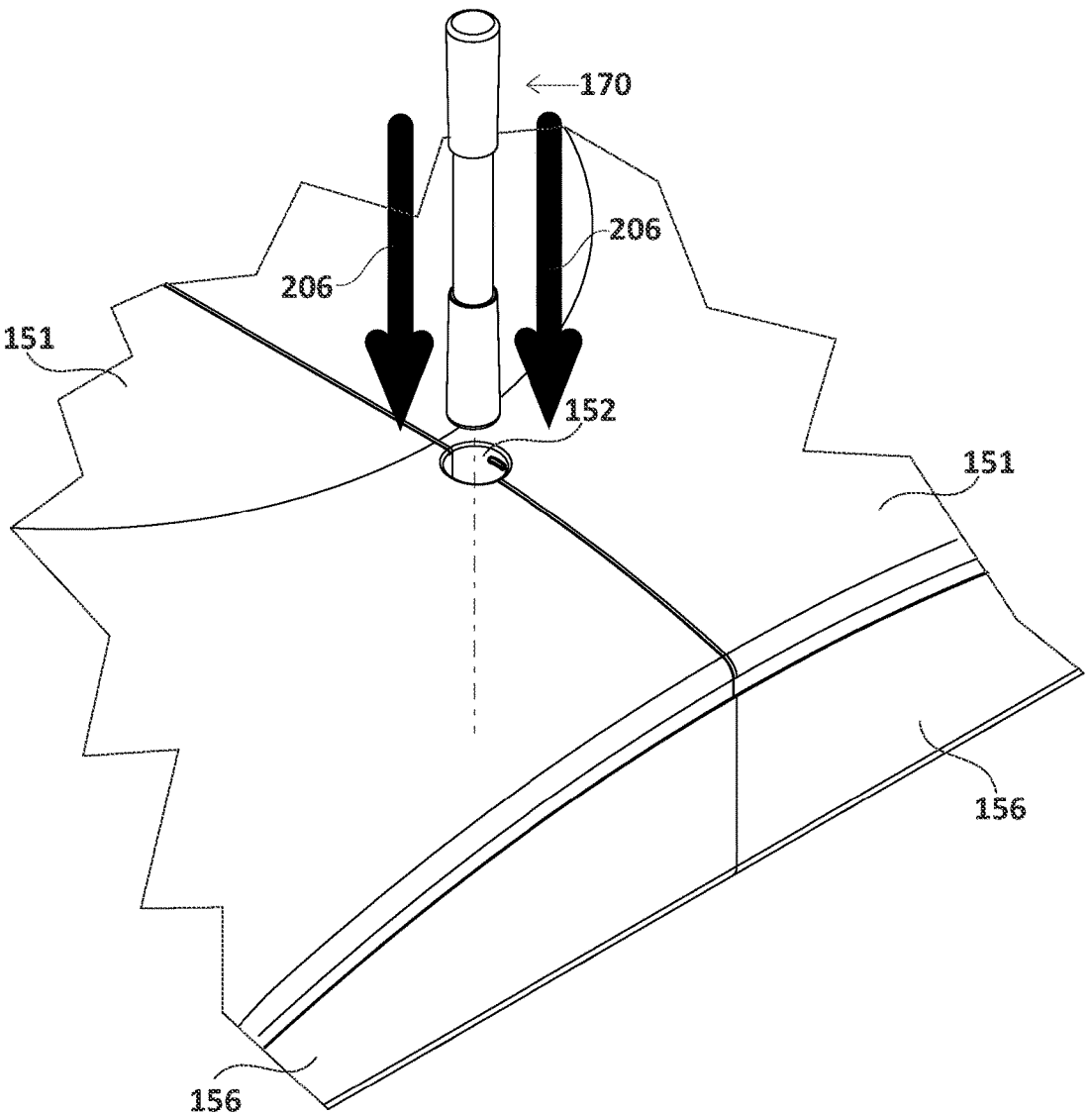
FIG. 198-FIG. 201 are diagrams illustrating perspective and side views demonstrating how deployable-hidable crank-and-bolt-lock system 170 deploys crank-handle-and-bolt-locks 172 into parallel gaps or holes in a patio or deck to secure the 5-device-in-one base to the patio or deck.
Figure 199:
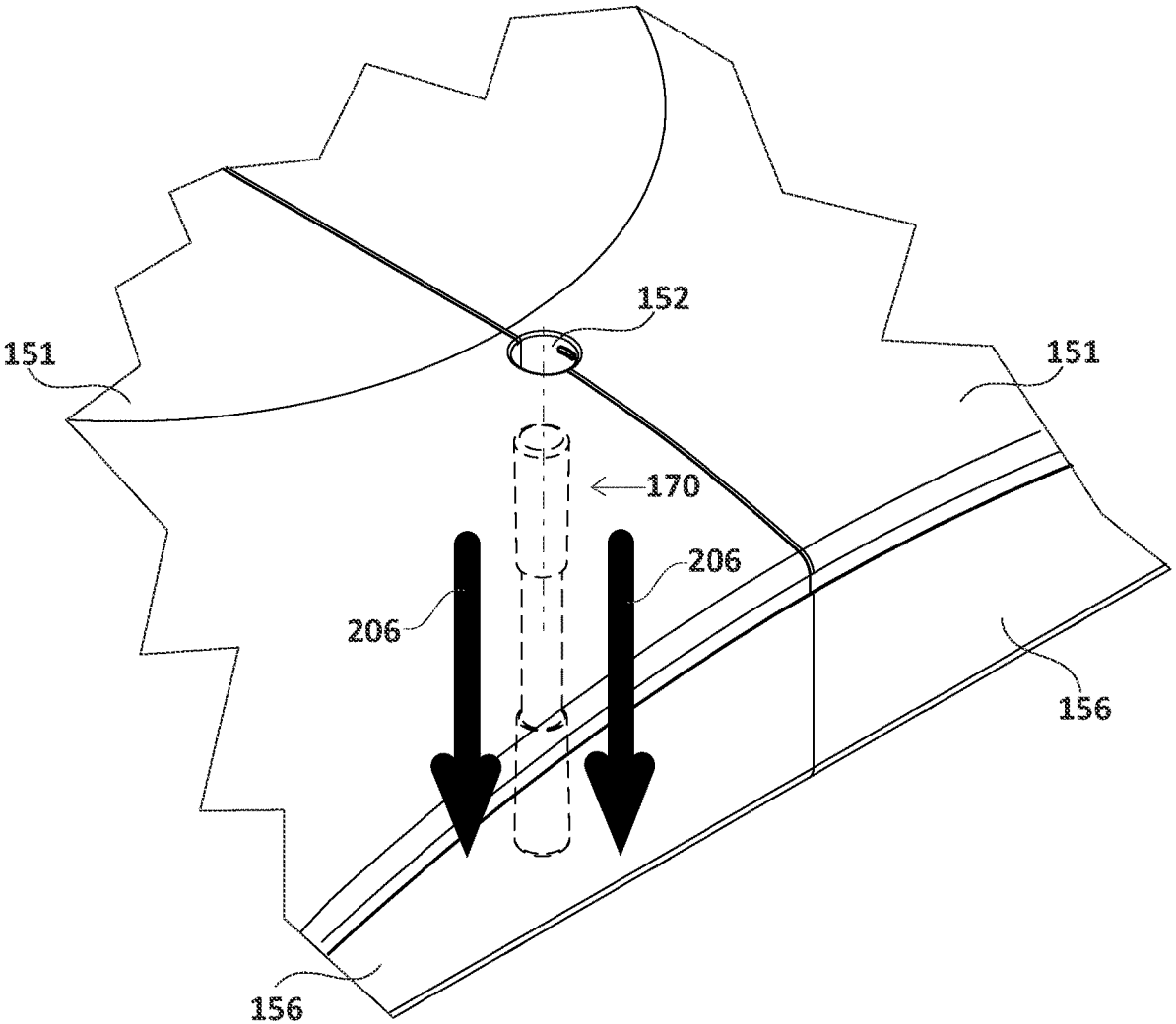
Figure 200:
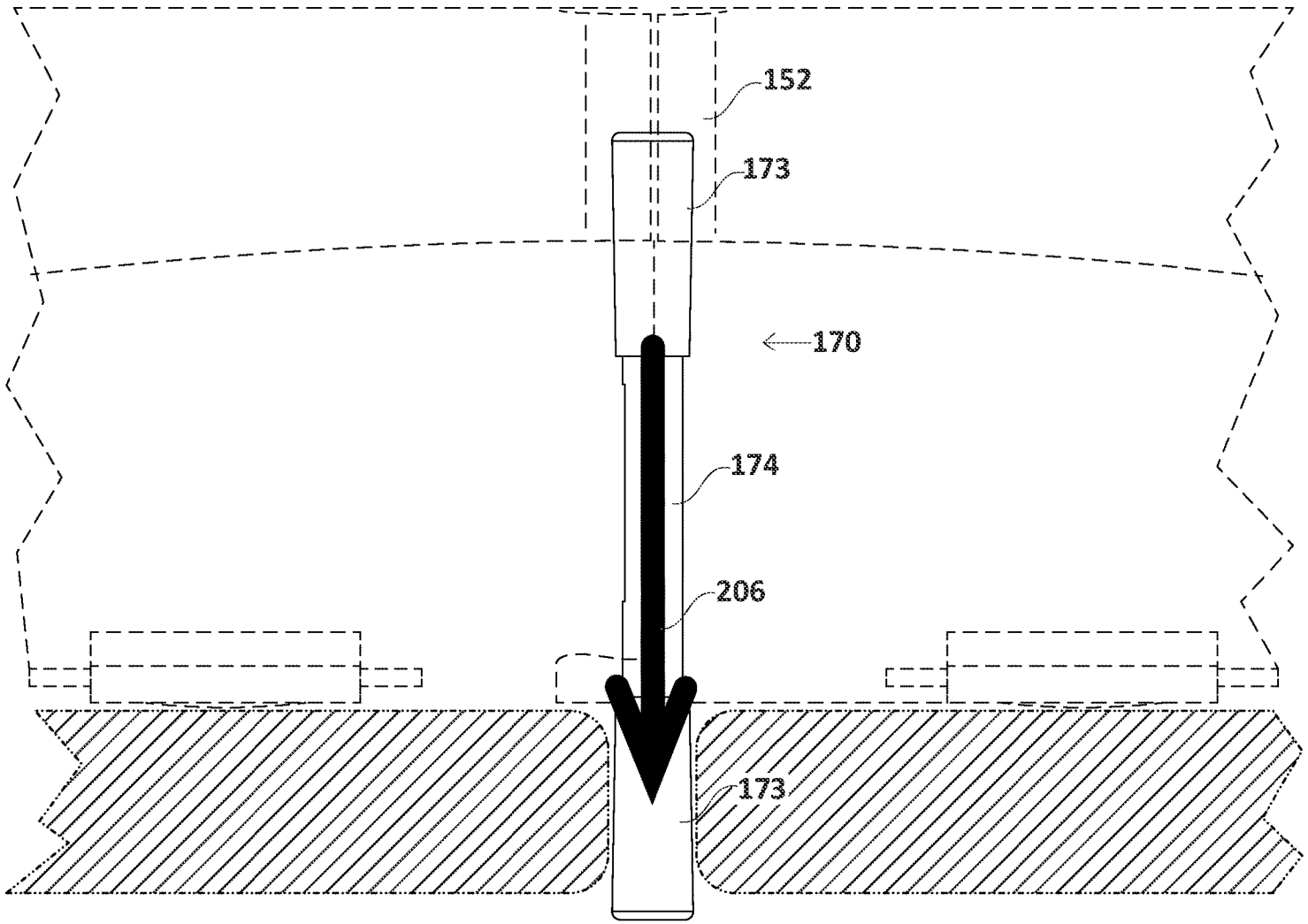
Figure 201:
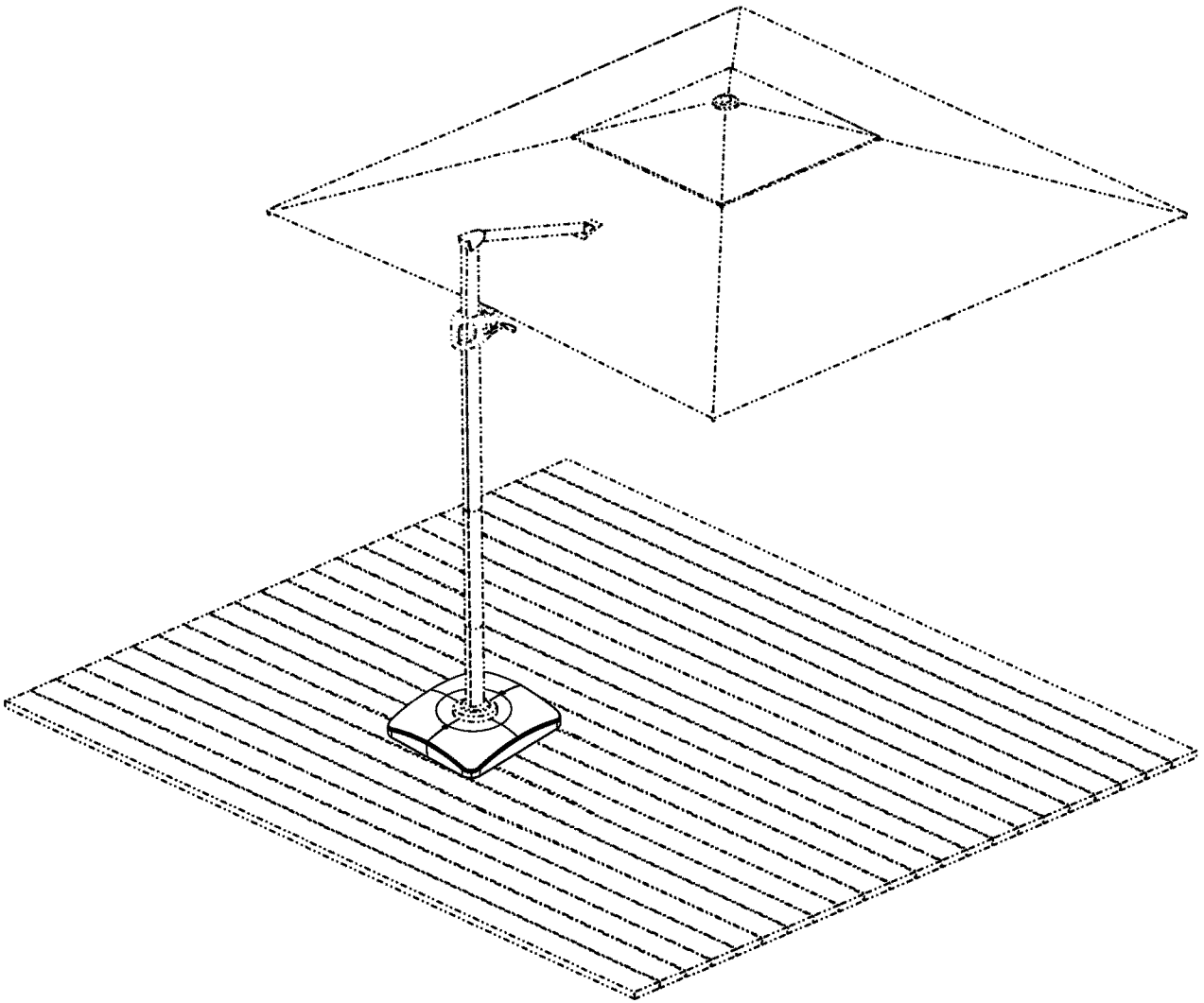
Figure 202:
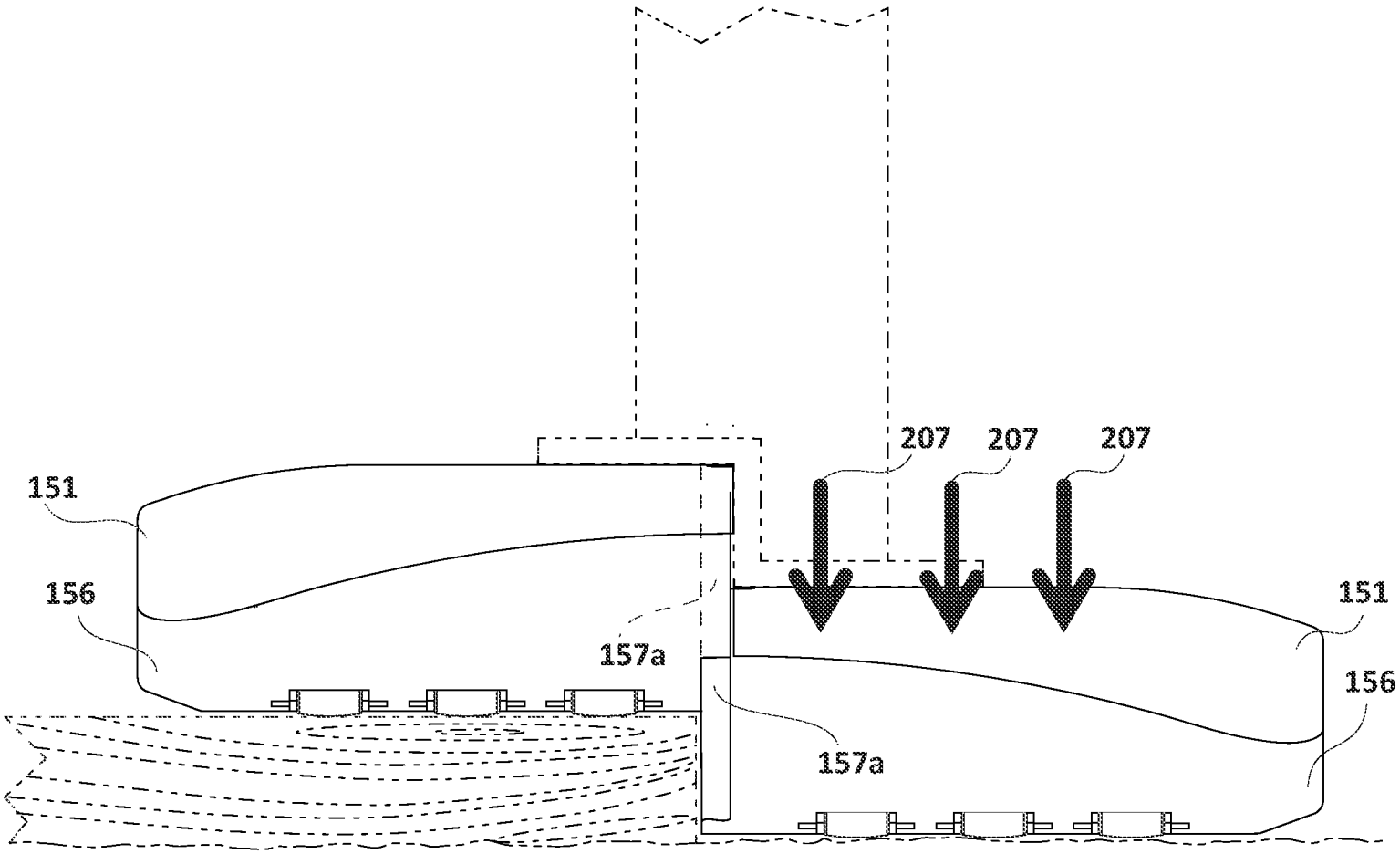
FIG. 202-FIG. 206 are diagrams illustrating perspective and side views demonstrating how production-increasing cost-saving identical-half-base-bottom system 155 can sit on two different elevations at the same time (for example, a platform and the ground, a staircase, or a truck bed and a truck bumper).
Figure 203:
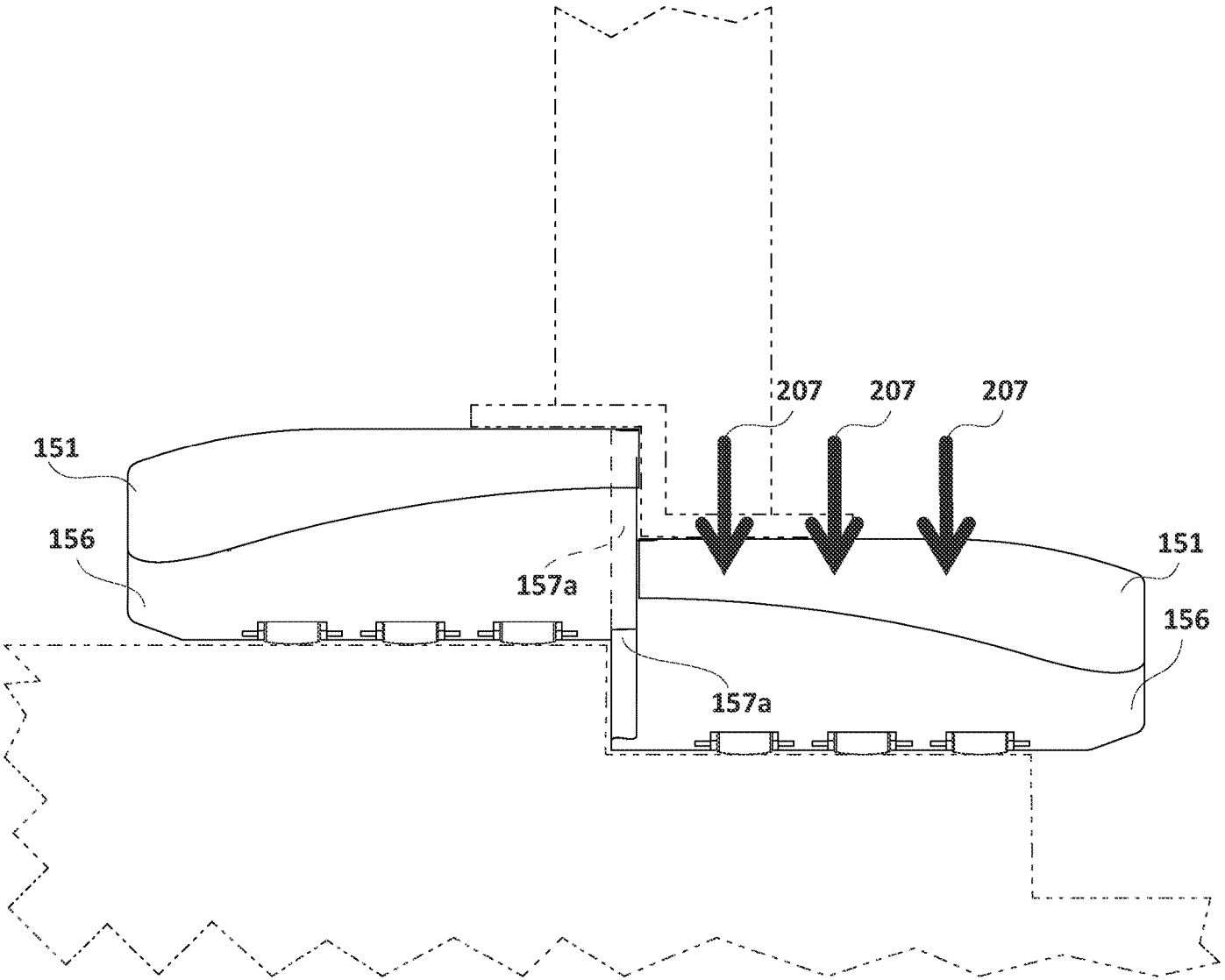
Figure 204:
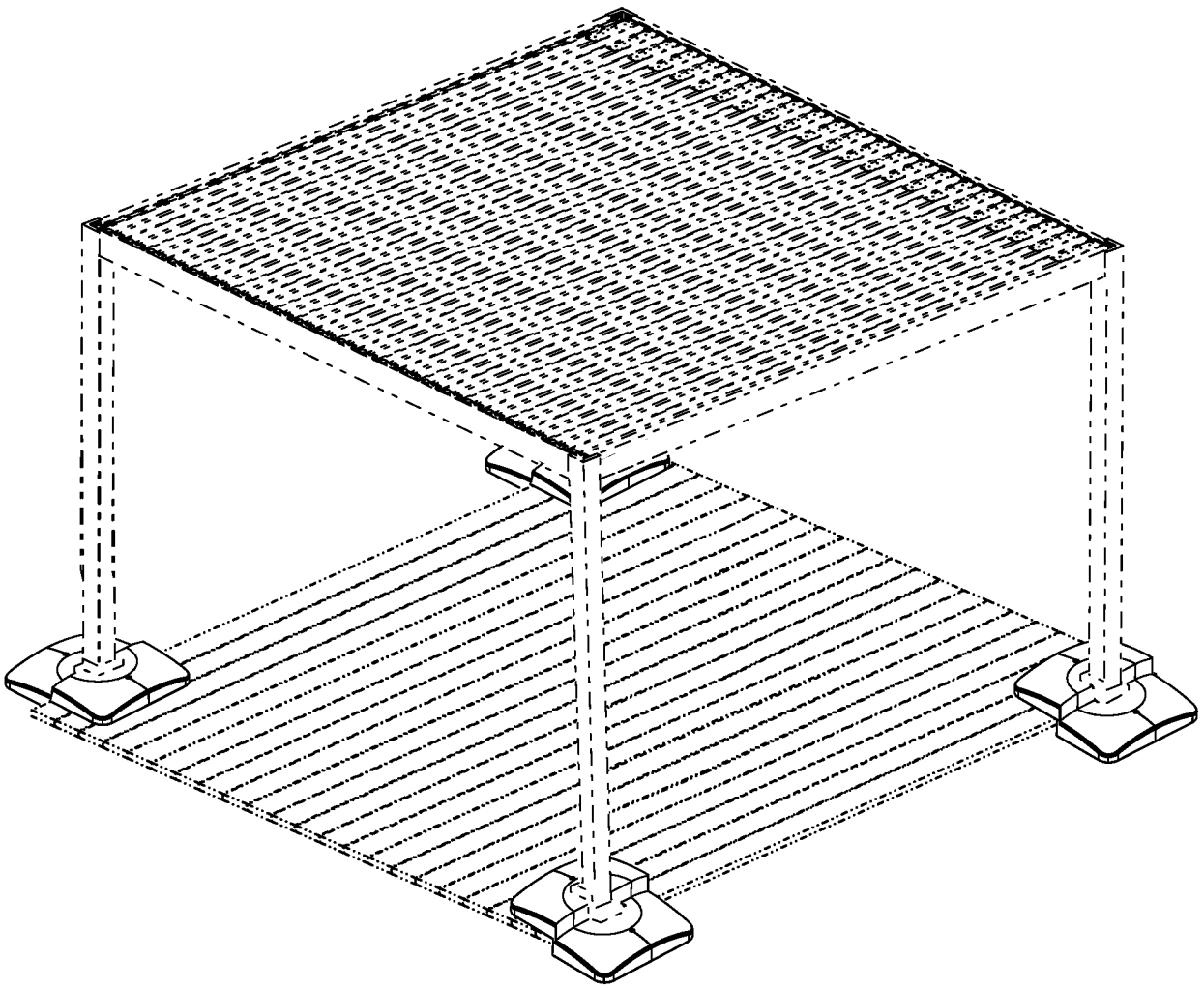
Figure 205:
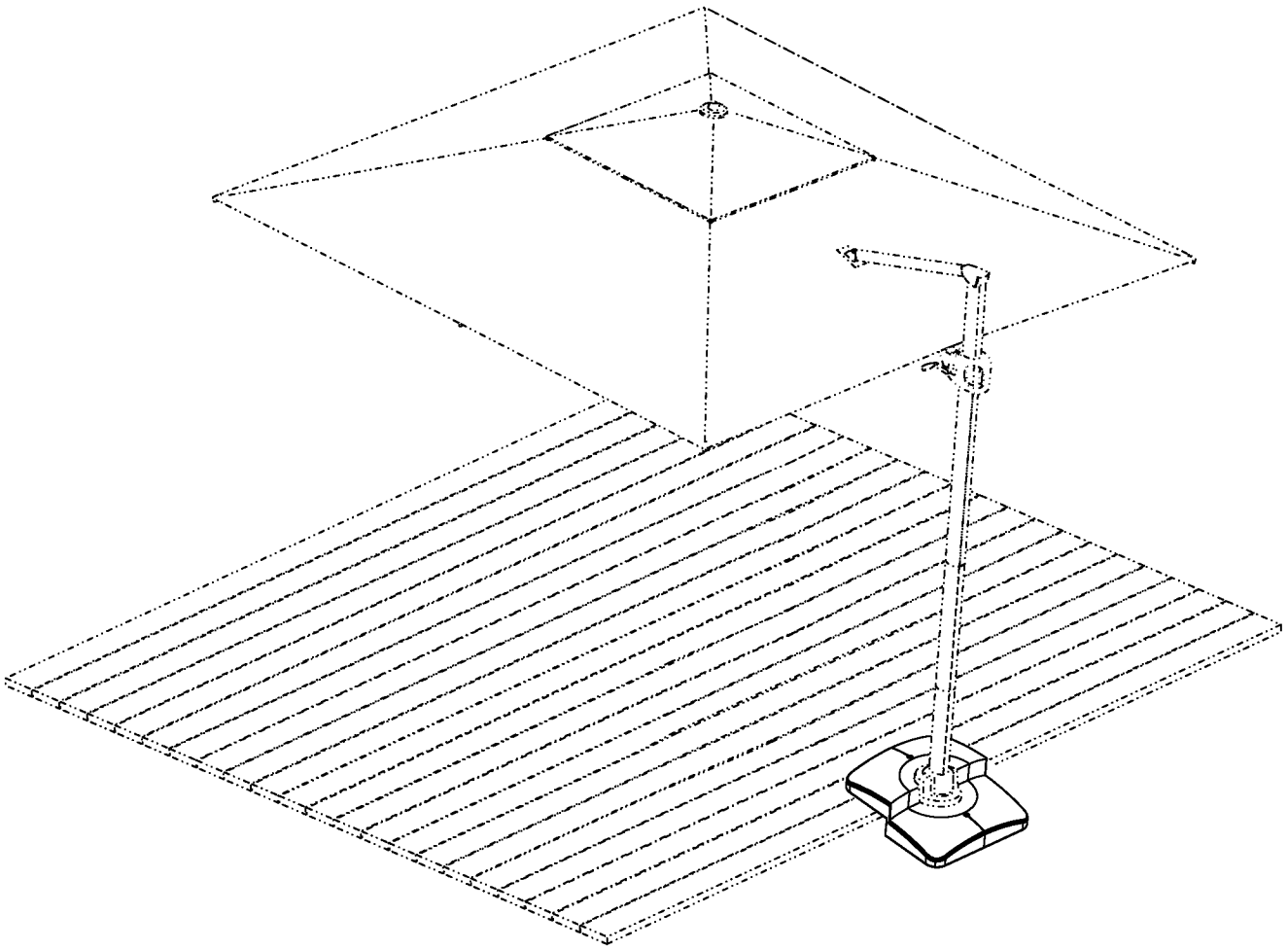

No prior art mention or disclose any umbrella, having arthritic-assisting twist-clamping-jaw hand-knob 141. Therefore, the prior art of umbrella are not capable of allowing an arthritic to eliminate the needs for folding his fingers when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113); and not capable of allowing an arthritic to eliminate pain when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113).

14) No prior art mention or disclose any umbrella, having 2 production-increasing cost-saving identical-half-base-bottoms 156. Therefore, the prior art of umbrella are not capable of being independently vertically adjusted to sit on 2 different elevations at the same time while interlocking each other (for example, sitting on 2 steps of a staircase, on a patio and a step, or on a truck bed and a truck bumper in the direction of arrow 207 (see FIG. 125-FIG. 130); and not capable of being independently vertically adjusted to sit on 2 different elevations at the same time while interlocking each other (for example, sitting on a platform and the ground to stabilize the platform) in the direction of arrow 207 (see FIG. 125-FIG. 130).

15) No prior art mention or disclose any umbrella, having 2 deployable-retractable crank-handle-and-bolt-locks 172. Therefore, the prior art of umbrella are not capable of deploying crank-handle-and-bolt-locks 172 into parallel gaps or holes in a patio or deck to secure the 5-device-in-one base to the patio or deck in the direction of arrow 206 (see FIG. 121-FIG. 124); not capable of deploying crank-handle-and-bolt-locks 172 into parallel gaps or holes in a patio or deck to prevent the wind from tipping or toppling the 5-device-in-one base in the direction of arrow 206 (see FIG. 121-FIG. 124); and not capable of being slidably deployed into 2 opposite handles to crank removable-hidable wrench 175 (see FIG. 131-FIG. 132, and FIG. 185-FIG. 188).

16) No prior art mention or disclose any umbrella, having adjustable-hidable angle-operated caster 166. Therefore, the prior art of umbrella are not capable of being adjusted to different tilted heights to mutually work with 6 angle-operated edge rollers 163 to elevate the 5-device-in-one base off the ground for moving in the directions of arrows 208-214 (see FIG. 131-FIG. 132); and not capable of being adjusted to retract off the ground and hide completely inside caster chamber 165 for the 5-device-in-one base to sit in a fixed location in the directions of arrows 208-214 (see FIG. 131-FIG. 132).

17) No prior art mention or disclose any umbrella, having 6 separation-preventing double-opposite-ridge-interlocks 157*a* and 6 separation-preventing double-opposite-inter-pockets 157*b*. Therefore, the prior art of umbrella are not capable of being independently vertically adjusted to interlock 2 production-increasing cost-saving identical-half-base-bottoms 156 while they sit on 2 different elevations at the same time (for example, sitting on 2 steps of a staircase, on a patio and a step, on a platform and the ground, on a truck be and a truck bumper, etc.) (see FIG. 125-FIG. 130, FIG. 154-FIG. 155, and FIG. 299); and not capable of being independently vertically adjusted to interlock 2 production-increasing cost-saving identical-half-base-bottoms 156 while they sit on 2 different elevations at the same time (for example, sitting on a platform and the ground to stabilize the platform) (see FIG. 125-FIG. 130, FIG. 154-FIG. 155, and FIG. 299).

Figure 304:
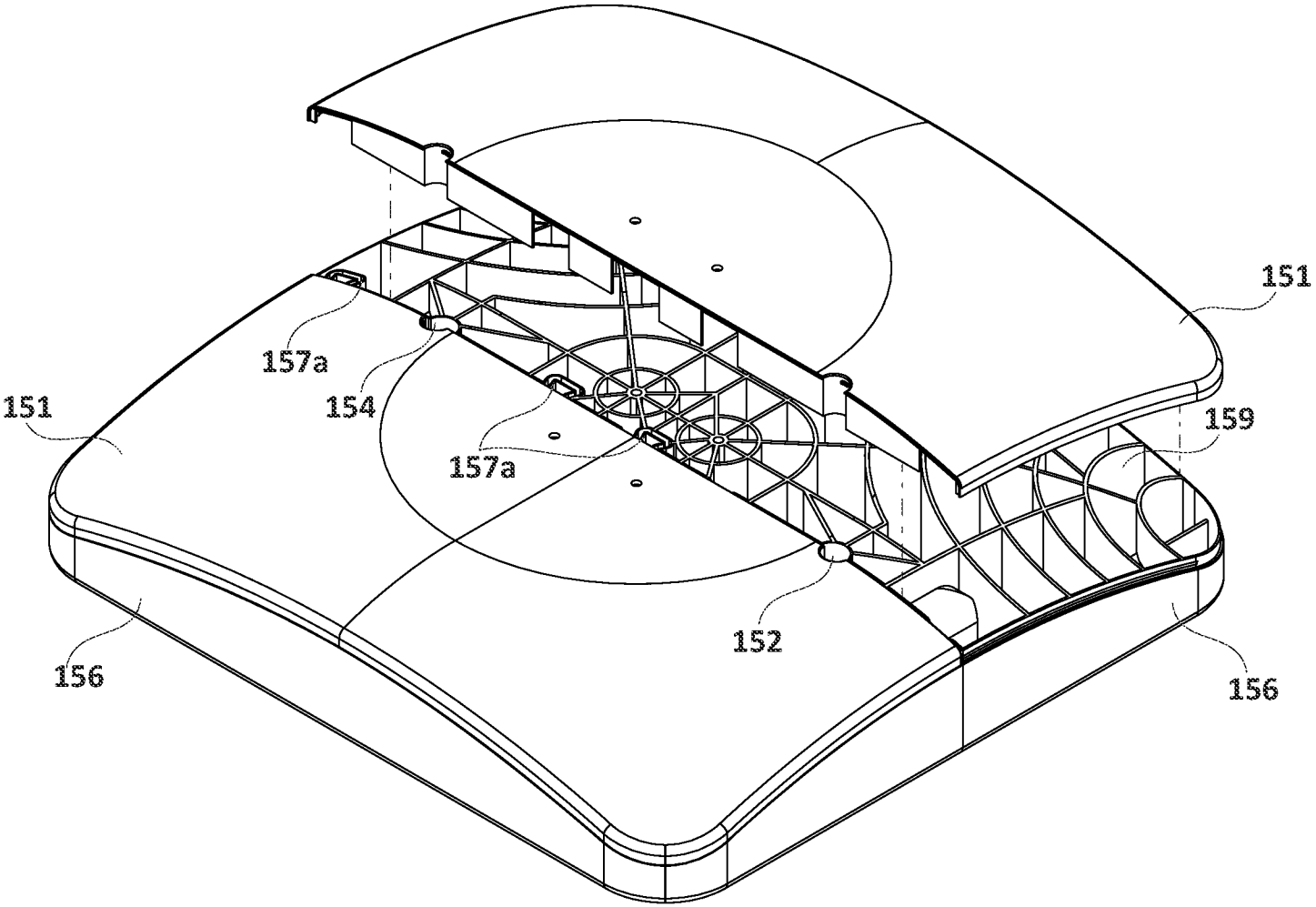
Figure 305:
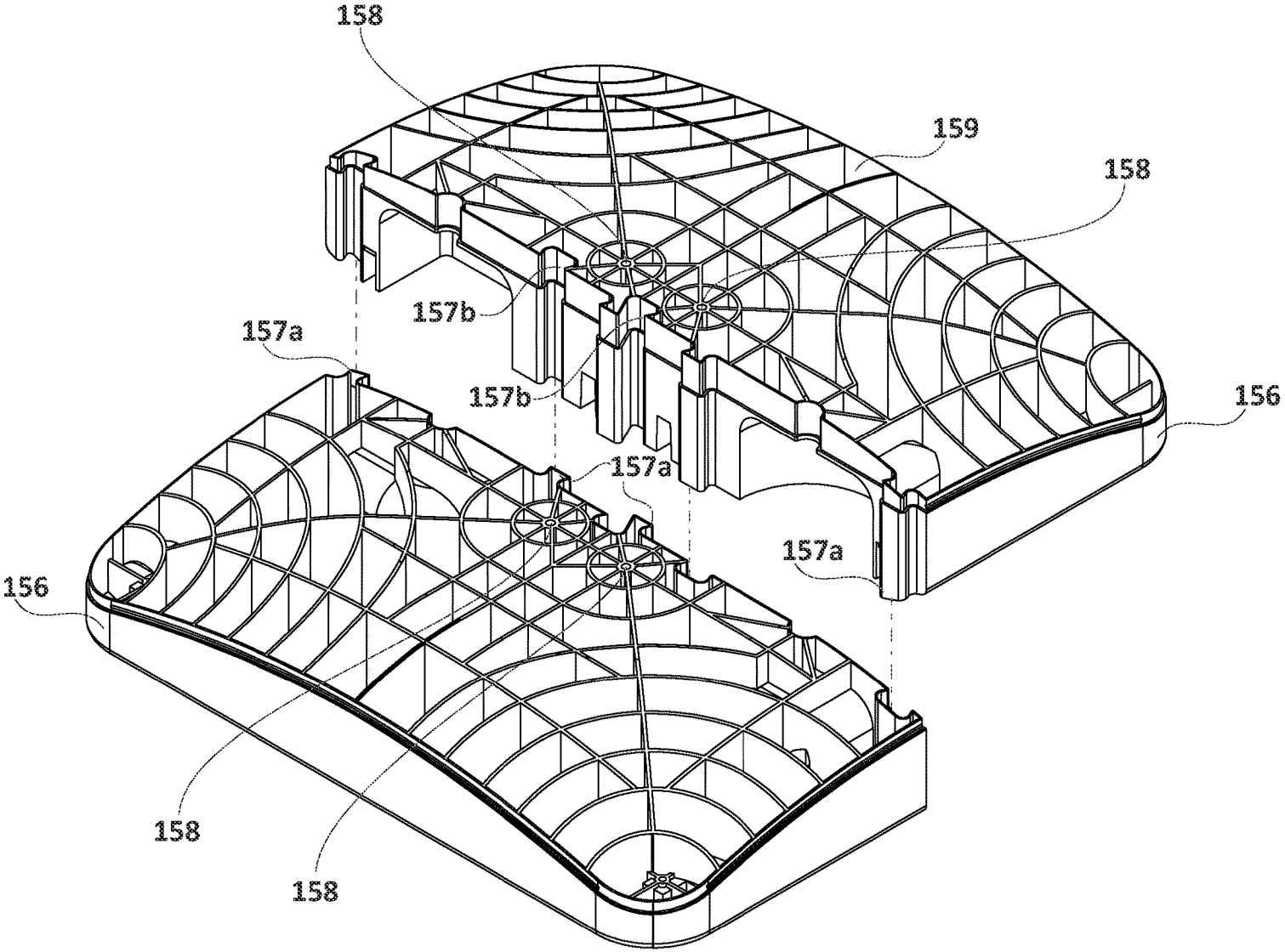

18) No prior art mention or disclose any umbrella, having removable-hidable wrench 175. Therefore, the prior art of umbrella are not capable of storing and hiding removable-hidable wrench 175 inside crank core 174 for a user to adjust adjustable-hidable angle-operated caster 166 at any time at any location (see FIG. 185-FIG. 195); and Not capable of hiding and storing removable-hidable wrench 175 inside 2 production-increasing cost-saving identical-half-base-bottoms 156 to eliminate tripping and personal injuries (see FIG. 121, FIG. 122, and FIG. 304).

19) No prior art mention or disclose any umbrella, having 6 angle-operated edge rollers 163. Therefore, the prior art of umbrella are not capable of tiltedly working together with adjustable-hidable angle-operated caster 166 when tilted by the tilting adjustment of adjustable-hidable angle-operated caster 166 to mutually elevate the 5-device-in-one base off the ground for moving in the directions of arrows 208-214 (see FIG. 131, FIG. 132, FIG. 163-FIG. 167); and Not capable of adjustably staying off the ground for the 5-device-in-one base to sit in a fixed location in the directions of arrows 208-214 (see FIG. 131, FIG. 132, FIG. 163-FIG. 167).

20) No prior art mention or disclose any umbrella, having crank-storing extra-umbrella-pole-locking hole 152. Therefore, the prior art of umbrella are not capable of storing and hiding deployable-hidable crank-and-bolt-lock system 170 inside crank-storing extra-umbrella-pole-locking hole 152 for a user to adjust adjustable-hidable angle-operated caster 166 at any time at any location in the direction of arrow 206 (see FIG. 121-FIG. 124, FIG. 294); and not capable of hiding and storing deployable-hidable crank-and-bolt-lock system 170 inside 2 production-increasing cost-saving identical-half-base-bottoms 156 to eliminate tripping and personal injuries in the direction of arrow 206 (see FIG. 121-FIG. 124, FIG. 294).

OBJECTS AND ADVANTAGES OF THE INVENTION

The present invention substantially departs from the conventional concepts and designs of the prior art. In doing so, the present invention provides five-device-in-one arthritic-assisting anti-vibration anti-friction anti-pinching portable elevators, twisting jaws, and uneven base (for being adapted to umbrella post, hand rail, sail pole, awning arm, and pergola column, and for being capable of functioning as uneven-step supporter, uneven-surface supporter, patio bolt-locker, platform stabilizer, and weight base), having many new and significant features, functions, and advantages, which overcome all the disadvantages of the prior art, as follows:

1) It is an object of an embodiment to provide five-device-in-one arthritic-assisting anti-vibration anti-friction anti-pinching portable elevators, twisting jaws, and uneven base, having arthritic-assisting anti-vibration anti-friction portable handle-elevator 107*a*. Therefore, the five-device-in-one arthritic-assisting anti-vibration anti-friction anti-pinching portable elevators, twisting jaws, and uneven base may be capable of eliminating the needs for an arthritic to fold and unfold his fingers to raise and lower arthritic-assisting anti-vibration anti-friction anti-pinching portable-elevator system 106 (see FIG. 51, FIG. 56, and FIG. 57); capable of securing and enclosing arthritic-assisting anti-vibration anti-friction anti-pinching portable roller-elevator 108 (see FIG. 10); capable of being used on umbrella post, hand rail, sail pole, awning arm, and pergola column (see FIG. 58-FIG. 62); and capable of preventing an arthritic's hand from being pinched by multi-elevator stabilizer 113, arthritic-assisting anti-vibration anti-friction portable rollers 111, and roller axles 110 (see FIG. 51, FIG. 56, and FIG. 57).

2) It is another object of an embodiment to provide five-device-in-one arthritic-assisting anti-vibration anti-friction anti-pinching portable elevators, twisting jaws, and uneven base, having arthritic-assisting anti-vibration anti-friction handle-elevator-track 107*b*. Therefore, the five-device-in-one arthritic-assisting anti-vibration anti-friction anti-pinching portable elevators, twisting jaws, and uneven base are: capable of sealing arthritic-assisting anti-vibration anti-friction portable rollers 111 to protect a user's hand or an arthritic's hand. capable of guiding arthritic-assisting anti-vibration anti-friction portable rollers 111 (see FIG. 3).

3) It is still another object of an embodiment to provide five-device-in-one arthritic-assisting anti-vibration anti-friction anti-pinching portable elevators, twisting jaws, and uneven base, having arthritic-assisting anti-vibration anti-friction portable roller-elevator 108. Therefore, the five-device-in-one arthritic-assisting anti-vibration anti-friction anti-pinching portable elevators, twisting jaws, and uneven base may be capable of being used on umbrella post, hand rail, sail pole, awning arm, and pergola column (see FIG. 58-FIG. 62) capable of hiding arthritic-assisting anti-vibration anti-friction portable roller-elevator 108 (see FIG. 2); and capable of securing and organizing arthritic-assisting anti-vibration anti-friction portable rollers 111 (see FIG. 11, FIG. 12, and FIG. 18).

4) It is a further object of an embodiment to provide five-device-in-one arthritic-assisting anti-vibration anti-friction anti-pinching portable elevators, twisting jaws, and uneven base, having arthritic-assisting anti-vibration anti-friction portable rollers 111. Therefore, the five-device-in-one arthritic-assisting anti-vibration anti-friction anti-pinching portable elevators, twisting jaws, and uneven base may be capable of assisting an arthritic in operating arthritic-assisting anti-vibration anti-friction anti-pinching portable-elevator system 106 in the directions of arrows 176-186 (see FIG. 51-FIG. 57); and capable of eliminating vibration and friction during operation of arthritic-assisting anti-vibration anti-friction anti-pinching portable-elevator system 106 in the direction of arrow 187 (see FIG. 49 and FIG. 50).

5) It is still a further object of an embodiment to provide five-device-in-one arthritic-assisting anti-vibration anti-friction anti-pinching portable elevators, twisting jaws, and uneven base, having arthritic-assisting anti-vibration anti-friction back roller-tracks 102 and arthritic-assisting anti-vibration anti-friction front roller-tracks 103. Therefore, the five-device-in-one arthritic-assisting anti-vibration anti-friction anti-pinching portable elevators, twisting jaws, and uneven base may be capable of guiding arthritic-assisting anti-vibration anti-friction portable rollers 111 to assist an arthritic during operation of arthritic-assisting anti-vibration anti-friction anti-pinching portable-elevator system 106 in the directions of arrows 176-186 (see FIG. 51-FIG. 57); and capable of eliminating vibration and friction during operation of arthritic-assisting anti-vibration anti-friction anti-pinching portable-elevator system 106 in the direction of arrow 187 (see FIG. 49 and FIG. 50).

6) It is yet still another object of an embodiment to provide five-device-in-one arthritic-assisting anti-vibration anti-friction anti-pinching portable elevators, twisting jaws, and uneven base, having arthritic-assisting raising angle-handle 112*a*. Therefore, the five-device-in-one arthritic-assisting anti-vibration anti-friction anti-pinching portable elevators, twisting jaws, and uneven base may be capable of assisting an arthritic to eliminate the needs for folding an arthritic's fingers when raising arthritic-assisting anti-vibration anti-friction anti-pinching portable-elevator system 106 in the directions of arrows 176-186 (see FIG. 51-FIG. 57); and capable of reducing impact against an arthritic's fingers during operation of arthritic-assisting anti-vibration anti-friction anti-pinching portable-elevator system 106 in the directions of arrows 176-186 (see FIG. 51-FIG. 57).

7) It is yet still a further object of an embodiment to provide five-device-in-one arthritic-assisting anti-vibration anti-friction anti-pinching portable elevators, twisting jaws, and uneven base, having arthritic-assisting lowering angle-handle 112*b*. Therefore, the five-device-in-one arthritic-assisting anti-vibration anti-friction anti-pinching portable elevators, twisting jaws, and uneven base may be capable of assisting an arthritic to eliminate the needs for folding an arthritic's fingers when lowering arthritic-assisting anti-vibration anti-friction anti-pinching portable-elevator system 106 in the directions of arrows 176-186 (see FIG. 51-FIG. 57); and capable of reducing impact against an arthritic's fingers during operation of arthritic-assisting anti-vibration anti-friction anti-pinching portable-elevator system 106 in the directions of arrows 176-186 (see FIG. 51-FIG. 57).

8) It is an object of an embodiment to provide five-device-in-one arthritic-assisting anti-vibration anti-friction anti-pinching portable elevators, twisting jaws, and uneven base, having first production-increasing anti-slipping anti-cracking opposite-twisting jaw 122 and second production-increasing anti-slipping anti-cracking opposite-twisting jaw 123. Therefore, the five-device-in-one arthritic-assisting anti-vibration anti-friction anti-pinching portable elevators, twisting jaws, and uneven base may be capable of mutually working with first upper-elevation twistable tube 131, first lower-elevation twistable tube 132, second upper-elevation twistable tube 133, and second lower-elevation twistable tube 134 to twistingly unclamp and to twistingly clamp threaded connector core 145 when turning arthritic-assisting twist-clamping-jaw hand-knob 141 in the directions of arrows 193, 194, and 195 (see FIG. 71-FIG. 74); and Capable of twisting while being twistingly spread by first twist-spreading spring 126 and second twist-spreading spring 127 to twistingly unclamp threaded connector core 145 to allow opposite-twisting-jaw-housing tunnel system 146 to be rotatably adjusted without slipping in the directions of arrows 193, 194, and 195 (see FIG. 71-FIG. 74).

9) It is another object of an embodiment to provide five-device-in-one arthritic-assisting anti-vibration anti-friction anti-pinching portable elevators, twisting jaws, and uneven base, having first anti-slipping core-twist-clamping threads 128 and second anti-slipping core-twist-clamping threads 129. Therefore, the five-device-in-one arthritic-assisting anti-vibration anti-friction anti-pinching portable elevators, twisting jaws, and uneven base are capable of mutually working with first upper-elevation twistable tube 131, first lower-elevation twistable tube 132, second upper-elevation twistable tube 133, and second lower-elevation twistable tube 134 to twistingly unclamp threaded connector core 145 when twistingly spread by first and second twist-spreading springs 126 and 127 to allow opposite-twisting-jaw-housing tunnel system 146 to be rotatably adjusted without slipping in the directions of arrows 193, 194, and 195 (see FIG. 71-FIG. 74); and Capable of mutually working with first upper-elevation twistable tube 131, first lower-elevation twistable tube 132, second upper-elevation twistable tube 133, and second lower-elevation twistable tube 134 to twistingly clamp threaded connector core 145 when squeezed by arthritic-assisting twist-clamping-jaw hand-knob 141 and hand-knob nut 142 (see FIG. 89).

10) It is still another object of an embodiment to provide five-device-in-one arthritic-assisting anti-vibration anti-friction anti-pinching portable elevators, twisting jaws, and uneven base, having first upper-elevation twistable tube 131 and first lower-elevation twistable tube 132.

Therefore, the five-device-in-one arthritic-assisting anti-vibration anti-friction anti-pinching portable elevators, twisting jaws, and uneven base are: Capable of being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 75-FIG. 78); and b) Capable of being on 2 different elevations to allow first production-increasing anti-slipping anti-cracking opposite-twisting jaw 122 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

11) It is a further object of an embodiment to provide five-device-in-one arthritic-assisting anti-vibration anti-friction anti-pinching portable elevators, twisting jaws, and uneven base, having second upper-elevation twistable tube 133 and second lower-elevation twistable tube 134. Therefore, the five-device-in-one arthritic-assisting anti-vibration anti-friction anti-pinching portable elevators, twisting jaws, and uneven base are: Capable of being on 2 different elevations to allow second production-increasing anti-slipping anti-cracking opposite-twisting jaw 123 to twistingly unclamp threaded connector core 145 when twistingly spread by first and second twist spreading springs 126 and 127 on different elevations of arrows 196, 197, 198, and 199 (see FIG. 75-FIG. 78); and Capable of being on 2 different elevations to allow second production-increasing anti-slipping anti-cracking opposite-twisting jaw 123 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

12) It is another further object of an embodiment to provide five-device-in-one arthritic-assisting anti-vibration anti-friction anti-pinching portable elevators, twisting jaws, and uneven base, having first reinforcing twistable ribs 138 and second reinforcing twistable ribs 139. Therefore, the five-device-in-one arthritic-assisting anti-vibration anti-friction anti-pinching portable elevators, twisting jaws, and uneven base are: Capable of mutually working with first upper-elevation twistable tube 131, first lower-elevation twistable tube 132, second upper-elevation twistable tube 133, and second lower-elevation twistable tube 134 to allow 1st production-increasing anti-slipping anti-cracking opposite-twisting jaw 122 and 2nd production-increasing anti-slipping anti-cracking opposite-twisting jaw 123 to twistingly unclamp and to twistingly clamp threaded connector core 145 in the directions of arrows 193, 194, and 195 (see FIG. 9-FIG. 12); and Capable of reinforcing 1st production-increasing anti-slipping anti-cracking opposite-twisting jaw 122 and 2nd production-increasing anti-slipping anti-cracking opposite-twisting jaw 123 to prevent them from cracking, and to securely unclamp and to securely clamp threaded connector core 145 in the directions of arrows 193, 194, and 195 (see FIG. 71-FIG. 74).

13) It is still another further object of an embodiment to provide five-device-in-one arthritic-assisting anti-vibration anti-friction anti-pinching portable elevators, twisting jaws, and uneven base, having arthritic-assisting twist-clamping-jaw hand-knob 141. Therefore, the five-device-in-one arthritic-assisting anti-vibration anti-friction anti-pinching portable elevators, twisting jaws, and uneven base are Capable of allowing an arthritic to eliminate the needs for folding his fingers when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113); and Capable of allowing an arthritic to eliminate pain when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113).

14) It is an object of an embodiment to provide five-device-in-one arthritic-assisting anti-vibration anti-friction anti-pinching portable elevators, twisting jaws, and uneven base, having 2 production-increasing cost-saving identical-half-base-bottoms 156. Therefore, the five-device-in-one arthritic-assisting anti-vibration anti-friction anti-pinching portable elevators, twisting jaws, and uneven base are: capable of being independently vertically adjusted to sit on 2 different elevations at the same time while interlocking each other (for example, sitting on 2 steps of a staircase, on a patio and a step, or on a truck bed and a truck bumper in the direction of arrow 207 (see FIG. 125-FIG. 130); and Capable of being independently vertically adjusted to sit on 2 different elevations at the same time while interlocking each other (for example, sitting on a platform and the ground to stabilize the platform) in the direction of arrow 207 (see FIG. 125-FIG. 130).

15) It is another object of an embodiment to provide five-device-in-one arthritic-assisting anti-vibration anti-friction anti-pinching portable elevators, twisting jaws, and uneven base, having 2 deployable-retractable crank-handle-and-bolt-locks 172. Therefore, the five-device-in-one arthritic-assisting anti-vibration anti-friction anti-pinching portable elevators, twisting jaws, and uneven base are: Capable of deploying crank-handle-and-bolt-locks 172 into parallel gaps or holes in a patio or deck to secure the 5-device-in-one base to the patio or deck in the direction of arrow 206 (see FIG. 121-FIG. 124); Capable of deploying crank-handle-and-bolt-locks 172 into parallel gaps or holes in a patio or deck to prevent the wind from tipping or toppling the 5-device-in-one base in the direction of arrow 206 (see FIG. 121-FIG. 124); and Capable of being slidably deployed into 2 opposite handles to crank removable-hidable wrench 175 (see FIG. 131-FIG. 132, and FIG. 185-FIG. 188).

16) It is still another object of an embodiment to provide five-device-in-one arthritic-assisting anti-vibration anti-friction anti-pinching portable elevators, twisting jaws, and uneven base, having adjustable-hidable angle-operated caster 166. Therefore, the five-device-in-one arthritic-assisting anti-vibration anti-friction anti-pinching portable elevators, twisting jaws, and uneven base are: Capable of being adjusted to different tilted heights to mutually work with 6 angle-operated edge rollers 163 to elevate the 5-device-in-one base off the ground for moving in the directions of arrows 208-214 (see FIG. 11-FIG. 12); and Capable of being adjusted to retract off the ground and hide completely inside caster chamber 165 for the 5-device-in-one base to sit in a fixed location in the directions of arrows 208-214 (see FIG. 131-FIG. 132).

17) It is yet still another object of an embodiment to provide five-device-in-one arthritic-assisting anti-vibration anti-friction anti-pinching portable elevators, twisting jaws, and uneven base, having 6 separation-preventing double-opposite-ridge-interlocks 157*a* and 6 separation-preventing double-opposite-interpockets 157*b*. Therefore, the five-device-in-one arthritic-assisting anti-vibration anti-friction anti-pinching portable elevators, twisting jaws, and uneven base are: Capable of being independently vertically adjusted to interlock 2 production-increasing cost-saving identical-half-base-bottoms 156 while they sit on 2 different elevations at the same time (for example, sitting on 2 steps of a staircase, on a patio and a step, on a platform and the ground, on a truck be and a truck bumper, etc.) (see FIG. 125-FIG. 130, FIG. 154-FIG. 155, FIG. 299); and Capable of being independently vertically adjusted to interlock 2 production-increasing cost-saving identical-half-base-bottoms 156 while they sit on 2 different elevations at the same time (for example, sitting on a platform and the ground to stabilize the platform) (see FIG. 125-FIG. 130, FIG. 154-FIG. 155, FIG. 299).

18) It is a further object of an embodiment to provide five-device-in-one arthritic-assisting anti-vibration anti-friction anti-pinching portable elevators, twisting jaws, and uneven base, having removable-hidable wrench 175. Therefore, the five-device-in-one arthritic-assisting anti-vibration anti-friction anti-pinching portable elevators, twisting jaws, and uneven base are: Capable of storing and hiding removable-hidable wrench 175 inside crank core 174 for a user to adjust adjustable-hidable angle-operated caster 166 at any time at any location (see FIG. 185-FIG. 195); and Capable of hiding and storing removable-hidable wrench 175 inside 2 production-increasing cost-saving identical-half-base-bottoms 156 to eliminate tripping and personal injuries (see FIG. 121, FIG. 122, and FIG. 304).

19) It is another further object of an embodiment to provide five-device-in-one arthritic-assisting anti-vibration anti-friction anti-pinching portable elevators, twisting jaws, and uneven base, having 6 angle-operated edge rollers 163. Therefore, the five-device-in-one arthritic-assisting anti-vibration anti-friction anti-pinching portable elevators, twisting jaws, and uneven base are: Capable of tiltedly working together with adjustable-hidable angle-operated caster 166 when tilted by the tilting adjustment of adjustable-hidable angle-operated caster 166 to mutually elevate the 5-device-in-one base off the ground for moving in the directions of arrows 208-214 (see FIG. 131, FIG. 132, FIG. 163-FIG. 167); and Capable of adjustably staying off the ground for the 5-device-in-one base to sit in a fixed location in the directions of arrows 208-214 (see FIG. 131, FIG. 132, FIG. 163-FIG. 167).

20) It is still another further object of an embodiment to provide five-device-in-one arthritic-assisting anti-vibration anti-friction anti-pinching portable elevators, twisting jaws, and uneven base, having crank-storing extra-umbrella-pole-locking hole 152. Therefore, the five-device-in-one arthritic-assisting anti-vibration anti-friction anti-pinching portable elevators, twisting jaws, and uneven base: Capable of storing and hiding deployable-hidable crank-and-bolt-lock system 170 inside crank-storing extra-umbrella-pole-locking hole 152 for a user to adjust adjustable-hidable angle-operated caster 166 at any time at any location in the direction of arrow 206 (see FIG. 121-FIG. 124, FIG. 294); and Capable of hiding and storing deployable-hidable crank-and-bolt-lock system 170 inside 2 production-increasing cost-saving identical-half-base-bottoms 156 to eliminate tripping and personal injuries in the direction of arrow 206 (see FIG. 121 FIG. 124, FIG. 294).

In an example embodiment, the five-device-in-one arthritic-assisting anti-vibration anti-friction anti-pinching portable elevators, twisting jaws, and uneven base (for being adapted to umbrella post, hand rail, sail pole, awning arm, and pergola column, and for being capable of functioning as uneven-step supporter, uneven-surface supporter, patio bolt-locker, platform stabilizer, and weight base) comprise: Arthritic-assisting anti-vibration anti-friction anti-pinching track system, Arthritic-assisting anti-vibration anti-friction anti-pinching portable-elevator system, Anti-slipping anti-cracking opposite-twisting-jaw system, Multi-elevation twistable-tube system, Anti-crack reinforcing twistable-rib system, Multi-application pivoting-connector system, Opposite-twisting-jaw-housing tunnel system, Production-increasing cost-saving identical-half-base-top system, Production-increasing cost-saving identical-half-base-bottom system, Adjustable-hidable angle-operated caster system; and Deployable-hidable crank-and-bolt-lock system.

Component

Figure 1A:
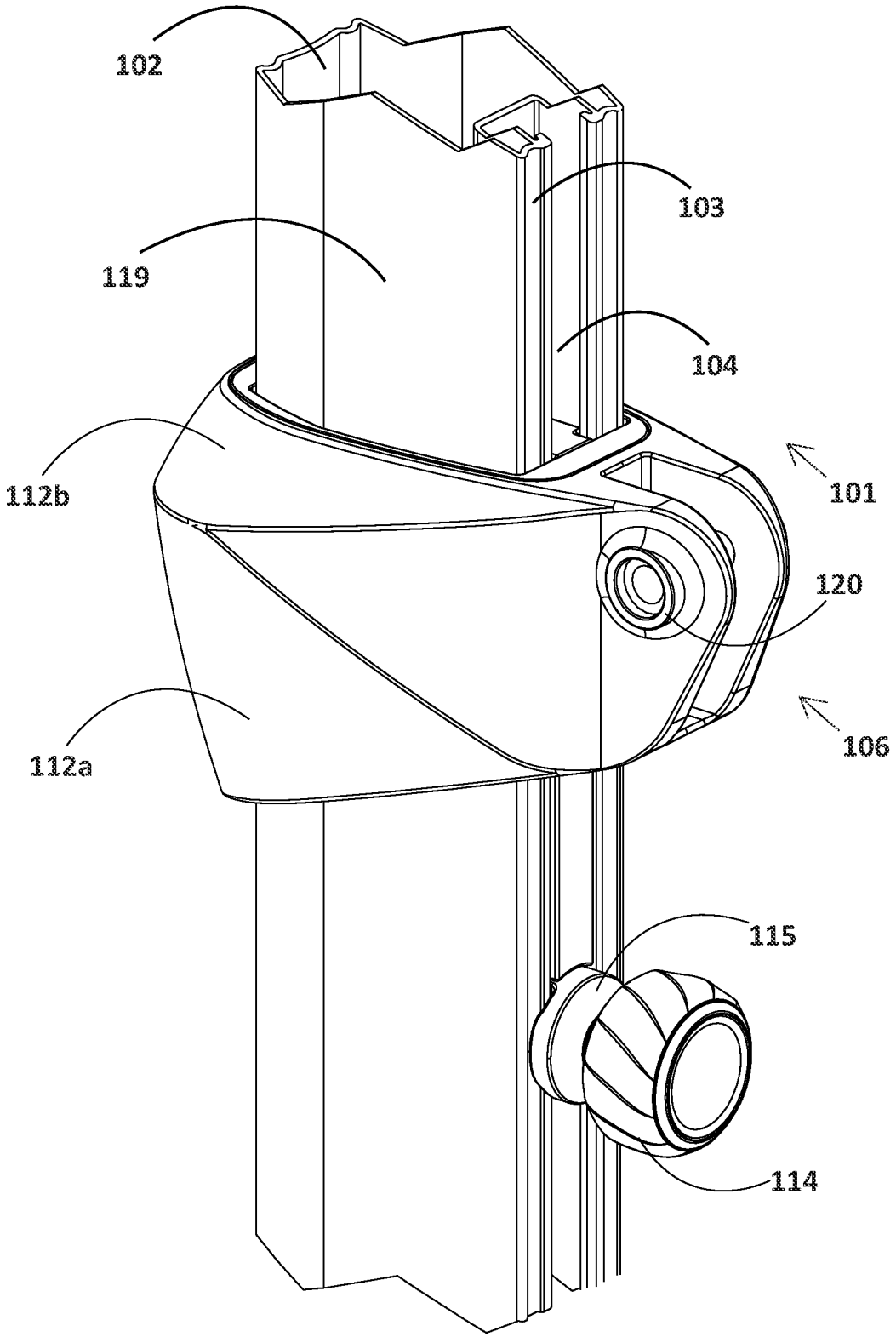
FIG. 1A-FIG. 39 are diagrams illustrating perspective, top, and side views demonstrating components and the assembly of arthritic-assisting anti-vibration anti-friction anti-pinching portable-elevator system 106.
Figure 1B:
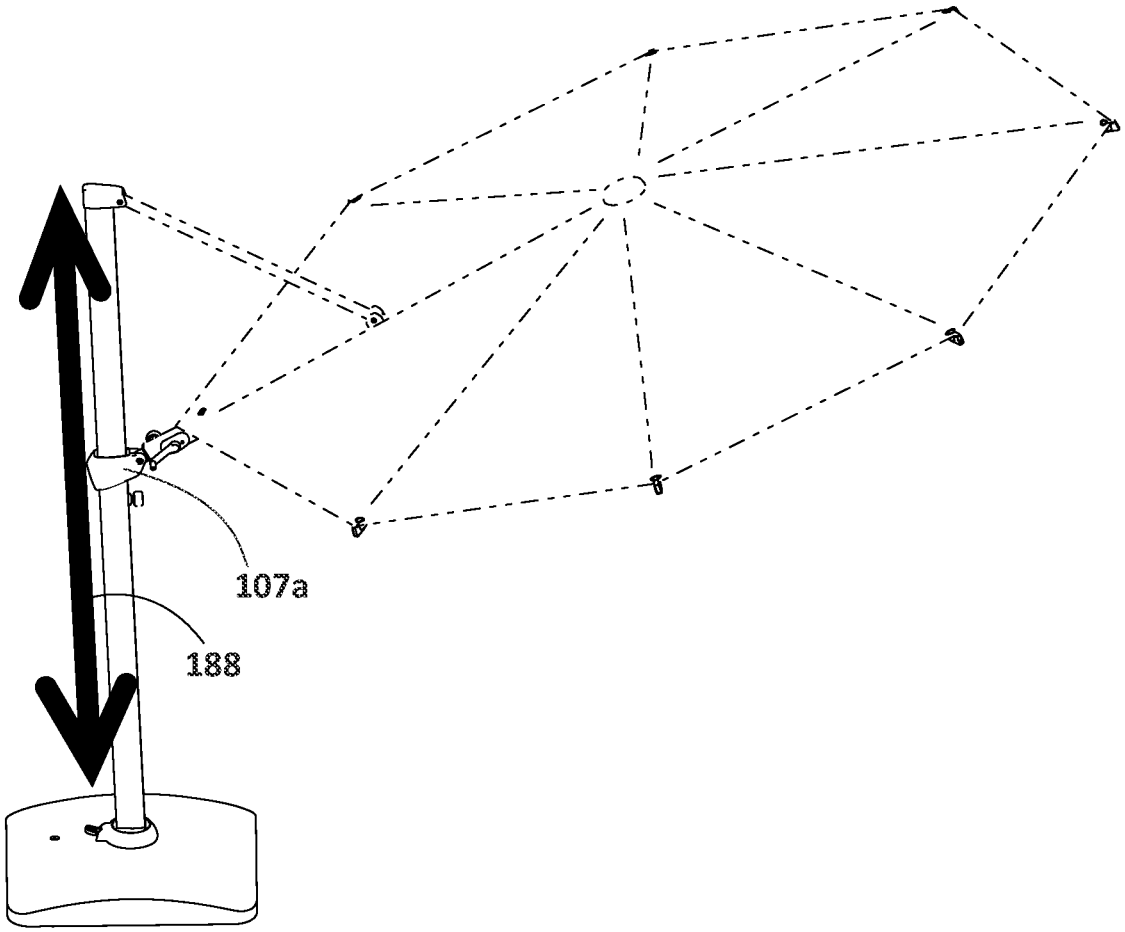
Figure 1C:
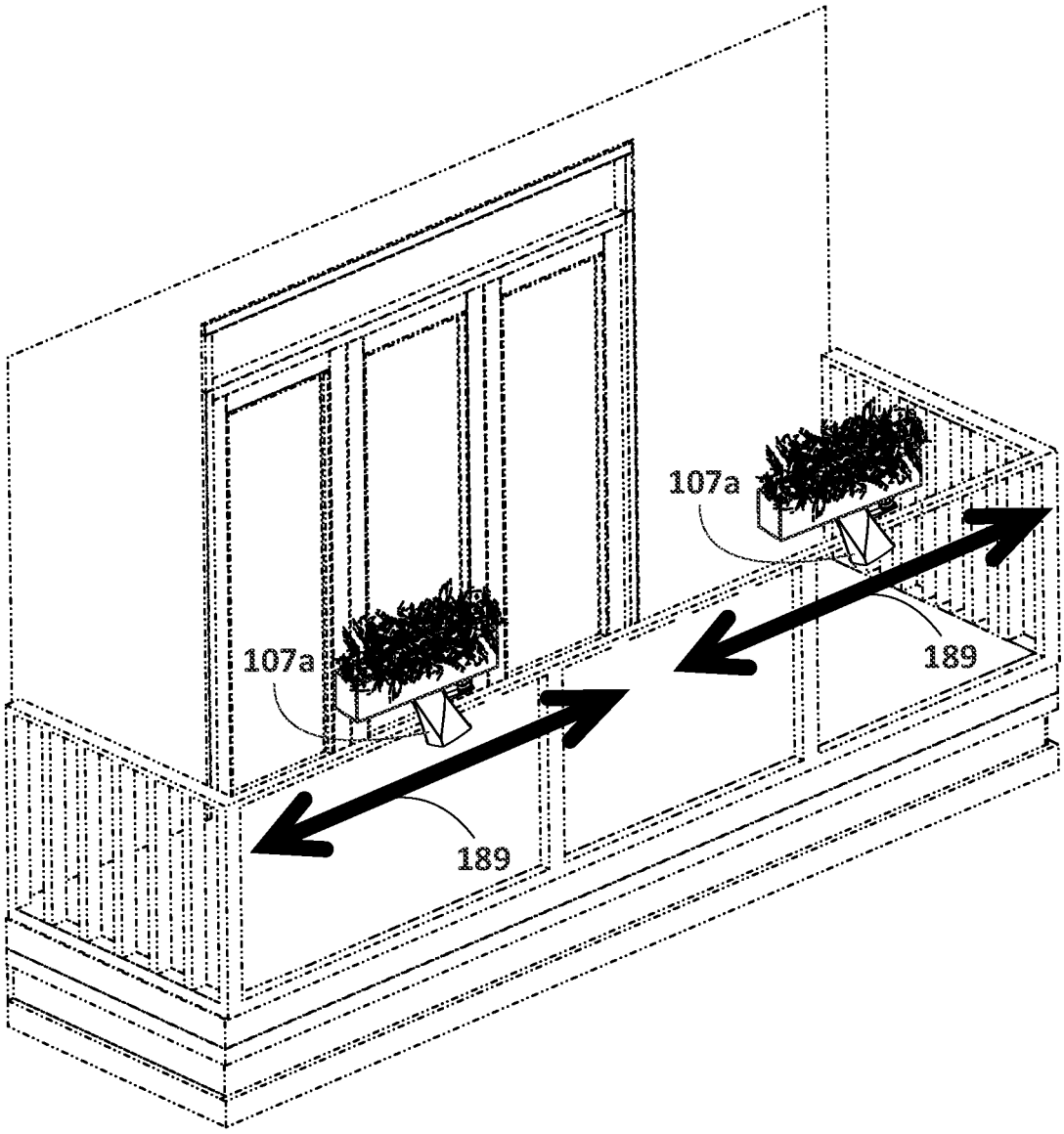
Figure 1D:
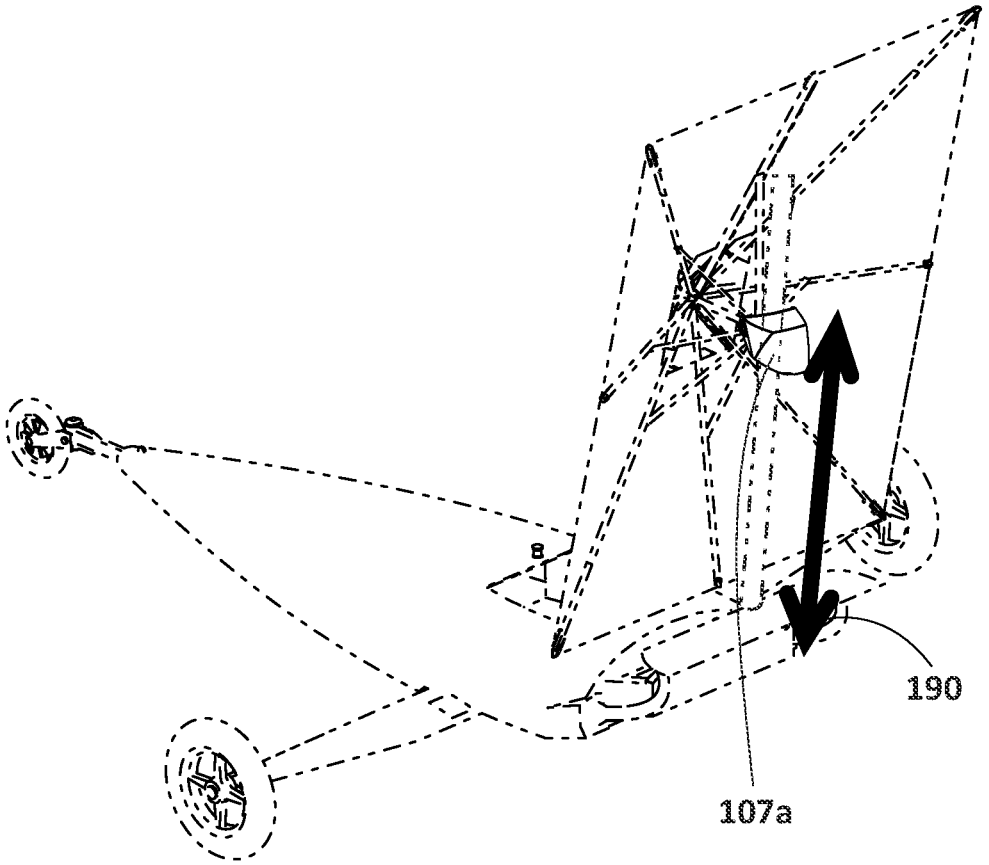
Figure 1E:
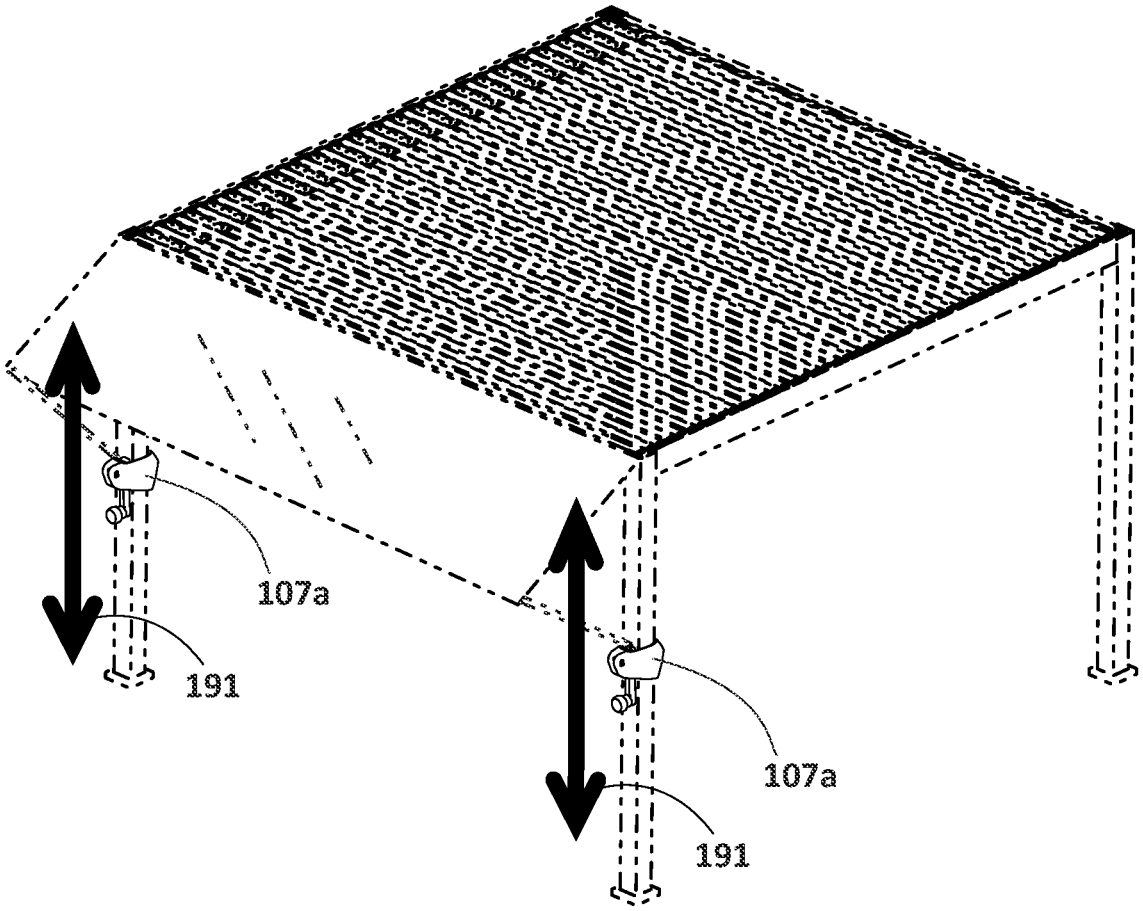
Figure 1F:
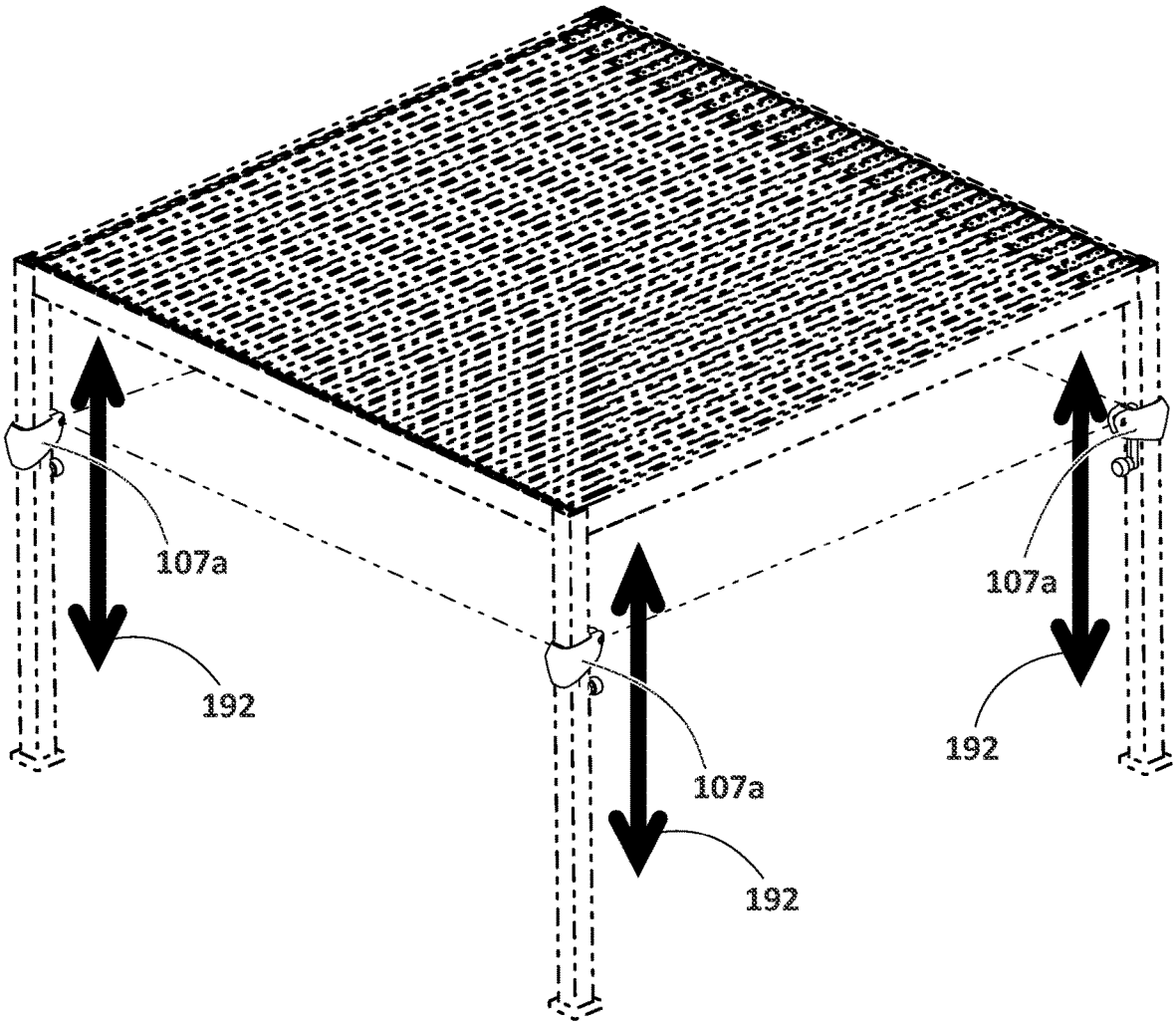
Figure 206:
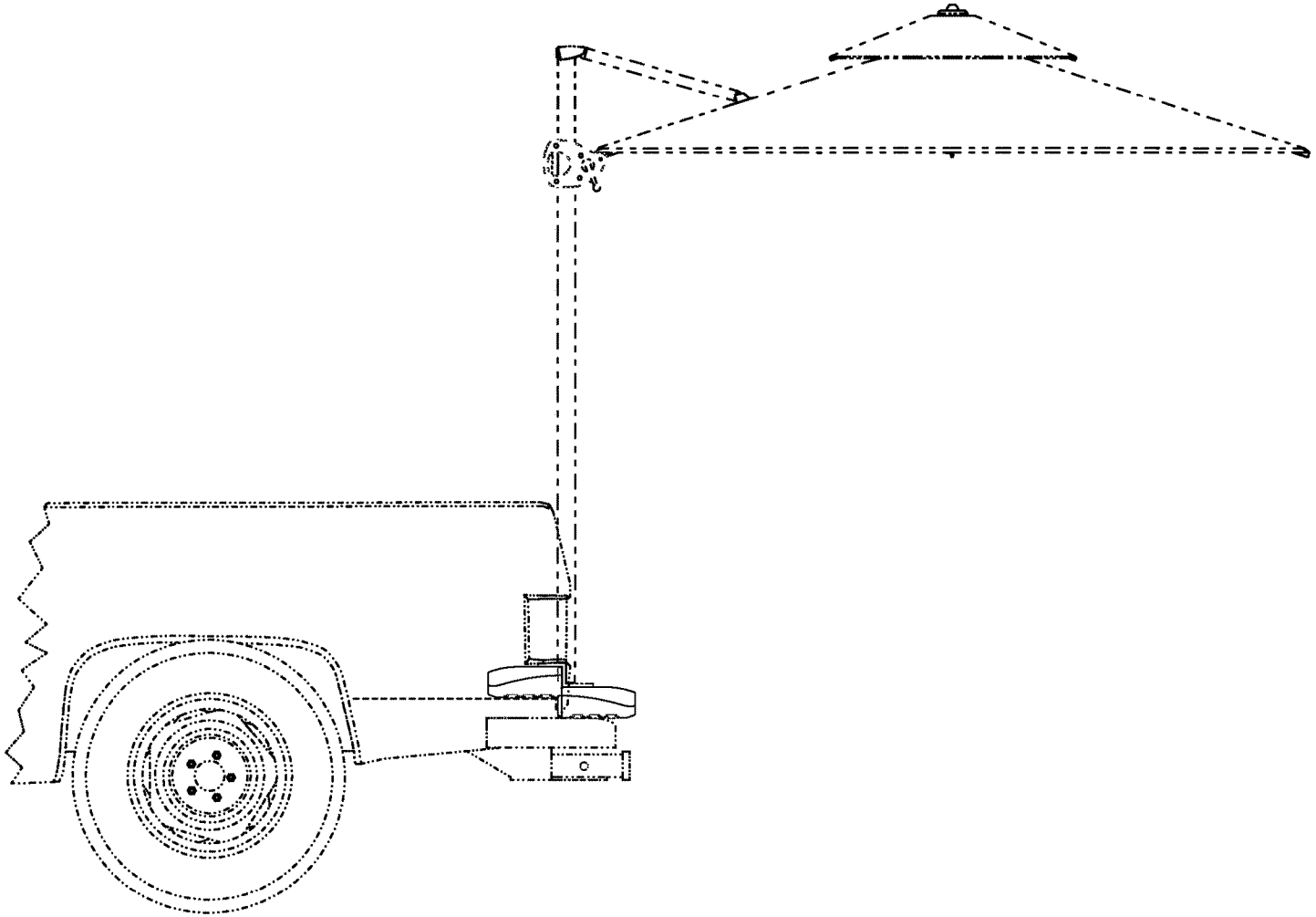
Figure 207:
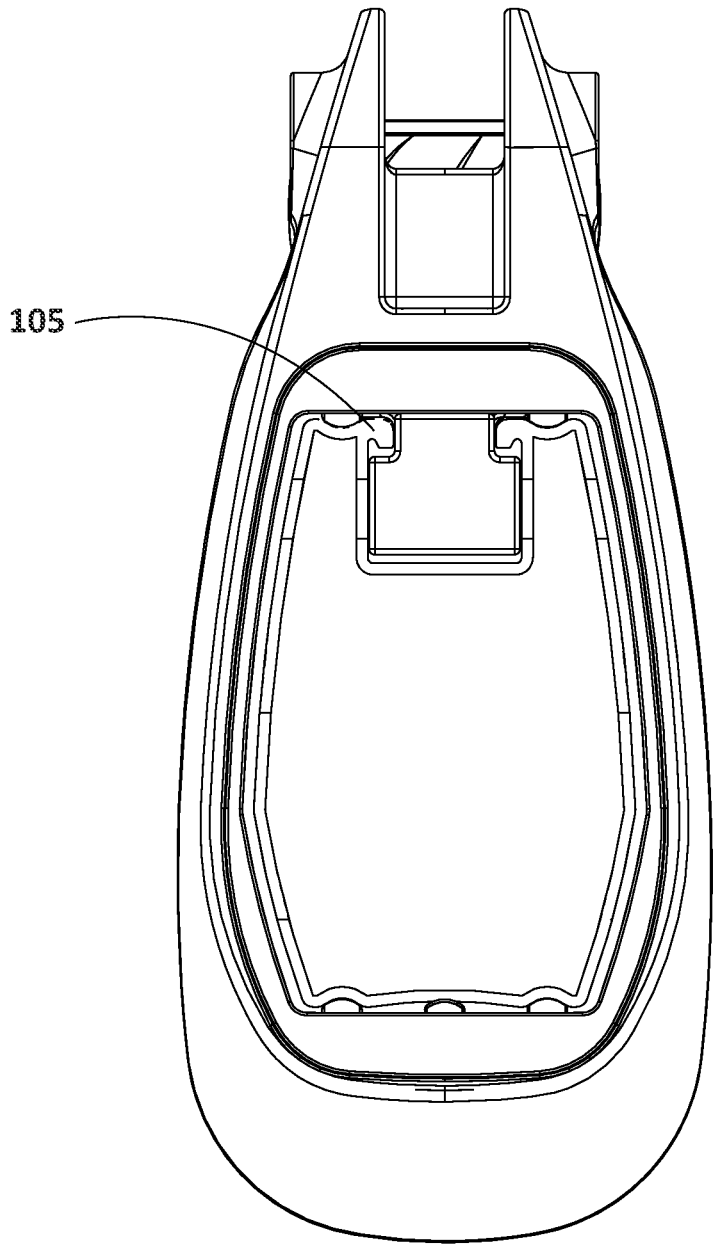
FIG. 207-FIG. 239 are diagrams illustrating perspective views of equivalent variations the five-device-in-one arthritic-assisting anti-vibration anti-friction anti-pinching portable elevators.
Figure 208:
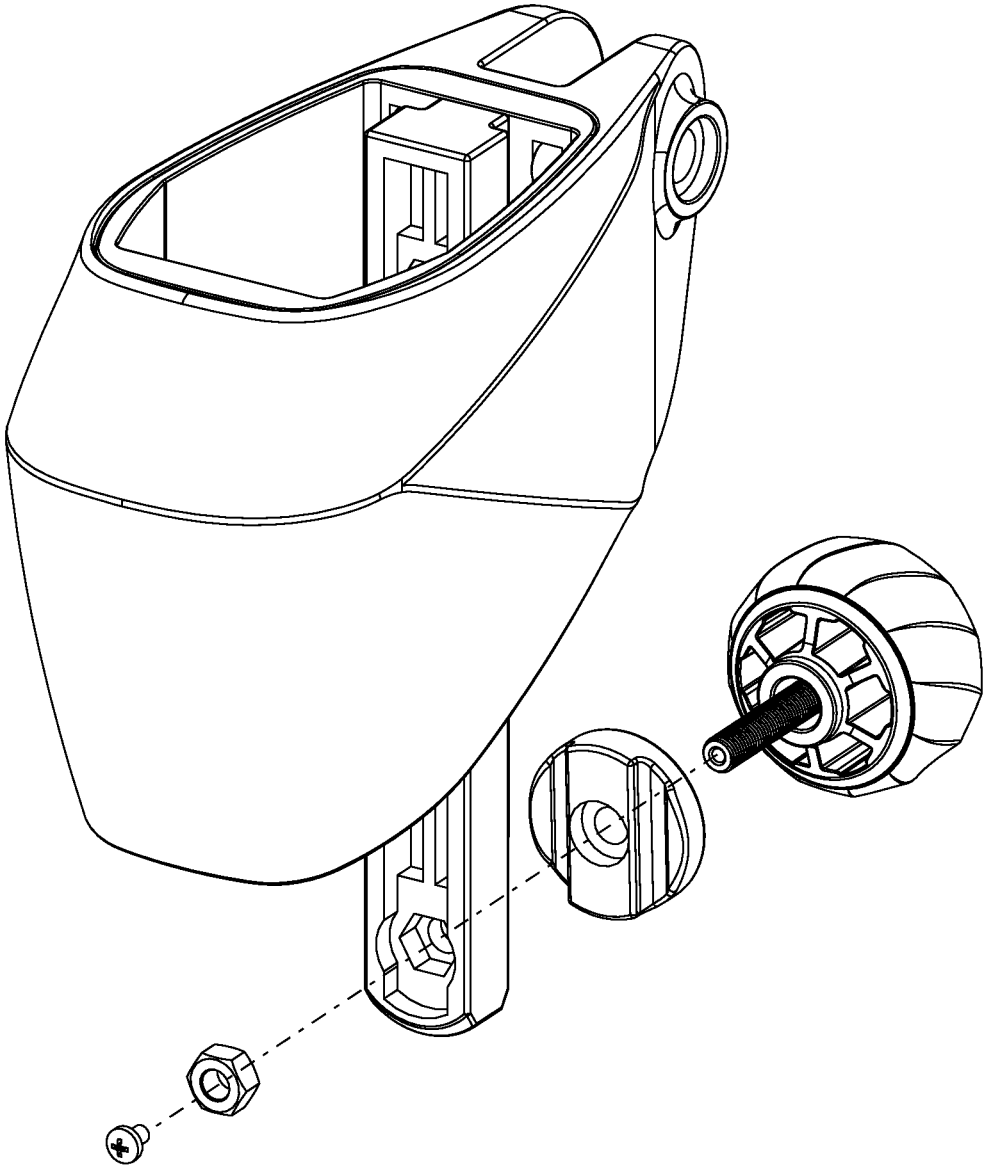
Figure 209:
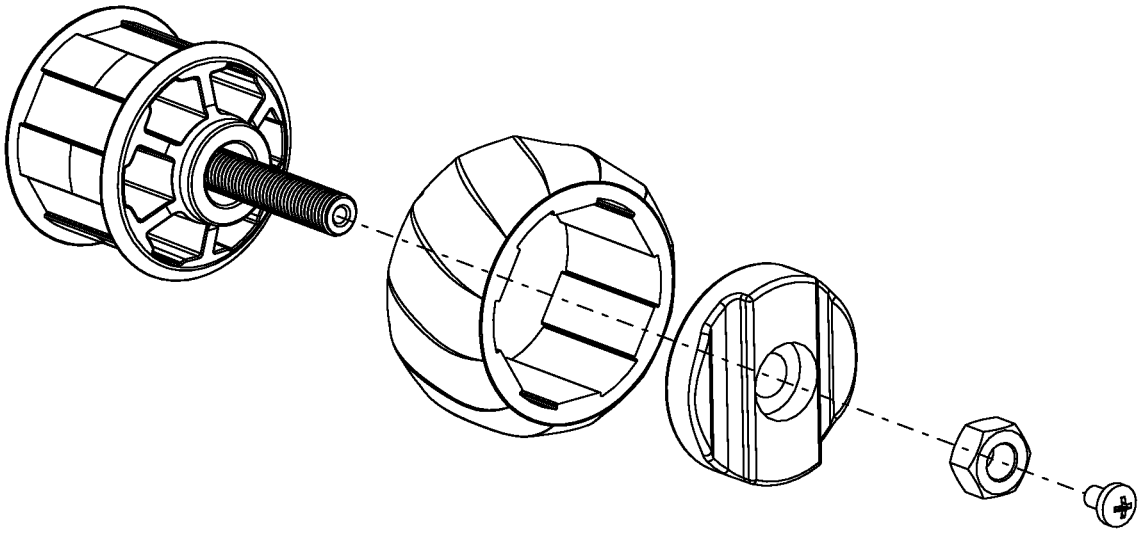
Figure 210:
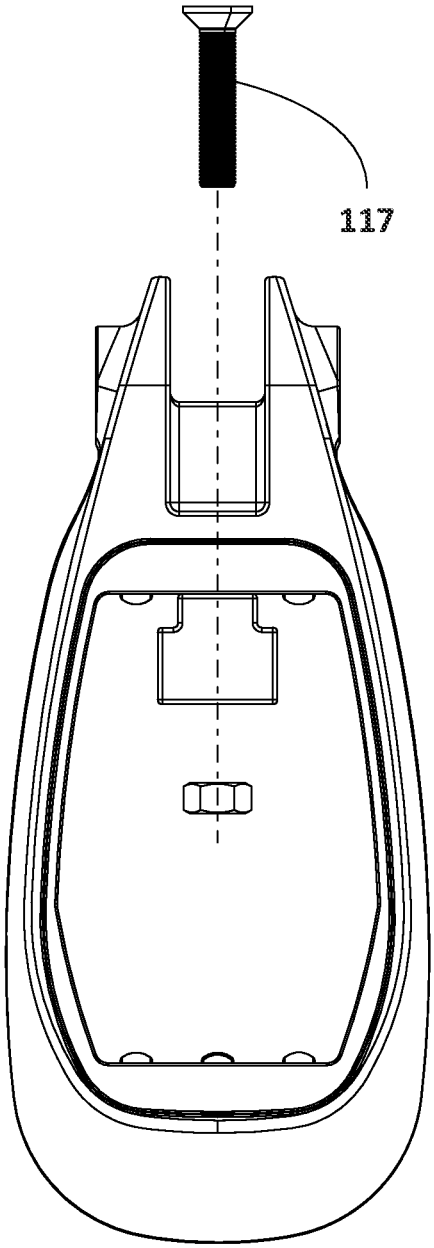
Figure 211:
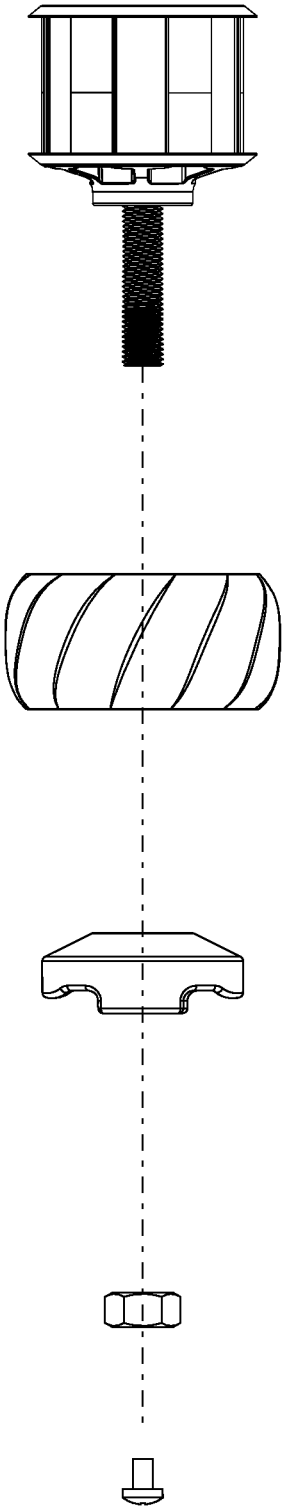
Figure 212:
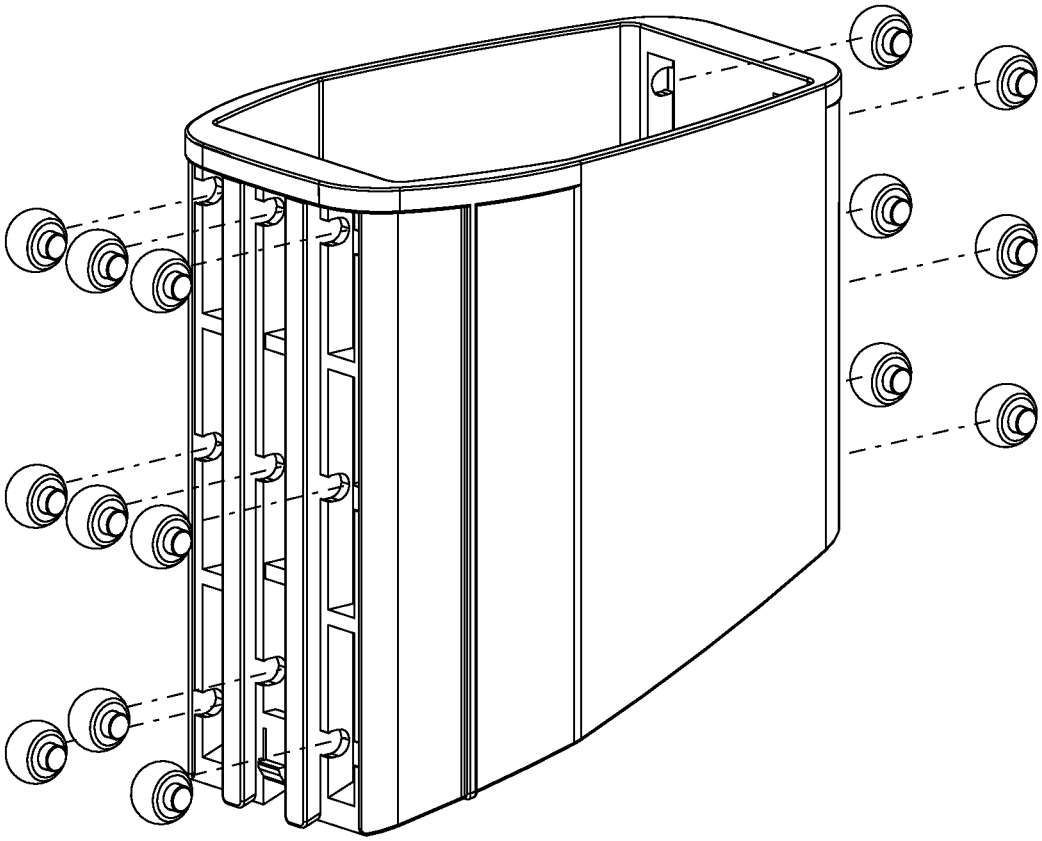
Figure 213:
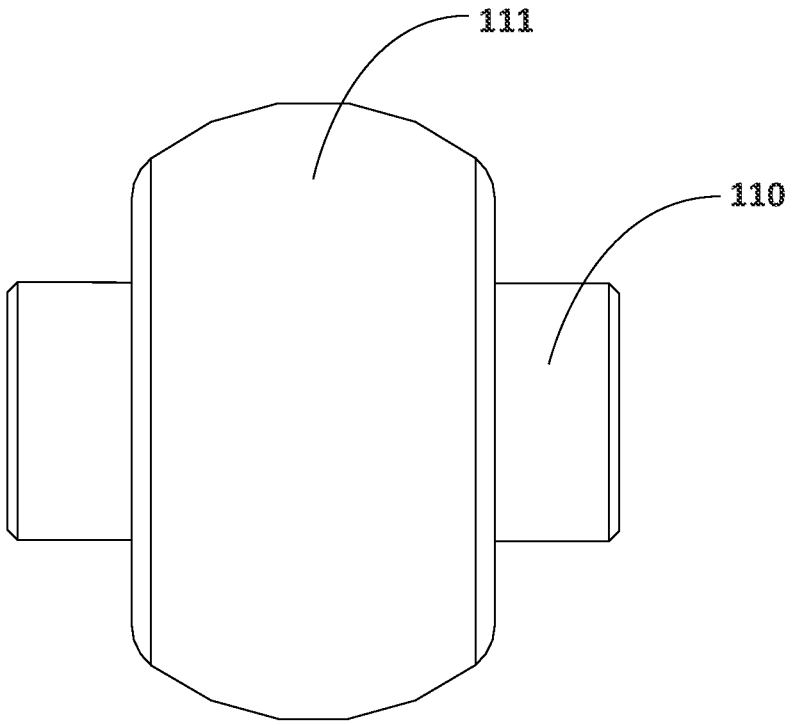
Figure 214:
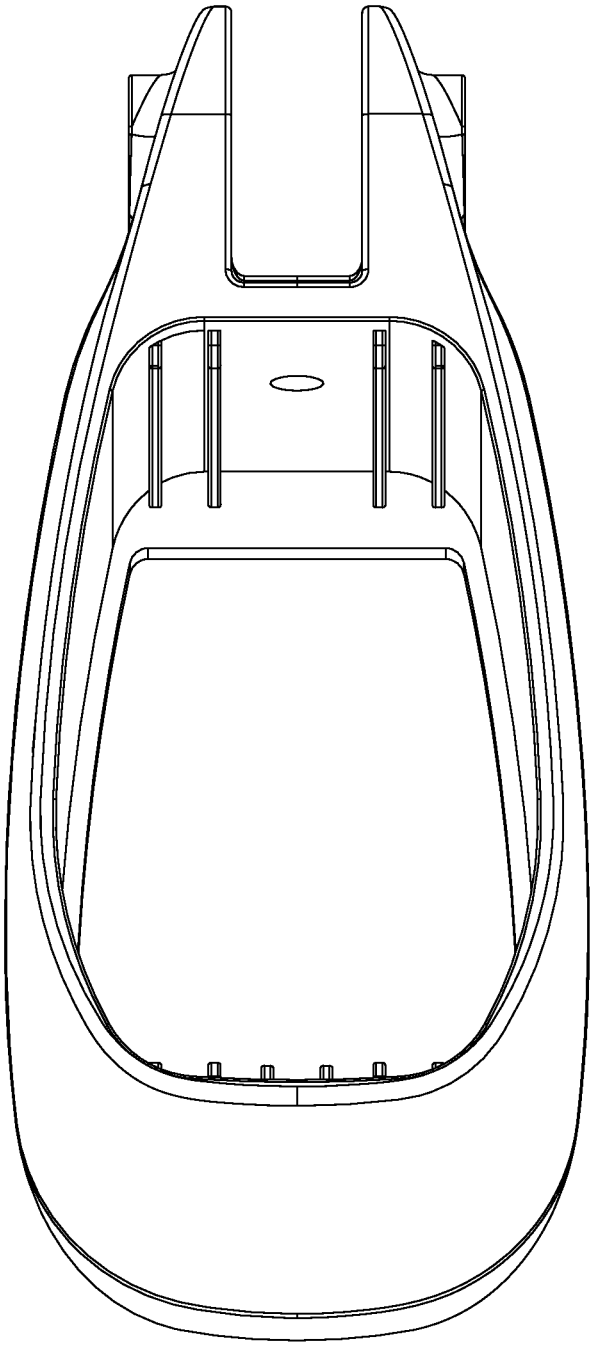
Figure 215:
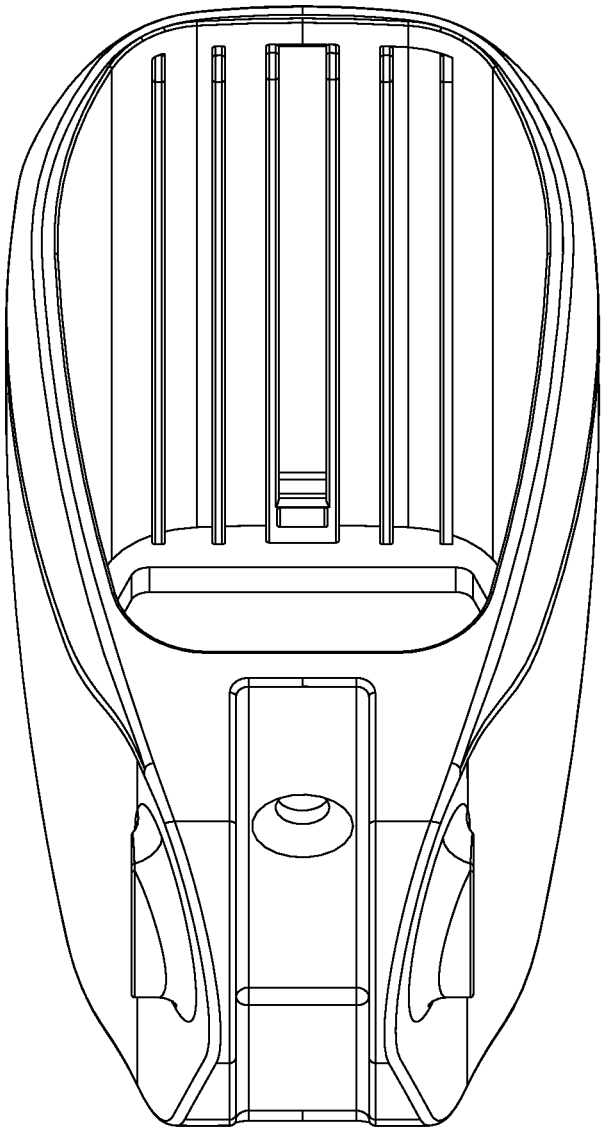
Figure 216:
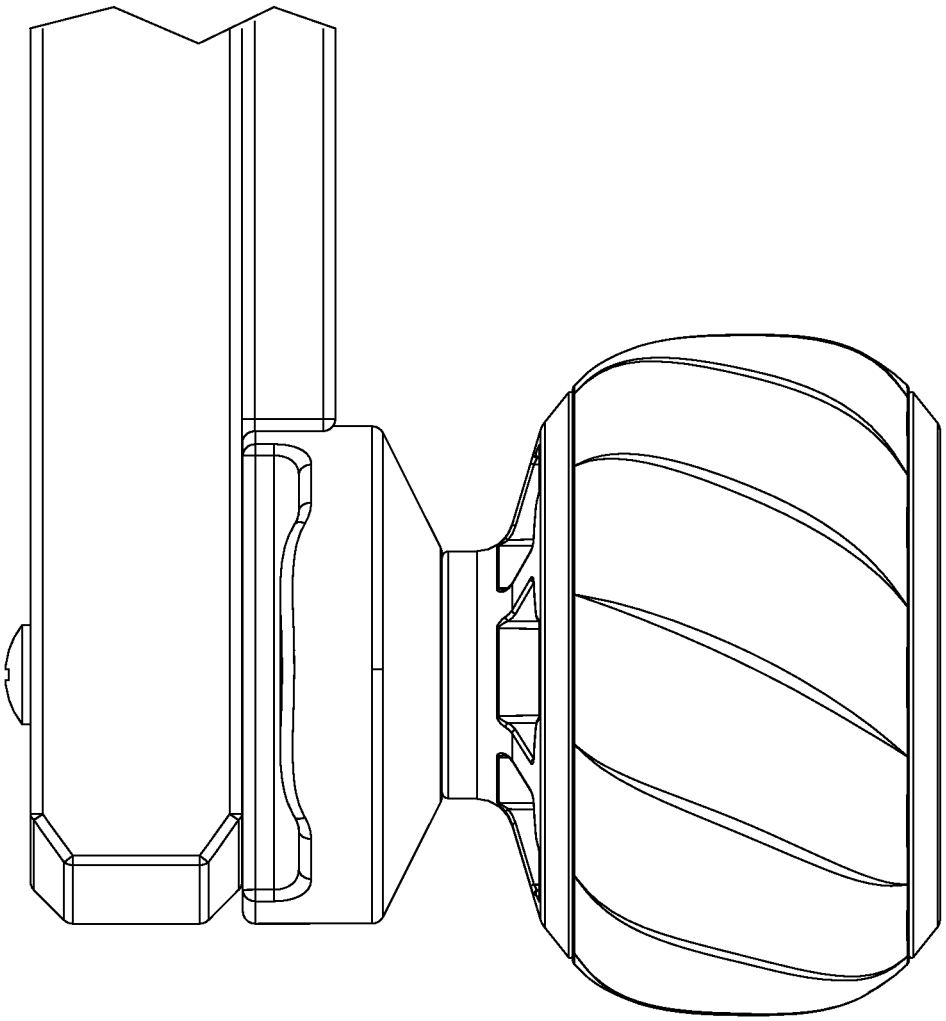
Figure 217:
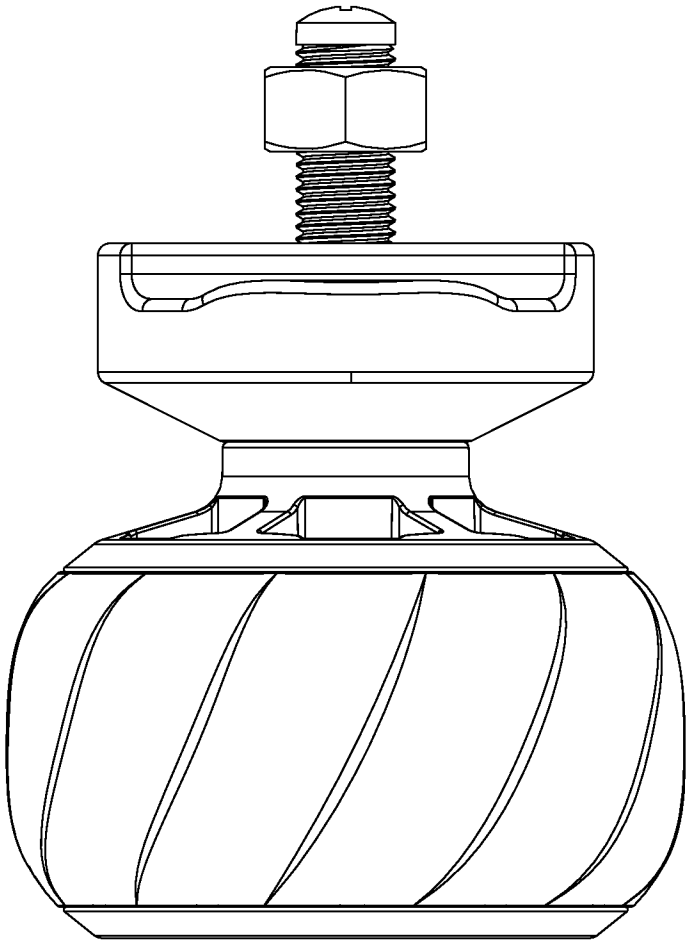
Figure 218:
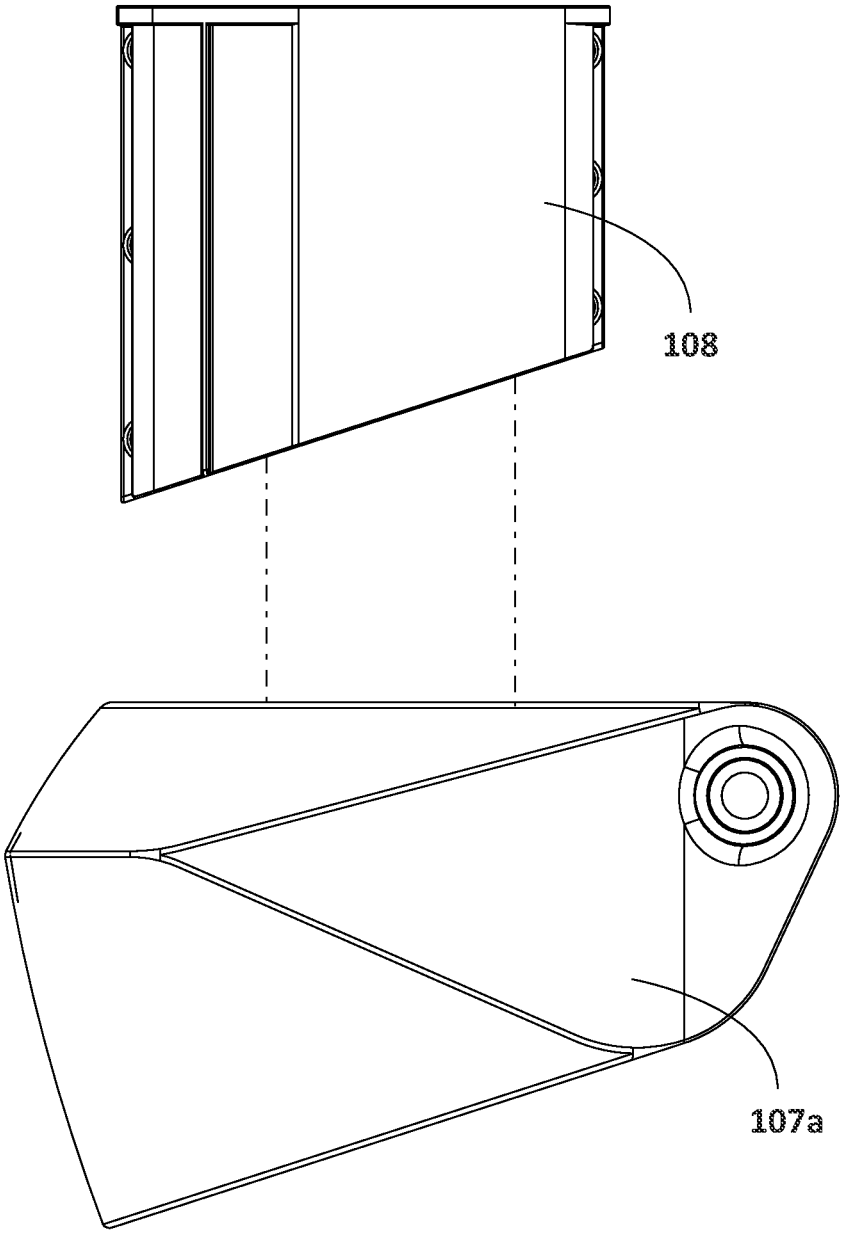
Figure 219:
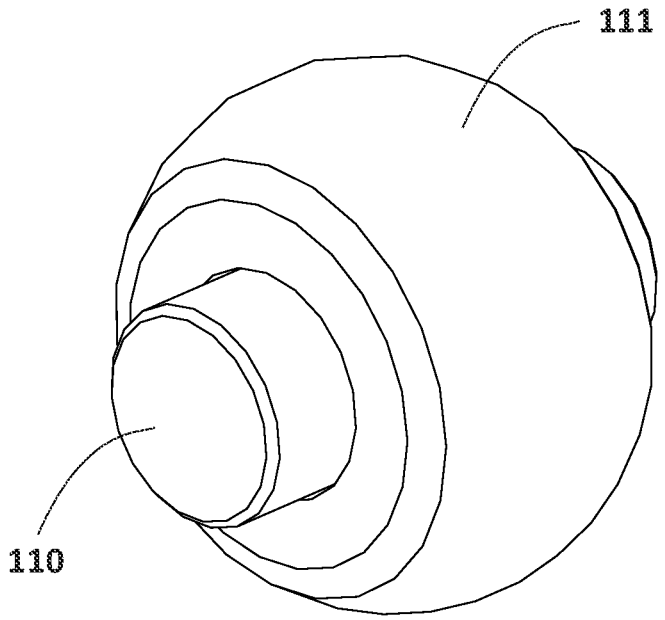
Figure 220:
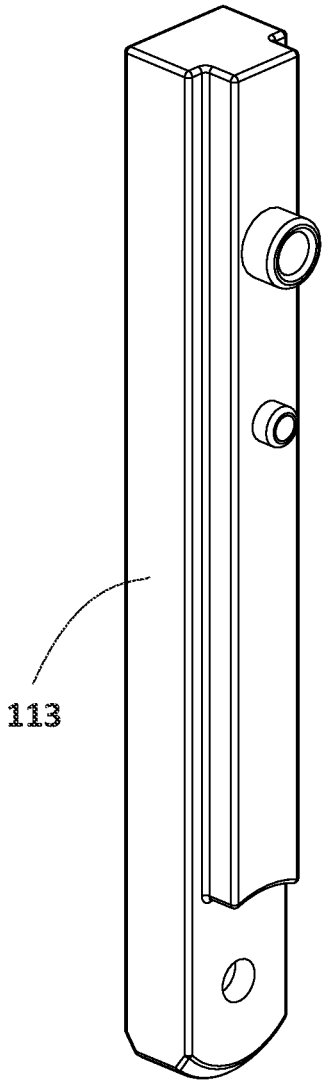
Figure 221:
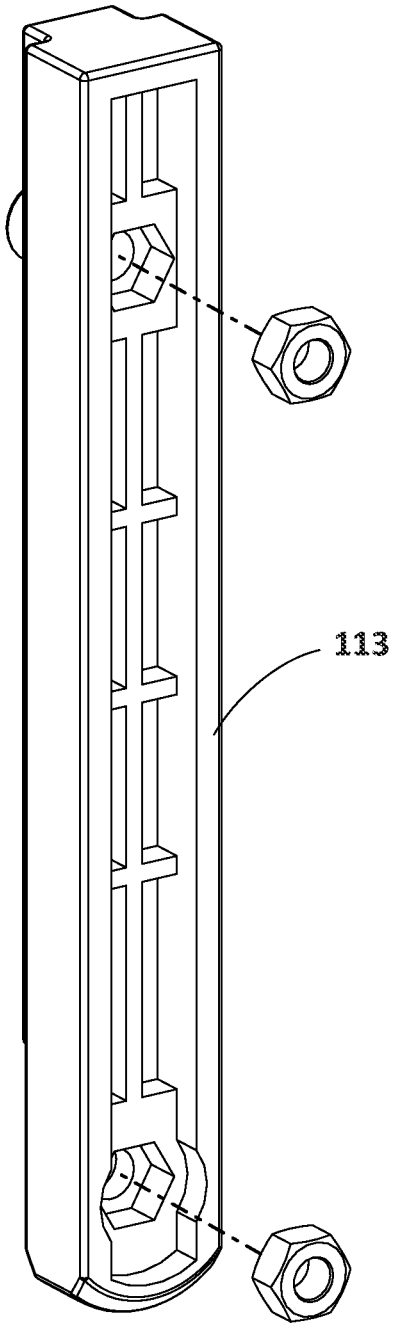
Figure 222:
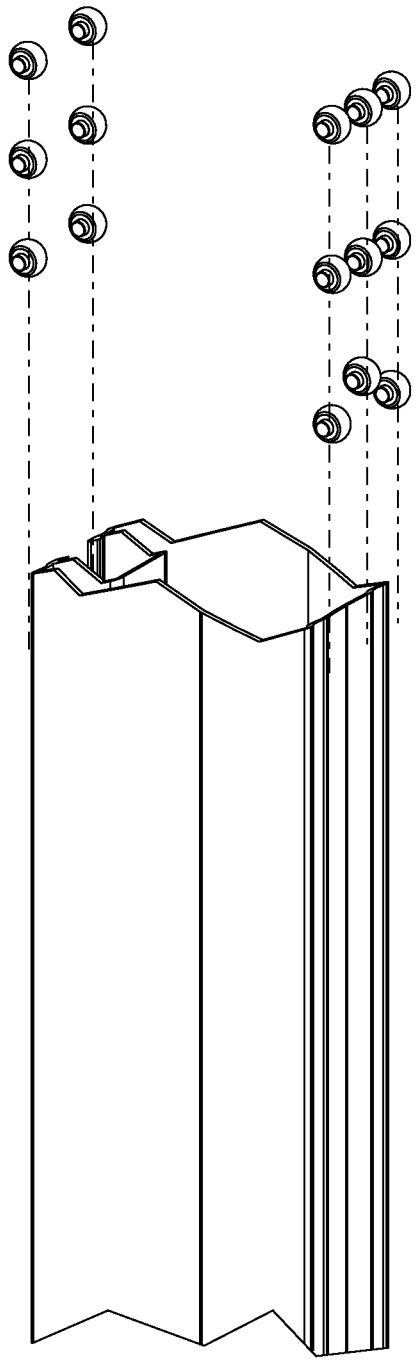
Figure 223:
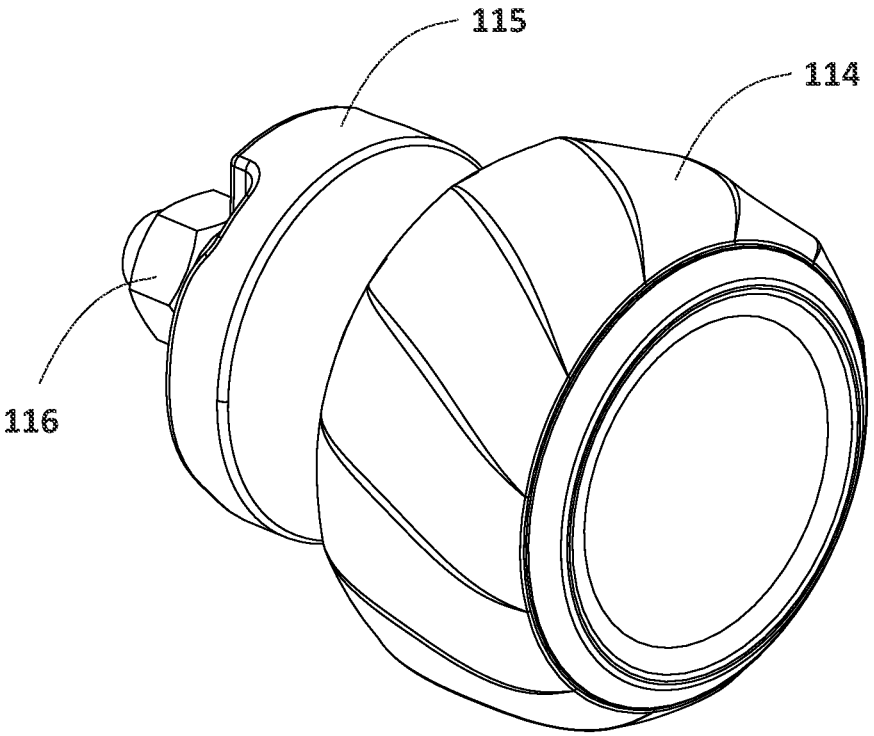
Figure 224:
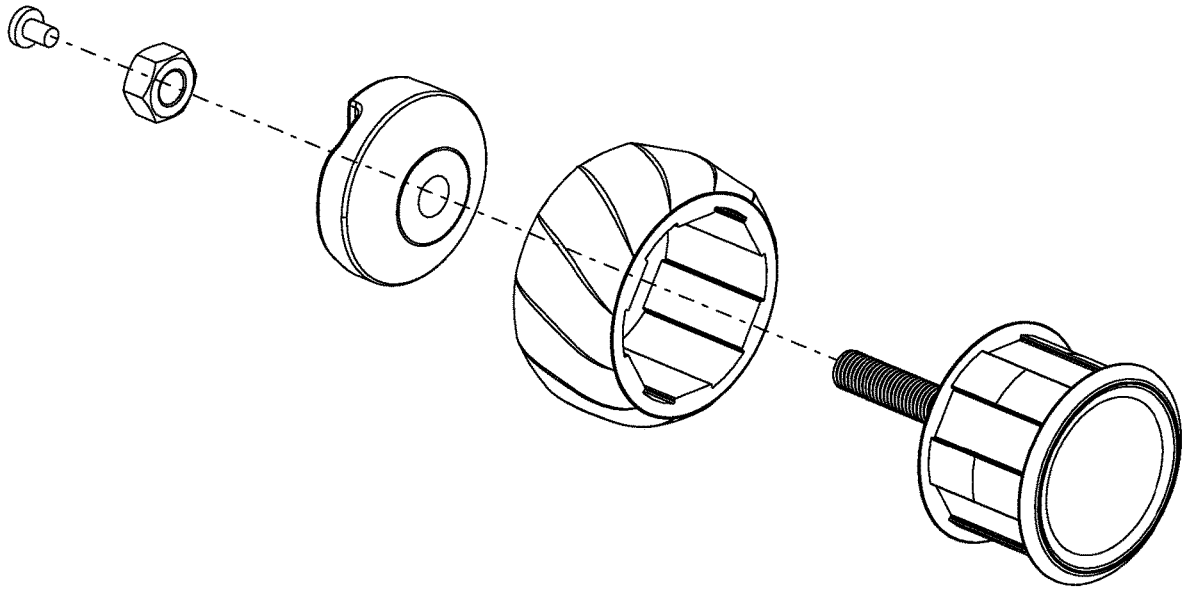
Figure 225:
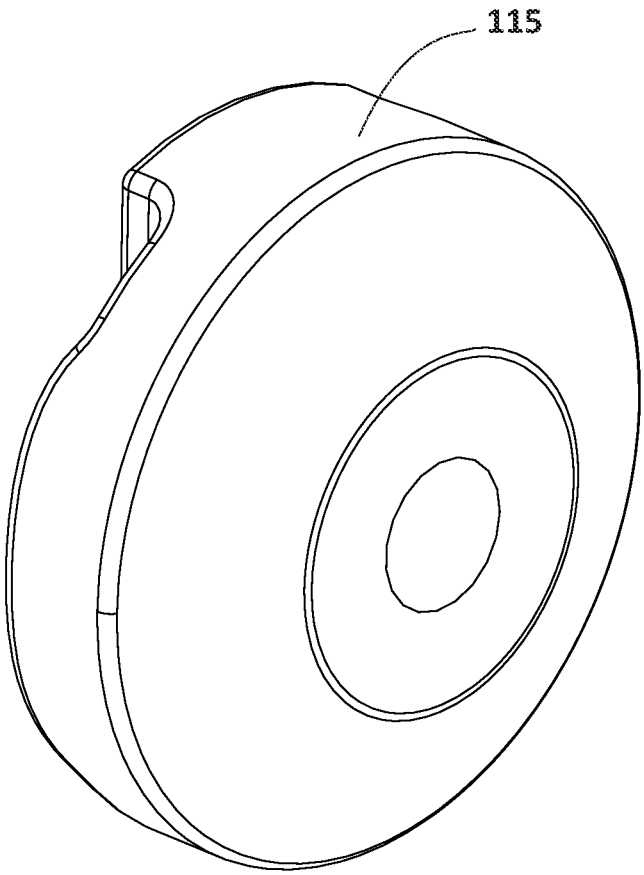
Figure 226:
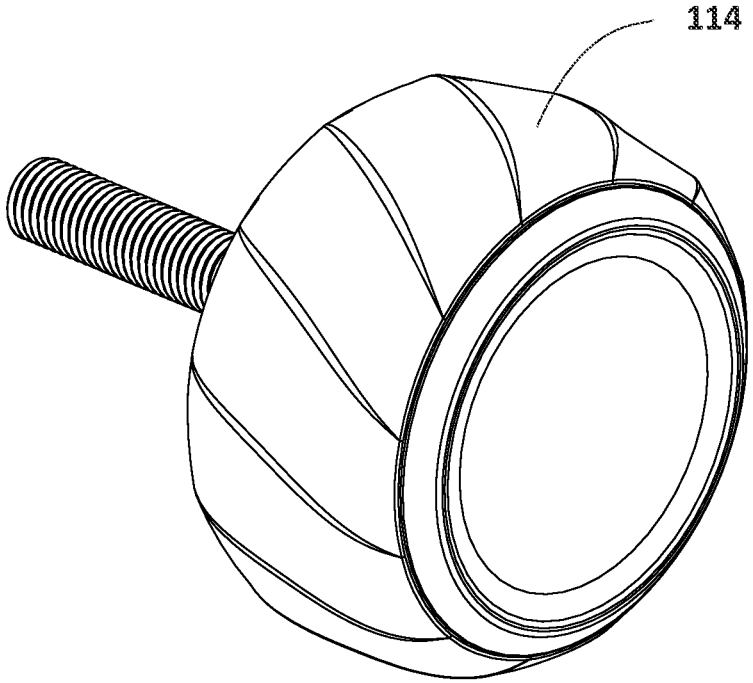
Figure 227:
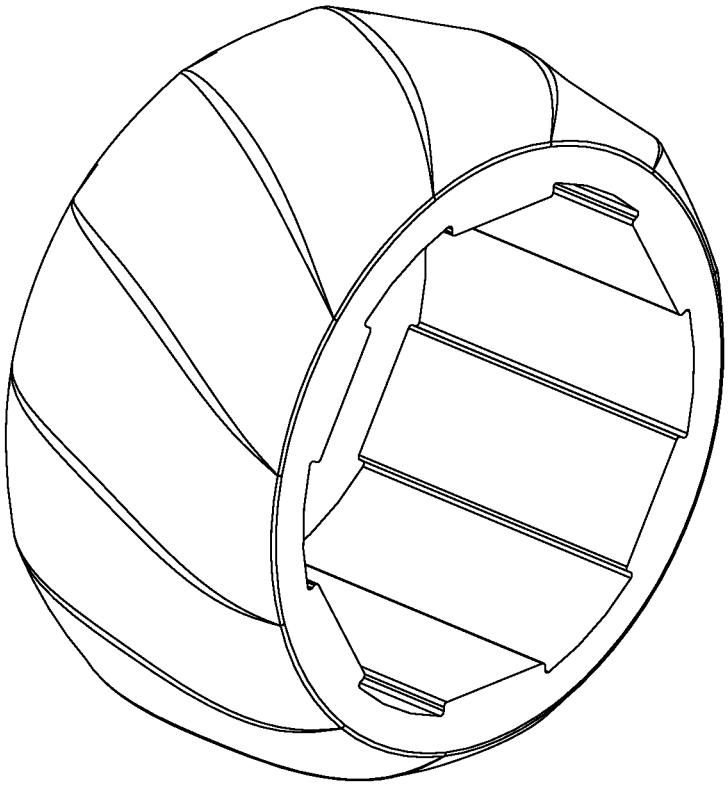
Figure 228:
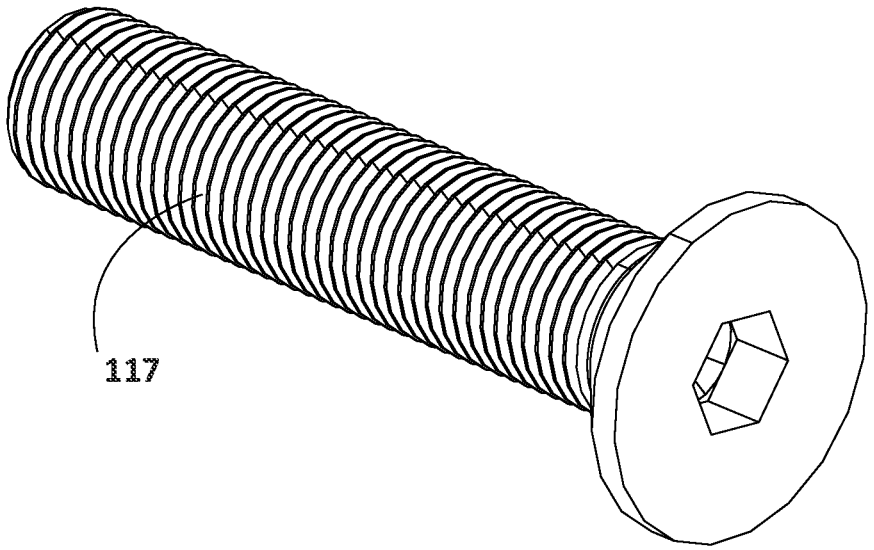
Figure 229:
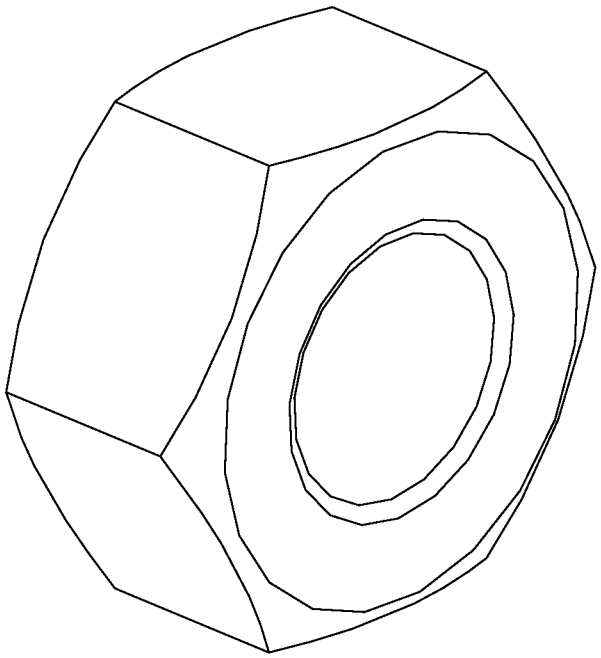
Figure 230:
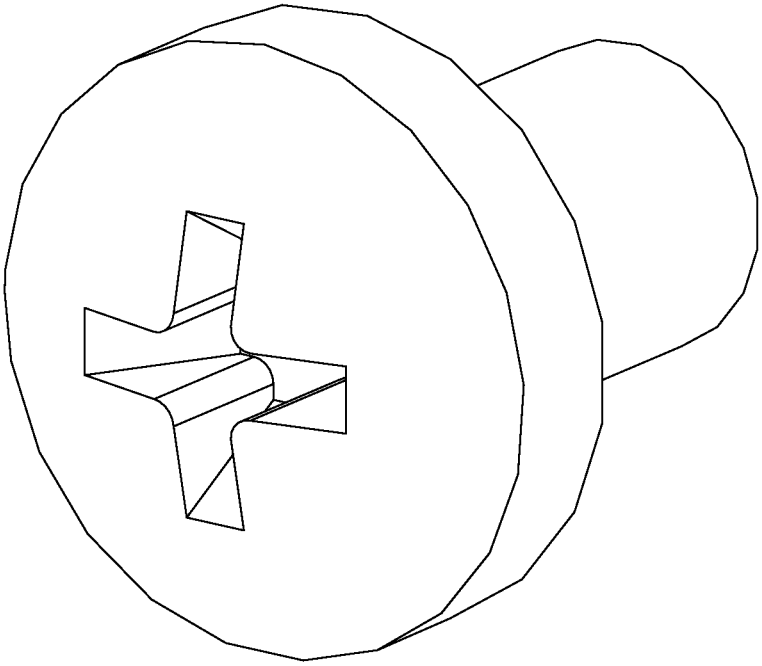
Figure 231:
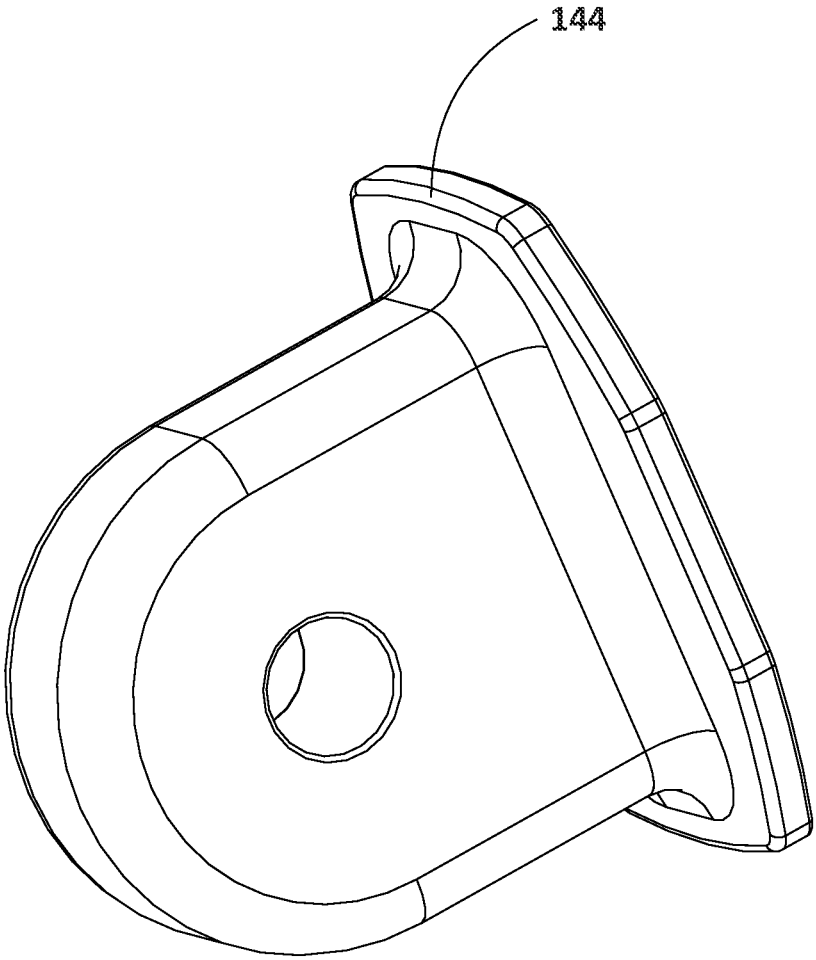
Figure 232:
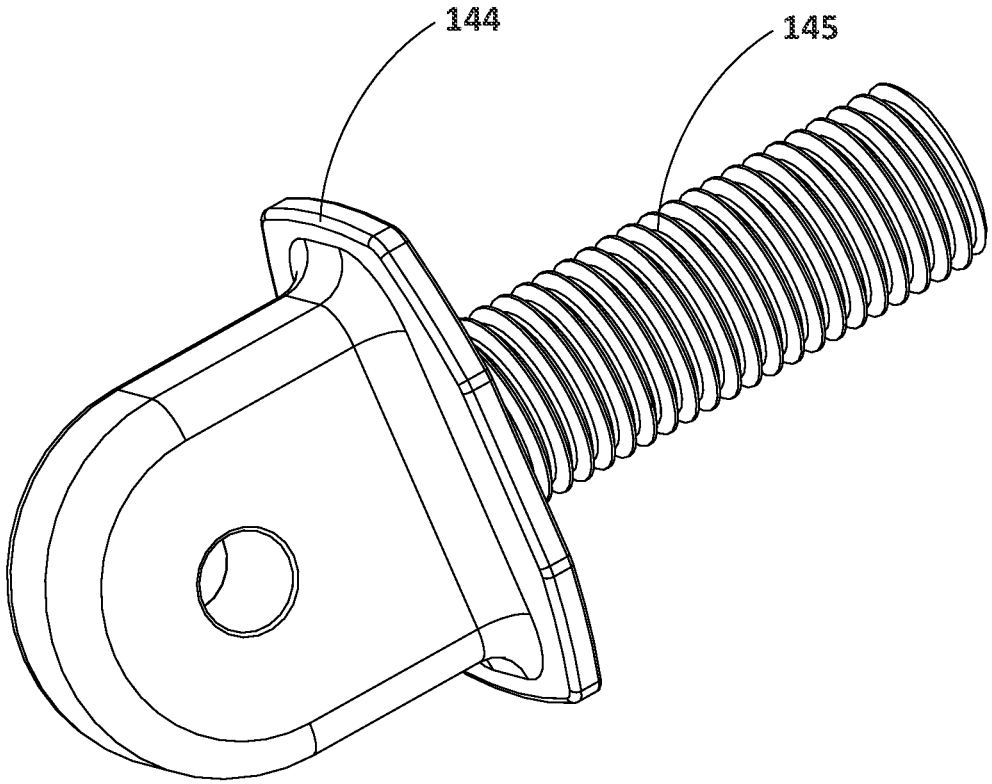
Figure 233:
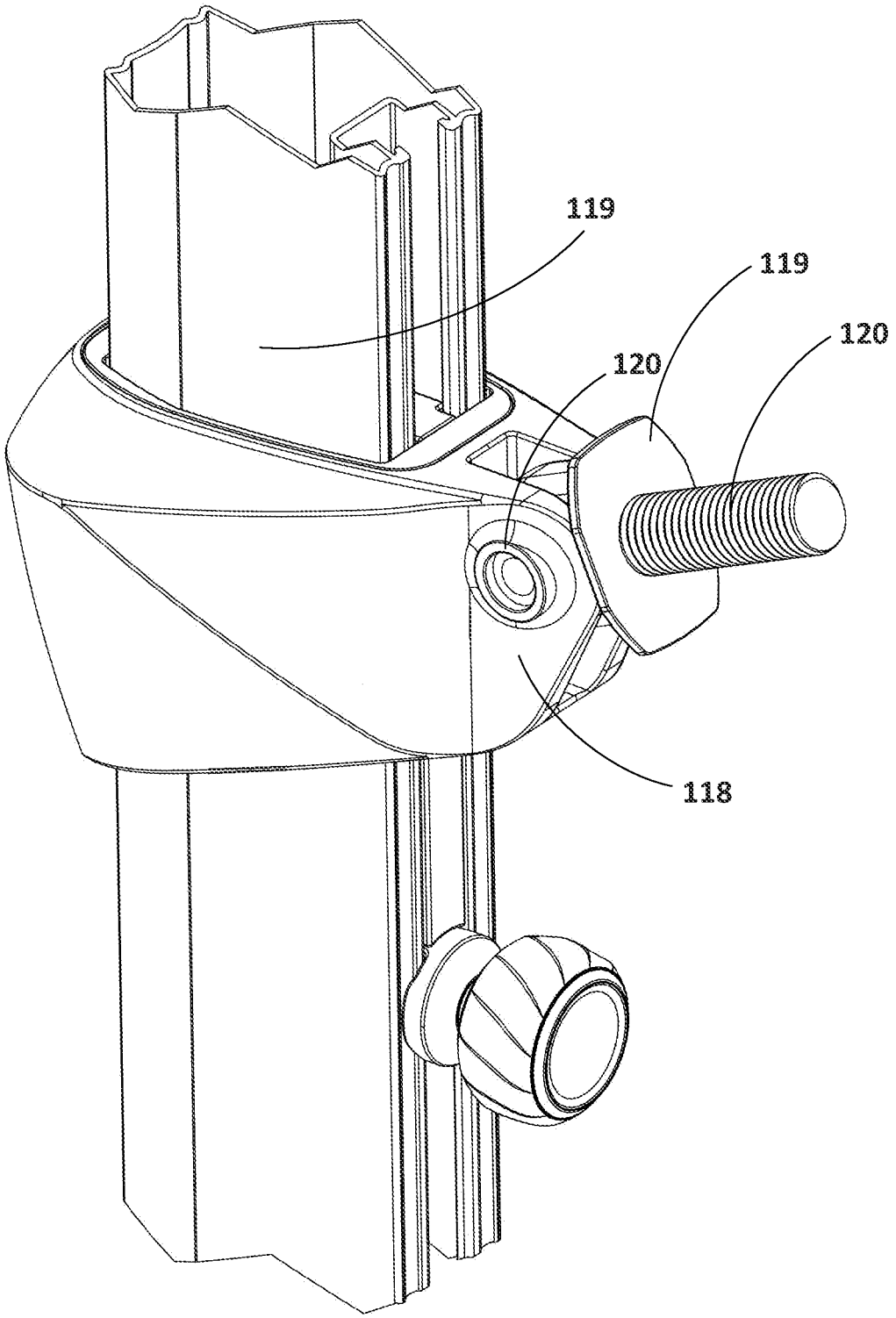
Figure 234:
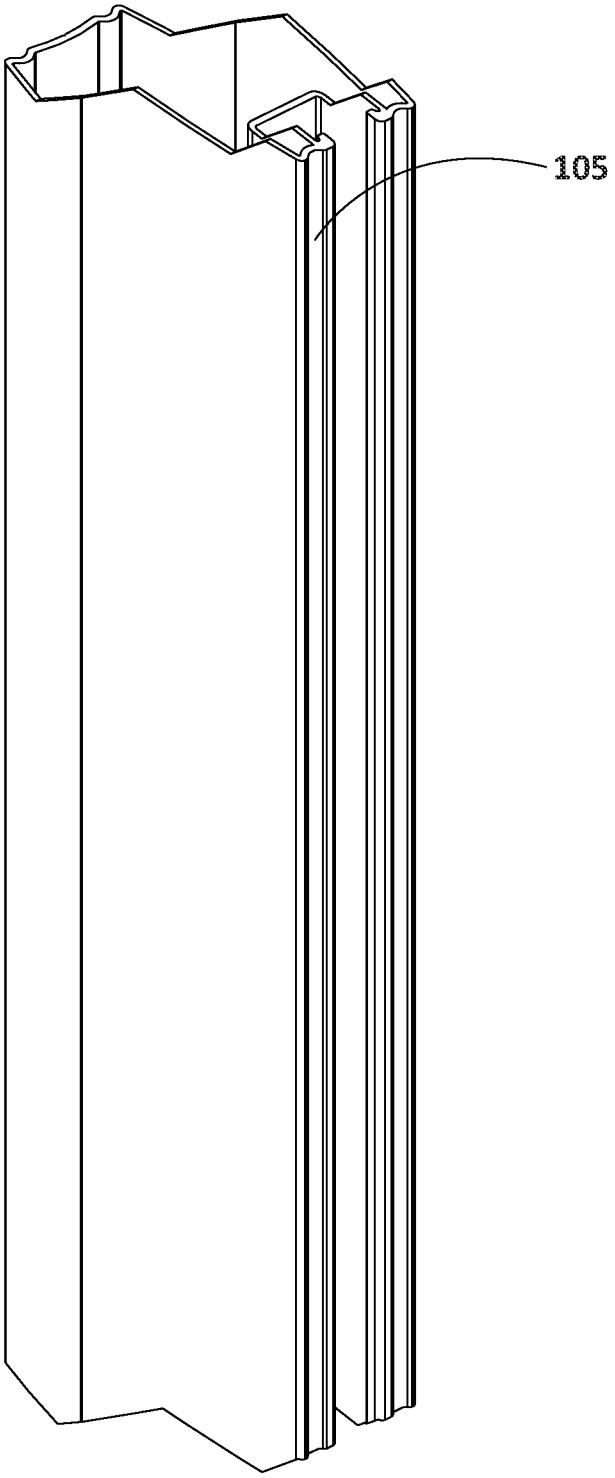
Figure 235:
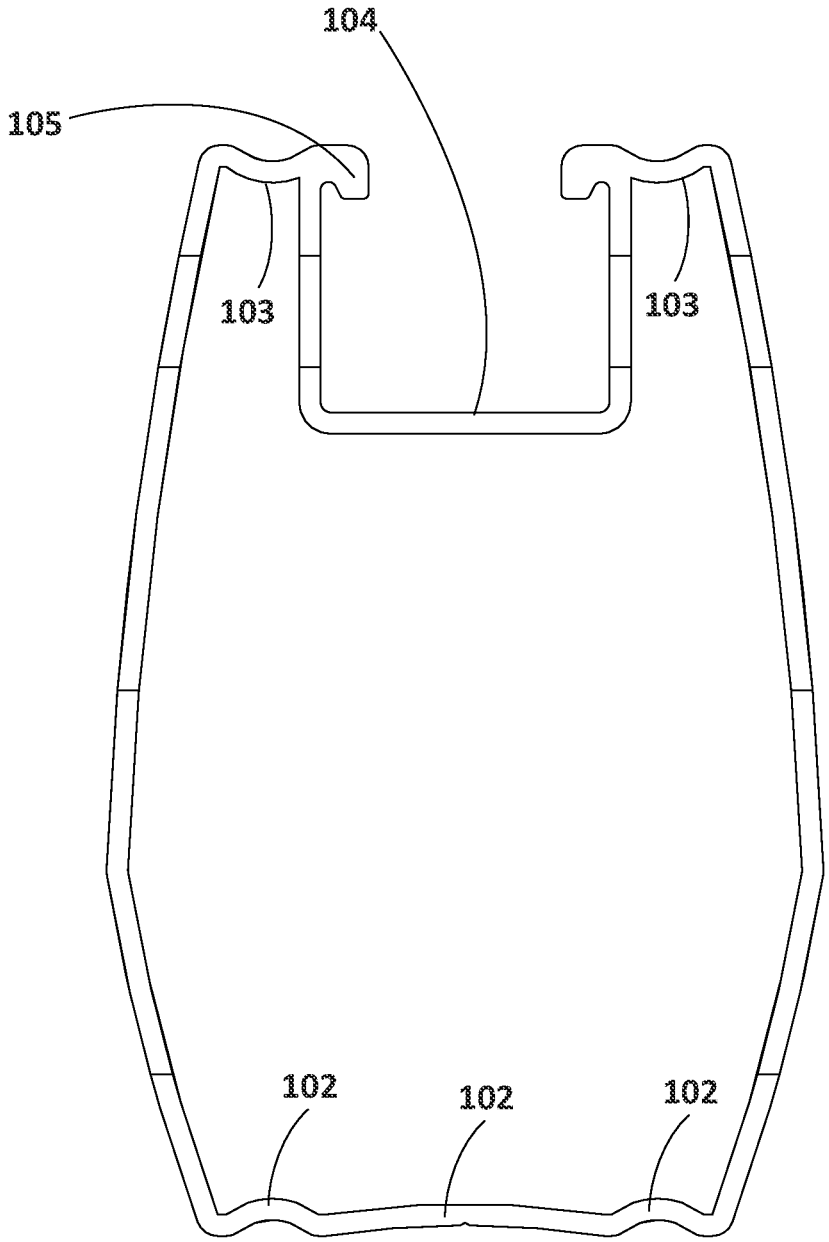
Figure 236:
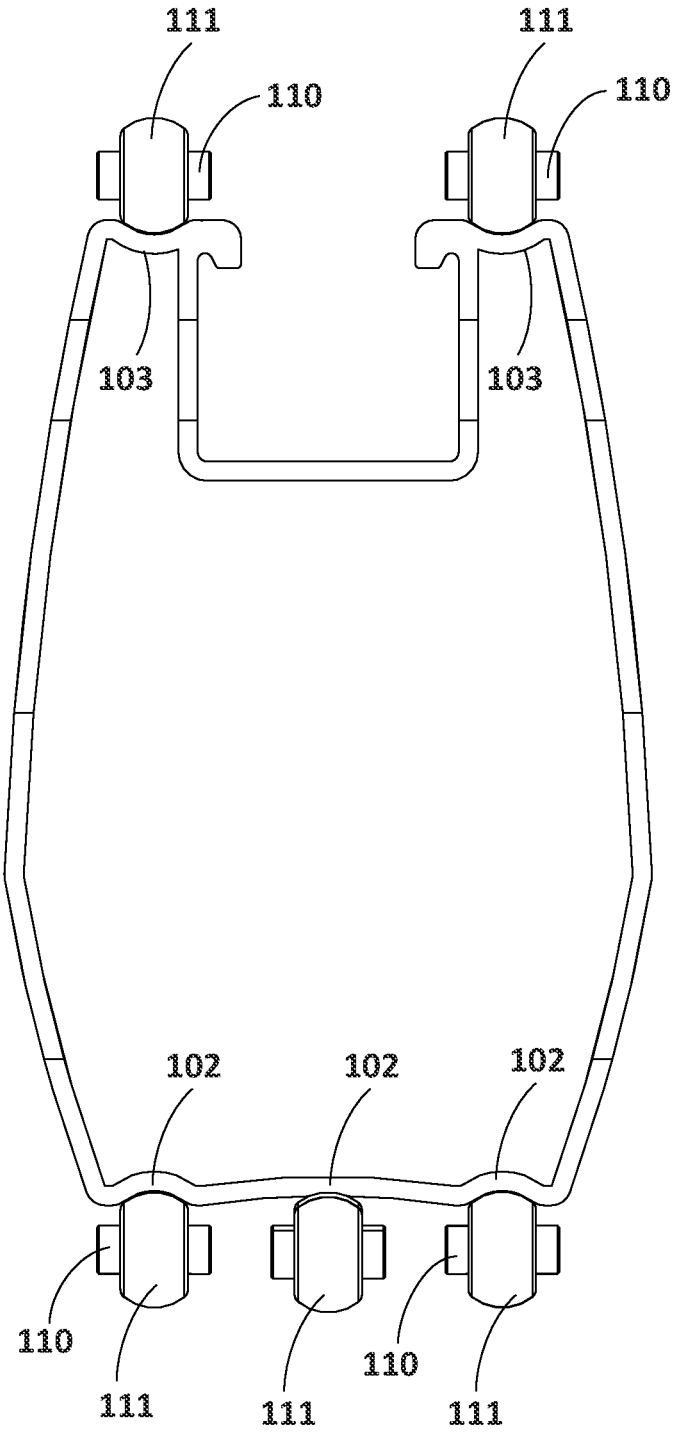
Figure 237:
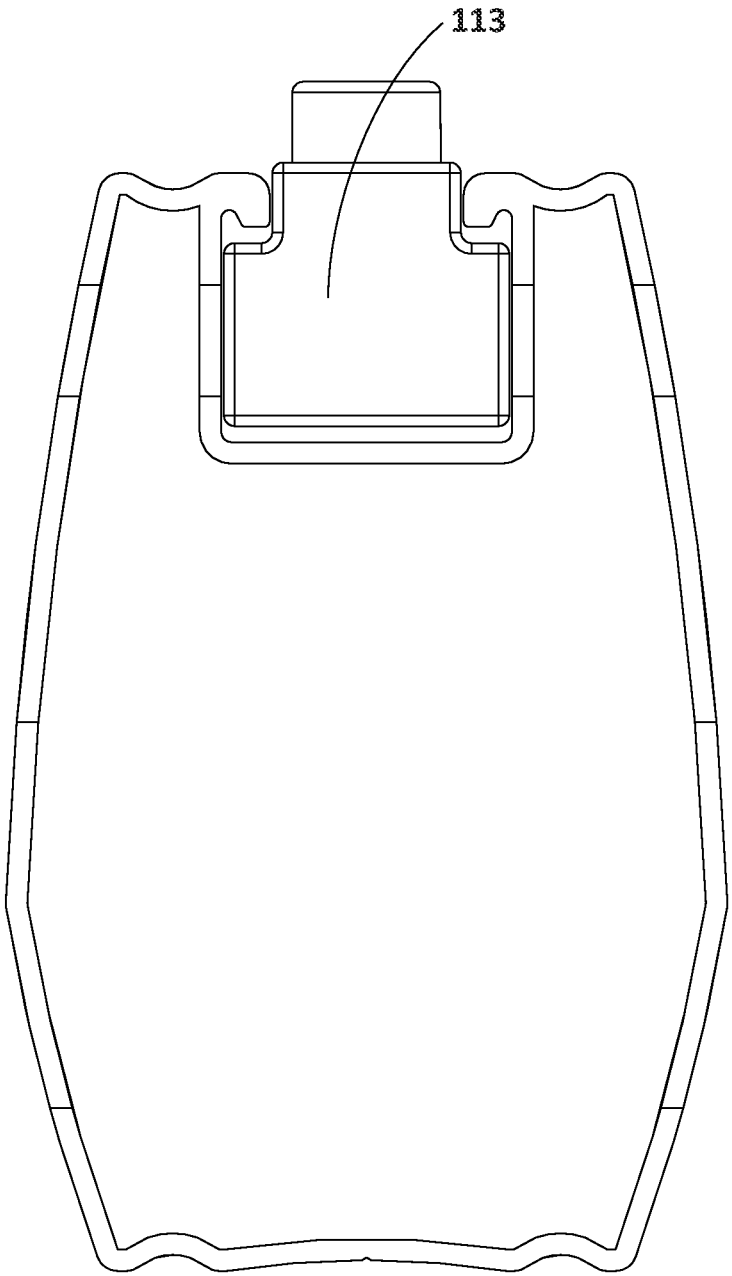
Figure 238:
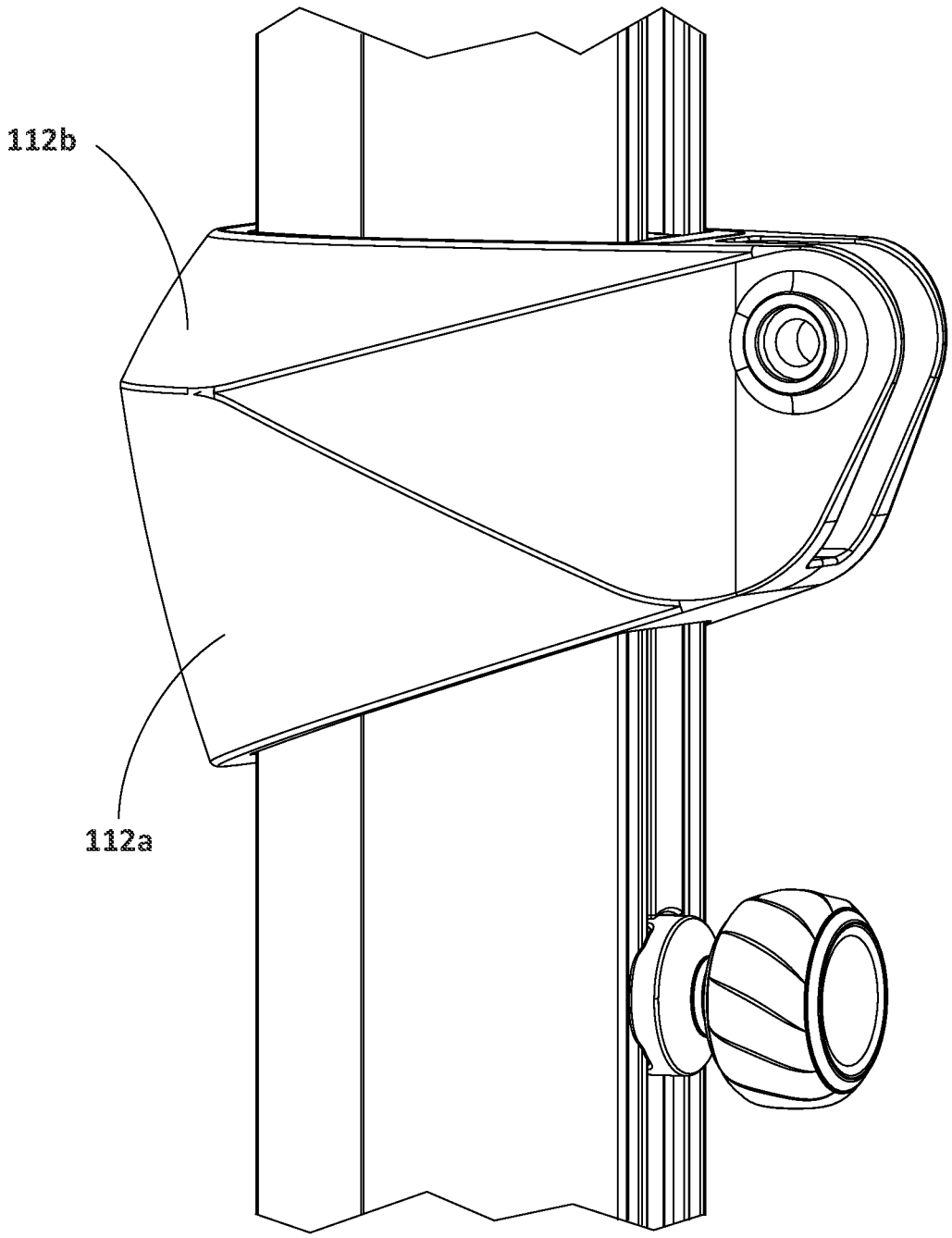
Figure 239:
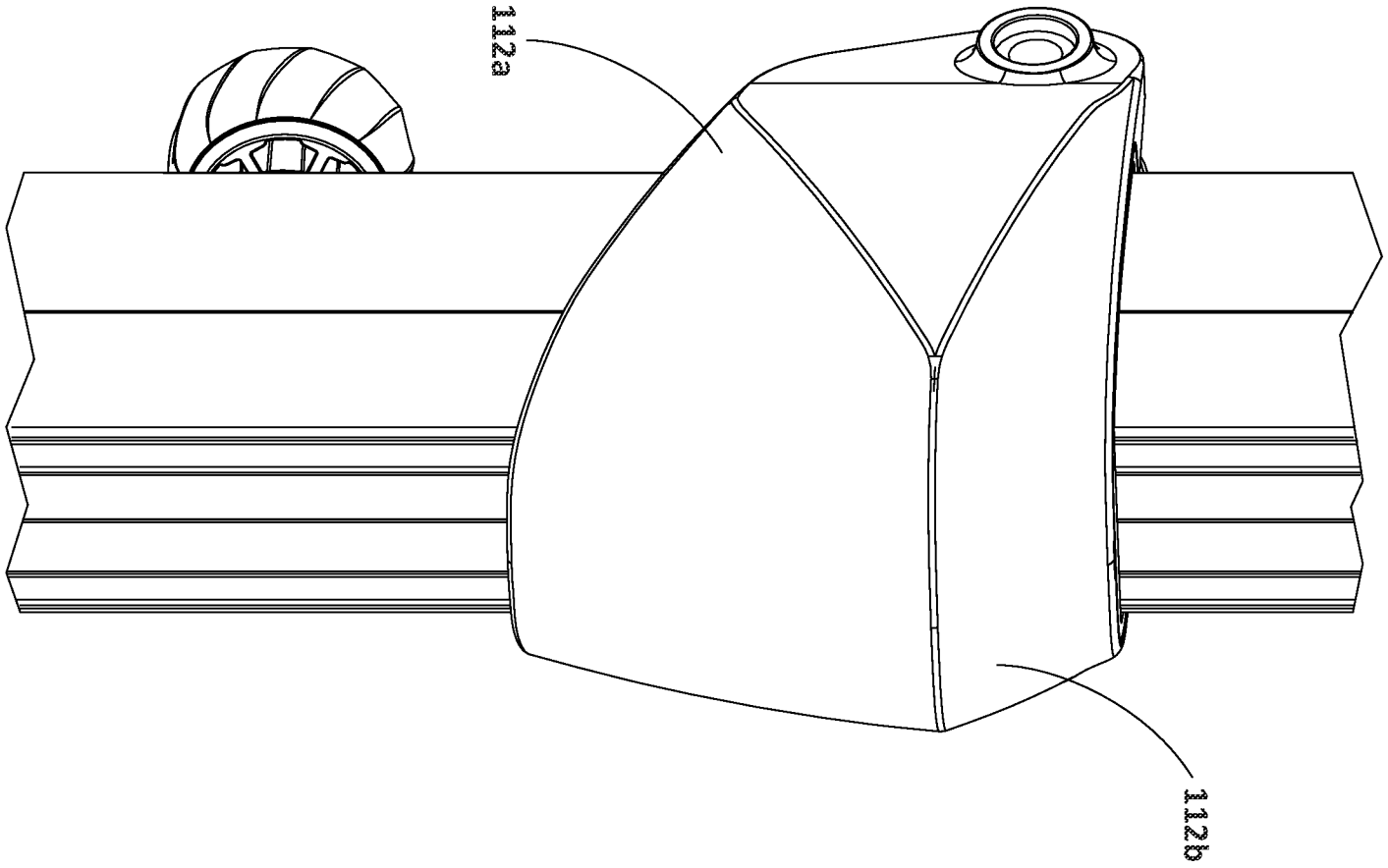
Figure 240:
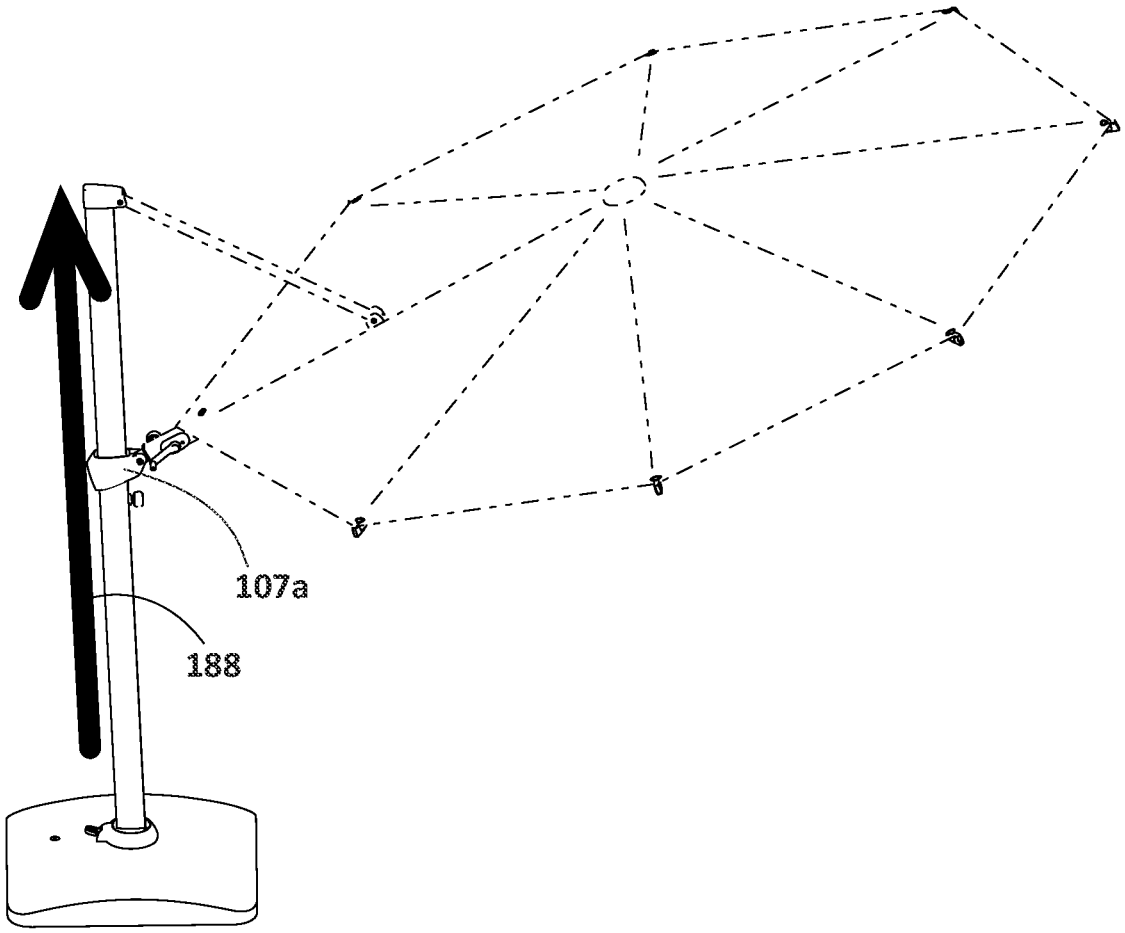
FIG. 240-FIG. 249 are diagrams illustrating perspective views equivalent applications of the five-device-in-onhritic-assisting anti-vibration anti-friction anti-pinching portable elevators (being used on an umbrella post, hand rail, sail pole, awning arm, and pergola column).
Figure 241:
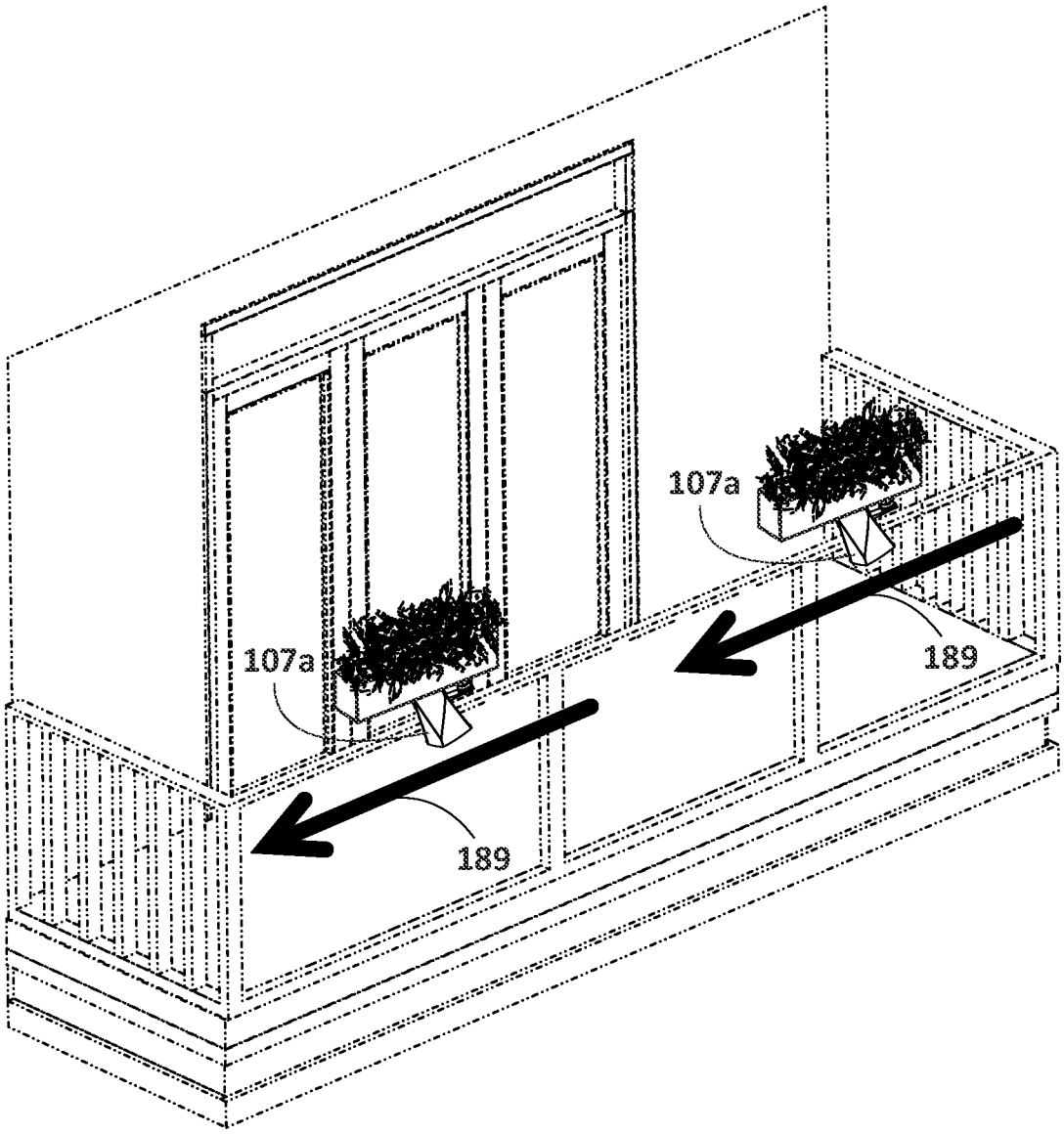
Figure 242:
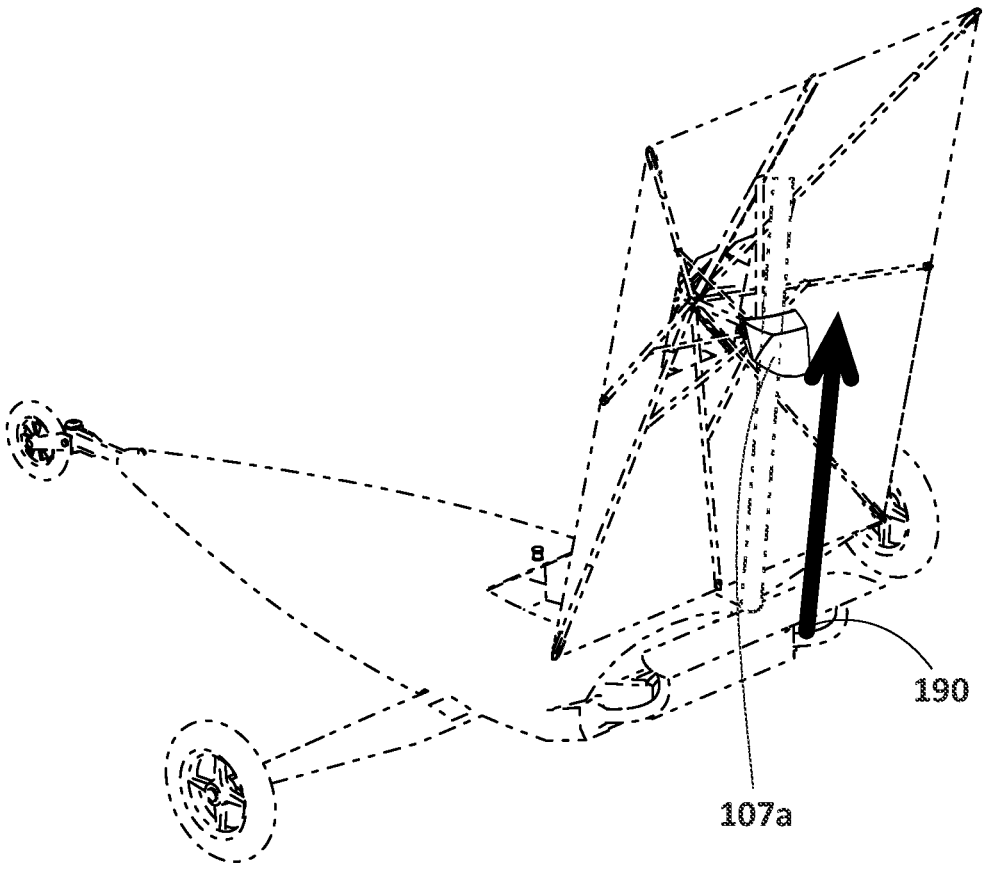
Figure 243:
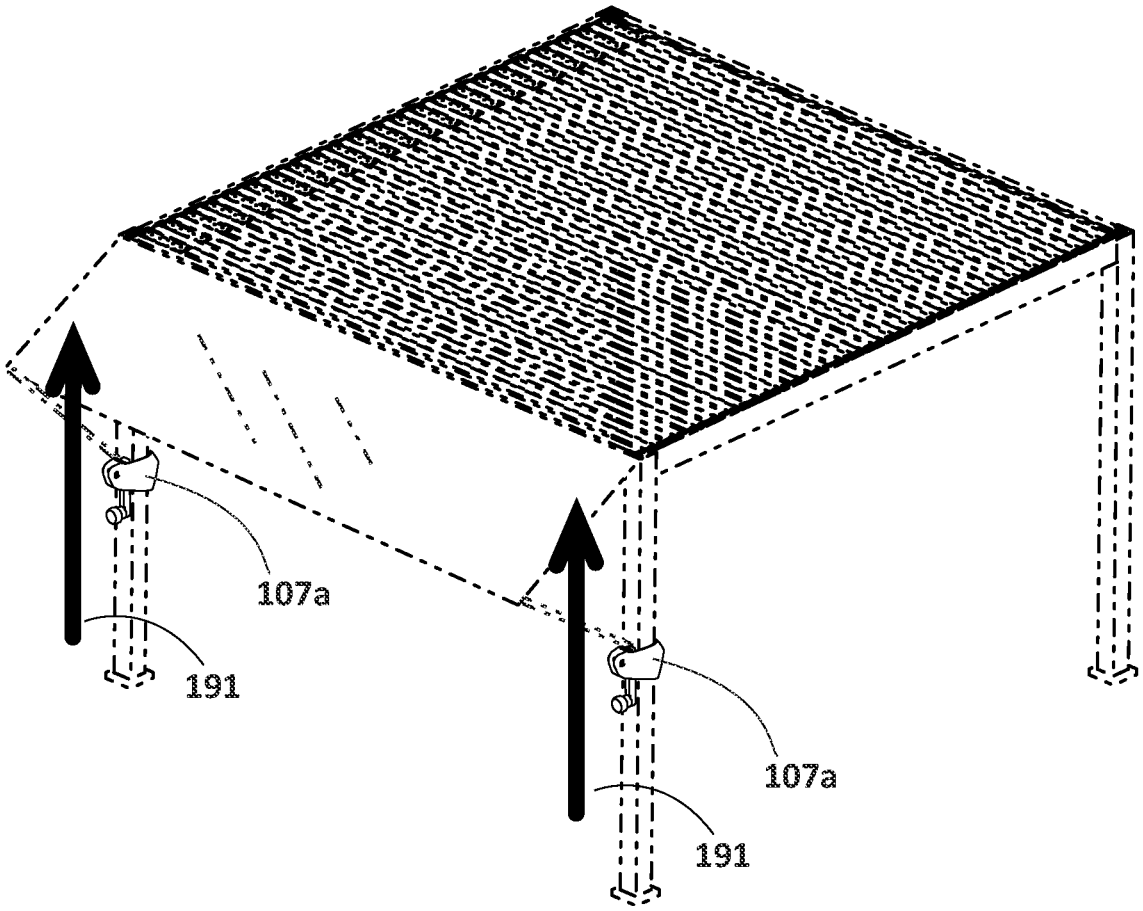
Figure 244:
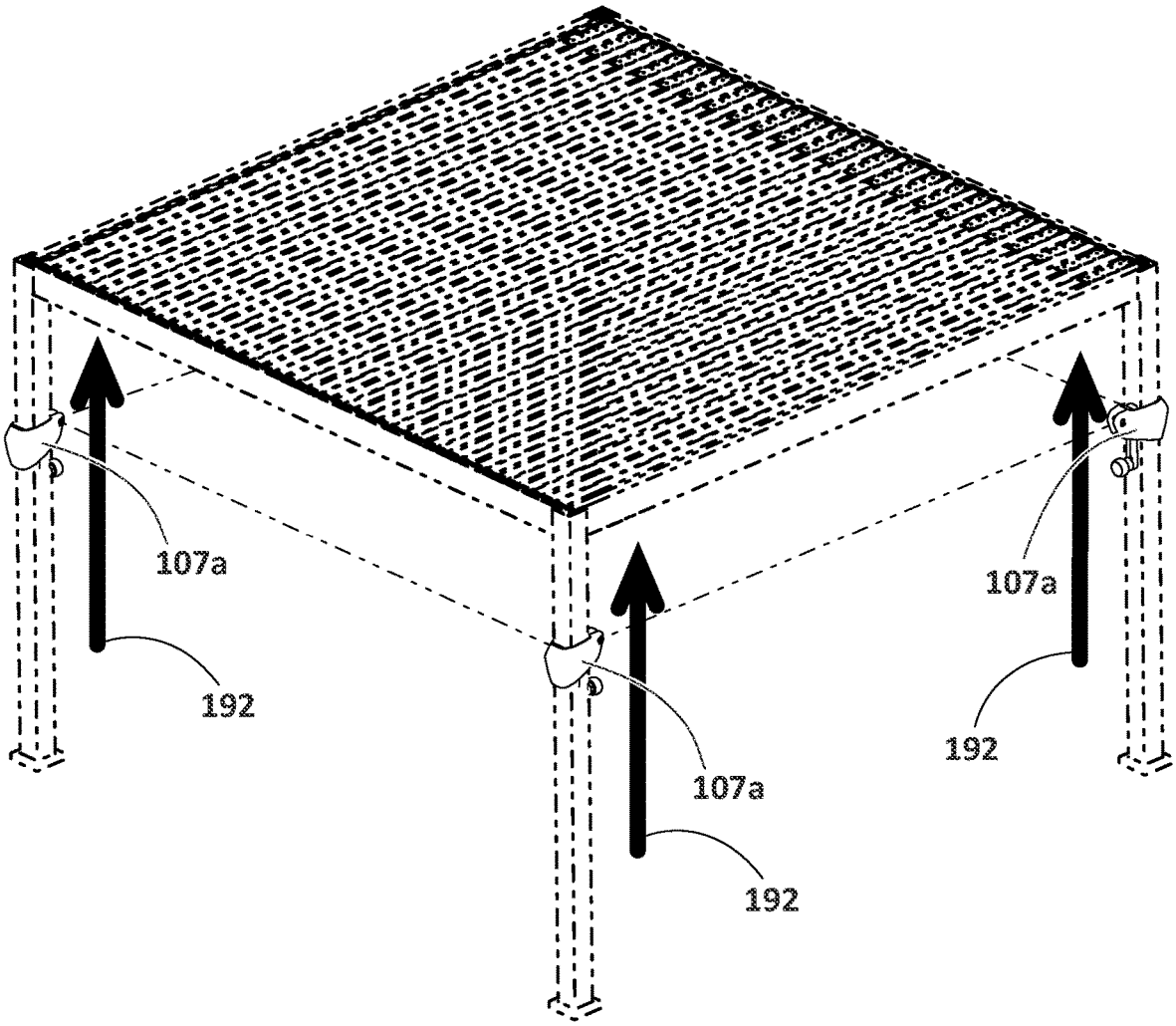
Figure 245:
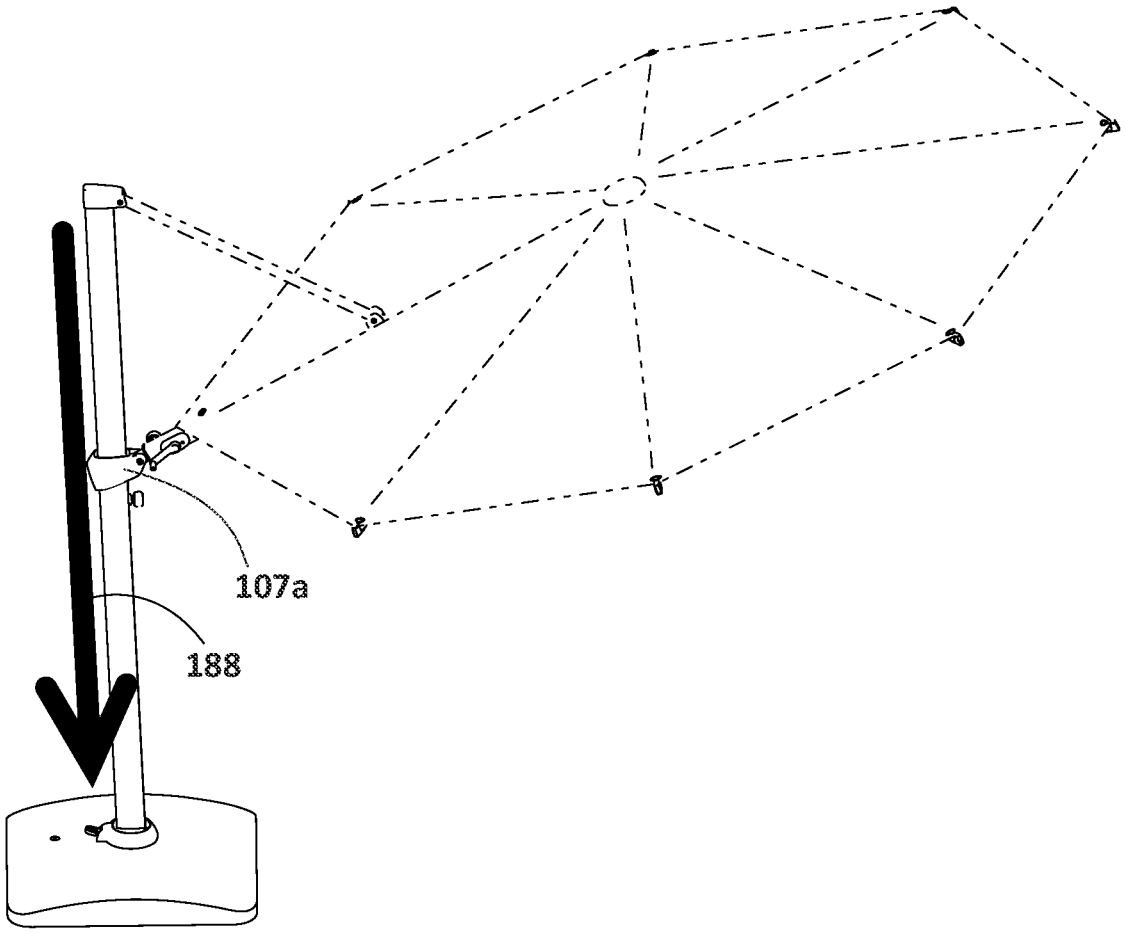
Figure 246:
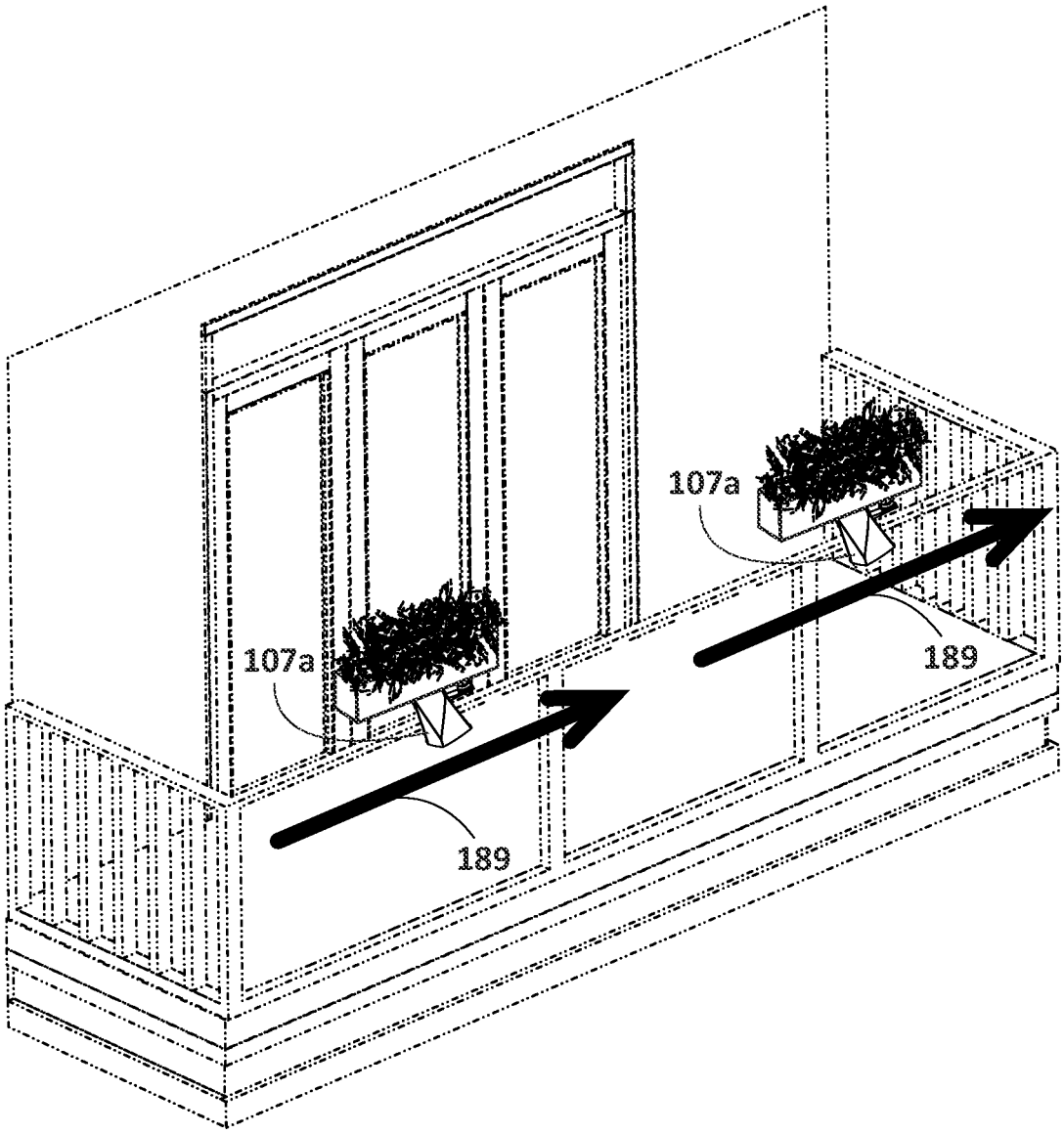
Figure 247:
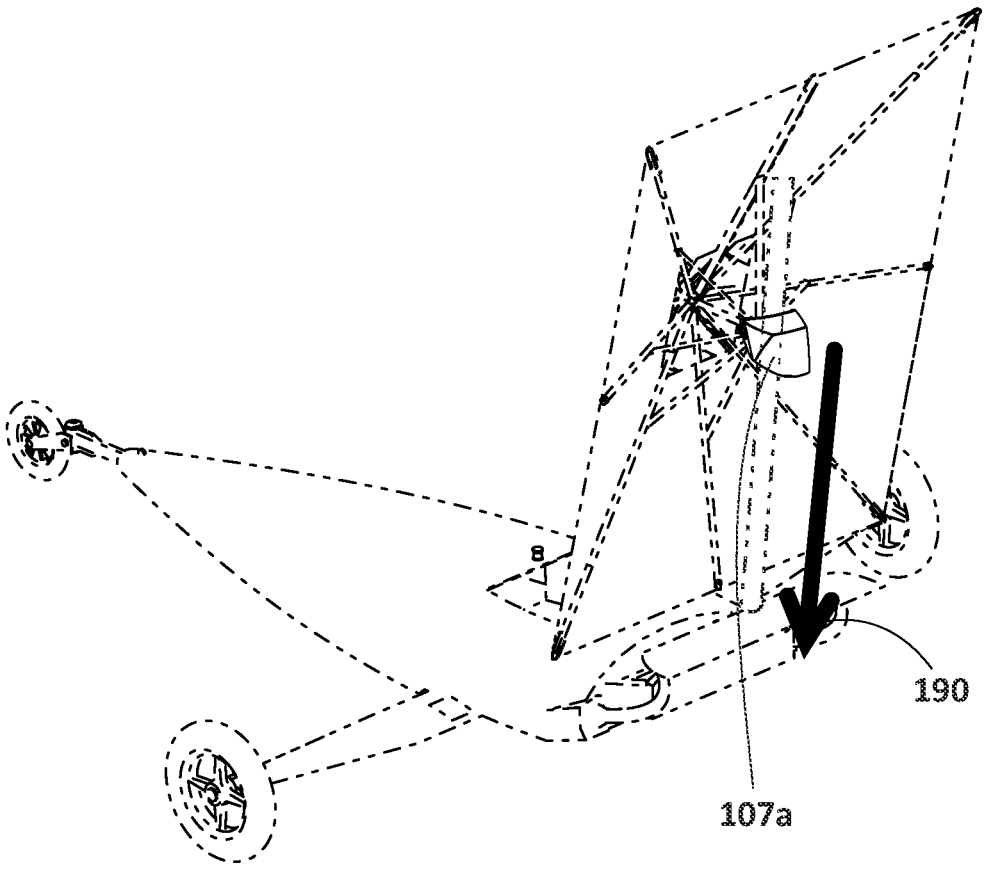
Figure 248:
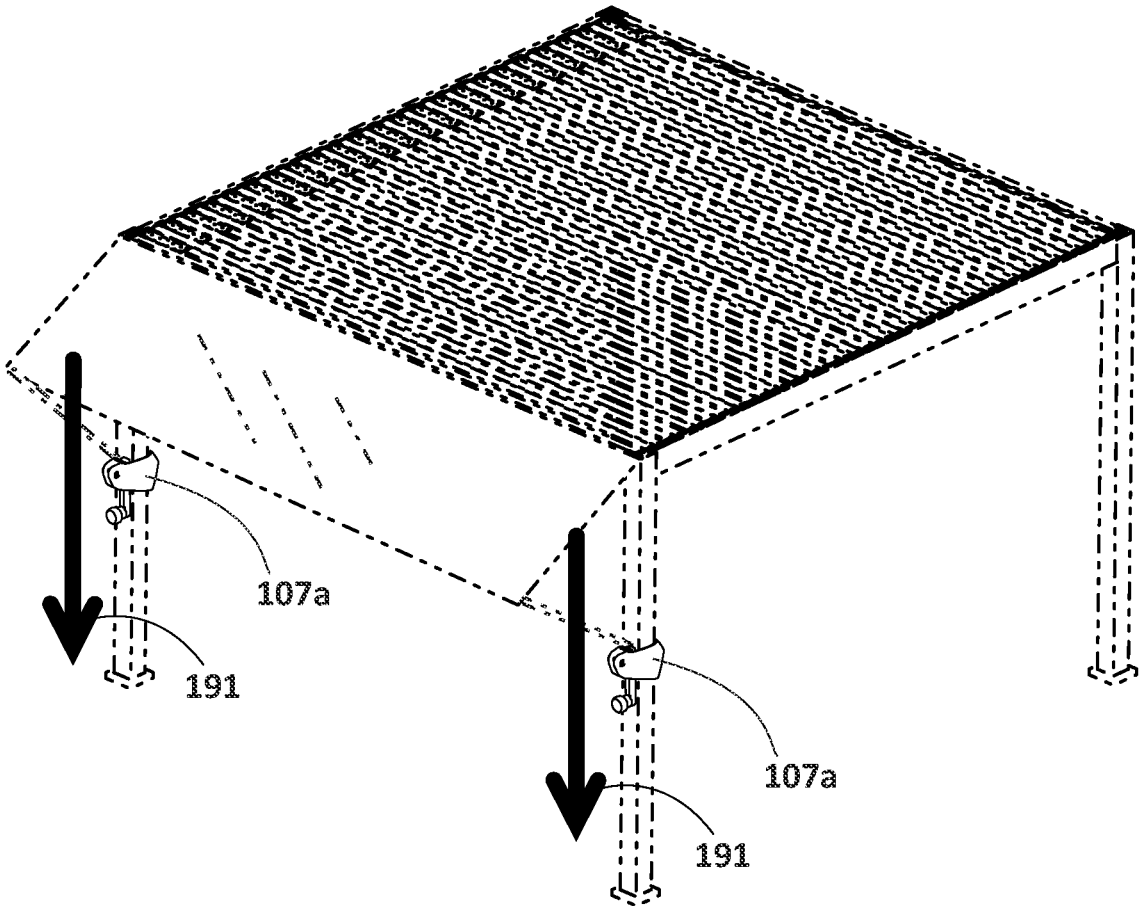
Figure 249:
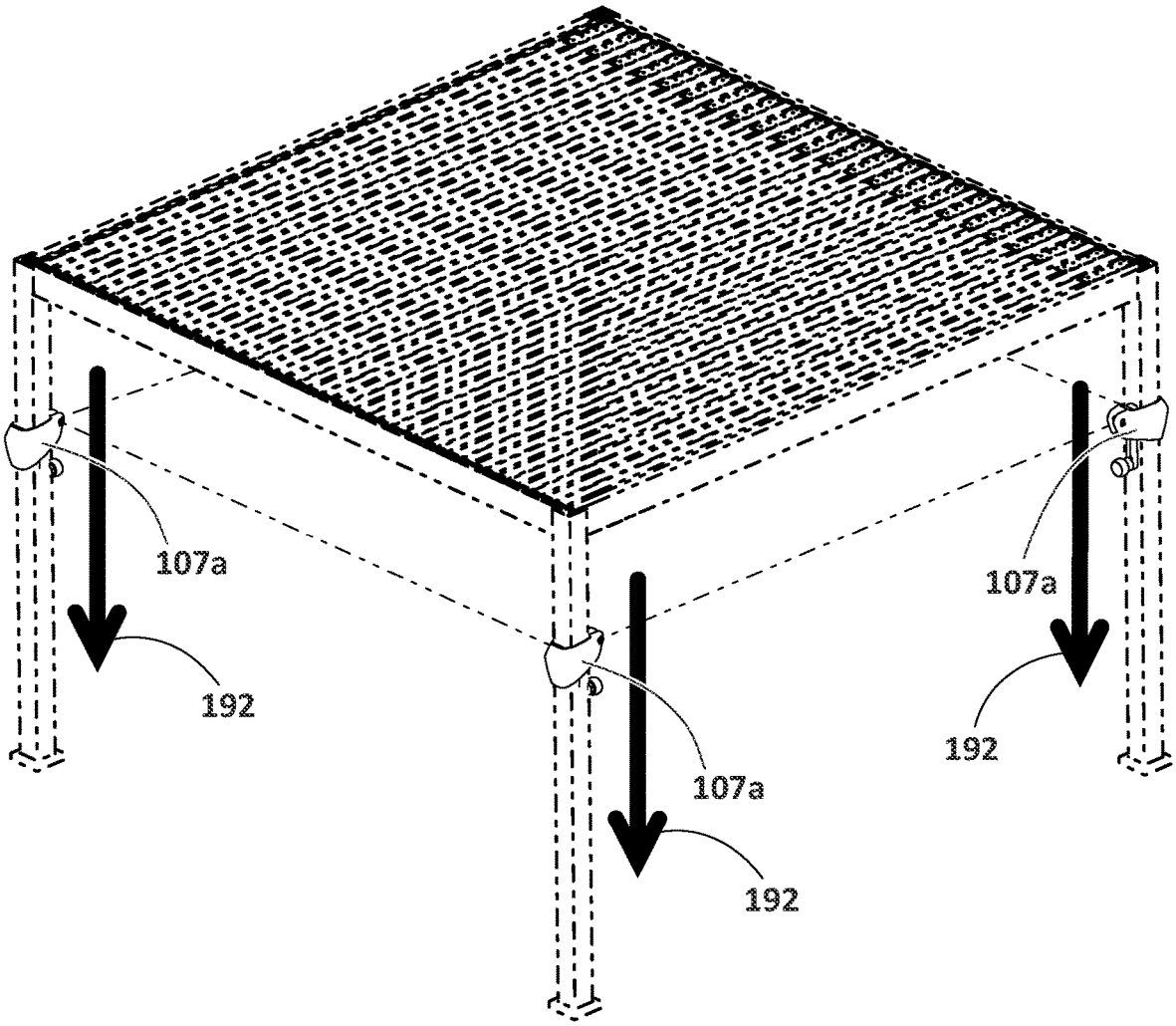
Figure 250:
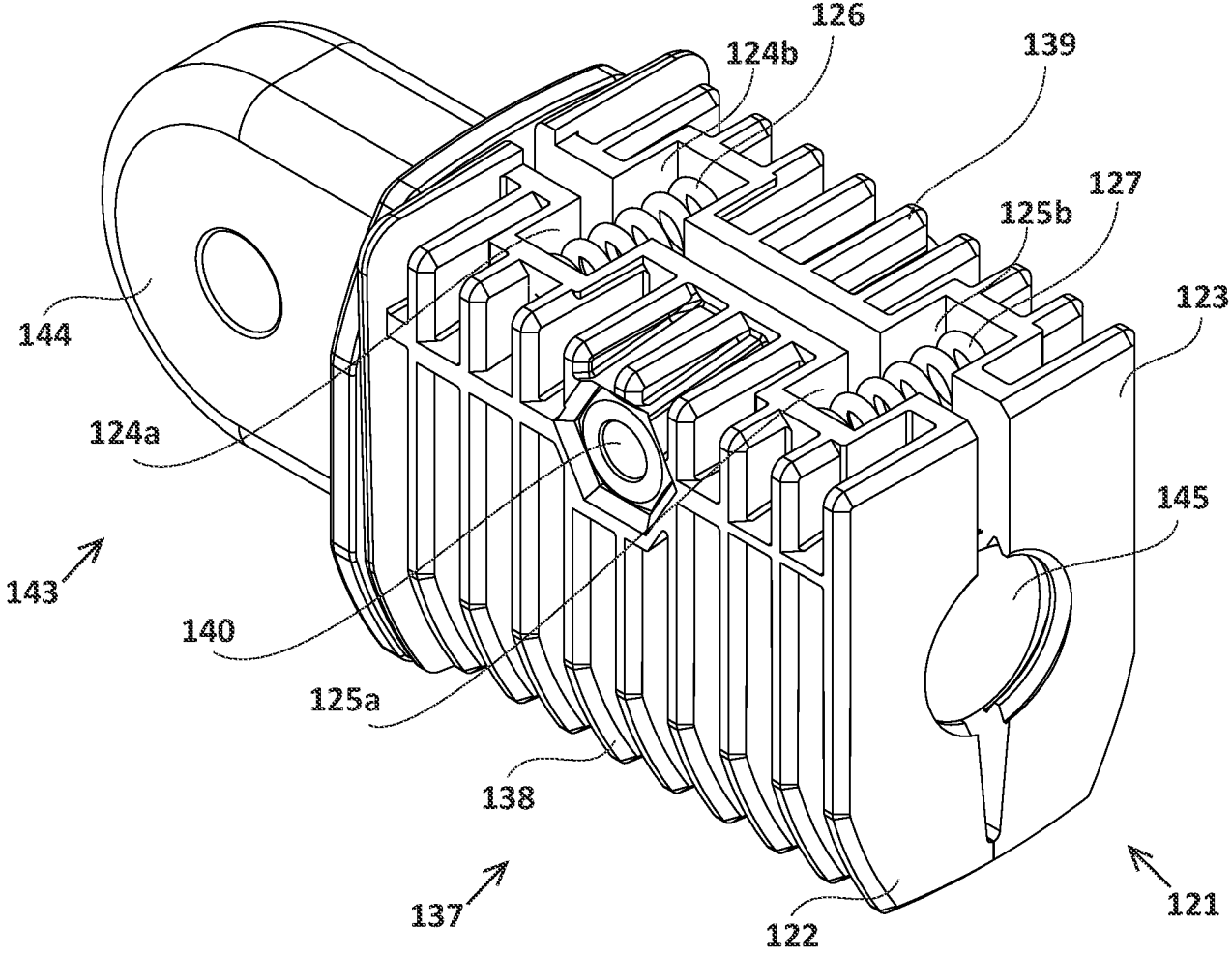
FIG. 250-FIG. 291 are diagrams illustrationing equivalent variations and applications of components and functions of five-device-in-one arthritic-assisting anti-slipping anti-cracking production-increasing opposite-twisting jaws.
Figure 251:
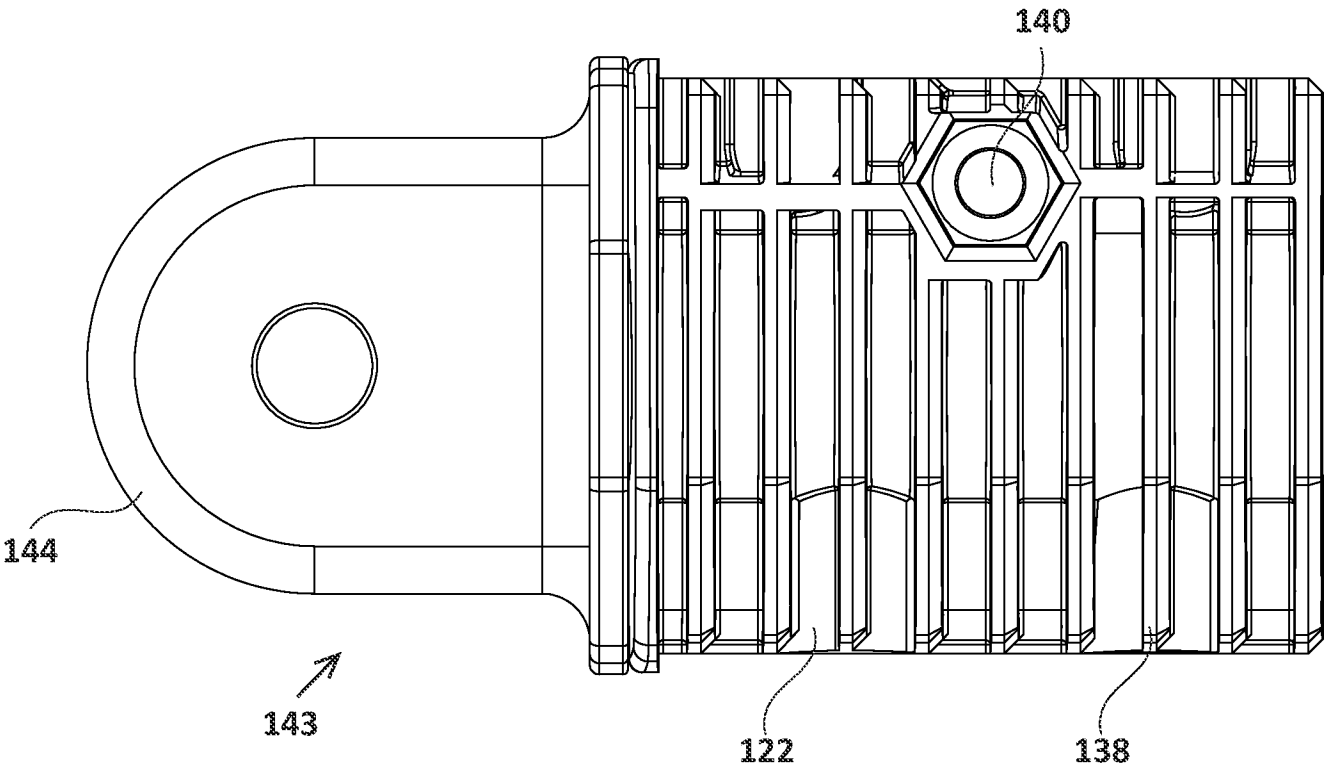
Figure 252:
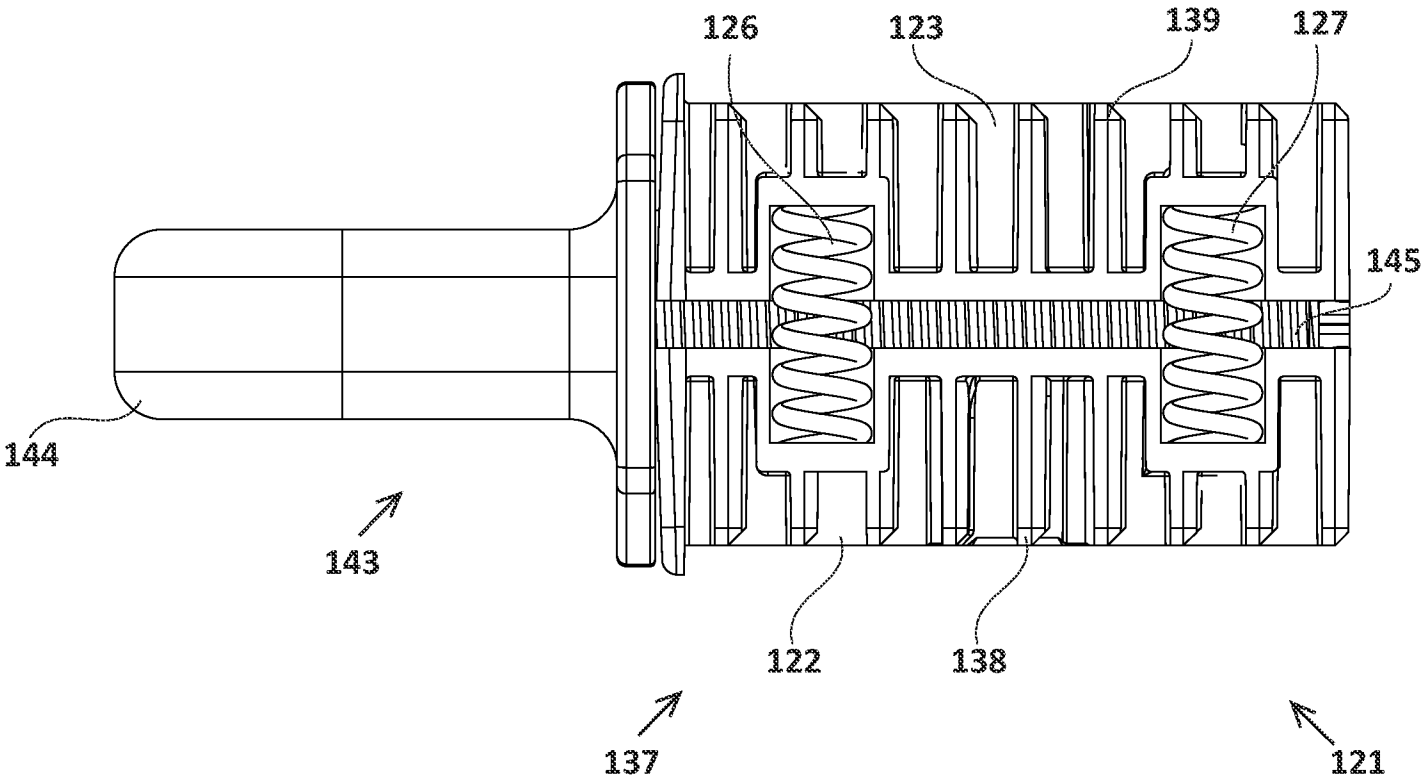
Figure 253:
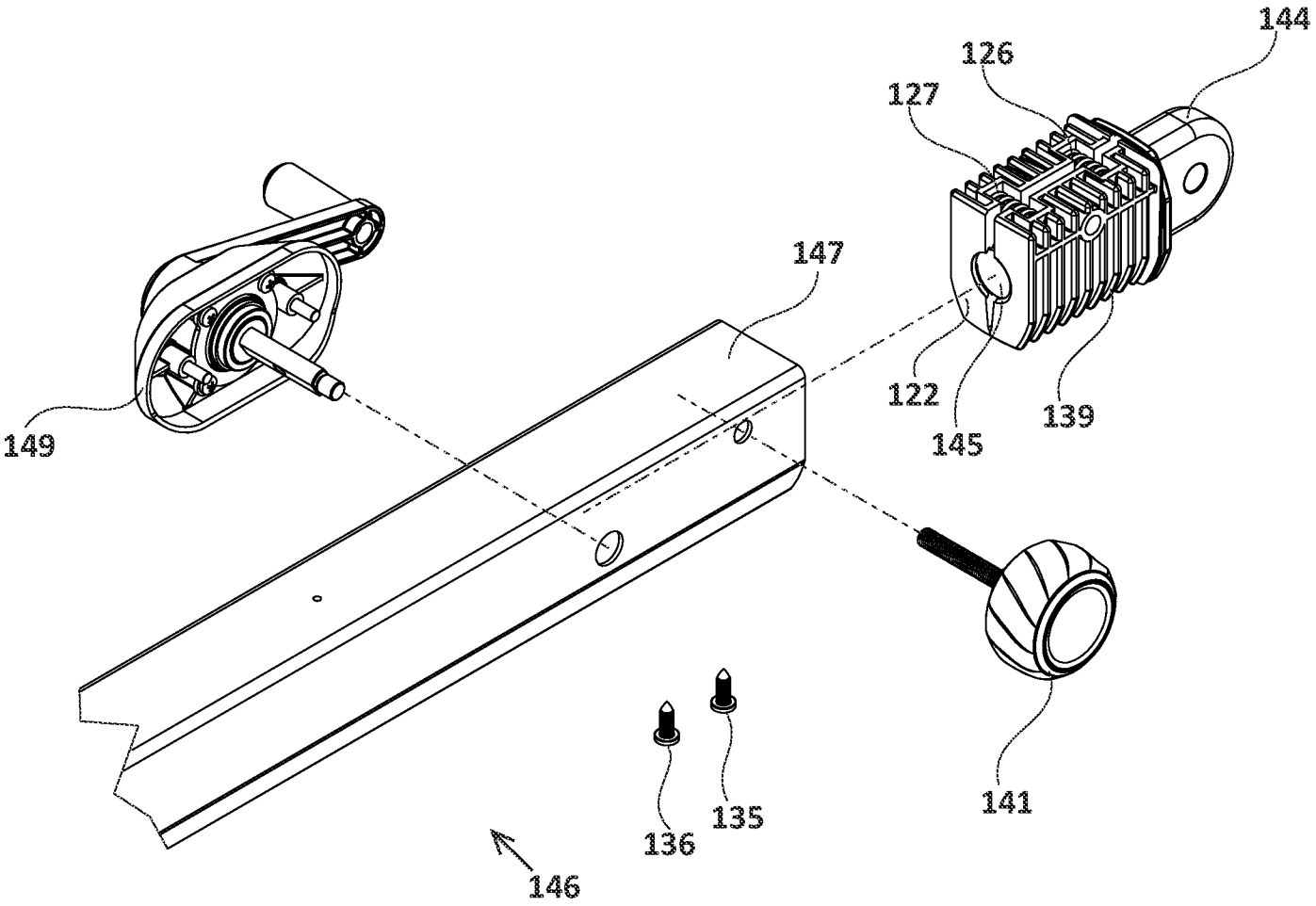
Figure 254:
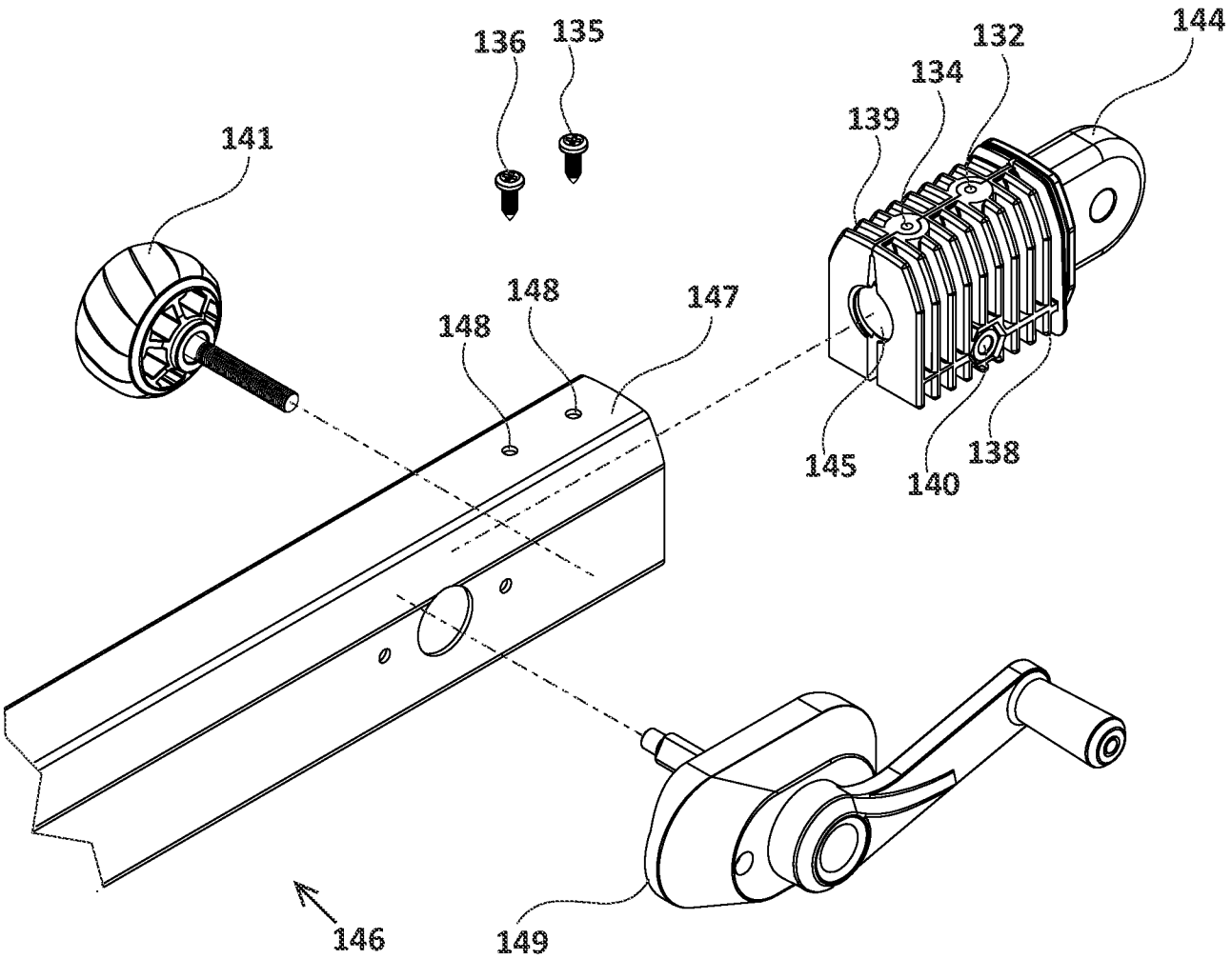
Figure 255:
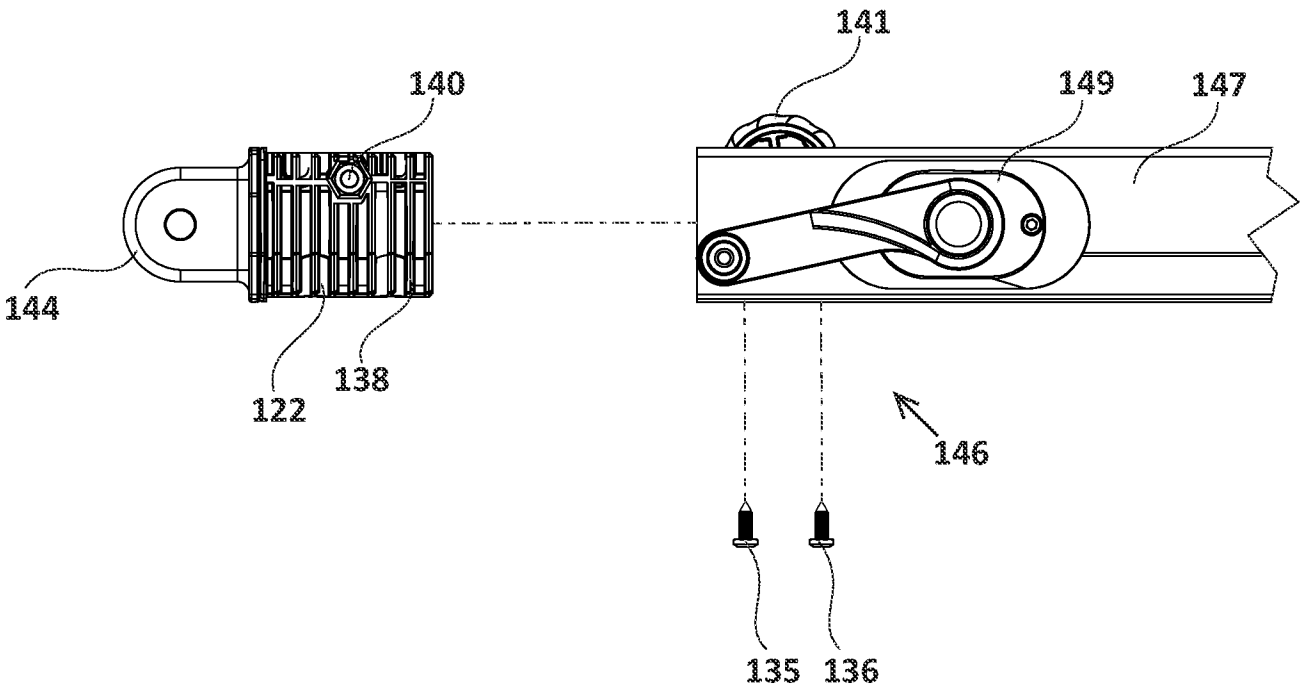
Figure 256:
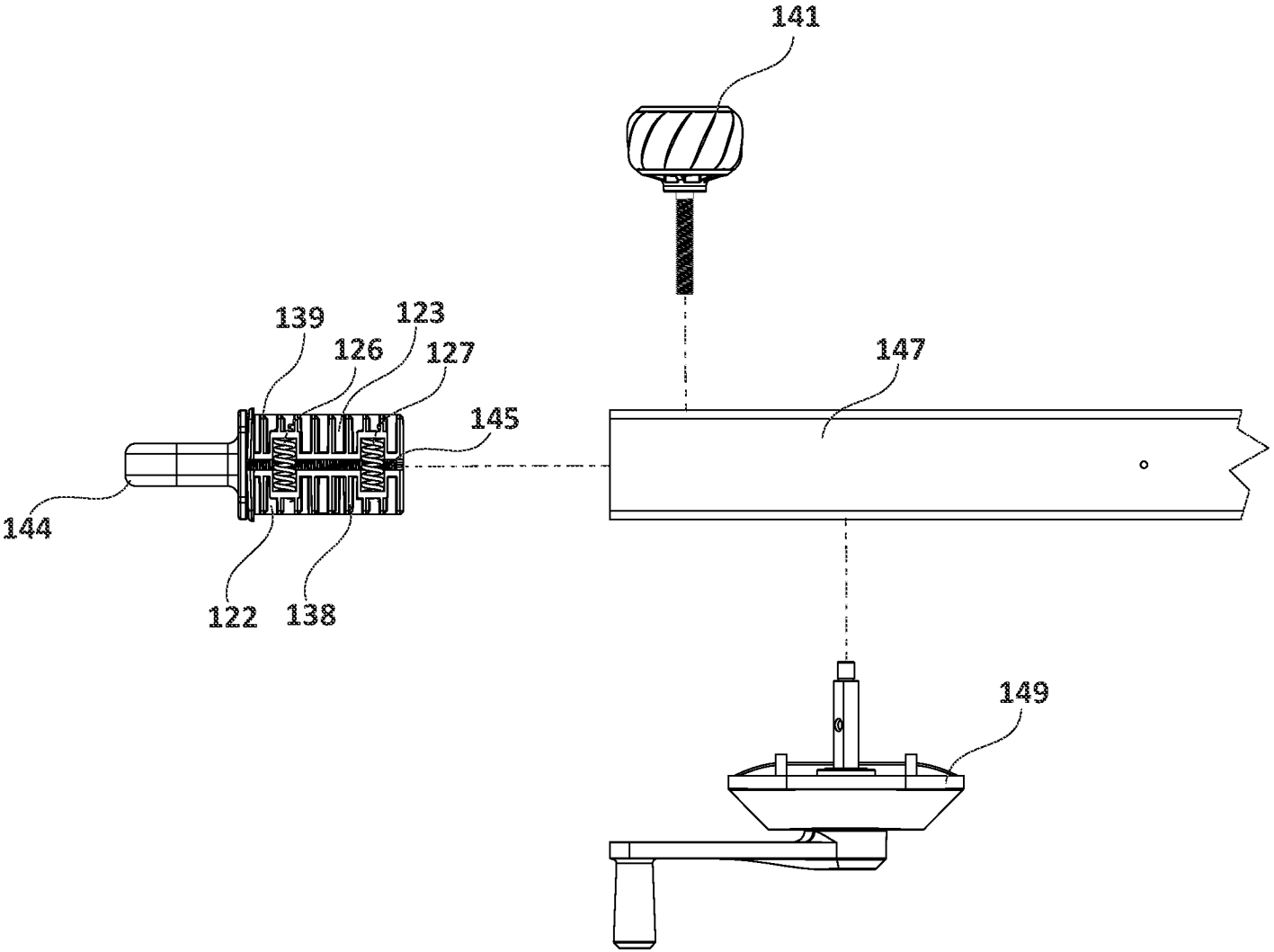
Figure 257:
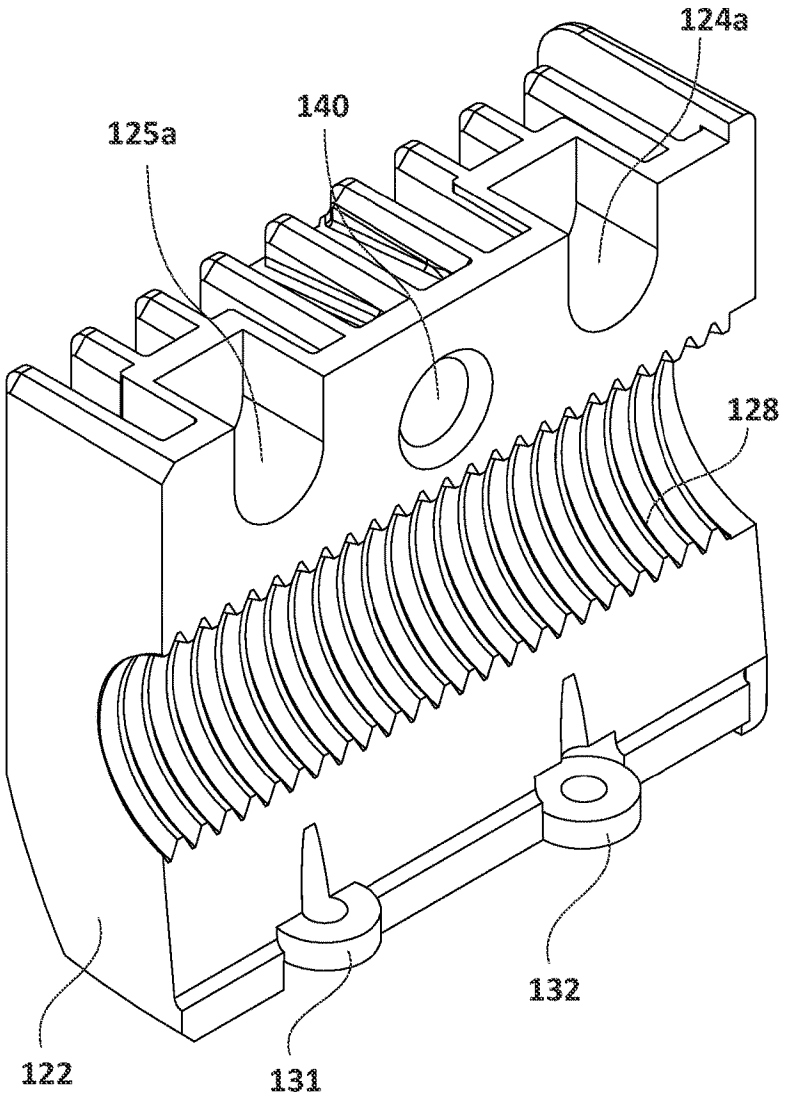
Figure 258:
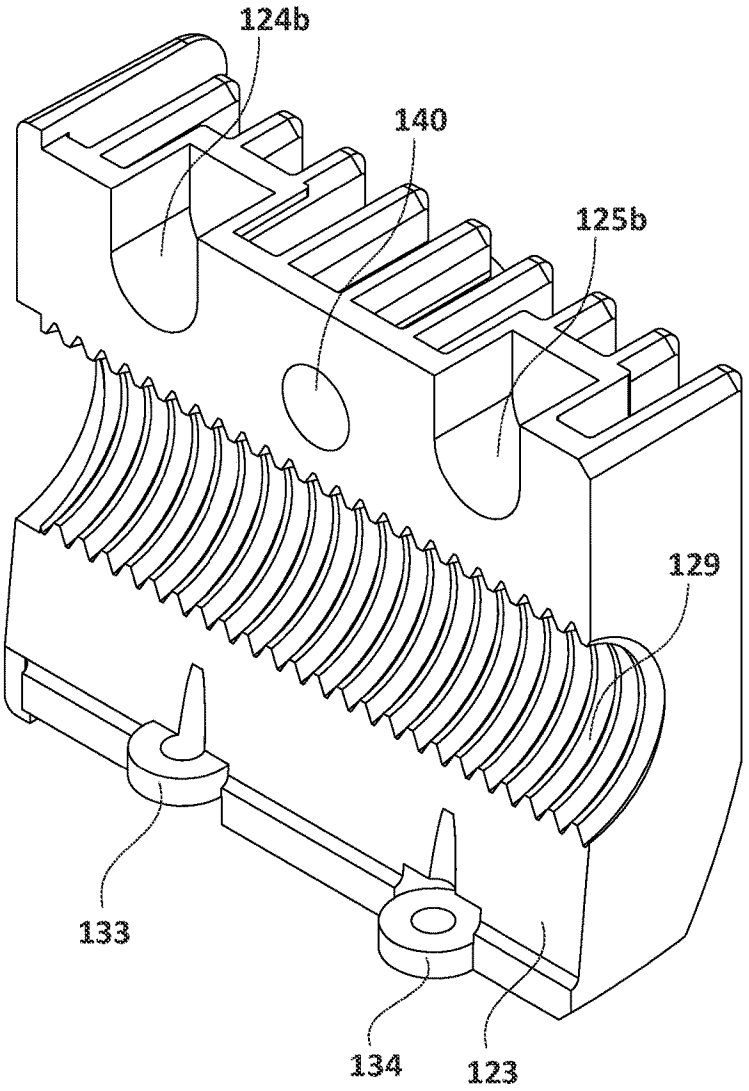
Figure 259:
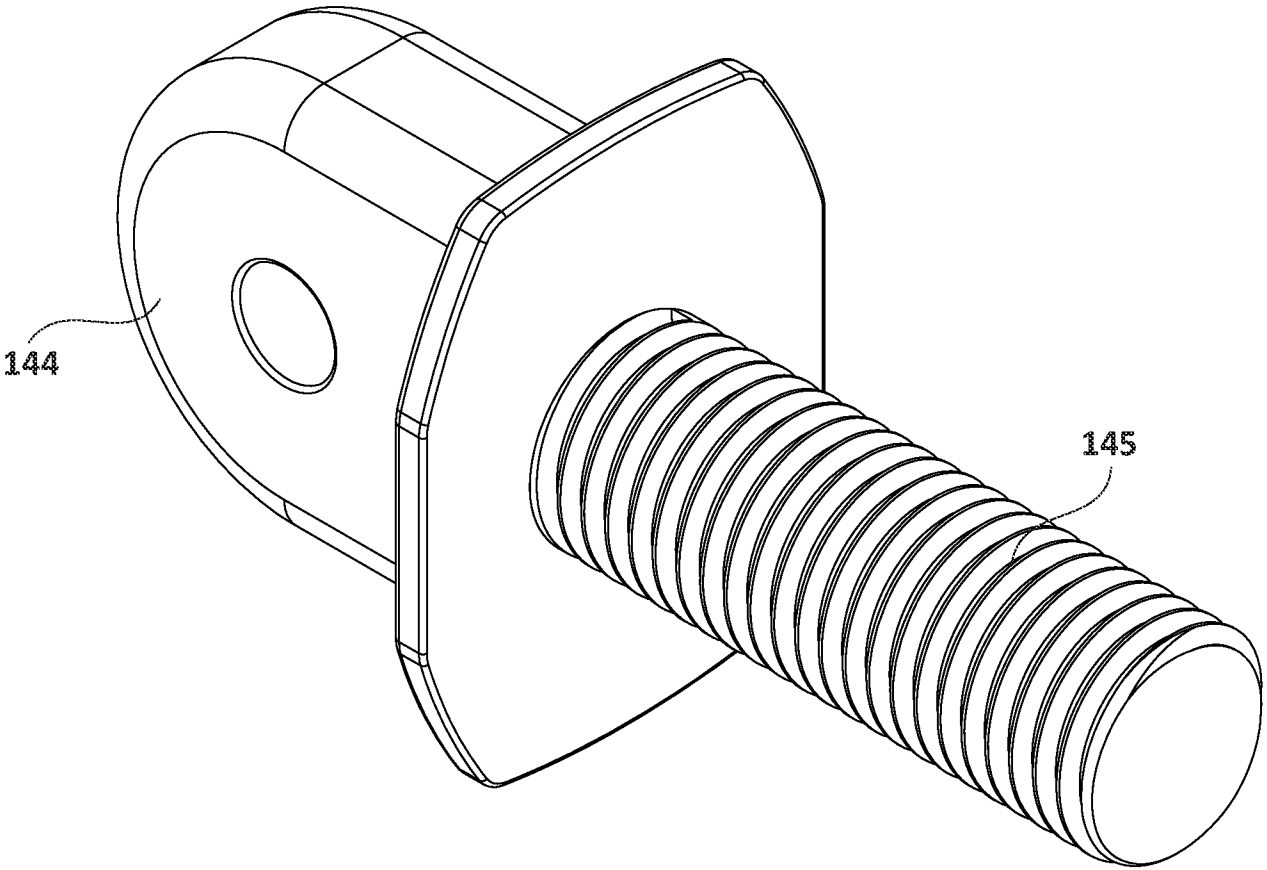
Figure 260:
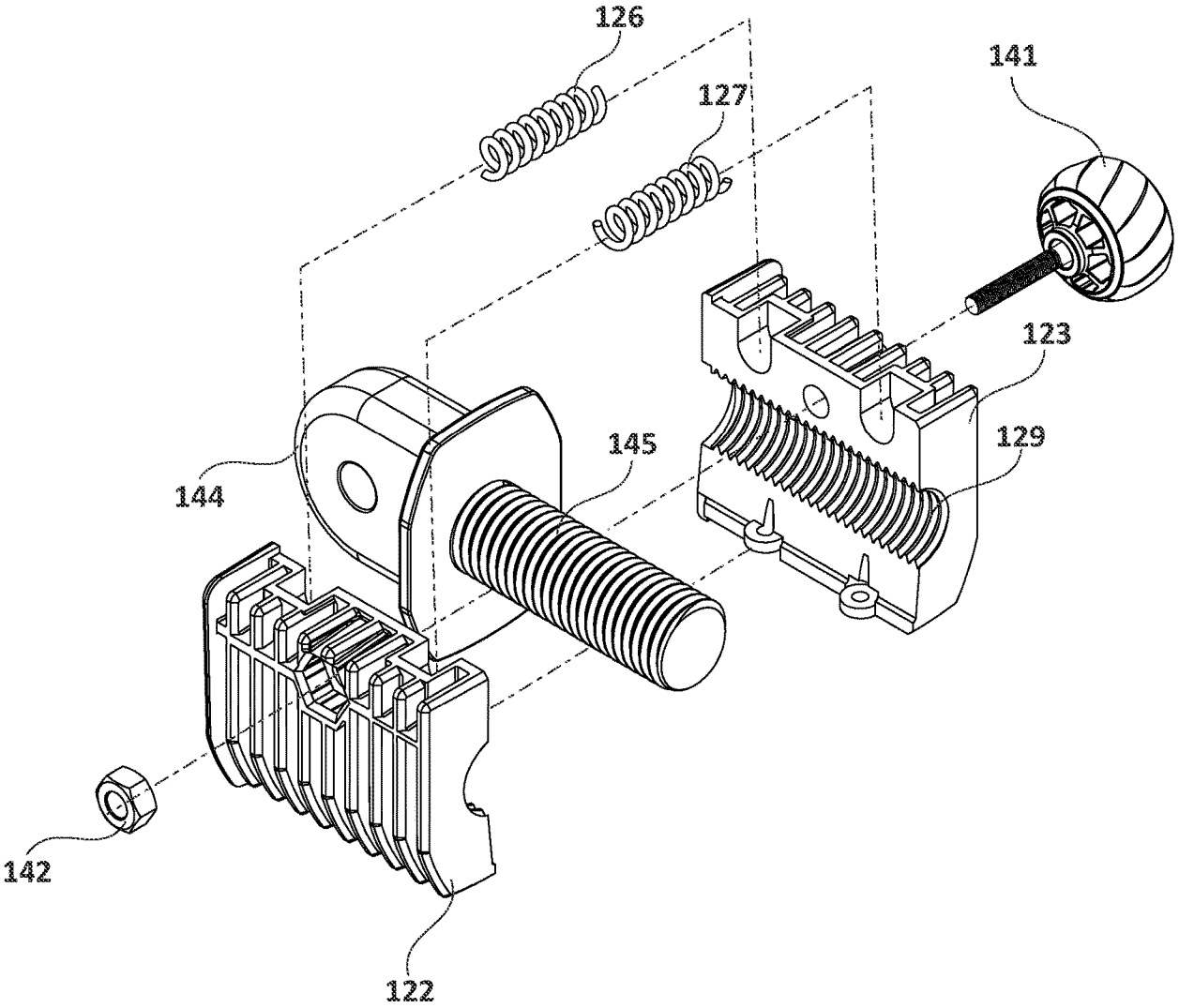
Figure 261:
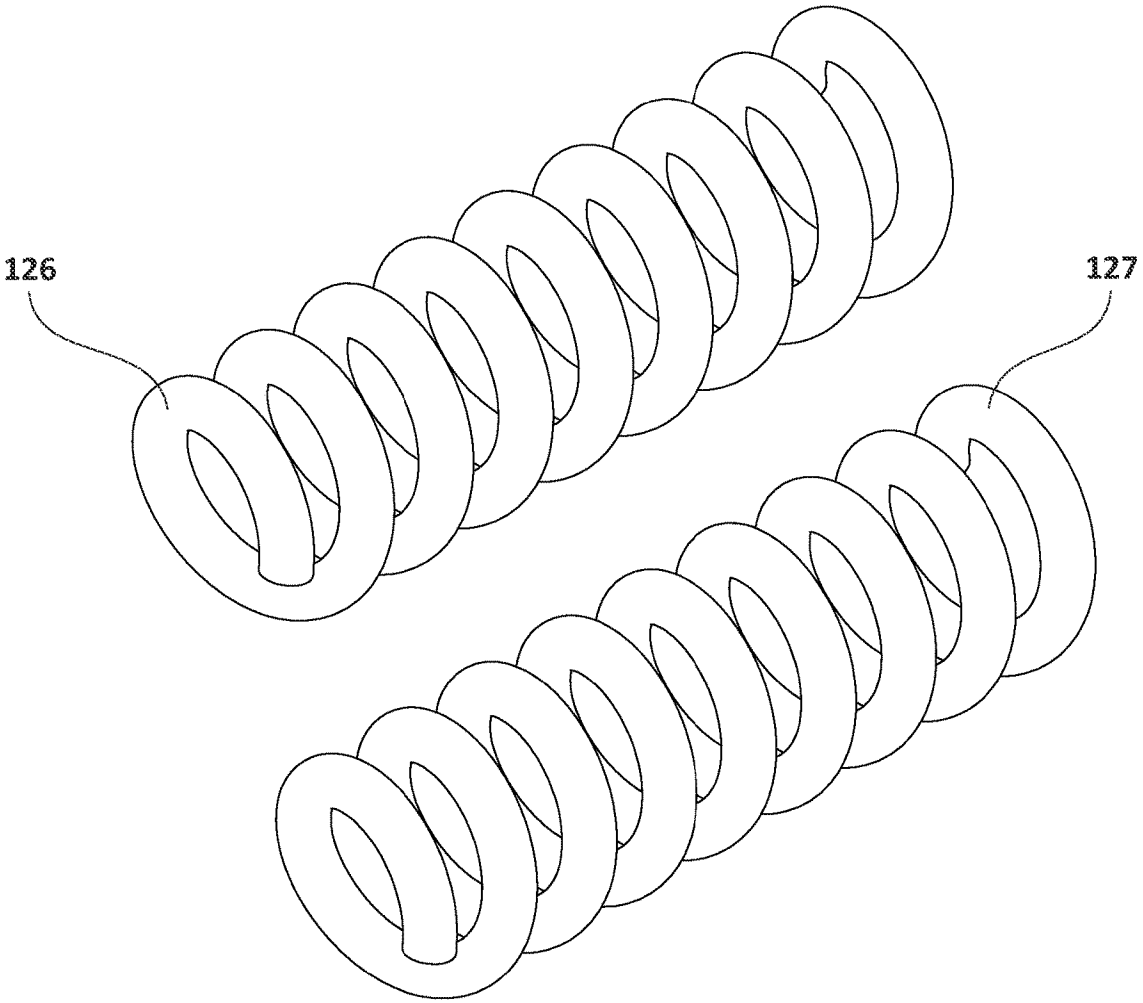
Figure 262:
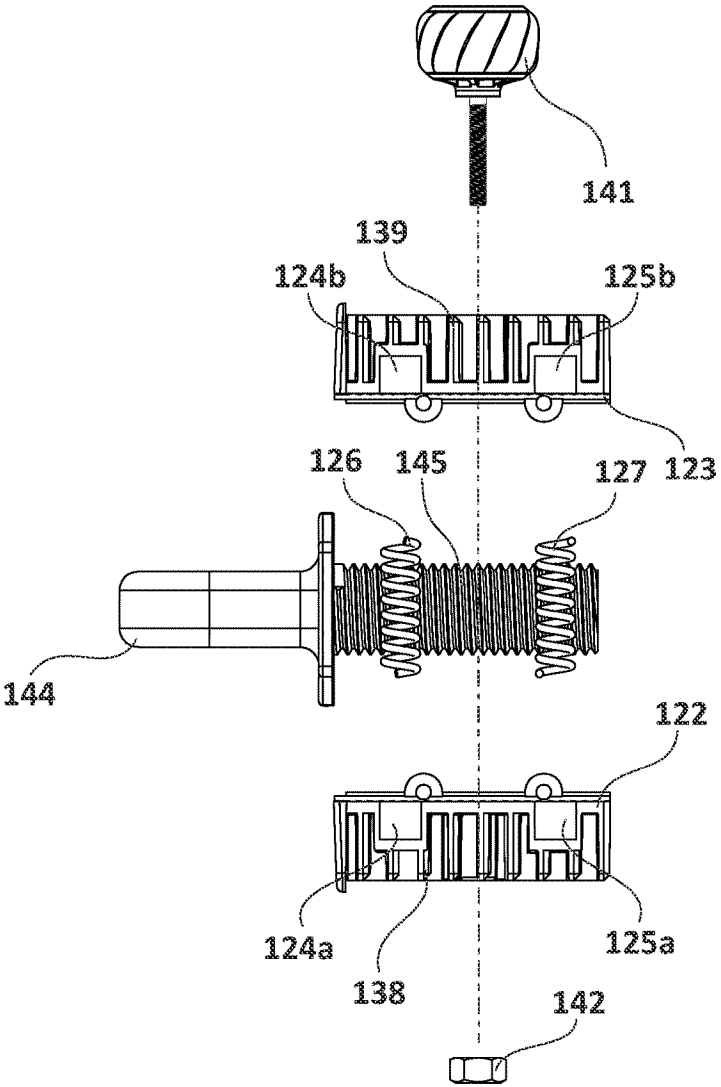
Figure 263:
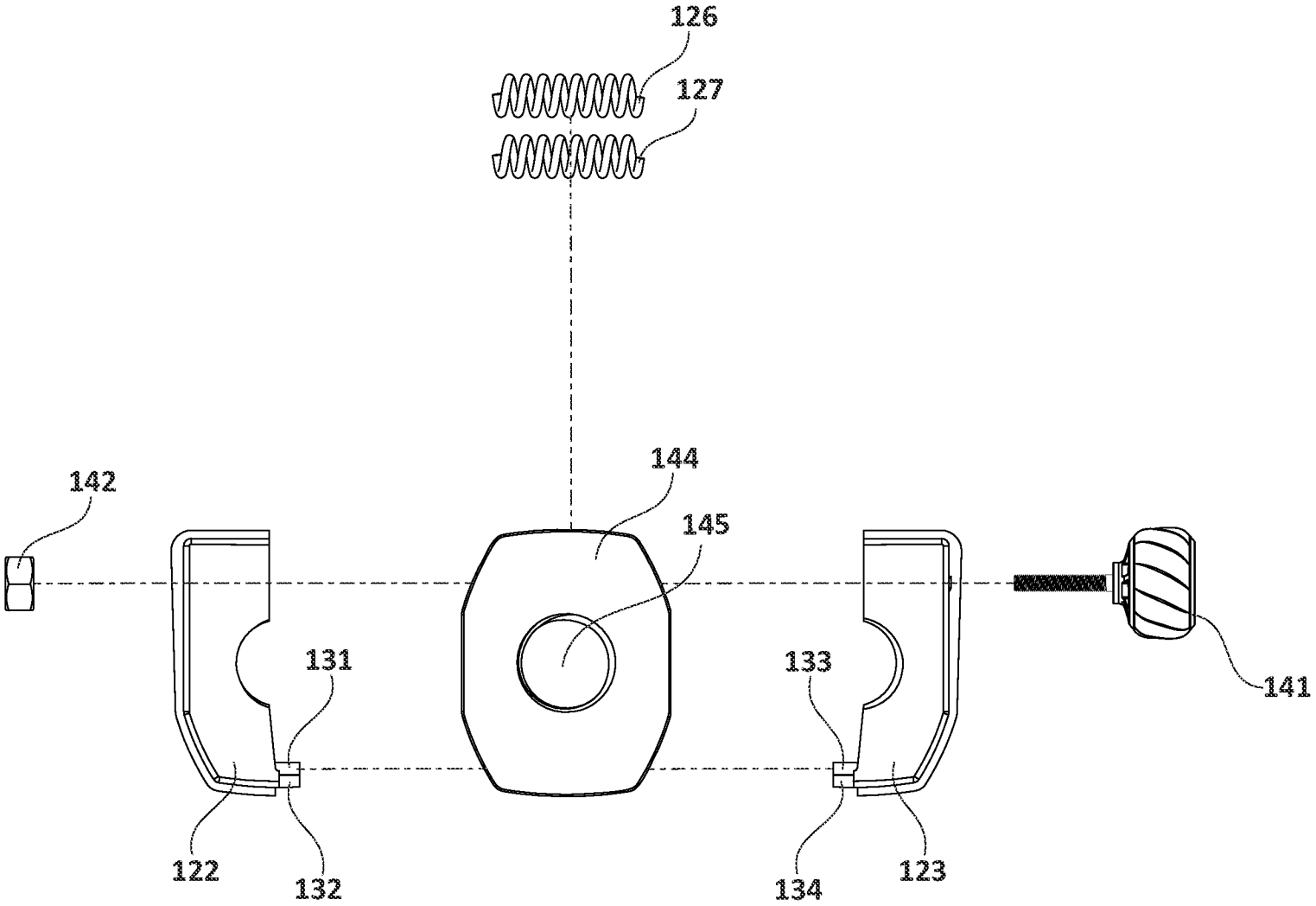
Figure 264:
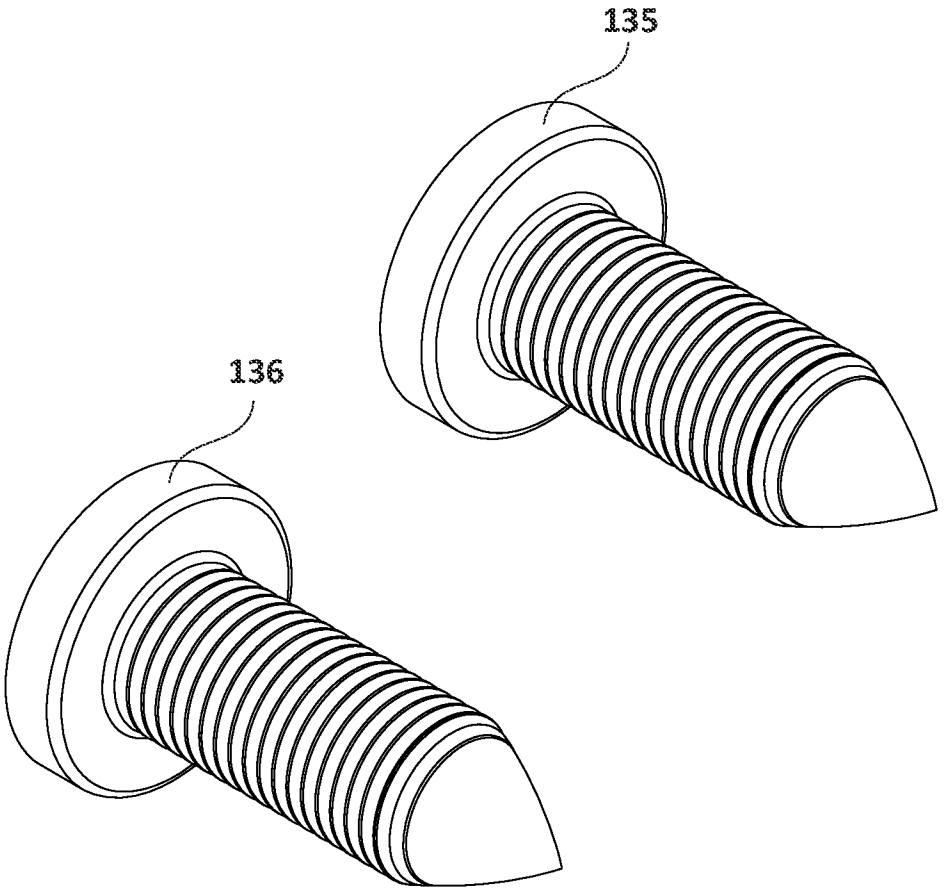
Figure 265:
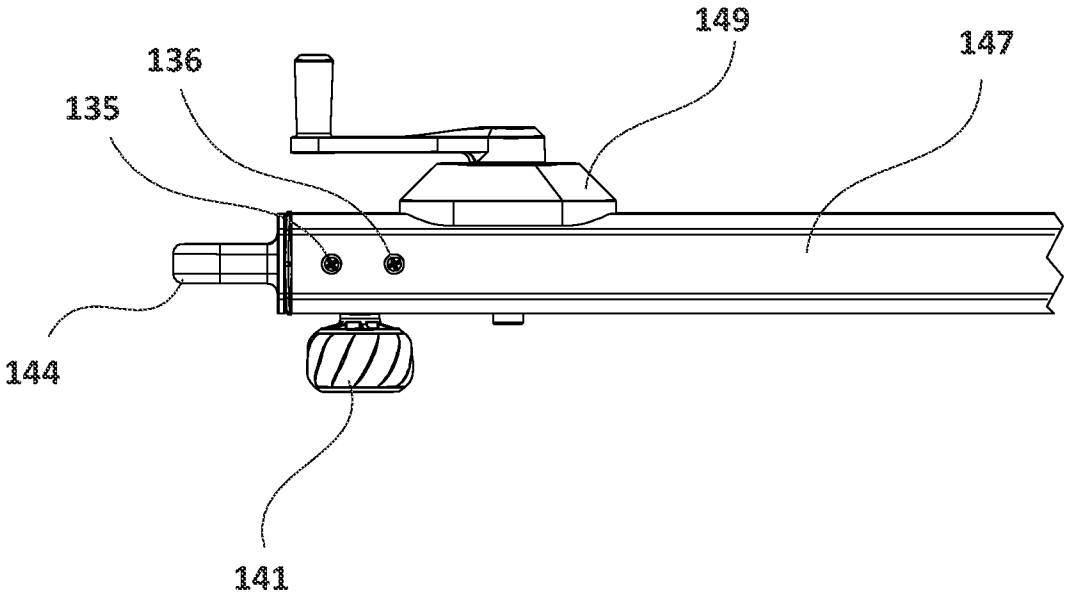
Figure 266:
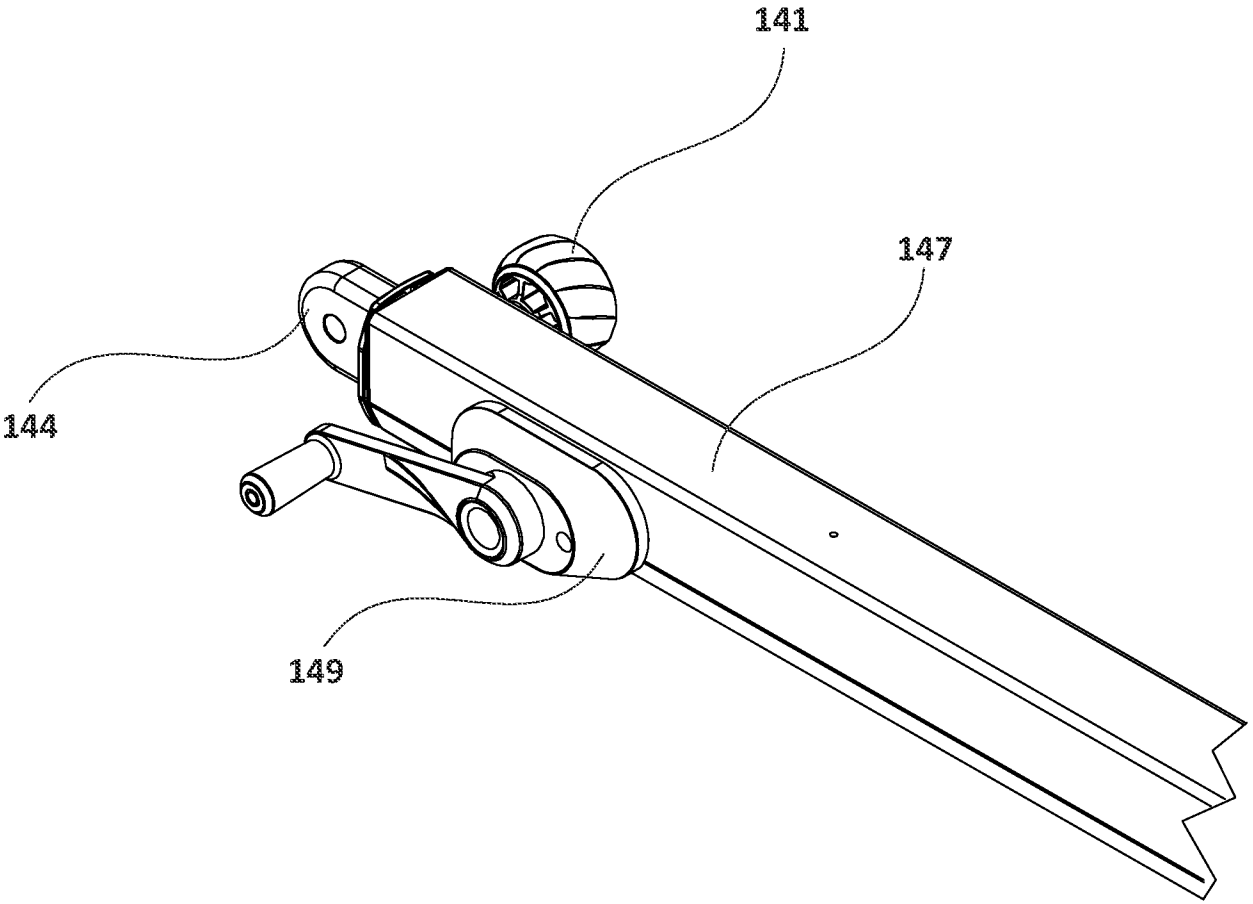
Figure 267:
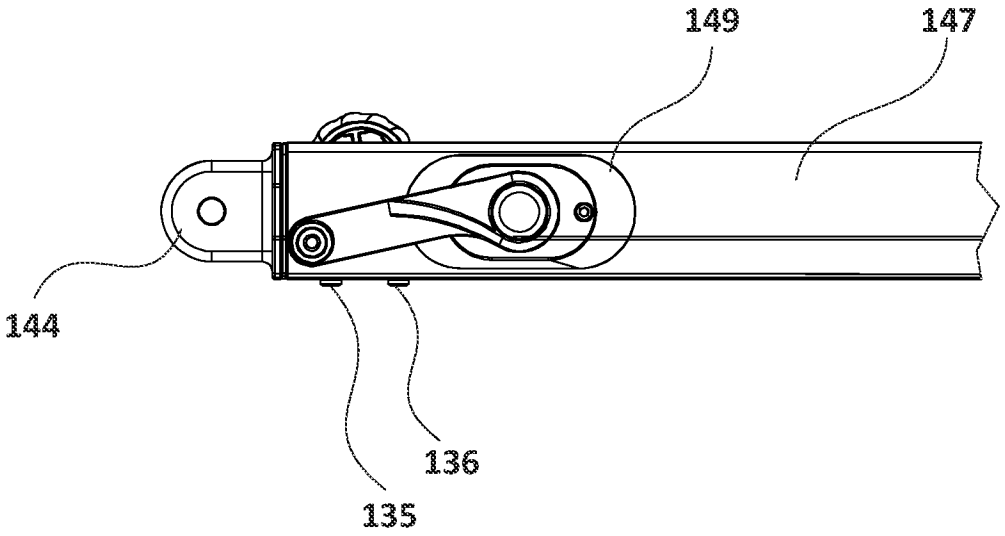
Figure 268:
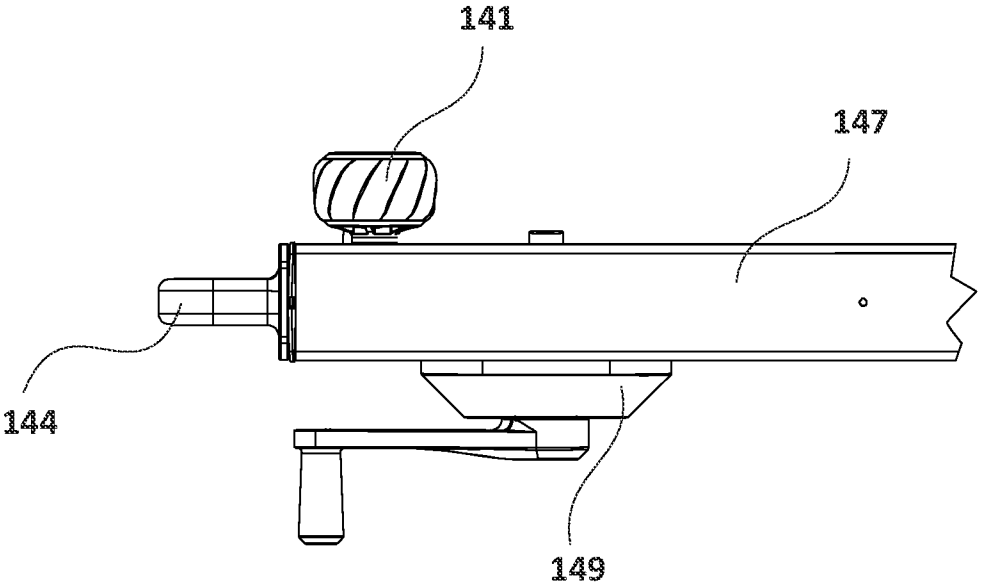
Figure 269:
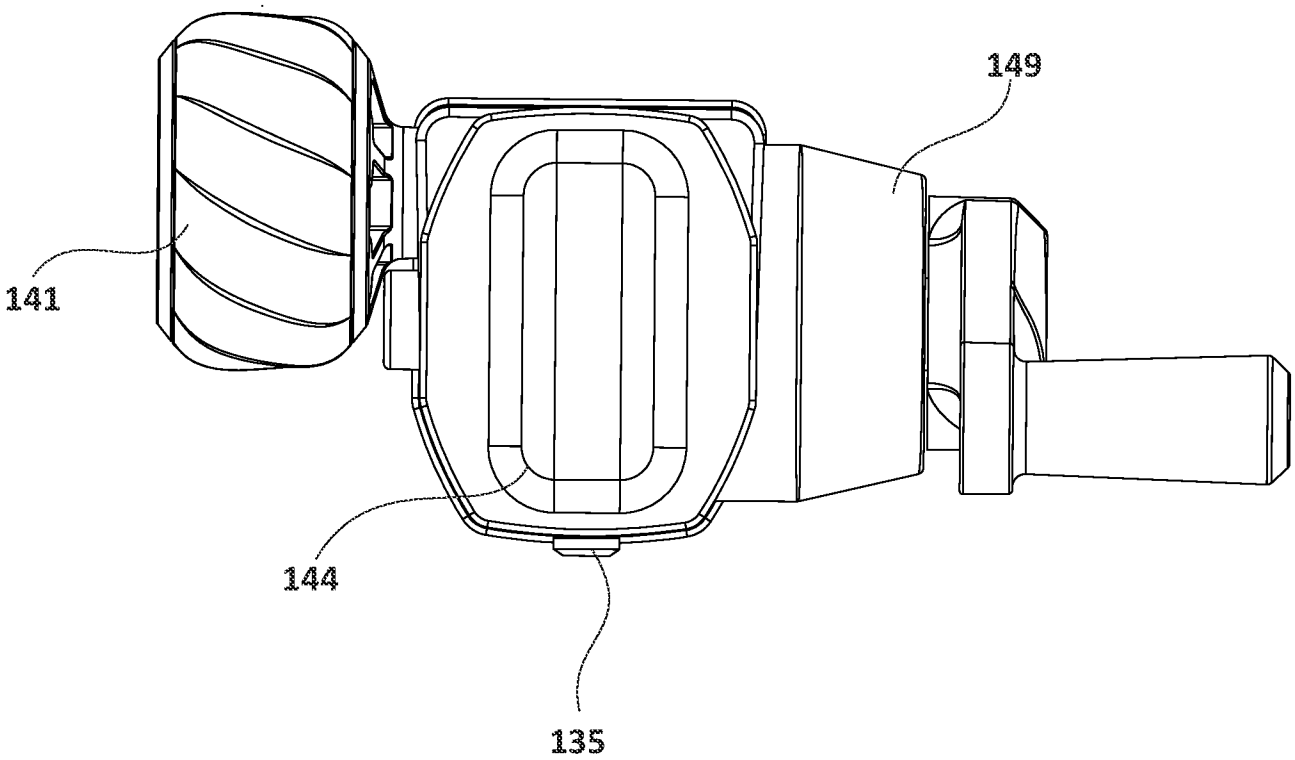
Figure 270:
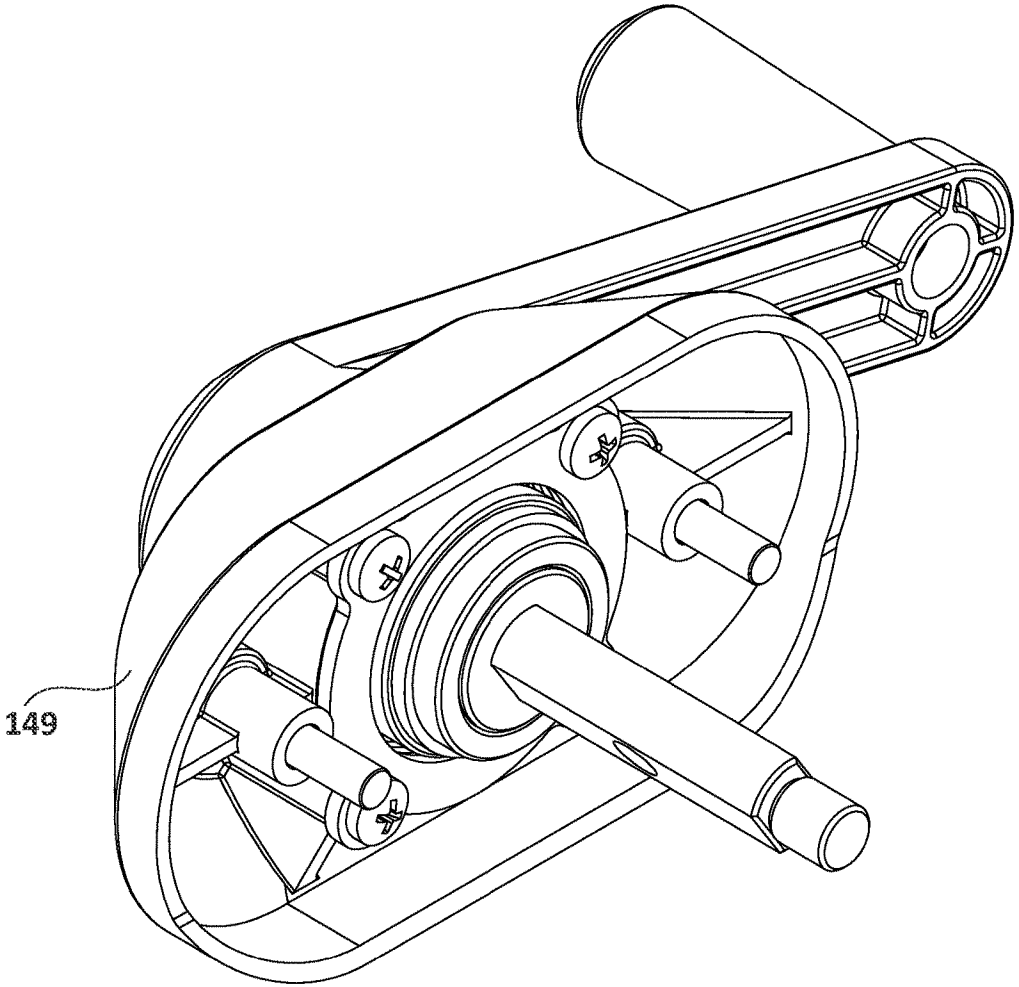
Figure 271:
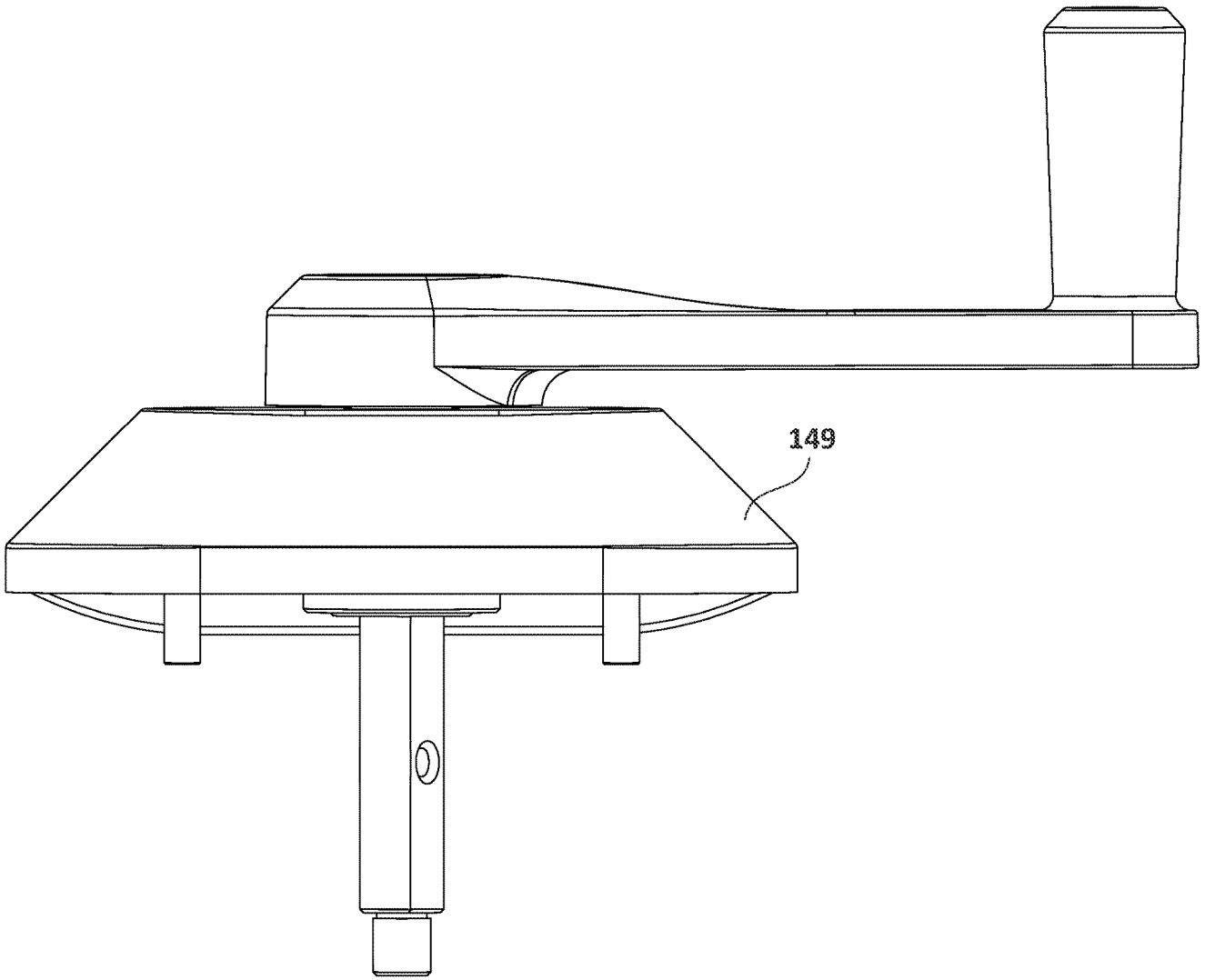
Figure 272:
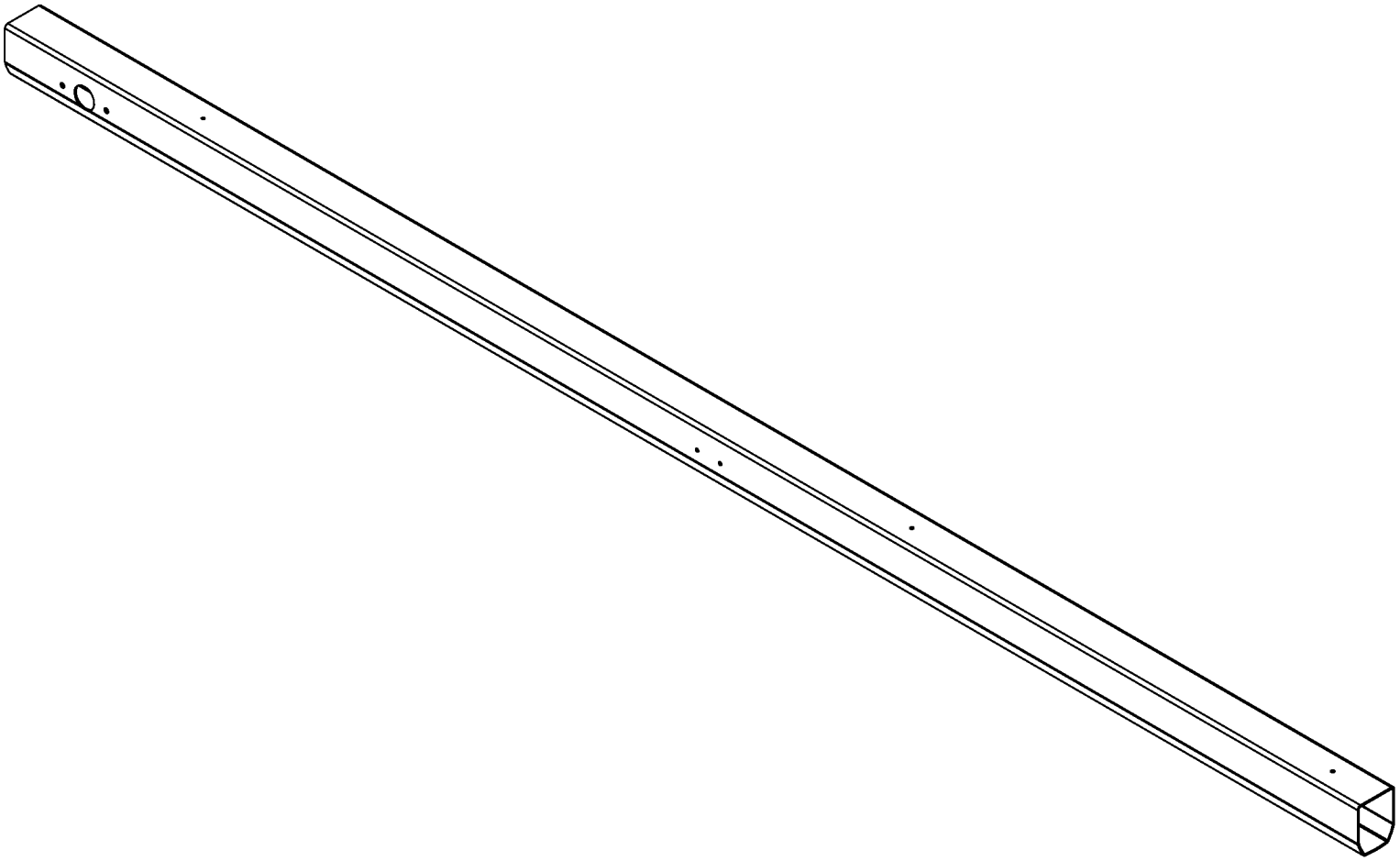
Figure 273:
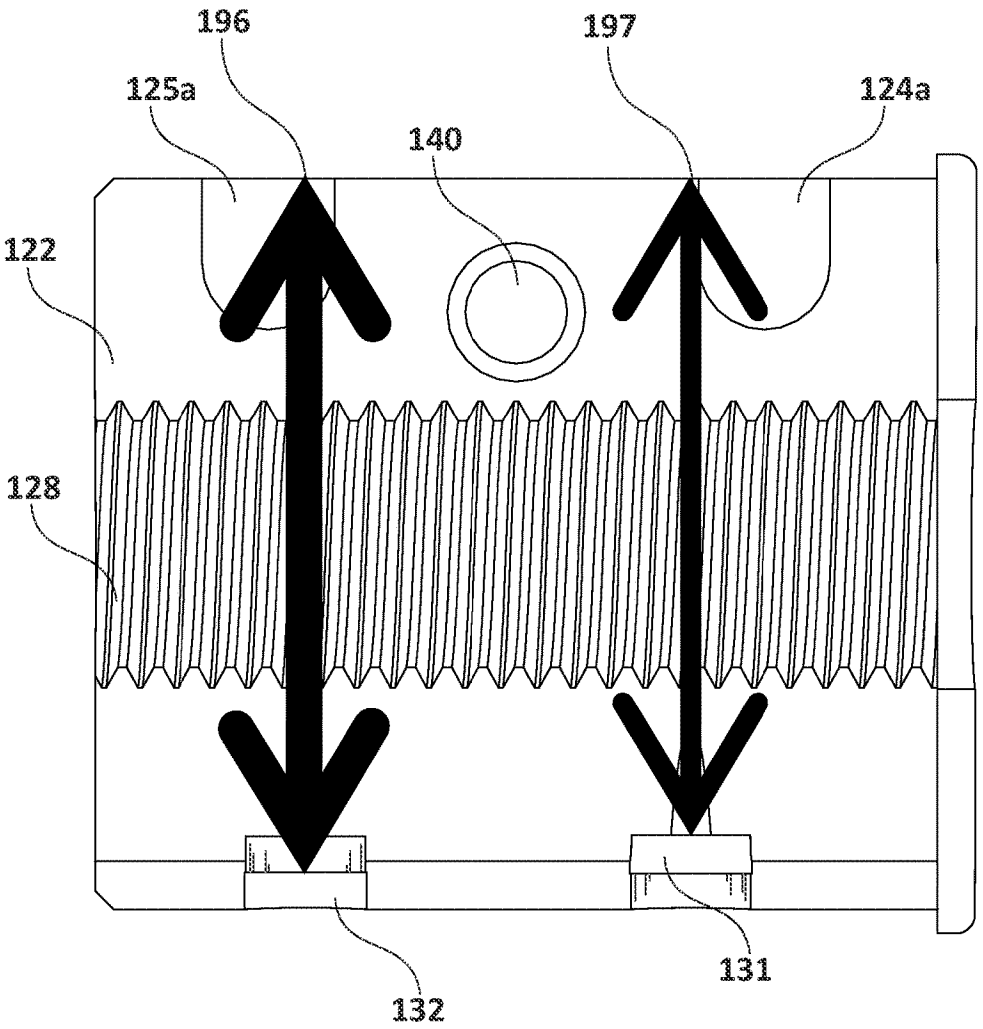
Figure 274:
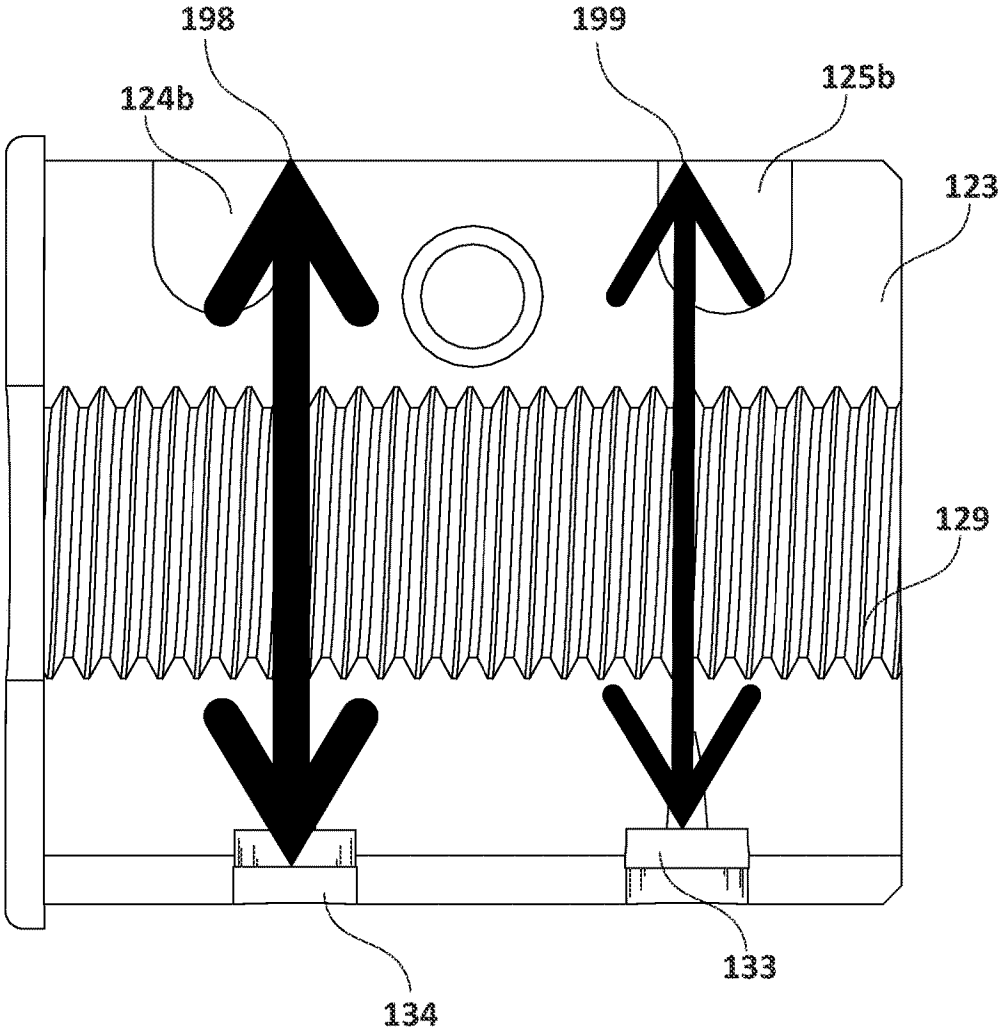
Figure 275:
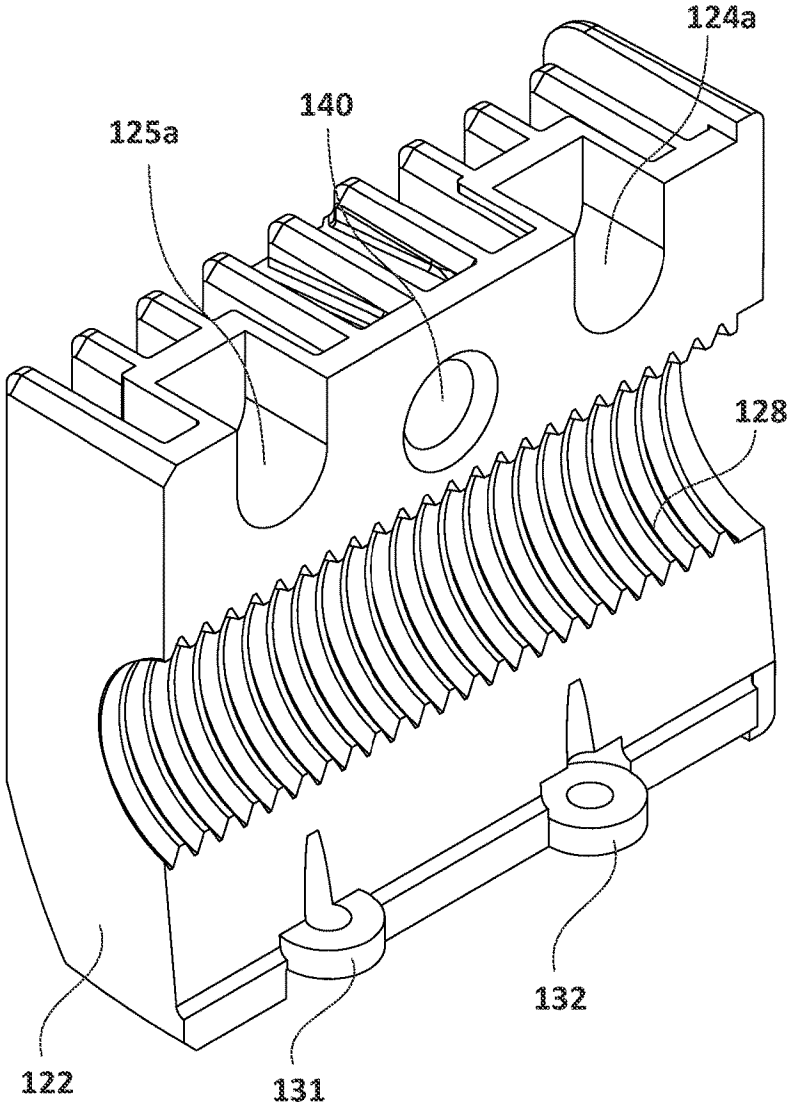
Figure 276:
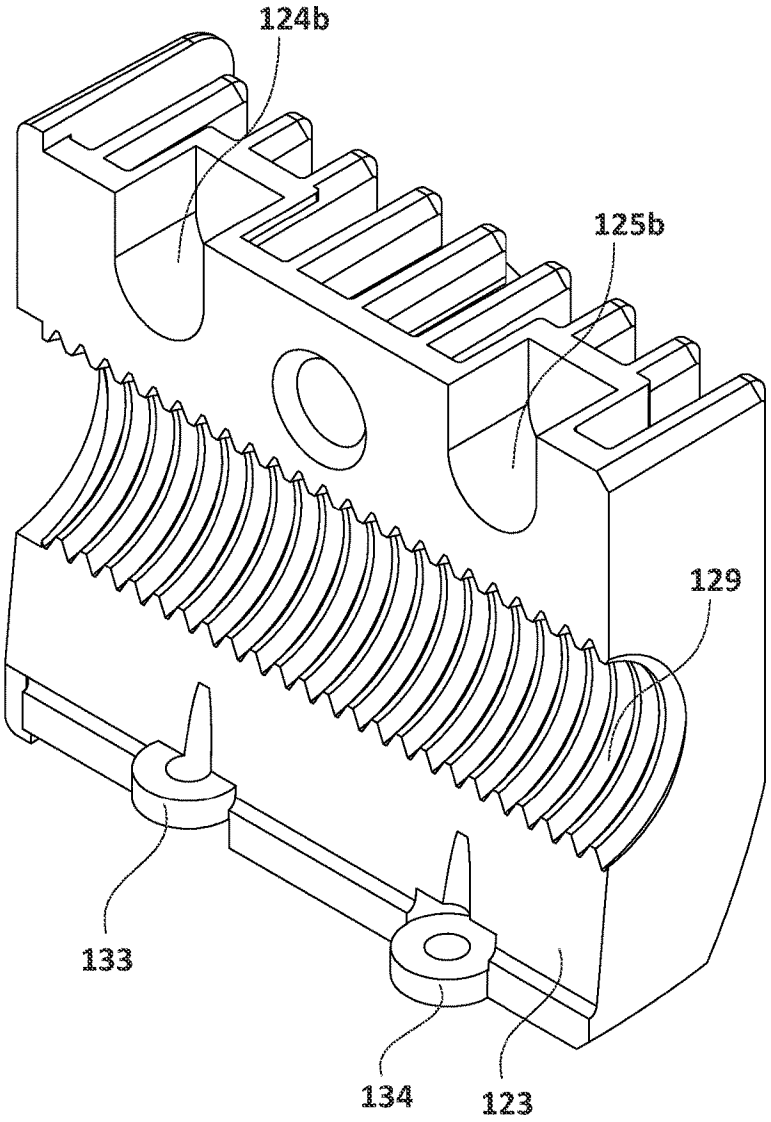
Figure 277:
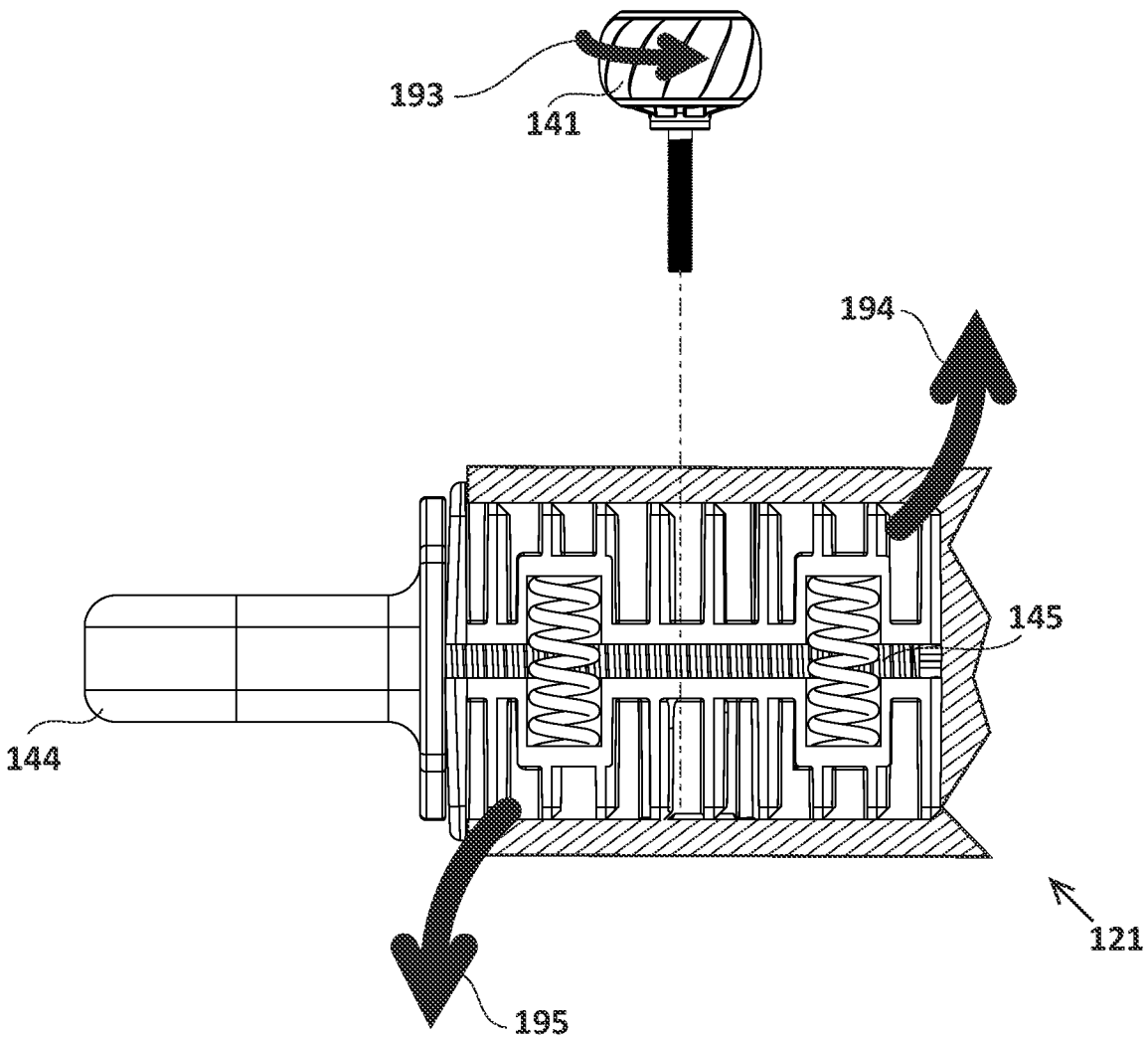
Figure 278:
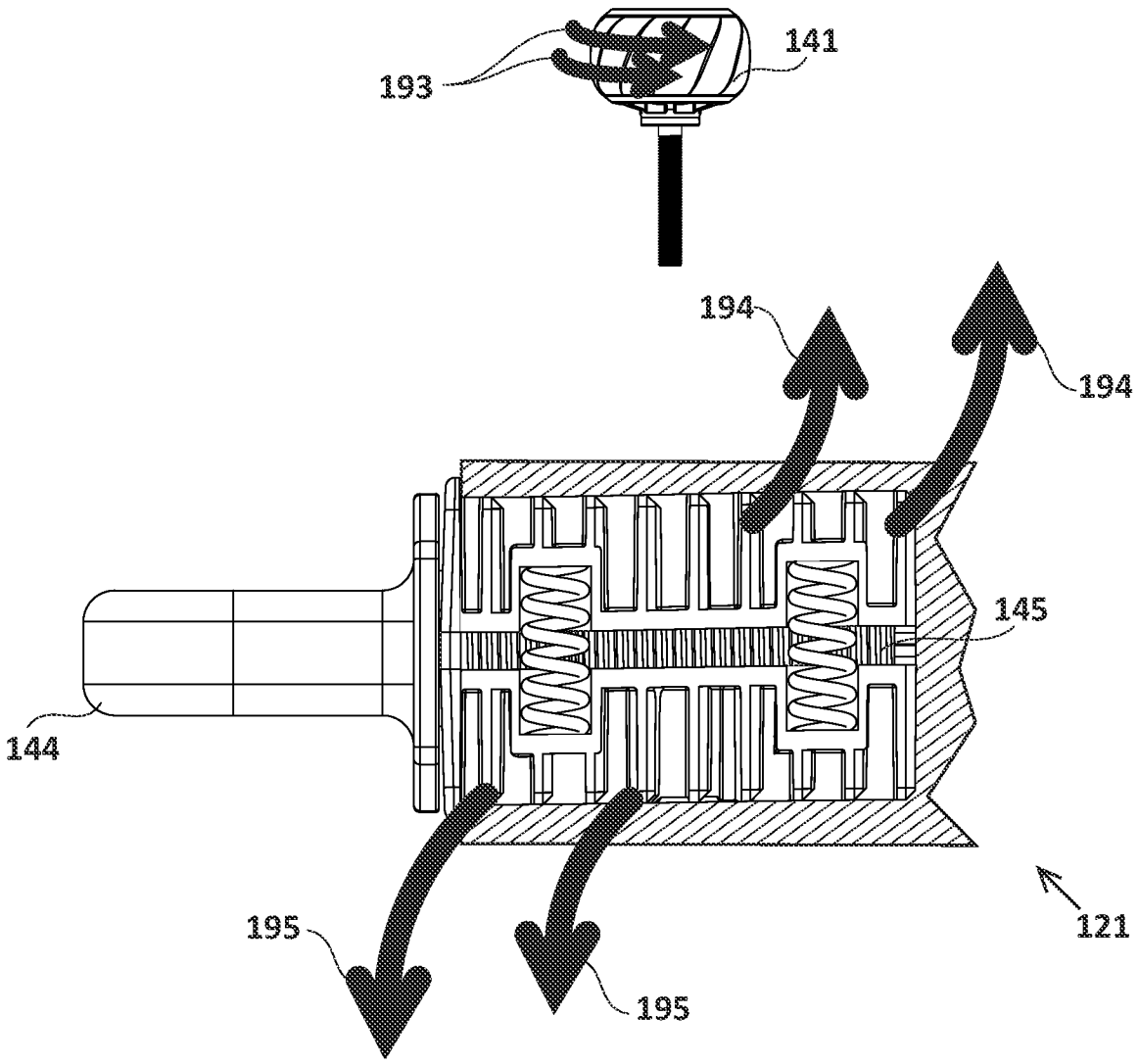
Figure 279:
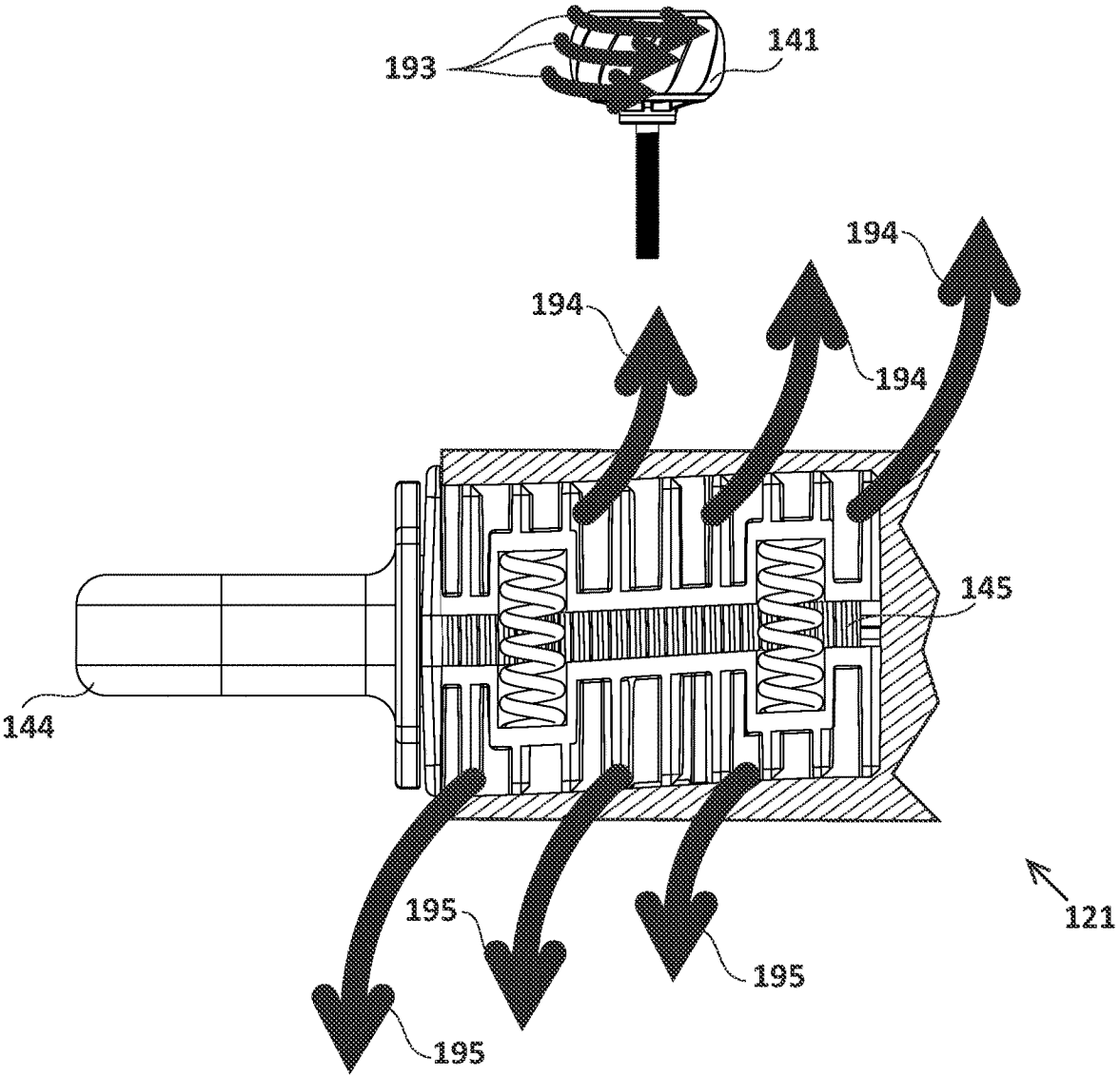
Figure 280:
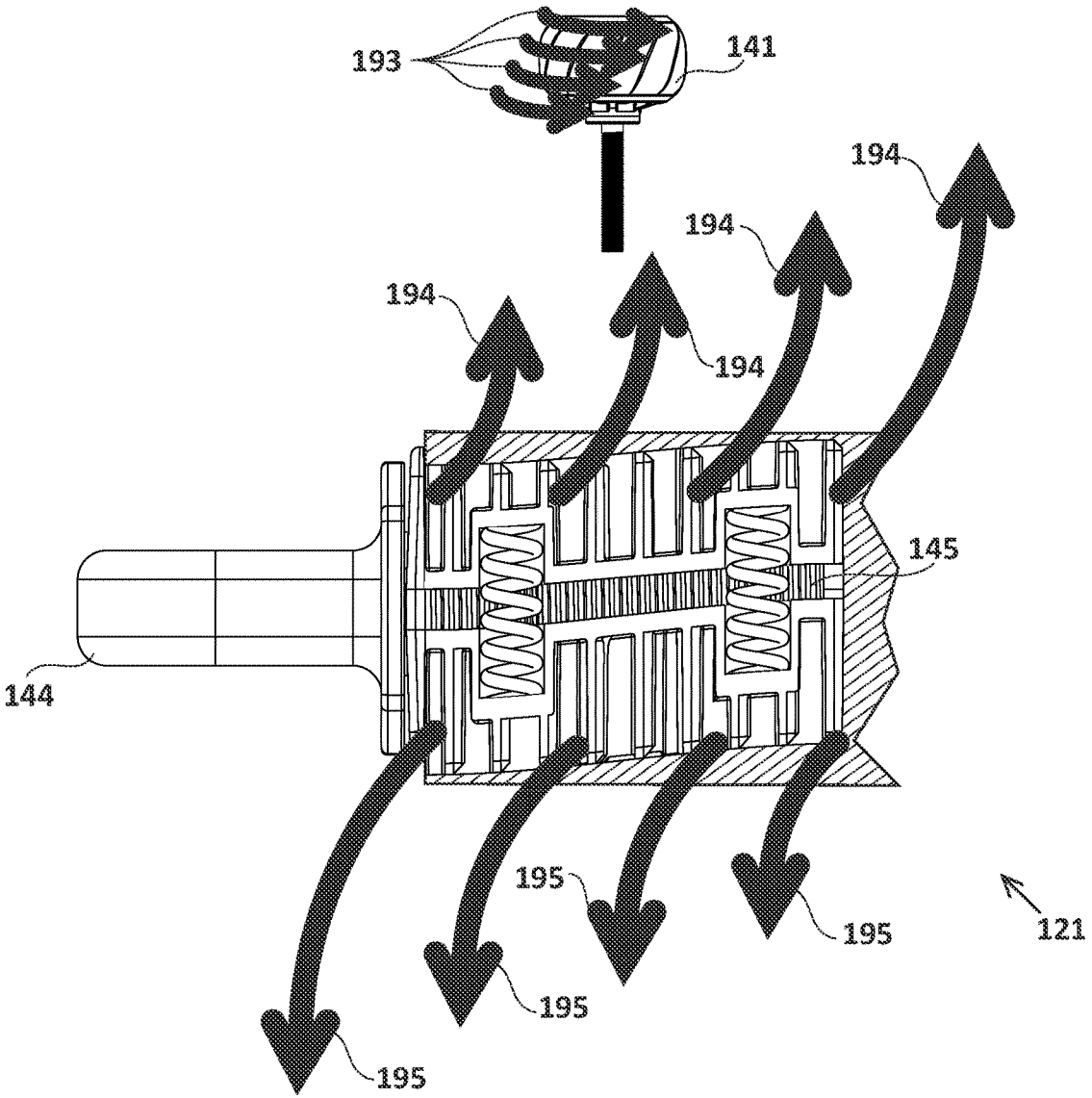
Figure 281:
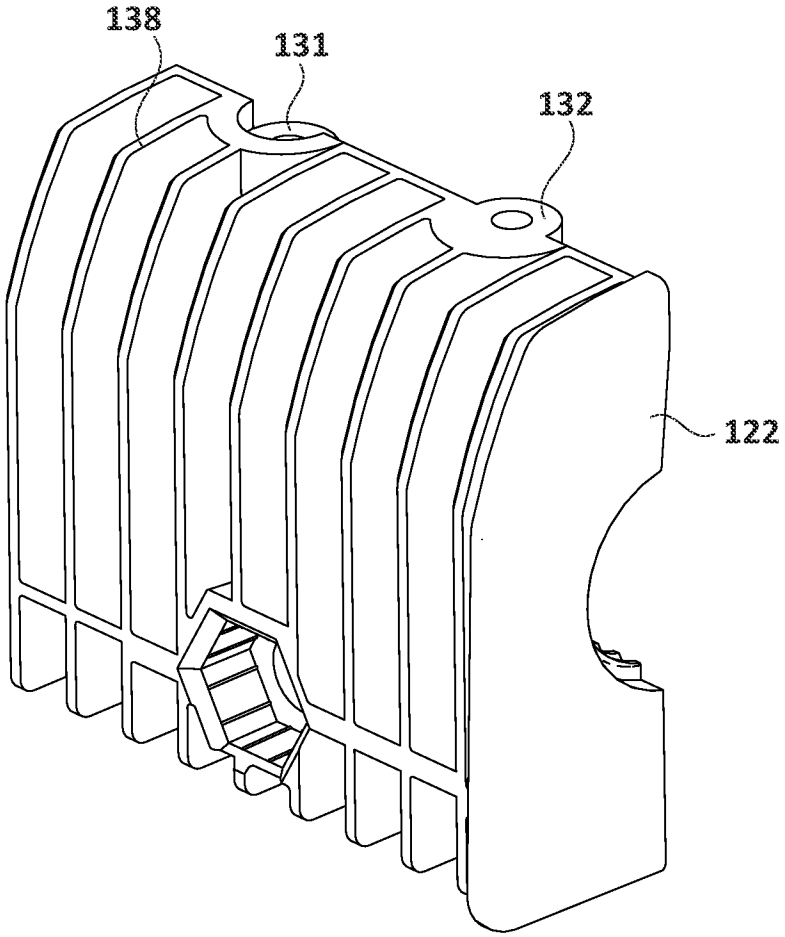
Figure 282:
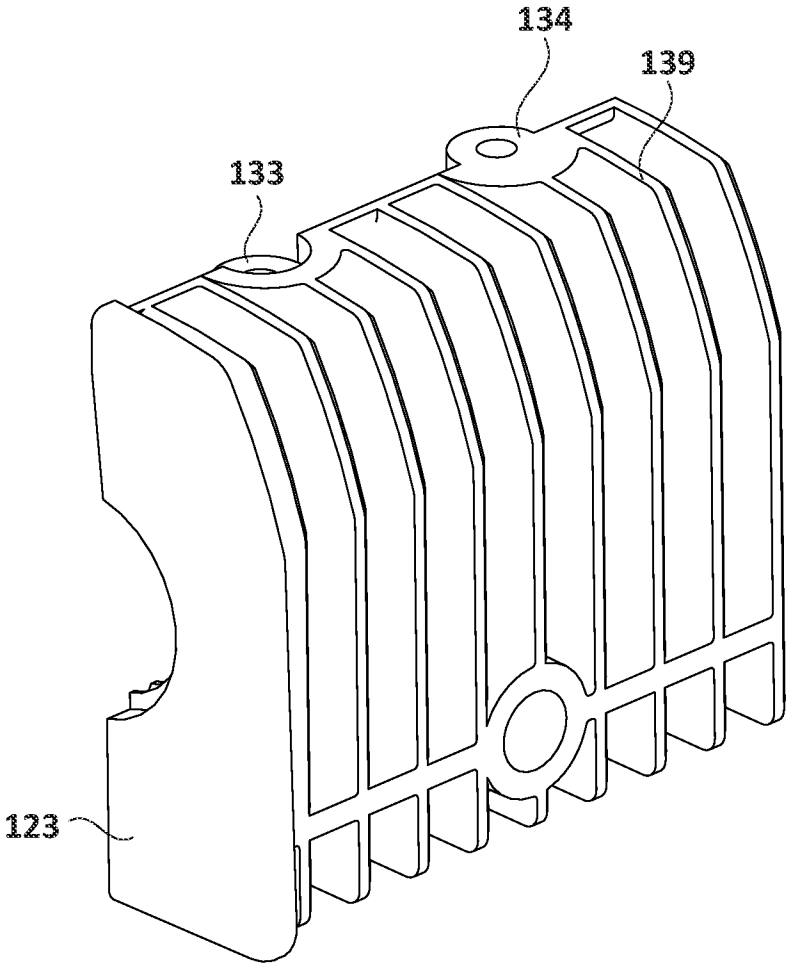
Figure 283:
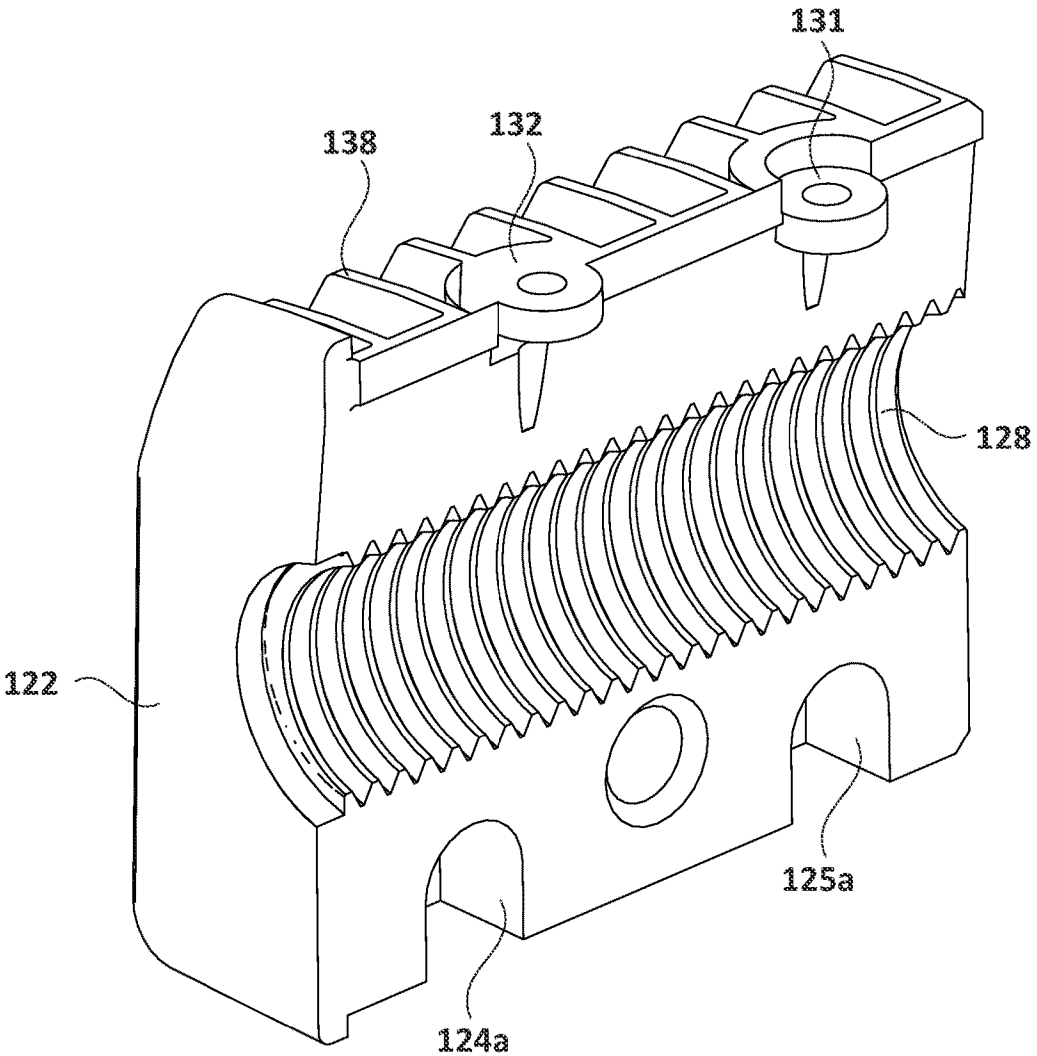
Figure 284:
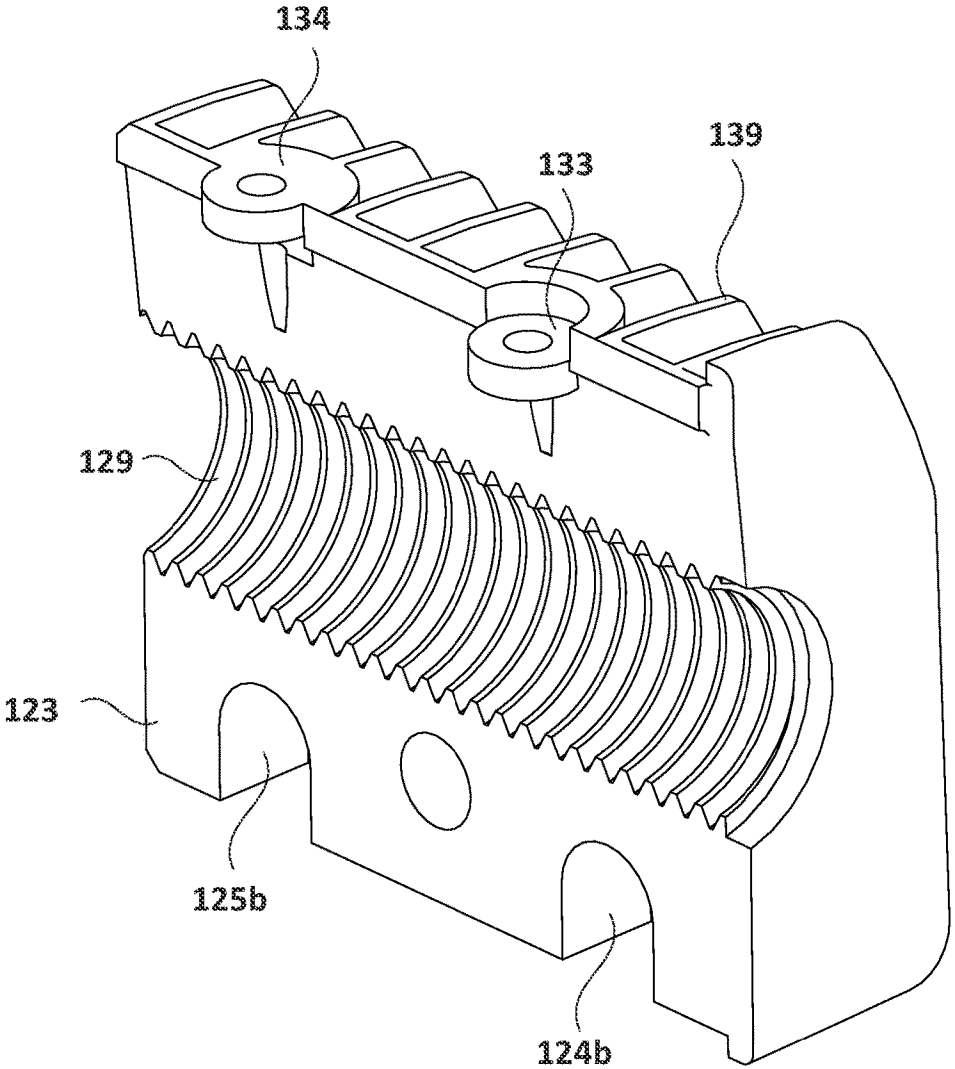
Figure 285:
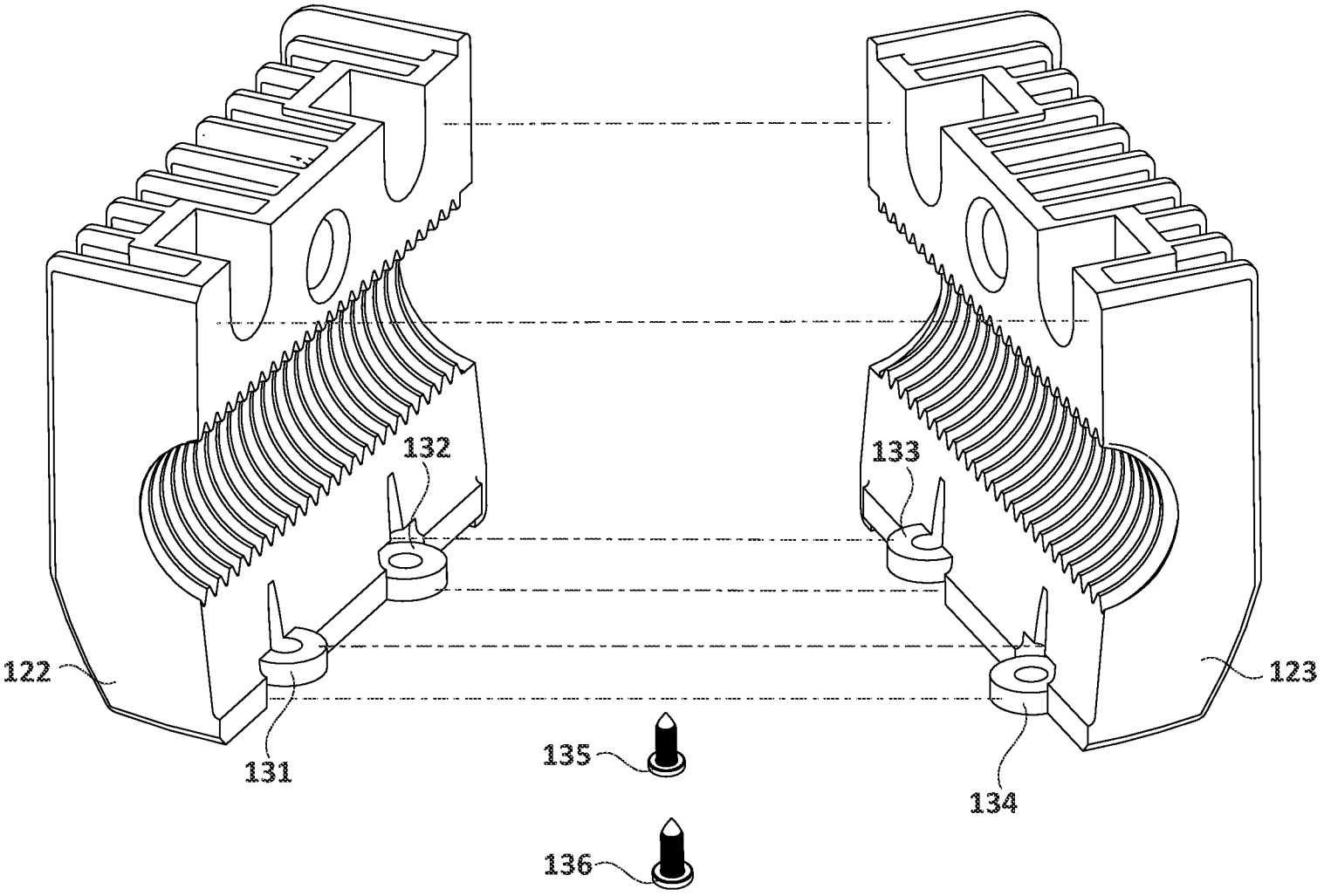
Figure 286:
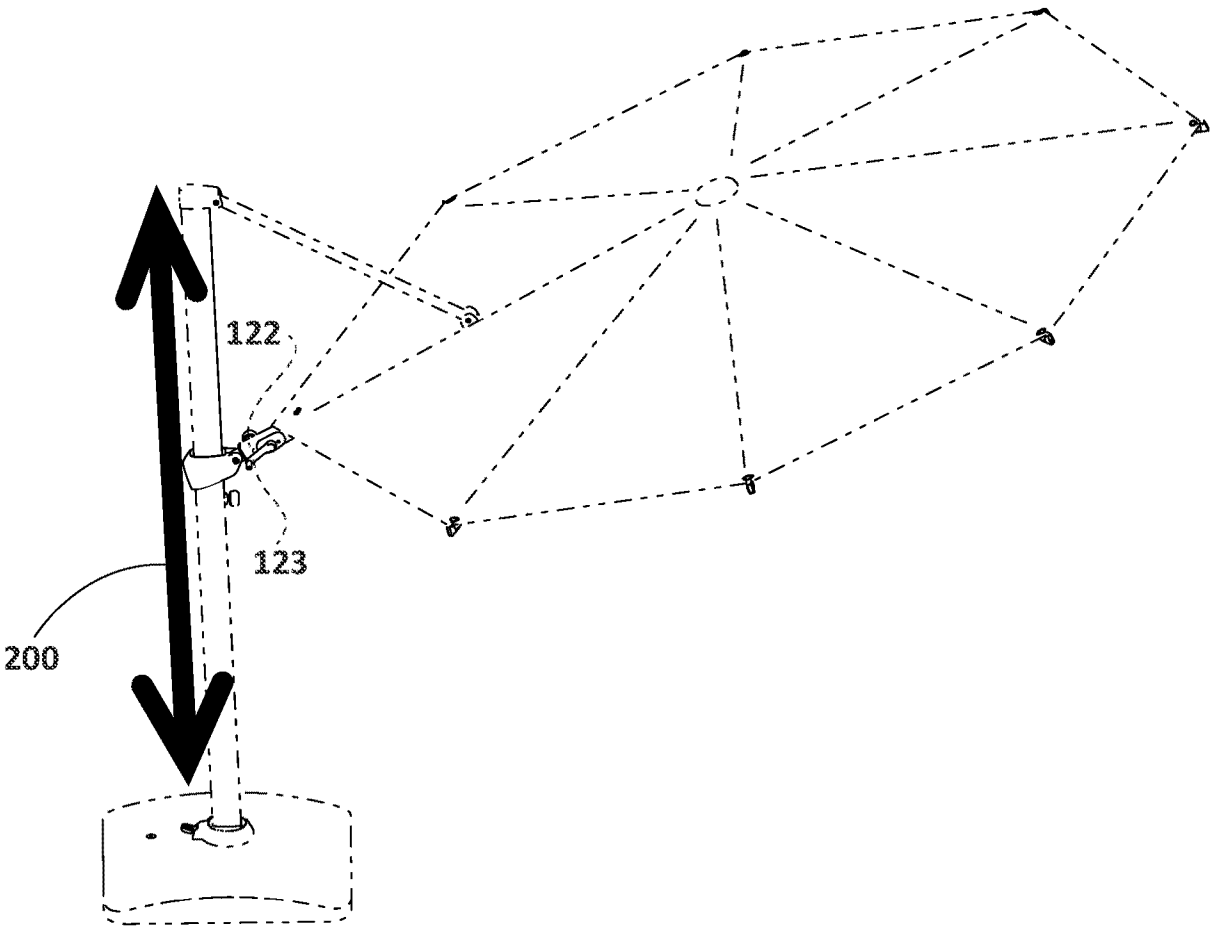
Figure 287:
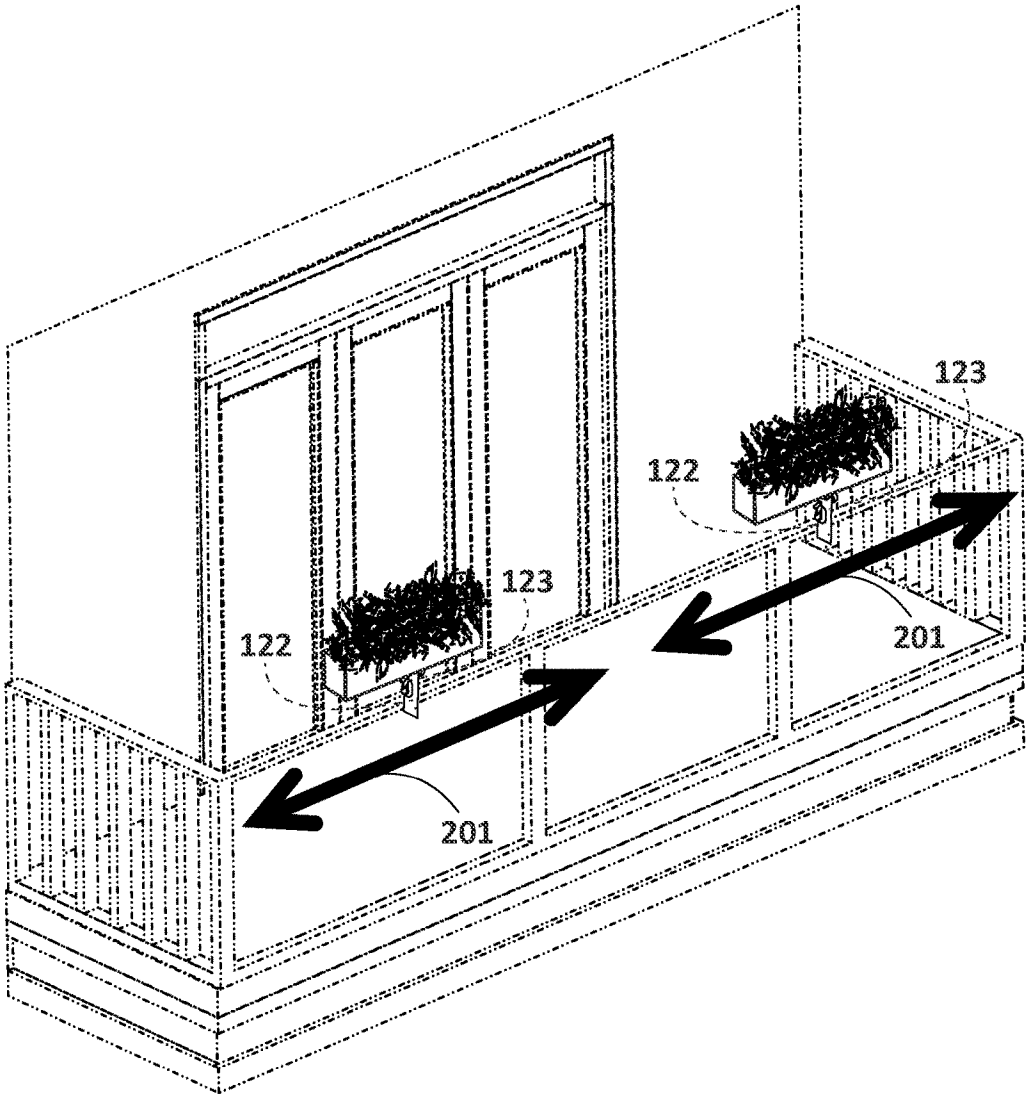
Figure 288:
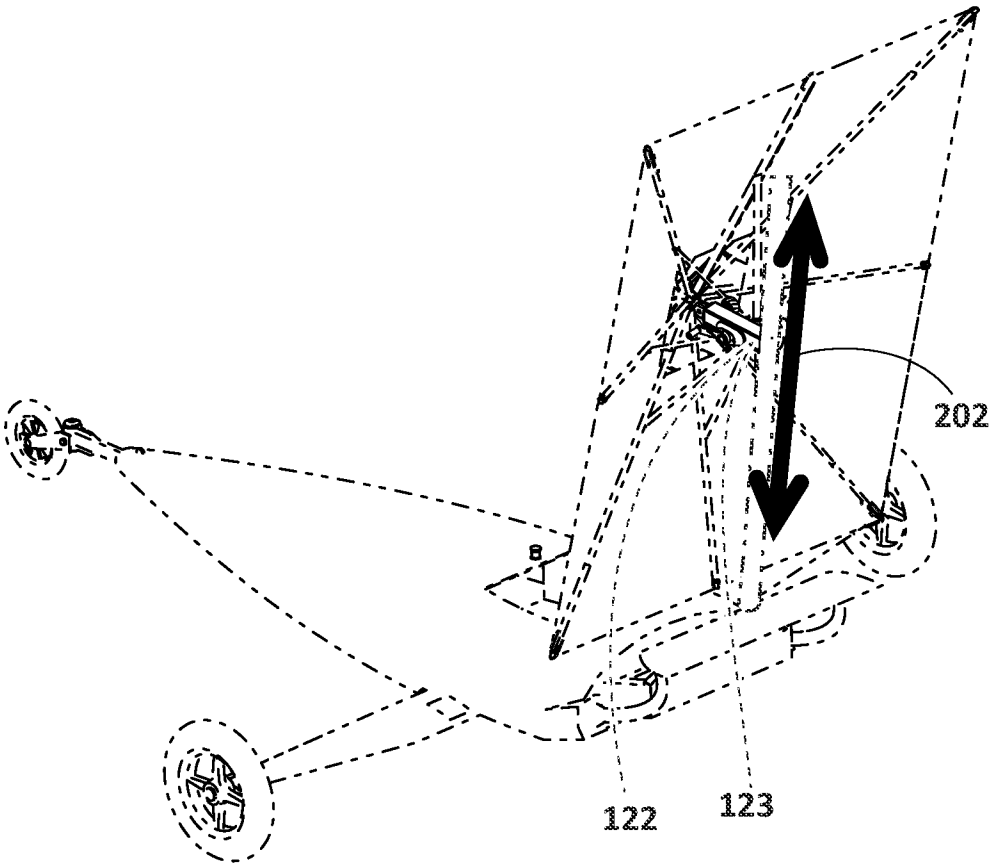
Figure 289:
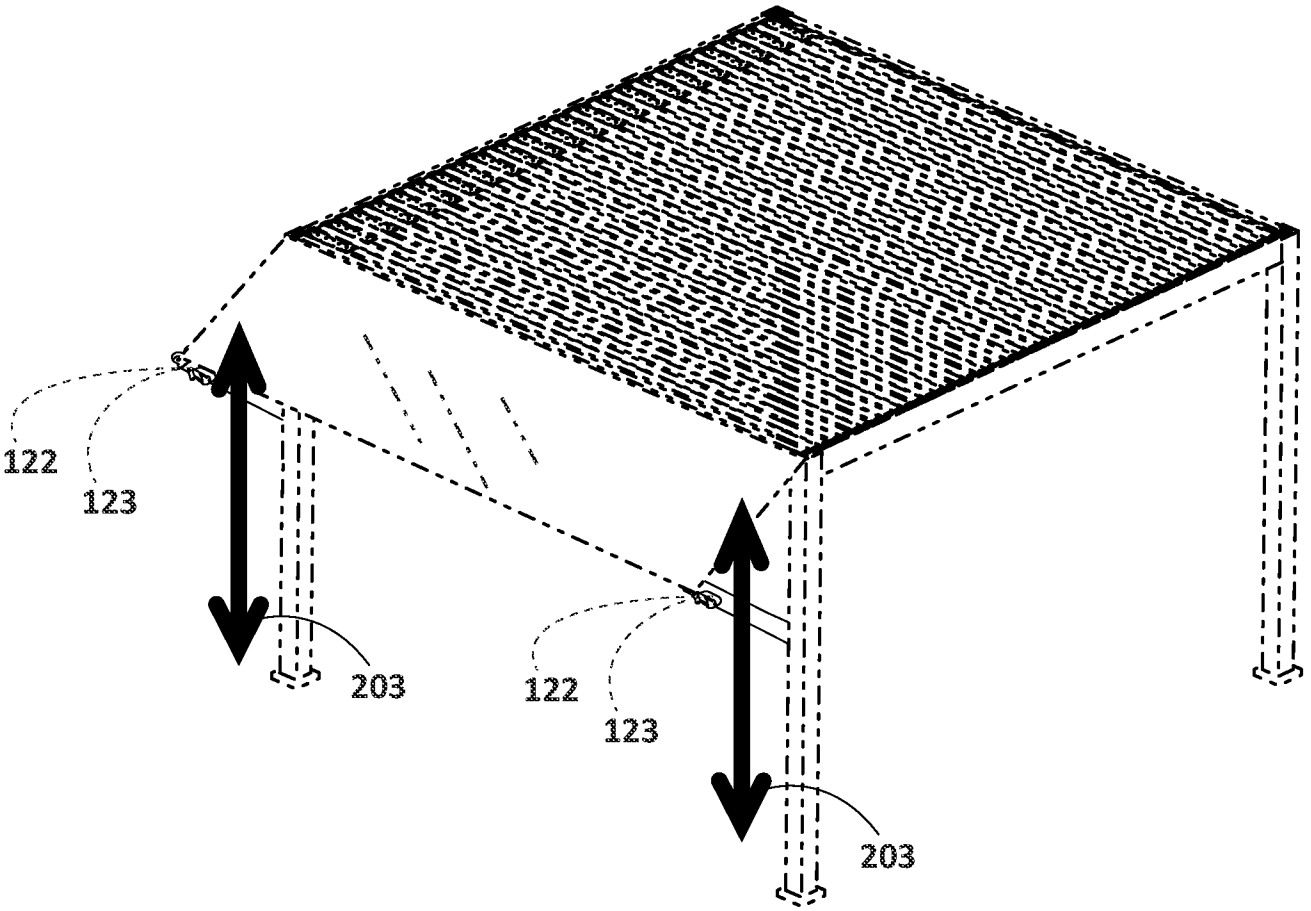
Figure 290:
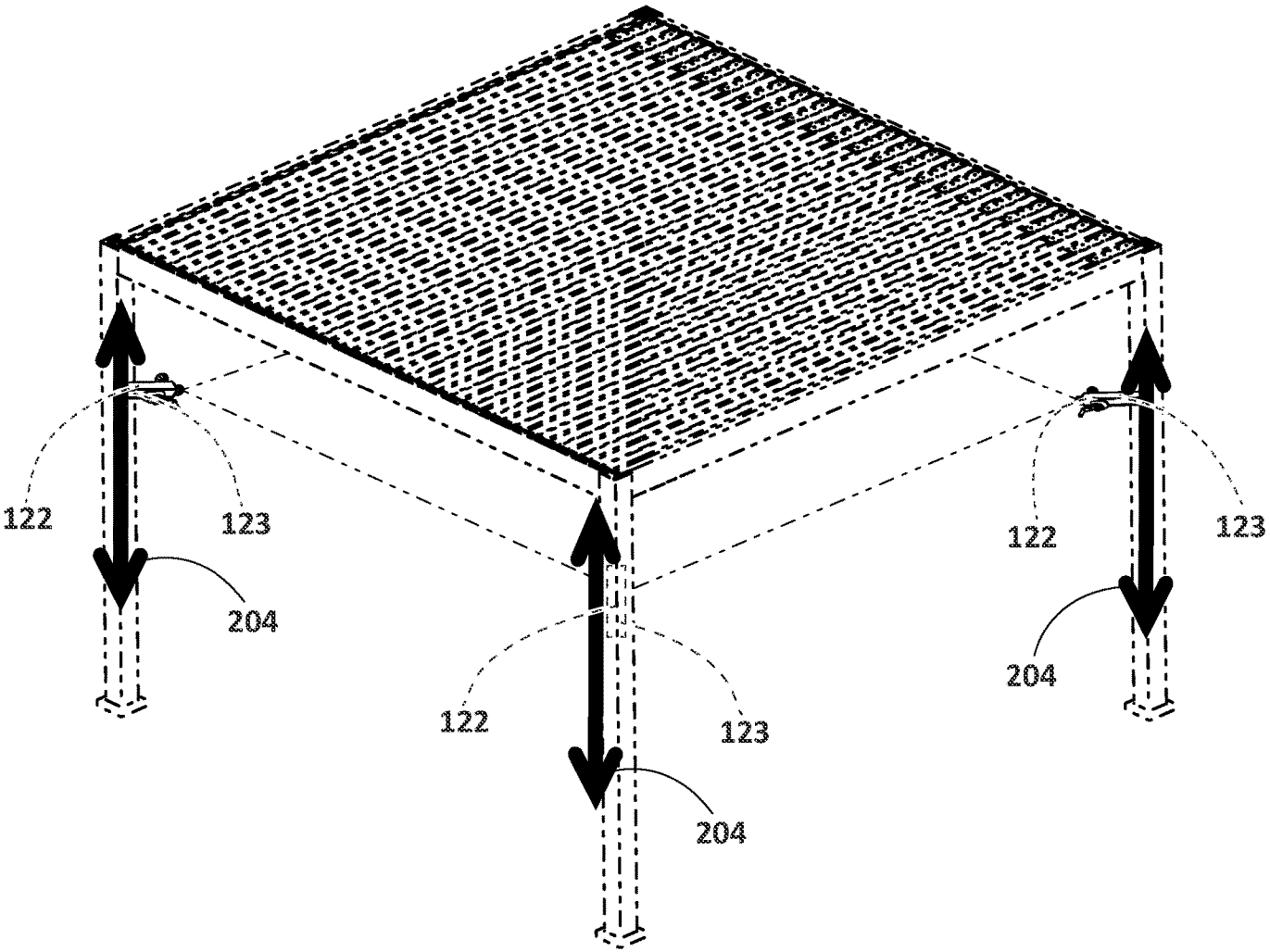

Referring to FIG. 1A-FIG. 206:

Component

In an example embodiment, the Arthritic-assisting anti-vibration anti-friction anti-pinching track system 101 comprising: Arthritic-assisting anti-vibration anti-friction back roller-tracks 102, Arthritic-assisting anti-vibration anti-friction front roller-tracks 103, Arthritic-assisting stabilizer-guiding track 104, and Arthritic-assisting stabilizer-securing ridges 105; Arthritic-assisting anti-vibration anti-friction anti-pinching portable-elevator system 106 comprising: Arthritic-assisting anti-vibration anti-friction portable handle-elevator 107*a*, Arthritic-assisting anti-vibration anti-friction handle-elevator-track 107*b*, Arthritic-assisting anti-vibration anti-friction portable roller-elevator 108, Roller openings 109, Roller axles 110, In an example embodiment, the Arthritic-assisting anti-vibration anti-friction portable rollers 111, Arthritic-assisting raising angle-handle 112*a*, Arthritic-assisting lowering angle-handle 112*b*, Multi-elevator stabilizer 113, Arthritic-assisting multi-elevator-locking hand-knob 114, Arthritic-assisting multi-elevator-locking lock 115, Multi-elevator-locking nut 116, Multi-elevator-locking screw 117, Multi-function joint 118, Multi-function track pole 119, Multi-function screw rivet 120; Anti-slipping anti-cracking opposite-twisting-jaw system 121 comprising: First production-increasing anti-slipping anti-cracking opposite-twisting jaw 122, Second production-increasing anti-slipping anti-cracking opposite-twisting jaw 123, First twist-spreading-spring housings 124*a* and 124*b*, Second twist-spreading-spring housings 125*a* and 125*b*, First twist-spreading spring 126, Second twist-spreading spring 127, First anti-slipping twist-clamping threads 128, and Second anti-slipping twist-clamping threads 129; Multi-elevation twistable-tube system 130 comprising: First upper-elevation twistable tube 131, First lower-elevation twistable tube 132, Second upper-elevation twistable tube 133, Second lower-elevation twistable tube 134, First multi-elevation-twisting-tube screw 135, and Second multi-elevation-twisting-tube screw 136; Anti-crack reinforcing twistable-rib system 137 comprising: First reinforcing twistable ribs 138, Second reinforcing twistable ribs 139, Hand-knob hole 140, Arthritic-assisting twist-clamping-jaw hand-knob 141, and Hand-knob nut 142; Multi-application pivoting-connector system 143 comprising: Pivoting connector 144, and Threaded connector core 145; Opposite-twisting-jaw-housing tunnel system 146 comprising: Opposite-twisting-jaw-housing tunnel 147, 2 opposite-twisting-jaw-securing holes 148, and Cord-cranking mechanism 149; Production-increasing cost-saving identical-half-base-top system 150 comprising: 2 production-increasing cost-saving identical-half-base-tops 151, Crank-storing extra-umbrella-pole-locking hole 152, Crank-storing-hole plug 153, and Caster-leg hole 154; Production-increasing cost-saving identical-half-base-bottom system 155 comprising: 2 production-increasing cost-saving identical-half-base-bottoms 156, 6 separation-preventing double-opposite-ridge-interlocks 157*a*, 6 separation-preventing double-opposite-interpockets 157*b*, 4 pole-mounting-hole stems 158, Weight compartments 159, 4 Brace slots 160, 4 Base-supporting braces 161, 6 Roller slots 162, and 6 angle-operated edge rollers 163; Adjustable-hidable angle-operated caster system 164 comprising: Caster chamber 165, Adjustable-hidable angle-operated caster 166, Caster leg 167, Caster-leg-wrenching recess 168, and Caster mount 169; and Deployable-hidable crank-and-bolt-lock system 170 comprising: Crank chamber 171, 2 deployable-retractable crank-handle-and-bolt-locks 172, 2 handle covers 173, Crank core 174, and Removable-hidable wrench 175.

Material

Referring to FIG. 1A-FIG. 206: In an example embodiment, the Arthritic-assisting anti-vibration anti-friction anti-pinching track system 101 may be made of the combined materials of its components. Arthritic-assisting anti-vibration anti-friction back roller-tracks 102 may each be made of the material of metal or plastic. Arthritic-assisting anti-vibration anti-friction front roller-tracks 103 may each be made of the material of metal. Arthritic-assisting stabilizer-guiding track 104 may be made of the material of metal or plastic. Arthritic-assisting stabilizer-securing ridges 105 may each be made of the material of metal or plastic.

In an example embodiment, the Arthritic-assisting anti-vibration anti-friction anti-pinching portable-elevator system 106 may be made of the combined materials of its components. Arthritic-assisting anti-vibration anti-friction portable handle-elevator 107*a* may be made of the material of metal or plastic. Arthritic-assisting anti-vibration anti-friction handle-elevator-tracks 107*b* may each be made of the material of metal or plastic. Arthritic-assisting anti-vibration anti-friction portable roller-elevator 108 may be made of the material of metal or plastic. Roller openings 109 may each be made of the material of metal or plastic.

In an example embodiment, the Roller axles 110 may each be made of the material of metal or plastic. Arthritic-assisting anti-vibration anti-friction portable rollers 111 may each be made of the material of rubber, metal, or plastic. Arthritic-assisting raising angle-handle 112*a* may be made of the material of metal or plastic. Arthritic-assisting lowering angle-handle 112*b* may be made of the material of metal or plastic. Multi-elevator stabilizer 113 may be made of the material of metal or plastic. Arthritic-assisting multi-elevator-locking hand-knob 114 may be made of the material of rubber, metal, or plastic. Arthritic-assisting multi-elevator-locking lock 115 may be made of the material of metal or plastic. Multi-elevator-locking nut 116 may be made of the material of metal or plastic. Multi-elevator-locking screw 117 may be made of the material of metal or plastic.

In an example embodiment, the Multi-function joint 118 may be made of the material of metal or plastic. Multi-function track pole 119 may be made of the material of metal or plastic. Multi-function screw rivet 120 may be made of the material of metal or plastic. Anti-slipping anti-cracking opposite-twisting-jaw system 121 may be made of the combined materials of its components. First production-increasing anti-slipping anti-cracking opposite-twisting jaw 122 may be made of the material of metal or plastic. Second production-increasing anti-slipping anti-cracking opposite-twisting jaw 123 may be made of the material of metal or plastic.

In an example embodiment, the First twist-spreading-spring housings 124*a* and 124*b* may each be made of empty space. Second twist-spreading-spring housings 125*a* and 125*b* may each be made of empty space. First twist-spreading spring 126 may be made of the material of metal or plastic. Second twist-spreading spring 127 may be made of the material of metal or plastic. First anti-slipping twist-clamping threads 128 may each be made of the material of metal or plastic. Second anti-slipping twist-clamping threads 129 may each be made of the material of metal or plastic. Multi-elevation twistable-tube system 130 may be made of the combined materials of its components. First upper-elevation twistable tube 131 may be made of the material of metal or plastic. First lower-elevation twistable tube 132 may be made of the material of metal or plastic. Second upper-elevation twistable tube 133 may be made of the material of metal or plastic. Second lower-elevation twistable tube 134 may be made of the material of metal or plastic. First multi-elevation-twisting-tube screw 135 may be made of the material of metal or plastic. Second multi-elevation-twisting-tube screw 136 may be made of the material of metal or plastic.

In an example embodiment, the Anti-crack reinforcing twistable-rib system 137 may be made of the combined materials of its components. First reinforcing twistable ribs 138 may each be made of the material of metal or plastic. Second reinforcing twistable ribs 139 may each be made of the material of metal or plastic. Hand-knob hole 140 may be made of empty space. Arthritic-assisting twist-clamping-jaw hand-knob 141 may be made of the material of rubber, metal, and/or plastic. Hand-knob nut 142 may be made of the material of metal or plastic. Multi-application pivoting-connector system 143 may be made of the combined materials of its components. Pivoting connector 144 may be made of the material of metal or plastic. Threaded connector core 145 may be made of the material of metal or plastic. Opposite-twisting-jaw-housing tunnel system 146 may be made of the combined materials of its components. Opposite-twisting-jaw-housing tunnel 147 may be made of the material of metal or plastic. Two opposite-twisting-jaw-securing holes 148 may each be made of empty space. Cord-cranking mechanism 149 may be made of the material of rubber, metal, and/or plastic.

In an example embodiment, the a Production-increasing cost-saving identical-half-base-top system 150 may be made of the combined materials of its components. Two production-increasing cost-saving identical-half-base-tops 151 may each be made of the material of metal or plastic. Crank-storing extra-umbrella-pole-locking hole 152 may be made of the material of metal or plastic. Crank-storing-hole plug 153 may be made of the material of metal or plastic. Caster-leg hole 154 may be made of the material of metal or plastic. Production-increasing cost-saving identical-half-base-bottom system 155 may be made of the combined materials of its components. Two production-increasing cost-saving identical-half-base-bottoms 156 may each be made of the material of metal or plastic. Six separation-preventing double-opposite-ridge-interlocks 157*a* may each be made of the material of metal or plastic. Six separation-preventing double-opposite-interpockets 157*b* may each be made of the material of metal or plastic.

In an example embodiment, the four pole-mounting-hole stems 158 may each be made of the material of metal or plastic. Weight compartments 159 may each be made of the material of metal or plastic. Four brace slots 160 may each be made of the material of metal or plastic. Four Base-supporting braces 161 may each be made of the material of metal or plastic. Six Roller slots 162 may each be made of the material of metal or plastic. Six angle-operated edge rollers 163 may each be made of the material of metal or plastic.

In an example embodiment, the adjustable-hidable angle-operated caster system 164 may be made of the combined materials of its components. Caster chamber 165 may be made of empty space. Adjustable-hidable angle-operated caster 166 may be made of the material of metal and/or plastic. Caster leg 167 may be made of the material of metal or plastic. Caster-leg-wrenching recess 168 may be made of empty space. Caster mount 169 may be made of the material of metal or plastic. Deployable-hidable crank-and-bolt-lock system 170 may be made of the combined materials of its components. Crank chamber 171 may be made of empty space.

In an example embodiment, the two deployable-retractable crank-handle-and-bolt-locks 172 may each be made of the material of metal or plastic. Two handle covers 173 may each be made of the material of metal or plastic. Crank core 174 may be made of the material of metal or plastic. Removable-hidable wrench 175 may be made of the material of metal or plastic.

Shape

Referring to FIG. 1A-FIG. 206:

In an example embodiment, the arthritic-assisting anti-vibration anti-friction anti-pinching track system 101 may be formed into the combined shapes of its components. Arthritic-assisting anti-vibration anti-friction back roller-tracks 102 may each be formed into the shape of a groove having a cross-section of letter C. Arthritic-assisting anti-vibration anti-friction front roller-tracks 103 may each be formed into the shape of a groove with a letter-C cross-section. Arthritic-assisting stabilizer-guiding track 104 may be formed into the shape of a groove with a letter-U cross-section.

In an example embodiment, the arthritic-assisting stabilizer-securing ridges 105 may each be formed into the shape of a stick with a letter-C-or-I cross-section. Arthritic-assisting anti-vibration anti-friction anti-pinching portable-elevator system 106 may be formed into the combined shapes of its components. Arthritic-assisting anti-vibration anti-friction portable handle-elevator 107*a* may be formed into the shape of a tube.

In an example embodiment, the arthritic-assisting anti-vibration anti-friction handle-elevator-tracks 107*b* may each be formed into the shape of a groove with a letter-U cross-section. Arthritic-assisting anti-vibration anti-friction portable roller-elevator 108 may be formed into the shape of a tube. Roller openings 109 may each be formed into the shape of a rectangle.

In an example embodiment, the roller axles 110 may each be formed into the shape of a cylinder. Arthritic-assisting anti-vibration anti-friction portable rollers 111 may each be formed into the shape of a ring. Arthritic-assisting raising angle-handle 112*a* may be formed into the shape of a folded triangle. Arthritic-assisting lowering angle-handle 112*b* may be formed into the shape of a folded triangle.

In an example embodiment, the multi-elevator stabilizer 113 may be formed into the shape of 2 rectangular sticks molded to each other. Arthritic-assisting multi-elevator-locking hand-knob 114 may be formed into the shape of a cheese wheel with a threaded screw. Arthritic-assisting multi-elevator-locking lock 115 may be formed into the shape of a cheese wheel and a rectangular stick molded to each other with a through hole. Multi-elevator-locking nut 116 may be formed into the shape of a nut.

In an example embodiment, the multi-elevator-locking screw 117 may be formed into the shape of a crew. Multi-function joint 118 may be formed into the shape of two separate triangles. Multi-function track pole 119 may be formed into the shape of a ring. Multi-function screw rivet 120 may be formed into the shape of a tube with a ring end. Anti-slipping anti-cracking opposite-twisting-jaw system 121 may be formed into the combined shapes of its components. First production-increasing anti-slipping anti-cracking opposite-twisting jaw 122 may be formed into the shape of a curved rectangle.

In an example embodiment, the second production-increasing anti-slipping anti-cracking opposite-twisting jaw 123 may be formed into the shape of a curved rectangle. First twist-spreading-spring housings 124*a* and 124*b* may each be formed into the shape of a rectangular cube. Second twist-spreading-spring housings 125*a* and 125*b* may each be formed into the shape of a rectangular cube. First twist-spreading spring 126 may be formed into the shape of a spiral spring. Second twist-spreading spring 127 may be formed into the shape of a spiral spring. First anti-slipping twist-clamping threads 128 may each be formed into the shape of a half-circle thread. Second anti-slipping twist-clamping threads 129 may each be formed into the shape of a half-circle thread. Multi-elevation twistable-tube system 130 may be formed into the combined shapes of its components.

In an example embodiment, the first upper-elevation twistable tube 131 may be formed into the shape of a round tube. First lower-elevation twistable tube 132 may be formed into the shape of a round tube. Second upper-elevation twistable tube 133 may be formed into the shape of a round tube. Second lower-elevation twistable tube 134 may be formed into the shape of a round tube. First multi-elevation-twisting-tube screw 135 may be formed into the shape of a screw. Second multi-elevation-twisting-tube screw 136 may be formed into the shape of a screw. Anti-crack reinforcing twistable-rib system 137 may be formed into the combined shapes of its components.

In an example embodiment, the first reinforcing twistable ribs 138 may each be formed into the shape of a curved-corner rectangle. Second reinforcing twistable ribs 139 may each be formed into the shape of a curved-corner rectangle. Hand-knob hole 140 may be formed into the shape of a round hole. Arthritic-assisting twist-clamping-jaw hand-knob 141 may be formed into the shape of a ridged cheese wheel with a threaded screw. Hand-knob nut 142 may be formed into the shape of a nut. Multi-application pivoting-connector system 143 may be formed into the combined shapes of its components.

In an example embodiment, the pivoting connector 144 may be formed into the shape of a square cube with one curved side. Threaded connector core 145 may be formed into the shape of a screw. Opposite-twisting-jaw-housing tunnel system 146 may be formed into the combined shapes of its components. Opposite-twisting-jaw-housing tunnel 147 may be formed into the shape of a square tube with one curved side. Two opposite-twisting-jaw-securing holes 148 may each be formed into the shape of a round hole. Cord-cranking mechanism 149 may be formed into the combined shapes of its components Production-increasing cost-saving identical-half-base-top system 150 may be formed into the combined shapes of its components. Two Production-increasing cost-saving identical-half-base-tops 151 may each be formed into the shape of a rectangle. Crank-storing extra-umbrella-pole-locking hole 152 may be formed into the shape of a cylinder.

In an example embodiment, the crank-storing-hole plug 153 may be formed into the shape of an elongated round cup. Caster-leg hole 154 may be formed into the shape of a cylinder. Production-increasing cost-saving identical-half-base-bottom system 155 may be formed into the combined shapes of its components. Two production-increasing cost-saving identical-half-base-bottoms 156 may each be formed into the shape of a rectangular box. Six separation-preventing double-opposite-ridge-interlocks 157*a* may each be formed into the shape of a dove tail with 2 opposite ridges molded to and along its 2 opposite corners. Six separation-preventing double-opposite-interpockets 157*b* may each be formed into the shape of a dove tail.

In an example embodiment, the four pole-mounting-hole stems 158 may each be formed into the shape of a tube. Weight compartments 159 may each be formed into the shape of a curved trapezoid. Four Brace slots 160 may each be formed into the shape of a rectangle. Four Base-supporting braces 161 may each be formed into the shape of a square tube. Six Roller slots 162 may each be formed into the shape of a half-wheel and an axle inserted therethrough. Six angle-operated edge rollers 163 may each be formed into the shape of a wheel and an axle inserted therethrough. Adjustable-hidable angle-operated caster system 164 may be formed into the combined shapes of its components.

In an example embodiment, the caster chamber 165 may be formed into the shape of a dome. Adjustable-hidable angle-operated caster 166 may be formed into the shape of a wheel and an axle inserted therethrough. Caster leg 167 may be formed into the shape of a cylinder. Caster-leg-wrenching recess 168 may be formed into the shape of a square, hexagonal, or pentagonal recess. Caster mount 169 may be formed into the shape of a tube with one flaring end. Deployable-hidable crank-and-bolt-lock system 170 may be formed into the combined shapes of its components.

In an example embodiment, the crank chamber 171 may be formed into the shape of a dome. Two deployable-retractable crank-handle-and-bolt-locks 172 may each be formed into the shape of a tube. Two handle covers 173 may each be formed into the shape of an elongated round cup. Crank core 174 may be formed into the shape of a cylinder with a built-in elongated recess. Removable-hidable wrench 175 may be formed into the shape of a straight Allen-wrench.

Connection

Referring to FIG. 1A-FIG. 206:

In an example embodiment, the arthritic-assisting anti-vibration anti-friction anti-pinching track system 101 has the combined connections of its components. Arthritic-assisting anti-vibration anti-friction back roller-tracks 102 may be respectively formed to a post or other surface. Arthritic-assisting anti-vibration anti-friction front roller-tracks 103 may be respectively formed to a post or other surface. Arthritic-assisting stabilizer-guiding track 104 may be formed into a post or other surface. Arthritic-assisting stabilizer-securing ridges 105 may be respectively formed into a post or other surface. Arthritic-assisting anti-vibration anti-friction anti-pinching portable-elevator system 106 has the combined connections of its components.

In an example embodiment, the arthritic-assisting anti-vibration anti-friction portable handle-elevator 107*a* may be secured around arthritic-assisting anti-vibration anti-friction portable roller-elevator 108. Arthritic-assisting anti-vibration anti-friction handle-elevator-tracks 107*b* may be respectively molded to arthritic-assisting anti-vibration anti-friction portable handle-elevator 107*a*. Arthritic-assisting anti-vibration anti-friction portable roller-elevator 108 may be inserted into and secured within arthritic-assisting anti-vibration anti-friction portable handle-elevator 107*a*. Roller openings 109 may be respectively formed into the inner side of arthritic-assisting anti-vibration anti-friction portable roller-elevator 108. Roller axles 110 may be respectively rotatably snap-locked into roller openings 109. Arthritic-assisting anti-vibration anti-friction portable rollers 111 may be respectively slid on roller axles 110.

In an example embodiment, the arthritic-assisting raising angle-handle 112*a* may be formed onto the lower section of arthritic-assisting anti-vibration anti-friction portable handle-elevator 107*a*. Arthritic-assisting lowering angle-handle 112*b* may be formed onto the upper section of arthritic-assisting anti-vibration anti-friction portable handle-elevator 107*a*. Multi-elevator stabilizer 113 may be attached to the opposite inner side of arthritic-assisting anti-vibration anti-friction portable roller-elevator 108, and slidably inserted into arthritic-assisting stabilizer-guiding track 104. Arthritic-assisting multi-elevator-locking hand-knob 114 may be inserted through arthritic-assisting multi-elevator-locking lock 115 and multi-elevator stabilizer 113.

In an example embodiment, the arthritic-assisting multi-elevator-locking lock 115 may be compressed onto multi-elevator stabilizer 113. Multi-elevator-locking nut 116 may be threadedly secured to multi-elevator-locking screw 117. Multi-elevator-locking screw 117 may be inserted through arthritic-assisting anti-vibration anti-friction portable handle-elevator 107*a*, arthritic-assisting anti-vibration anti-friction portable roller-elevator 108, and multi-elevator stabilizer 113, then threadedly secured to multi-elevator-locking nut 116.

In an example embodiment, the multi-function joint 118 may be molded to arthritic-assisting anti-vibration anti-friction portable handle-elevator 107*a*. Multi-function track pole 119 may be slidably secured to arthritic-assisting anti-vibration anti-friction portable roller-elevator 108. Multi-function screw rivet 120 may be secured to multi-function joint 118. Anti-slipping anti-cracking opposite-twisting-jaw system 121 has the combined connections of its components.

In an example embodiment, the first production-increasing anti-slipping anti-cracking opposite-twisting jaw 122 may be screwed to second production-increasing anti-slipping anti-cracking opposite-twisting jaw 123. Second production-increasing anti-slipping anti-cracking opposite-twisting jaw 123 may be screwed to first production-increasing anti-slipping anti-cracking opposite-twisting jaw 122. First twist-spreading-spring housings 124*a* and 124*b* may be respectively formed in first production-increasing anti-slipping anti-cracking opposite-twisting jaw 122 and second production-increasing anti-slipping anti-cracking opposite-twisting jaw 123. Second twist-spreading-spring housings 125*a* and 125*b* may be respectively formed in first production-increasing anti-slipping anti-cracking opposite-twisting jaw 122 and second production-increasing anti-slipping anti-cracking opposite-twisting jaw 123.

In an example embodiment, the first twist-spreading spring 126 may be fitted in first twist-spreading-spring housings 124*a* and 124*b*, respectively. Second twist-spreading spring 127 may be fitted in second twist-spreading-spring housings 125*a* and 125*b*, respectively. First anti-slipping twist-clamping threads 128 may be respectively formed in first production-increasing anti-slipping anti-cracking opposite-twisting jaw 122. Second anti-slipping twist-clamping threads 129 may be respectively formed in second production-increasing anti-slipping anti-cracking opposite-twisting jaw 123. Multi-elevation twistable-tube system 130 has the combined connections of its components.

In an example embodiment, the first upper-elevation twistable tube 131 may be molded to the upper bottom-edge of first production-increasing anti-slipping anti-cracking opposite-twisting jaw 122. First lower-elevation twistable tube 132 may be molded to the lower bottom-edge of first production-increasing anti-slipping anti-cracking opposite-twisting jaw 122. Second upper-elevation twistable tube 133 may be molded to the upper bottom-edge of second production-increasing anti-slipping anti-cracking opposite-twisting jaw 123. Second lower-elevation twistable tube 134 may be molded to the lower bottom-edge of second production-increasing anti-slipping anti-cracking opposite-twisting jaw 123. First multi-elevation-twisting-tube screw 135 may be screwed through opposite-twisting-jaw-securing hole 148, first upper-elevation twistable tube 131, and second upper-elevation twistable tube 133 to secure them together to allow first production-increasing anti-slipping anti-cracking opposite-twisting jaw 122 and second production-increasing anti-slipping anti-cracking opposite-twisting jaw 123 to twistingly unclamp and to twistingly clamp threaded connector core 145.

In an example embodiment, the second multi-elevation-twisting-tube screw 136 may be screwed through opposite-twisting-jaw-securing hole 148, first lower-elevation twistable tube 132, and second lower-elevation twistable tube 134 to secure them together. Anti-crack reinforcing twistable-rib system 137 has the combined connections of its components.

In an example embodiment, the first reinforcing twistable ribs 138 may be respectively molded to the back of first production-increasing anti-slipping anti-cracking opposite-twisting jaw 122. Second reinforcing twistable ribs 139 may be respectively molded to the back of second production-increasing anti-slipping anti-cracking opposite-twisting jaw 123. Hand-knob hole 140 may be formed through opposite-twisting-jaw-housing tunnel 147, first production-increasing anti-slipping anti-cracking opposite-twisting jaw 122, and second production-increasing anti-slipping anti-cracking opposite-twisting jaw 123. Arthritic-assisting twist-clamping-jaw hand-knob 141 may be inserted through hand-knob hole 140. Hand-knob nut 142 may be threadedly attached to arthritic-assisting twist-clamping-jaw hand-knob 141. Multi-application pivoting-connector system 143 has the combined connections of its components. Pivoting connector 144 may be attached to multi-function screw rivet 120.

In an example embodiment, the threaded connector core 145 may be threadedly connected to and between first anti-slipping twist-clamping threads 128 and second anti-slipping twist-clamping threads 129 such that threaded connector core 145 can be twistingly clamped and unclamped by first anti-slipping twist-clamping threads 128 and second anti-slipping twist-clamping threads 129. Opposite-twisting-jaw-housing tunnel system 146 has the combined connections of its components.

In an example embodiment, the opposite-twisting-jaw-housing tunnel 147 may be slid on and around first production-increasing anti-slipping anti-cracking opposite-twisting jaw 122 and second production-increasing anti-slipping anti-cracking opposite-twisting jaw 123. Two opposite-twisting-jaw-securing holes 148 may be respectively drilled into opposite-twisting-jaw-housing tunnel 147. Cord-cranking mechanism 149 may be attached to opposite-twisting-jaw-housing tunnel 147 such that it can ratchetingly wind and unwind a cord inside opposite-twisting-jaw-housing tunnel 147.

In an example embodiment, the production-increasing cost-saving identical-half-base-top system 150 has the combined connections of its components. Two production-increasing cost-saving identical-half-base-tops 151 each have multiple taps. The taps may be respectively snap-inserted into the central crannies of 2 production-increasing cost-saving identical-half-base-bottoms 156 to secure them together, to respectively seat 2 production-increasing cost-saving identical-half-base-tops 151 on 2 production-increasing cost-saving identical-half-base-bottoms 156.

In an example embodiment, the crank-storing extra-umbrella-pole-locking hole 152 may be formed in and between 2 production-increasing cost-saving identical-half-base-tops 151 and engaged with crank chamber 171. Crank-storing-hole plug 153 may be twist-locked inside caster-leg hole 154. Caster-leg hole 154 may be formed in and between 2 production-increasing cost-saving identical-half-base-tops 151 and engaged with caster chamber 165. Production-increasing cost-saving identical-half-base-bottom system 155 has the combined connections of its components. Two production-increasing cost-saving identical-half-base-bottoms 156 may be respectively slidably and interlockingly secured to each other.

In an example embodiment, the six separation-preventing double-opposite-ridge-interlocks 157*a* may be respectively molded to and along edges of 2 production-increasing cost-saving identical-half-base-bottoms 156. Six separation-preventing double-opposite-interpockets 157*b* may be respectively molded to and along other edges of 2 production-increasing cost-saving identical-half-base-bottoms 156 such that 6 separation-preventing double-opposite-ridge-interlocks 157*a* may be slidably and interlockingly inserted into 6 separation-preventing double-opposite-interpockets 157*b* to interlock them together.

In an example embodiment, the four pole-mounting-hole stems 158 may be respectively molded inside 2 production-increasing cost-saving identical-half-base-bottoms 156. Weight compartments 159 may be respectively formed inside 2 production-increasing cost-saving identical-half-base-bottoms 156. Four Brace slots 160 may be respectively formed on the underside of 2 production-increasing cost-saving identical-half-base-bottoms 156. Four Base-supporting braces 161 may be respectively inserted into 4 brace slots 160 and screwed to 2 production-increasing cost-saving identical-half-base-bottoms 156.

In an example embodiment, the six Roller slots 162 may be respectively formed on and along the 2 opposite angled edges of 2 production-increasing cost-saving identical-half-base-bottoms 156. Six angle-operated edge rollers 163 may be respectively snap-locked in 6 roller slots 162. Adjustable-hidable angle-operated caster system 164 has the combined connections of its components. Caster chamber 165 may be formed in and between 2 production-increasing cost-saving identical-half-base-bottoms 156. Adjustable-hidable angle-operated caster 166 may be secured to caster leg 167.

In an example embodiment, the caster leg 167 may be secured to caster mount 169. Caster-leg-wrenching recess 168 may be formed into caster leg 167. Caster mount 169 may be screwed to caster chamber 165 Deployable-hidable crank-and-bolt-lock system 170 has the combined connections of its components. Crank chamber 171 may be formed in and between 2 production-increasing cost-saving identical-half-base-bottoms 156. Two deployable-retractable crank-handle-and-bolt-locks 172 may be respectively slidably secured to the 2 opposite ends of crank core 174. Two sleeve covers 173 may be respectively slid onto 2 deployable-retractable crank-handle-and-bolt-locks 172. Crank core 174 may be slidably inserted inside 2 deployable-retractable crank-handle-and-bolt-locks 172. Removable-hidable wrench 175 may be removably concealed within a groove on crank core 174.

Function

Referring to FIG. 1A-FIG. 206:

In an example embodiment, the arthritic-assisting anti-vibration anti-friction anti-pinching track system 101 may be for performing the combined functions of its components. Arthritic-assisting anti-vibration anti-friction back roller-tracks 102 may be respectively for: Guiding arthritic-assisting anti-vibration anti-friction portable rollers 111 to assist an arthritic during operation of arthritic-assisting anti-vibration anti-friction anti-pinching portable-elevator system 106 in the directions of arrows 176-186 (see FIG. 51-FIG. 57); and Eliminating vibration and friction during operation of arthritic-assisting anti-vibration anti-friction anti-pinching portable-elevator system 106 in the direction of arrow 187 (see FIG. 49 and FIG. 50).

In an example embodiment, the arthritic-assisting anti-vibration anti-friction front roller-tracks 103 may be respectively for: Guiding arthritic-assisting anti-vibration anti-friction portable rollers 111 to assist an arthritic during operation of arthritic-assisting anti-vibration anti-friction anti-pinching portable-elevator system 106 in the directions of arrows 176-186 (see FIG. 51-FIG. 57); and Eliminating vibration and friction during operation of arthritic-assisting anti-vibration anti-friction anti-pinching portable-elevator system 106 in the direction of arrow 187 (see FIG. 49 and FIG. 50).

In an example embodiment, the arthritic-assisting stabilizer-guiding track 104 may be for: Guiding multi-elevator stabilizer 113 as it travels up and down during deployment and retraction. Arthritic-assisting stabilizer-securing ridges 105 may be respectively for preventing multi-elevator stabilizer 113 dislodging from arthritic-assisting stabilizer-guiding track 104 during deployment and retraction. Arthritic-assisting anti-vibration anti-friction anti-pinching anti-pinching portable-elevator system 106 may be for performing the combined functions of its components. Arthritic-assisting anti-vibration anti-friction portable handle-elevator 107*a* may be for the capablity of eliminating the needs for an arthritic to fold and unfold hmay be fingers to raise and lower arthritic-assisting anti-vibration anti-friction portable-elevator system 106 (see FIG. 51, FIG. 56, and FIG. 57); Capable of securing and enclosing arthritic-assisting anti-vibration anti-friction portable roller-elevator 108 (see FIG. 10); Capable of being used on umbrella post, hand rail, sail pole, awning arm, and pergola column (see FIG. 58-FIG. 62); and Capable of preventing an arthritic's hand from being pinched by multi-elevator stabilizer 113, arthritic-assisting anti-vibration anti-friction portable rollers 111, and roller axles 110 (see FIG. 51, FIG. 56, and FIG. 57).

In an example embodiment, the arthritic-assisting anti-vibration anti-friction handle-elevator-tracks 107*b* may be respectively for: Sealing arthritic-assisting anti-vibration anti-friction portable rollers 111 to protect a user's hand or an arthritic's hand; and Guiding arthritic-assisting anti-vibration anti-friction portable rollers 111 (see FIG. 3). Arthritic-assisting anti-vibration anti-friction portable roller-elevator 108 may be for: Being used on umbrella post, handrail, sail pole, awning arm, and pergola column (see FIG. 58-FIG. 62); Hiding arthritic-assisting anti-vibration anti-friction portable roller-elevator 108 (see FIG. 2); and Securing and organizing arthritic-assisting anti-vibration anti-friction portable rollers 111 (see FIG. 11, FIG. 12, and FIG. 18).

In an example embodiment, the roller openings 109 may be respectively for: Securing roller axles 110 and arthritic-assisting anti-vibration anti-friction portable rollers 111. Roller axles 110 may be respectively for: Allowing arthritic-assisting anti-vibration anti-friction portable rollers 111 to rotate. Arthritic-assisting anti-vibration anti-friction portable rollers 111 may be respectively for: Assisting an arthritic in operating arthritic-assisting anti-vibration anti-friction anti-pinching portable-elevator system 106 in the directions of arrows 176-186 (see FIG. 51-FIG. 57); and Eliminating vibration and friction during operation of arthritic-assisting anti-vibration anti-friction anti-pinching portable-elevator system 106 in the direction of arrow 187 (see FIG. 49 and FIG. 50).

In an example embodiment, the arthritic-assisting raising angle-handle 112*a* may be for: Assisting an arthritic to eliminate the needs for folding an arthritic's fingers when raising arthritic-assisting anti-vibration anti-friction anti-pinching portable-elevator system 106 in the directions of arrows 176-186 (see FIG. 51-FIG. 57); and Reducing impact against an arthritic's fingers during operation of arthritic-assisting anti-vibration anti-friction anti-pinching portable-elevator system 106 in the directions of arrows 176-186 (see FIG. 51-FIG. 57).

In an example embodiment, the arthritic-assisting lowering angle-handle 112*b* may be for: Assisting an arthritic to eliminate the needs for folding an arthritic's fingers when raising arthritic-assisting anti-vibration anti-friction anti-pinching portable-elevator system 106 in the directions of arrows 176-186 (see FIG. 51-FIG. 57); and Reducing impact against an arthritic's fingers during operation of arthritic-assisting anti-vibration anti-friction anti-pinching portable-elevator system 106 in the directions of arrows 176-186 (see FIG. 51-FIG. 57).

In an example embodiment, the multi-elevator stabilizer 113 may be for: Gliding up and down during deployment and retraction. Arthritic-assisting multi-elevator-locking hand-knob 114 may be for: Twist-locking and unlocking arthritic-assisting multi-elevator-locking lock 115 to allow multi-elevator stabilizer 113 to glide freely to allow deployment and retraction. Arthritic-assisting multi-elevator-locking lock 115 may be for: Locking and unlocking multi-elevator stabilizer 113 with arthritic-assisting multi-elevator-locking hand-knob 114 to allow deployment and retraction.

In an example embodiment, the multi-elevator-locking nut 116 may be for: Securing arthritic-assisting multi-elevator-locking hand-knob 114. Multi-elevator-locking screw 117 may be for: Securing multi-elevator stabilizer 113 to arthritic-assisting anti-vibration anti-friction portable handle-elevator 107*a* and arthritic-assisting anti-vibration anti-friction portable roller-elevator 108, respectively.

In an example embodiment, the multi-function joint 118 may be for: Securing multi-function screw rivet 120 to arthritic-assisting anti-vibration anti-friction portable handle-elevator 107*a*. Multi-function track pole 119 may be for: Allowing arthritic-assisting anti-vibration anti-friction portable roller-elevator 108 to track-slide up and down thereon. Multi-function screw rivet 120 may be for: Pivotably providing a pivoting means for accessories to be attached. Anti-slipping anti-cracking opposite-twisting-jaw system 121 may be for performing the combined functions of its components.

In an example embodiment, the first production-increasing anti-slipping anti-cracking opposite-twisting jaw 122 may be for: Mutually working with first upper-elevation twistable tube 131, first lower-elevation twistable tube 132, second upper-elevation twistable tube 133, and second lower-elevation twistable tube 134 to twistingly unclamp and to twistingly clamp threaded connector core 145 when turning arthritic-assisting twist-clamping-jaw hand-knob 141 in the directions of arrows 193, 194, and 195 (see FIG. 9, FIG. 10, FIG. 11, and FIG. 12); and In an example embodiment, the twisting while being twistingly spread by first twist-spreading spring 126 and second twist-spreading spring 127 to twistingly unclamp threaded connector core 145 to allow opposite-twisting-jaw-housing tunnel system 146 to be rotatably adjusted without slipping in the directions of arrows 193, 194, and 195 (see FIG. 9, FIG. 10, FIG. 11, and FIG. 12). Second production-increasing anti-slipping anti-cracking opposite-twisting jaw 123 may be for: Mutually working with first upper-elevation twistable tube 131, first lower-elevation twistable tube 132, second upper-elevation twistable tube 133, and second lower-elevation twistable tube 134 to twistingly unclamp and to twistingly clamp threaded connector core 145 when turning arthritic-assisting twist-clamping-jaw hand-knob 141 in the directions of arrows 193, 194, and 195 (see FIG. 9, FIG. 10, FIG. 11, and FIG. 12); and Twisting while being twistingly spread by first twist-spreading spring 126 and second twist-spreading spring 127 to twistingly unclamp threaded connector core 145 to allow opposite-twisting-jaw-housing tunnel system 146 to be rotatably adjusted without slipping in the directions of arrows 193, 194, and 195 (see FIG. 9, FIG. 10, FIG. 11, and FIG. 12).

In an example embodiment, the first twist-spreading-spring housings 124*a* and 124*b* may be respectively for: Housing and clamping first twist-spreading spring 126. Second twist-spreading-spring housings 125*a* and 125*b* may be respectively for: Housing and clamping second twist-spreading spring 127. First twist-spreading spring 126 may be for: Twistingly spreading first production-increasing anti-slipping anti-cracking opposite-twisting jaw 122 and second production-increasing anti-slipping anti-cracking opposite-twisting jaw 123 from pivoting connector 144 allowing opposite-twisting-jaw-housing tunnel system 146 to be rotatably adjusted without slipping. Second twist-spreading spring 127 may be for: Twistingly spreading first production-increasing anti-slipping anti-cracking opposite-twisting jaw 122 and second production-increasing anti-slipping anti-cracking opposite-twisting jaw 123 from pivoting connector 144 allowing opposite-twisting-jaw-housing tunnel system 146 to be rotatably adjusted without slipping.

Figure 27:
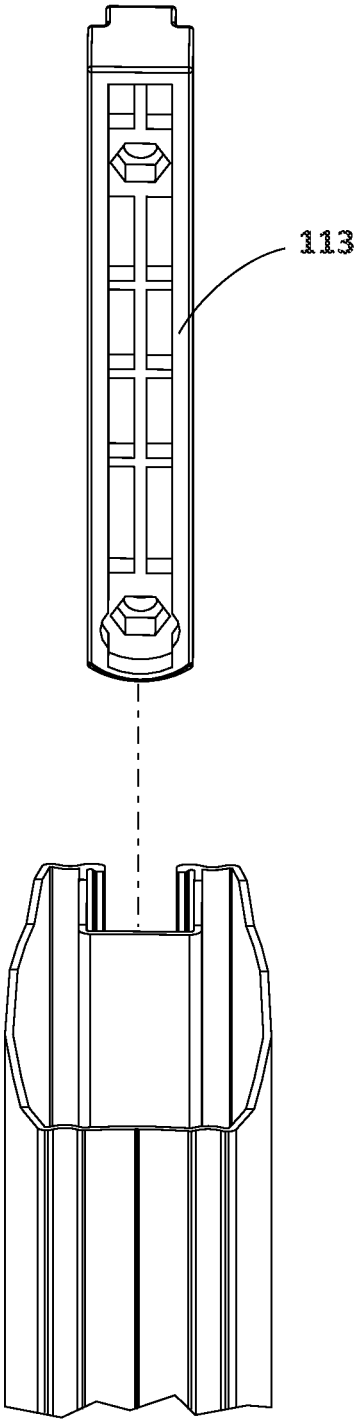
Figure 28:
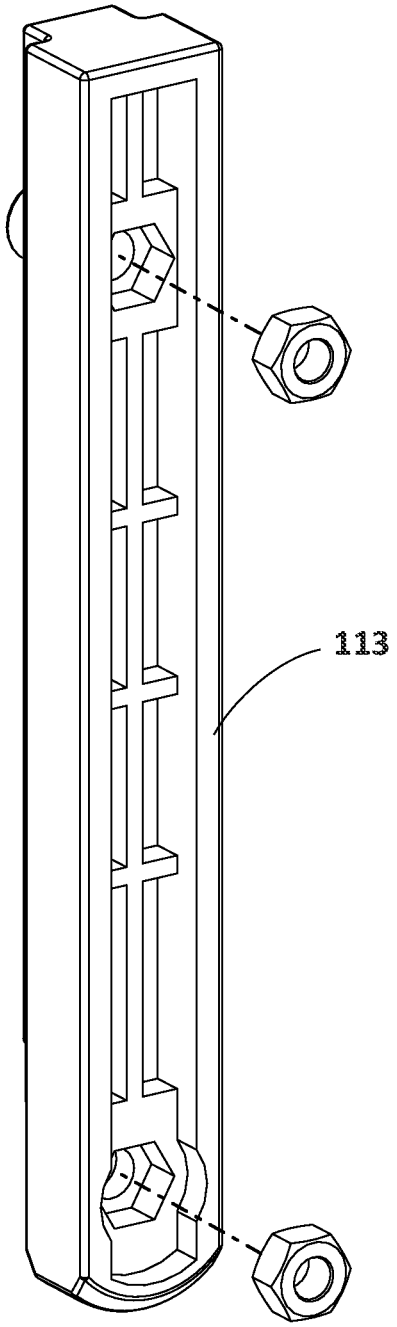
Figure 29:
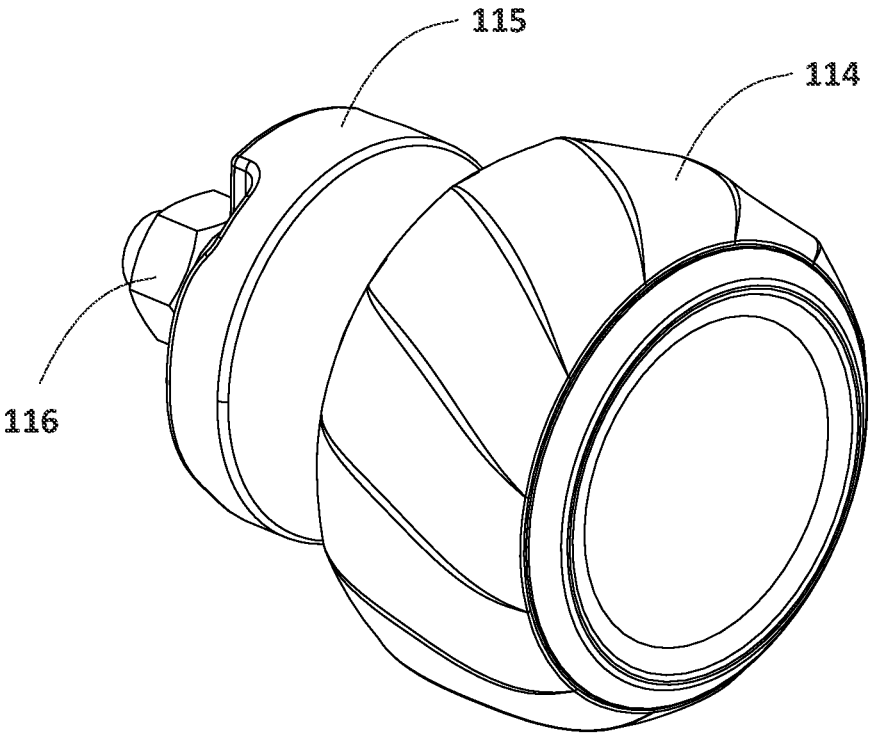
Figure 30:
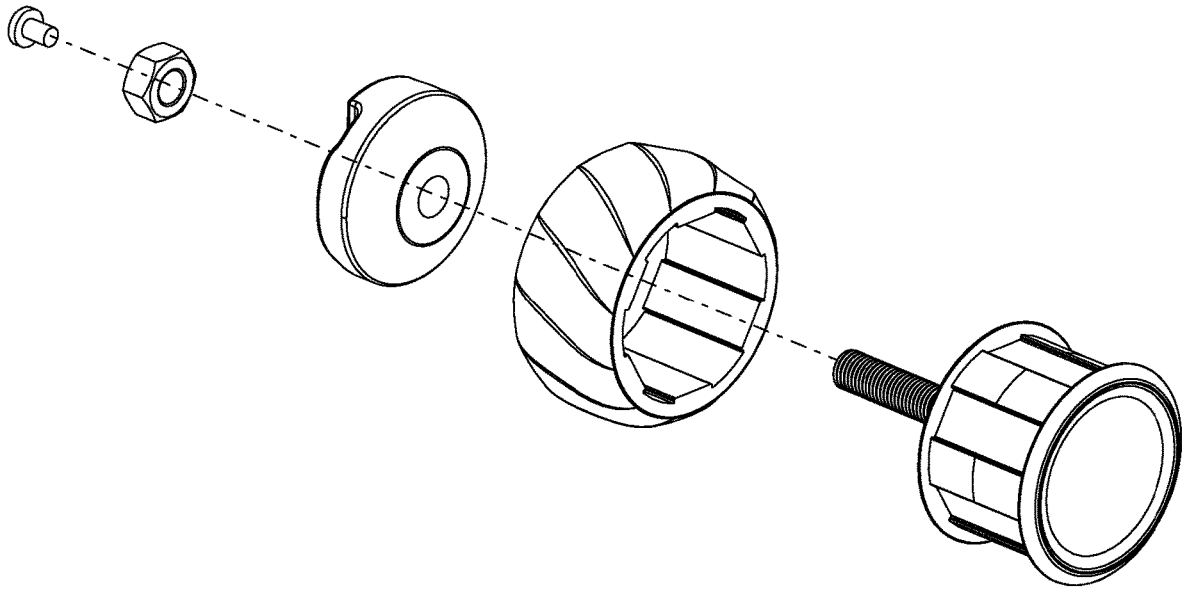
Figure 31:
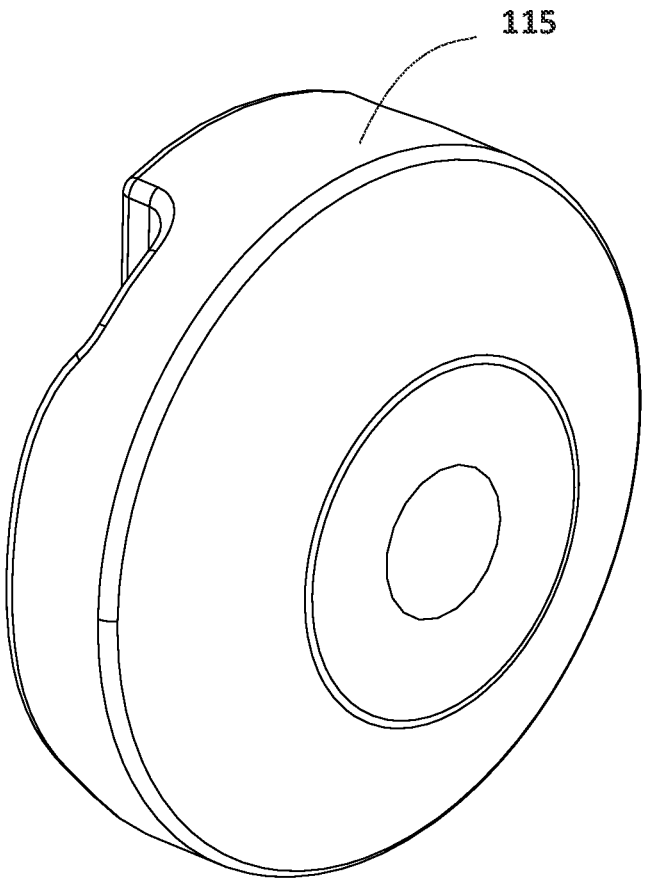
Figure 32:
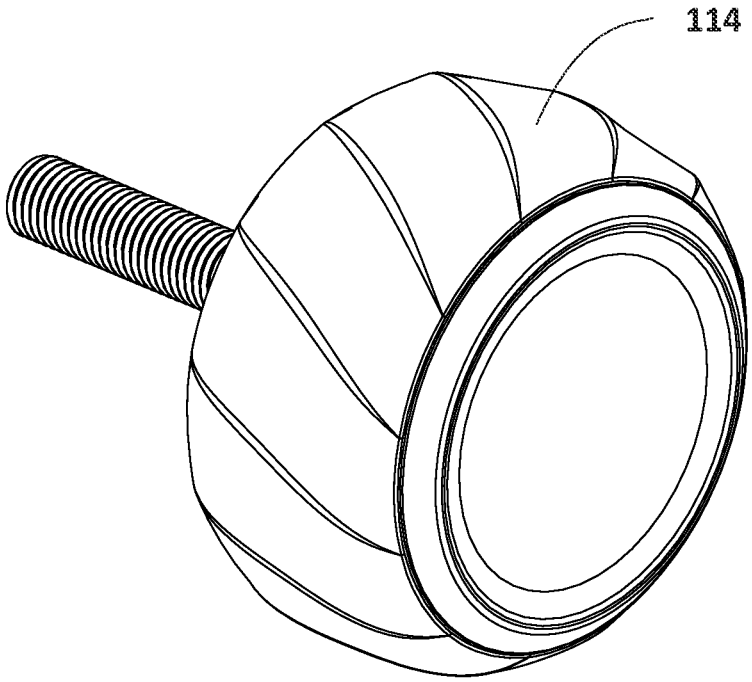
Figure 33:
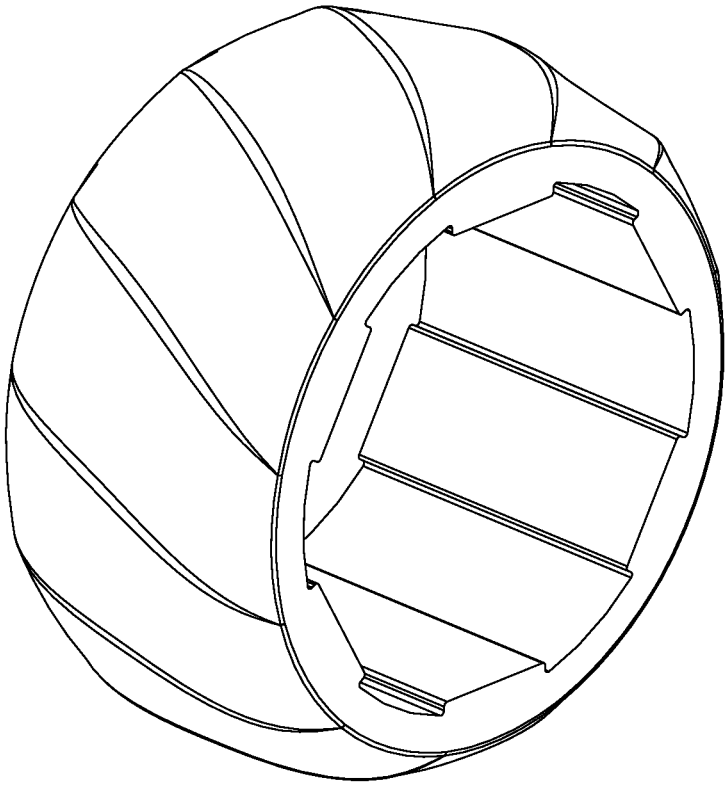
Figure 34:
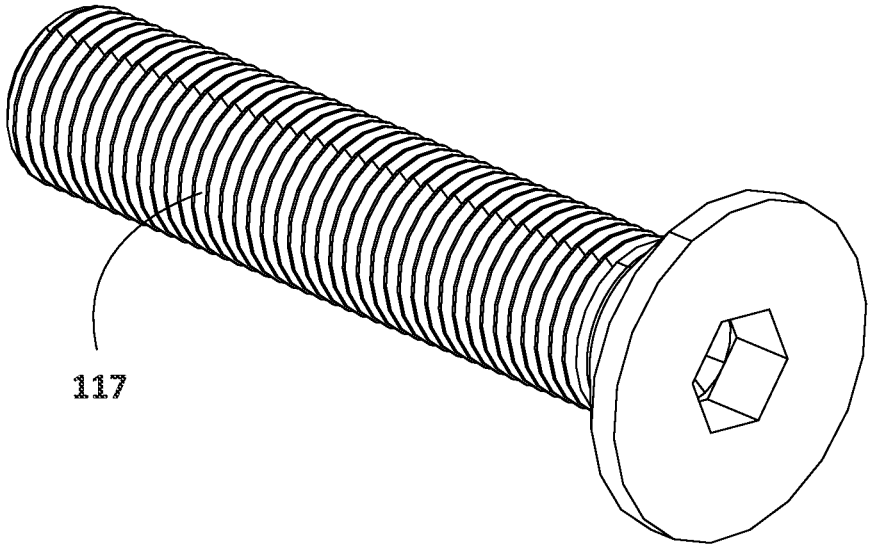
Figure 35:
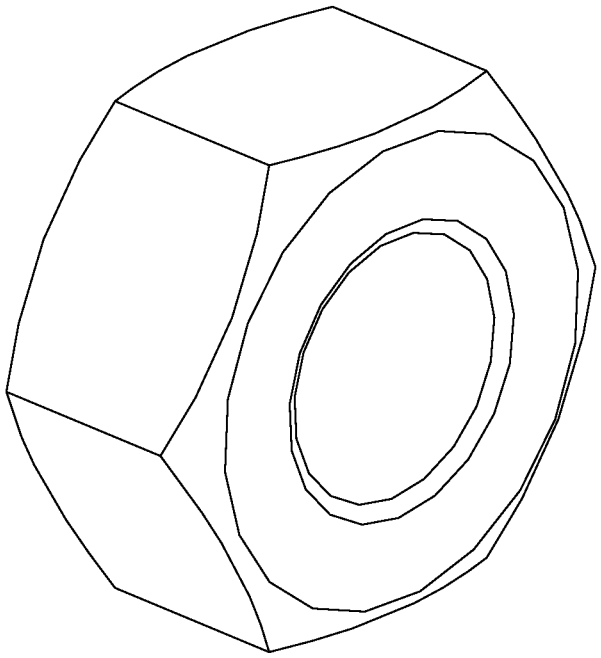
Figure 36:
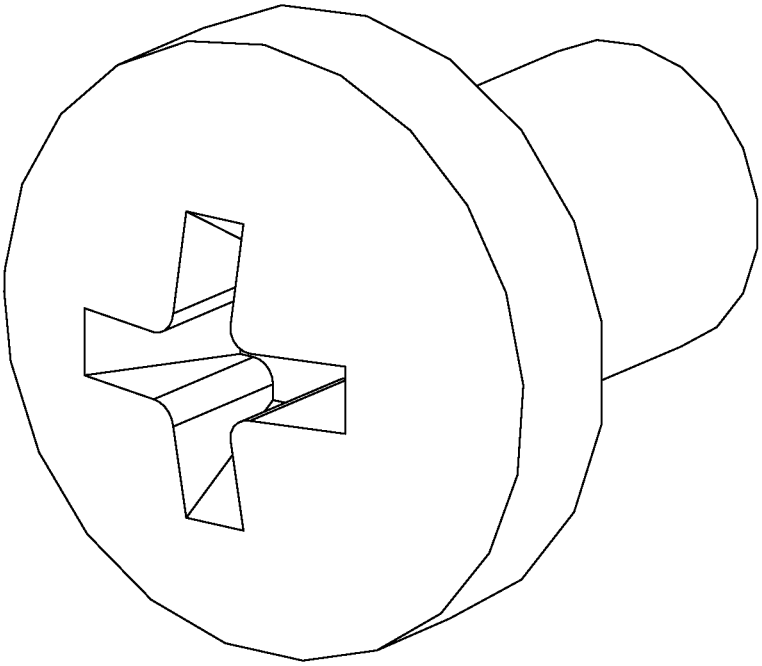
Figure 37:
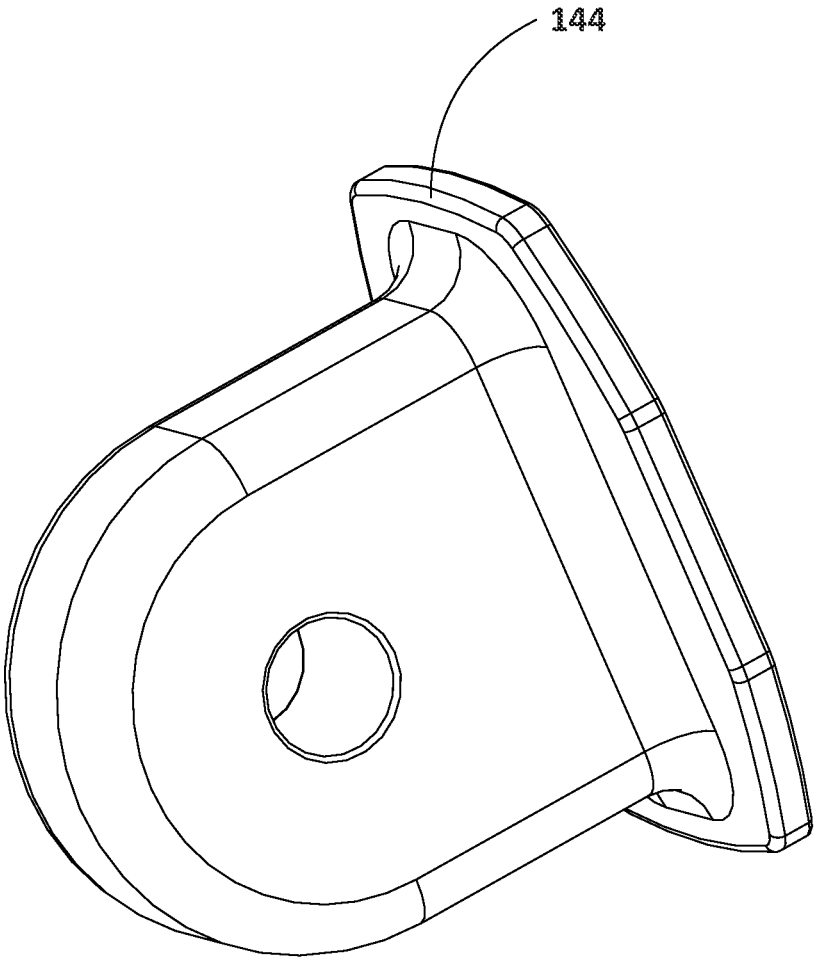
Figure 38:
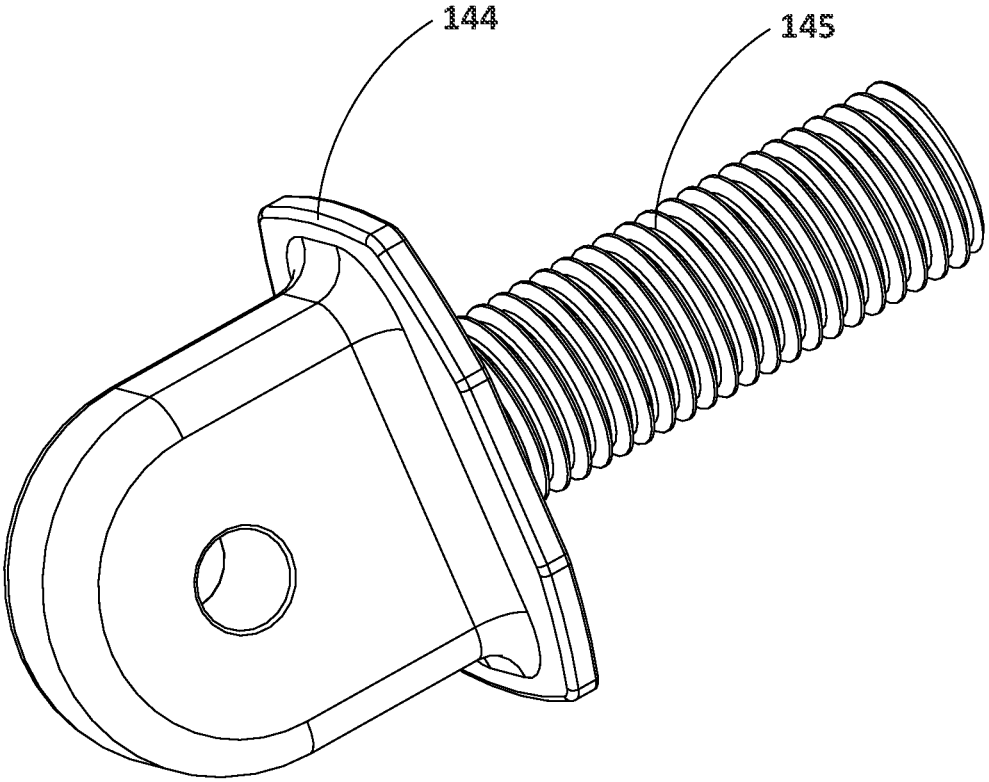
Figure 39:
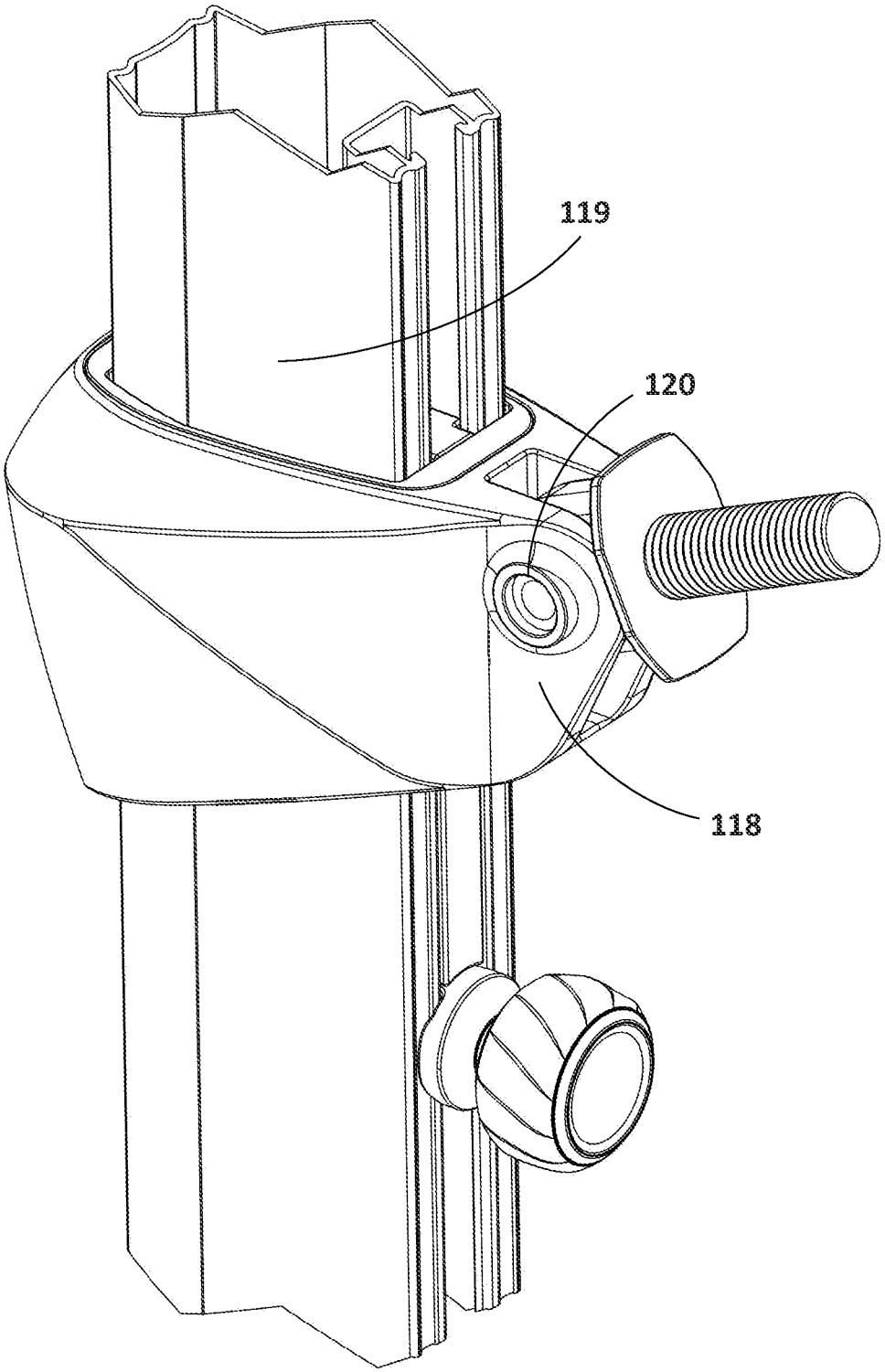
Figure 40:
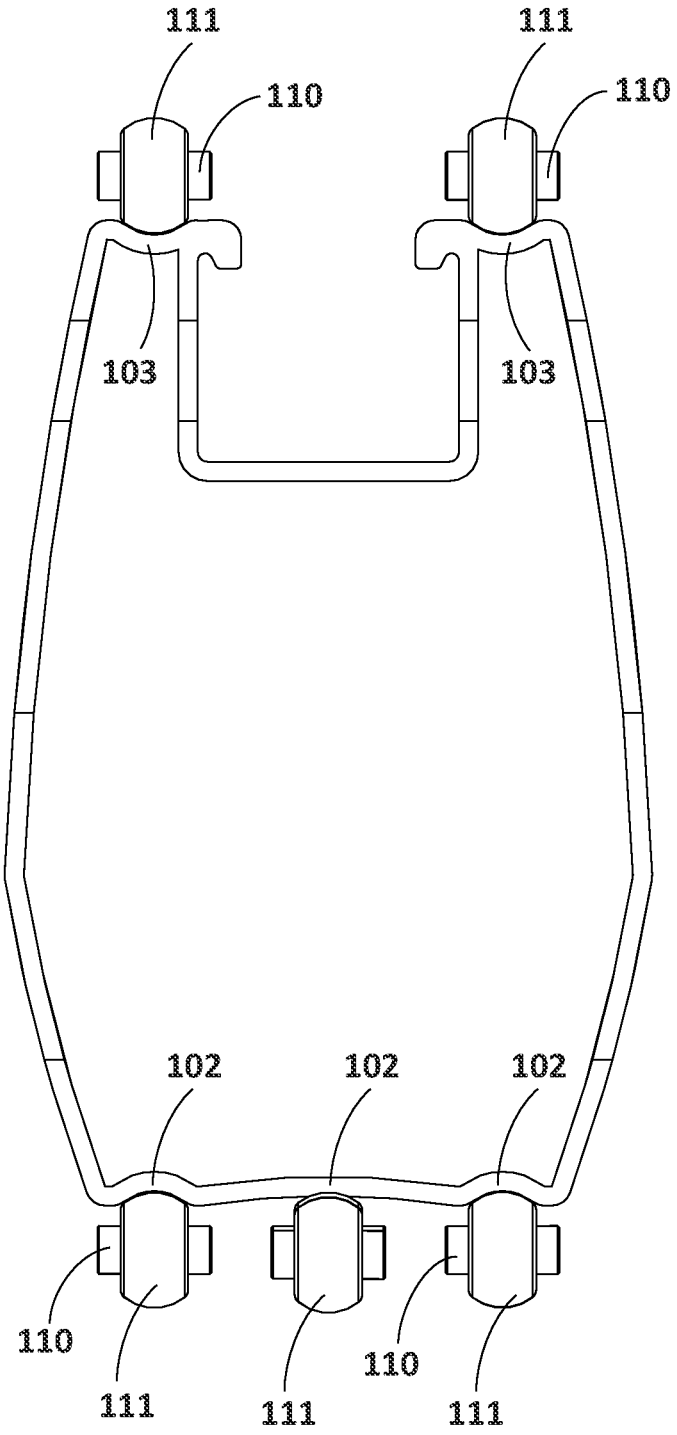
FIG. 40-FIG. 48 are diagrams illustrating perspective, top, and side views demonstrating components and the assembly of arthritic-assisting anti-vibration anti-friction anti-pinching track system 101.
Figure 41:
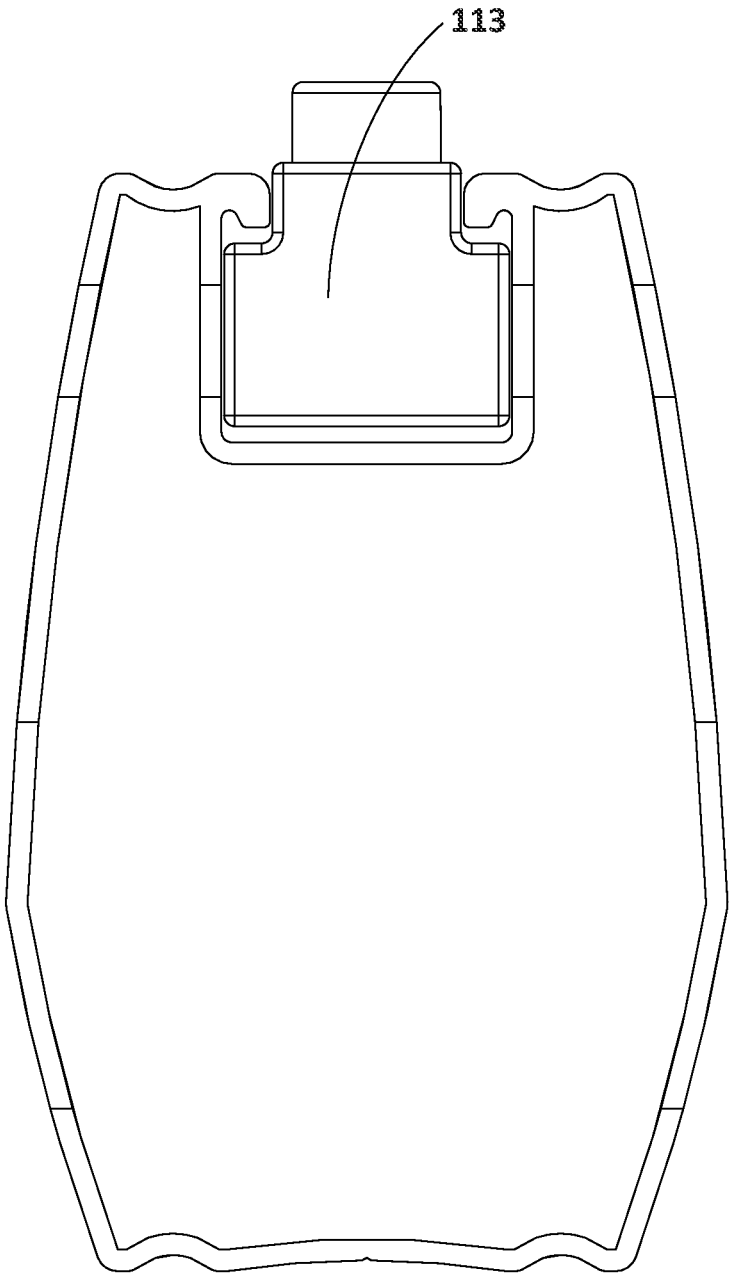
Figure 42:
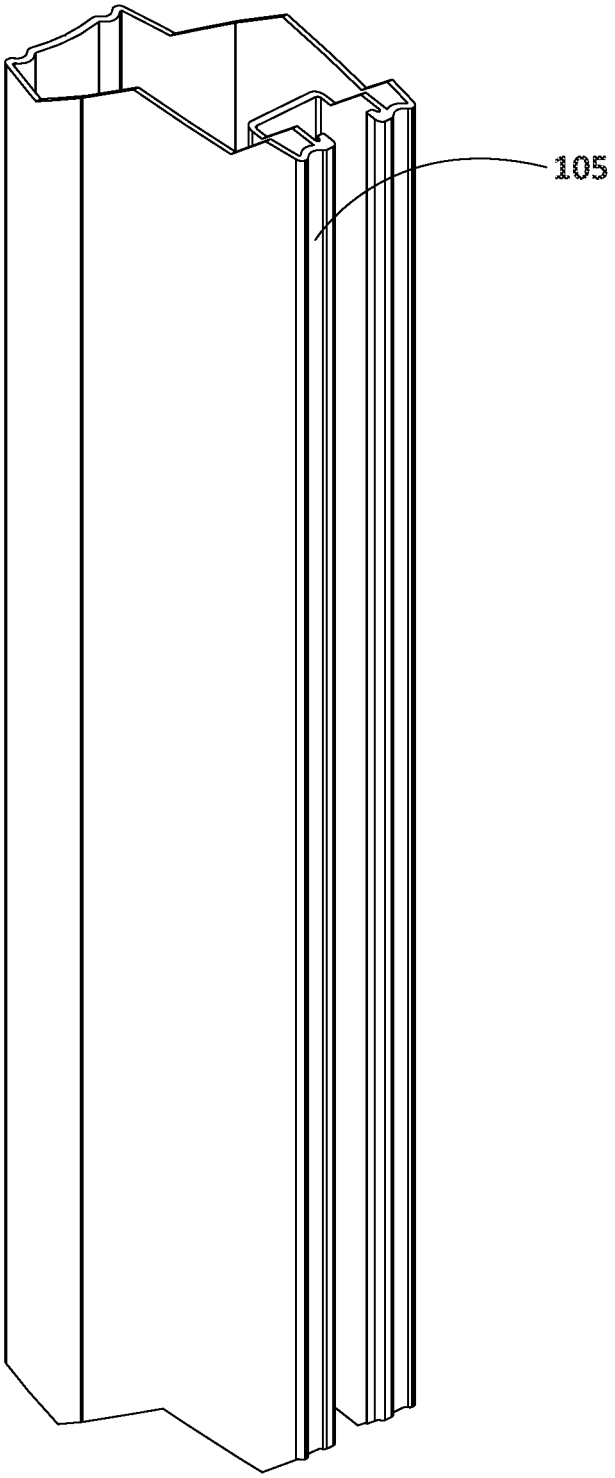
Figure 43:
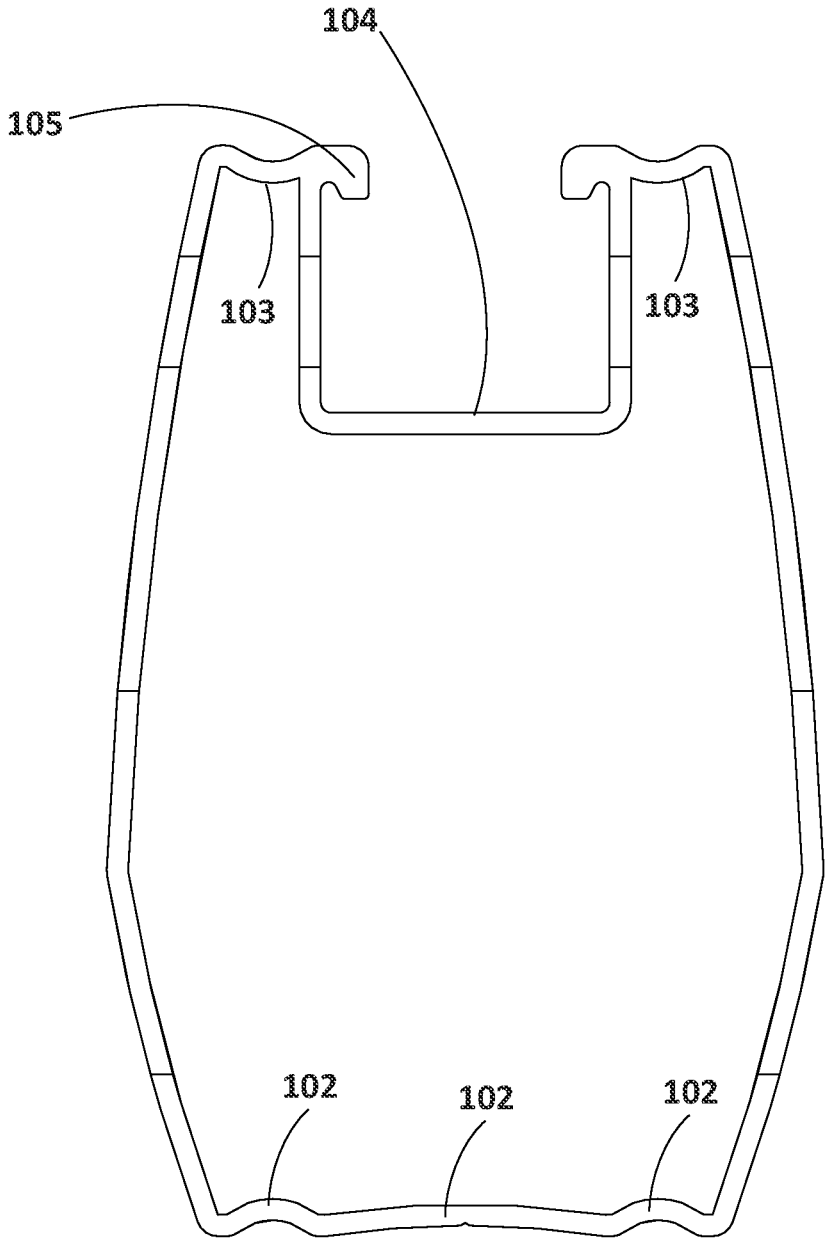
Figure 44:
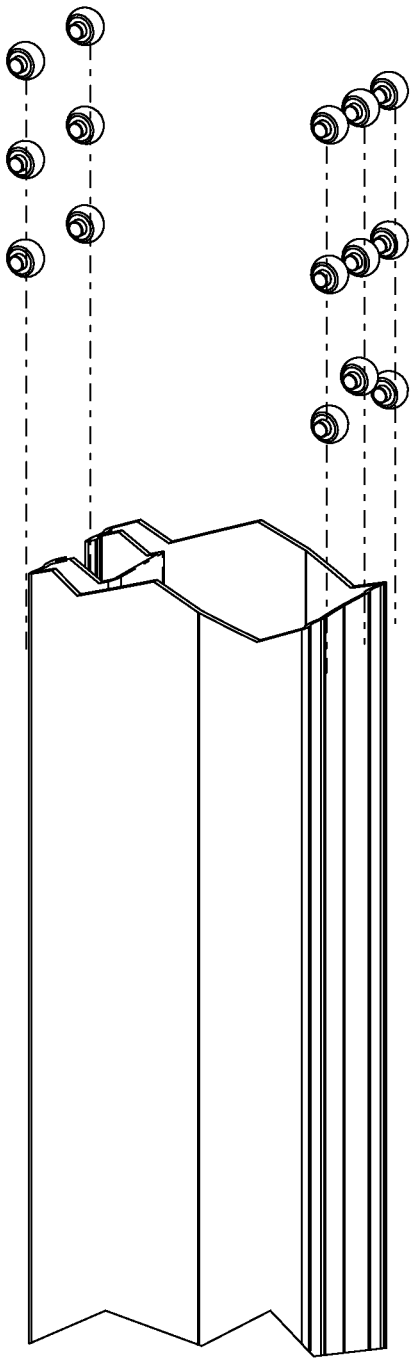
Figure 45:
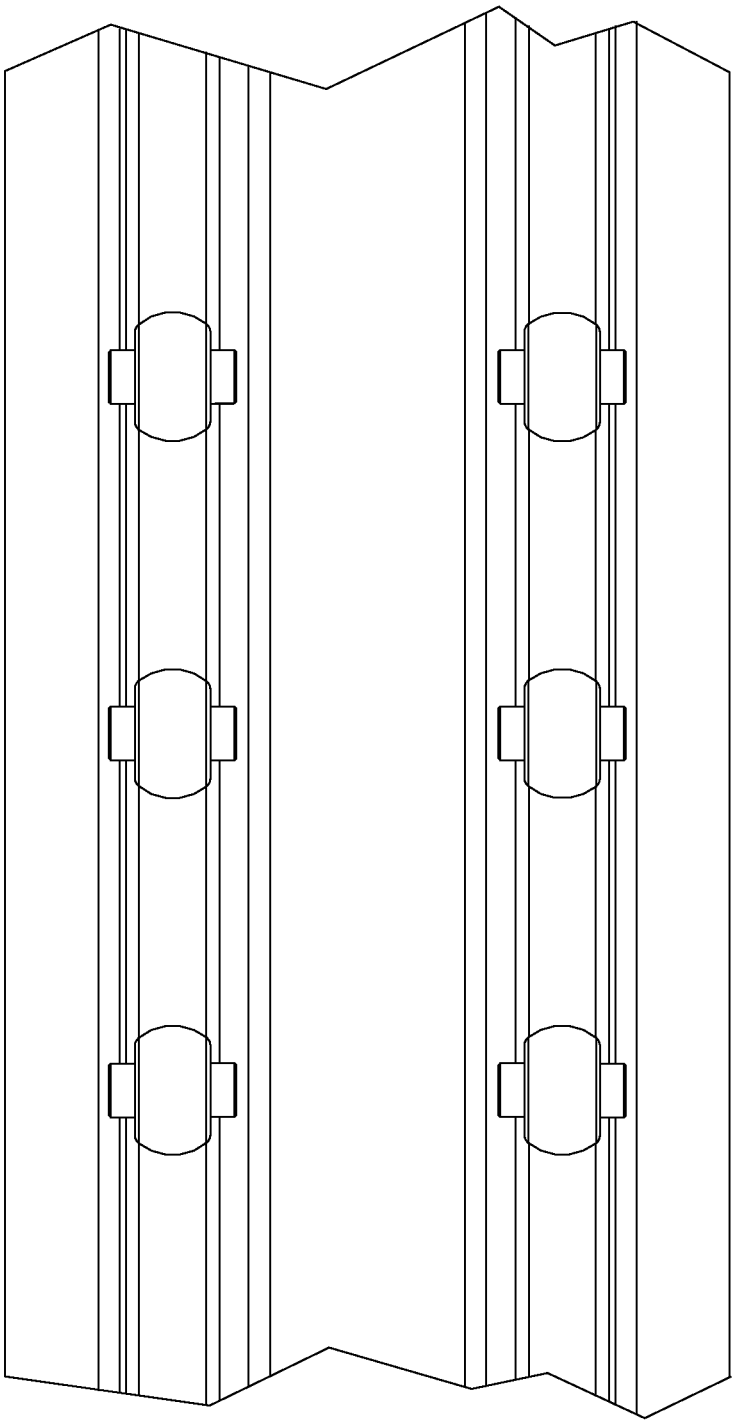
Figure 46:
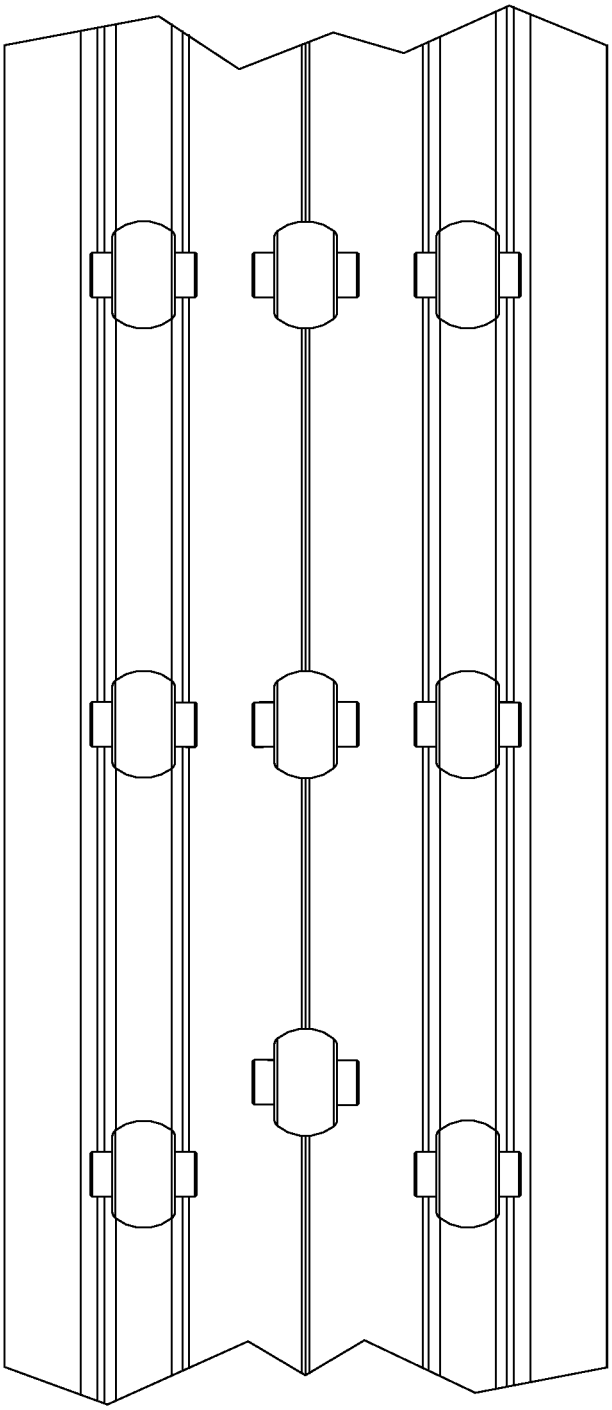
Figure 47:
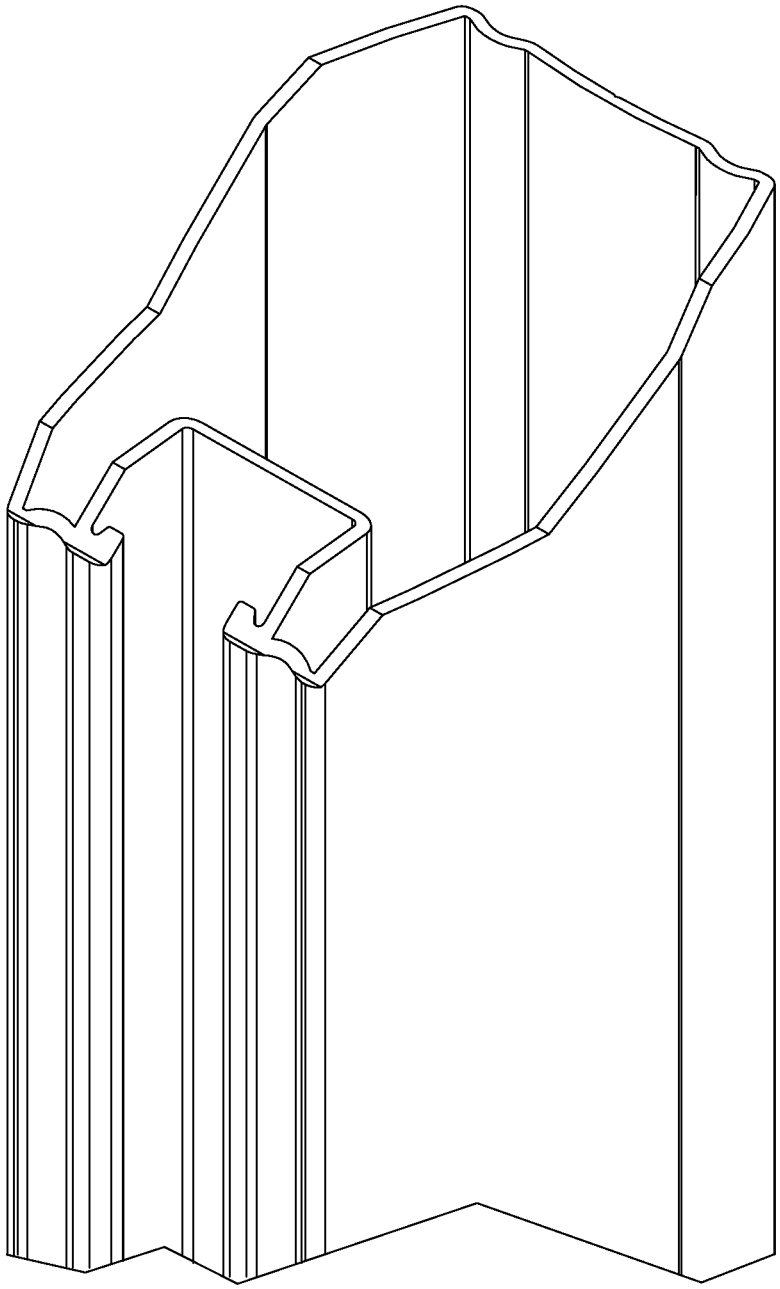
Figure 48:
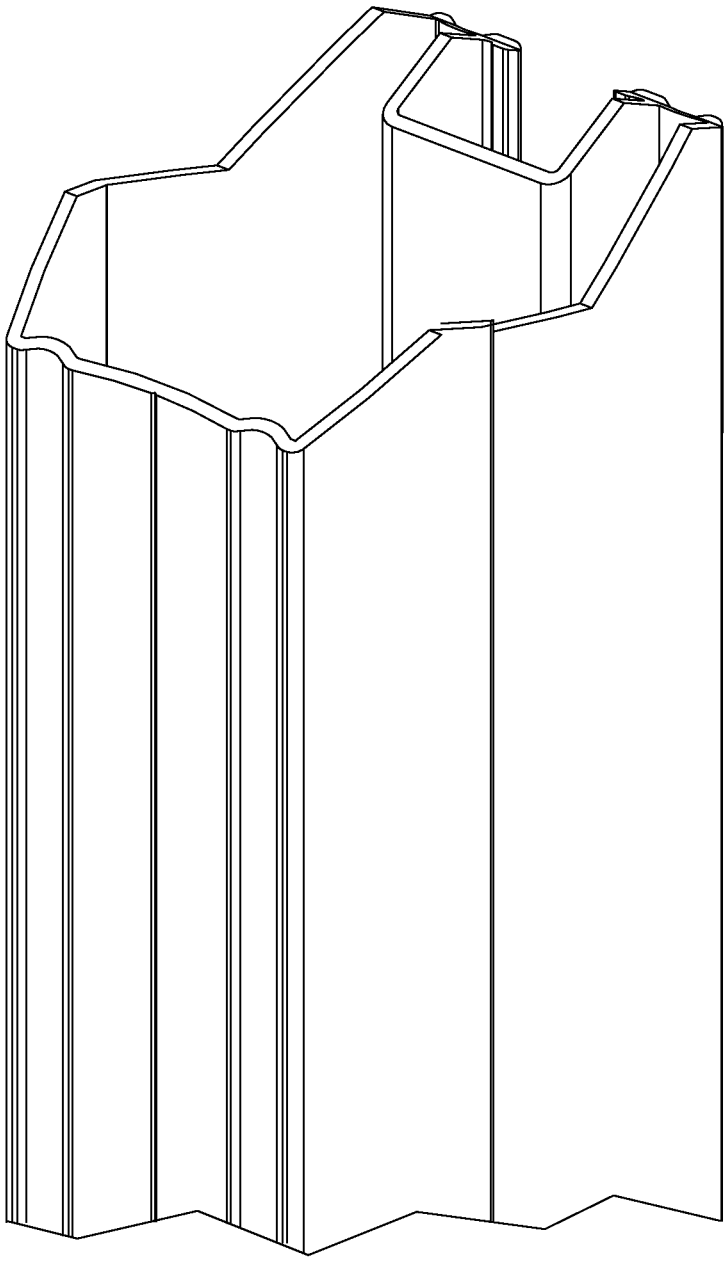

In an example embodiment, the first anti-slipping twist-clamping threads 128 may be respectively for: Mutually working with first upper-elevation twistable tube 131, first lower-elevation twistable tube 132, second upper-elevation twistable tube 133, and second lower-elevation twistable tube 134 to twistingly unclamp threaded connector core 145 when twistingly spread by first and second twist-spreading springs 126 and 127 to allow opposite-twisting-jaw-housing tunnel system 146 to be rotatably adjusted without slipping in the directions of arrows 193, 194, and 195 (see FIG. 9-FIG. 12); and Mutually working with first upper-elevation twistable tube 131, first lower-elevation twistable tube 132, second upper-elevation twistable tube 133, and second lower-elevation twistable tube 134 to twistingly clamp threaded connector core 145 when squeezed by arthritic-assisting twist-clamping-jaw hand-knob 141 and hand-knob nut 142 (see FIG. 27).

In an example embodiment, the second anti-slipping twist-clamping threads 129 may be respectively for: Mutually working with first upper-elevation twistable tube 131, first lower-elevation twistable tube 132, second upper-elevation twistable tube 133, and second lower-elevation twistable tube 134 to twistingly unclamp threaded connector core 145 when twistingly spread by first and second twist-spreading springs 126 and 127 to allow opposite-twisting-jaw-housing tunnel system 146 to be rotatably adjusted without slipping in the directions of arrows 193, 194, and 195 (see FIG. 9-FIG. 12); and Mutually working with first upper-elevation twistable tube 131, first lower-elevation twistable tube 132, second upper-elevation twistable tube 133, and second lower-elevation twistable tube 134 to twistingly clamp threaded connector core 145 when squeezed by arthritic-assisting twist-clamping-jaw hand-knob 141 and hand-knob nut 142 (see FIG. 27).

In an example embodiment, the multi-elevation twistable-tube system 130 may be for performing the combined functions of its components. First upper-elevation twistable tube 131 may be for: Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16); and being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16).

In an example embodiment, the first lower-elevation twistable tube 132 may be for: Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16); and Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16).

In an example embodiment, the second upper-elevation twistable tube 133 may be for: Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16); and Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16).

In an example embodiment, the second lower-elevation twistable tube 134 may be for: Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16); and Being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 13-FIG. 16).

In an example embodiment, the first multi-elevation-twisting-tube screw 135 may be for: Securing first production-increasing anti-slipping anti-cracking opposite-twisting jaw 122 and second production-increasing anti-slipping anti-cracking opposite-twisting jaw 123 to opposite-twisting-jaw-housing tunnel 147. Second multi-elevation-twisting-tube screw 136 may be for: Securing first production-increasing anti-slipping anti-cracking opposite-twisting jaw 122 and second production-increasing anti-slipping anti-cracking opposite-twisting jaw 123 to opposite-twisting-jaw-housing tunnel 147.

In an example embodiment, the anti-crack reinforcing twistable-rib system 137 may be for performing the combined functions of its components. First reinforcing twistable ribs 138 may be respectively for: Mutually working with first upper-elevation twistable tube 131, first lower-elevation twistable tube 132, second upper-elevation twistable tube 133, and second lower-elevation twistable tube 134 to allow 1st production-increasing anti-slipping anti-cracking opposite-twisting jaw 122 and 2nd production-increasing anti-slipping anti-cracking opposite-twisting jaw 123 to twistingly unclamp and to twistingly clamp threaded connector core 145 in the directions of arrows 193, 194, and 195 (see FIG. 9-FIG. 12); and Reinforcing 1st production-increasing anti-slipping anti-cracking opposite-twisting jaw 122 and 2nd production-increasing anti-slipping anti-cracking opposite-twisting jaw 123 to prevent them from cracking, and to securely unclamp and to securely clamp threaded connector core 145 in the directions of arrows 193, 194, and 195 (see FIG. 9-FIG. 12).

In an example embodiment, the second reinforcing twistable ribs 139 may be respectively for: Mutually working with first upper-elevation twistable tube 131, first lower-elevation twistable tube 132, second upper-elevation twistable tube 133, and second lower-elevation twistable tube 134 to allow 1st production-increasing anti-slipping anti-cracking opposite-twisting jaw 122 and 2nd production-increasing anti-slipping anti-cracking opposite-twisting jaw 123 to twistingly unclamp and to twistingly clamp threaded connector core 145 in the directions of arrows 193, 194, and 195 (see FIG. 9-FIG. 12); and Reinforcing 1st production-increasing anti-slipping anti-cracking opposite-twisting jaw 122 and 2nd production-increasing anti-slipping anti-cracking opposite-twisting jaw 123 to prevent them from cracking, and to securely unclamp and to securely clamp threaded connector core 145 in the directions of arrows 193, 194, and 195 (see FIG. 9-FIG. 12). Hand-knob hole 140 may be for: Inserting arthritic-assisting twist-clamping-jaw hand-knob 141 therethrough.

Figure 100:
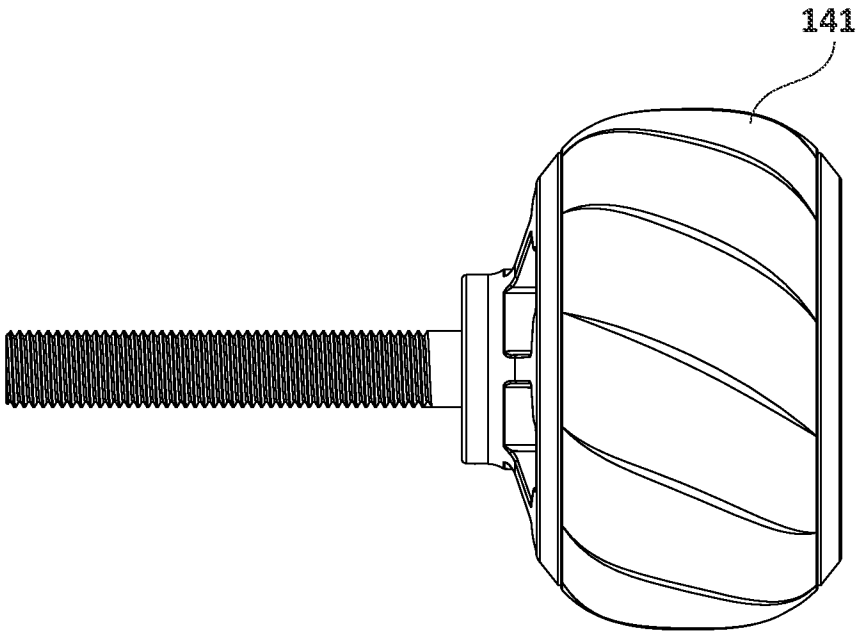
Figure 101:
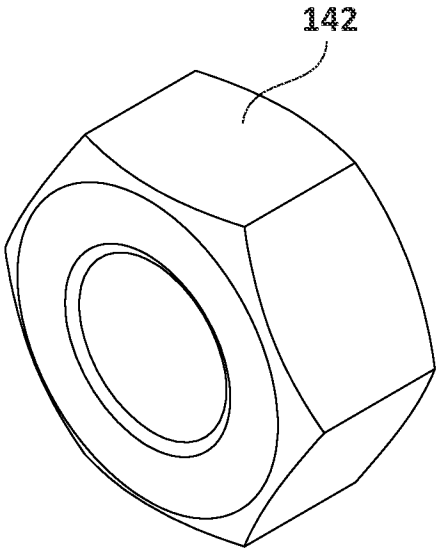
Figure 102:
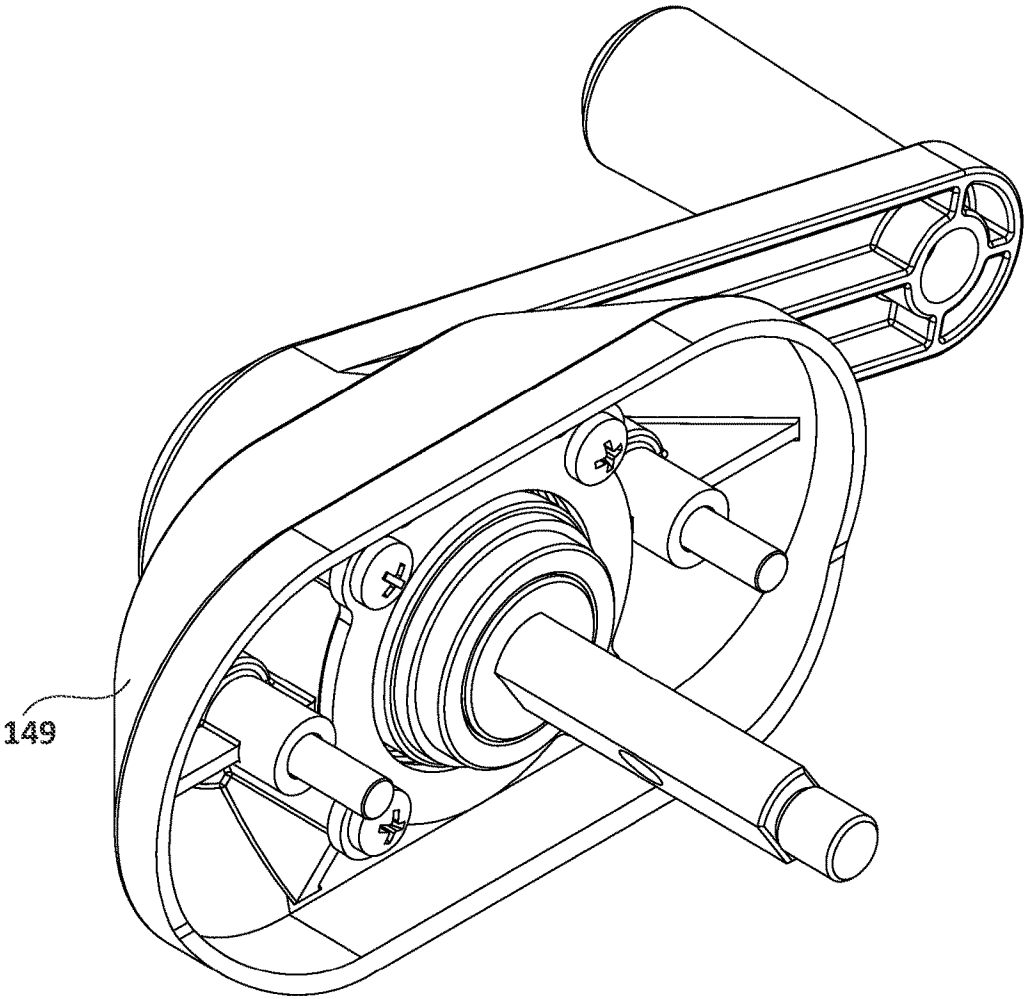
Figure 103:
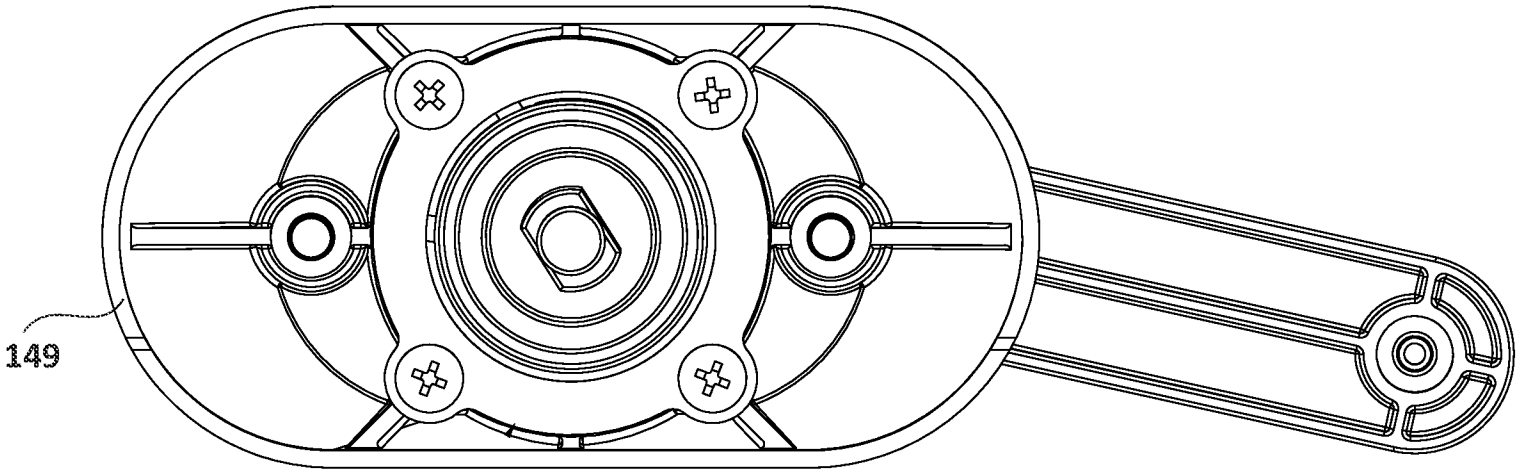
Figure 104:
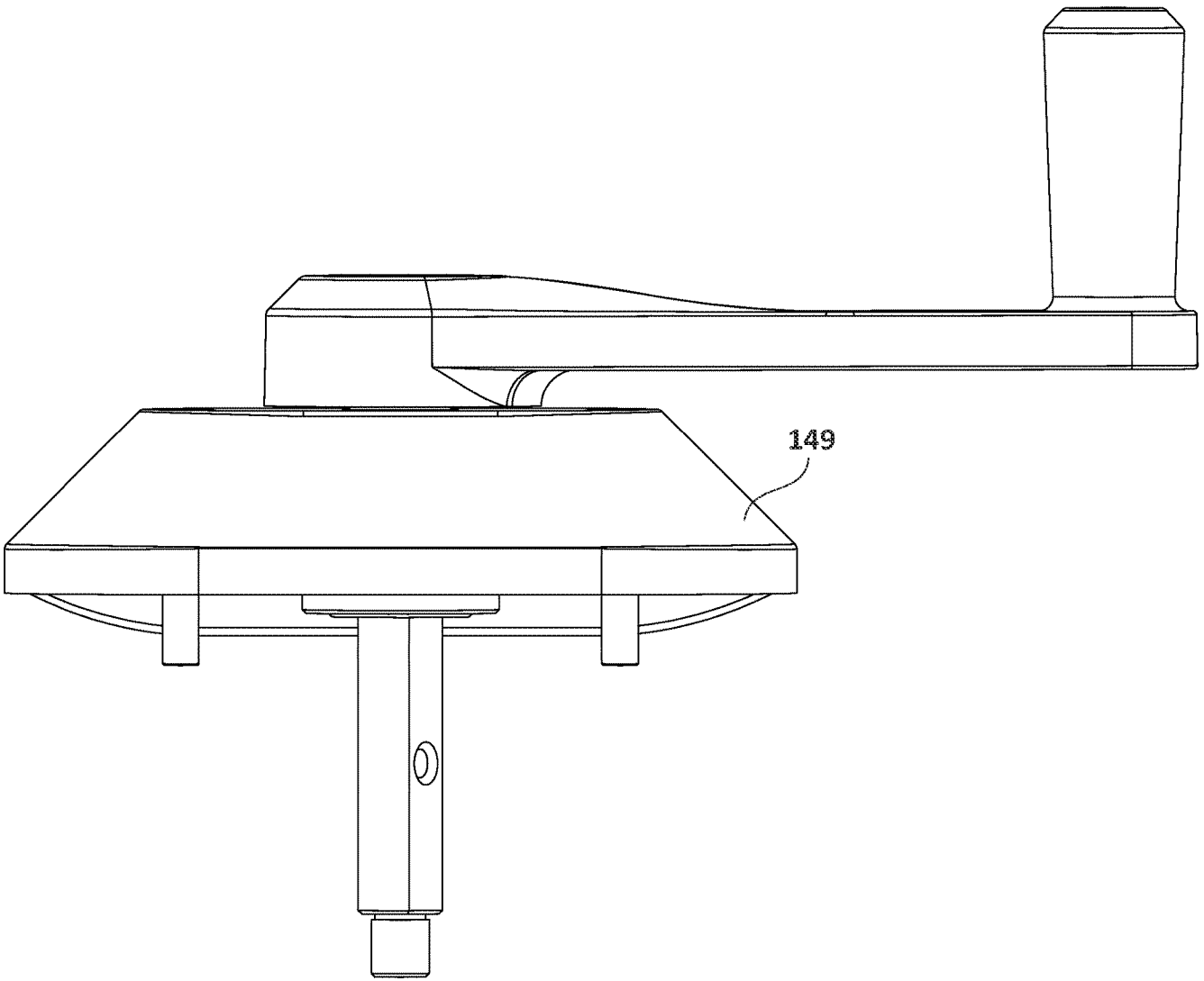
Figure 105:
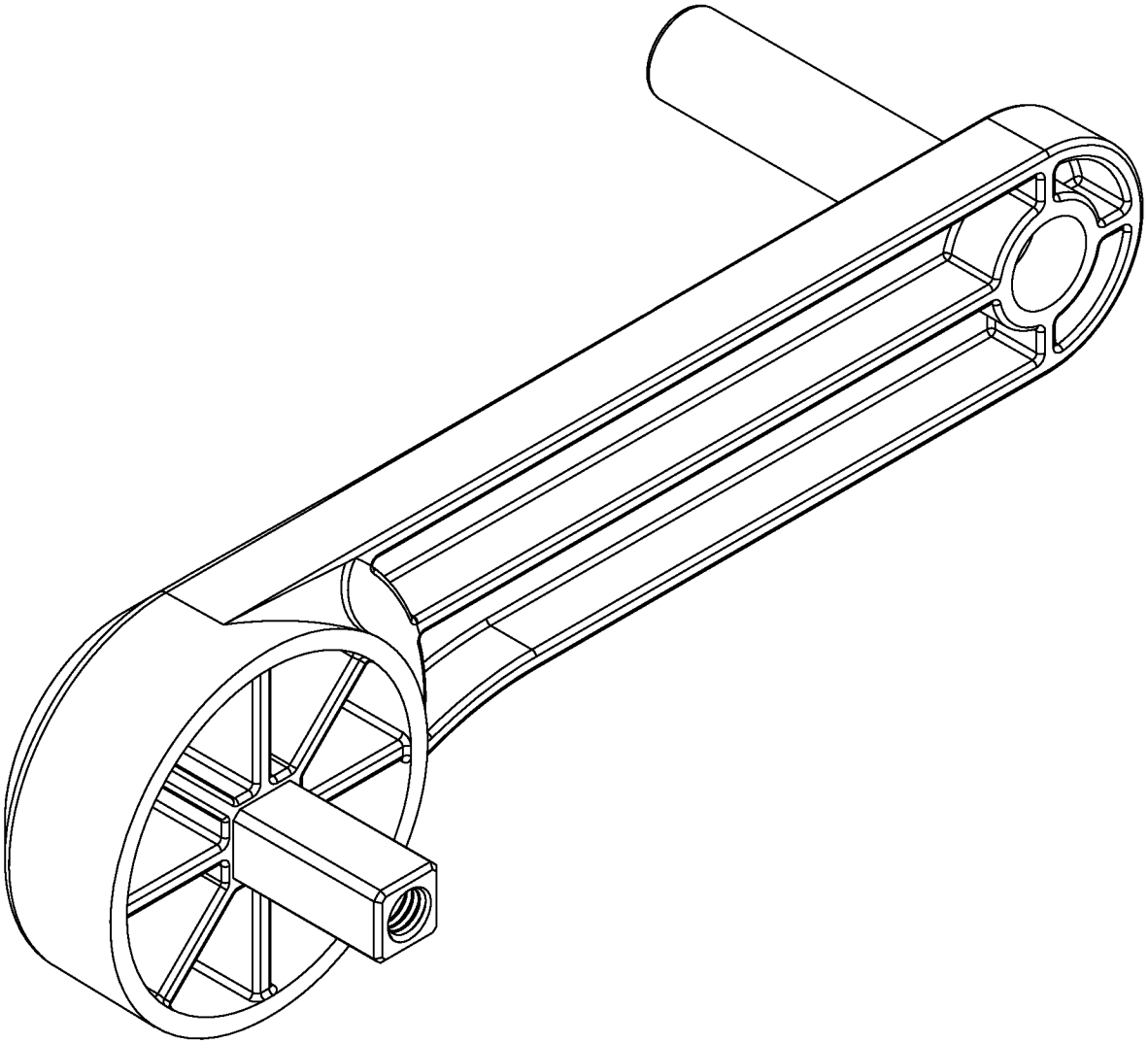
Figure 106:
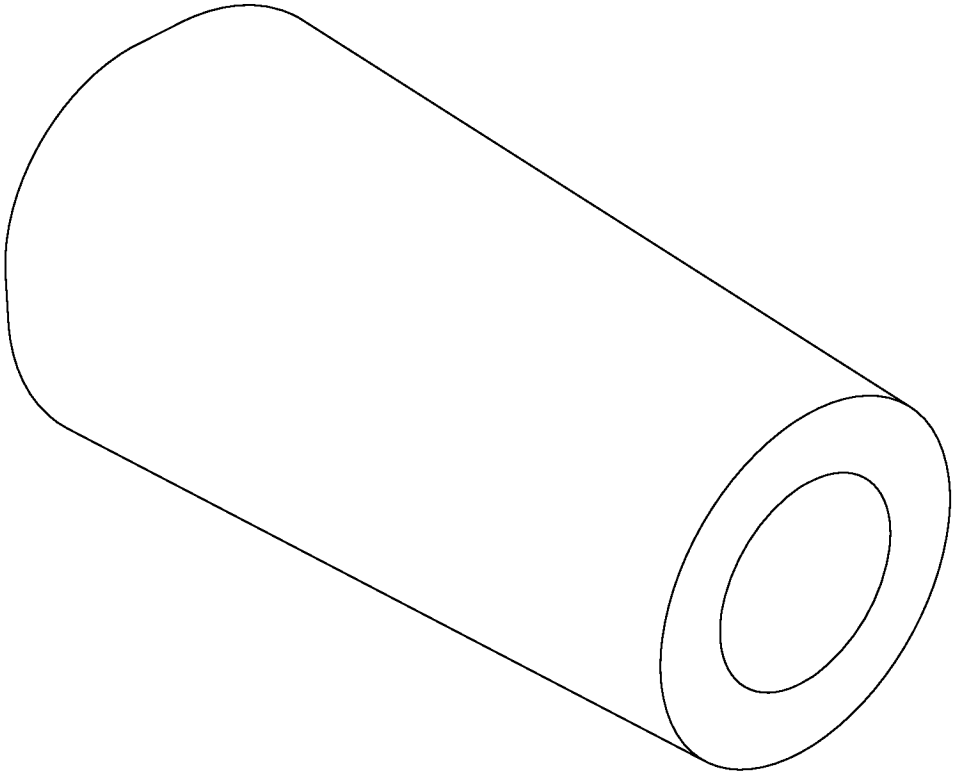
Figure 107:
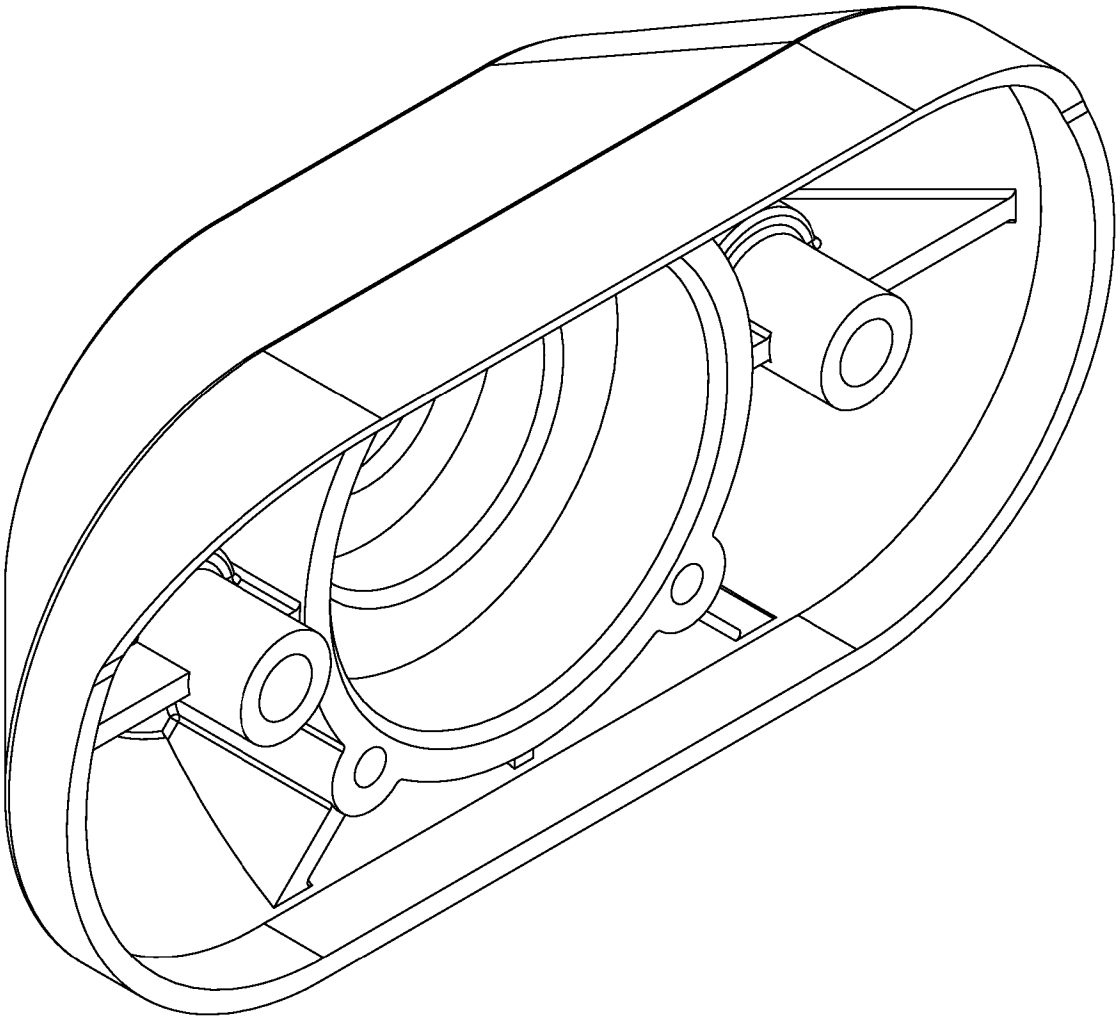
Figure 108:
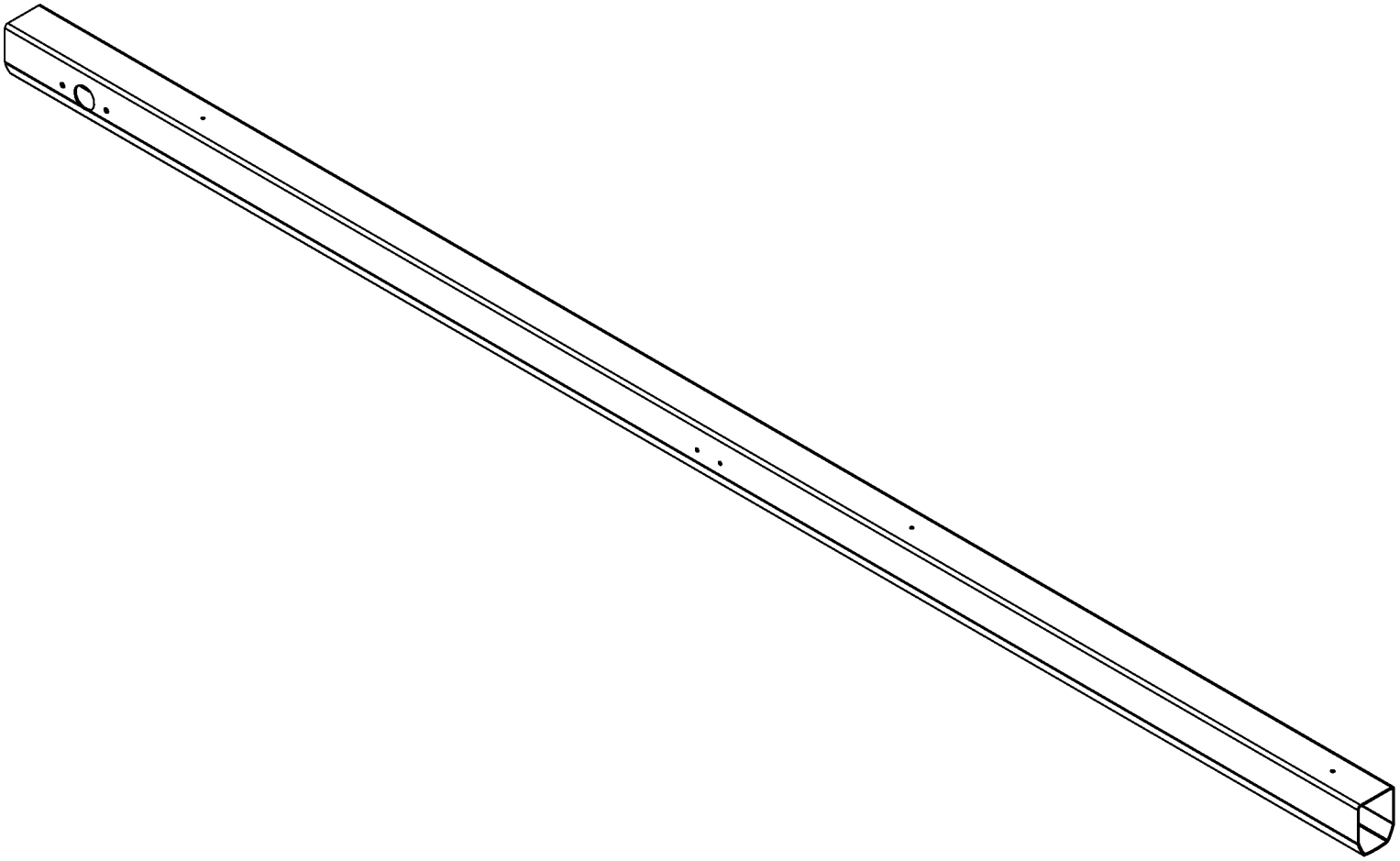
Figure 109:
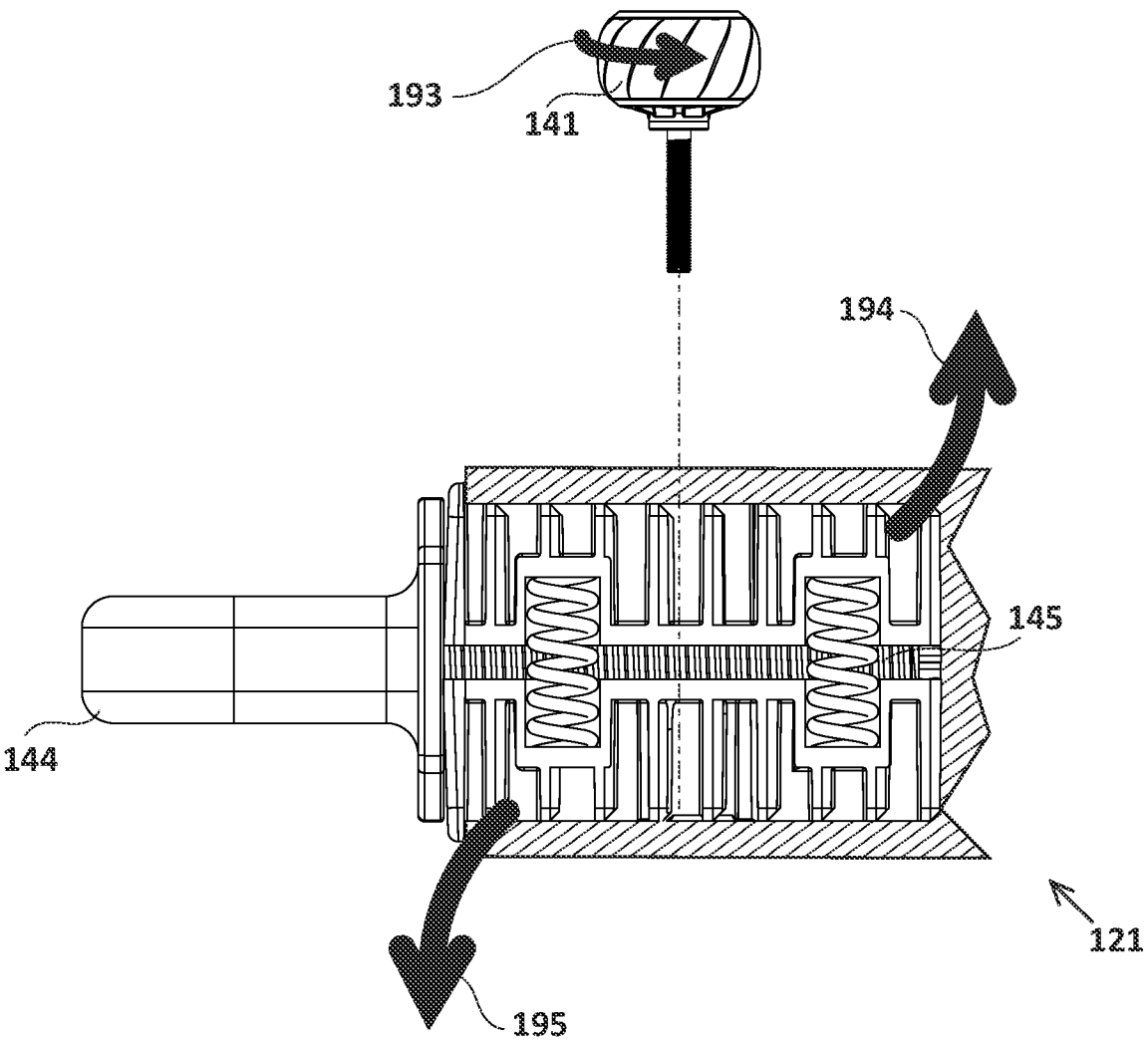
FIG. 109-FIG. 120 are diagrams illustrating perspective, top, and side views demonstrating various functions of the five-device-in-one arthritic-assisting anti-slipping anti-cracking production-increasing opposite-twisting jaws.
Figure 110:
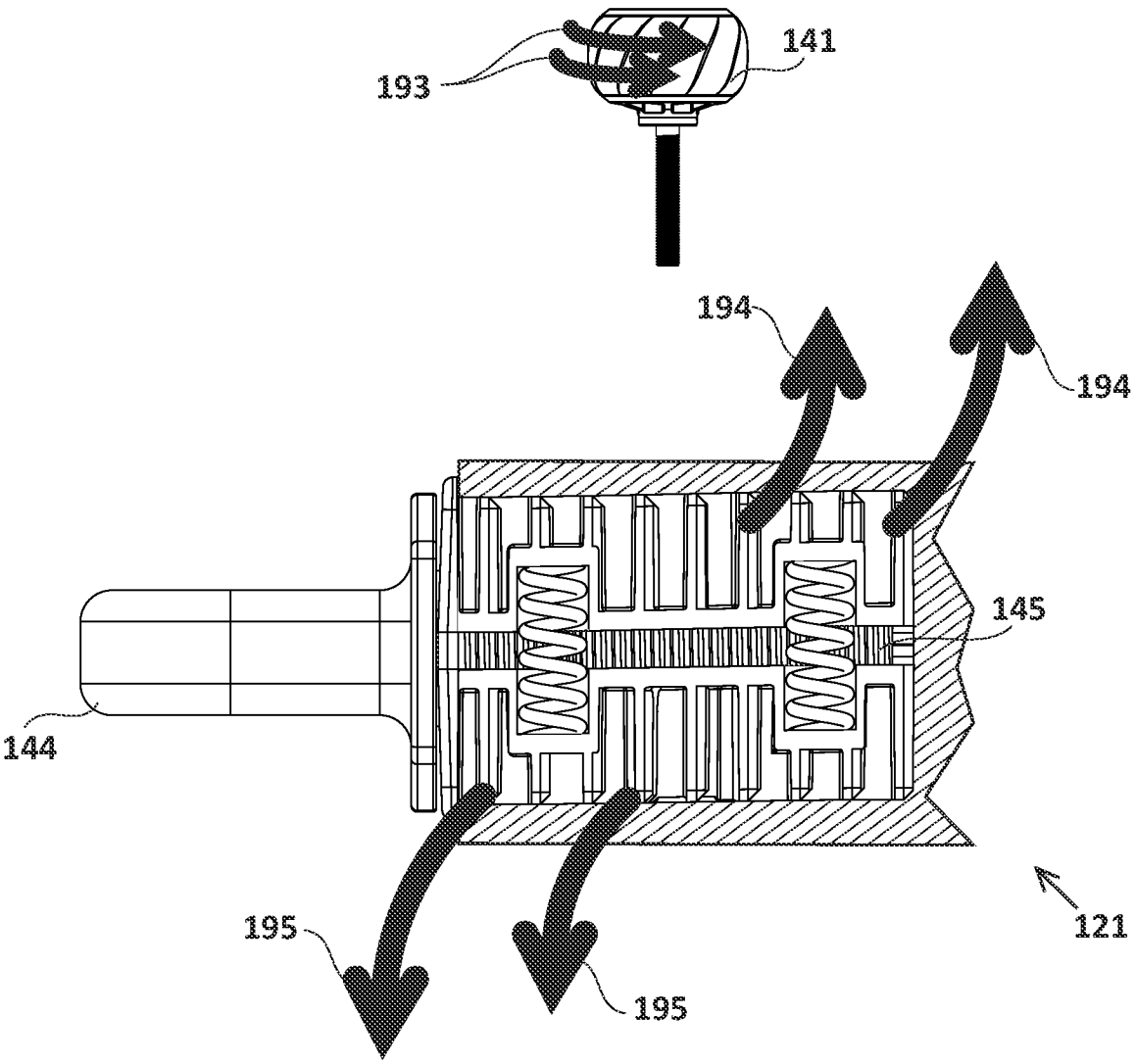
Figure 111:
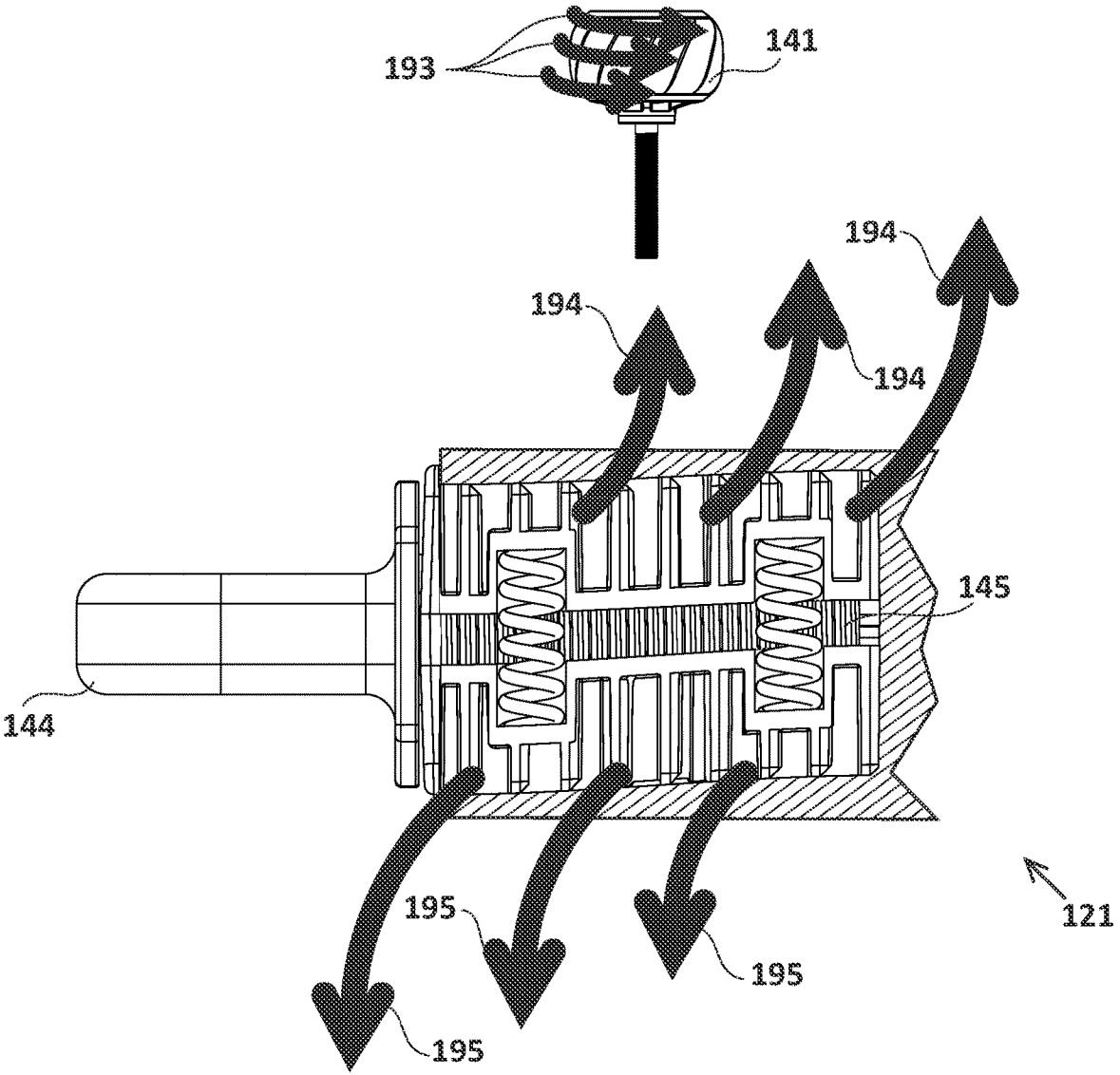
Figure 112:
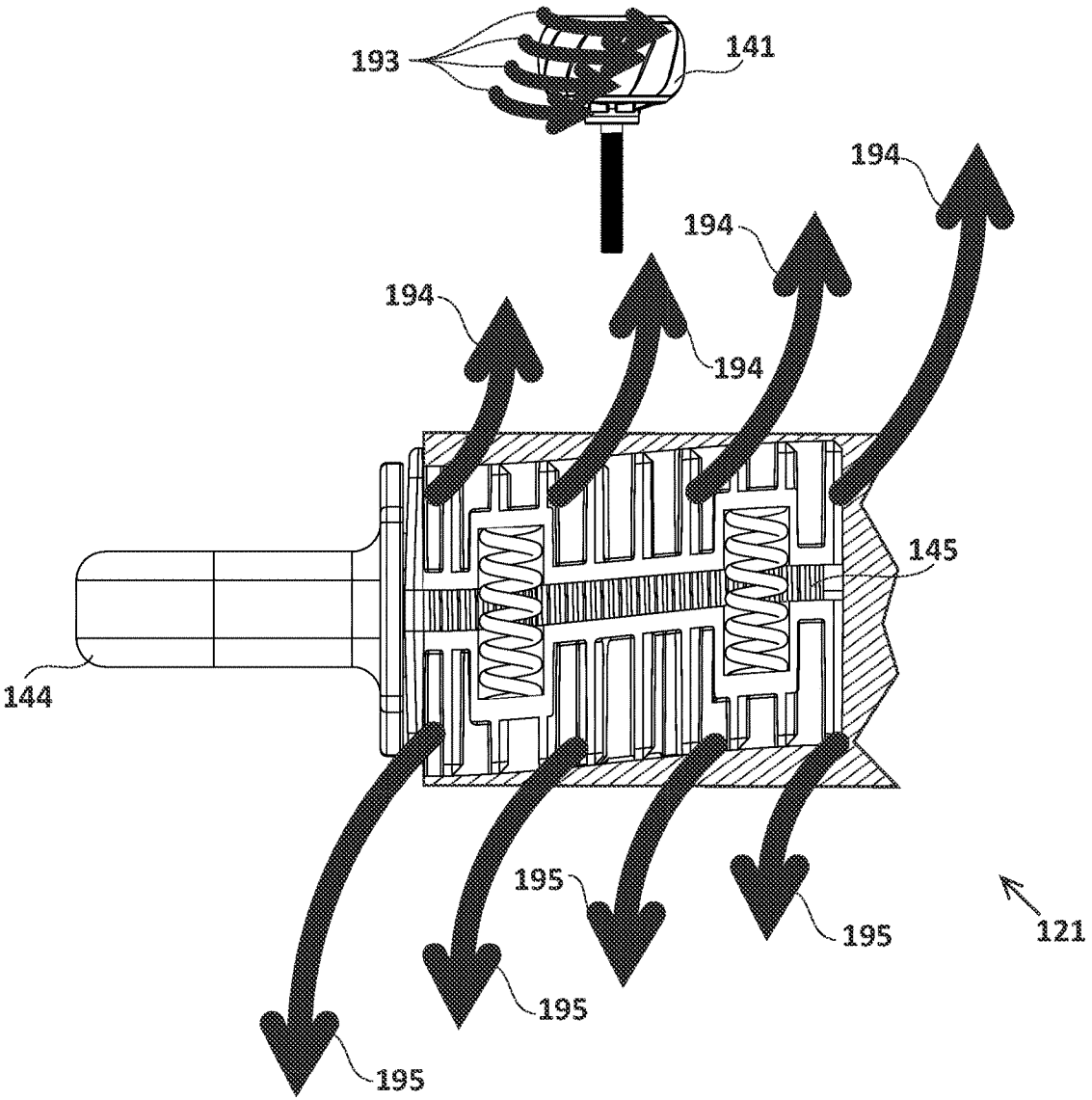

In an example embodiment, the arthritic-assisting twist-clamping-jaw hand-knob 141 may be for: Allowing an arthritic to eliminate the needs for folding his fingers when operating first production-increasing anti-slipping anti-cracking opposite-twisting jaw 122 and second production-increasing anti-slipping anti-cracking opposite-twisting jaw 123 to securely unclamp and to securely clamp threaded connector core 145 in the direction of arrow 205 (see FIG. 51, FIG. 100); and Allowing an arthritic to eliminate pain when operating first production-increasing anti-slipping anti-cracking opposite-twisting jaw 122 and second production-increasing anti-slipping anti-cracking opposite-twisting jaw 123 to securely unclamp and to securely clamp threaded connector core 145 in the direction of arrow 205 (see FIG. 51, FIG. 100).

In an example embodiment, the hand-knob nut 142 may be for: Securing arthritic-assisting twist-clamping-jaw hand-knob 141 to anti-slipping anti-cracking opposite-twisting-jaw system 121. Multi-application pivoting-connector system 143 may be for performing the combined functions of its components. Pivoting connector 144 may be for: Pivotably attaching accessories to. Threaded connector core 145 may be for: Twistingly clamping first anti-slipping twist-clamping threads 128 and second anti-slipping twist-clamping threads 129 thereon.

In an example embodiment, the opposite-twisting-jaw-housing tunnel system 146 may be for performing the combined functions of its components. Opposite-twisting-jaw-housing tunnel 147 may be for: Housing anti-slipping anti-cracking opposite-twisting-jaw system 121 therein. Two opposite-twisting-jaw-securing holes 148 may be respectively for: Screwing first multi-elevation-twisting-tube screw 135 and second multi-elevation-twisting-tube screw 136 therethrough. Cord-cranking mechanism 149 may be for: Ratchetedly winding and unwinding a cord inside opposite-twisting-jaw-housing tunnel 147.

In an example embodiment, the production-increasing cost-saving identical-half-base-top system 150 may be for performing the combined functions of its components. Two production-increasing cost-saving identical-half-base-tops 151 may be respectively for: Covering production-increasing cost-saving identical-half-base-bottom system 155, adjustable-hidable angle-operated caster system 164, and deployable-hidable crank-and-bolt-lock system 170; and Protecting all the components of production-increasing cost-saving identical-half-base-bottom system 155, adjustable-hidable angle-operated caster system 164, and deployable-hidable crank-and-bolt-lock system 170.

In an example embodiment, the crank-storing extra-umbrella-pole-locking hole 152 may be for: Storing and hiding deployable-hidable crank-and-bolt-lock system 170 inside crank-storing extra-umbrella-pole-locking hole 152 for a user to adjust adjustable-hidable angle-operated caster 166 at any time at any location in the direction of arrow 206 (see FIG. 1-FIG. 4, FIG. 89); and Hiding and storing deployable-hidable crank-and-bolt-lock system 170 inside 2 production-increasing cost-saving identical-half-base-bottoms 156 to eliminate tripping and personal injuries in the direction of arrow 206 (see FIG. 1-FIG. 4, FIG. 89).

In an example embodiment, the crank-storing-hole plug 153 may be for: Covering crank-storing extra-umbrella-pole-locking hole 152. Caster-leg hole 154 may be for: Allowing access to caster-leg-wrenching recess 168 to adjust caster leg 167. Production-increasing cost-saving identical-half-base-bottom system 155 may be for performing the combined functions of its components. Two production-increasing cost-saving identical-half-base-bottoms 156 may be respectively for: Being independently vertically adjusted to sit on 2 different elevations at the same time while interlocking each other (for example, sitting on 2 steps of a staircase, on a patio and a step, or on a truck bed and a truck bumper in the direction of arrow 207 (see FIG. 5-FIG. 10); and Being independently vertically adjusted to sit on 2 different elevations at the same time while interlocking each other (for example, sitting on a platform and the ground to stabilize the platform) in the direction of arrow 207 (see FIG. 5-FIG. 10).

In an example embodiment, the six interlocking separation-preventing double-opposite-ridge-locks 157*a* may be respectively for: Being independently vertically adjusted to interlock 2 production-increasing cost-saving identical-half-base-bottoms 156 while they sit on 2 different elevations at the same time (for example, sitting on 2 steps of a staircase, on a patio and a step, on a platform and the ground, on a truck be and a truck bumper, etc.) (see FIG. 5-FIG. 10, FIG. 34-FIG. 35, FIG. 94); and Being independently vertically adjusted to interlock 2 production-increasing cost-saving identical-half-base-bottoms 156 while they sit on 2 different elevations at the same time (for example, sitting on a platform and the ground to stabilize the platform) (see FIG. 5-FIG. 10, FIG. 34-FIG. 35, FIG. 94).

In an example embodiment, the six interlocking separation-preventing double-opposite-interpockets 157*b* may be respectively for: Being independently vertically adjusted to interlock 2 production-increasing cost-saving identical-half-base-bottoms 156 while they sit on 2 different elevations at the same time (for example, sitting on 2 steps of a staircase, on a patio and a step, on a platform and the ground, on a truck be and a truck bumper, etc.) (see FIG. 5-FIG. 10, FIG. 34-FIG. 35, FIG. 94); and Being independently vertically adjusted to interlock 2 production-increasing cost-saving identical-half-base-bottoms 156 while they sit on 2 different elevations at the same time (for example, sitting on a platform and the ground to stabilize the platform) (see FIG. 5-FIG. 10, FIG. 34-FIG. 35, FIG. 94).

In an example embodiment, the four pole-mounting-hole stems 158 may be respectively for: Screwing 2 production-increasing cost-saving identical-half-base-tops 151 thereto to secure 2 production-increasing cost-saving identical-half-base-tops 151 to 2 production-increasing cost-saving identical-half-base-bottoms 156; and Screwing multi-function track pole 119 thereto.

In an example embodiment, the weight compartments 159 may be respectively for: Storing soil, sand, or small stones, for the purpose of stabilizing the 5-device-in-one base. Four Brace slots 160 may be respectively for: Providing recesses for 4 base-supporting braces 161 to be installed therein. Four Base-supporting braces 161 may be respectively for: Providing horizontal strength to support the 5-device-in-one base.

In an example embodiment, the six Roller slots 162 may be respectively for: Providing recesses for 6 angle-operated edge rollers 163 to be installed therein. Six angle-operated edge rollers 163 may be respectively for: Tiltedly working together with adjustable-hidable angle-operated caster 166 when tilted by the tilting adjustment of adjustable-hidable angle-operated caster 166 to mutually elevate the 5-device-in-one base off the ground for moving in the directions of arrows 208-214 (see FIG. 11, FIG. 12, FIG. 43-FIG. 47); and Adjustably staying off the ground for the 5-device-in-one base to sit in a fixed location in the directions of arrows 208-214 (see FIG. FIG. 11, FIG. 12, FIG. 43-FIG. 47). Adjustable-hidable angle-operated caster system 164 may be for performing the combined functions of its components.

In an example embodiment, the caster chamber 165 may be for: Discretely storing adjustable-hidable angle-operated caster 166. Adjustable-hidable angle-operated caster 166 may be for: Being adjusted to different tilted heights to mutually work with 6 angle-operated edge rollers 163 to elevate the 5-device-in-one base off the ground for moving in the directions of arrows 208-214 (see FIG. 11-FIG. 12); and Being adjusted to retract off the ground and hide completely inside caster chamber 165 for the 5-device-in-one base to sit in a fixed location in the directions of arrows 208-214 (see FIG. 11-FIG. 12).

In an example embodiment, the caster leg 167 may be for: Being raised and lowered to allow the 5-device-in-one base to be moved or in a fixed location, respectively. Caster-leg-wrenching recess 168 may be for: Providing a keyhole for removable-hidable wrench 175 to be inserted to adjustably tiltedly raising or lowering adjustable-hidable angle-operated caster 166. Caster mount 169 may be for: Securing adjustable-hidable angle-operated caster 166 and caster leg 167 to 2 production-increasing cost-saving identical-half-base-bottoms 156. Deployable-hidable crank-and-bolt-lock system 170 may be for performing the combined functions of its components In an example embodiment, the crank chamber 171 may be for: Discretely hiding deployable-hidable crank-and-bolt-lock system 170 two deployable-retractable crank-handle-and-bolt-locks 172 may be respectively for being deployed into parallel gaps or holes in a patio or deck to secure the 5-device-in-one base to the patio or deck in the direction of arrow 206 (see FIG. 1-FIG. 4); Being deployed into parallel gaps or holes in a patio or deck to prevent the wind from tipping or toppling the 5-device-in-one base in the direction of arrow 206 (see FIG. 1-FIG. 4); and Being slidably deployed into 2 opposite handles to crank removable-hidable wrench 175 (see FIG. 11-FIG. 12, and FIG. 65-FIG. 68).

Figure 99:
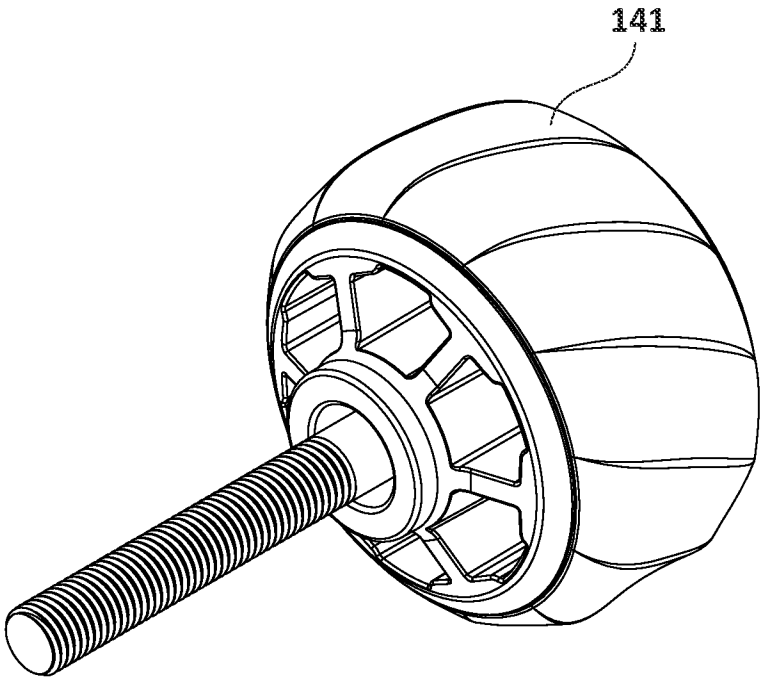

In an example embodiment, the two handle covers 173 may be respectively for: Covering and protecting 2 deployable-retractable crank-handle-and-bolt-locks 172, crank core 174, and removable-hidable wrench 175. Crank core 174 may be for: Securely hiding removable-hidable wrench 175. Removable-hidable wrench 175 may be for: Being stored and hidden inside crank core 174 for a user to adjust adjustable-hidable angle-operated caster 166 at any time at any location (see FIG. 65-FIG. 75), and Being stored and hidden inside 2 production-increasing cost-saving identical-half-base-bottoms 156 to eliminate tripping and personal injuries (see FIG. 1, FIG. 2, and FIG. 99).

Variation

Referring to FIG. 207-FIG. 249: Any component of the five-device-in-one arthritic-assisting anti-vibration anti-friction anti-pinching portable elevators can have any shape and size. Any component of the five-device-in-one arthritic-assisting anti-vibration anti-friction anti-pinching portable elevators can be made of any material(s).

FIG. 1B-FIG. 1F and FIG. 58-FIG. 62 illustrate equivalent applications of the five-device-in-one arthritic-assisting anti-vibration anti-friction anti-pinching portable elevators (being used on an umbrella post, hand rail, sail pole, awning arm, and pergola column such that the five-device-in-one arthritic-assisting anti-vibration anti-friction anti-pinching portable elevators can move in the directions of arrows 188, 189, 190, 191 and 192, respectively).

FIG. 207-FIG. 239 illustrate equivalent variations of the five-device-in-one arthritic-assisting anti-vibration anti-friction anti-pinching portable elevators.

FIG. 240-FIG. 249 illustrate equivalent applications of the five-device-in-one arthritic-assisting anti-vibration anti-friction anti-pinching portable elevators (being used on an umbrella post, hand rail, sail pole, awning arm, and pergola column such that the five-device-in-one arthritic-assisting anti-vibration anti-friction anti-pinching portable elevators can move in the directions of arrows 188, 189, 190, 191 and 192, respectively).

Referring to FIG. 250-FIG. 291: Any component of the five-device-in-one arthritic-assisting anti-slipping anti-cracking production-increasing opposite-twisting jaws can have any shape and size. Any component of the five-device-in-one arthritic-assisting anti-slipping anti-cracking production-increasing opposite-twisting jaws can be made of any material(s).

FIG. 250-FIG. 285 illustrate equivalent variations of the five-device-in-one arthritic-assisting anti-slipping anti-cracking production-increasing opposite-twisting jaws.

FIG. 286-FIG. 290 illustrate equivalent applications of the five-device-in-one arthritic-assisting anti-slipping anti-cracking production-increasing opposite-twisting jaws (being used on an umbrella post, hand rail, sail pole, awning arm, and pergola column such that the five-device-in-one arthritic-assisting anti-slipping anti-cracking production-increasing opposite-twisting jaws can move in the directions of arrows 200, 201, 202, 203, and 204, respectively).

Figure 291:
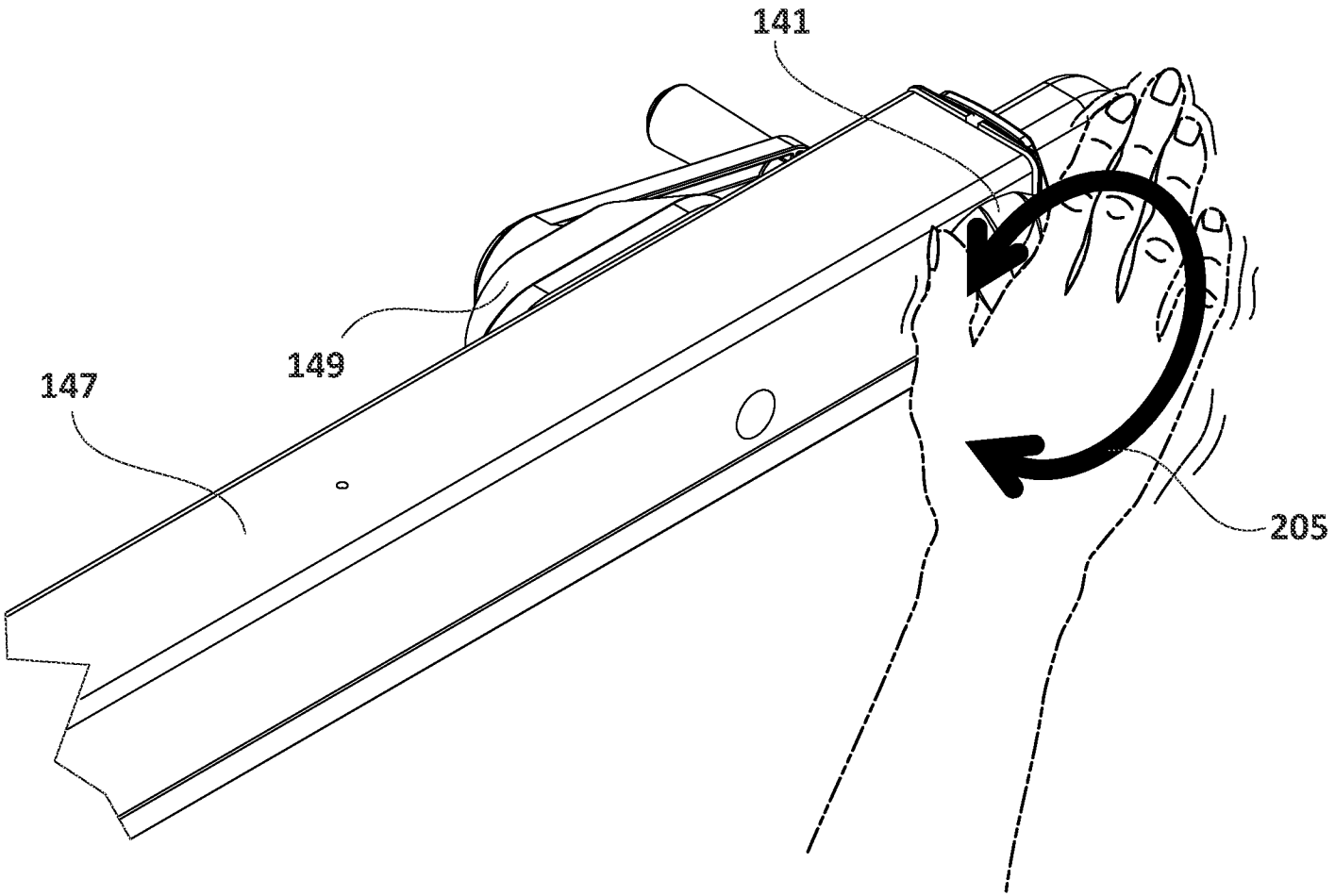
Figure 292:
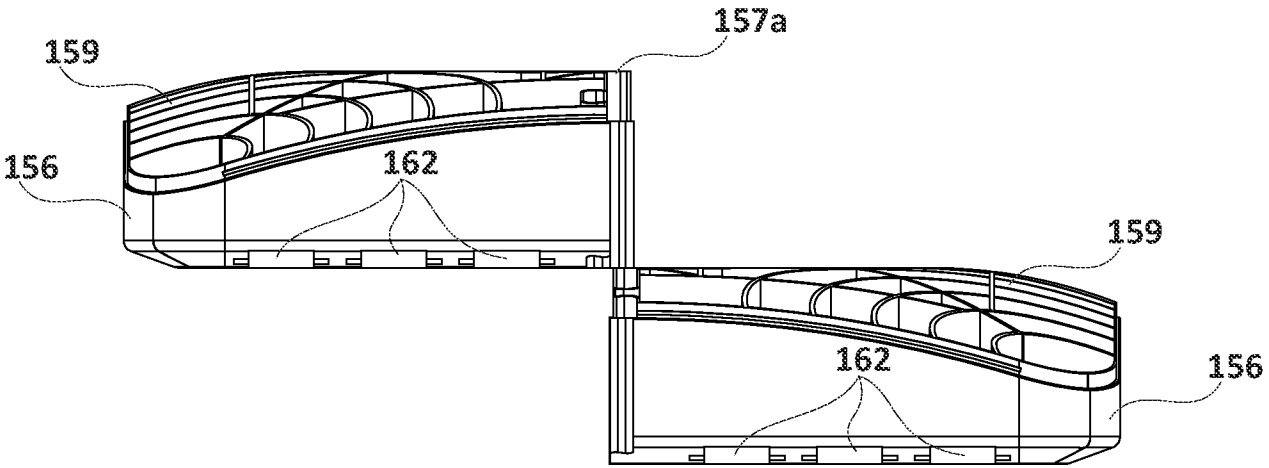
FIG. 292-FIG. 296 are diagrams illustrating top, side and perspective views demonstrating equivalent applications of the 5-device-in-one base (having built-in deployable-retractable crank-handle-and-bolt-locks), for being used as uneven-step supporter, uneven-surface supporter, patio bolt-locker, platform stabilizer, or weight base (For example, being used with a cantilever umbrella, a straight pole umbrella, and a pergola, a platform, a staircase, a truck, or a patio, respectively).
Figure 293:
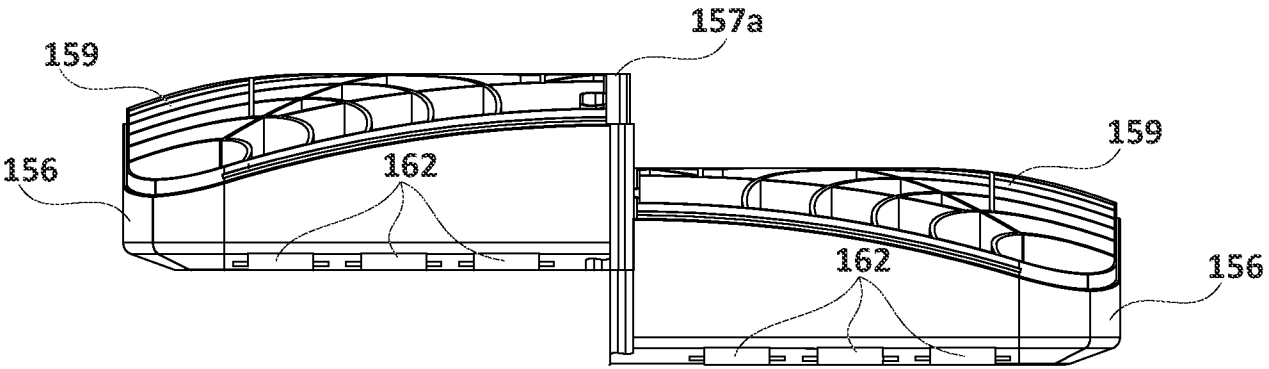
Figure 294:
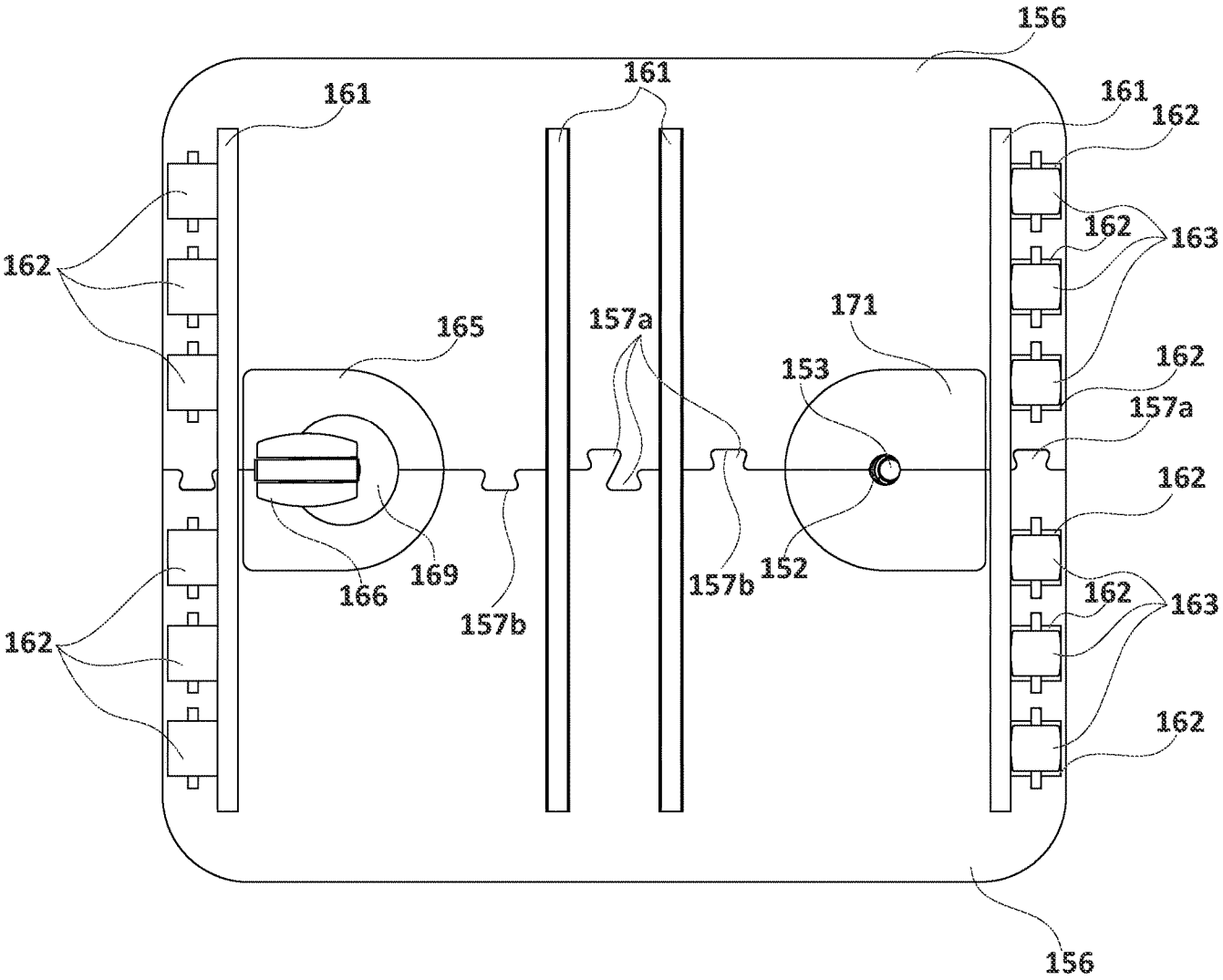
Figure 295:
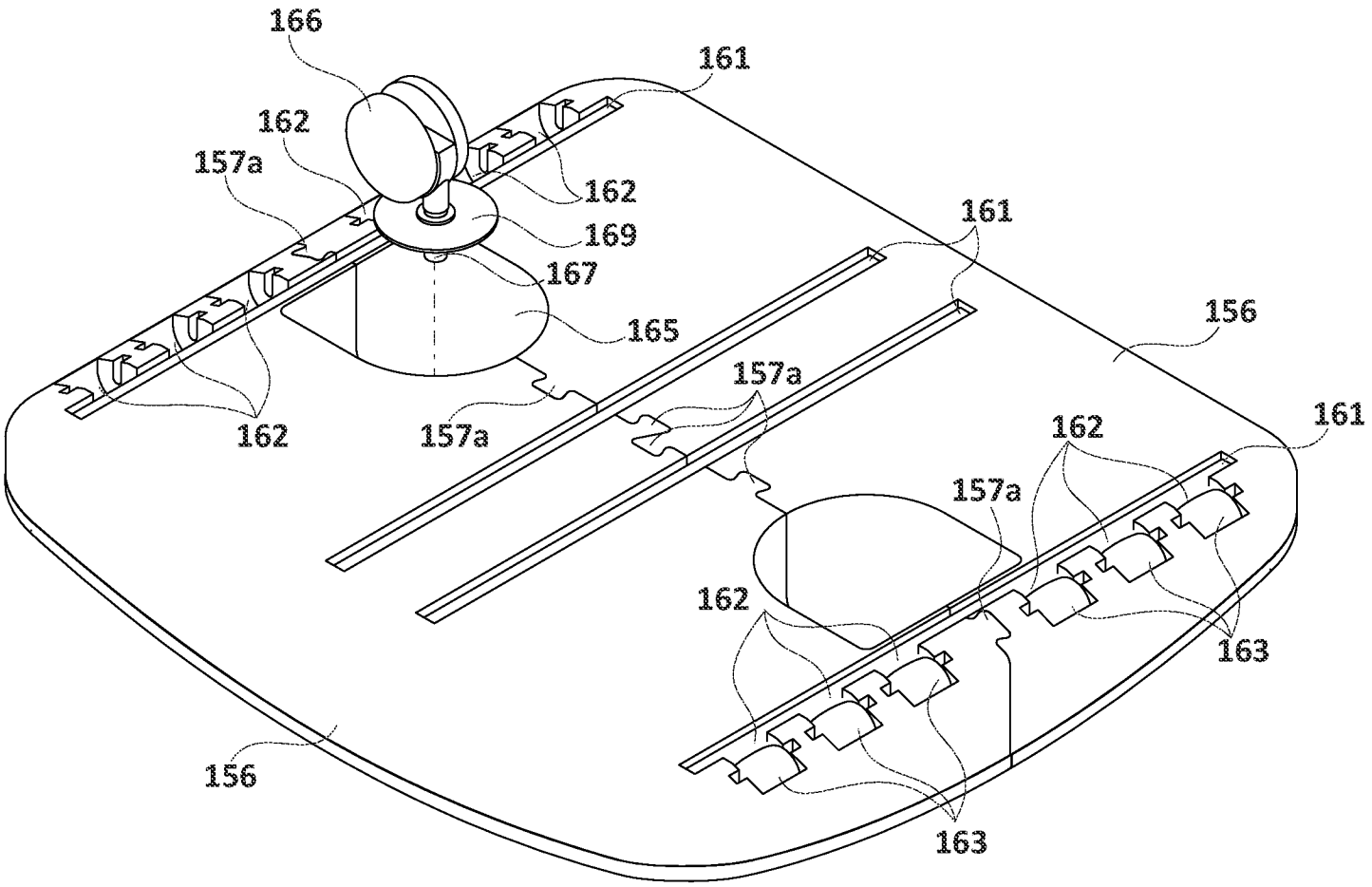
Figure 296:
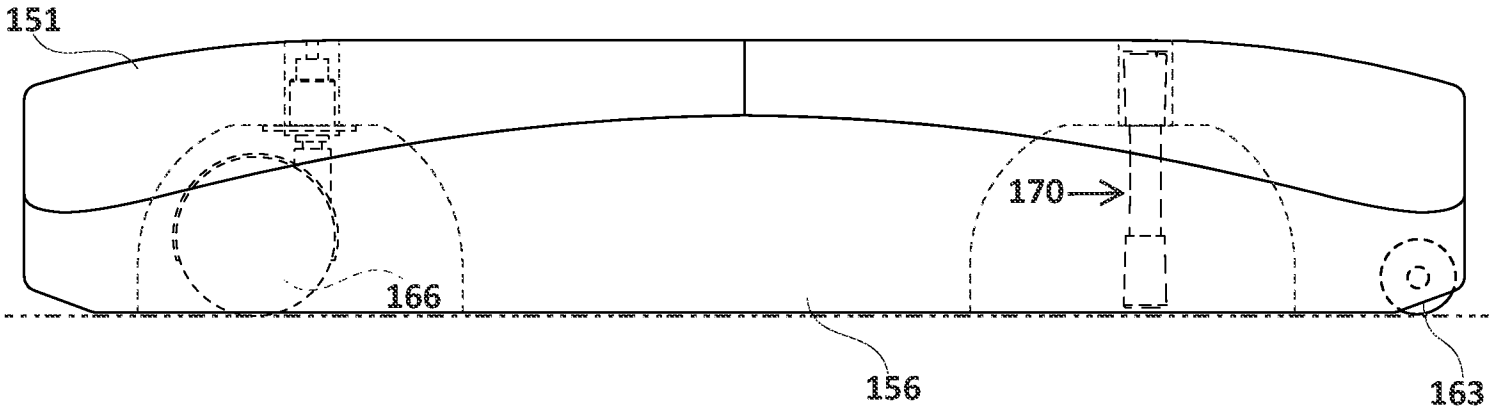
Figure 297:
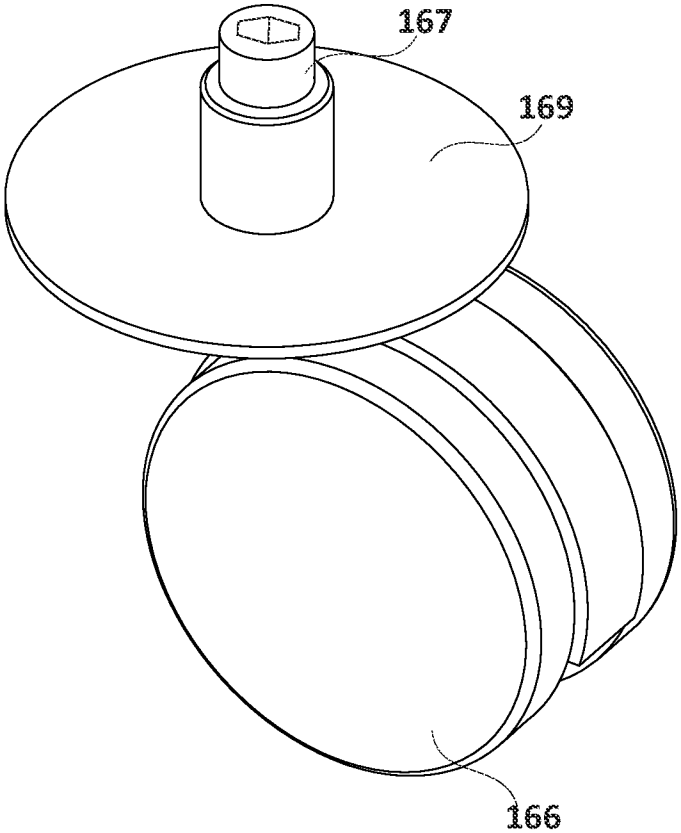
FIG. 297-FIG. 305 are diagrams illustrating perspective, side, and top views demonstrating equivalent variations of components for the 5-device-in-one base (having built-in deployable-retractable crank-handle-and-bolt-locks), for being used as uneven-step supporter, uneven-surface supporter, patio bolt-locker, platform stabilizer, or weight base.
Figure 298:
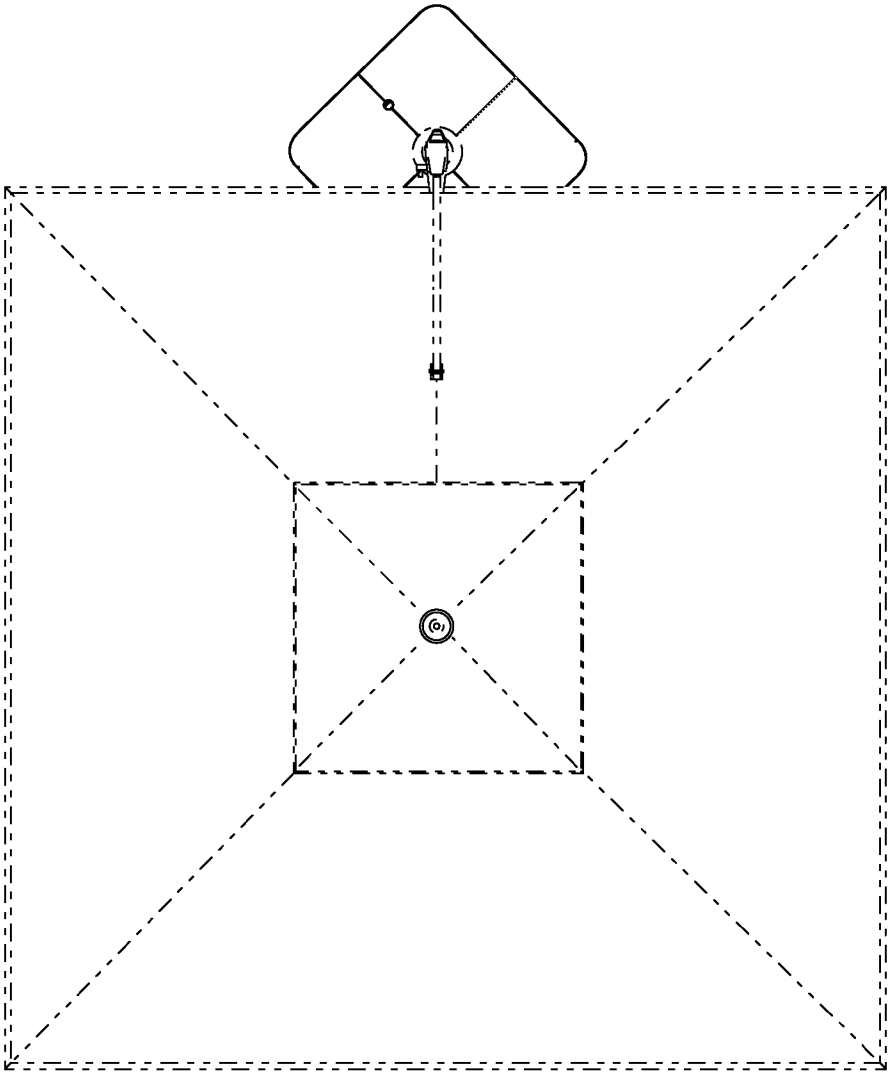
Figure 299:
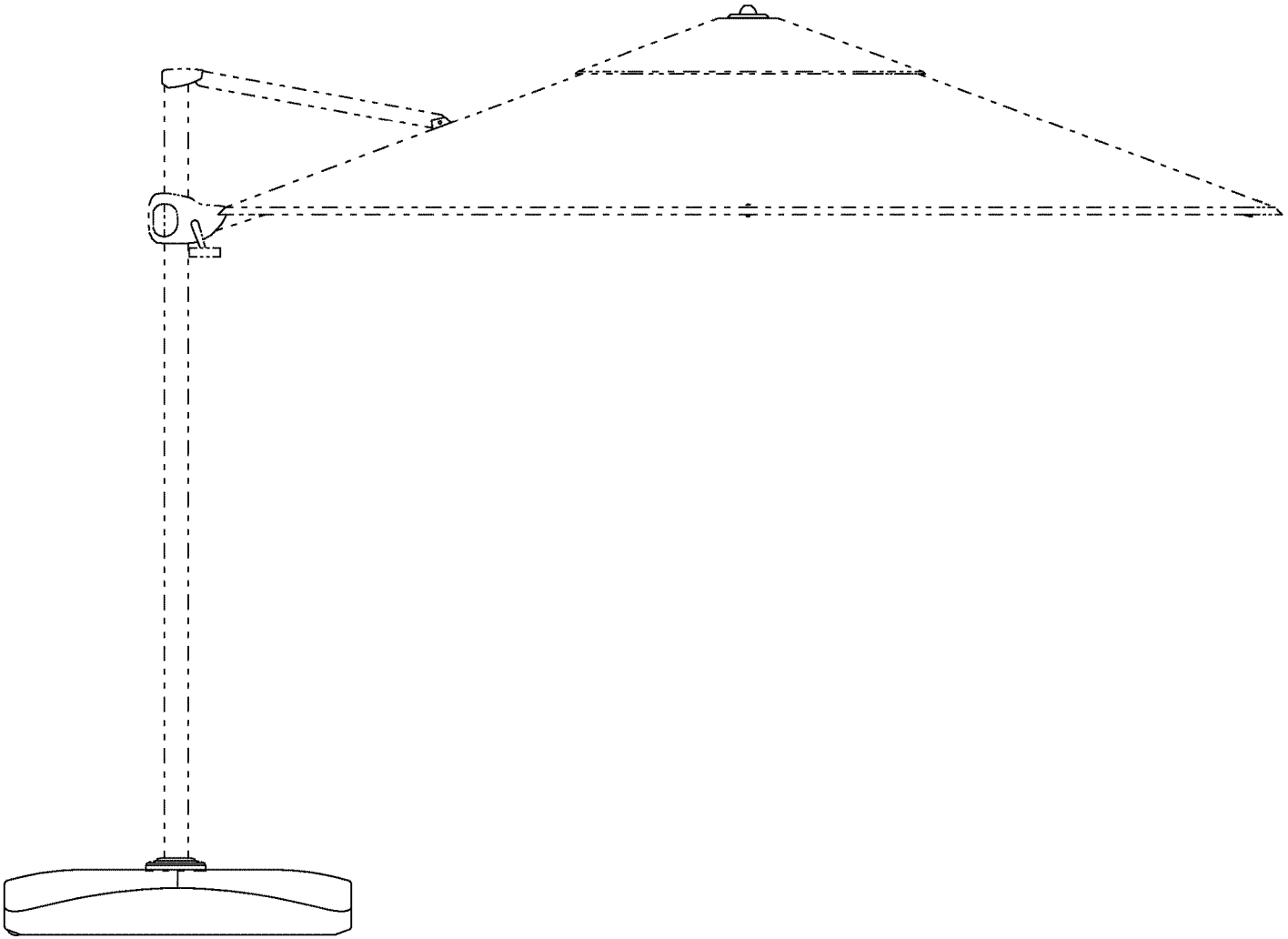
Figure 300:
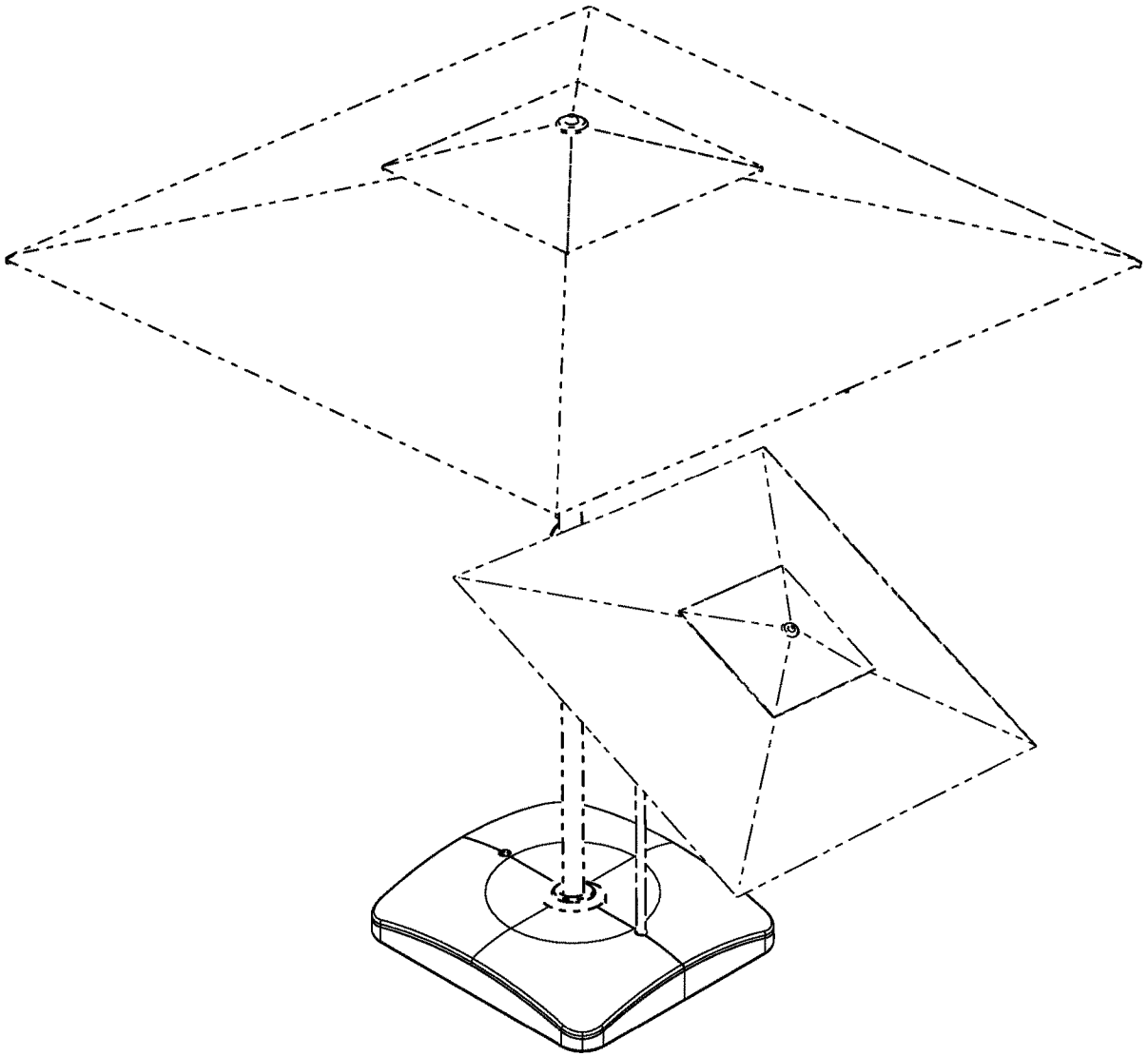
Figure 301:
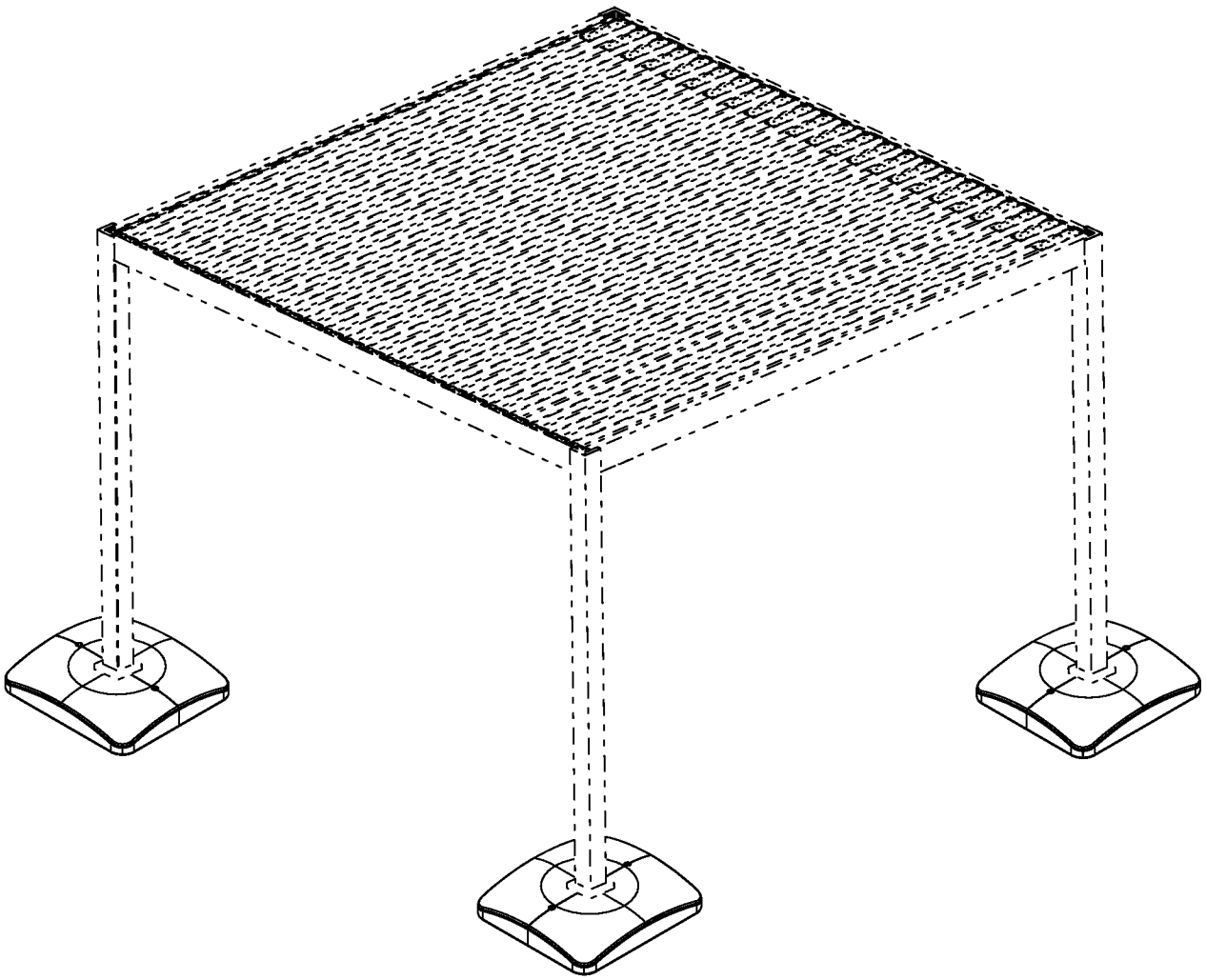
Figure 302:
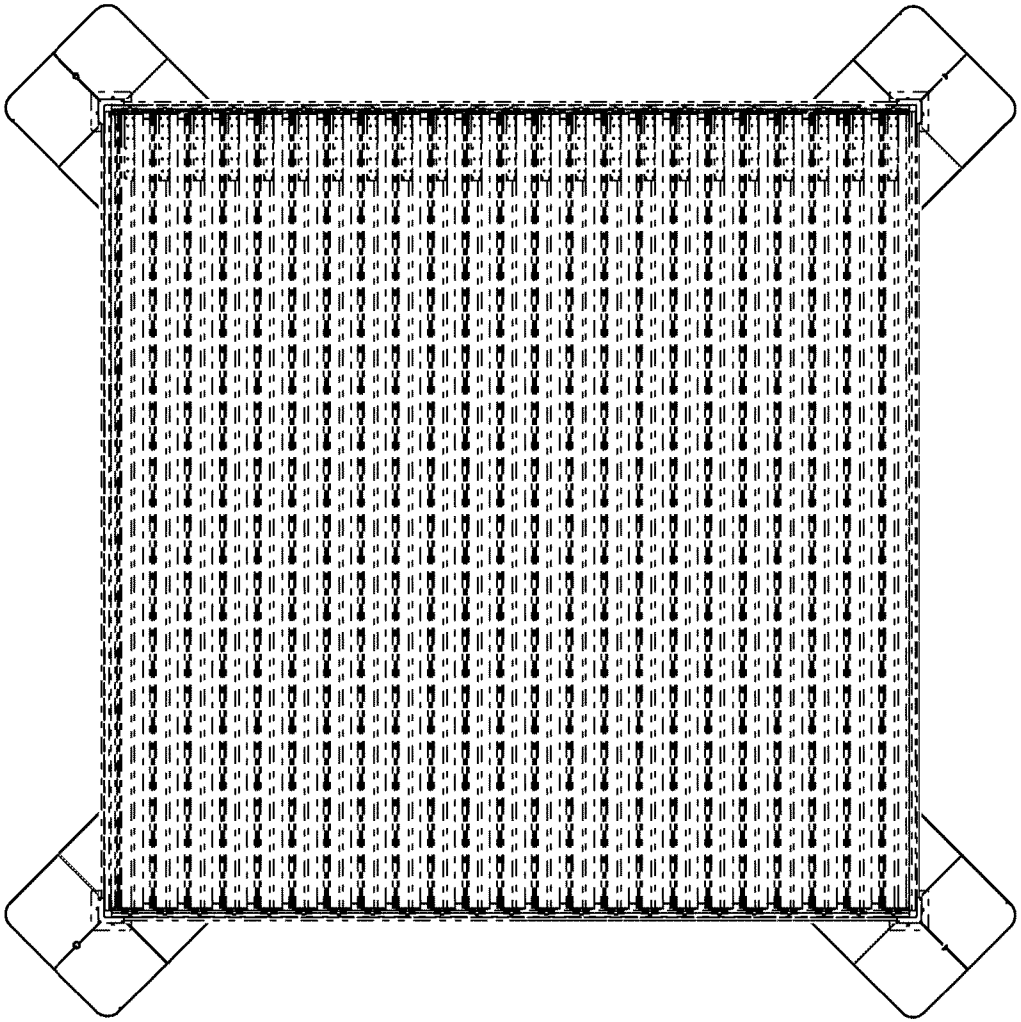
Figure 303:
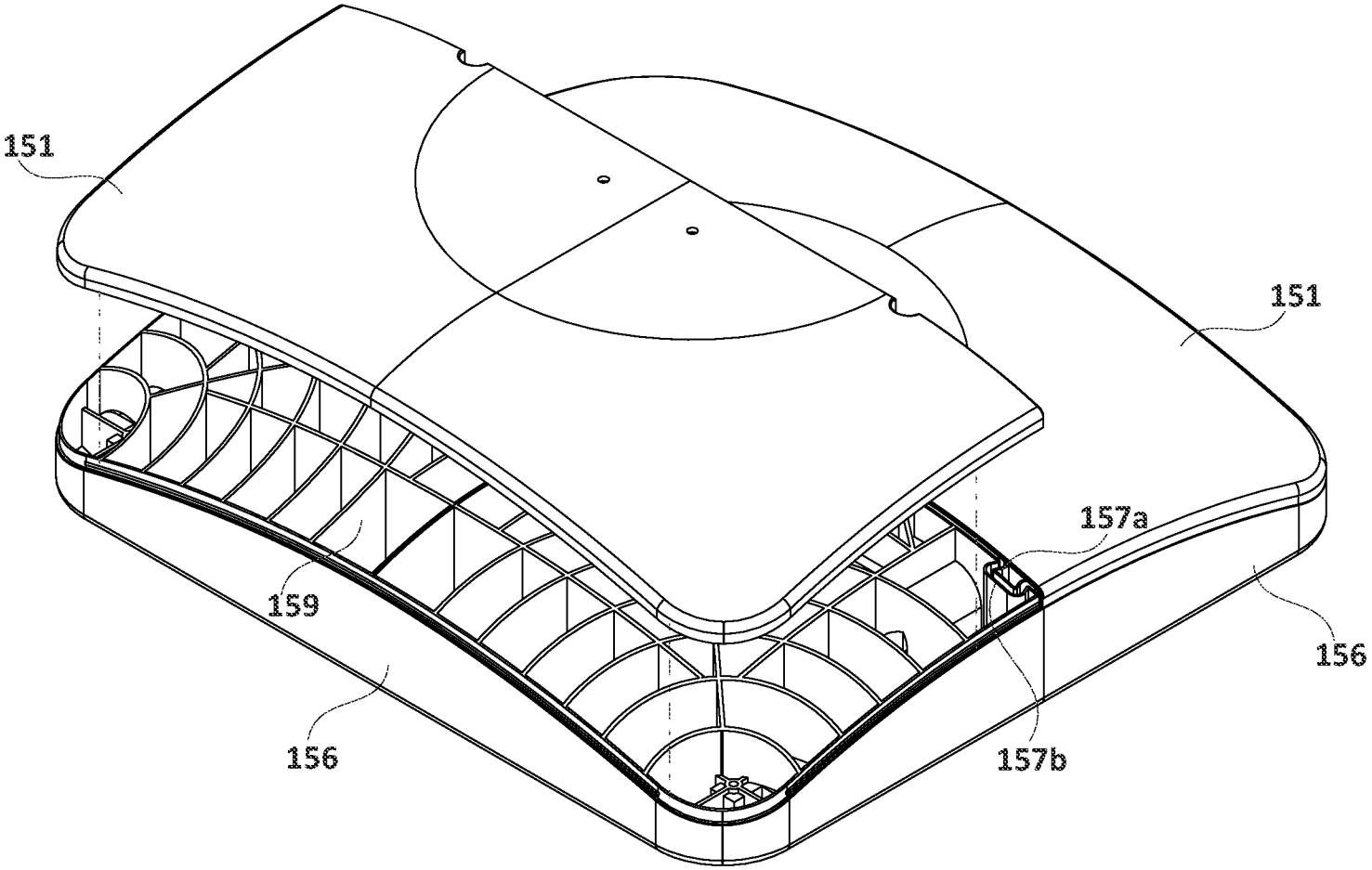

FIG. 291 illustrates an equivalent application of the five-device-in-one arthritic-assisting anti-slipping anti-cracking production-increasing opposite-twisting jaws being used by an arthritic in the direction of arrow 205.

Referring to FIG. 292-FIG. 305: Any component of the 5-device-in-one base (having built-in deployable-retractable crank-handle-and-bolt-locks), for being used as uneven-step supporter, uneven-surface supporter, patio bolt-locker, platform stabilizer, and weight base, can have any shape and size. Any component of the 5-device-in-one base (having built-in deployable-retractable crank-handle-and-bolt-locks), for being used as uneven-step supporter, uneven-surface supporter, patio bolt-locker, platform stabilizer, and weight base, can be made of any material(s).

FIG. 292-FIG. 296 illustrate top, side and perspective views demonstrating equivalent applications of the 5-device-in-one base (having built-in deployable-retractable crank-handle-and-bolt-locks), for being used as uneven-step supporter, uneven-surface supporter, patio bolt-locker, platform stabilizer, or weight base (For example, being used with a cantilever umbrella, a straight pole umbrella, and a pergola, a platform, a staircase, a truck, or a patio, respectively).

FIG. 297-FIG. 305 illustrate perspective, side, and top views demonstrating equivalent variations of components for the 5-device-in-one base (having built-in deployable-retractable crank-handle-and-bolt-locks), for being used as uneven-step supporter, uneven-surface supporter, patio bolt-locker, platform stabilizer, or weight base.

The present invention substantially departs from the conventional concepts and designs of the prior art. In doing so, the present invention provides five-device-in-one arthritic-assisting anti-vibration anti-friction anti-pinching portable elevators, twisting jaws, and uneven base (for being adapted to umbrella post, hand rail, sail pole, awning arm, and pergola column, and for being capable of functioning as uneven-step supporter, uneven-surface supporter, patio bolt-locker, platform stabilizer, and weight base), having many new and significant features, functions, and advantages, which overcome all the disadvantages of the prior art, as follows:

1) It is an object of an embodiment to provide five-device-in-one arthritic-assisting anti-vibration anti-friction anti-pinching portable elevators, twisting jaws, and uneven base, having arthritic-assisting anti-vibration anti-friction portable handle-elevator 107*a*. Therefore, the five-device-in-one arthritic-assisting anti-vibration anti-friction anti-pinching portable elevators, twisting jaws, and uneven base may be: Capable of eliminating the needs for an arthritic to fold and unfold his fingers to raise and lower arthritic-assisting anti-vibration anti-friction anti-pinching portable-elevator system 106 (see FIG. 51, FIG. 56, and FIG. 57); Capable of securing and enclosing arthritic-assisting anti-vibration anti-friction anti-pinching portable roller-elevator 108 (see FIG. 10); Capable of being used on umbrella post, handrail, sail pole, awning arm, and pergola column (see FIG. 58-FIG. 62); and Capable of preventing an arthritic's hand from being pinched by multi-elevator stabilizer 113, arthritic-assisting anti-vibration anti-friction portable rollers 111, and roller axles 110 (see FIG. 51, FIG. 56, and FIG. 57).

2) It is another object of an embodiment to provide five-device-in-one arthritic-assisting anti-vibration anti-friction anti-pinching portable elevators, twisting jaws, and uneven base, having arthritic-assisting anti-vibration anti-friction handle-elevator-track 107*b*. Therefore, the five-device-in-one arthritic-assisting anti-vibration anti-friction anti-pinching portable elevators, twisting jaws, and uneven base may be: Capable of sealing arthritic-assisting anti-vibration anti-friction portable rollers 111 to protect a user's hand or an arthritic's hand. Capable of guiding arthritic-assisting anti-vibration anti-friction portable rollers 111 (see FIG. 3).

3) It is still another object of an embodiment to provide five-device-in-one arthritic-assisting anti-vibration anti-friction anti-pinching portable elevators, twisting jaws, and uneven base, having arthritic-assisting anti-vibration anti-friction portable roller-elevator 108. Therefore, the five-device-in-one arthritic-assisting anti-vibration anti-friction anti-pinching portable elevators, twisting jaws, and uneven base may be: Capable of being used on umbrella post. handrail, sail pole, awning arm, and pergola column (see FIG. 58-FIG. 62) Capable of hiding arthritic-assisting anti-vibration anti-friction portable roller-elevator 108 (see FIG. 2); and Capable of securing and organizing arthritic-assisting anti-vibration anti-friction portable rollers 111 (see FIG. 11, FIG. 12, and FIG. 18).

4) It is a further object of an embodiment to provide five-device-in-one arthritic-assisting anti-vibration anti-friction anti-pinching portable elevators, twisting jaws, and uneven base, having arthritic-assisting anti-vibration anti-friction portable rollers 111. Therefore, the five-device-in-one arthritic-assisting anti-vibration anti-friction anti-pinching portable elevators, twisting jaws, and uneven base may be: Capable of assisting an arthritic in operating arthritic-assisting anti-vibration anti-friction anti-pinching portable-elevator system 106 in the directions of arrows 176-186 (see FIG. 51-FIG. 57); and Capable of eliminating vibration and friction during operation of arthritic-assisting anti-vibration anti-friction anti-pinching portable-elevator system 106 in the direction of arrow 187 (see FIG. 49 and FIG. 50).

5) It is still a further object of an embodiment to provide five-device-in-one arthritic-assisting anti-vibration anti-friction anti-pinching portable elevators, twisting jaws, and uneven base, having arthritic-assisting anti-vibration anti-friction back roller-tracks 102 and arthritic-assisting anti-vibration anti-friction front roller-tracks 103. Therefore, the five-device-in-one arthritic-assisting anti-vibration anti-friction anti-pinching portable elevators, twisting jaws, and uneven base may be: Capable of guiding arthritic-assisting anti-vibration anti-friction portable rollers 111 to assist an arthritic during operation of arthritic-assisting anti-vibration anti-friction anti-pinching portable-elevator system 106 in the directions of arrows 176-186 (see FIG. 51-FIG. 57); and Capable of eliminating vibration and friction during operation of arthritic-assisting anti-vibration anti-friction anti-pinching portable-elevator system 106 in the direction of arrow 187 (see FIG. 49 and FIG. 50).

6) It is yet still another object of an embodiment to provide five-device-in-one arthritic-assisting anti-vibration anti-friction anti-pinching portable elevators, twisting jaws, and uneven base, having arthritic-assisting raising angle-handle 112*a*. Therefore, the five-device-in-one arthritic-assisting anti-vibration anti-friction anti-pinching portable elevators, twisting jaws, and uneven base may be: Capable of assisting an arthritic to eliminate the needs for folding an arthritic's fingers when raising arthritic-assisting anti-vibration anti-friction anti-pinching portable-elevator system 106 in the directions of arrows 176-186 (see FIG. 51-FIG. 57); and Capable of reducing impact against an arthritic's fingers during operation of arthritic-assisting anti-vibration anti-friction anti-pinching portable-elevator system 106 in the directions of arrows 176-186 (see FIG. 51-FIG. 57).

7) It is yet still a further object of an embodiment to provide five-device-in-one arthritic-assisting anti-vibration anti-friction anti-pinching portable elevators, twisting jaws, and uneven base, having arthritic-assisting lowering angle-handle 112*b*. Therefore, the five-device-in-one arthritic-assisting anti-vibration anti-friction anti-pinching portable elevators, twisting jaws, and uneven base may be: Capable of assisting an arthritic to eliminate the needs for folding an arthritic's fingers when lowering arthritic-assisting anti-vibration anti-friction anti-pinching portable-elevator system 106 in the directions of arrows 176-186 (see FIG. 51-FIG. 57); and Capable of reducing impact against an arthritic's fingers during operation of arthritic-assisting anti-vibration anti-friction anti-pinching portable-elevator system 106 in the directions of arrows 176-186 (see FIG. 51-FIG. 57).

8) It is an object of an embodiment to provide five-device-in-one arthritic-assisting anti-vibration anti-friction anti-pinching portable elevators, twisting jaws, and uneven base, having first production-increasing anti-slipping anti-cracking opposite-twisting jaw 122 and second production-increasing anti-slipping anti-cracking opposite-twisting jaw 123. Therefore, the five-device-in-one arthritic-assisting anti-vibration anti-friction anti-pinching portable elevators, twisting jaws, and uneven base may be: Capable of mutually working with first upper-elevation twistable tube 131, first lower-elevation twistable tube 132, second upper-elevation twistable tube 133, and second lower-elevation twistable tube 134 to twistingly unclamp and to twistingly clamp threaded connector core 145 when turning arthritic-assisting twist-clamping-jaw hand-knob 141 in the directions of arrows 193, 194, and 195 (see FIG. 71-FIG. 74); and Capable of twisting while being twistingly spread by first twist-spreading spring 126 and second twist-spreading spring 127 to twistingly unclamp threaded connector core 145 to allow opposite-twisting-jaw-housing tunnel system 146 to be rotatably adjusted without slipping in the directions of arrows 193, 194, and 195 (see FIG. 71-FIG. 74).

9) It is another object of an embodiment to provide five-device-in-one arthritic-assisting anti-vibration anti-friction anti-pinching portable elevators, twisting jaws, and uneven base, having first anti-slipping core-twist-clamping threads 128 and second anti-slipping core-twist-clamping threads 129. Therefore, the five-device-in-one arthritic-assisting anti-vibration anti-friction anti-pinching portable elevators, twisting jaws, and uneven base may be: Capable of mutually working with first upper-elevation twistable tube 131, first lower-elevation twistable tube 132, second upper-elevation twistable tube 133, and second lower-elevation twistable tube 134 to twistingly unclamp threaded connector core 145 when twistingly spread by first and second twist-spreading springs 126 and 127 to allow opposite-twisting-jaw-housing tunnel system 146 to be rotatably adjusted without slipping in the directions of arrows 193, 194, and 195 (see FIG. 71-FIG. 74); and Capable of mutually working with first upper-elevation twistable tube 131, first lower-elevation twistable tube 132, second upper-elevation twistable tube 133, and second lower-elevation twistable tube 134 to twistingly clamp threaded connector core 145 when squeezed by arthritic-assisting twist-clamping-jaw hand-knob 141 and hand-knob nut 142 (see FIG. 89).

10) It is still another object of an embodiment to provide five-device-in-one arthritic-assisting anti-vibration anti-friction anti-pinching portable elevators, twisting jaws, and uneven base, having first upper-elevation twistable tube 131 and first lower-elevation twistable tube 132. Therefore, the five-device-in-one arthritic-assisting anti-vibration anti-friction anti-pinching portable elevators, twisting jaws, and uneven base may be: Capable of being on 2 different elevations to allow first production-increasing anti-slipping anti-cracking opposite-twisting jaw 122 to twistingly unclamp threaded connector core 145 when twistingly spread by first and second twist-spreading springs 126 and 127 on different elevations of arrows 196, 197, 198, and 199 (see FIG. 75-FIG. 78); and b) Capable of being on 2 different elevations to allow first production-increasing anti-slipping anti-cracking opposite-twisting jaw 122 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

11) It is a further object of an embodiment to provide five-device-in-one arthritic-assisting anti-vibration anti-friction anti-pinching portable elevators, twisting jaws, and uneven base, having second upper-elevation twistable tube 133 and second lower-elevation twistable tube 134. Therefore, the five-device-in-one arthritic-assisting anti-vibration anti-friction anti-pinching portable elevators, twisting jaws, and uneven base may be: Capable of being on 2 different elevations to allow second production-increasing anti-slipping anti-cracking opposite-twisting jaw 123 to twistingly unclamp threaded connector core 145 when twistingly spread by first and second twist spreading springs 126 and 127 on different elevations of arrows 196, 197, 198, and 199 (see FIG. 75-FIG. 78); and Capable of being on 2 different elevations to allow second production-increasing anti-slipping anti-cracking opposite-twisting jaw 123 to twistingly clamp threaded connector core 145 when squeezed by arthritic-assisting twist-clamping-jaw hand-knob 141 and hand-knob nut 142 on different elevations of arrows 196, 197, 198, and 199 (see FIG. 75-FIG. 78).

12) It is another further object of an embodiment to provide five-device-in-one arthritic-assisting anti-vibration anti-friction anti-pinching portable elevators, twisting jaws, and uneven base, having first reinforcing twistable ribs 138 and second reinforcing twistable ribs 139. Therefore, the five-device-in-one arthritic-assisting anti-vibration anti-friction anti-pinching portable elevators, twisting jaws, and uneven base may be: Capable of mutually working with first upper-elevation twistable tube 131, first lower-elevation twistable tube 132, second upper-elevation twistable tube 133, and second lower-elevation twistable tube 134 to allow 1st production-increasing anti-slipping anti-cracking opposite-twisting jaw 122 and 2nd production-increasing anti-slipping anti-cracking opposite-twisting jaw 123 to twistingly unclamp and to twistingly clamp threaded connector core 145 in the directions of arrows 193, 194, and 195 (see FIG. 9-FIG. 12); and Capable of reinforcing 1st production-increasing anti-slipping anti-cracking opposite-twisting jaw 122 and 2nd production-increasing anti-slipping anti-cracking opposite-twisting jaw 123 to prevent them from cracking, and to securely unclamp and to securely clamp threaded connector core 145 in the directions of arrows 193, 194, and 195 (see FIG. 71-FIG. 74).

13) It is still another further object of an embodiment to provide five-device-in-one arthritic-assisting anti-vibration anti-friction anti-pinching portable elevators, twisting jaws, and uneven base, having arthritic-assisting twist-clamping-jaw hand-knob 141. Therefore, the five-device-in-one arthritic-assisting anti-vibration anti-friction anti-pinching portable elevators, twisting jaws, and uneven base may be: Capable of allowing an arthritic to eliminate the needs for folding his fingers when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113); and Capable of allowing an arthritic to eliminate pain when operating 1st production-increasing anti-slipping anti-cracking opposite-twisting jaw 122 and 2nd production-increasing anti-slipping anti-cracking opposite-twisting jaw 123 to securely unclamp and to securely clamp threaded connector core 145 in the direction of arrow 205 (see FIG. 113).

14) It is an object of an embodiment to provide five-device-in-one arthritic-assisting anti-vibration anti-friction anti-pinching portable elevators, twisting jaws, and uneven base, having 2 production-increasing cost-saving identical-half-base-bottoms 156. Therefore, the five-device-in-one arthritic-assisting anti-vibration anti-friction anti-pinching portable elevators, twisting jaws, and uneven base may be: Capable of being independently vertically adjusted to sit on 2 different elevations at the same time while interlocking each other (for example, sitting on 2 steps of a staircase, on a patio and a step, or on a truck bed and a truck bumper in the direction of arrow 207 (see FIG. 125-FIG. 130); and Capable of being independently vertically adjusted to sit on 2 different elevations at the same time while interlocking each other (for example, sitting on a platform and the ground to stabilize the platform) in the direction of arrow 207 (see FIG. 125-FIG. 130).

15) It is another object of an embodiment to provide five-device-in-one arthritic-assisting anti-vibration anti-friction anti-pinching portable elevators, twisting jaws, and uneven base, having 2 deployable-retractable crank-handle-and-bolt-locks 172. Therefore, the five-device-in-one arthritic-assisting anti-vibration anti-friction anti-pinching portable elevators, twisting jaws, and uneven base may be: Capable of deploying crank-handle-and-bolt-locks 172 into parallel gaps or holes in a patio or deck to secure the 5-device-in-one base to the patio or deck in the direction of arrow 206 (see FIG. 121-FIG. 124); Capable of deploying crank-handle-and-bolt-locks 172 into parallel gaps or holes in a patio or deck to prevent the wind from tipping or toppling the 5-device-in-one base in the direction of arrow 206 (see FIG. 121-FIG. 124); and Capable of being slidably deployed into 2 opposite handles to crank removable-hidable wrench 175 (see FIG. 131-FIG. 132, and FIG. 185-FIG. 188).

16) It is still another object of an embodiment to provide five-device-in-one arthritic-assisting anti-vibration anti-friction anti-pinching portable elevators, twisting jaws, and uneven base, having adjustable-hidable angle-operated caster 166. Therefore, the five-device-in-one arthritic-assisting anti-vibration anti-friction anti-pinching portable elevators, twisting jaws, and uneven base may be: Capable of being adjusted to different tilted heights to mutually work with 6 angle-operated edge rollers 163 to elevate the 5-device-in-one base off the ground for moving in the directions of arrows 208-214 (see FIG. 11-FIG. 12); and Capable of being adjusted to retract off the ground and hide completely inside caster chamber 165 for the 5-device-in-one base to sit in a fixed location in the directions of arrows 208-214 (see FIG. 131-FIG. 132).

17) It is yet still another object of an embodiment to provide five-device-in-one arthritic-assisting anti-vibration anti-friction anti-pinching portable elevators, twisting jaws, and uneven base, having 6 separation-preventing double-opposite-ridge-interlocks 157*a* and 6 separation-preventing double-opposite-interpockets 157*b*. Therefore, the five-device-in-one arthritic-assisting anti-vibration anti-friction anti-pinching portable elevators, twisting jaws, and uneven base may be: Capable of being independently vertically adjusted to interlock 2 production-increasing cost-saving identical-half-base-bottoms 156 while they sit on 2 different elevations at the same time (for example, sitting on 2 steps of a staircase, on a patio and a step, on a platform and the ground, on a truck be and a truck bumper, etc.) (see FIG. 125-FIG. 130, FIG. 154-FIG. 155, FIG. 299); and Capable of being independently vertically adjusted to interlock 2 production-increasing cost-saving identical-half-base-bottoms 156 while they sit on 2 different elevations at the same time (for example, sitting on a platform and the ground to stabilize the platform) (see FIG. 125-FIG. 130, FIG. 154-FIG. 155, FIG. 299).

18) It is a further object of an embodiment to provide five-device-in-one arthritic-assisting anti-vibration anti-friction anti-pinching portable elevators, twisting jaws, and uneven base, having removable-hidable wrench 175. Therefore, the five-device-in-one arthritic-assisting anti-vibration anti-friction anti-pinching portable elevators, twisting jaws, and uneven base may be: Capable of storing and hiding removable-hidable wrench 175 inside crank core 174 for a user to adjust adjustable-hidable angle-operated caster 166 at any time at any location (see FIG. 185-FIG. 195); and Capable of hiding and storing removable-hidable wrench 175 inside 2 production-increasing cost-saving identical-half-base-bottoms 156 to eliminate tripping and personal injuries (see FIG. 121, FIG. 122, and FIG. 304).

19) It is another further object of an embodiment to provide five-device-in-one arthritic-assisting anti-vibration anti-friction anti-pinching portable elevators, twisting jaws, and uneven base, having 6 angle-operated edge rollers 163. Therefore, the five-device-in-one arthritic-assisting anti-vibration anti-friction anti-pinching portable elevators, twisting jaws, and uneven base may be: Capable of tiltedly working together with adjustable-hidable angle-operated caster 166 when tilted by the tilting adjustment of adjustable-hidable angle-operated caster 166 to mutually elevate the 5-device-in-one base off the ground for moving in the directions of arrows 208-214 (see FIG. 131, FIG. 132, FIG. 163-FIG. 167); and Capable of adjustably staying off the ground for the 5-device-in-one base to sit in a fixed location in the directions of arrows 208-214 (see FIG. 131, FIG. 132, FIG. 163-FIG. 167).

20) It is still another further object of an embodiment to provide five-device-in-one arthritic-assisting anti-vibration anti-friction anti-pinching portable elevators, twisting jaws, and uneven base, having crank-storing extra-umbrella-pole-locking hole 152. Therefore, the five-device-in-one arthritic-assisting anti-vibration anti-friction anti-pinching portable elevators, twisting jaws, and uneven base: Capable of storing and hiding deployable-hidable crank-and-bolt-lock system 170 inside crank-storing extra-umbrella-pole-locking hole 152 for a user to adjust adjustable-hidable angle-operated caster 166 at any time at any location in the direction of arrow 206 (see FIG. 121-FIG. 124, FIG. 294); and Capable of hiding and storing deployable-hidable crank-and-bolt-lock system 170 inside 2 production-increasing cost-saving identical-half-base-bottoms 156 to eliminate tripping and personal injuries in the direction of arrow 206 (see FIG. 121-FIG. 124, FIG. 294).

One or more elements or aspects or steps, or any portion (s) thereof, from one or more of any of the systems and methods described herein may be combined with one or more elements or aspects or steps, or any portion(s) thereof, from one or more of any of the other systems and methods described herein and combinations thereof, to form one or more additional implementations and/or claims of the present disclosure.

One or more of the components, steps, features, and/or functions illustrated in the figures may be rearranged and/or combined into a single component, block, feature or function or embodied in several components, steps, or functions. Additional elements, components, steps, and/or functions may also be added without departing from the disclosure. The apparatus, devices, and/or components illustrated in the Figures may be configured to perform one or more of the methods, features, or steps described in the Figures. The algorithms described herein may also be efficiently implemented in software and/or embedded in hardware.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats.

Furthermore, as will be apparent to one of ordinary skill in the relevant art, the modules, routines, features, attributes, methodologies and other aspects of the present invention can be implemented as software, hardware, firmware or any combination of the three. Also, wherever a component, an example of which is a module, of the present invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming.

Additionally, the present invention is in no way limited to implementation in any specific programming language, or for any specific operating system or environment. Accordingly, the disclosure of the present invention is intended to be illustrative, but not limiting, of the scope of the present invention, which is set forth in the following claims.

It is understood that the specific order or hierarchy of blocks in the processes/flowcharts disclosed is an illustration of example approaches. Based upon design preferences, it is understood that the specific order or hierarchy of blocks in the processes/flowcharts may be rearranged. Further, some blocks may be combined or omitted. The accompanying method claims present elements of the various blocks in a sample order and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

The inventions and embodiments described herein are only examples. Each element of the inventions and embodiments described herein may be combined with any other element of the inventions and embodiments described herein unless otherwise indicated.

What is claimed is:

1. A combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, comprising:

an arthritic-assisting anti-vibration anti-friction portable handle-elevator having a lower section and an upper section;

a plurality of arthritic-assisting anti-vibration anti-friction handle-elevator-tracks molded to said arthritic-assisting anti-vibration anti-friction portable handle-elevator;

an arthritic-assisting anti-vibration anti-friction portable roller-elevator having an inner side and an opposite inner side, said arthritic-assisting anti-vibration anti-friction portable roller-elevator inserted into and secured within said arthritic-assisting anti-vibration anti-friction portable handle-elevator;

a plurality of roller openings formed into said inner side of said arthritic-assisting anti-vibration anti-friction portable roller-elevator;

a plurality of roller axles;

a plurality of arthritic-assisting anti-vibration anti-friction portable rollers respectively slid on said roller axles, said roller axles rotatably respectively snap-locked into said roller openings;

an arthritic-assisting raising angle-handle formed onto said lower section of arthritic-assisting anti-vibration anti-friction portable handle-elevator;

an arthritic-assisting lowering angle-handle formed onto said upper section of arthritic-assisting anti-vibration anti-friction portable handle-elevator;

a multi-elevator stabilizer attached to said opposite inner side of said arthritic-assisting anti-vibration anti-friction portable roller-elevator;

an arthritic-assisting multi-elevator-locking lock compressed onto said multi-elevator stabilizer;

an arthritic-assisting multi-elevator-locking hand-knob compressed onto said multi-elevator stabilizer;

a multi-elevator-locking screw inserted through said arthritic-assisting anti-vibration anti-friction portable handle-elevator, said arthritic-assisting anti-vibration anti-friction portable roller-elevator, and said multi-elevator stabilizer;

a multi-elevator-locking nut threadedly secured to said multi-elevator-locking screw;

a multi-function joint molded to said arthritic-assisting anti-vibration anti-friction portable handle-elevator;

a multi-function track pole slidably secured to said arthritic-assisting anti-vibration anti-friction portable roller-elevator;

a multi-function screw rivet secured to said multi-function joint;

first production-increasing anti-slipping anti-cracking opposite-twisting jaw having first upper bottom-edge, first lower bottom-edge, and a first back;

first upper-elevation twistable tube molded to said first upper bottom-edge of said first production-increasing anti-slipping anti-cracking opposite-twisting jaw;

first lower-elevation twistable tube molded to said first lower bottom-edge of said first production-increasing anti-slipping anti-cracking opposite-twisting jaw;

second production-increasing anti-slipping anti-cracking opposite-twisting jaw having second upper bottom-edge, second lower bottom-edge, and a second back;

second upper-elevation twistable tube molded to said second upper bottom-edge of said second production-increasing anti-slipping anti-cracking opposite-twisting jaw;

second lower-elevation twistable tube molded to said second lower bottom-edge of said second production-increasing anti-slipping anti-cracking opposite-twisting jaw;

first reinforcing twistable ribs respectively molded to said first back of said first production-increasing anti-slipping anti-cracking opposite-twisting jaw;

second reinforcing twistable ribs respectively molded to said second back of said second production-increasing anti-slipping anti-cracking opposite-twisting jaw;

two first twist-spreading-spring housings respectively formed in said first and said second production-increasing anti-slipping anti-cracking opposite-twisting jaws;

two second twist-spreading-spring housings respectively formed in said first and said second production-increasing anti-slipping anti-cracking opposite-twisting jaws;

first twist-spreading spring fitted in said two first twist-spreading-spring housings;

second twist-spreading spring fitted in said two second twist-spreading-spring housings;

first anti-slipping twist-clamping threads respectively formed in said first production-increasing anti-slipping anti-cracking opposite-twisting jaw;

second anti-slipping twist-clamping threads respectively formed in said second production-increasing anti-slipping anti-cracking opposite-twisting jaw;

an opposite-twisting-jaw-housing tunnel slid on and around said first and said second production-increasing anti-slipping anti-cracking opposite-twisting jaws;

two opposite-twisting-jaw-securing holes respectively drilled into said opposite-twisting-jaw-housing tunnel;

first multi-elevation-twisting-tube screw screwed through one of said two opposite-twisting-jaw-securing holes, said first upper-elevation twistable tube, and said second lower-elevation twistable tube to secure;

second multi-elevation-twisting-tube screw screwed through another one of said two opposite-twisting-jaw-securing holes, said first lower-elevation twistable tube, and said second upper-elevation twistable tube to secure;

a hand-knob hole formed through said opposite-twisting-jaw-housing tunnel and through said first and said second production-increasing anti-slipping anti-cracking opposite-twisting jaws;

an arthritic-assisting twist-clamping-jaw hand-knob inserted through said hand-knob hole;

a hand-knob nut threadedly attached to said arthritic-assisting twist-clamping-jaw hand-knob;

a threaded connector core threadedly connected to and between said first and said second anti-slipping twist-clamping threads such that said threaded connector core can be twistingly unclamped and clamped by said first and said second production-increasing anti-slipping anti-cracking opposite-twisting jaws;

a pivoting connector pivotably attached to said multi-function screw rivet and said threaded connector core;

two production-increasing cost-saving identical-half-base-bottoms having two edges, two other edges, an underside, two opposite angled edges, and a plurality of central crannies;

a plurality of separation-preventing double-opposite-ridge-interlocks respectively molded to and along said edges of said two production-increasing cost-saving identical-half-base-bottoms;

a plurality of separation-preventing double-opposite-interpockets respectively molded to and along said other edges of said two production-increasing cost-saving identical-half-base-bottoms such that said separation-preventing double-opposite-ridge-interlocks are slidably and interlockingly inserted into said separation-preventing double-opposite-interpockets to interlock;

respectively formed inside said two production-increasing cost-saving identical-half-base-bottoms;

a plurality of brace slots respectively formed on said underside of said two production-increasing cost-saving identical-half-base-bottoms;

a plurality of base-supporting braces respectively inserted into said brace slots and screwed to said two production-increasing cost-saving identical-half-base-bottoms;

a plurality of roller slots respectively formed on and along said two opposite angled edges of said two production-increasing cost-saving identical-half-base-bottoms;

a plurality of angle-operated edge rollers respectively snap-locked in said roller slots;

a caster chamber formed in and between said two production-increasing cost-saving identical-half-base-bottoms;

a caster mount screwed to said caster chamber;

a caster leg secured to said caster mount;

a caster-leg-wrenching recess formed into said caster leg;

an adjustable-hidable angle-operated caster secured to said caster leg;

a crank chamber formed in and between said two production-increasing cost-saving identical-half-base-bottoms, and on said underside of said two production-increasing cost-saving identical-half-base-bottoms;

a crank core having two opposite ends and a groove;

two deployable-retractable crank-handle-and-bolt-locks respectively slidably secured to said two opposite ends of said crank core;

two sleeve covers respectively slid onto said two deployable-retractable crank-handle-and-bolt-locks;

a removable-hidable wrench removably concealed within said groove on crank core;

two production-increasing cost-saving identical-half-base-tops having a plurality of taps, said taps respectively snap-inserted into said central crannies of said two production-increasing cost-saving identical-half-base-bottoms;

a plurality of pole-mounting-hole stems respectively molded inside said two production-increasing cost-saving identical-half-base-bottoms, said multi-function track pole and said two production-increasing cost-saving identical-half-base-tops screwed to said pole-mounting-hole stems to be secured to said two production-increasing cost-saving identical-half-base-bottoms;

a crank-storing extra-umbrella-pole-locking hole formed in and between said two production-increasing cost-saving identical-half-base-tops and engaged with said crank chamber;

a caster-leg hole formed in and between said two production-increasing cost-saving identical-half-base-tops and engaged with said caster chamber; and a crank-storing-hole plug twist-locked inside said caster-leg hole.

2. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said arthritic-assisting anti-vibration anti-friction portable handle-elevator is made of the material of metal or plastic.

3. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said arthritic-assisting anti-vibration anti-friction portable roller-elevator is made of the material of metal or plastic.

4. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said arthritic-assisting anti-vibration anti-friction handle-elevator-tracks are each made of the material of metal or plastic.

5. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: further comprising a cord-cranking mechanism attached to said opposite-twisting-jaw-housing tunnel such that said cord-cranking mechanism can ratchetedly wind and unwind a cord inside said opposite-twisting-jaw-housing tunnel.

6. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said first upper-elevation and said first lower-elevation twistable tubes and said second upper-elevation and said second lower-elevation twistable tubes are each made of the material of metal or plastic.

7. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said interlocking separation-preventing double-opposite-ridge-interlocks may each be made of the material of metal or plastic.

8. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said two deployable-retractable crank-handle-and-bolt-locks are each made of the material of metal or plastic.

9. The combination of five-device-in-one arthritic-assisting anti-vibration anti-friction anti-pinching portable elevators, twisting jaws, and uneven base, for being adapted to umbrella post, hand rail, sail pole, awning arm, and pergola column, and for being capable of functioning as uneven-step supporter, uneven-surface supporter, patio bolt-locker, platform stabilizer, and weight base, of claim 1: wherein said separation-preventing double-opposite-interpockets are each made of the material of rubber, metal, or plastic.

10. A combination of five-device-in-one arthritic-assisting anti-vibration anti-friction anti-pinching portable elevators, twisting jaws, and uneven base, comprising:

an arthritic-assisting anti-vibration anti-friction portable handle-elevator having a lower section and an upper section;

a plurality of arthritic-assisting anti-vibration anti-friction handle-elevator-tracks molded to said arthritic-assisting anti-vibration anti-friction portable handle-elevator;

an arthritic-assisting anti-vibration anti-friction portable roller-elevator having an inner side and an opposite inner side, said arthritic-assisting anti-vibration anti-friction portable roller-elevator inserted into and secured within said arthritic-assisting anti-vibration anti-friction portable handle-elevator;

a plurality of roller openings formed into said inner side of said arthritic-assisting anti-vibration anti-friction portable roller-elevator;

a plurality of roller axles;

a plurality of arthritic-assisting anti-vibration anti-friction portable rollers respectively slid on said roller axles, said roller axles rotatably respectively snap-locked into said roller openings;

an arthritic-assisting raising angle-handle formed onto said lower section of arthritic-assisting anti-vibration anti-friction portable handle-elevator;

an arthritic-assisting lowering angle-handle formed onto said upper section of arthritic-assisting anti-vibration anti-friction portable handle-elevator;

a multi-elevator stabilizer attached to said opposite inner side of said arthritic-assisting anti-vibration anti-friction portable roller-elevator;

an arthritic-assisting multi-elevator-locking lock compressed onto said multi-elevator stabilizer;

an arthritic-assisting multi-elevator-locking hand-knob compressed onto said multi-elevator stabilizer;

a multi-elevator-locking screw inserted through said arthritic-assisting anti-vibration anti-friction portable handle-elevator, said arthritic-assisting anti-vibration anti-friction portable roller-elevator, and said multi-elevator stabilizer;

a multi-elevator-locking nut threadedly secured to said multi-elevator-locking screw;

a multi-function joint molded to said arthritic-assisting anti-vibration anti-friction portable handle-elevator;

a multi-function track pole slidably secured to said arthritic-assisting anti-vibration anti-friction portable roller-elevator;

a multi-function screw rivet secured to said multi-function joint;

first production-increasing anti-slipping anti-cracking opposite-twisting jaw having first upper bottom-edge, first lower bottom-edge, and a first back;

first upper-elevation twistable tube molded to said first upper bottom-edge of said first production-increasing anti-slipping anti-cracking opposite-twisting jaw;

first lower-elevation twistable tube molded to said first lower bottom-edge of said first production-increasing anti-slipping anti-cracking opposite-twisting jaw;

second production-increasing anti-slipping anti-cracking opposite-twisting jaw having second upper bottom-edge, second lower bottom-edge, and a second back;

second upper-elevation twistable tube molded to said second upper bottom-edge of said second production-increasing anti-slipping anti-cracking opposite-twisting jaw;

second lower-elevation twistable tube molded to said second lower bottom-edge of said second production-increasing anti-slipping anti-cracking opposite-twisting jaw;

two first twist-spreading-spring housings respectively formed in said first and said second production-increasing anti-slipping anti-cracking opposite-twisting jaws;

two second twist-spreading-spring housings respectively formed in said first and said second production-increasing anti-slipping anti-cracking opposite-twisting jaws;

first twist-spreading spring fitted in said two first twist-spreading-spring housings;

second twist-spreading spring fitted in said two second twist-spreading-spring housings;

first anti-slipping twist-clamping threads respectively formed in said first production-increasing anti-slipping anti-cracking opposite-twisting jaw;

second anti-slipping twist-clamping threads respectively formed in said second production-increasing anti-slipping anti-cracking opposite-twisting jaw;

an opposite-twisting-jaw-housing tunnel slid on and around said first and said second production-increasing anti-slipping anti-cracking opposite-twisting jaws;

two opposite-twisting-jaw-securing holes respectively drilled into said opposite-twisting-jaw-housing tunnel;

first multi-elevation-twisting-tube screw screwed through one of said two opposite-twisting-jaw-securing holes, said first upper-elevation twistable tube, and said second lower-elevation twistable tube to secure;

second multi-elevation-twisting-tube screw screwed through another one of said two opposite-twisting-jaw-securing holes, said first lower-elevation twistable tube, and said second upper-elevation twistable tube to secure;

a hand-knob hole formed through said opposite-twisting-jaw-housing tunnel and through said first and said second production-increasing anti-slipping anti-cracking opposite-twisting jaws;

an arthritic-assisting twist-clamping-jaw hand-knob inserted through said hand-knob hole;

a hand-knob nut threadedly attached to said arthritic-assisting twist-clamping-jaw hand-knob;

a threaded connector core threadedly connected to and between said first and said second anti-slipping twist-clamping threads such that said threaded connector core can be twistingly unclamped and clamped by said first and said second production-increasing anti-slipping anti-cracking opposite-twisting jaws:

a pivoting connector pivotably attached to said multi-function screw rivet and said threaded connector core;

two production-increasing cost-saving identical-half-base-bottoms having two edges, two other edges, an underside, two opposite angled edges, and a plurality of central crannies;

a plurality of separation-preventing double-opposite-ridge-interlocks respectively molded to and along said edges of said two production-increasing cost-saving identical-half-base-bottoms;

a plurality of separation-preventing double-opposite-interpockets respectively molded to and along said other edges of said two production-increasing cost-saving identical-half-base-bottoms such that said separation-preventing double-opposite-ridge-interlocks are slidably and interlockingly inserted into said separation-preventing double-opposite-interpockets to interlock;

a plurality of weight compartments respectively formed inside said two production-increasing cost-saving identical-half-base-bottoms;

a plurality of brace slots respectively formed on said underside of said two production-increasing cost-saving identical-half-base-bottoms;

a plurality of base-supporting braces respectively inserted into said brace slots and screwed to said two production-increasing cost-saving identical-half-base-bottoms;

a plurality of roller slots respectively formed on and along said two opposite angled edges of said two production-increasing cost-saving identical-half-base-bottoms;

a plurality of angle-operated edge rollers respectively snap-locked in said roller slots;

a caster chamber formed in and between said two production-increasing cost-saving identical-half-base-bottoms;

a caster mount screwed to said caster chamber;

a caster leg secured to said caster mount;

a caster-leg-wrenching recess formed into said caster leg;

an adjustable-hidable angle-operated caster secured to said caster leg;

a crank chamber formed in and between said two production-increasing cost-saving identical-half-base-bottoms, and on said underside of said two production-increasing cost-saving identical-half-base-bottoms;

a crank core having two opposite ends and a groove;

two deployable-retractable crank-handle-and-bolt-locks respectively slidably secured to said two opposite ends of said crank core;

two sleeve covers respectively slid onto said two deployable-retractable crank-handle-and-bolt-locks;

a removable-hidable wrench removably concealed within said groove on crank core;

two production-increasing cost-saving identical-half-base-tops having a plurality of taps, said taps respectively snap-inserted into said central crannies of said two production-increasing cost-saving identical-half-base-bottoms;

a plurality of pole-mounting-hole stems respectively molded inside said two production-increasing cost-saving identical-half-base-bottoms, said multi-function track pole and said two production-increasing cost-saving identical-half-base-tops screwed to said pole-mounting-hole stems to be secured to said two production-increasing cost-saving identical-half-base-bottoms;

a crank-storing extra-umbrella-pole-locking hole formed in and between said two production-increasing cost-saving identical-half-base-tops and engaged with said crank chamber;

a caster-leg hole formed in and between said two production-increasing cost-saving identical-half-base-tops and engaged with said caster chamber; and a crank-storing-hole plug twist-locked inside said caster-leg hole.

11. The combination of five-device-in-one arthritic-assisting anti-vibration anti-friction anti-pinching portable elevators, twisting jaws, and uneven base of claim 10: wherein said arthritic-assisting anti-vibration anti-friction portable handle-elevator is made of the material of metal or plastic.

12. The combination of five-device-in-one arthritic-assisting anti-vibration anti-friction anti-pinching portable elevators, twisting jaws, and uneven base of claim 10: wherein said arthritic-assisting anti-vibration anti-friction portable roller-elevator is made of the material of metal or plastic.

13. The combination of five-device-in-one arthritic-assisting anti-vibration anti-friction anti-pinching portable elevators, twisting jaws, and uneven base of claim 10: wherein said arthritic-assisting anti-vibration anti-friction handle-elevator-tracks are each made of the material of metal or plastic.

14. The combination of five-device-in-one arthritic-assisting anti-vibration anti-friction anti-pinching portable elevators, twisting jaws, and uneven base of claim 10: wherein said arthritic-assisting anti-vibration anti-friction portable rollers are each made of the material of rubber, metal, or plastic.

15. The combination of five-device-in-one arthritic-assisting anti-vibration anti-friction anti-pinching portable elevators, twisting jaws, and uneven base of claim 10: wherein said arthritic-assisting raising angle-handle is made of the material of metal or plastic.

16. The combination of five-device-in-one arthritic-assisting anti-vibration anti-friction anti-pinching portable elevators, twisting jaws, and uneven base of claim 10:

wherein said arthritic-assisting lowering angle-handle is made of the material of metal or plastic.

17. The combination of five-device-in-one arthritic-assisting anti-vibration anti-friction anti-pinching portable elevators, twisting jaws, and uneven base of claim 10:

wherein said multi-elevator stabilizer is made of the material of metal or plastic.

18. The combination of five-device-in-one arthritic-assisting anti-vibration anti-friction anti-pinching portable elevators, twisting jaws, and uneven base of claim 10:

wherein said multi-function joint is made of the material of metal or plastic.

19. A combination of five-device-in-one arthritic-assisting portable elevators, twisting jaws, and uneven base comprising:

an arthritic-assisting anti-vibration anti-friction portable handle-elevator having a lower section and an upper section;

a plurality of arthritic-assisting anti-vibration anti-friction handle-elevator-tracks molded to said arthritic-assisting anti-vibration anti-friction portable handle-elevator;

an arthritic-assisting anti-vibration anti-friction portable roller-elevator having an inner side and an opposite inner side, said arthritic-assisting anti-vibration anti-friction portable roller-elevator inserted into and secured within said arthritic-assisting anti-vibration anti-friction portable handle-elevator;

a plurality of roller openings formed into said inner side of said arthritic-assisting anti-vibration anti-friction portable roller-elevator;

a plurality of roller axles;

a plurality of arthritic-assisting anti-vibration anti-friction portable rollers respectively slid on said roller axles, said roller axles rotatably respectively snap-locked into said roller openings;

an arthritic-assisting raising angle-handle formed onto said lower section of arthritic-assisting anti-vibration anti-friction portable handle-elevator;

an arthritic-assisting lowering angle-handle formed onto said upper section of arthritic-assisting anti-vibration anti-friction portable handle-elevator;

a multi-elevator stabilizer attached to said opposite inner side of said arthritic-assisting anti-vibration anti-friction portable roller-elevator;

an arthritic-assisting multi-elevator-locking lock compressed onto said multi-elevator stabilizer;

an arthritic-assisting multi-elevator-locking hand-knob compressed onto said multi-elevator stabilizer;

a multi-elevator-locking screw inserted through said arthritic-assisting anti-vibration anti-friction portable handle-elevator, said arthritic-assisting anti-vibration anti-friction portable roller-elevator, and said multi-elevator stabilizer;

a multi-elevator-locking nut threadedly secured to said multi-elevator-locking screw;

a multi-function joint molded to said arthritic-assisting anti-vibration anti-friction portable handle-elevator;

a multi-function track pole slidably secured to said arthritic-assisting anti-vibration anti-friction portable roller-elevator;

a multi-function screw rivet secured to said multi-function joint;

first production-increasing anti-slipping anti-cracking opposite-twisting jaw having first upper bottom-edge, first lower bottom-edge, and a first back;

first upper-elevation twistable tube molded to said first upper bottom-edge of said first production-increasing anti-slipping anti-cracking opposite-twisting jaw;

first lower-elevation twistable tube molded to said first lower bottom-edge of said first production-increasing anti-slipping anti-cracking opposite-twisting jaw;

second production-increasing anti-slipping anti-cracking opposite-twisting jaw having second upper bottom-edge, second lower bottom-edge, and a second back;

second upper-elevation twistable tube molded to said second upper bottom-edge of said second production-increasing anti-slipping anti-cracking opposite-twisting jaw;

second lower-elevation twistable tube molded to said second lower bottom-edge of said second production-increasing anti-slipping anti-cracking opposite-twisting jaw;

two first twist-spreading-spring housings respectively formed in said first and said second production-increasing anti-slipping anti-cracking opposite-twisting jaws;

two second twist-spreading-spring housings respectively formed in said first and said second production-increasing anti-slipping anti-cracking opposite-twisting jaws;

first twist-spreading spring fitted in said two first twist-spreading-spring housings;

second twist-spreading spring fitted in said two second twist-spreading-spring housings;

first anti-slipping twist-clamping threads respectively formed in said first production-increasing anti-slipping anti-cracking opposite-twisting jaw;

second anti-slipping twist-clamping threads respectively formed in said second production-increasing anti-slipping anti-cracking opposite-twisting jaw;

an opposite-twisting-jaw-housing tunnel slid on and around said first and said second production-increasing anti-slipping anti-cracking opposite-twisting jaws;

two opposite-twisting-jaw-securing holes respectively drilled into said opposite-twisting-jaw-housing tunnel;

first multi-elevation-twisting-tube screw screwed through one of said two opposite-twisting-jaw-securing holes, said first upper-elevation twistable tube, and said second lower-elevation twistable tube to secure;

second multi-elevation-twisting-tube screw screwed through another one of said two opposite-twisting-jaw-securing holes, said first lower-elevation twistable tube, and said second upper-elevation twistable tube to secure;

a hand-knob hole formed through said opposite-twisting-jaw-housing tunnel and through said first and said second production-increasing anti-slipping anti-cracking opposite-twisting jaws;

an arthritic-assisting twist-clamping-jaw hand-knob inserted through said hand-knob hole;

a hand-knob nut threadedly attached to said arthritic-assisting twist-clamping-jaw hand-knob;

a threaded connector core threadedly connected to and between said first and said second anti-slipping twist-clamping threads such that said threaded connector core can be twistingly unclamped and clamped by said first and said second production-increasing anti-slipping anti-cracking opposite-twisting jaws;

a pivoting connector pivotably attached to said multi-function screw rivet and said threaded connector core;

two production-increasing cost-saving identical-half-base-bottoms having two edges, two other edges, an underside, two opposite angled edges, and a plurality of central crannies;

a plurality of separation-preventing double-opposite-ridge-interlocks respectively molded to and along said edges of said two production-increasing cost-saving identical-half-base-bottoms;

a plurality of separation-preventing double-opposite-interpockets respectively molded to and along said other edges of said two production-increasing cost-saving identical-half-base-bottoms such that said separation-preventing double-opposite-ridge-interlocks are slidably and interlockingly inserted into said separation-preventing double-opposite-interpockets to interlock;

a plurality of weight compartments respectively formed inside said two production-increasing cost-saving identical-half-base-bottoms;

a plurality of brace slots respectively formed on said underside of said two production-increasing cost-saving identical-half-base-bottoms;

a plurality of base-supporting braces respectively inserted into said brace slots and screwed to said two production-increasing cost-saving identical-half-base-bottoms;

a plurality of roller slots respectively formed on and along said two opposite angled edges of said two production-increasing cost-saving identical-half-base-bottoms;

a plurality of angle-operated edge rollers respectively snap-locked in said roller slots;

a caster chamber formed in and between said two production-increasing cost-saving identical-half-base-bottoms;

a caster mount screwed to said caster chamber;

a caster leg secured to said caster mount;

a caster-leg-wrenching recess formed into said caster leg;

an adjustable-hidable angle-operated caster secured to said caster leg;

a crank chamber formed in and between said two production-increasing cost-saving identical-half-base-bottoms, and on said underside of said two production-increasing cost-saving identical-half-base-bottoms;

two production-increasing cost-saving identical-half-base-tops having a plurality of taps, said taps respectively snap-inserted into said central crannies of said two production-increasing cost-saving identical-half-base-bottoms;

a plurality of pole-mounting-hole stems respectively molded inside said two production-increasing cost-saving identical-half-base-bottoms, said multi-function track pole and said two production-increasing cost-saving identical-half-base-tops screwed to said pole-mounting-hole stems to be secured to said two production-increasing cost-saving identical-half-base-bottoms;

a crank-storing extra-umbrella-pole-locking hole formed in and between said two production-increasing cost-saving identical-half-base-tops and engaged with said crank chamber;

a caster-leg hole formed in and between said two production-increasing cost-saving identical-half-base-tops and engaged with said caster chamber; and a crank-storing-hole plug twist-locked inside said caster-leg hole.

20. The combination of five-device-in-one arthritic-assisting portable elevators, twisting jaws, and uneven base of claim 19, wherein said multi-elevator stabilizer is made of the material of metal or plastic.

* * * * *